US012607185B2

(12) United States Patent
Foster et al.

(10) Patent No.: US 12,607,185 B2
(45) Date of Patent: Apr. 21, 2026

(54) FLUID END WITH THREADED DYNAMIC SECTION

(71) Applicant: Kerr Machine Co., Sulphur, OK (US)

(72) Inventors: Kelcy Jake Foster, Sulphur, OK (US); Christopher Todd Barnett, Stratford, OK (US); John Keith, Ardmore, OK (US); Nicholas Son, Davis, OK (US)

(73) Assignee: Kerr Machine Co., Sulphur, OK (US)

( * ) Notice: Subject to any disclaimer, the term of this patent is extended or adjusted under 35 U.S.C. 154(b) by 0 days.

(21) Appl. No.: 19/291,201

(22) Filed: Aug. 5, 2025

(65) Prior Publication Data

US 2025/0354547 A1 Nov. 20, 2025

Related U.S. Application Data

(63) Continuation-in-part of application No. 19/073,550, filed on Mar. 7, 2025.

(Continued)

(51) Int. Cl.

| | |
|---|---|
| ***F04B 53/10*** | (2006.01) |
| ***E21B 43/26*** | (2006.01) |
| ***F04B 7/00*** | (2006.01) |

(52) U.S. Cl.

CPC ..... *F04B 53/1087* (2013.01); *E21B 43/2607* (2020.05); *F04B 7/0088* (2013.01)

(58) Field of Classification Search

CPC ..... F04B 53/22; F04B 15/02; F04B 53/1027; F04B 53/16; F04B 1/0404; F04B 1/0421; F04B 1/0461; F04B 1/0538; F04B 15/04; F04B 19/22; F04B 37/12; F04B 39/14; F04B 47/00; F04B 53/02; F04B 53/1022; F04B 53/103; F04B 53/1032; F04B 53/1087; F04B 53/127; F04B 53/14; F04B 53/147; F04B 53/164; F04B 53/166; F04B 53/168; F04B 53/18; F16K 1/42; F16K 1/36; F16K 25/005; F16K 1/46;

(Continued)

(56) References Cited

U.S. PATENT DOCUMENTS

| | | | |
|---|---|---|---|
| 677,137 | A | 6/1901 | Leavitt |
| 2,771,846 | A | 11/1956 | Horton et al. |

(Continued)

FOREIGN PATENT DOCUMENTS

| | | | |
|---|---|---|---|
| CN | 105756880 | A | 7/2016 |
| CN | 108843531 | A | 11/2018 |

(Continued)

*Primary Examiner* — Anthony Ayala Delgado

(74) *Attorney, Agent, or Firm* — Tomlinson McKinstry, P.C.

(57) ABSTRACT

A high-pressure hydraulic fracturing pump. The pump is in-line in orientation, with a static section having a high-pressure discharge chamber and a dynamic section having a dynamic internal bore threaded to the static section. A fluid routing plug is disposed within a bore which includes the dynamic internal bore. The pump is designed for ease of access and for reducing wear. Large, external threads on the dynamic section pair with internal threads on the static section to reduce wear associated with repeated pressurization of hydraulic fracturing fluid found within the pump. Seals and wear rings are found at a nose of the dynamic section to further prevent wear and damage.

23 Claims, 176 Drawing Sheets

Related U.S. Application Data

(60) Provisional application No. 63/757,010, filed on Feb. 11, 2025, provisional application No. 63/744,603, filed on Jan. 13, 2025, provisional application No. 63/734,842, filed on Dec. 17, 2024, provisional application No. 63/725,664, filed on Nov. 27, 2024, provisional application No. 63/686,423, filed on Aug. 23, 2024, provisional application No. 63/672,815, filed on Jul. 18, 2024, provisional application No. 63/654,317, filed on May 31, 2024, provisional application No. 63/653,393, filed on May 30, 2024, provisional application No. 63/647,138, filed on May 14, 2024, provisional application No. 63/641,192, filed on May 1, 2024, provisional application No. 63/566,527, filed on Mar. 18, 2024, provisional application No. 63/565,657, filed on Mar. 15, 2024, provisional application No. 63/562,774, filed on Mar. 8, 2024.

(58) Field of Classification Search
CPC ..... F16K 1/48; F16K 15/026; F16K 15/063; F16K 2200/30; F16K 2200/305; F16J 15/18; F16J 13/02; F16J 13/08; F16J 13/10; F16J 13/12; F16J 15/028; F16J 15/166; F16J 15/183; F16J 15/189; F16J 15/26; F16J 15/56
See application file for complete search history.

(56) References Cited

U.S. PATENT DOCUMENTS

| | | | |
|---|---|---|---|
| 2,828,696 | A | 4/1958 | Wright |
| 3,062,198 | A | 11/1962 | Richardson |
| 3,181,473 | A | 5/1965 | Duron |
| 3,309,013 | A | 3/1967 | Bauer |
| 3,370,545 | A | 2/1968 | Waibel |
| 3,508,849 | A | 4/1970 | Weber |
| 3,528,613 | A | 9/1970 | Berlyn |
| 3,531,052 | A | 9/1970 | Berlyn |
| 3,652,098 | A | 3/1972 | Kawazu |
| 3,702,624 | A | 11/1972 | Fries |
| 3,746,483 | A | 7/1973 | Hindel |
| 3,777,779 | A | 12/1973 | Scwaller |
| 4,078,574 | A | 3/1978 | Kosarzecki |
| 4,174,194 | A | 11/1979 | Hammelmann |
| 4,412,792 | A | 11/1983 | LaBorde |
| 4,551,077 | A | 11/1985 | Pacht |
| 4,616,983 | A | 10/1986 | Hanafi |
| 4,878,815 | A | 11/1989 | Stachowiak |
| 4,960,039 | A | 10/1990 | Robertson |
| 5,037,276 | A | 8/1991 | Tremoulet |
| 5,059,101 | A | 10/1991 | Valavaara |
| 5,064,354 | A | 11/1991 | Robertson |
| 5,127,807 | A | 7/1992 | Eslinger |
| 5,230,363 | A | 7/1993 | Winn |
| 5,253,987 | A | 10/1993 | Harrison |
| 5,302,087 | A | 4/1994 | Pacht |
| 5,331,736 | A | 7/1994 | Suggs |
| 5,382,057 | A | 1/1995 | Richter |
| 5,605,449 | A | 2/1997 | Reed |
| 5,636,975 | A | 6/1997 | Tiffany |
| 5,709,514 | A | 1/1998 | Suggs |
| 5,924,853 | A | 7/1999 | Pacht |
| 6,231,323 | B1 | 5/2001 | Jezek |
| 6,234,490 | B1 | 5/2001 | Champlin |
| 6,341,950 | B1 | 1/2002 | Schuller et al. |
| 7,296,591 | B2 | 11/2007 | Moe |
| 7,354,046 | B2 | 4/2008 | Ramsay |
| 8,047,820 | B2 | 11/2011 | Merrick |
| 8,240,634 | B2 | 8/2012 | Jarchau |
| 9,188,122 | B1 | 11/2015 | Reed |
| 9,328,745 | B2 | 5/2016 | Bartlok et al. |
| 9,371,919 | B2 | 6/2016 | Forrest et al. |
| 9,670,922 | B2 | 6/2017 | Pacht |
| 9,739,382 | B2 | 8/2017 | Laird et al. |
| 10,184,470 | B2 | 1/2019 | Barnett |
| D916,240 | S | 4/2021 | Nowell et al. |
| 11,808,254 | B2 * | 11/2023 | Thomas ..... F16K 15/063 |
| 11,859,601 | B2 | 1/2024 | Son et al. |
| 12,000,257 | B2 | 6/2024 | Foster et al. |
| 12,188,458 | B2 * | 1/2025 | Thomas ..... F04B 1/0452 |
| D1,061,623 | S * | 2/2025 | Newberg ..... D15/7 |
| 2008/0093361 | A1 | 4/2008 | Kennedy |
| 2011/0036408 | A1 | 2/2011 | Desai |
| 2012/0272764 | A1 | 11/2012 | Pendleton |
| 2013/0045123 | A1 | 2/2013 | Roman et al. |
| 2013/0263932 | A1 | 10/2013 | Baxter |
| 2014/0127062 | A1 | 5/2014 | Buckley et al. |
| 2014/0348677 | A1 | 11/2014 | Moeller |
| 2015/0071803 | A1 | 3/2015 | Huang |
| 2015/0132157 | A1 | 5/2015 | Whaley |
| 2015/0147194 | A1 | 5/2015 | Foote |
| 2016/0090980 | A1 | 3/2016 | Howard et al. |
| 2017/0204852 | A1 | 7/2017 | Barnett, Jr. |
| 2018/0306150 | A1 | 10/2018 | Stecklein et al. |
| 2018/0363642 | A1 | 12/2018 | Salih |
| 2019/0017503 | A1 | 1/2019 | Foster et al. |
| 2019/0032685 | A1 | 1/2019 | Foster et al. |
| 2019/0063427 | A1 | 2/2019 | Nowell et al. |
| 2019/0128104 | A1 | 5/2019 | Graham et al. |
| 2019/0242373 | A1 | 8/2019 | Wernig |
| 2019/0331245 | A1 * | 10/2019 | Gable ..... F04B 53/16 |
| 2019/0360483 | A1 | 11/2019 | Nowell et al. |
| 2020/0182240 | A1 | 6/2020 | Nowell et al. |
| 2020/0291928 | A1 | 9/2020 | Mullins |
| 2020/0347843 | A1 | 11/2020 | Mullins |
| 2021/0148349 | A1 | 5/2021 | Nowell et al. |
| 2022/0099073 | A1 * | 3/2022 | Thomas ..... F04B 53/1022 |
| 2022/0243724 | A1 | 8/2022 | Li |
| 2022/0260161 | A1 | 8/2022 | Nowell et al. |
| 2022/0282719 | A1 | 9/2022 | Barnhouse |
| 2022/0381234 | A1 * | 12/2022 | Son ..... F16K 1/42 |
| 2022/0397107 | A1 * | 12/2022 | Thomas ..... F04B 53/16 |
| 2022/0412346 | A1 | 12/2022 | Nowel et al. |
| 2025/0122866 | A1 | 4/2025 | Garrison |

FOREIGN PATENT DOCUMENTS

| | | | |
|---|---|---|---|
| CN | 109989912 | A | 7/2019 |
| CN | 111255677 | A | 6/2020 |

* cited by examiner

FLUID END WITH THREADED DYNAMIC SECTION

SUMMARY

The present invention is directed to a high-pressure pump. The high-pressure pump comprises a fluid end body. The fluid end body comprises a static section and a dynamic section. The static section comprises at least one internal flow bore having internally disposed threads. The dynamic section comprises a dynamic internal flow bore, the dynamic section having external threads disposed about an external surface of the dynamic section. The dynamic section is configured for threaded attachment to the static section such that the at least one internal flow bore and the dynamic internal flow bore are aligned.

BRIEF DESCRIPTION OF THE DRAWINGS

FIG. 118 is a cross-sectional view of the dynamic body shown in FIG. 117, taken along line AS-AS.

FIG. 120 is the back, top, left isometric view of the retainer shown in FIG. 119.

FIG. 121 is a top plan view of the retainer shown in FIG. 119.

FIG. 122 is a back elevation view of the retainer shown in FIG. 119.

FIG. 123 is a cross-sectional view of the retainer shown in FIG. 121, taken along line AT-AT.

FIG. 124 is a cross-sectional view of the retainer shown in FIG. 122, taken along line AU-AU.

FIG. 125 is an enlarged view of area AV shown in FIG. 123.

FIG. 126 is a back, top, left isometric view of another embodiment of a multi-piece fluid end.

FIG. 127 is a cross-sectional view of the multi-piece fluid end shown in FIG. 126, taken along line AW-AW.

FIG. 128 is an enlarged view of area AX shown in FIG. 127.

FIG. 129 is a cross-sectional view of the multi-piece fluid end shown in FIG. 126, taken along line AY-AY.

FIG. 130 is an enlarged view of area AZ shown in FIG. 129.

FIG. 131 is an exploded, back, top, left isometric view of the multi-piece fluid end shown in FIG. 126.

Figure 126:
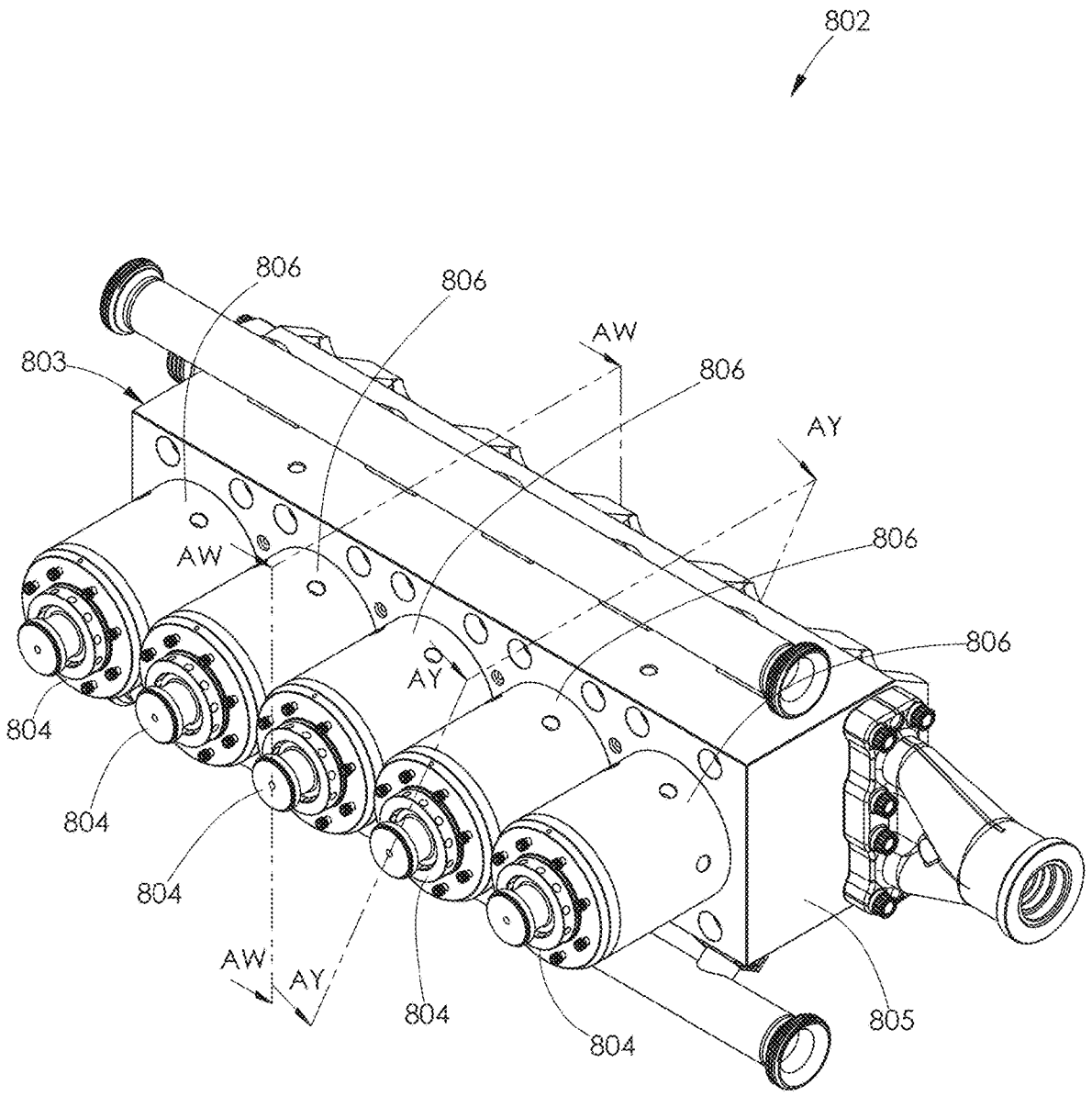
Figure 132:
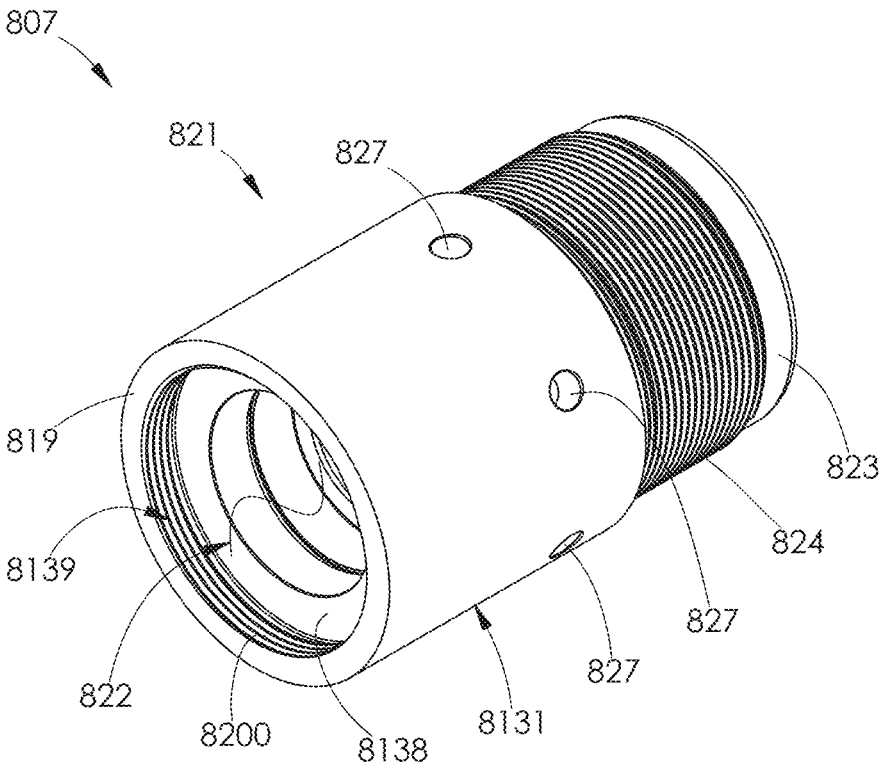

FIG. 132 is a back, top, left isometric view of a dynamic body used in the multi-piece fluid end shown in FIG. 126.

Figure 133:
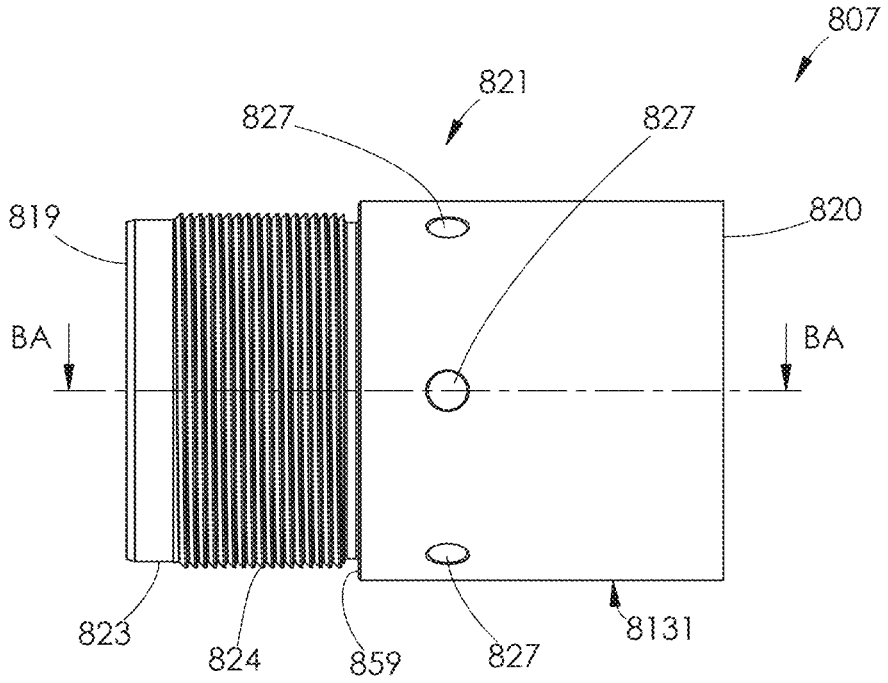

FIG. 133 is a top plan view of the dynamic body shown in FIG. 132.

Figure 134:
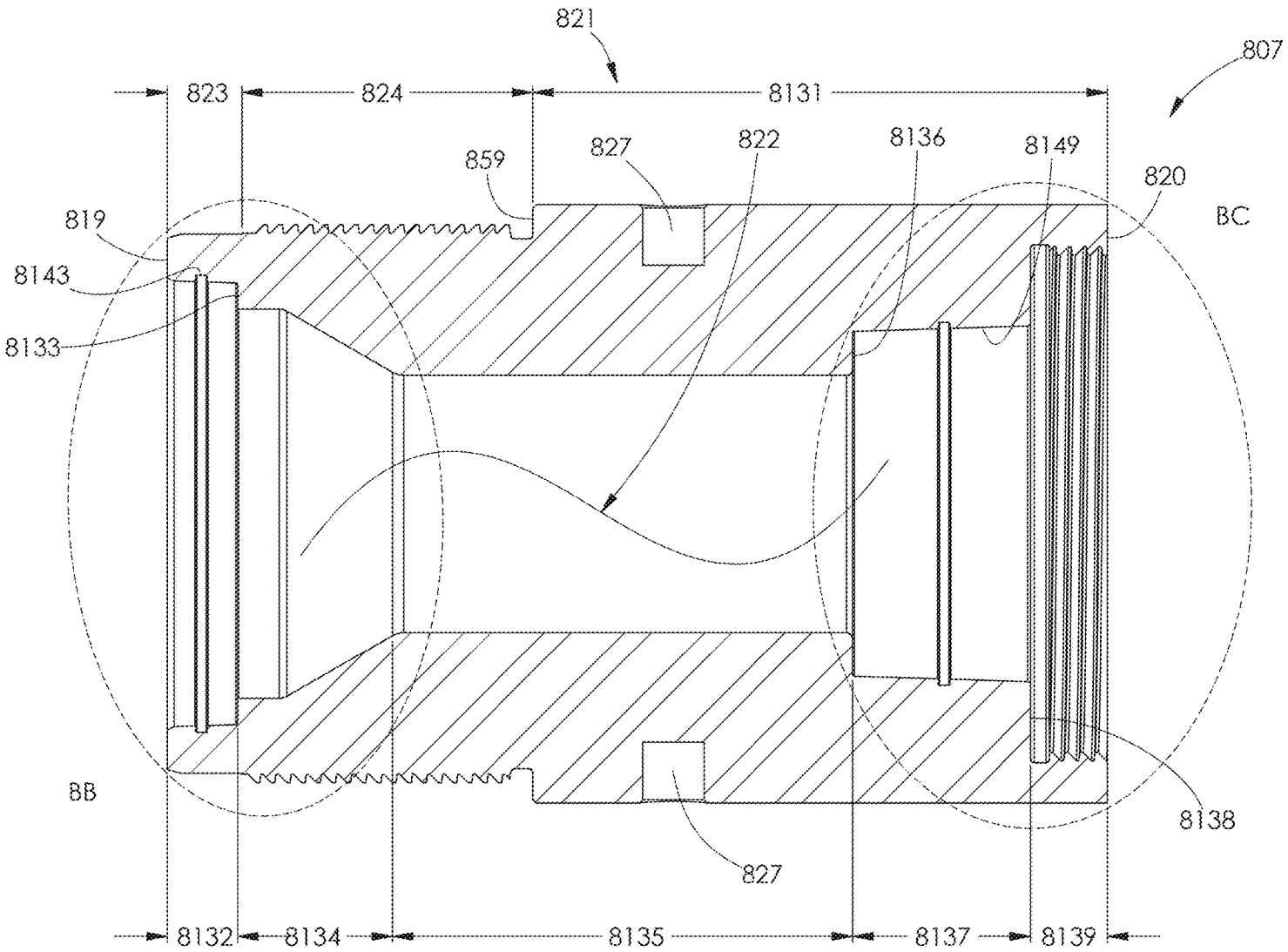

FIG. 134 is a cross-sectional view of the dynamic body shown in FIG. 133, taken along line BA-BA.

Figure 135:
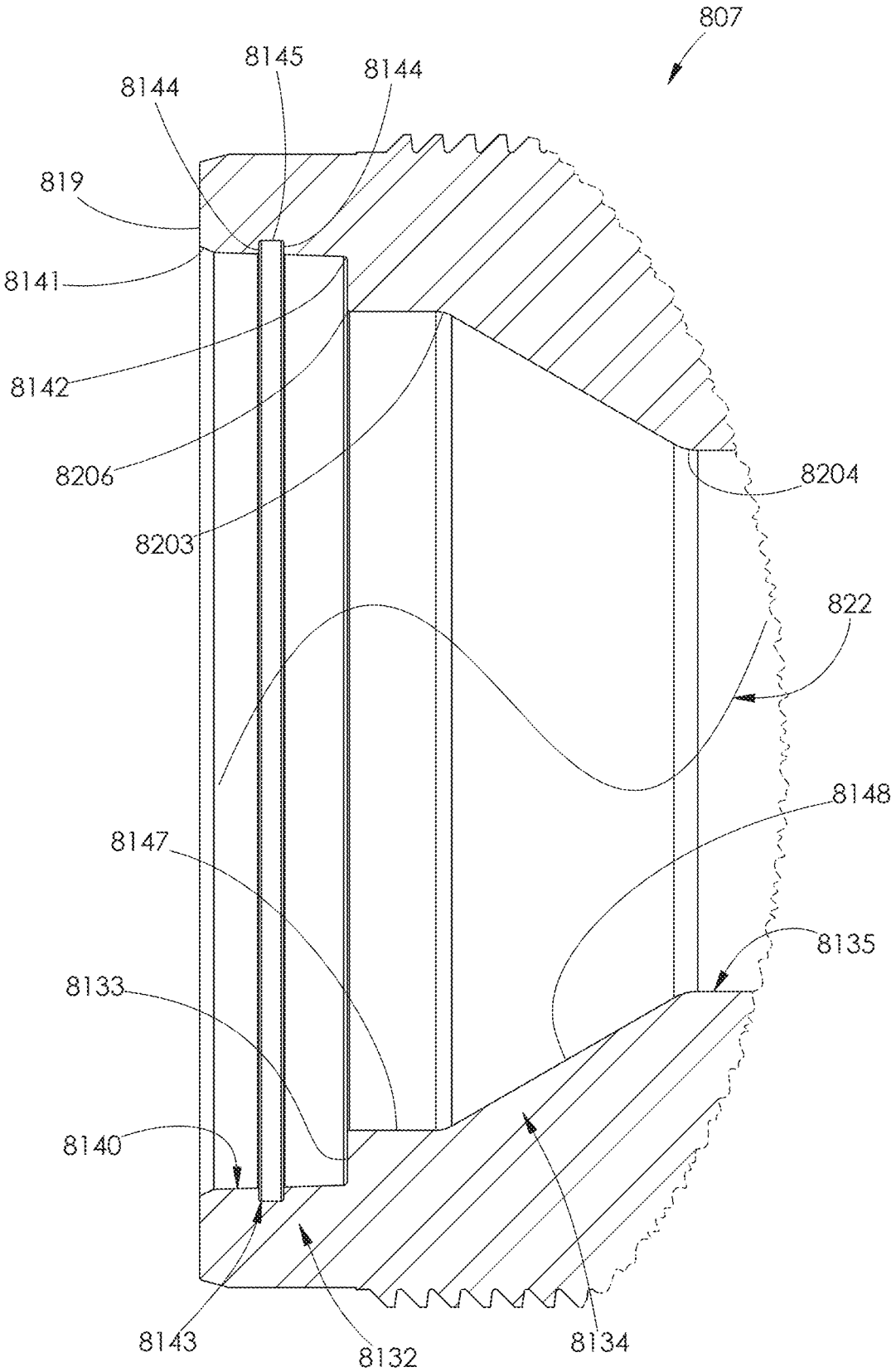

FIG. 135 is an enlarged view of area BB shown in FIG. 134.

Figure 136:
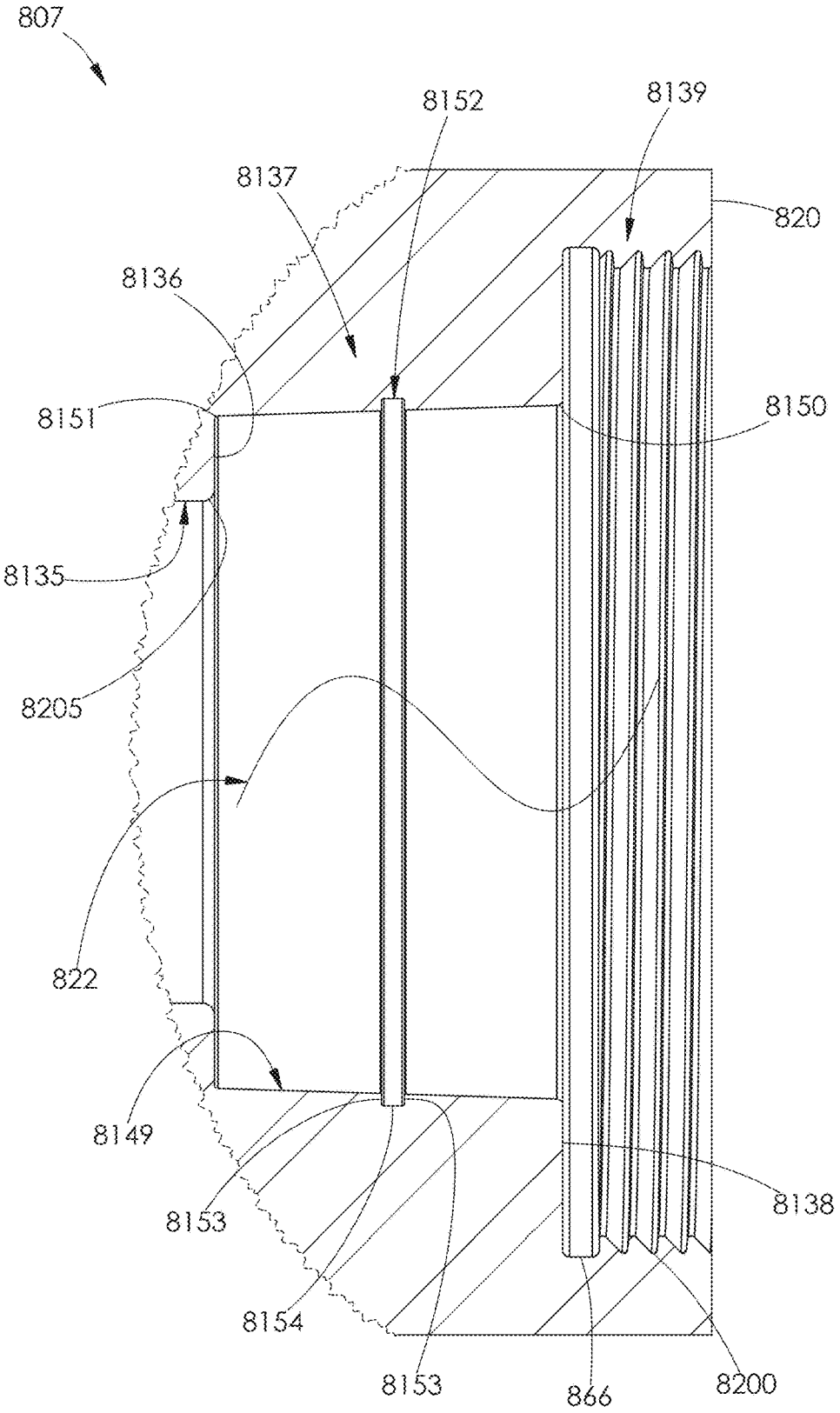

FIG. 136 is an enlarged view of area BC shown in FIG. 134.

Figure 137:
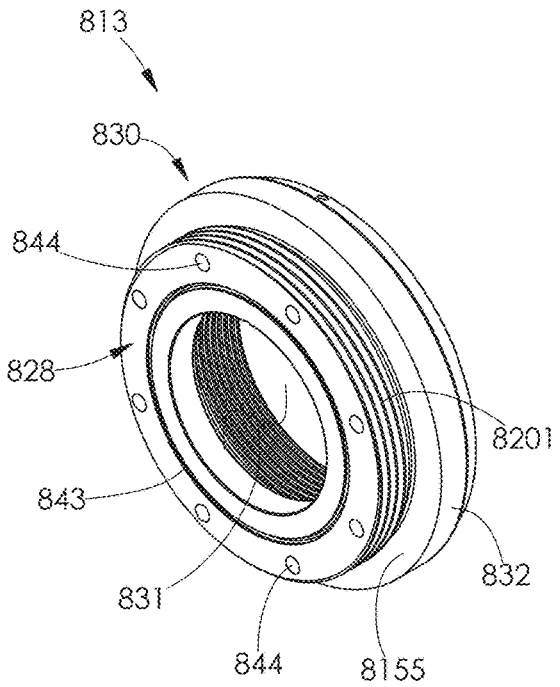

FIG. 137 is an isometric view of a retainer used in the multi-piece fluid end shown in FIG. 126.

Figure 138:
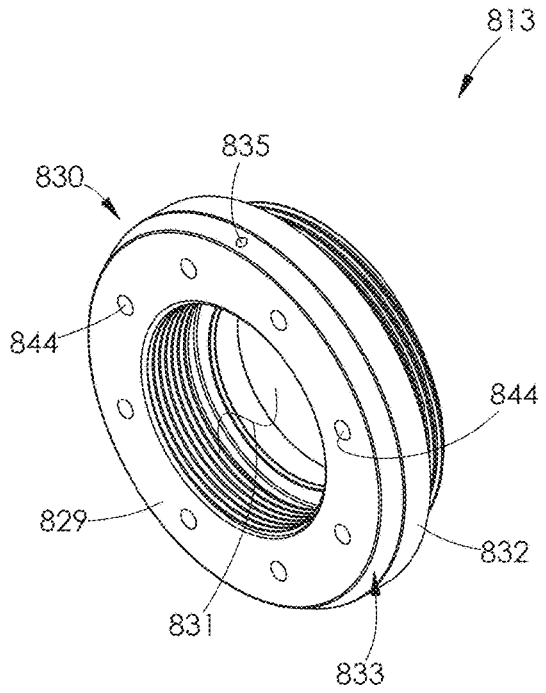

FIG. 138 is a back, top, left isometric view of the retainer shown in FIG. 137.

Figure 139:
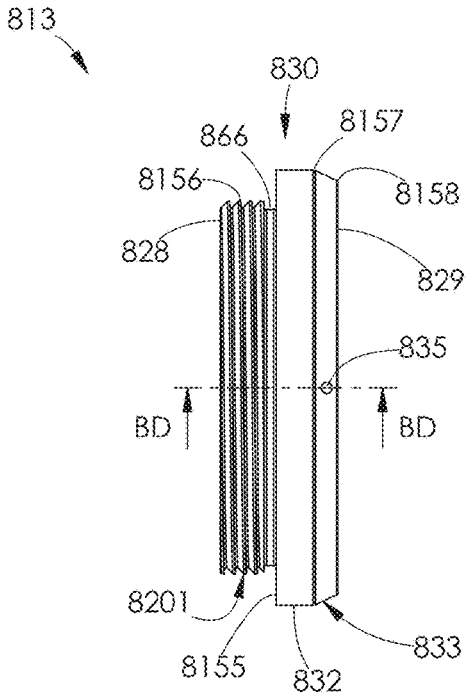

FIG. 139 is a top plan view of the retainer shown in FIG. 137.

Figure 140:
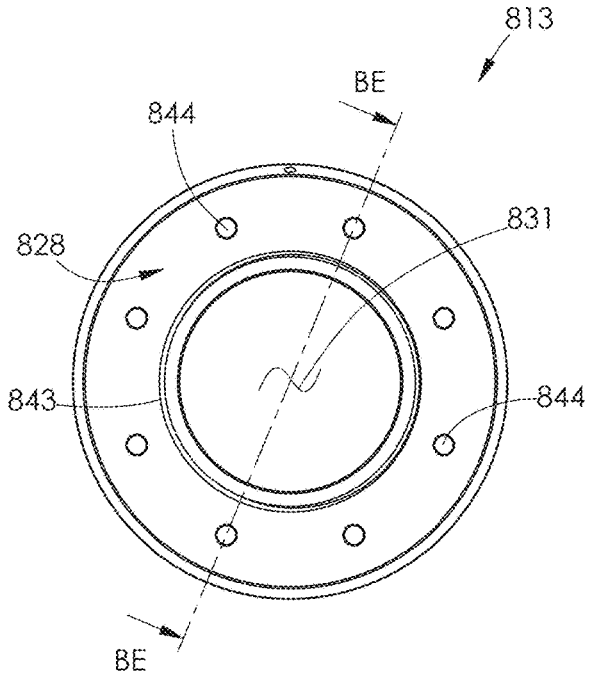

FIG. 140 is a back elevation view of the retainer shown in FIG. 137.

Figure 141:
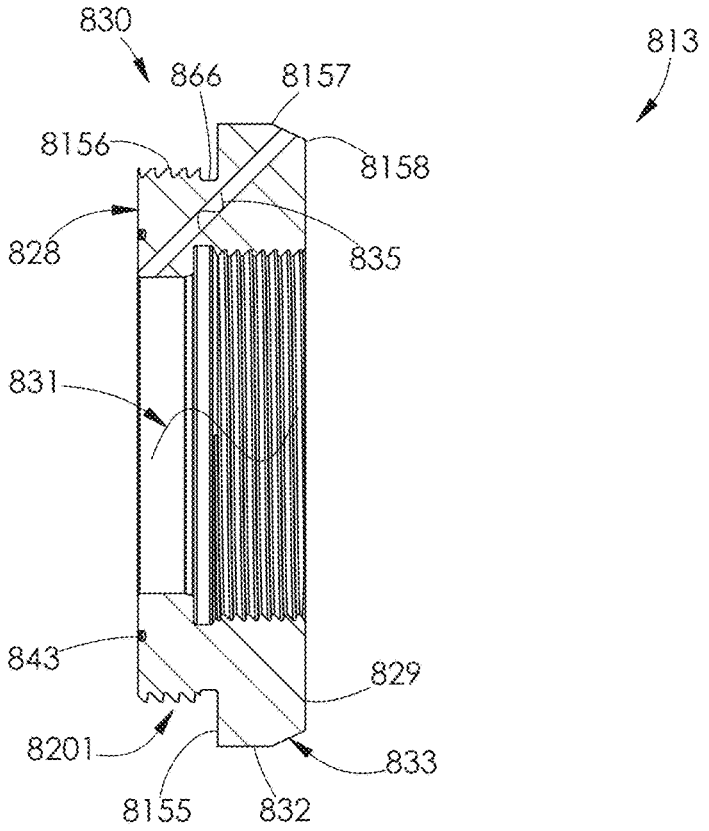

FIG. 141 is a cross-sectional view of the retainer shown in FIG. 139, taken along line BD-BD.

Figure 142:
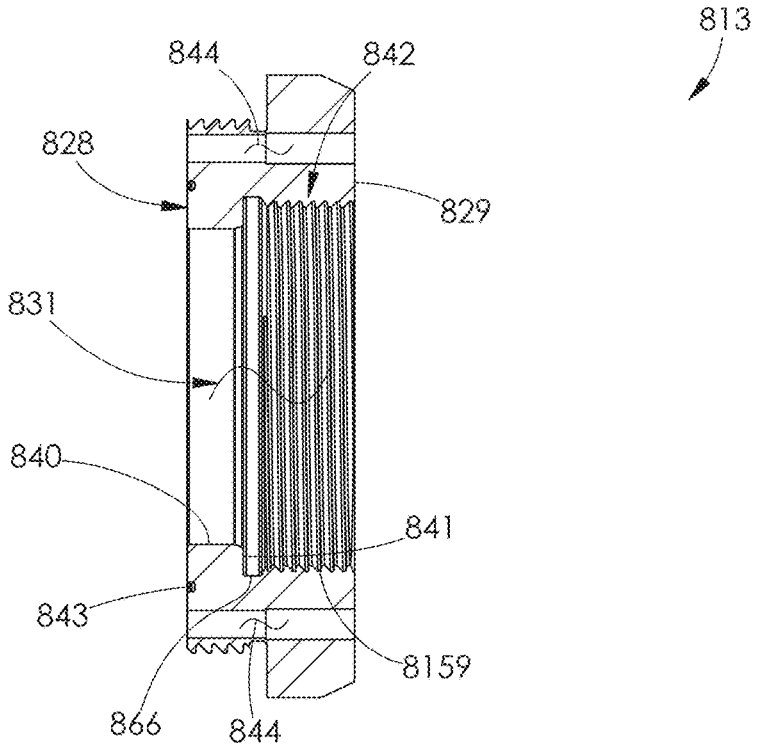

FIG. 142 is a cross-section view of the retainer shown in FIG. 140, taken along line BE-BE.

Figure 143:
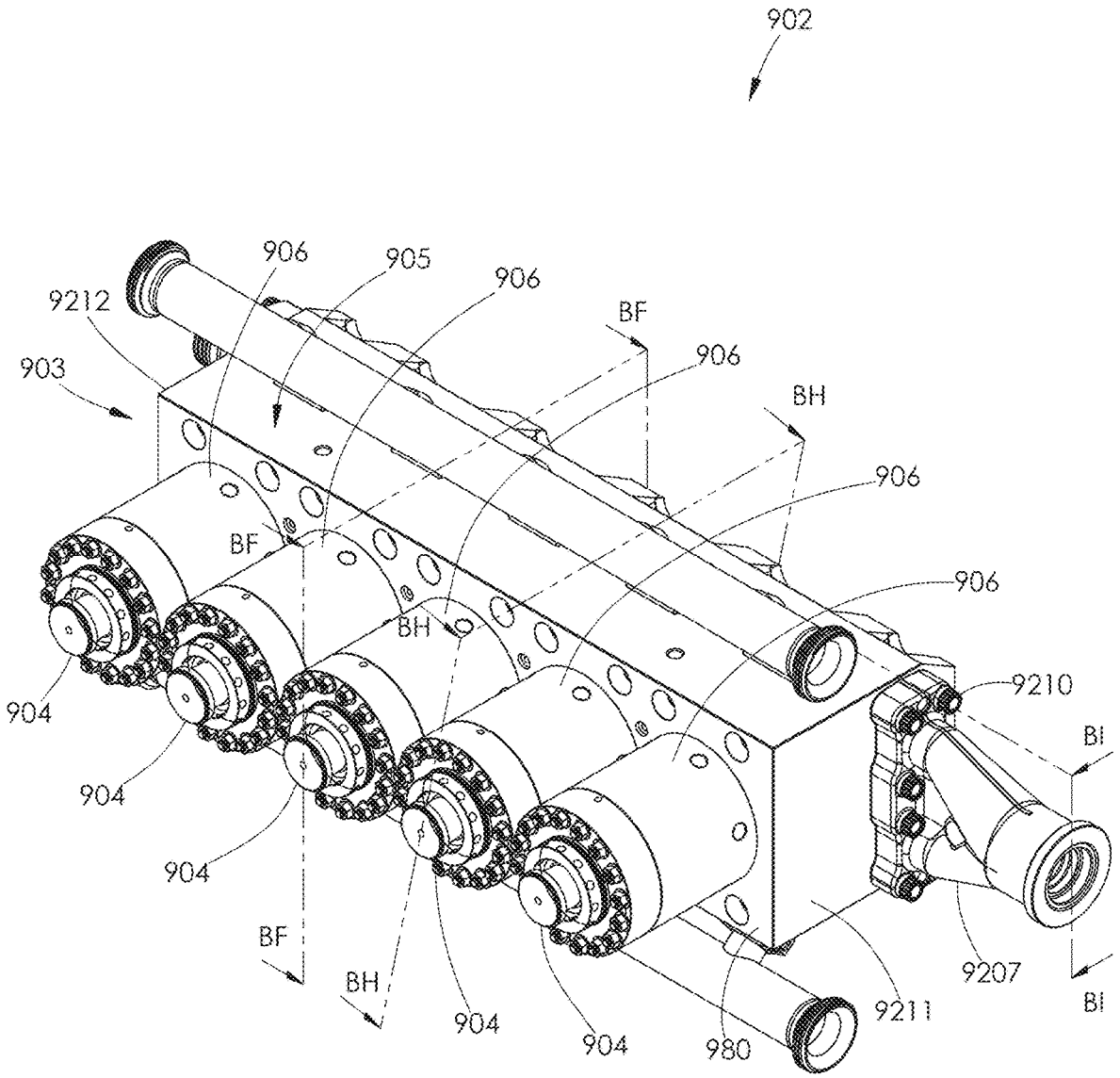

FIG. 143 is a back, top, left isometric view of another embodiment of a multi-piece fluid end.

Figure 144:
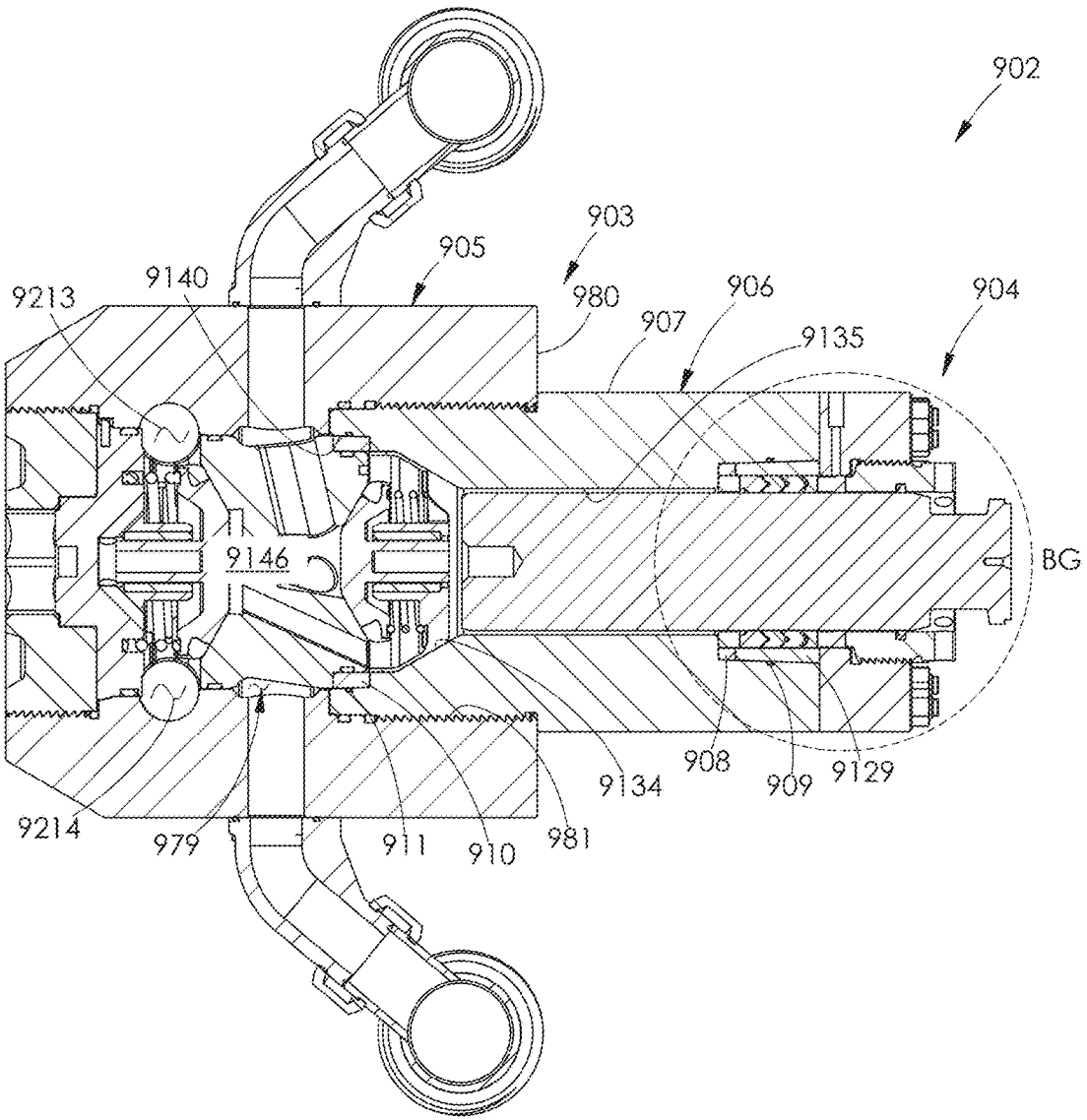

FIG. 144 is a cross-sectional view of the multi-piece fluid end shown in FIG. 143, taken along line BF-BF.

Figure 145:
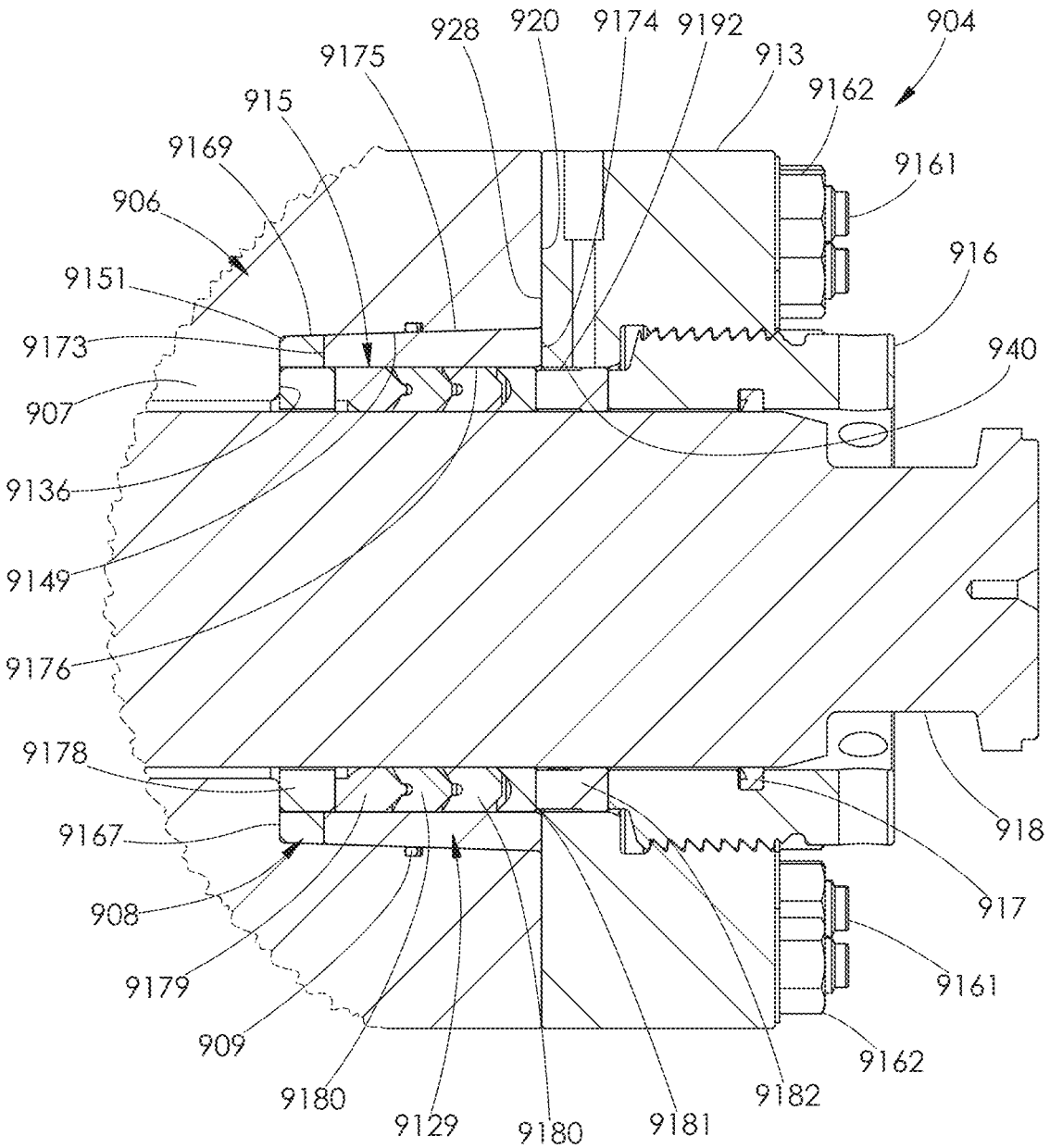

FIG. 145 is an enlarged view of area BG shown in FIG. 144.

Figure 146:
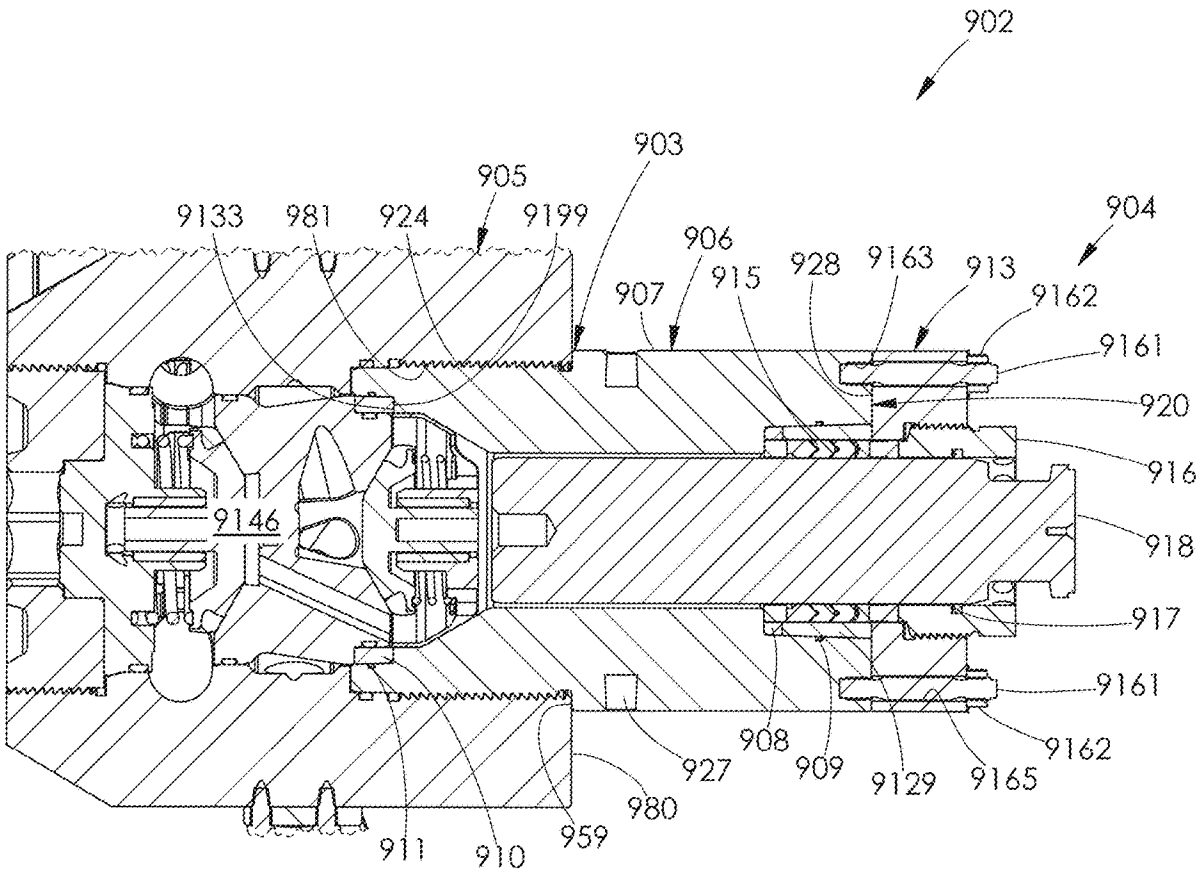

FIG. 146 is a cross-sectional view of the multi-piece fluid end shown in FIG. 143, taken along line BH-BH.

Figure 147:
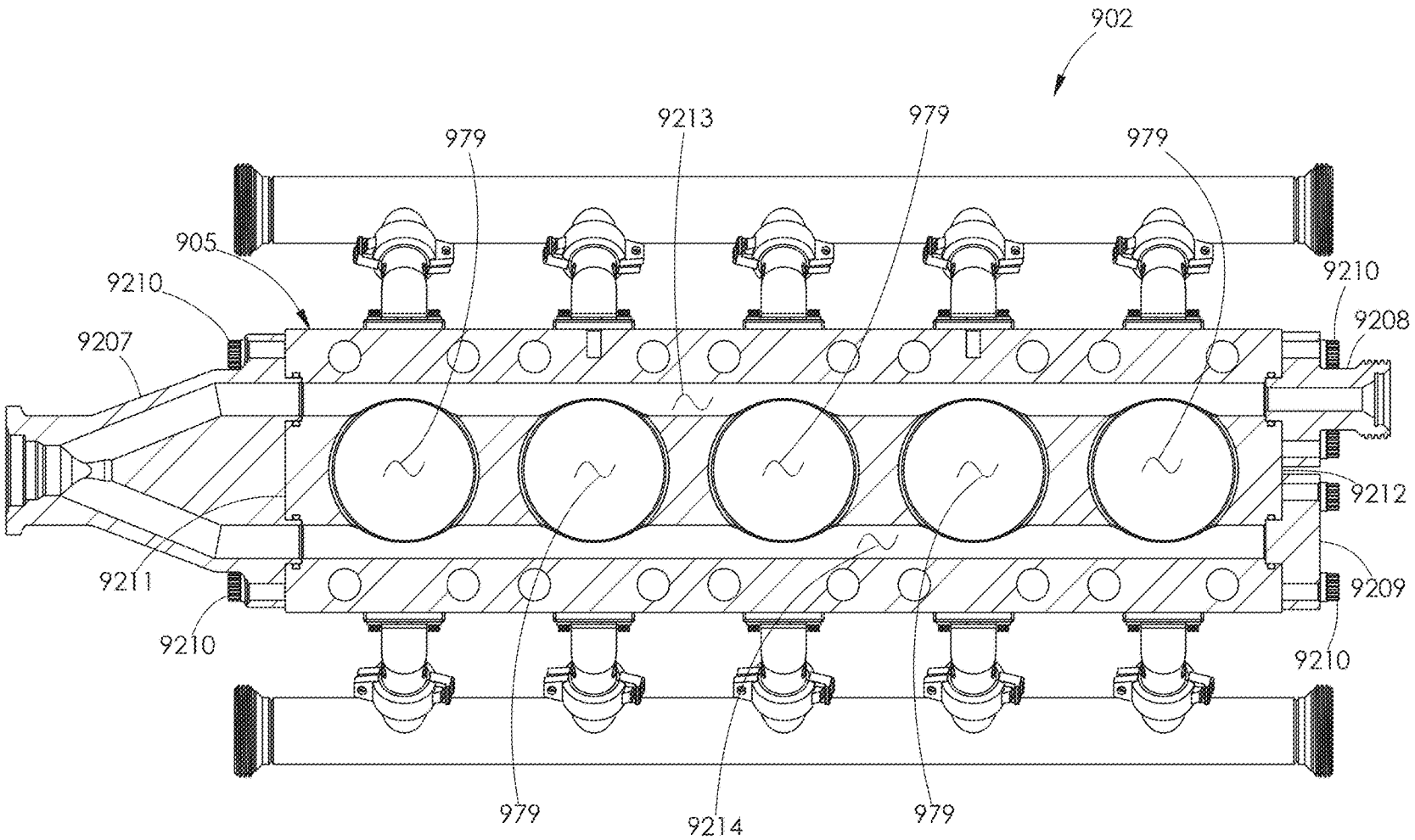

FIG. 147 is a cross-sectional view of the multi-piece fluid end shown in FIG. 143, taken along line BI-BI.

Figure 148:
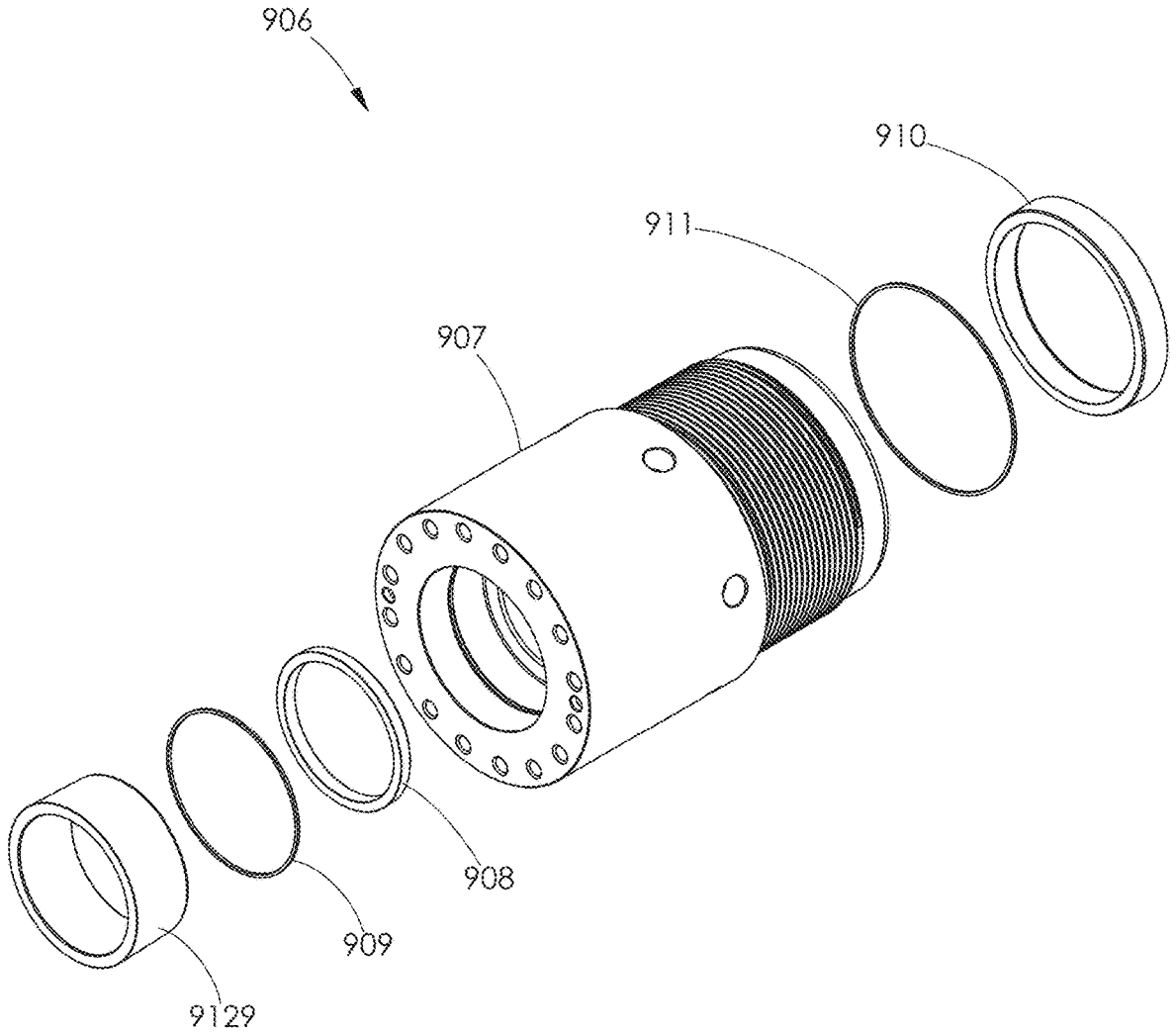

FIG. 148 is an exploded back, top, left, isometric view of a dynamic section of the multi-piece fluid end shown in FIG. 143.

Figure 149:
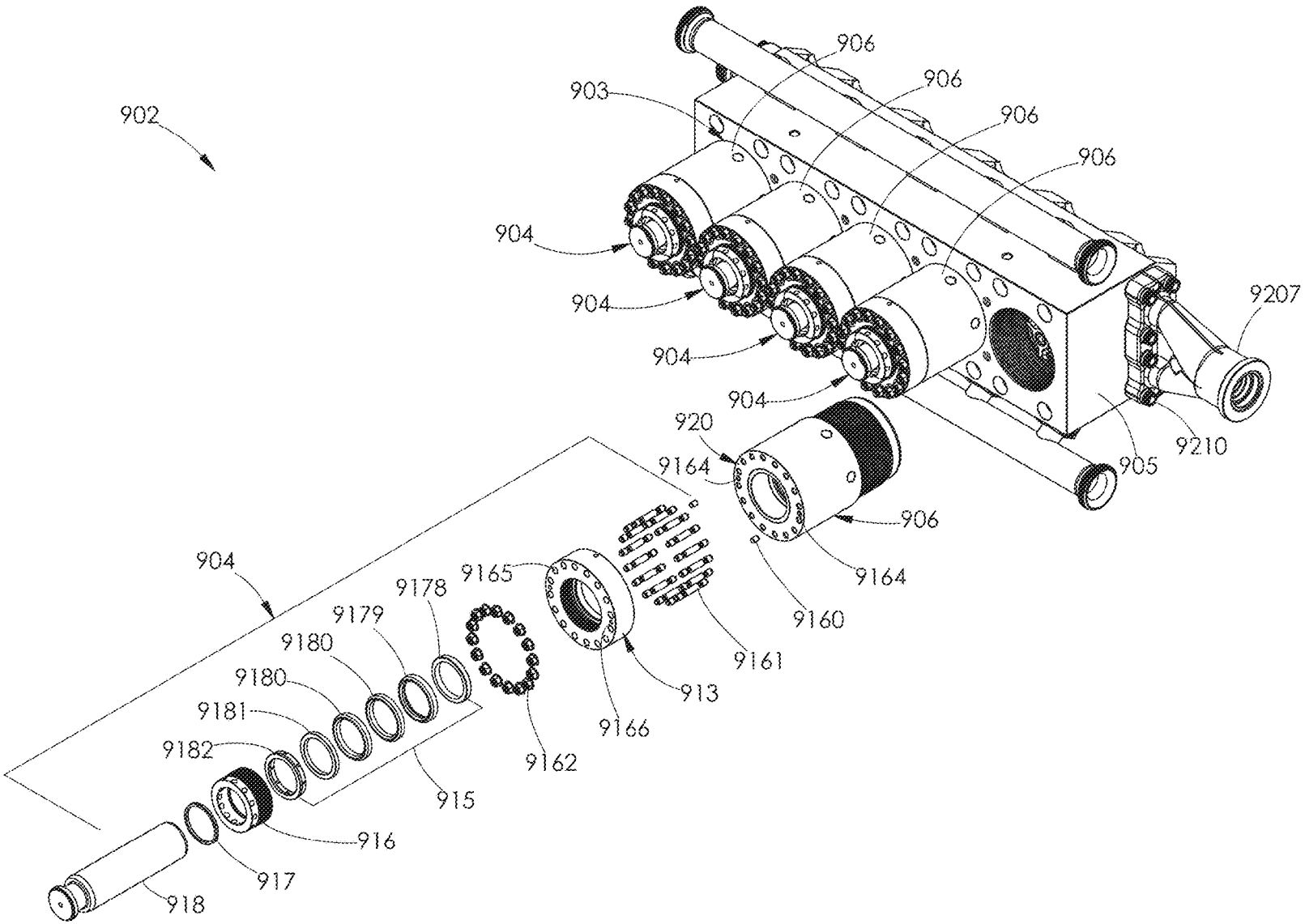

FIG. 149 is an exploded, back, top, left isometric view of the multi-piece fluid end shown in FIG. 143.

Figure 150:
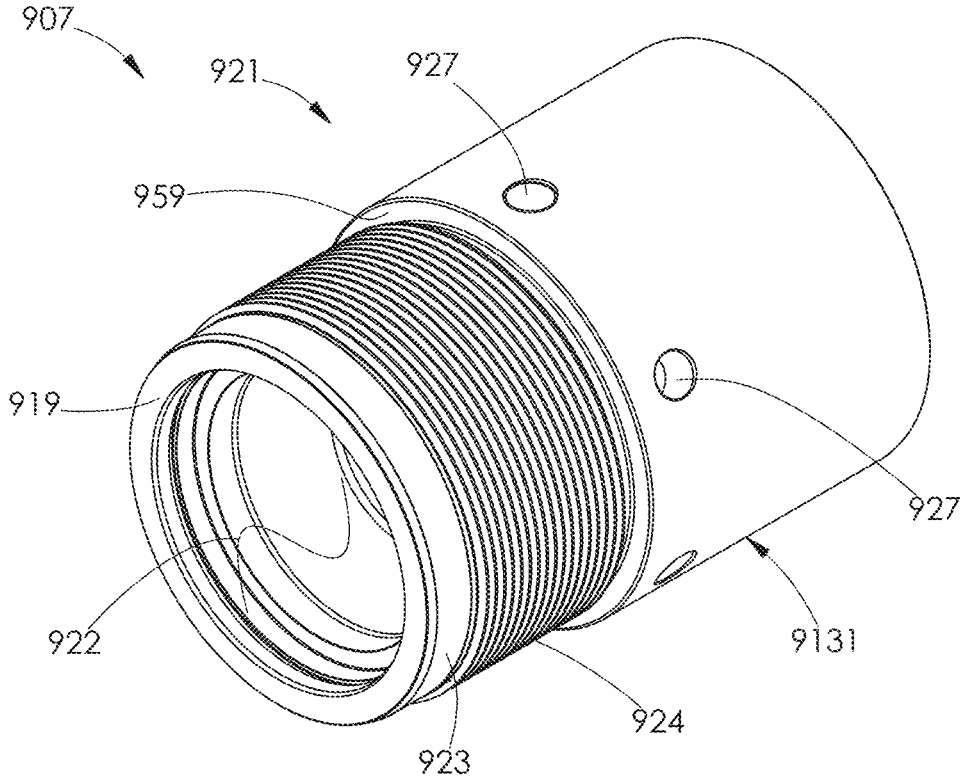

FIG. 150 is an isometric view of a dynamic body used in the multi-piece fluid end shown in FIG. 143.

Figure 151:
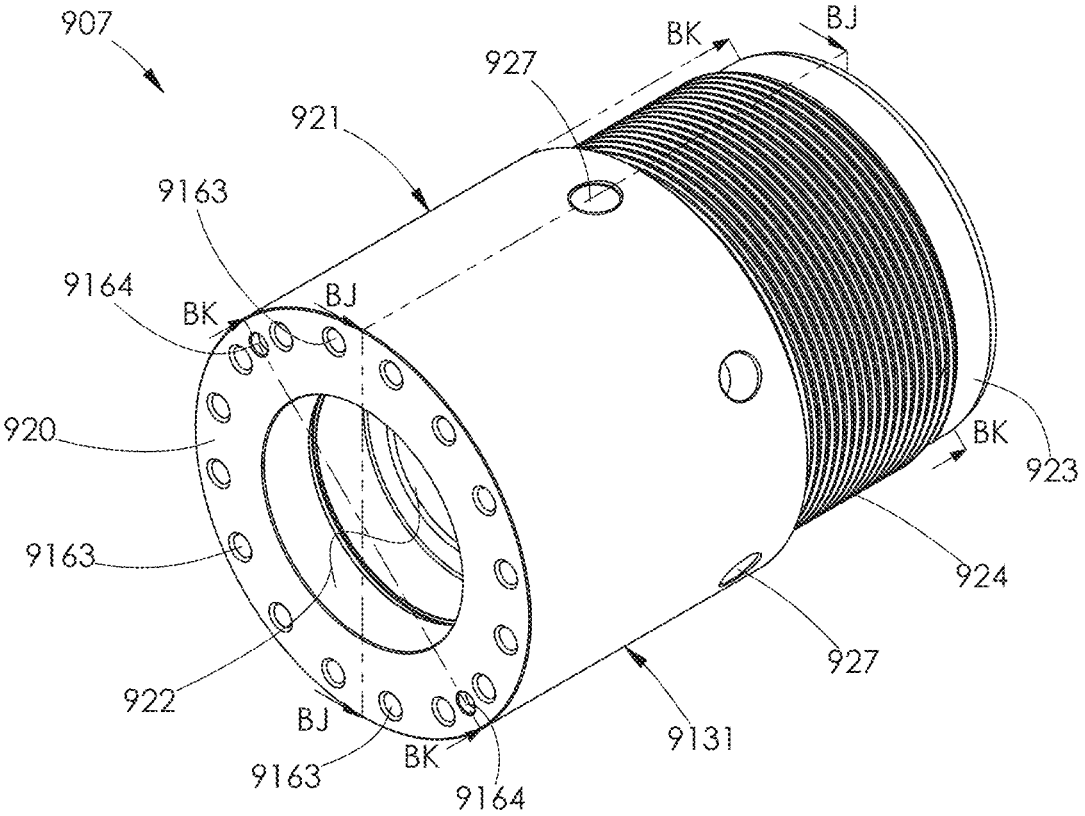

FIG. 151 is a back, top, left isometric view of a dynamic body shown in FIG. 150.

Figure 152:
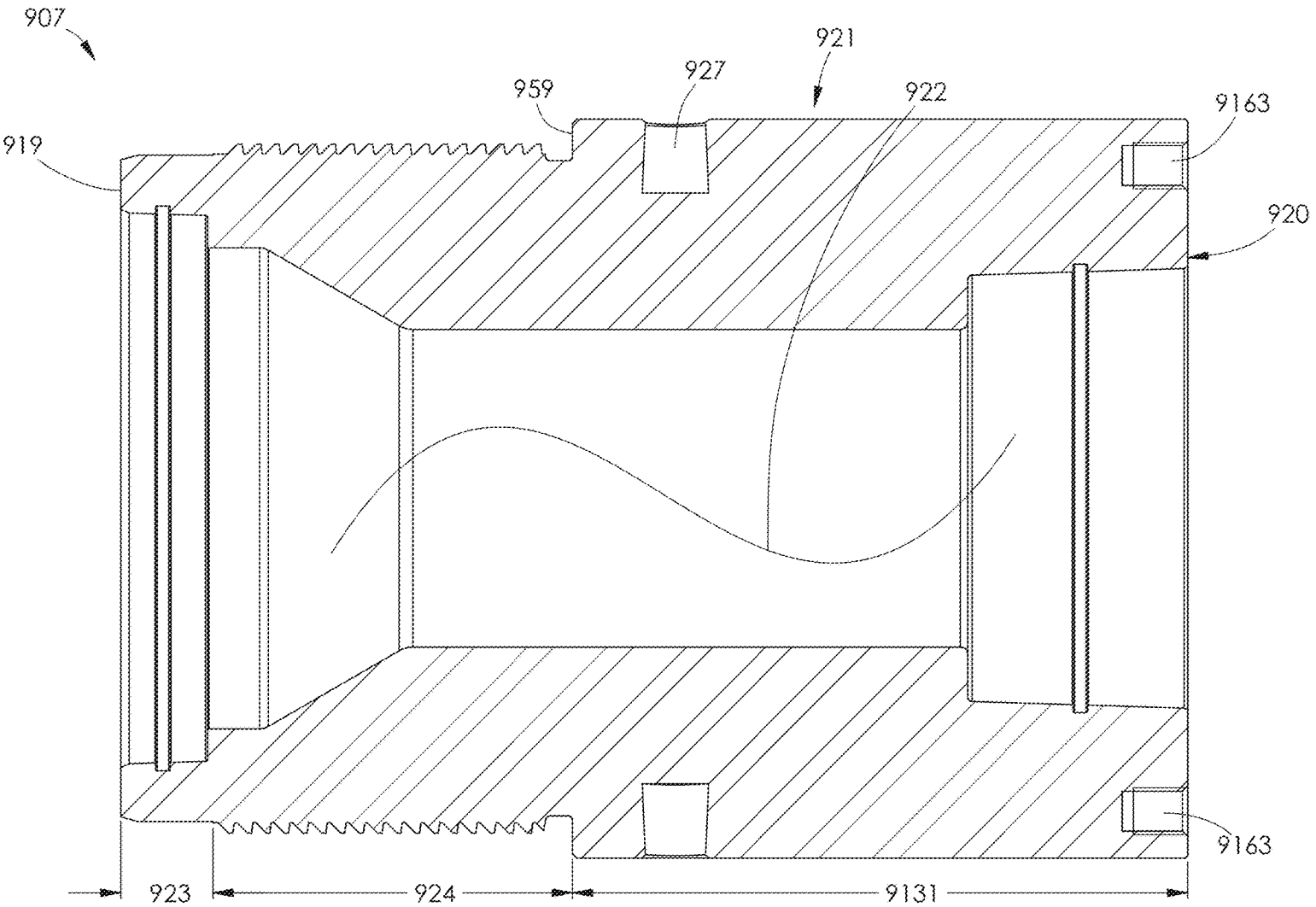

FIG. 152 is a cross-sectional view of the dynamic body shown in FIG. 151, taken along line BJ-BJ.

Figure 153:
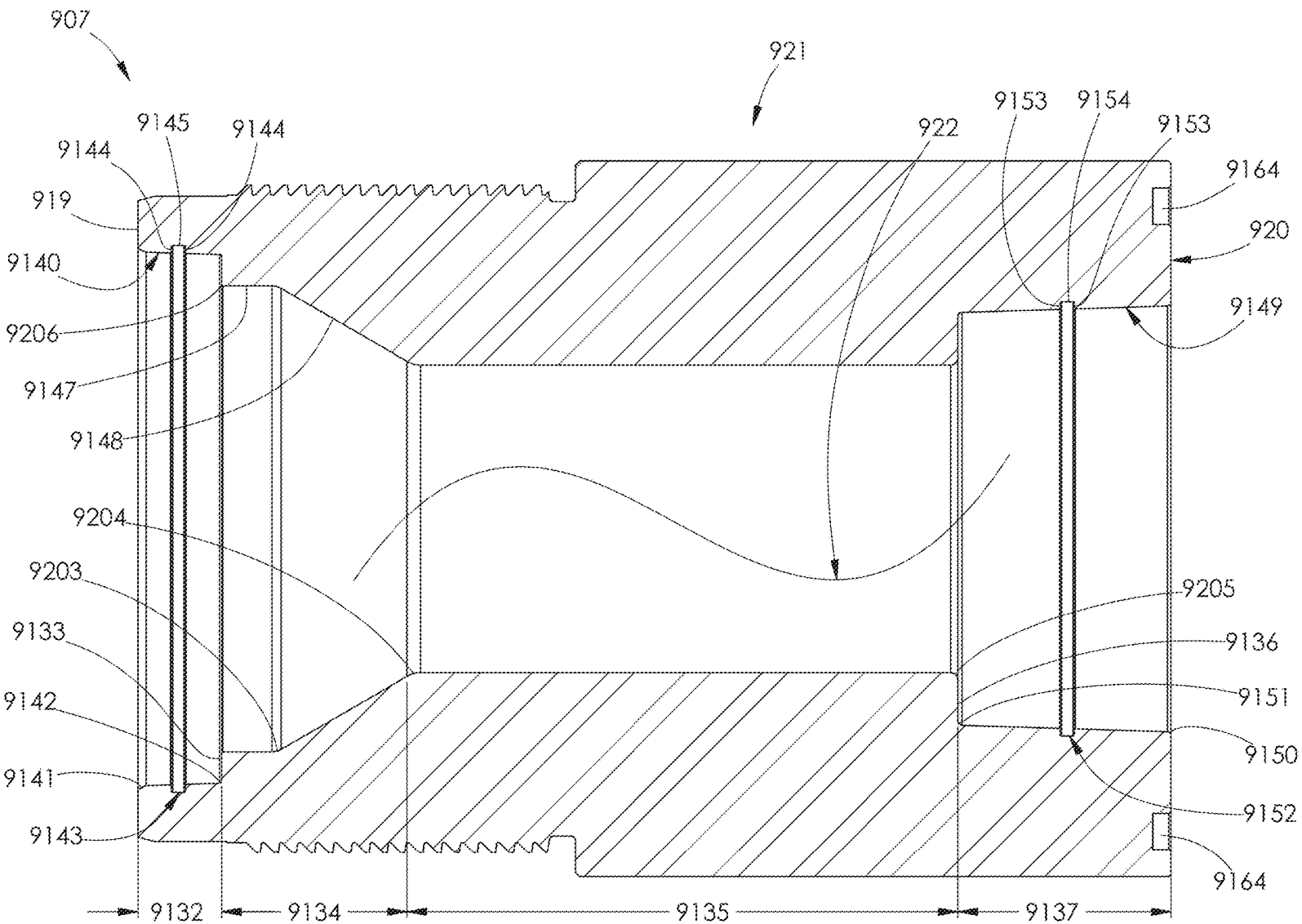

FIG. 153 is a cross-sectional view of the dynamic body shown in FIG. 151, taken along line BK-BK.

Figure 154:
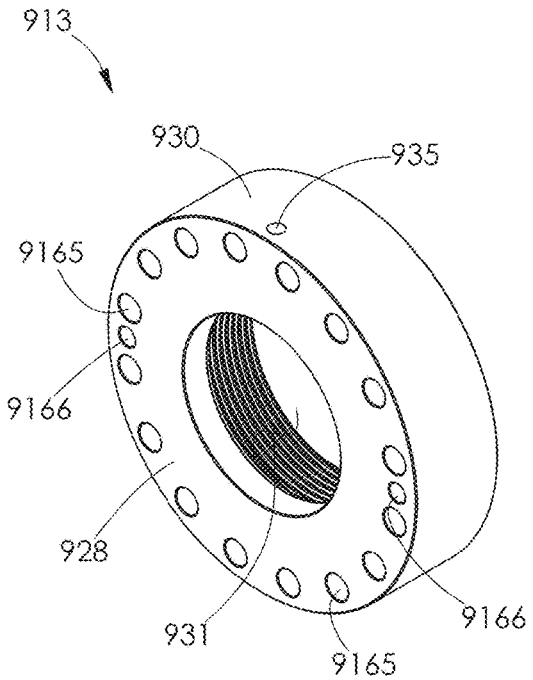

FIG. 154 is an isometric view of a retainer used in the multi-piece fluid end shown in FIG. 143.

Figure 155:
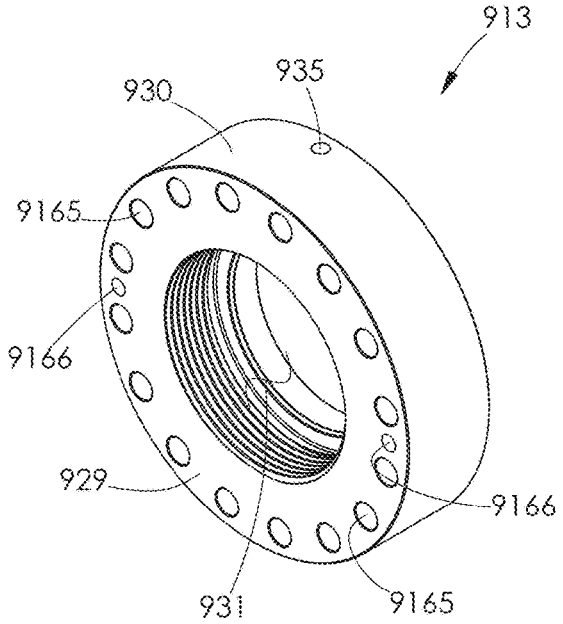

FIG. 155 is a back, top, left isometric view of the retainer shown in FIG. 154.

Figure 156:
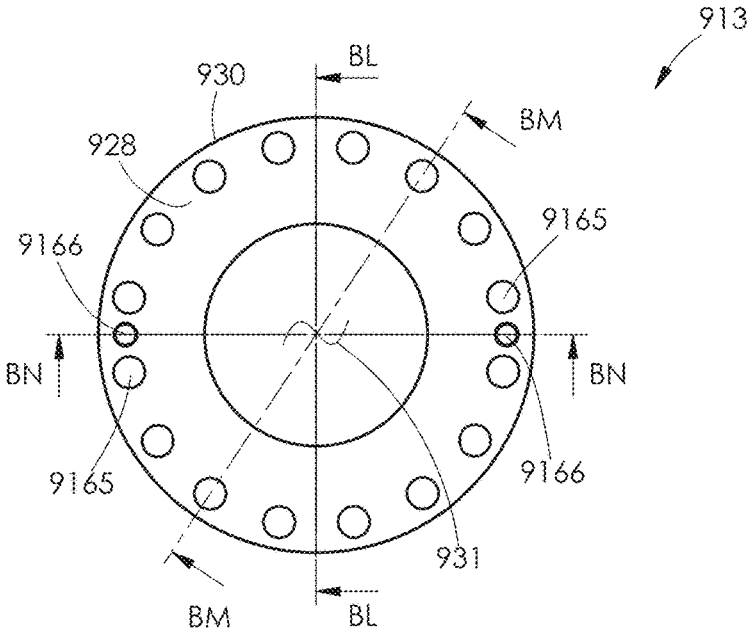

FIG. 156 is a front elevation view of the retainer shown in FIG. 154.

Figure 157:
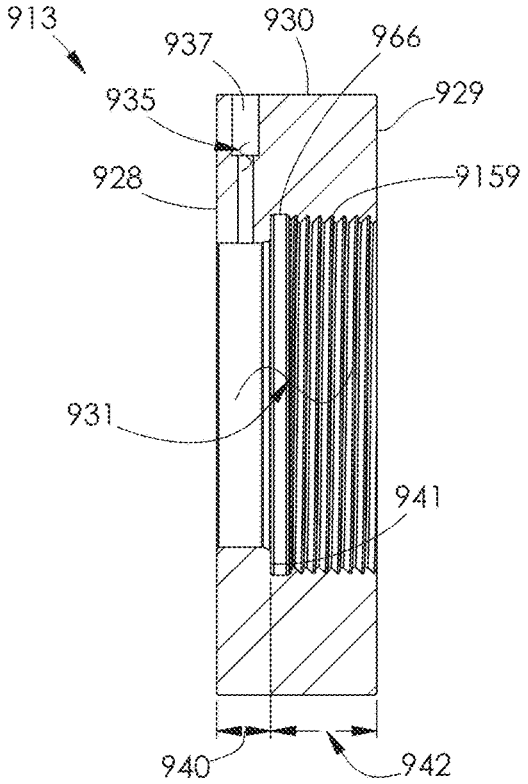

FIG. 157 is a cross-sectional view of the retainer shown in FIG. 156, taken along line BL-BL.

Figure 158:
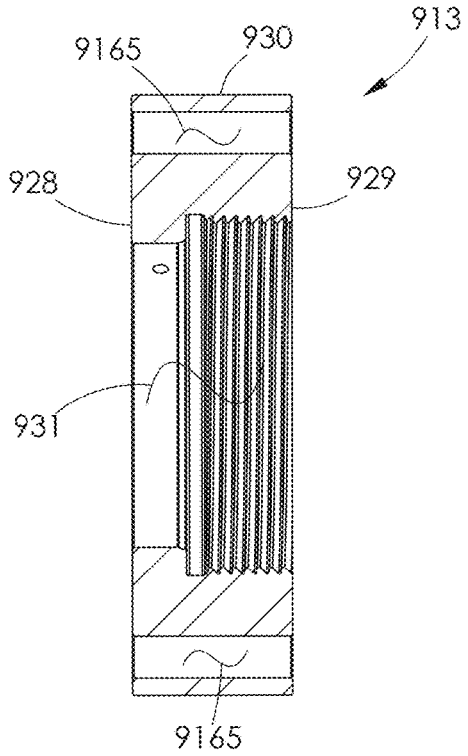

FIG. 158 is a cross-sectional view of the retainer shown in FIG. 156, taken along line BM-BM.

Figure 159:
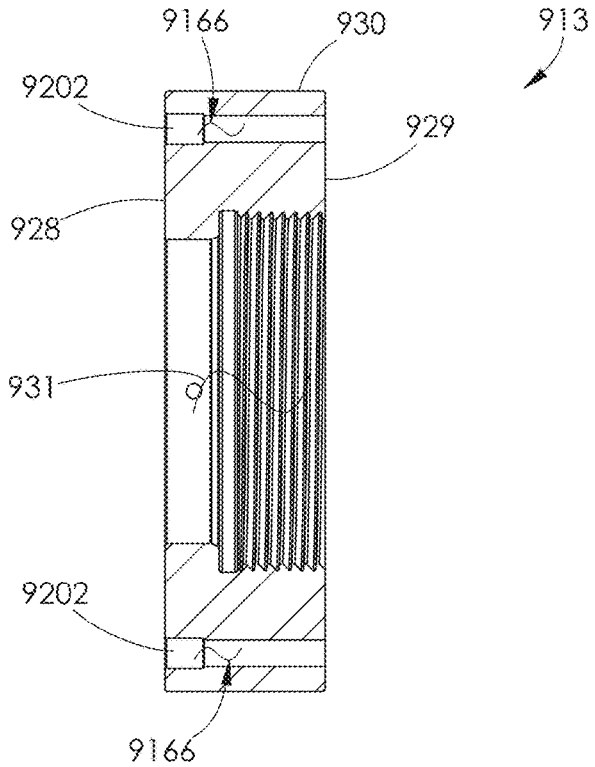

FIG. 159 is a cross-sectional view of the retainer shown in FIG. 156, taken along line BN-BN.

Figure 160:
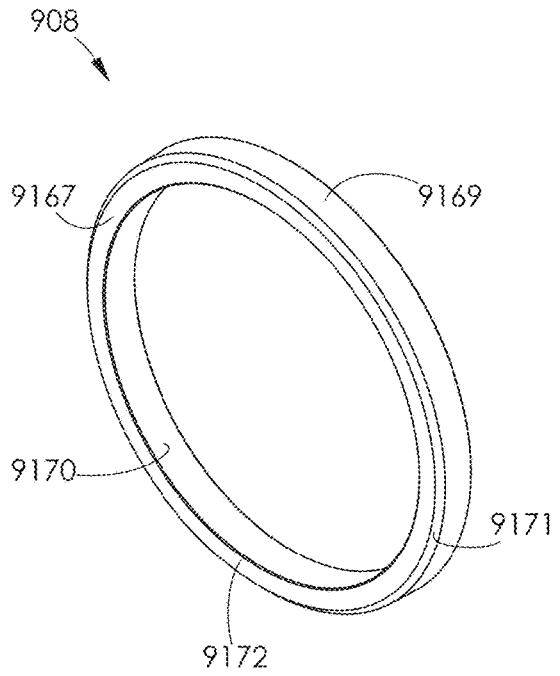

FIG. 160 is an isometric view of a front plunger system wear ring used in the multi-piece fluid end shown in FIG. 143.

Figure 161:
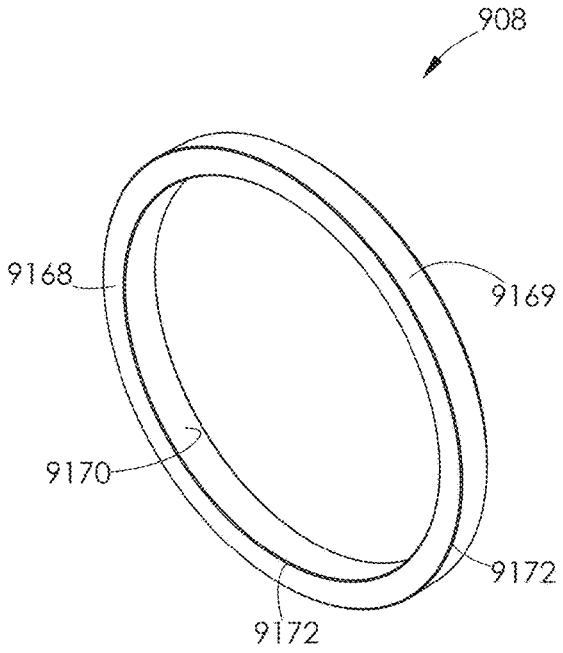

FIG. 161 is a back, top, left isometric view of the front plunger system wear ring shown in FIG. 160.

Figure 162:
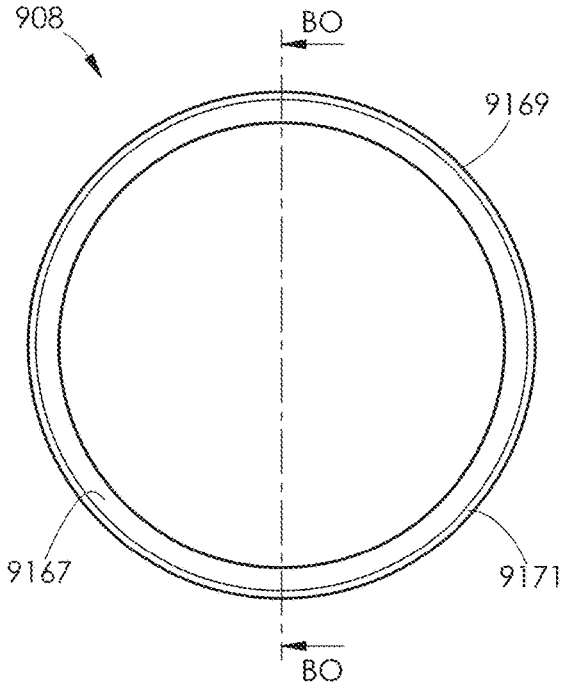

FIG. 162 is a front elevation view of the front plunger system wear ring shown in FIG. 160.

Figure 163:
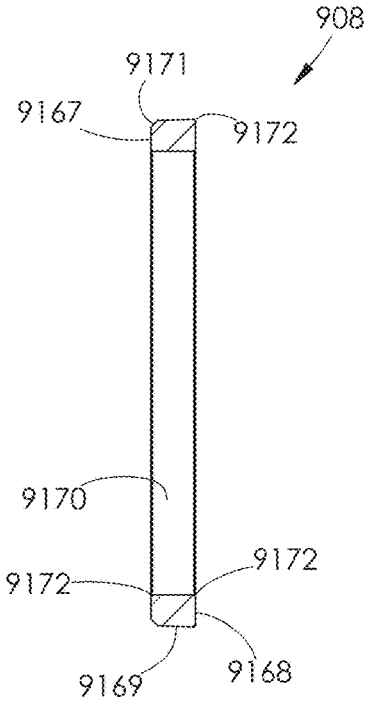

FIG. 163 is a cross-sectional view of the front plunger system wear ring shown in FIG. 162, taken along line BO-BO.

Figure 164:
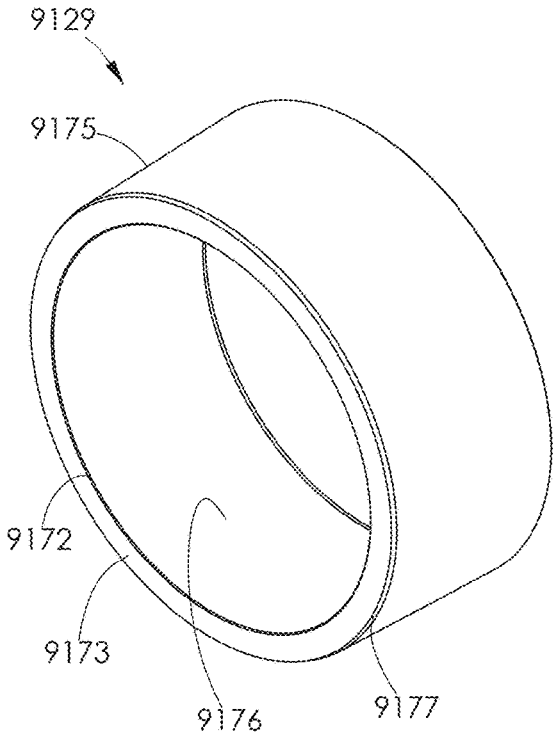

FIG. 164 is an isometric view of a back plunger system wear ring used in the multi-piece fluid end shown in FIG. 143.

Figure 165:
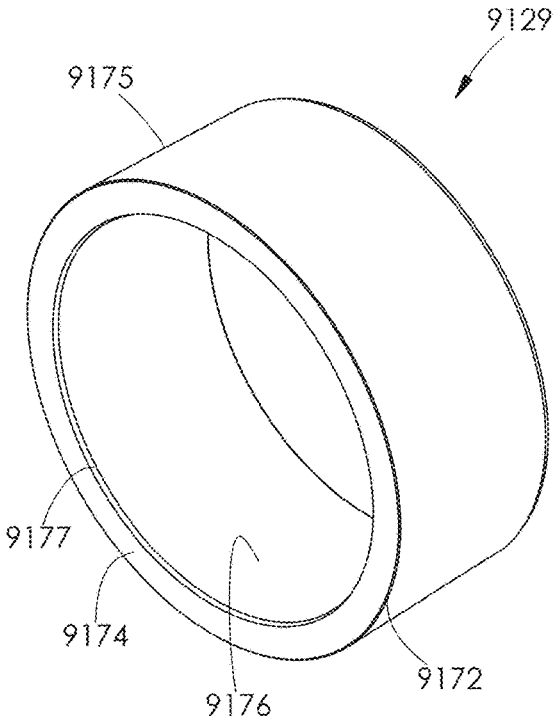

FIG. 165 is a back, top, left isometric view of the back plunger system wear ring shown in FIG. 164.

Figure 166:
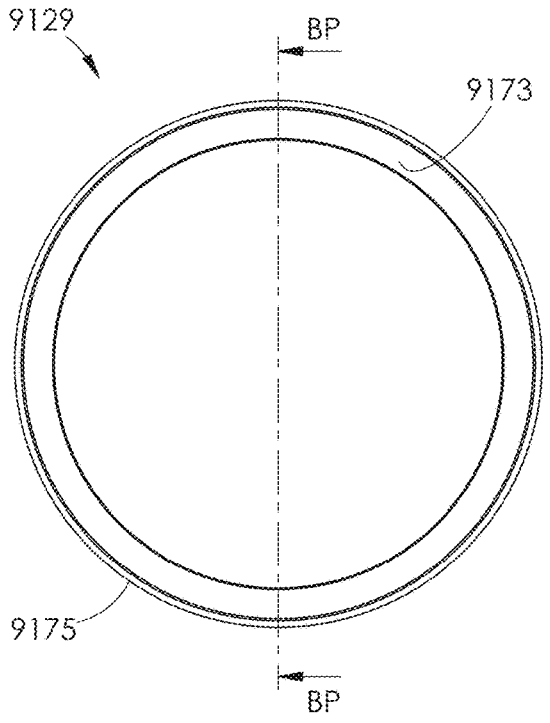

FIG. 166 is a front elevation view of the back plunger system wear ring shown in FIG. 164.

Figure 167:
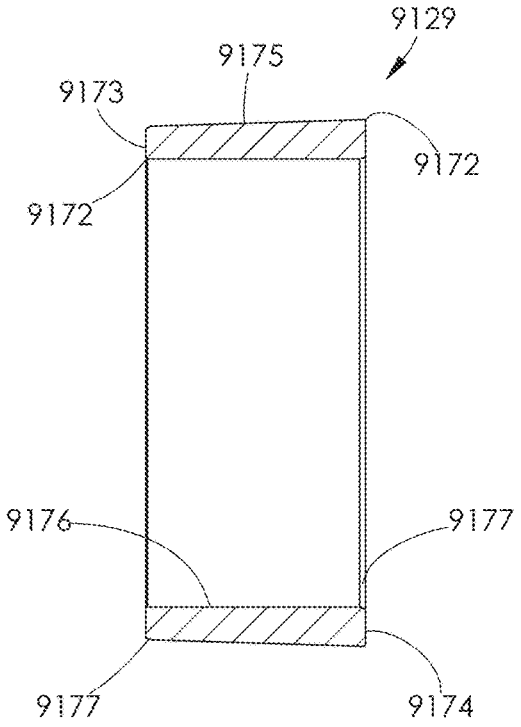

FIG. 167 is a cross-sectional view of the back plunger system wear ring shown in FIG. 166, taken along line BP-BP.

Figure 168:
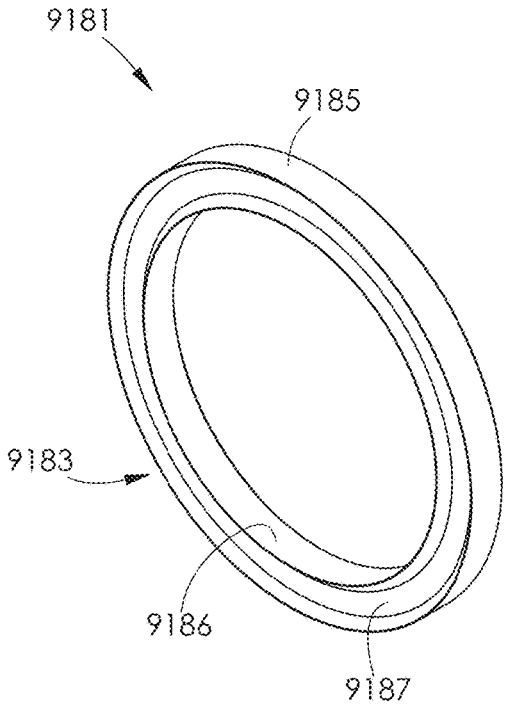

FIG. 168 is an isometric view of a front lantern ring used in the multi-piece fluid end shown in FIG. 143.

Figure 169:
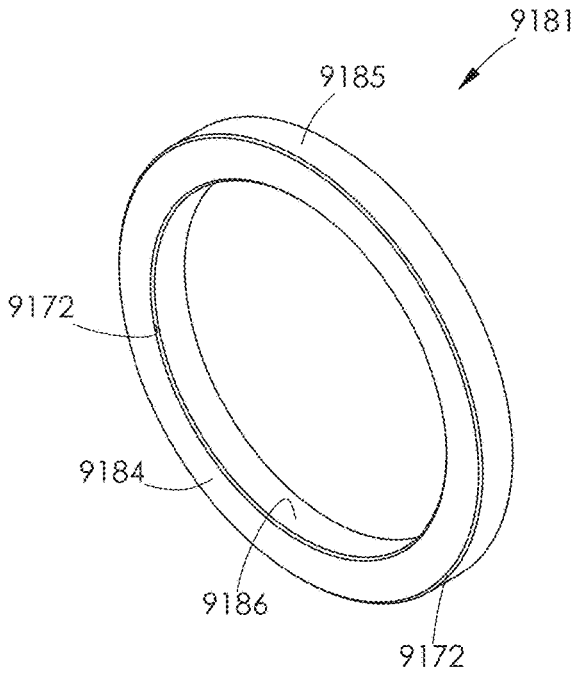

FIG. 169 is a back, top, left isometric view of the front lantern ring shown in FIG. 168.

Figure 170:
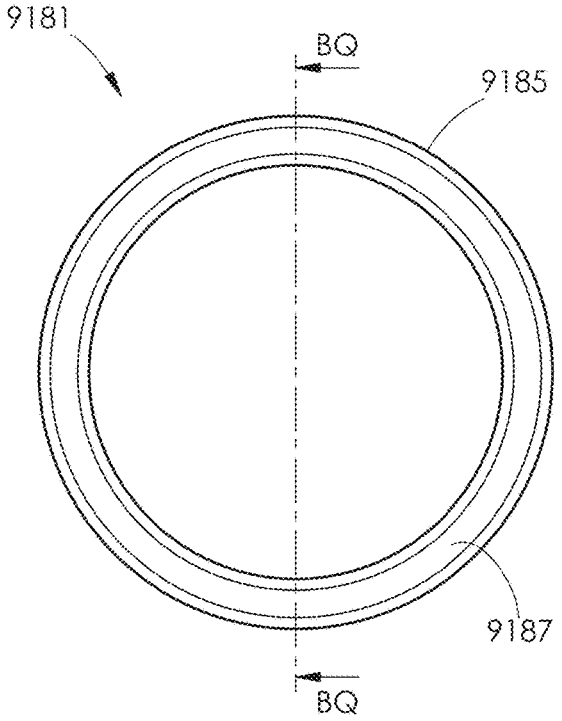

FIG. 170 is a front elevation view of the front lantern ring shown in FIG. 168.

Figure 171:
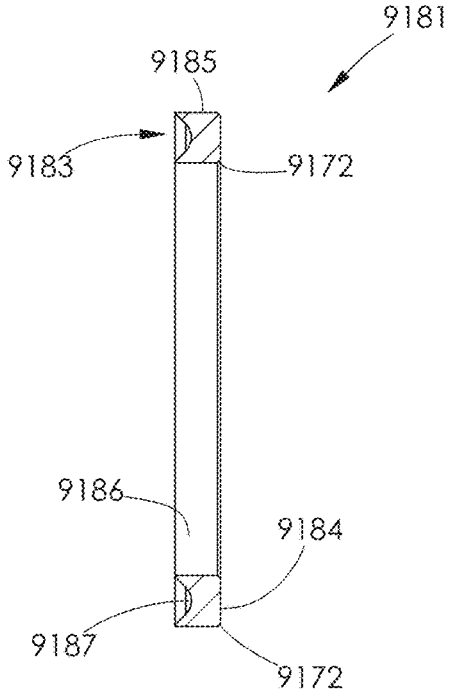

FIG. 171 is a cross-sectional view of the front lantern ring shown in FIG. 170, taken along line BQ-BQ.

Figure 172:
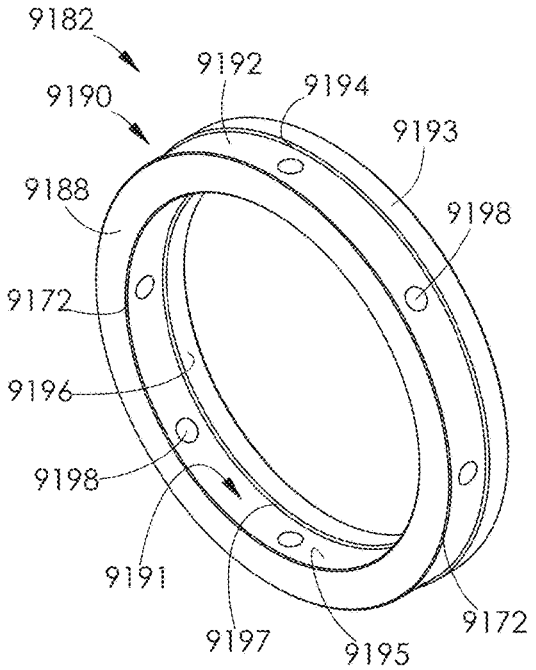

FIG. 172 is an isometric view of a back lantern ring used in the multi-piece fluid end shown in FIG. 143.

Figure 173:
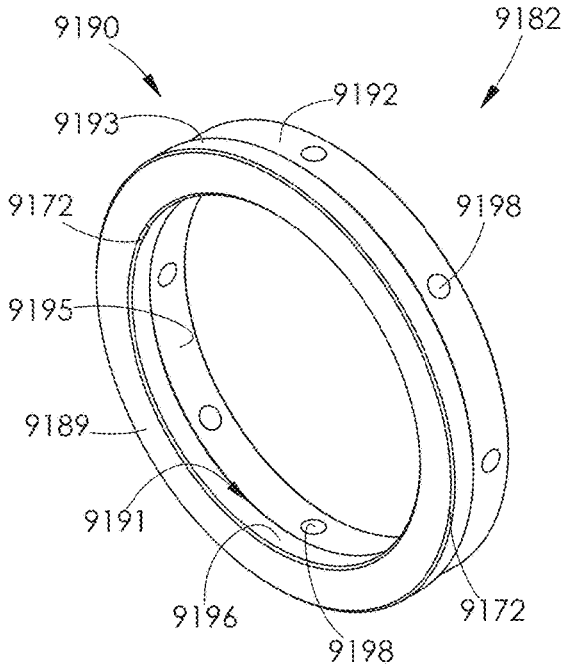

FIG. 173 is a back, top, left isometric view of the back lantern ring shown in FIG. 172.

Figure 174:
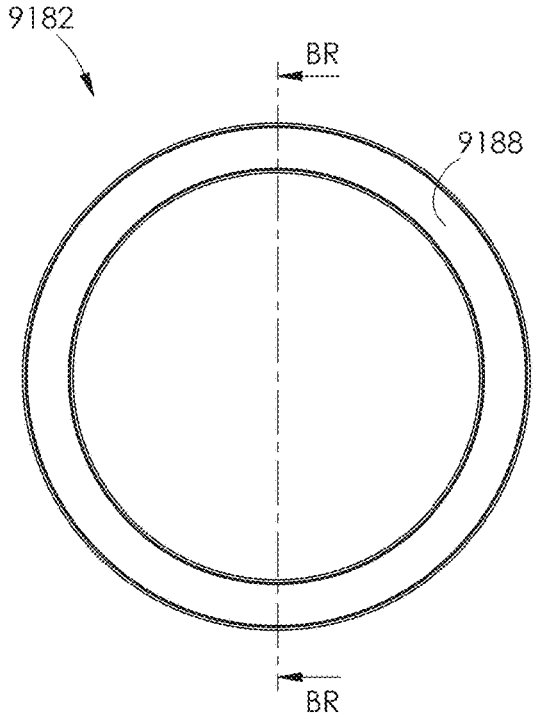

FIG. 174 is a front elevation view of the back lantern ring shown in FIG. 172.

Figure 175:
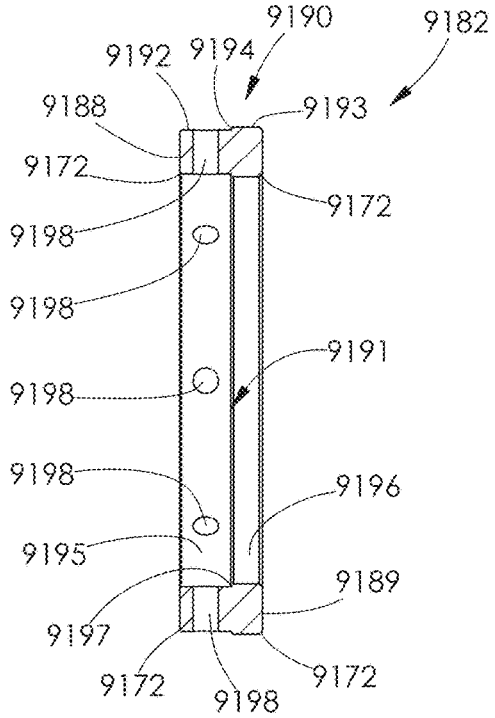

FIG. 175 is a cross-sectional view of the back lantern ring shown in FIG. 174, taken along line BR-BR.

Figure 176:
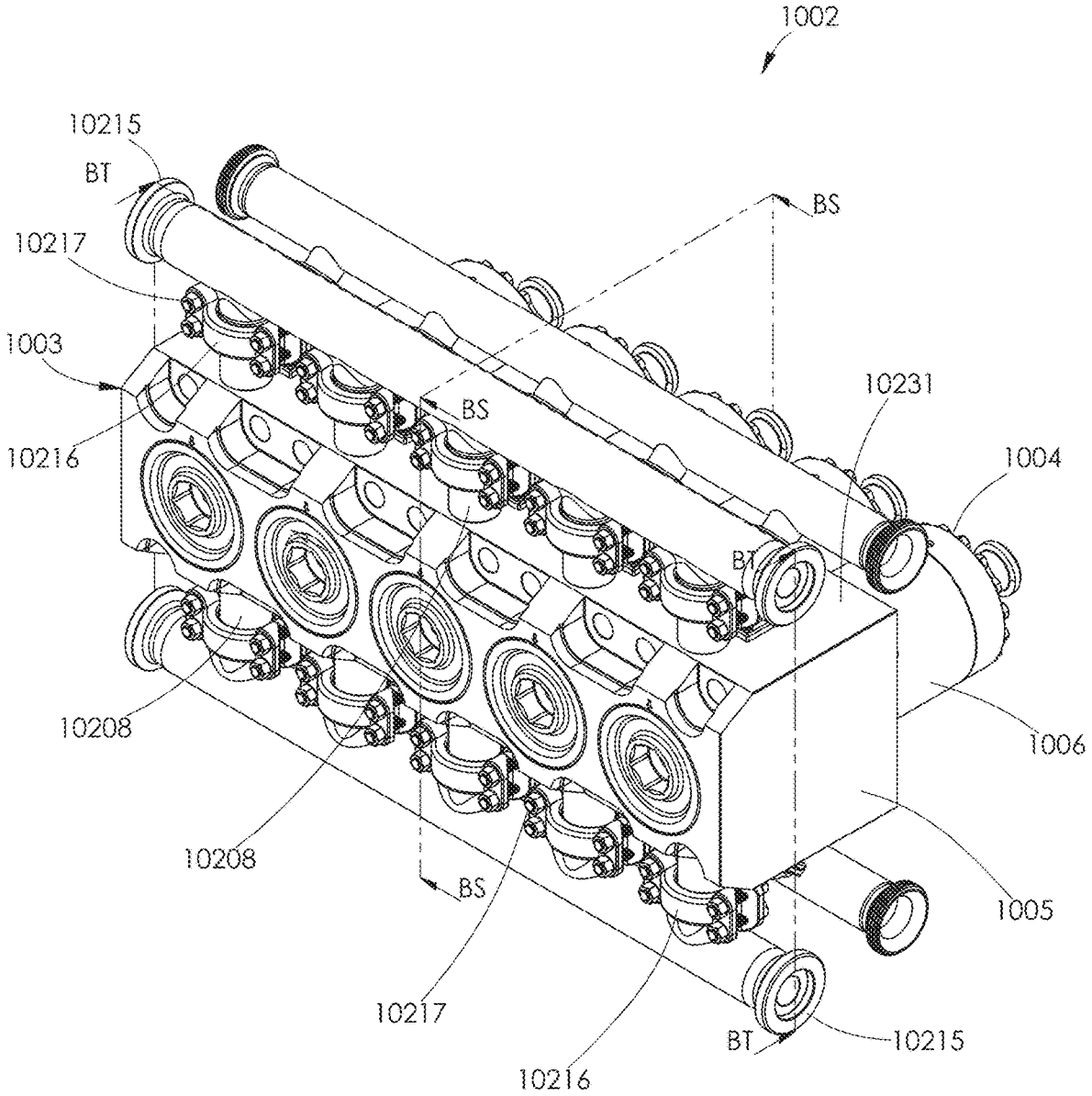

FIG. 176 is an isometric view of another embodiment of a multi-piece fluid end.

Figure 177:
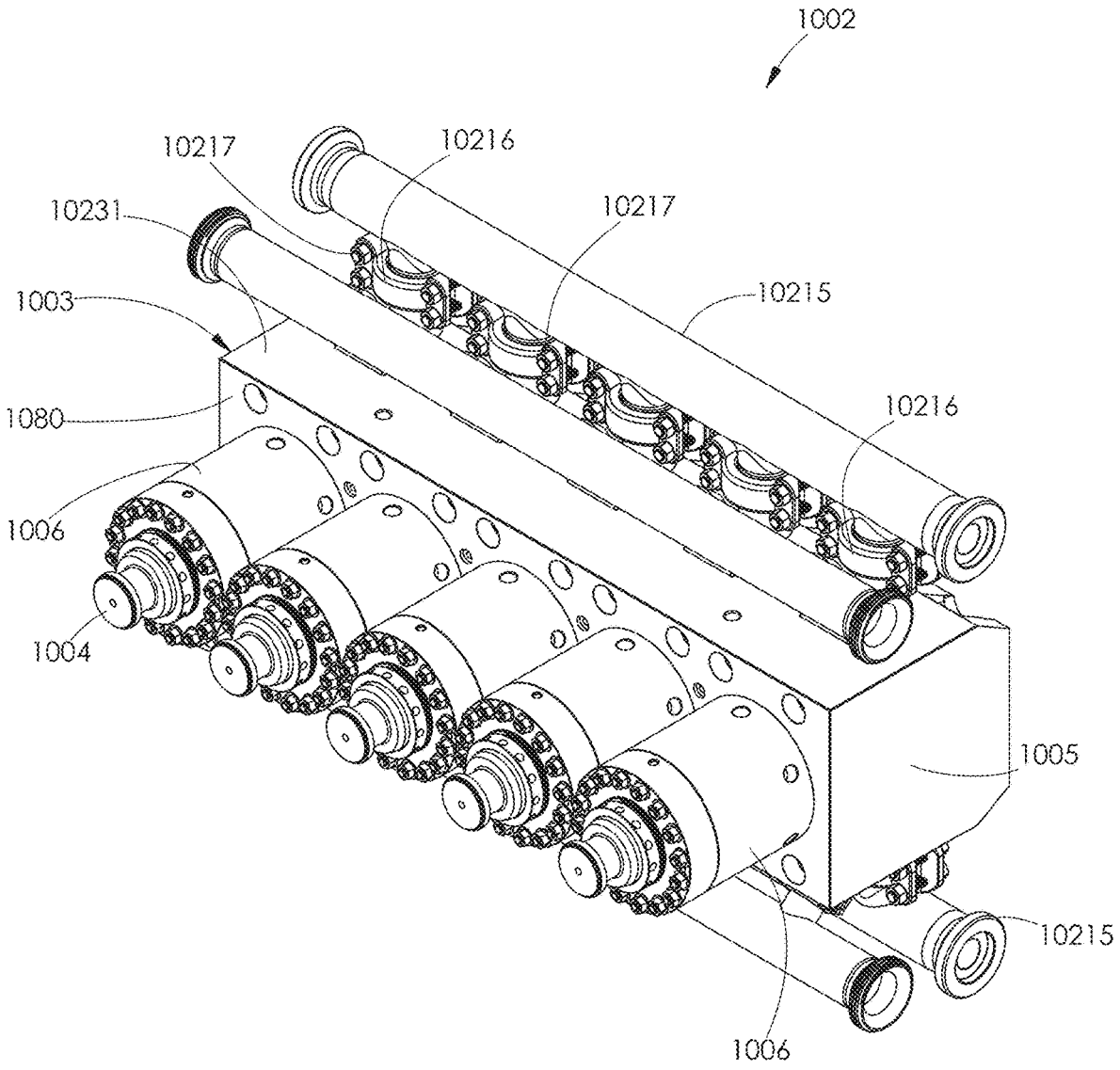

FIG. 177 is a rear isometric view of the multi-piece fluid end shown in FIG. 176.

Figure 178:
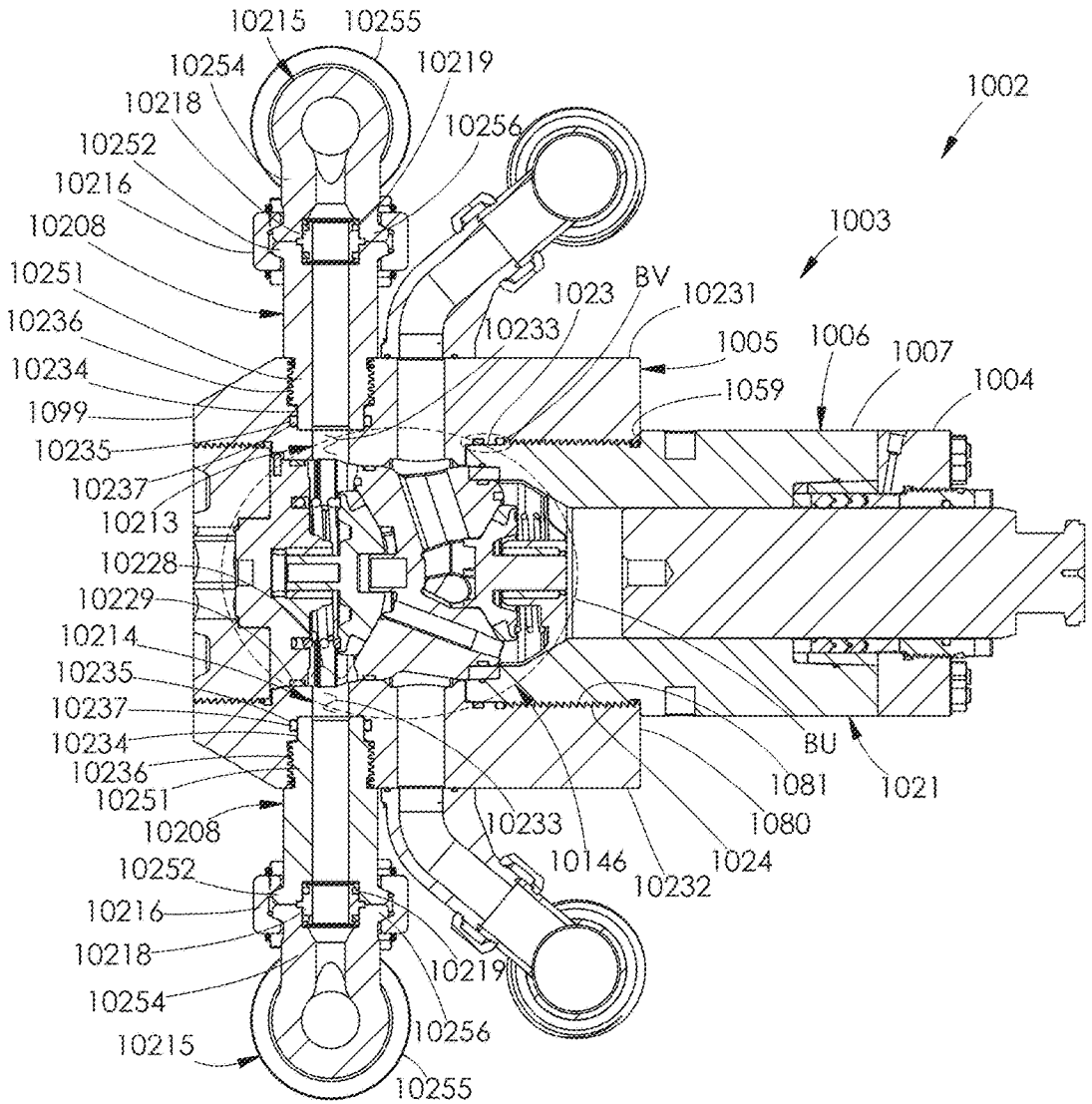

FIG. 178 is a cross-sectional view of the multi-piece fluid end shown in FIG. 176, taken along line BS-BS.

Figure 179:
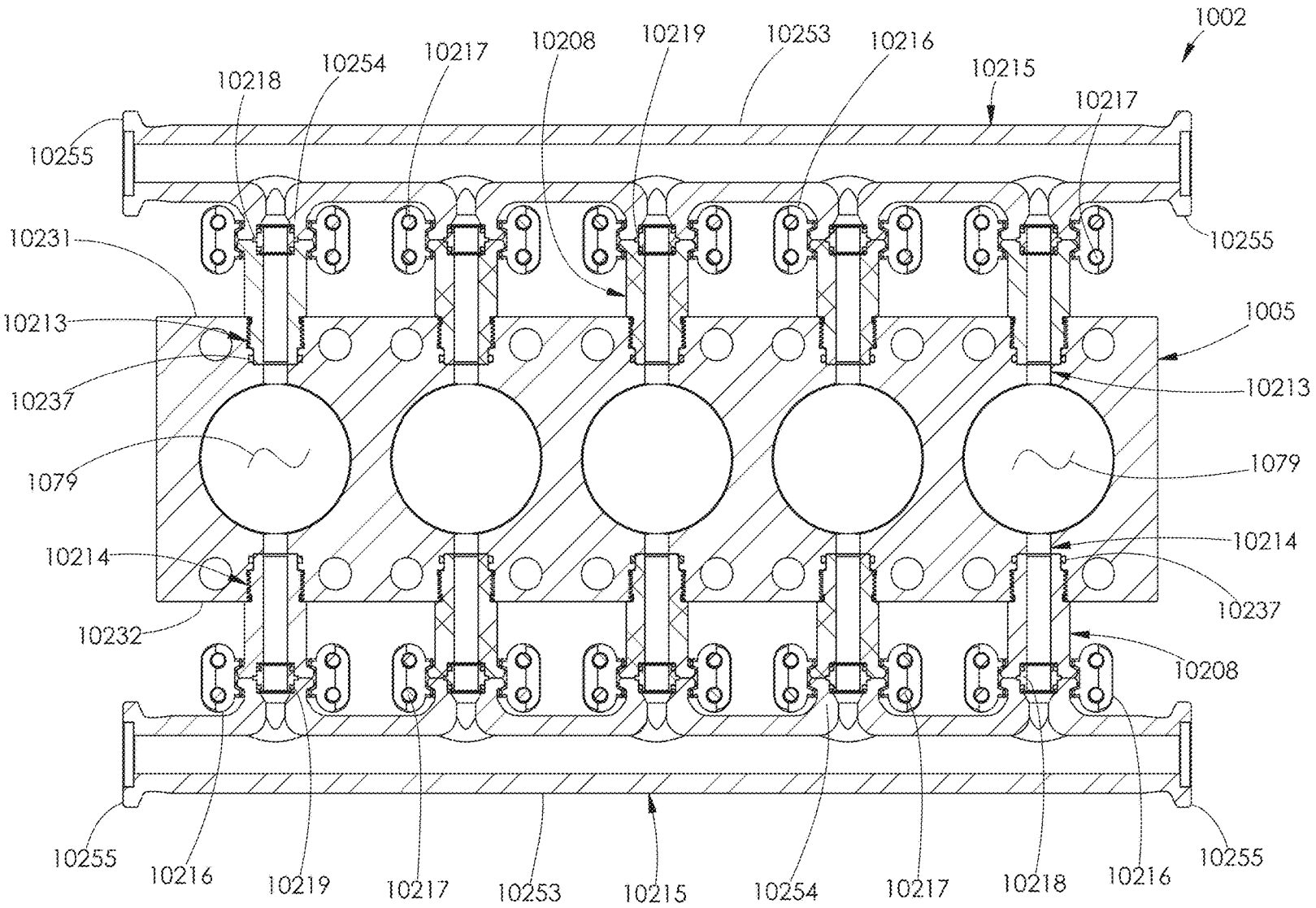

FIG. 179 is a cross-sectional view of the multi-piece fluid end shown in FIG. 176, taken along line BT-BT.

Figure 180:
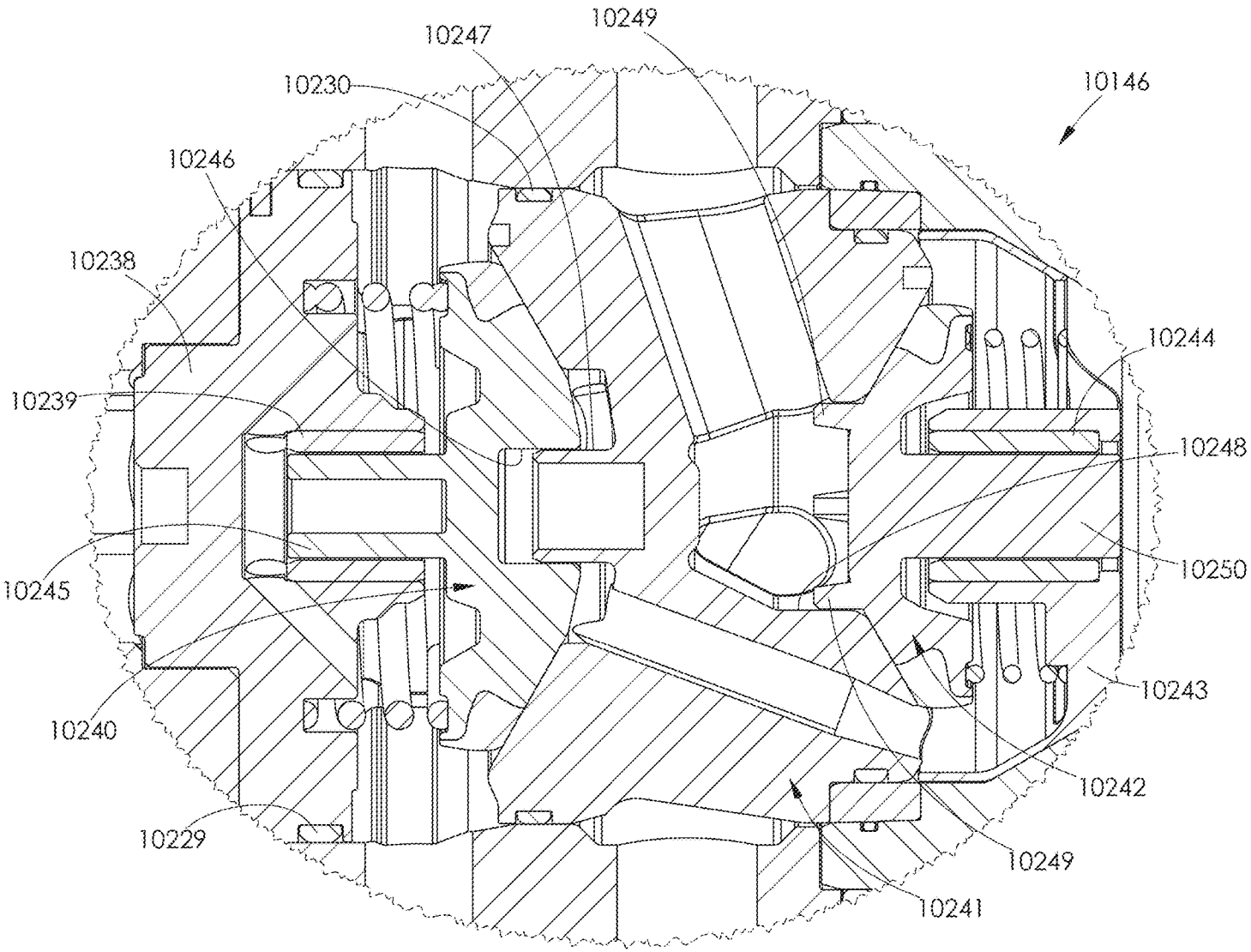

FIG. 180 is an enlarged view of area BU shown in FIG. 178.

Figure 181:
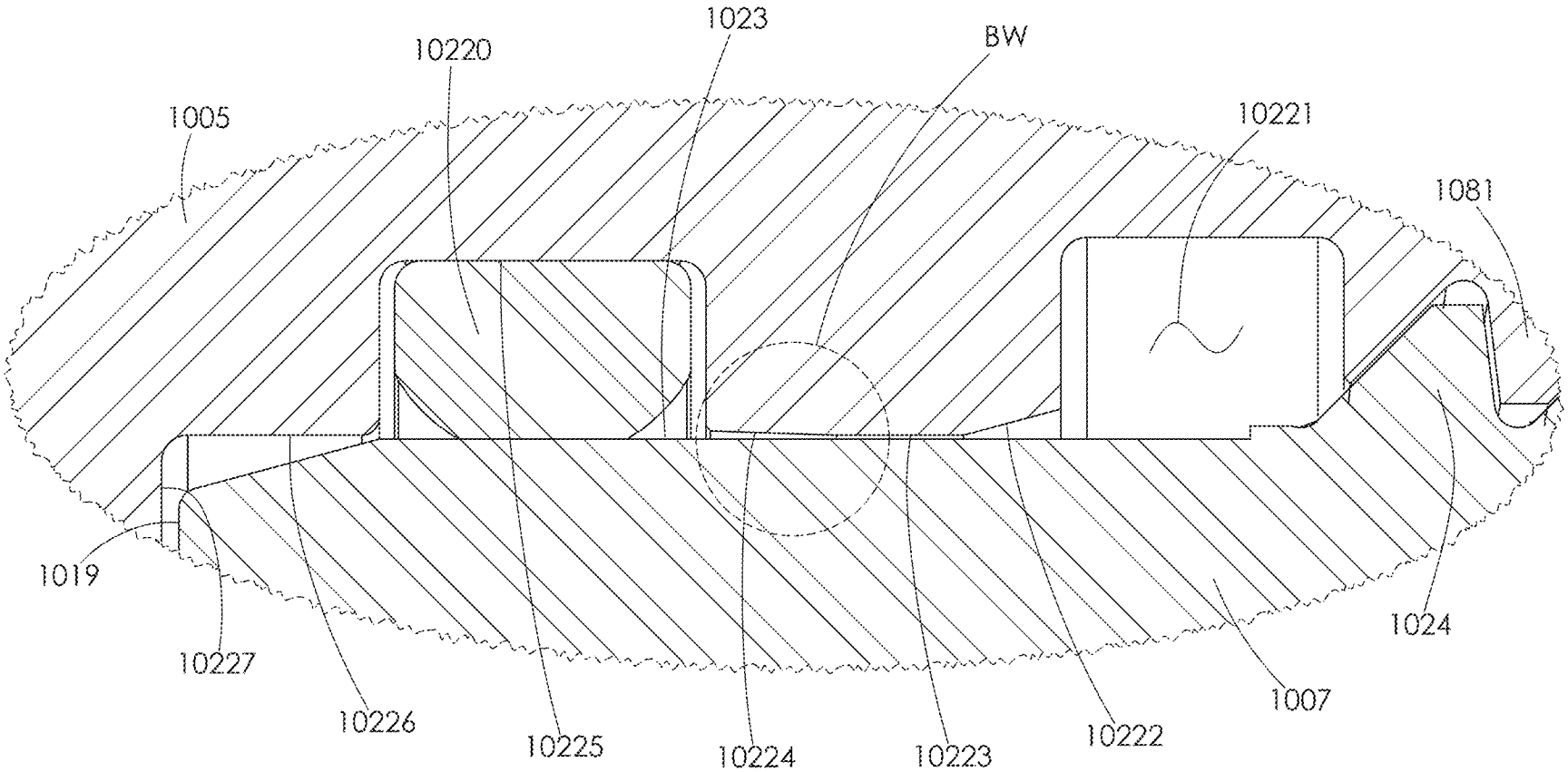

FIG. 181 is an enlarged view of area BV shown in FIG. 178.

Figure 182:
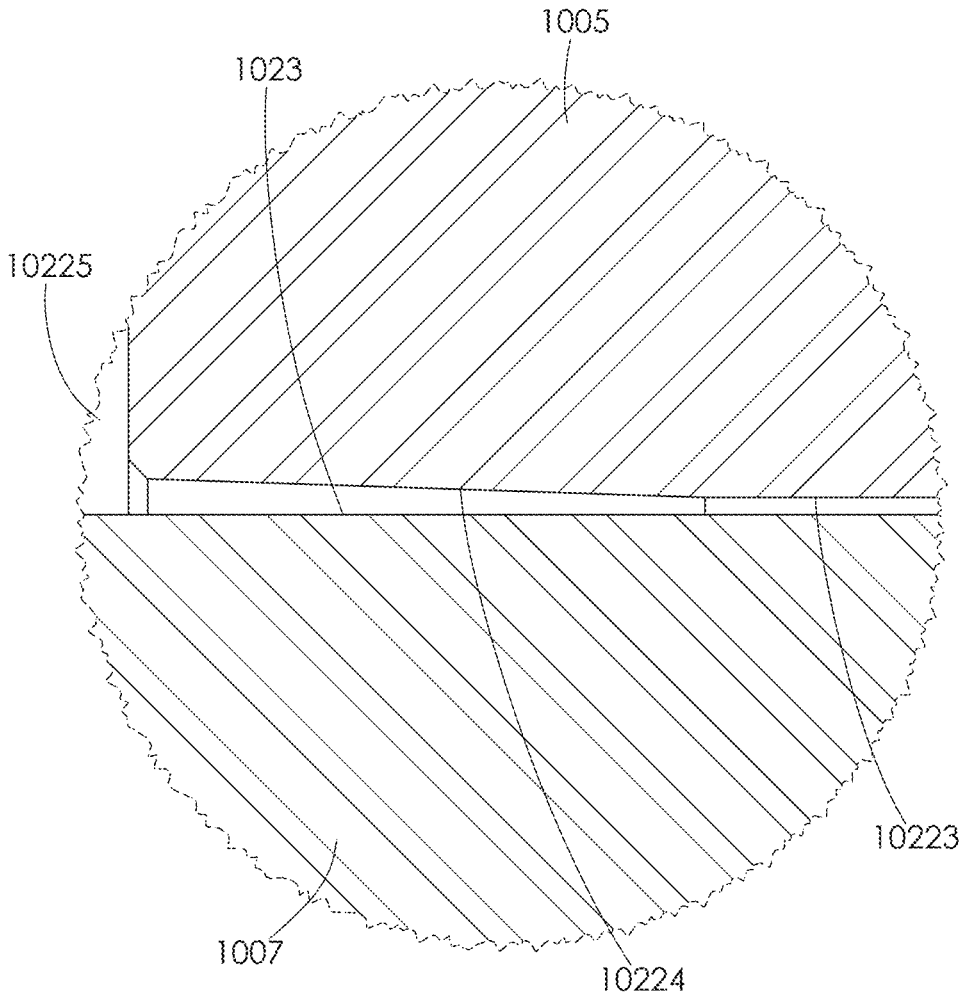

FIG. 182 is an enlarged view of area BW shown in FIG. 181.

Figure 183:
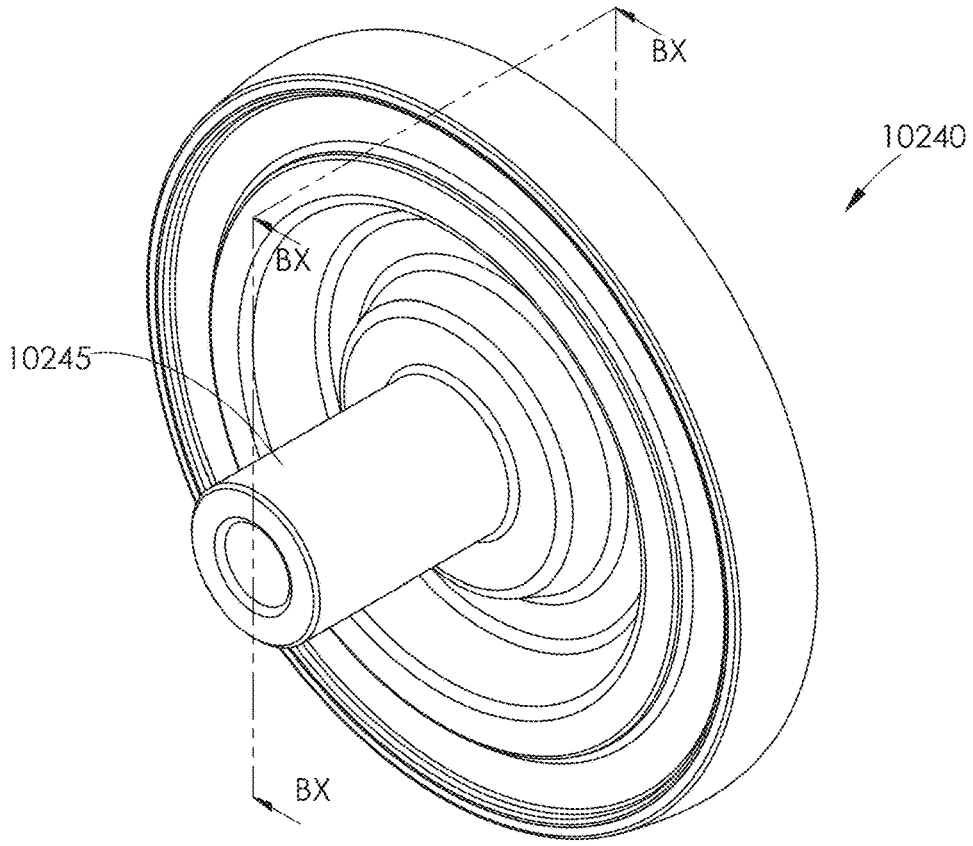

FIG. 183 is an isometric view of a discharge valve used in the multi-piece fluid end shown in FIG. 176.

Figure 184:
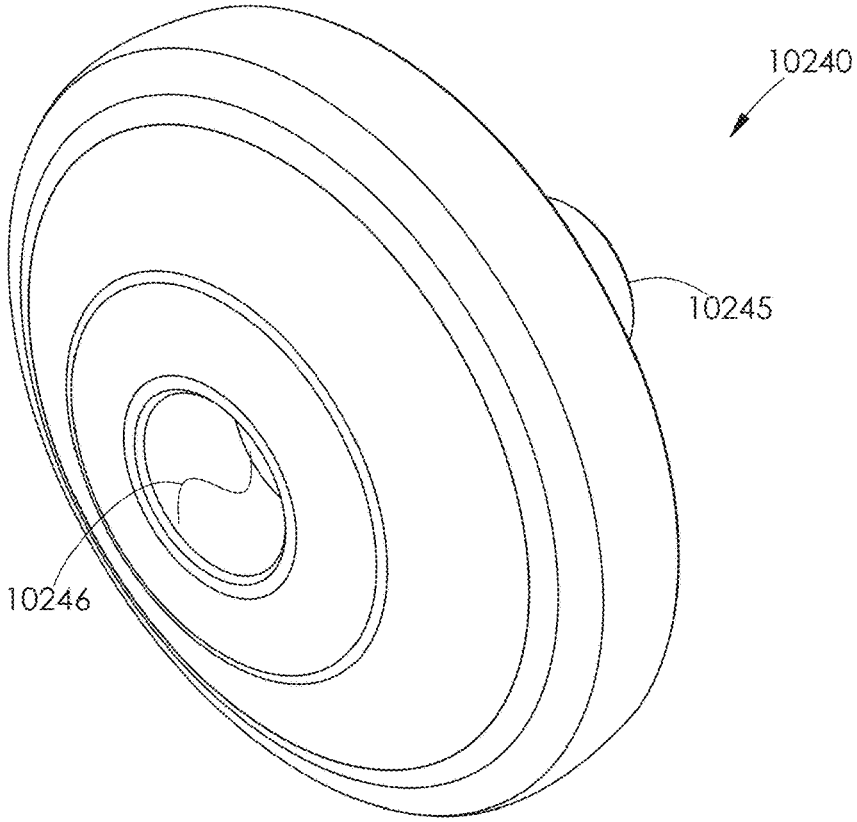

FIG. 184 is a rear isometric view of the discharge valve shown in FIG. 183.

Figure 185:
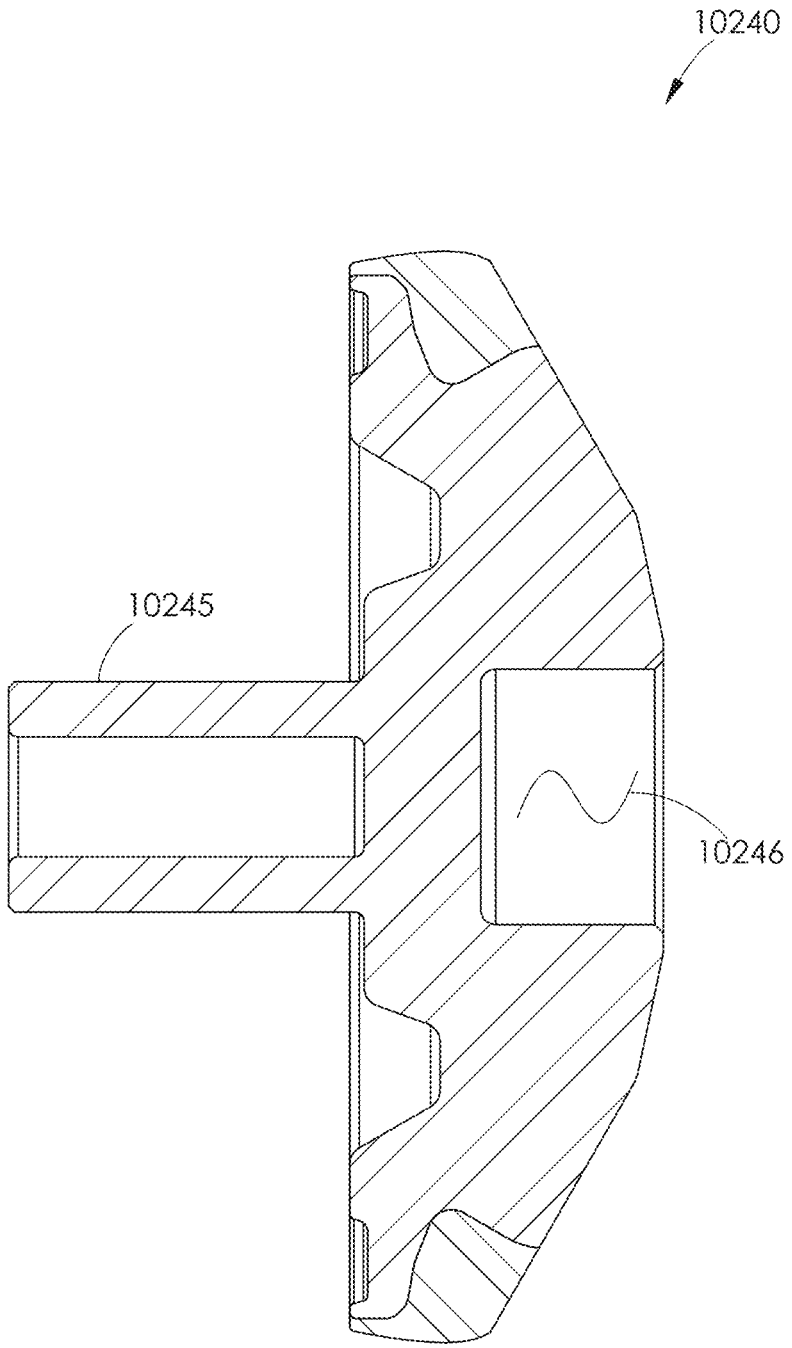

FIG. 185 is a cross-sectional view of the discharge valve shown in FIG. 183, taken along line BX-BX.

Figure 186:
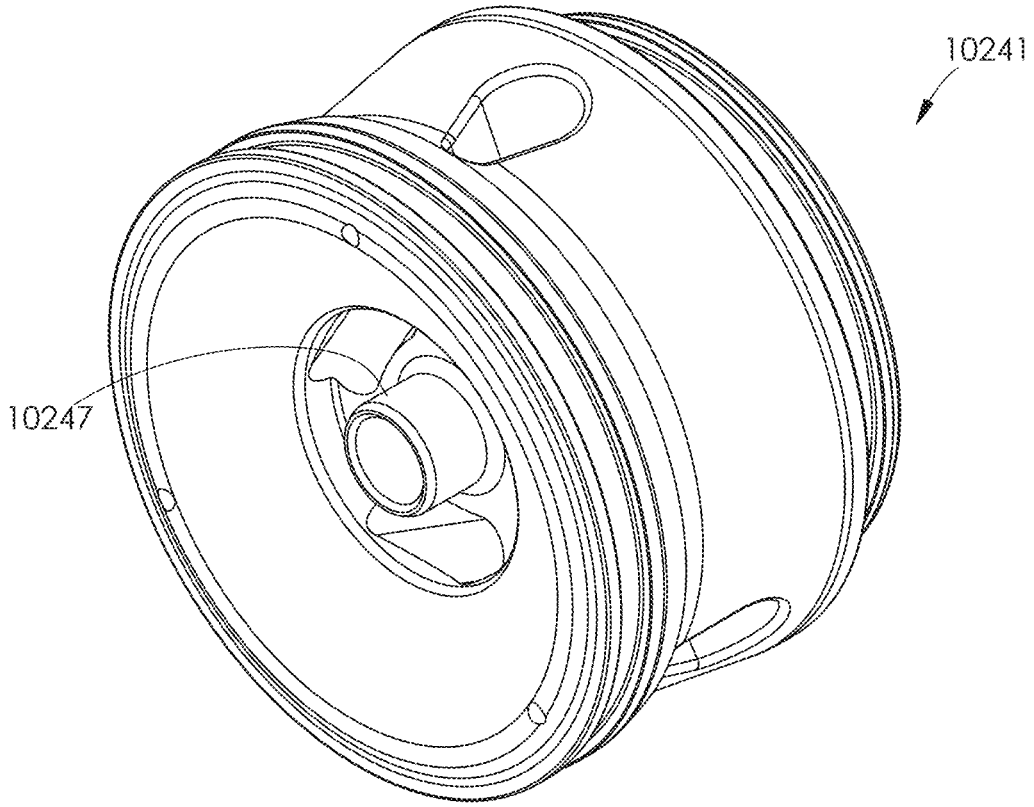

FIG. 186 is an isometric view of a fluid routing plug used in the multi-piece fluid end shown in FIG. 176.

Figure 187:
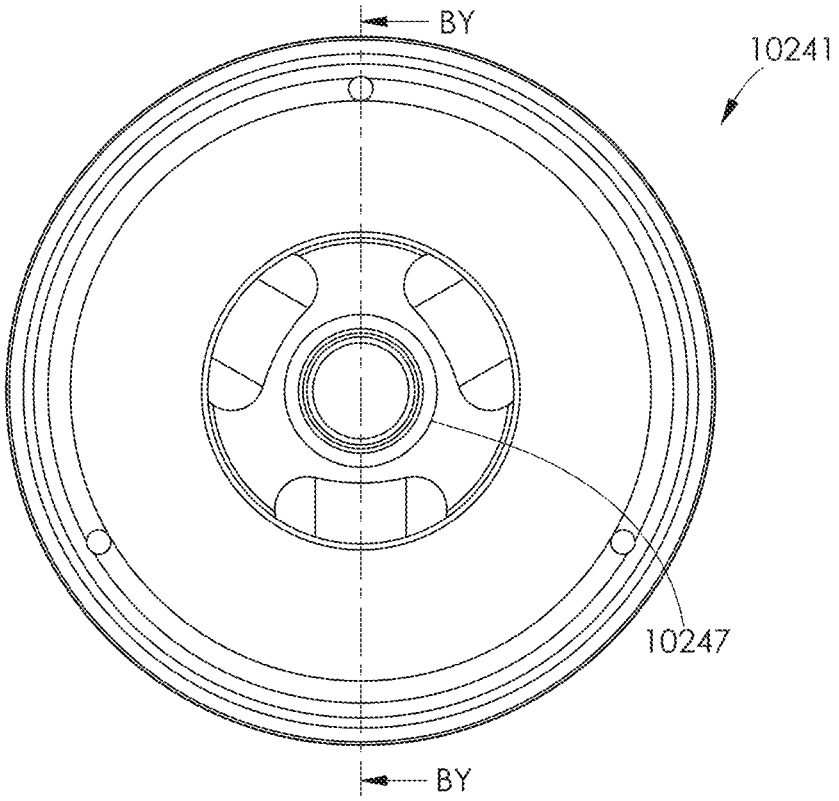

FIG. 187 is a front elevation view of the fluid routing plug shown in FIG. 186.

Figure 188:
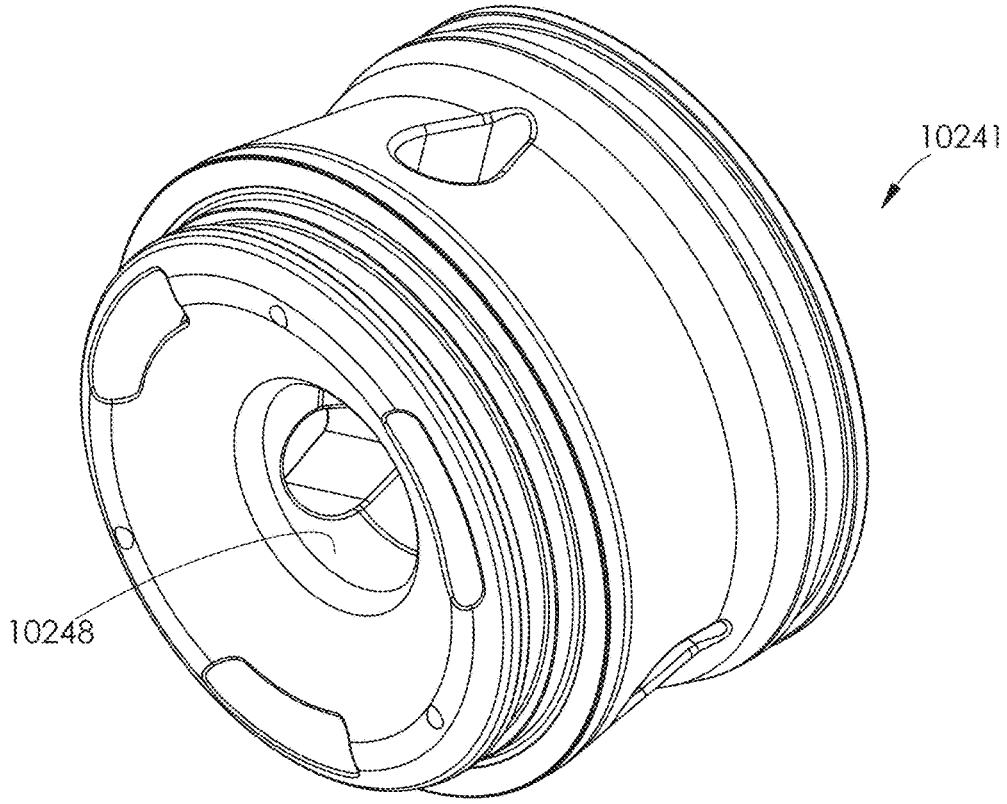

FIG. 188 is a rear isometric view of the fluid routing plug shown in FIG. 186.

Figure 189:
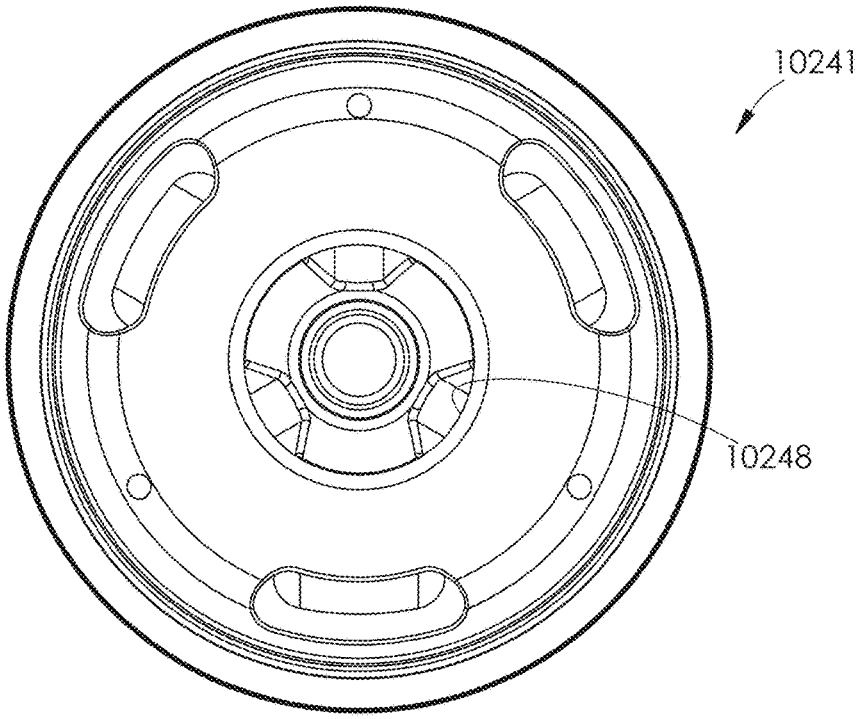

FIG. 189 is a rear elevation view of the fluid routing plug shown in FIG. 186.

Figure 190:
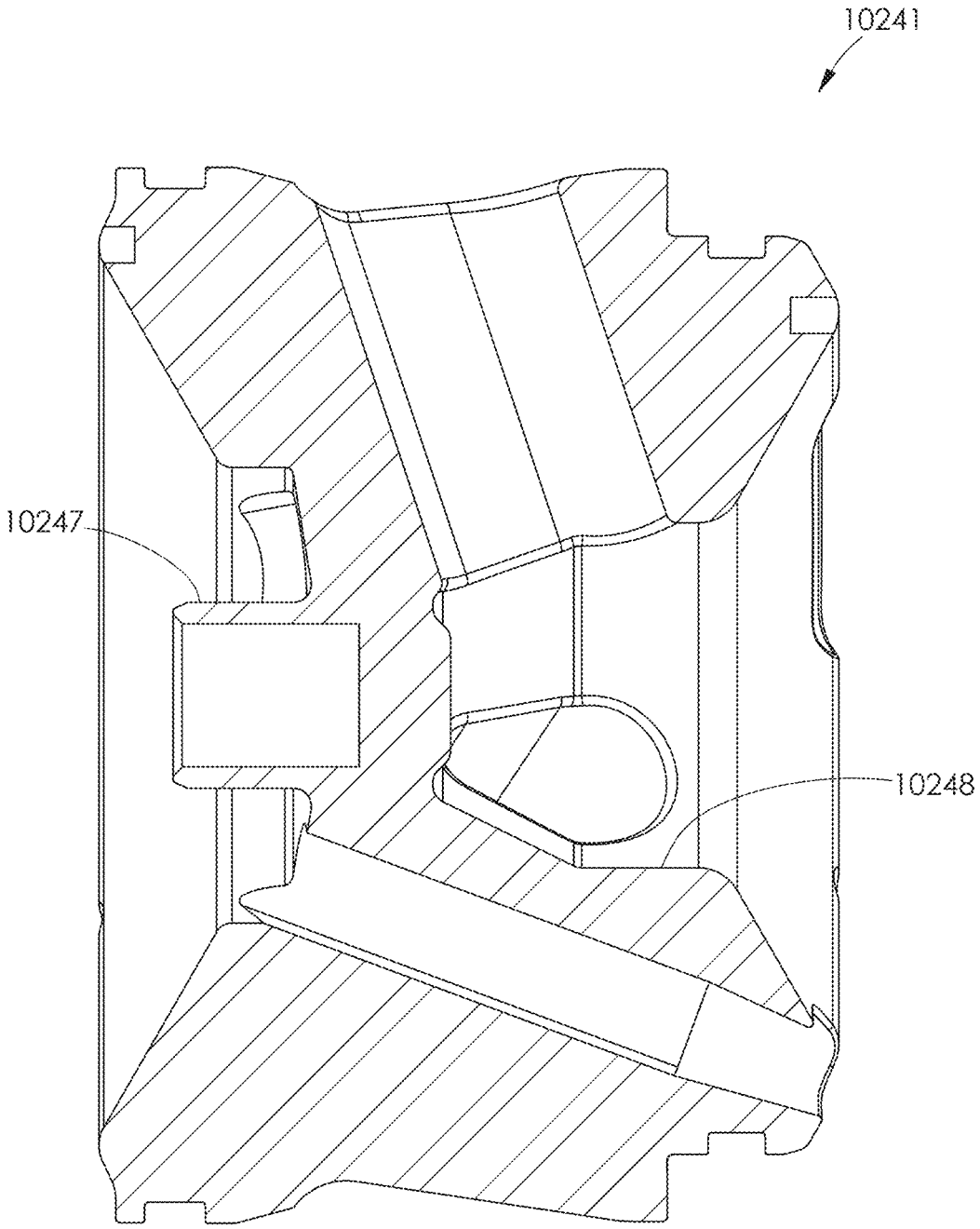

FIG. 190 is a cross-sectional view of the fluid routing plug shown in FIG. 187, taken along line BY-BY.

Figure 191:
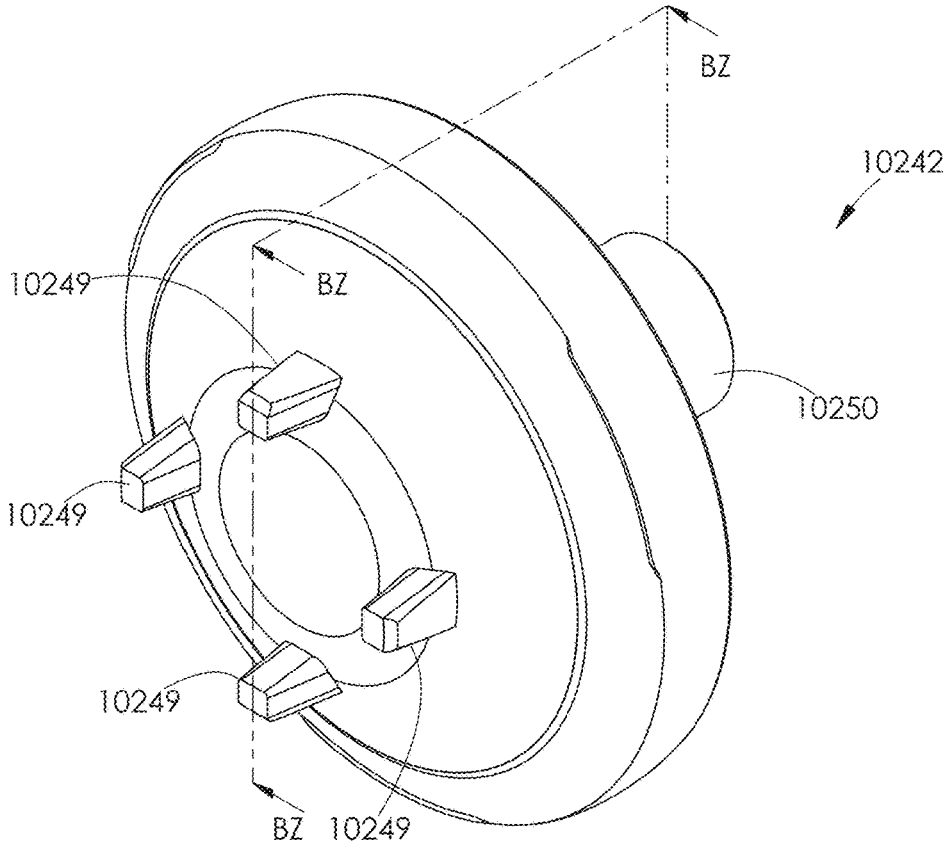

FIG. 191 is an isometric view of a suction valve used in the multi-piece fluid end shown in FIG. 176.

Figure 192:
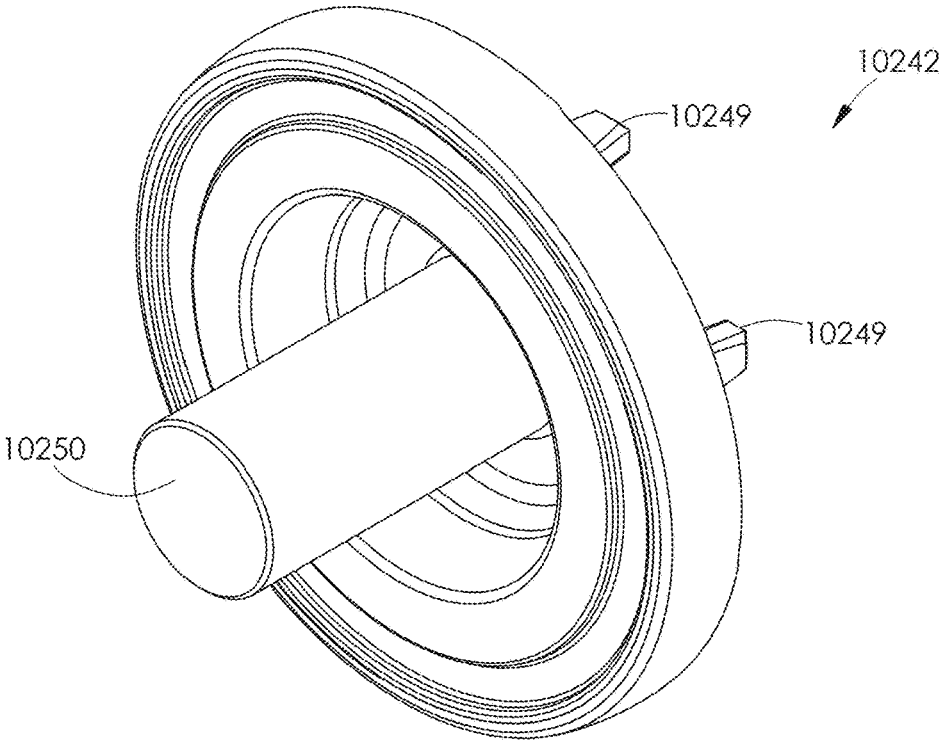

FIG. 192 is a rear isometric view of the suction valve shown in FIG. 191.

Figure 193:
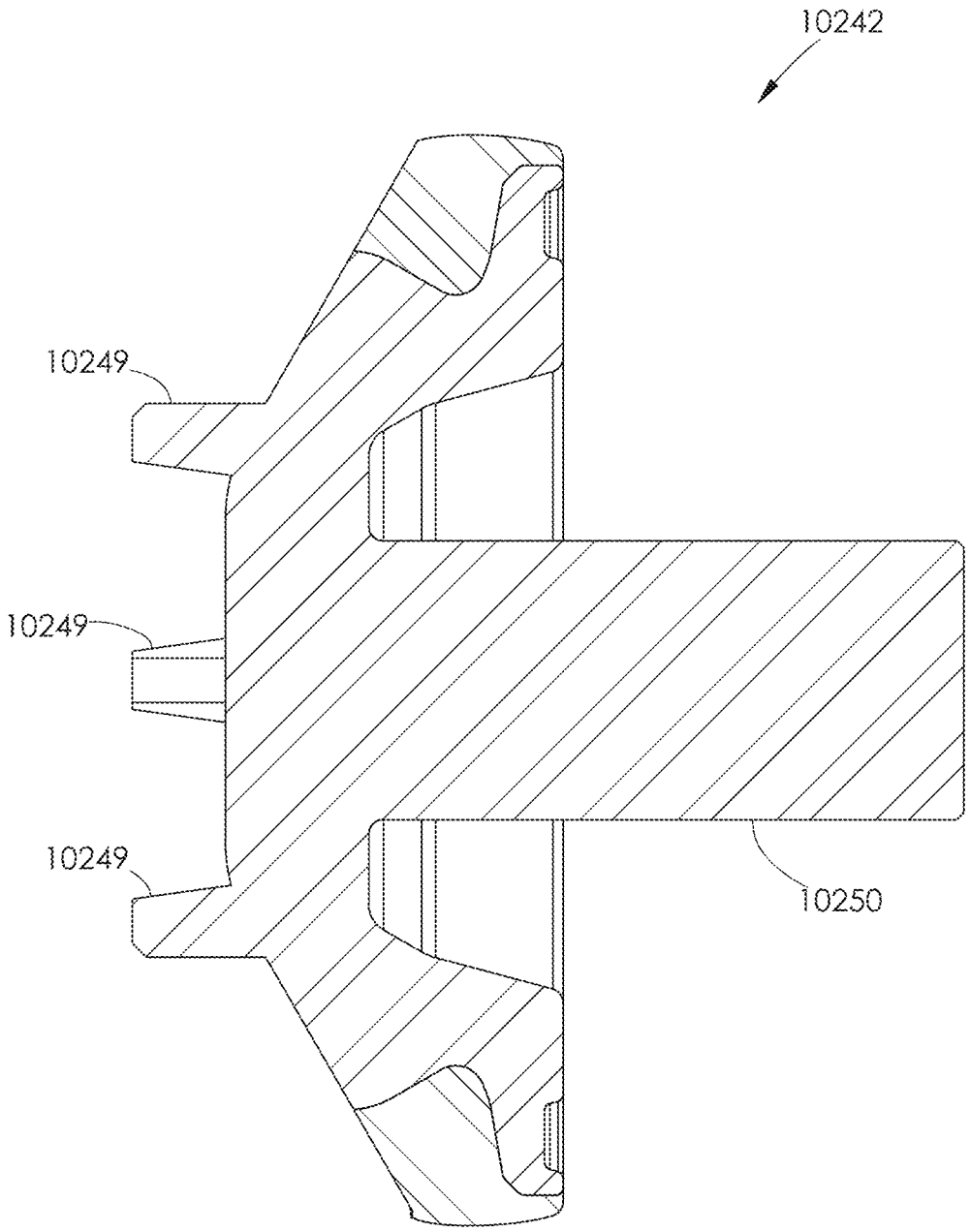

FIG. 193 is a cross-sectional view of the suction valve shown in FIG. 191, taken along line BZ-BZ.

Figure 194:
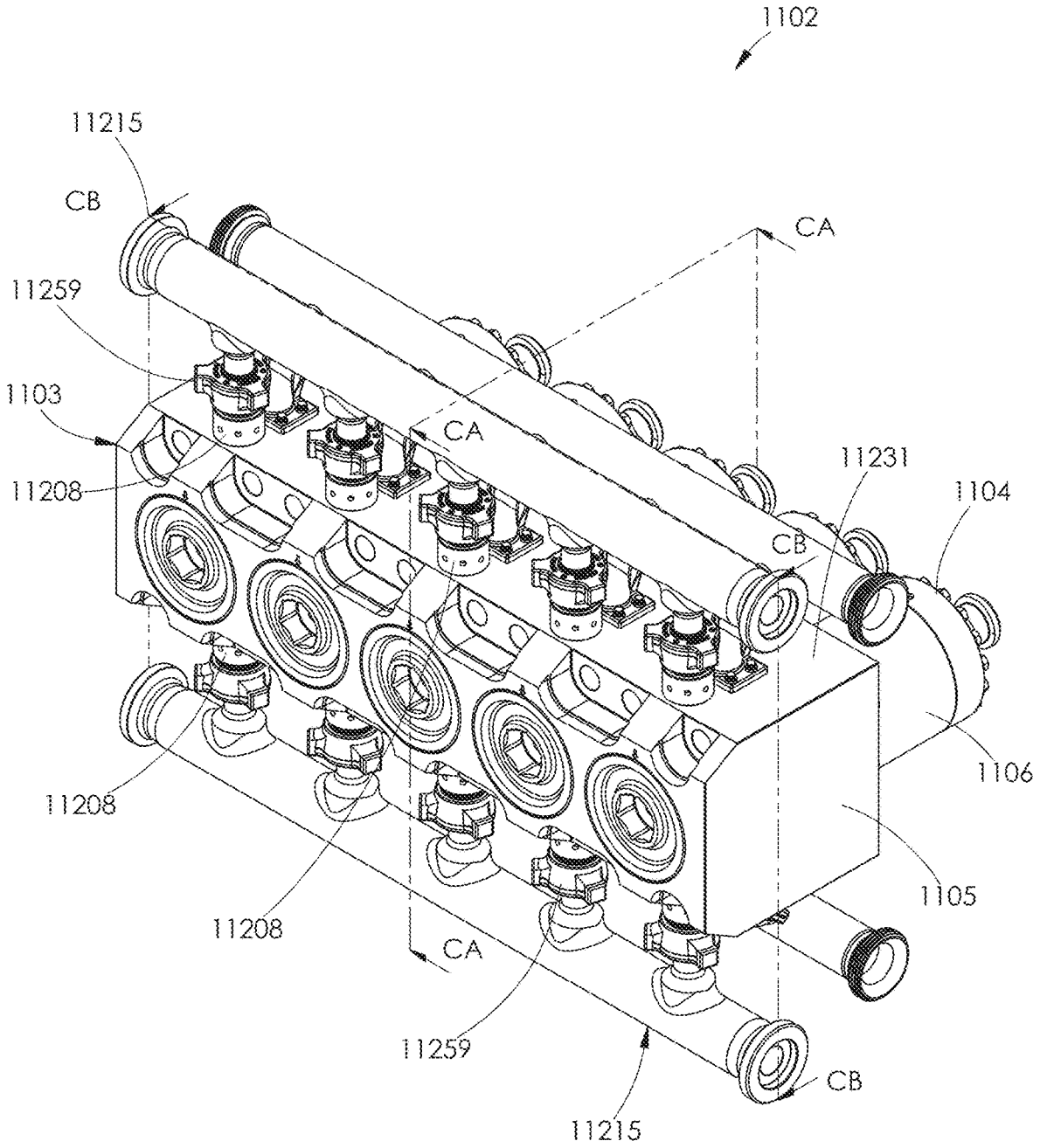

FIG. 194 is an isometric view of another embodiment of a multi-piece fluid end.

Figure 195:
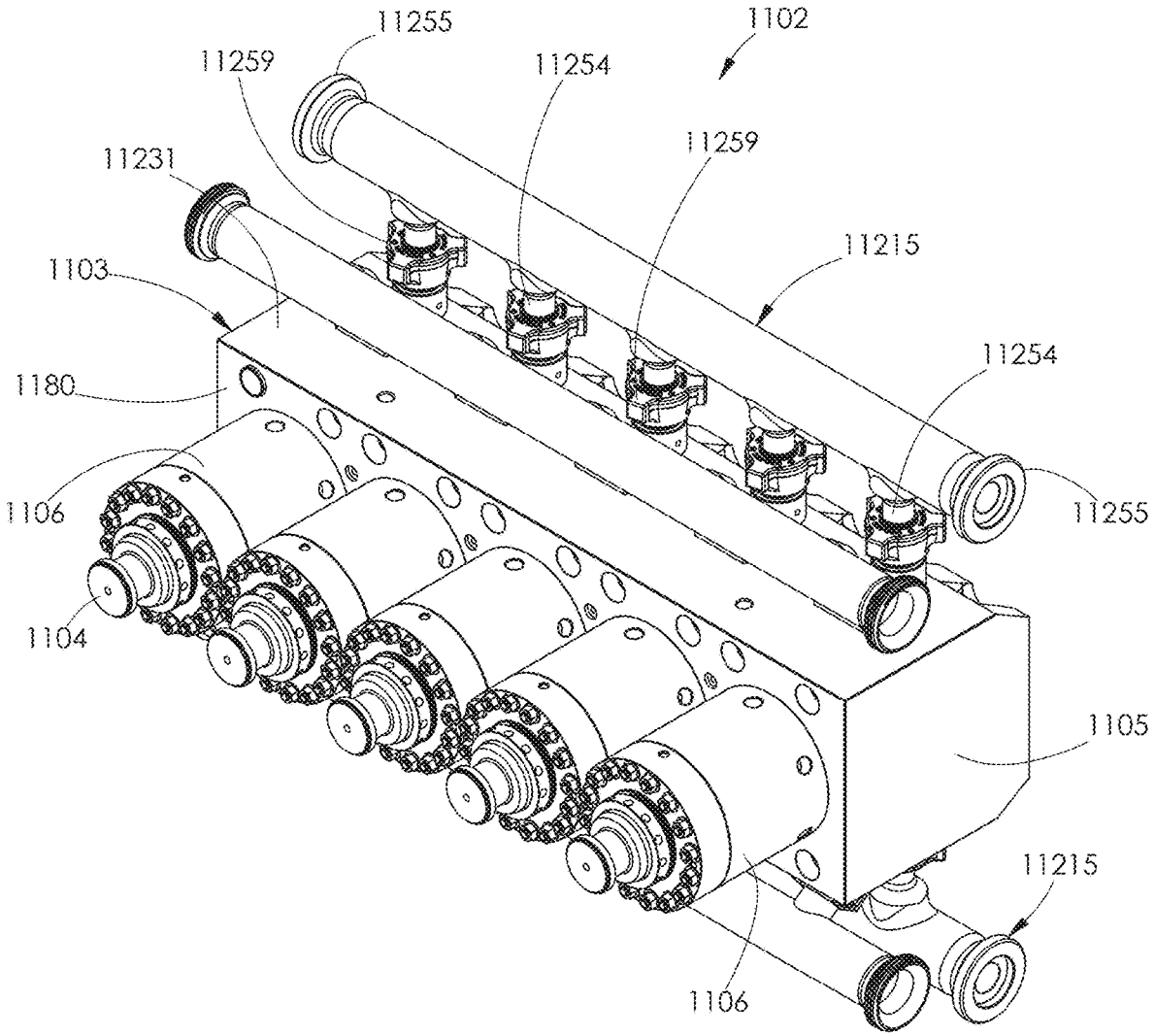

FIG. 195 is a rear isometric view of the multi-piece fluid end shown in FIG. 194.

Figure 196:
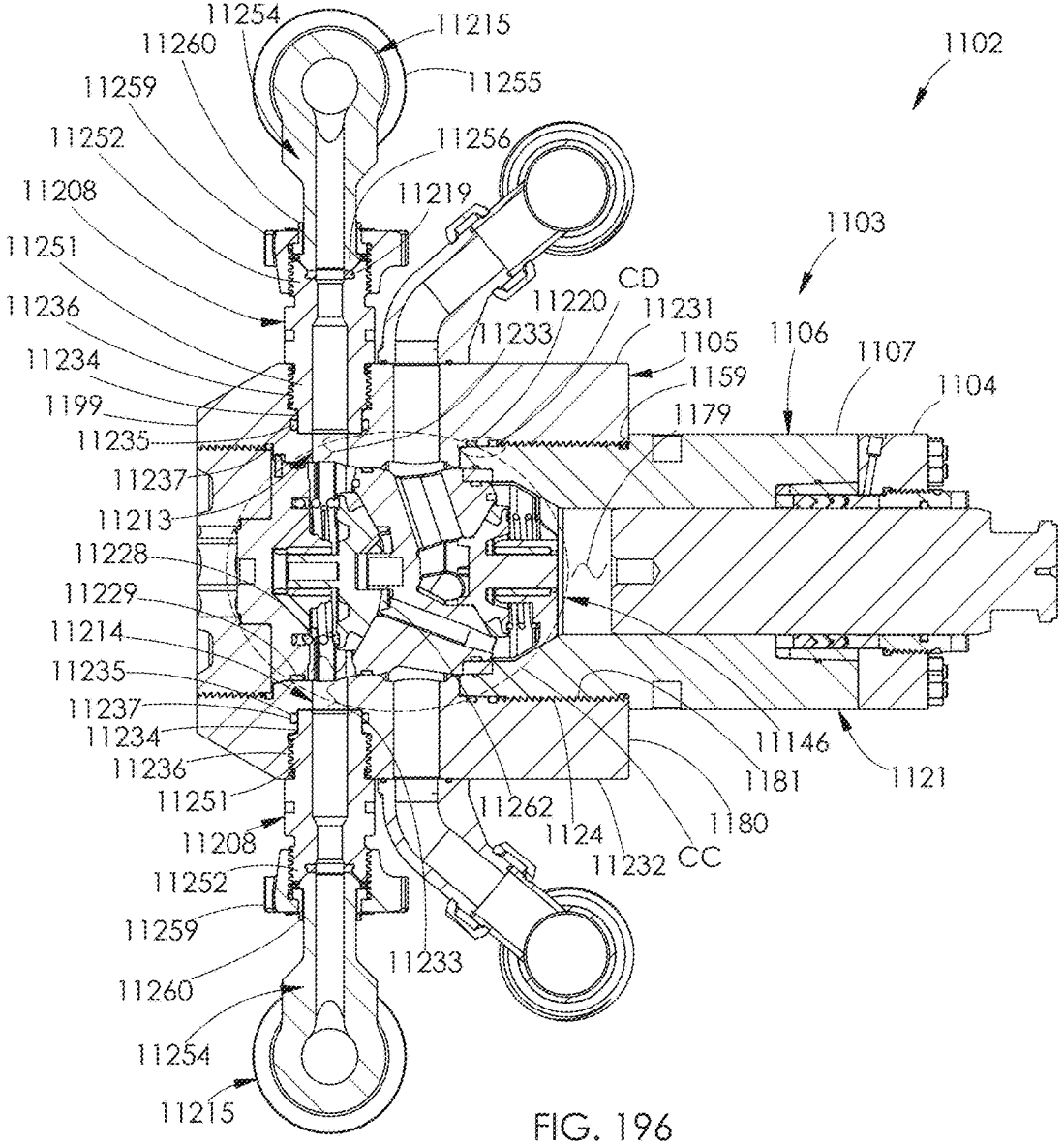

FIG. 196 is a cross-sectional view of the multi-piece fluid end shown in FIG. 194, taken along line CA-CA.

Figure 197:
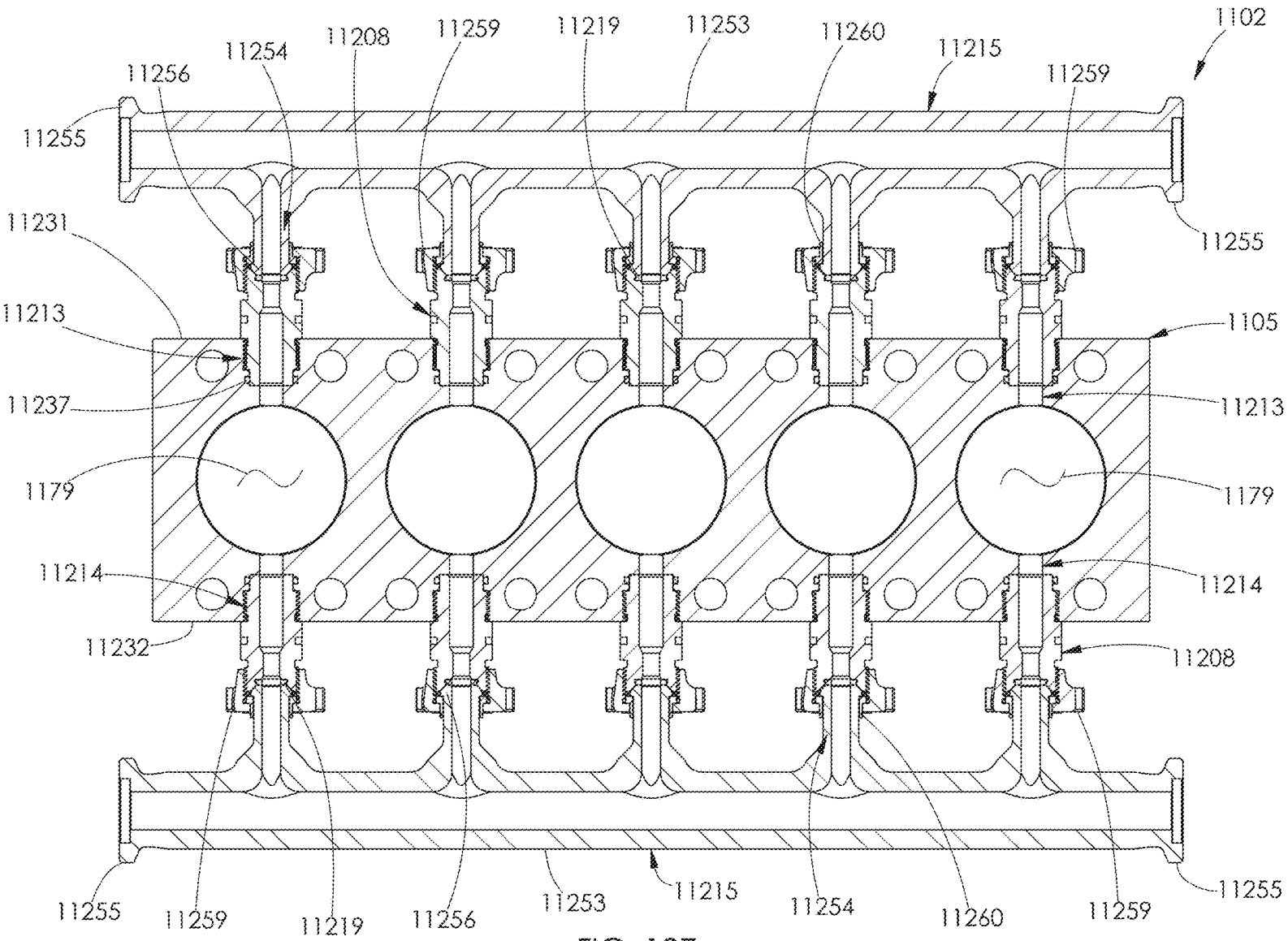

FIG. 197 is a cross-sectional view of the multi-piece fluid end shown in FIG. 194, taken along line CB-CB.

Figure 198:
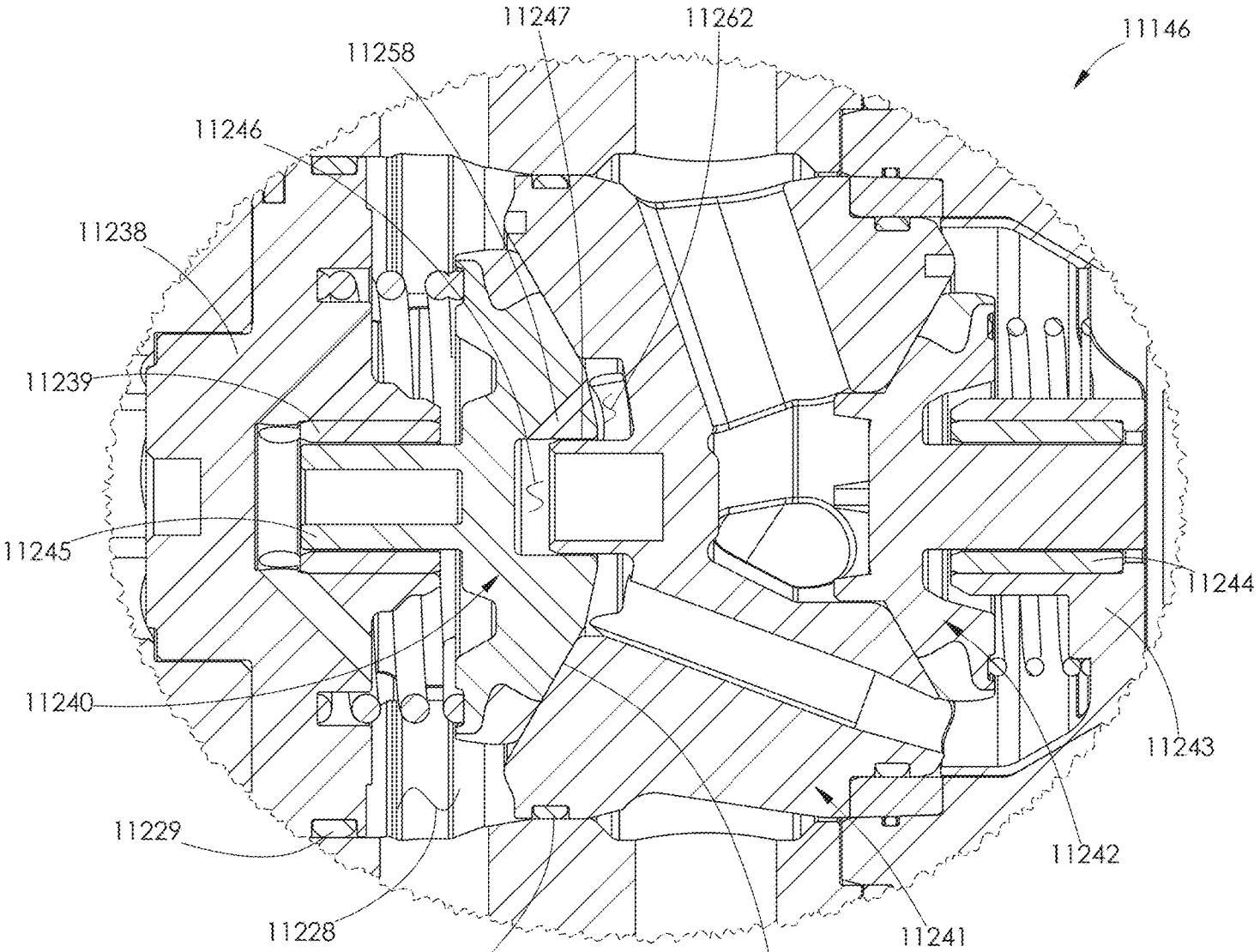

FIG. 198 is an enlarged view of area CC shown in FIG. 196.

Figure 199:
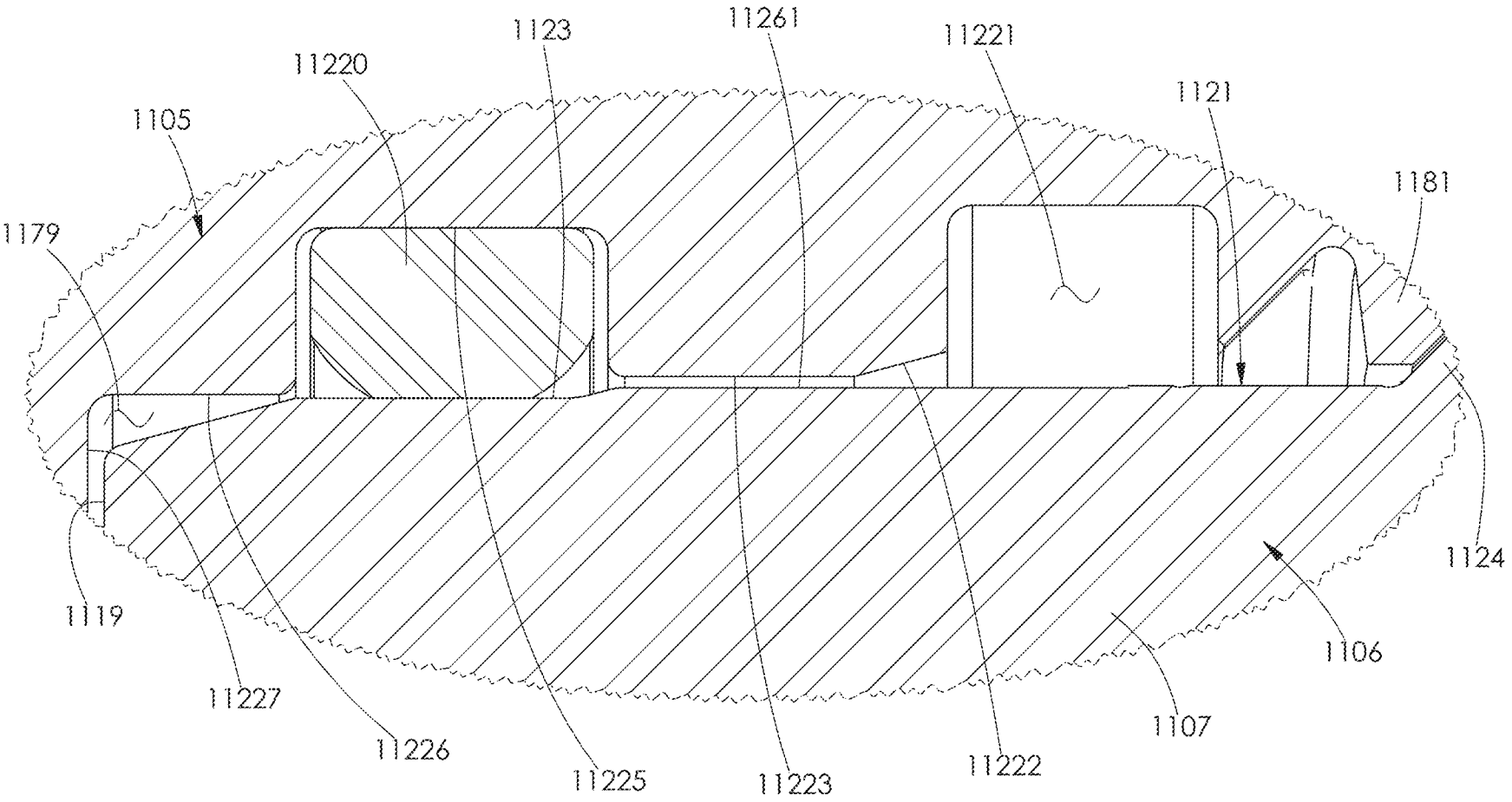

FIG. 199 is an enlarged view of area CD shown in FIG. 196.

Figure 200:
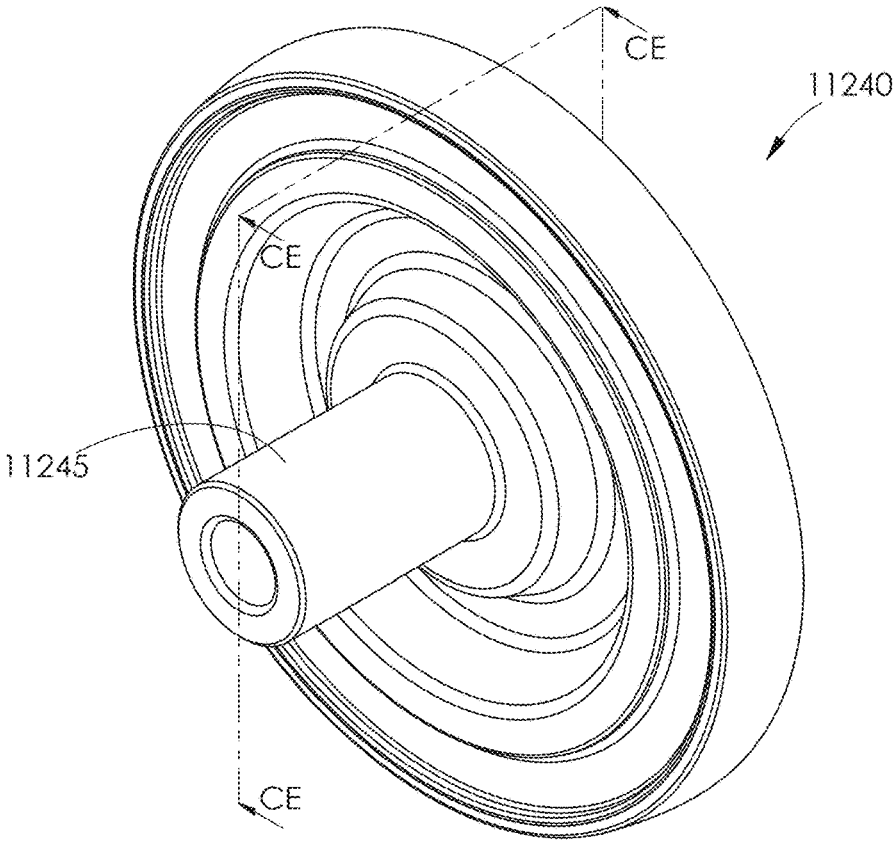

FIG. 200 is an isometric view of a discharge valve used in the multi-piece fluid end shown in FIG. 194.

Figure 201:
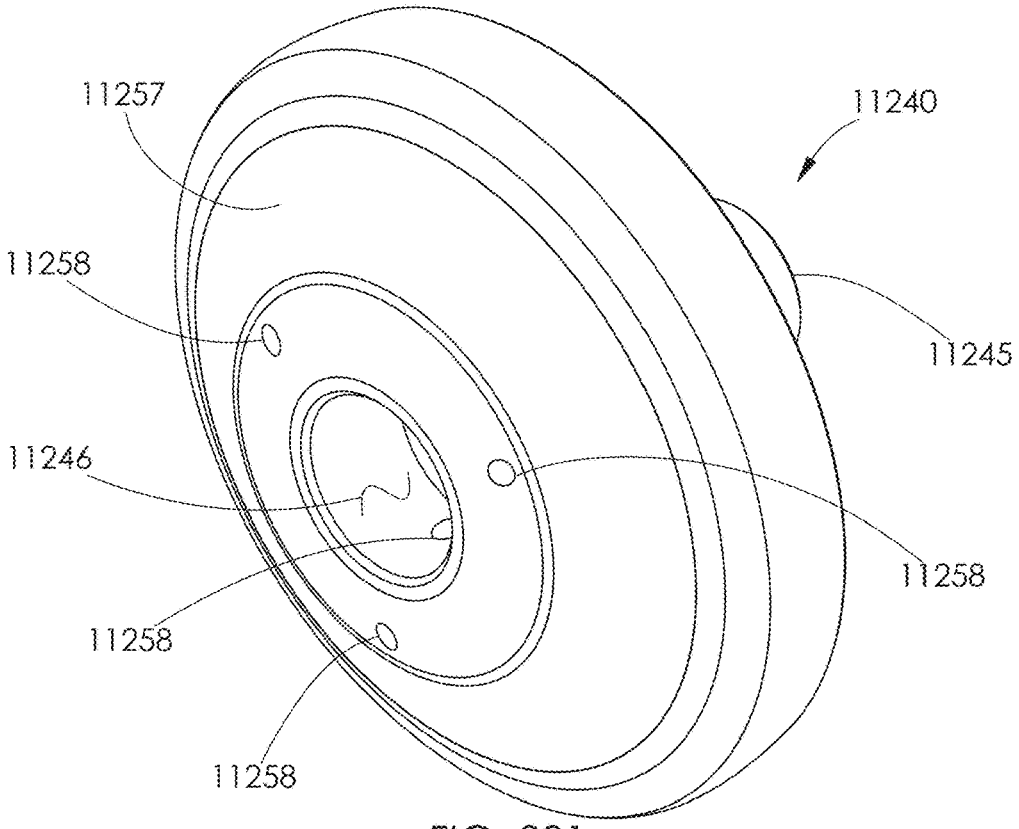

FIG. 201 is a rear isometric view of the discharge valve shown in FIG. 200.

Figure 202:
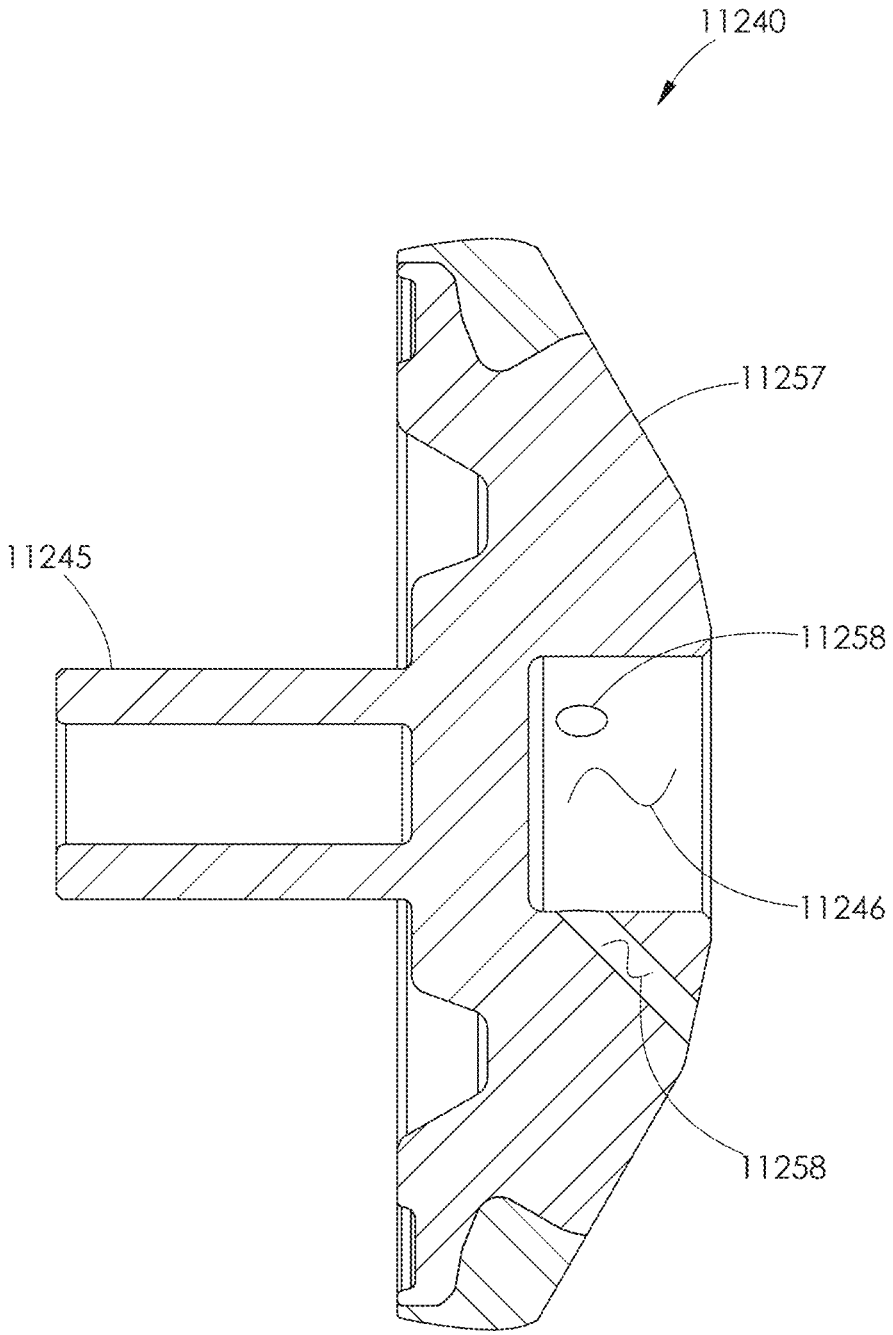

FIG. 202 is a cross-sectional view of the discharge valve shown in FIG. 200, taken along line CE-CE.

Figure 203:
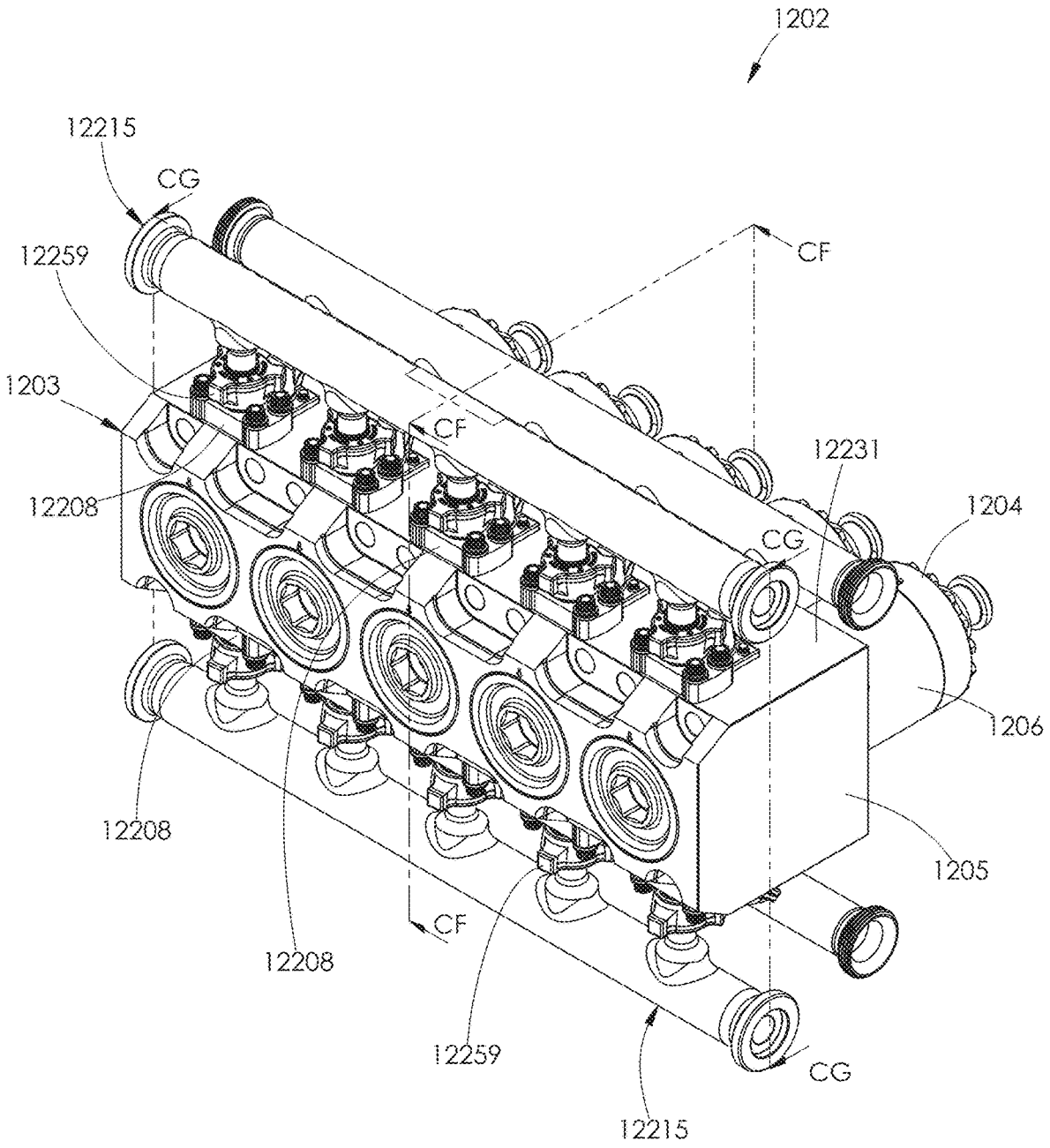

FIG. 203 is an isometric view of another embodiment of a multi-piece fluid end.

Figure 204:
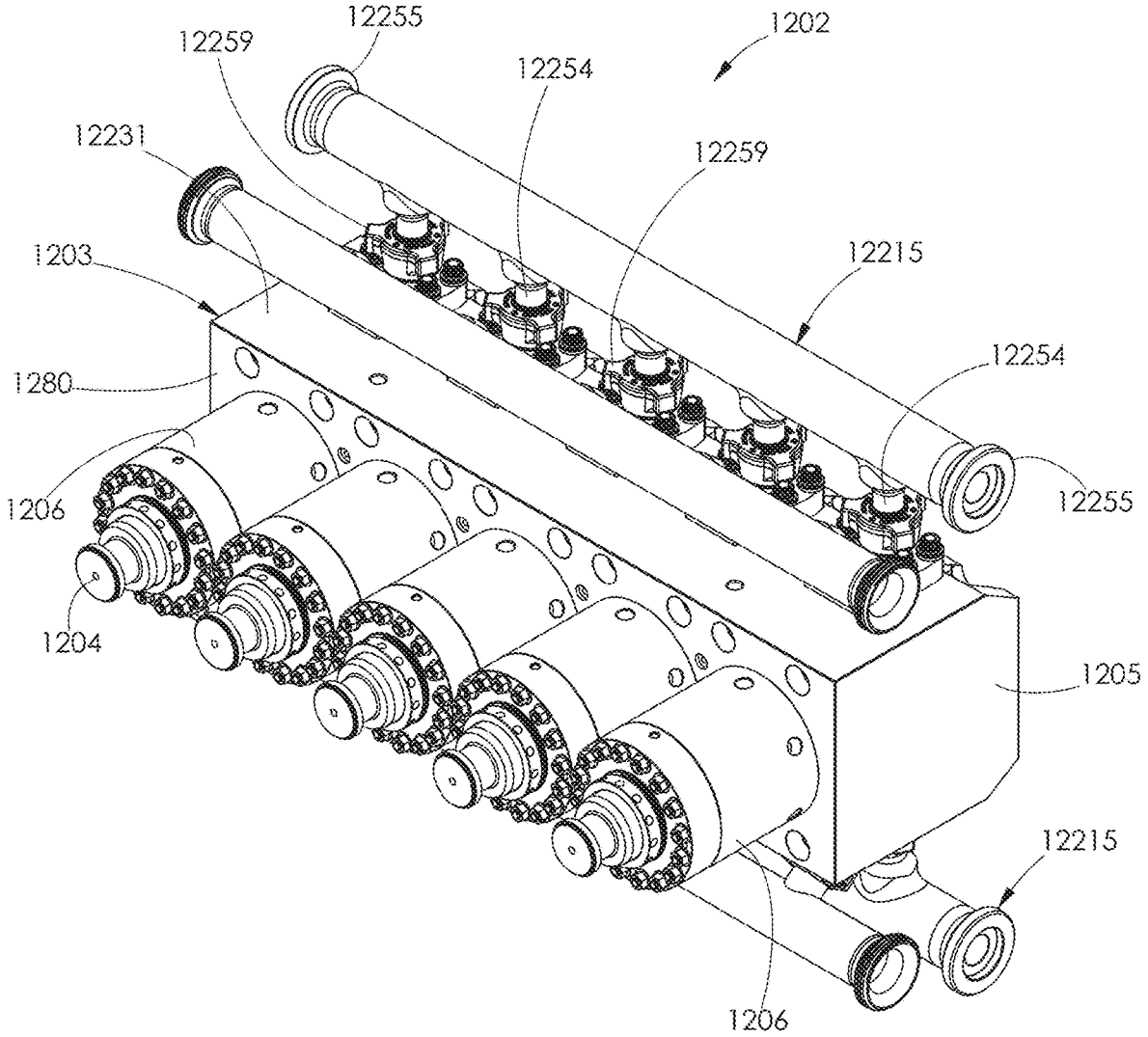

FIG. 204 is a rear isometric view of the multi-piece fluid end shown in FIG. 203.

Figure 205:
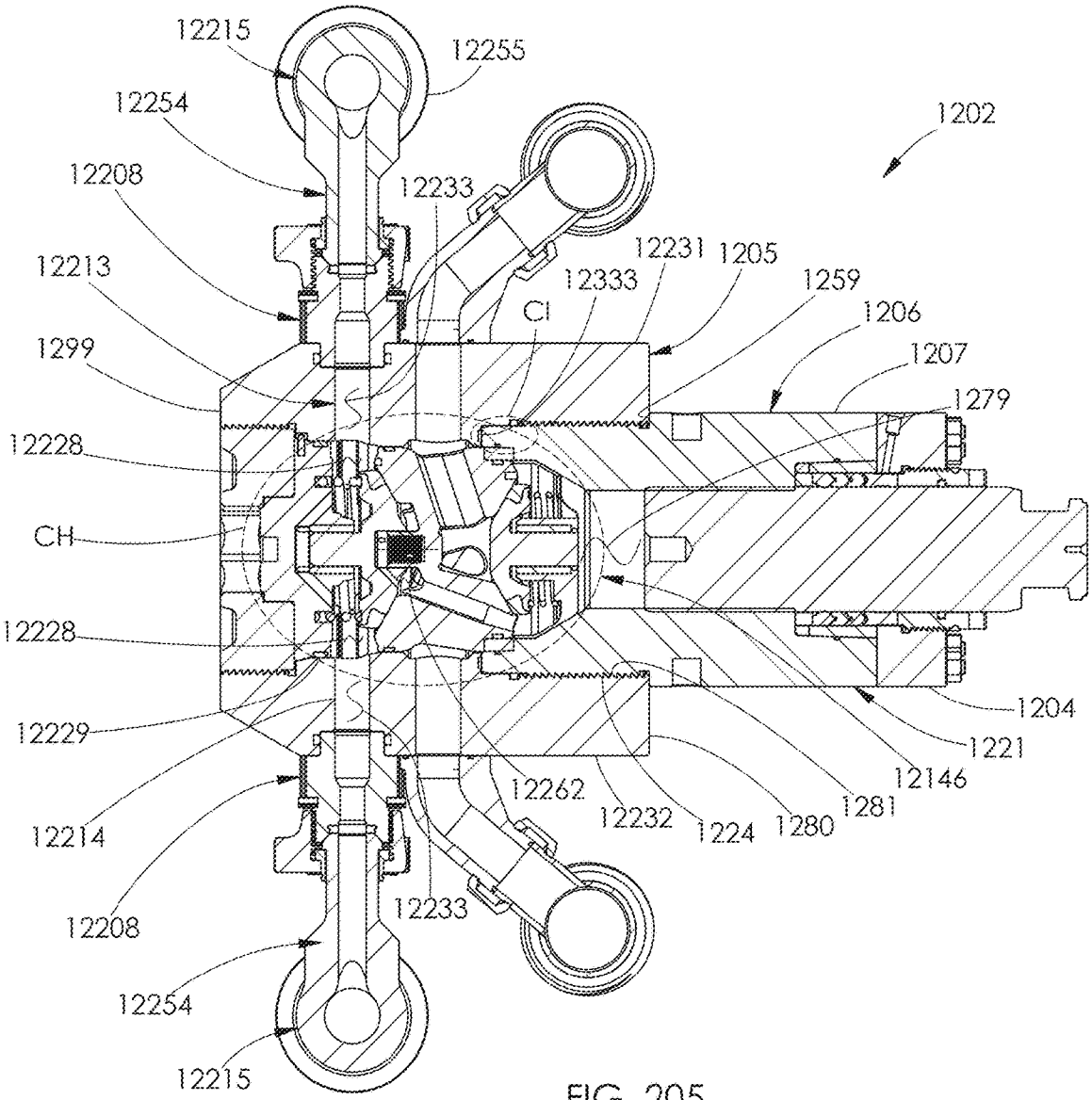

FIG. 205 is a cross-sectional view of the multi-piece fluid end shown in FIG. 203, taken along line CF-CF.

Figure 206:
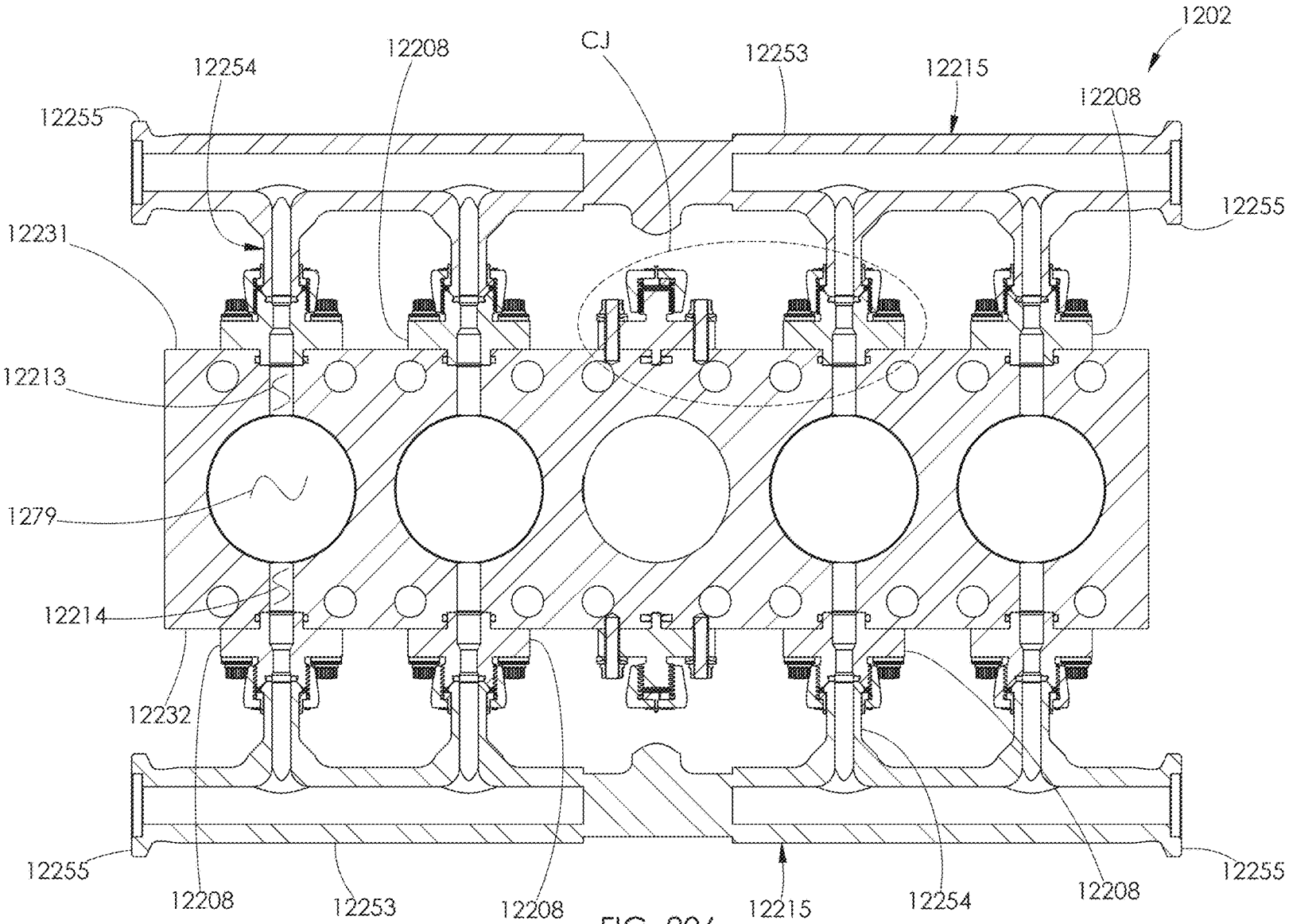

FIG. 206 is an offset cross-sectional view of the multi-piece fluid end shown in FIG. 203, taken along line CG-CG.

Figure 207:
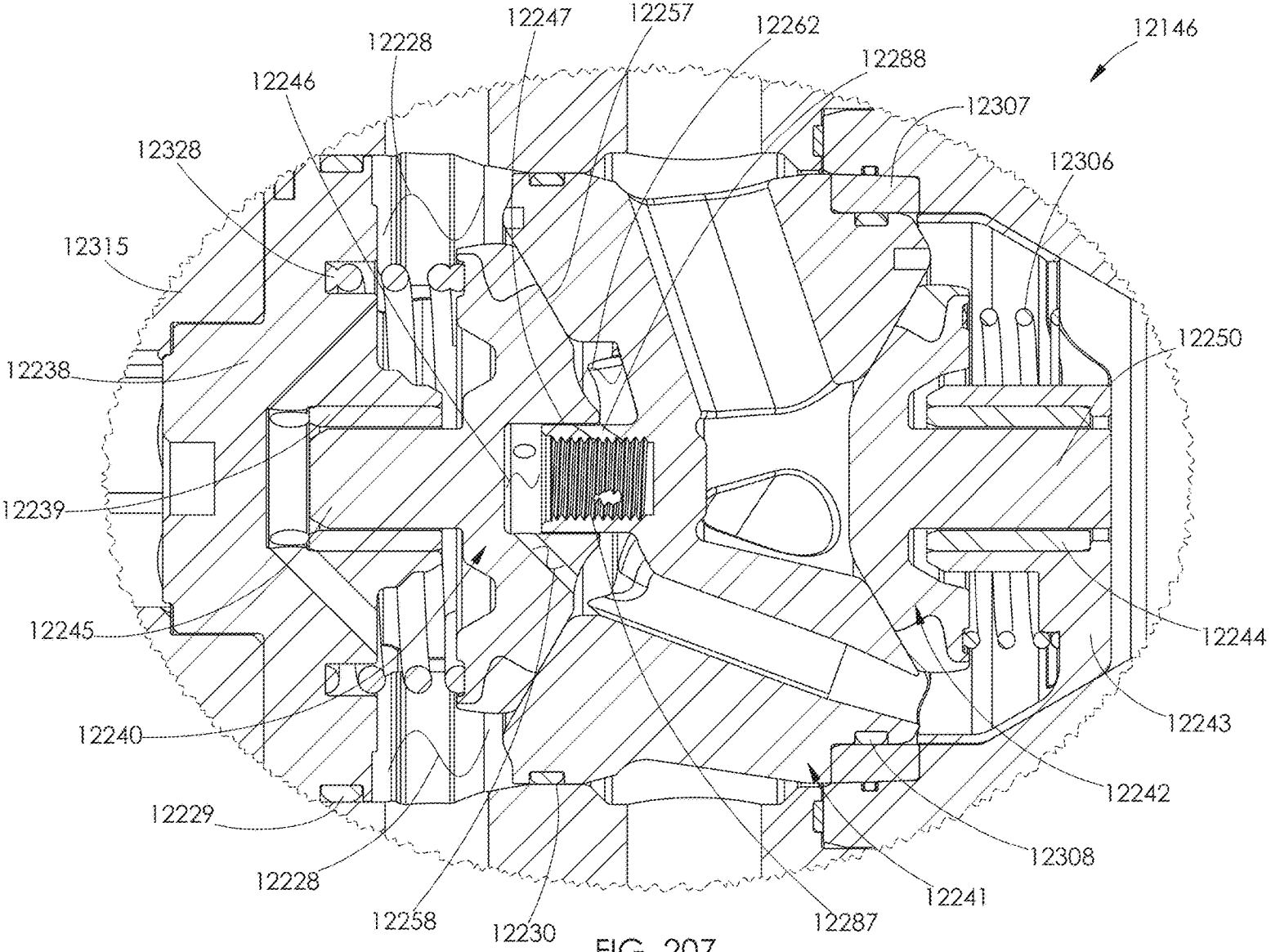

FIG. 207 is an enlarged view of area CH shown in FIG. 205.

Figure 208:
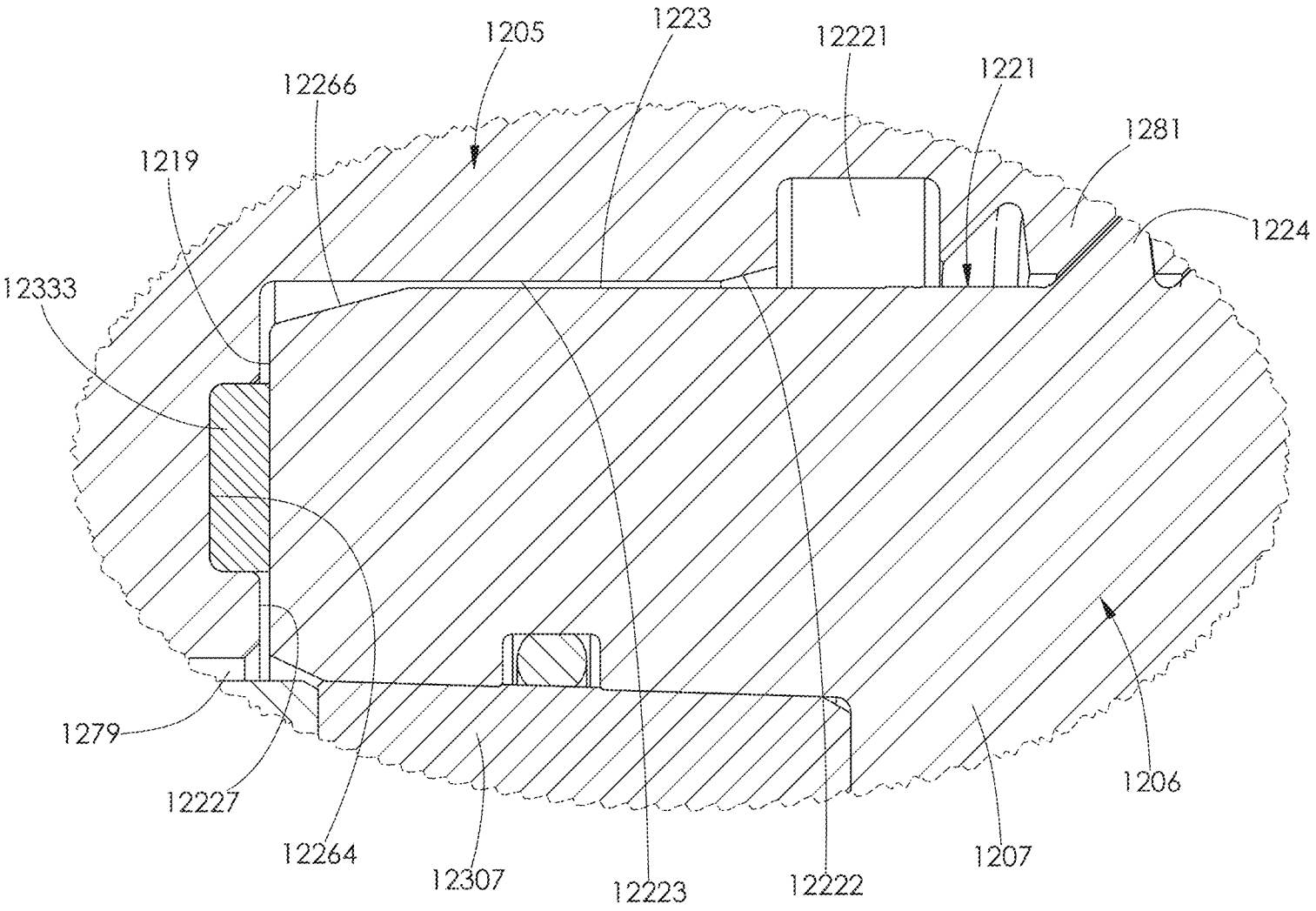

FIG. 208 is an enlarged view of area CI shown in FIG. 205.

Figure 209:
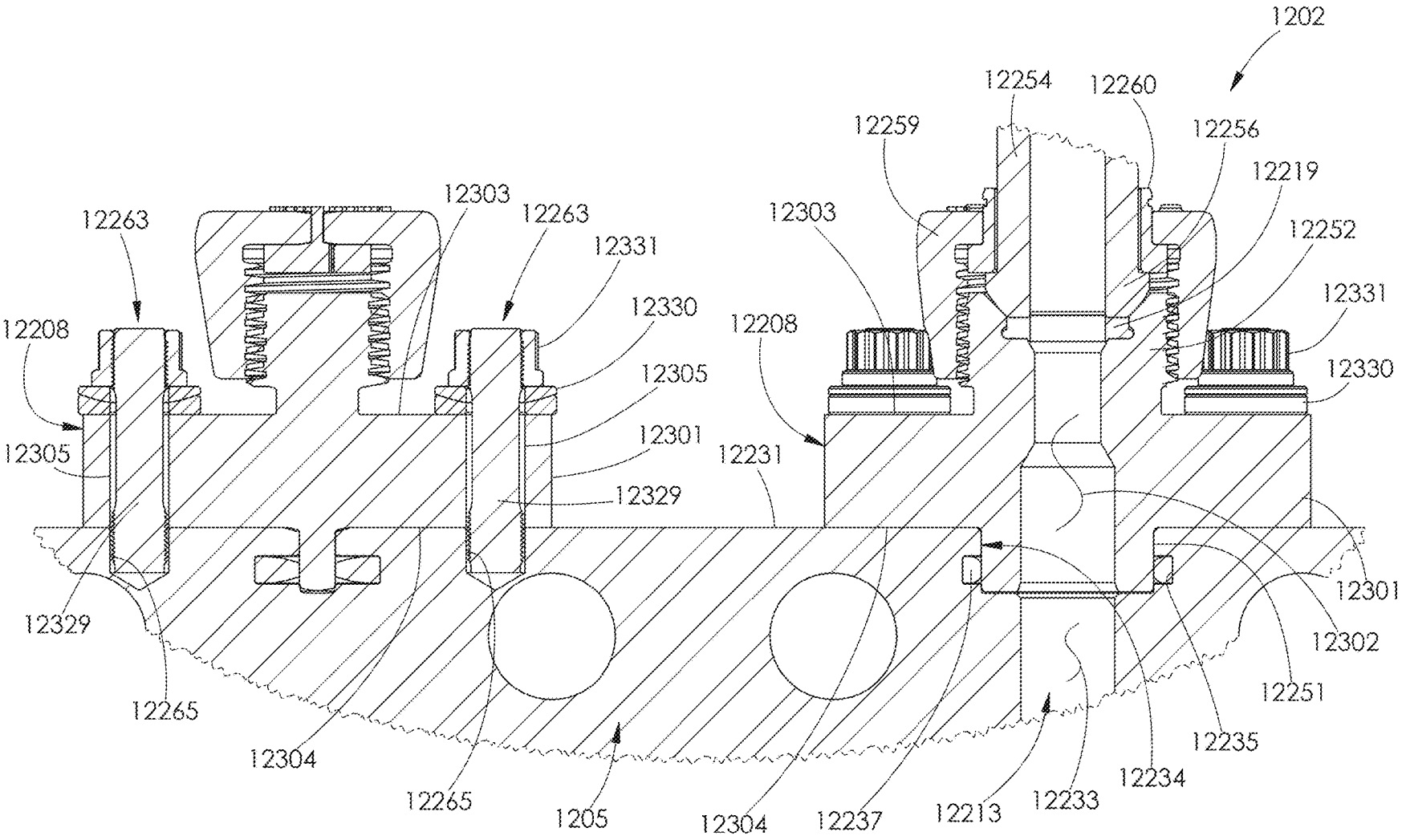

FIG. 209 is an enlarged view of area CJ shown in FIG. 206.

Figure 210:
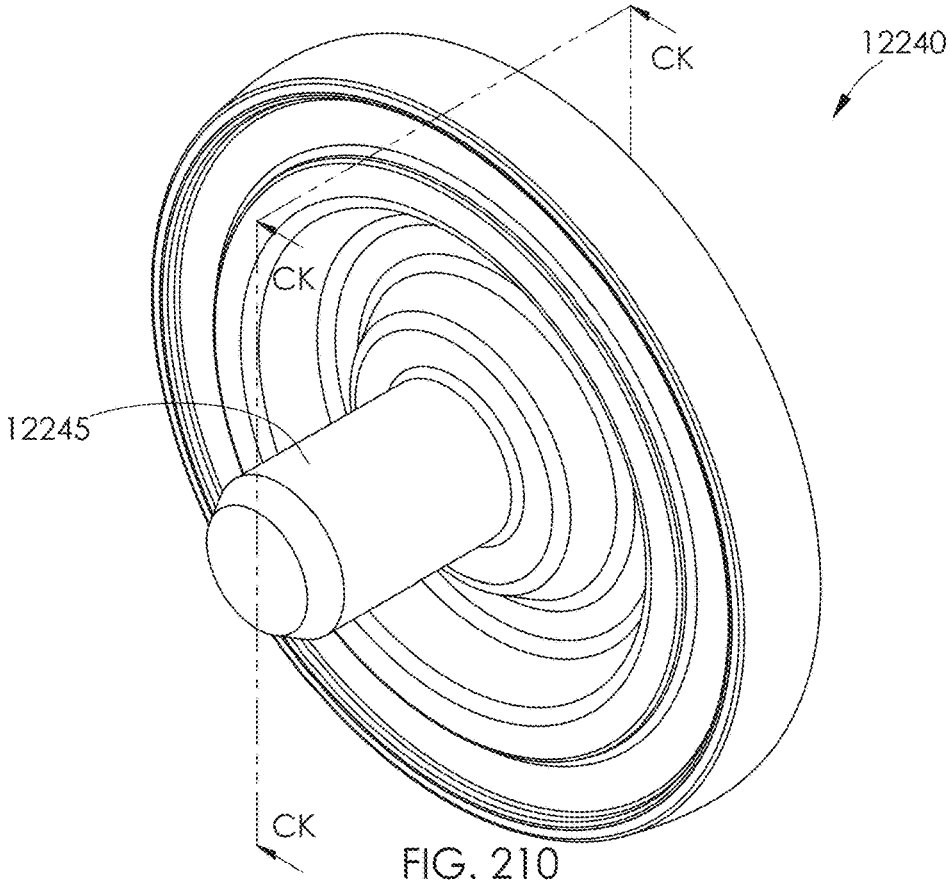

FIG. 210 is an isometric view of a discharge valve used in the multi-piece fluid end shown in FIG. 203.

Figure 211:
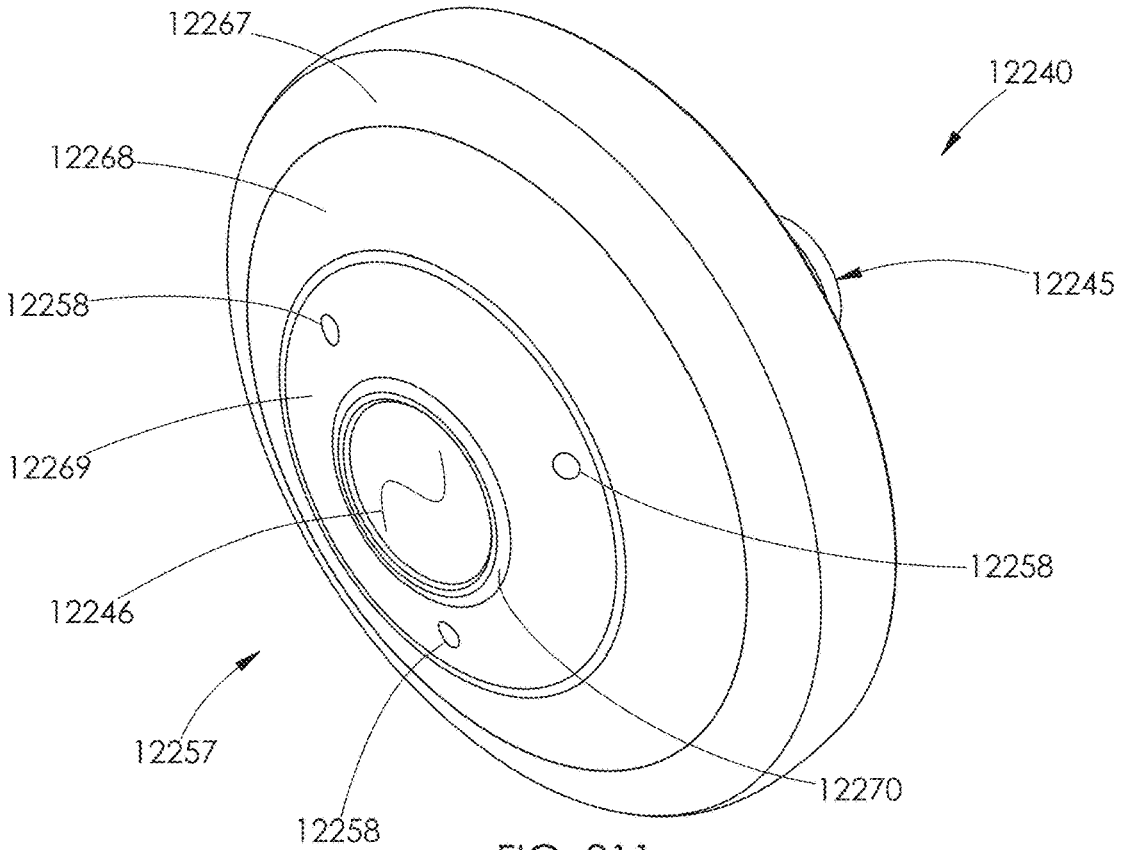

FIG. 211 is a rear isometric view of the discharge valve shown in FIG. 210.

Figure 212:
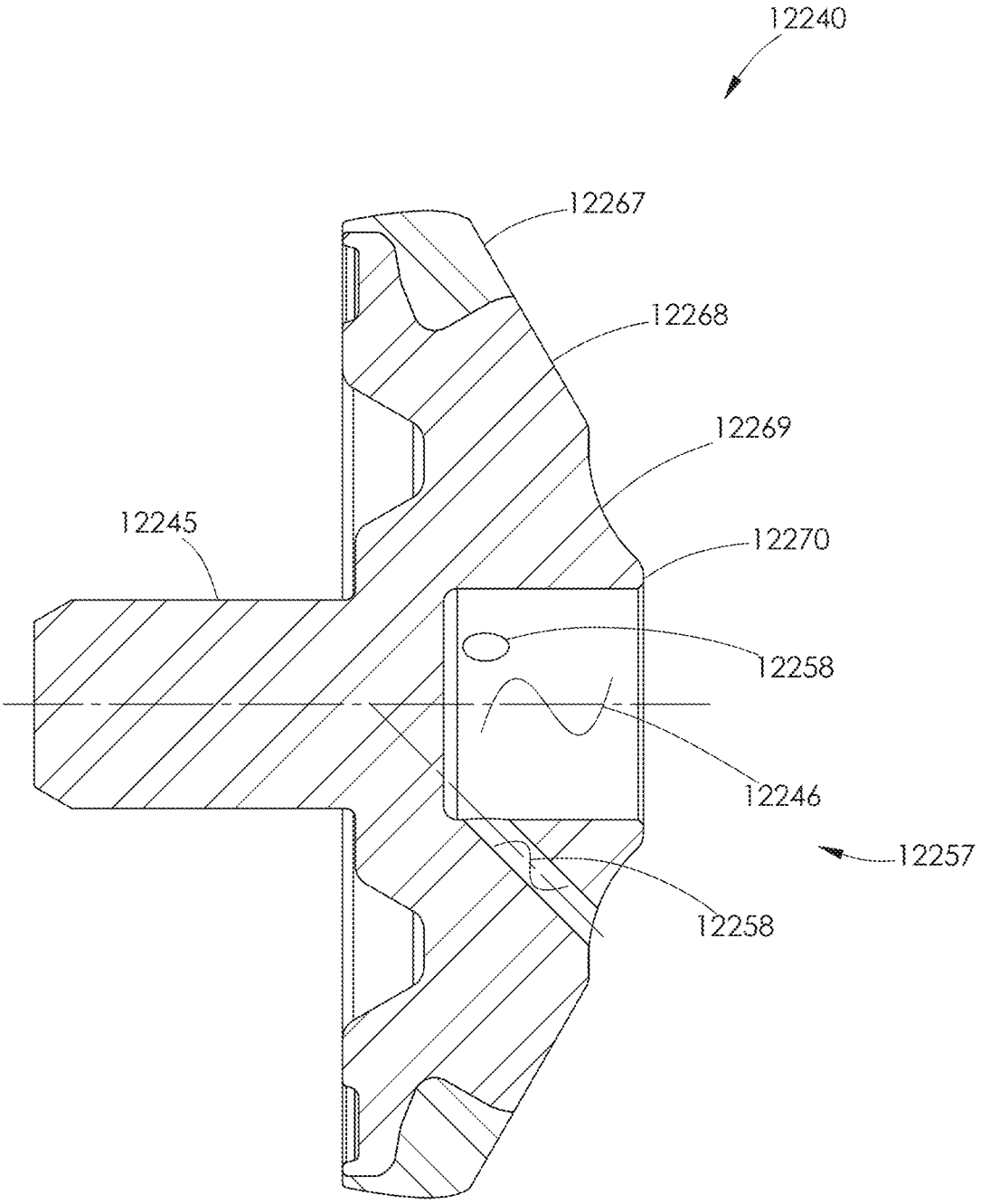

FIG. 212 is a cross-sectional view of the discharge valve shown in FIG. 210, taken along line CK-CK.

Figure 213:
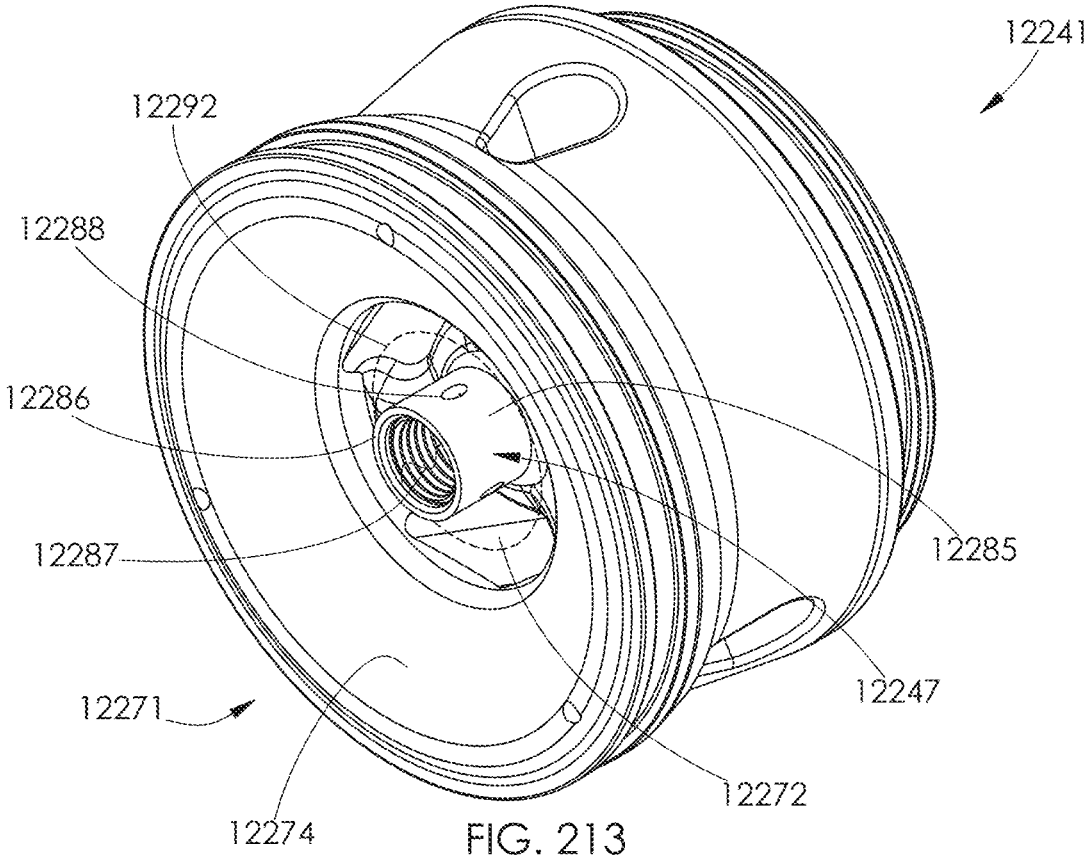

FIG. 213 is an isometric view of a fluid routing plug used in the multi-piece fluid end shown in FIG. 203.

Figure 214:
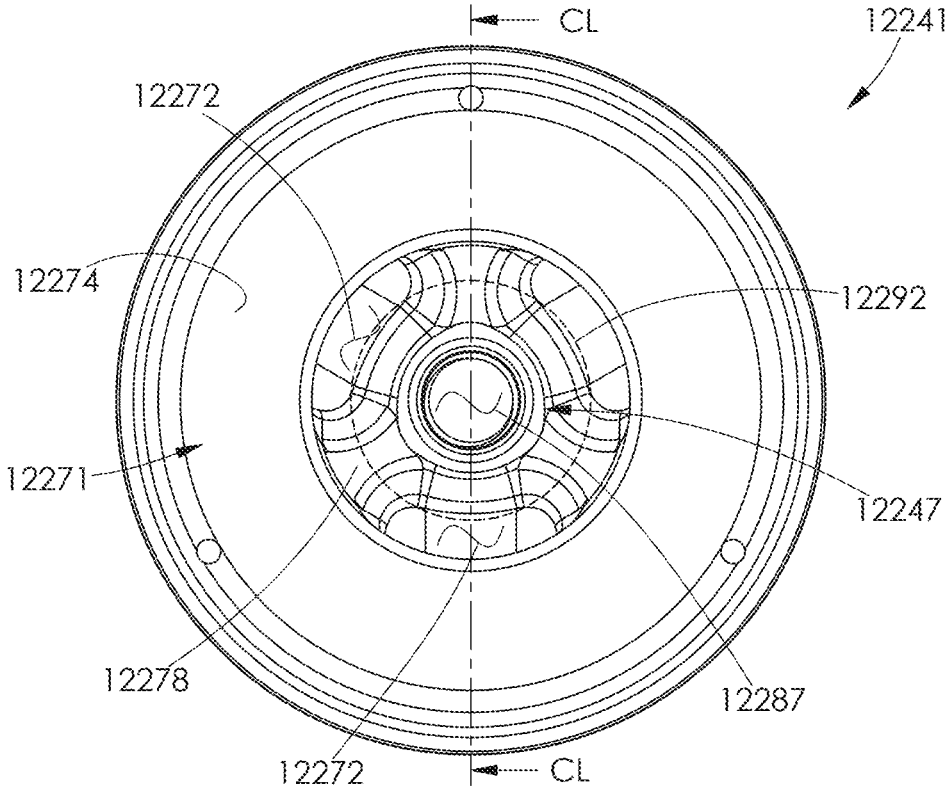

FIG. 214 is a front elevation view of the fluid routing plug shown in FIG. 213.

Figure 215:
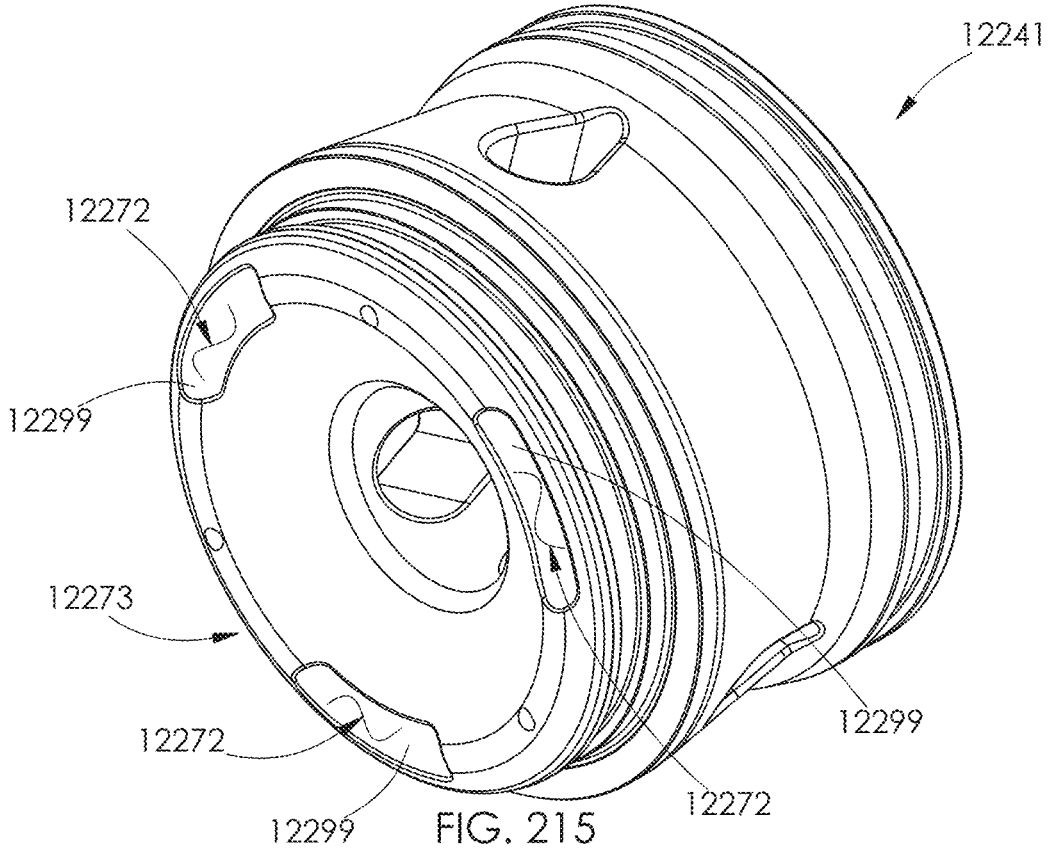

FIG. 215 is a rear isometric view of the fluid routing plug shown in FIG. 213.

Figure 216:
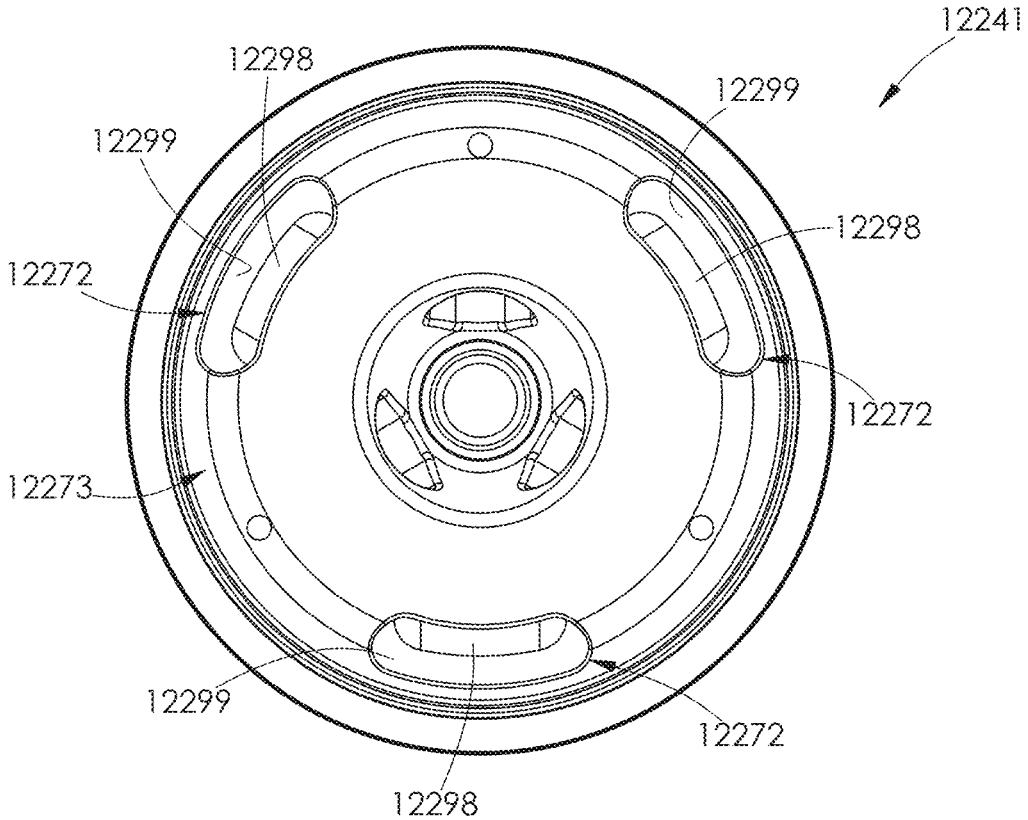

FIG. 216 is a rear elevation view of the fluid routing plug shown in FIG. 213.

Figure 217:
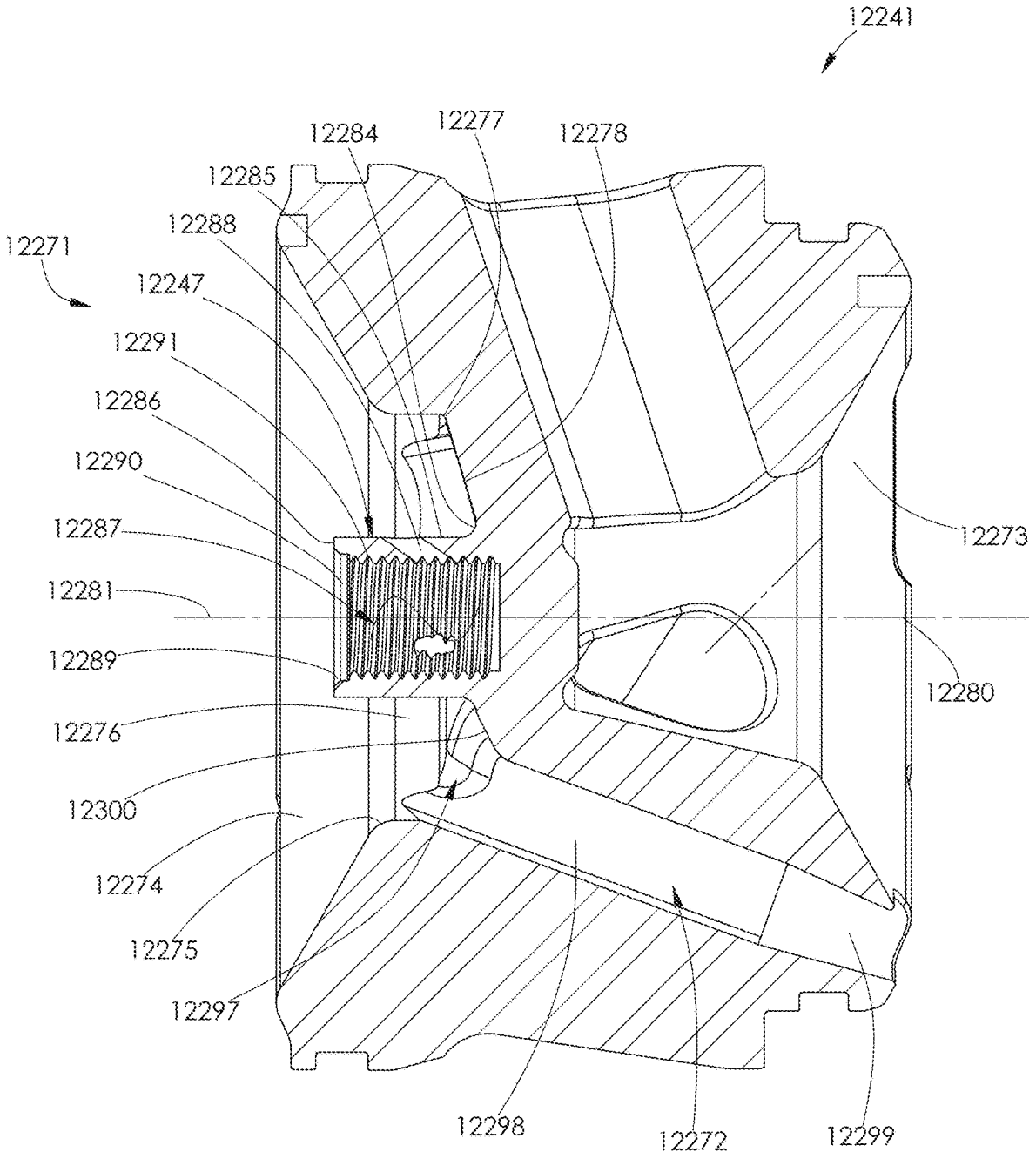

FIG. 217 is a cross-sectional view of the fluid routing plug shown in FIG. 214, taken along line CL-CL.

Figure 218:
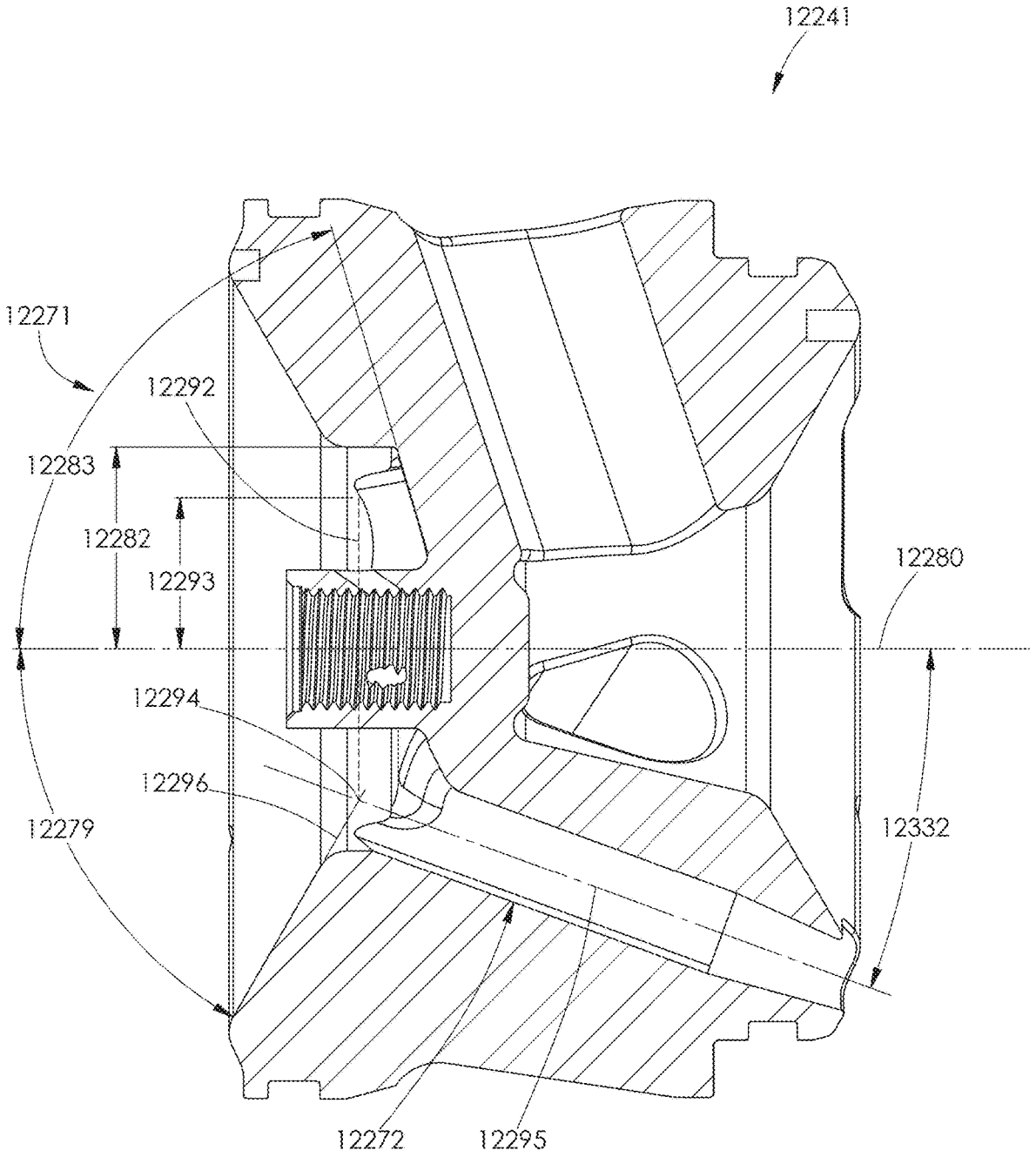

FIG. 218 is a cross-sectional view of the fluid routing plug shown in FIG. 214, taken along line CL-CL. This view illustrates the relationship between discharge fluid passage circle and the counterbore of the discharge surface.

Figure 219:
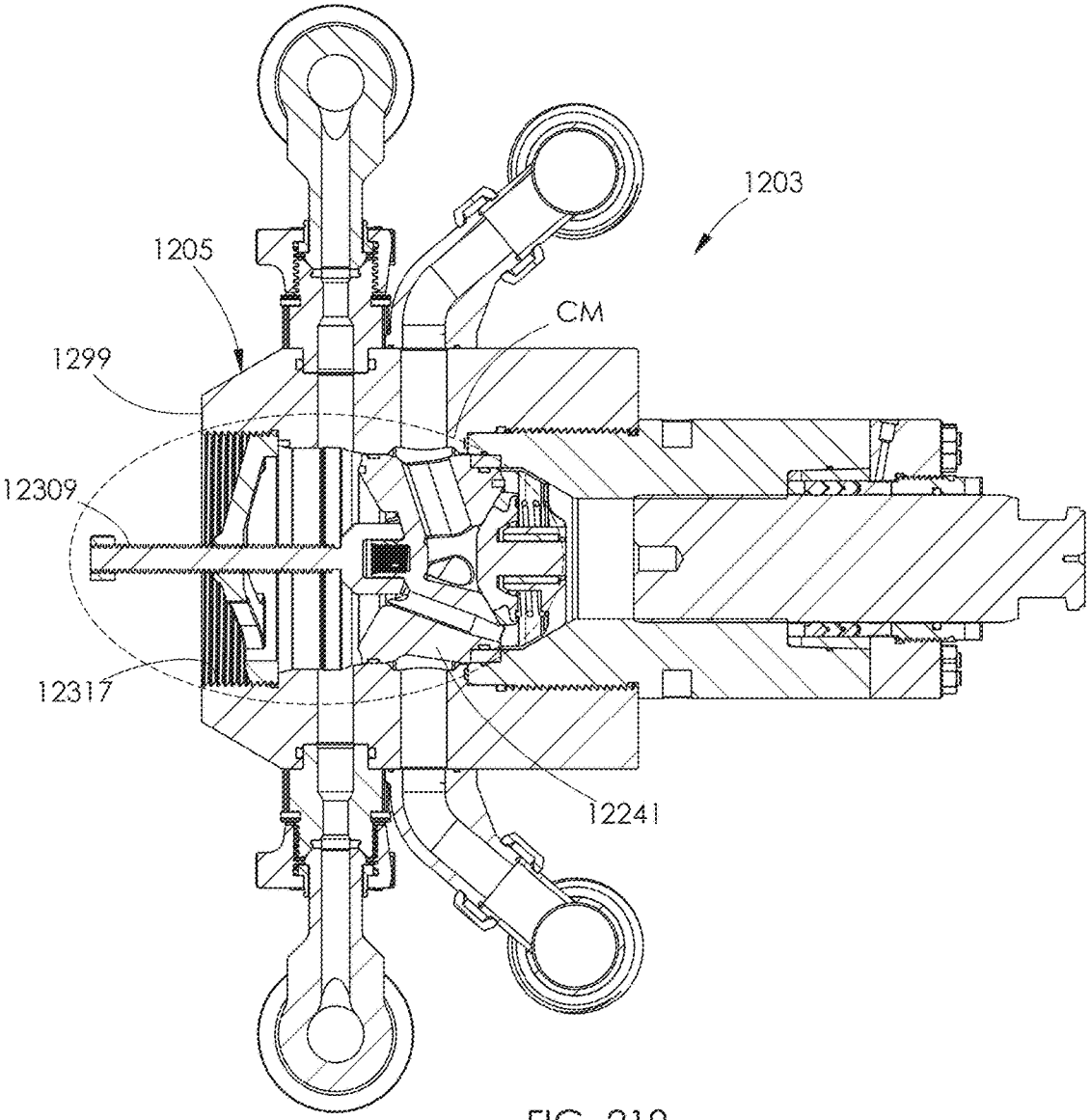

FIG. 219 is a cross-sectional view of the multi-piece fluid end shown in FIG. 203, taken along line CF-CF. The multi-piece fluid end is shown with the installation tool being utilized to insert the fluid routing plug.

Figure 220:
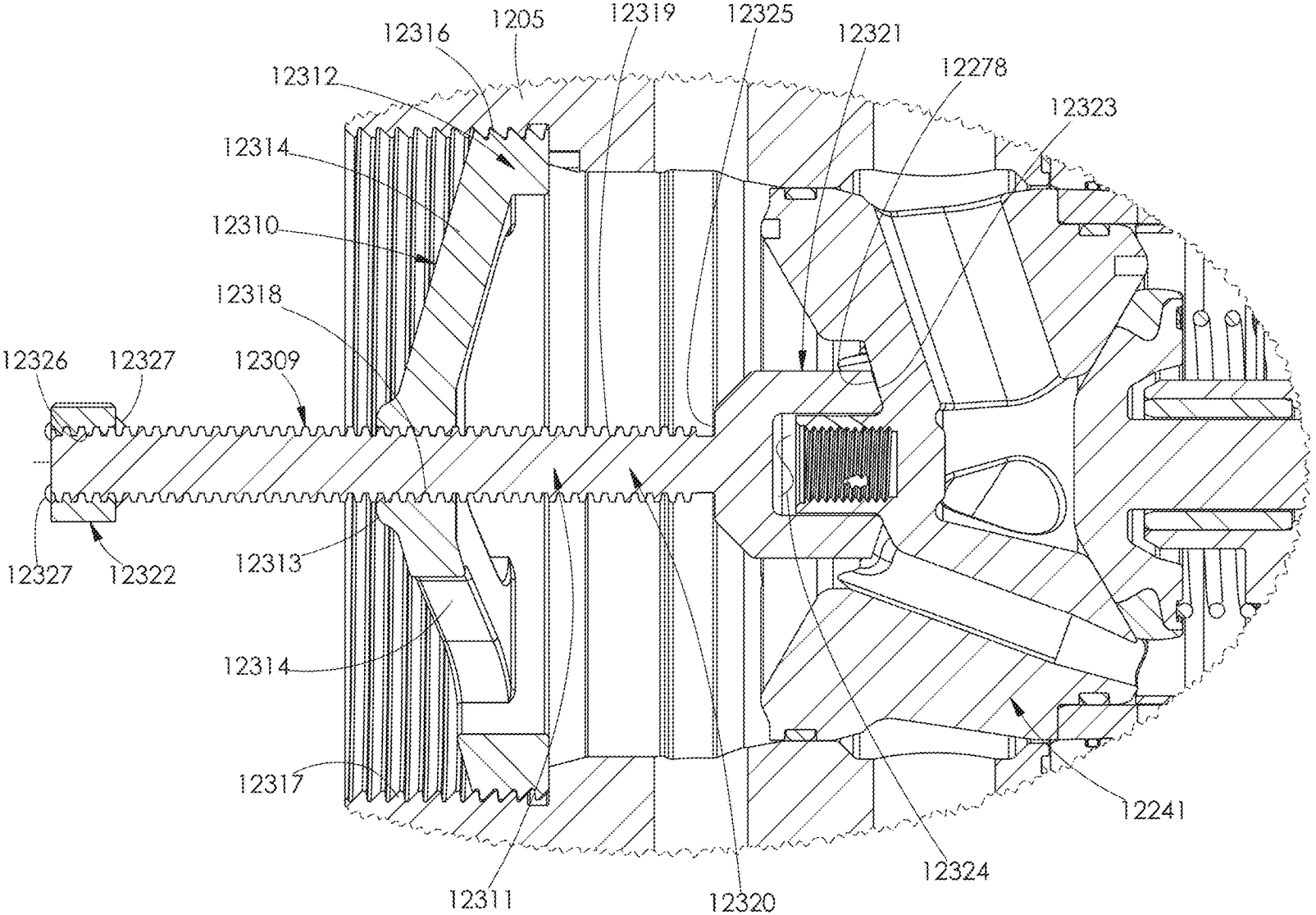

FIG. 220 is an enlarged view of area CM shown in FIG. 219

Figure 221:
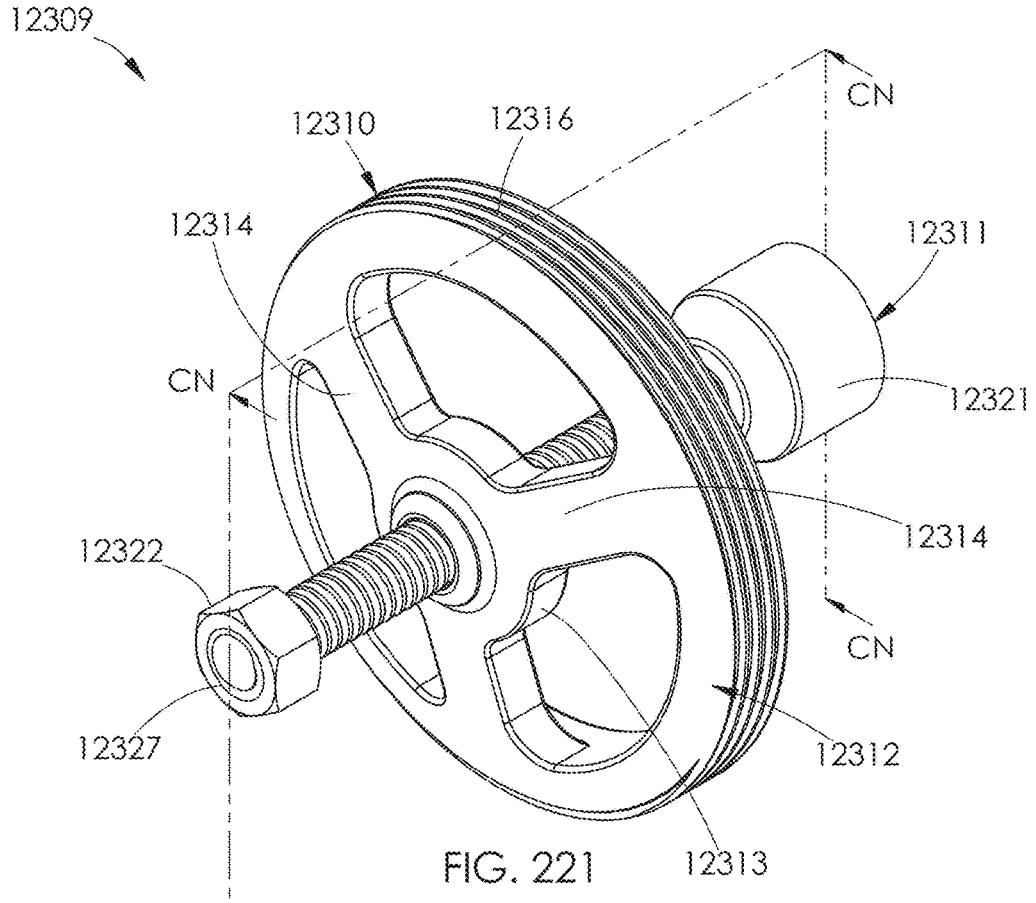

FIG. 221 is an isometric view of the installation tool used in the assembly of the multi-piece fluid end shown in FIG. 203.

Figure 222:
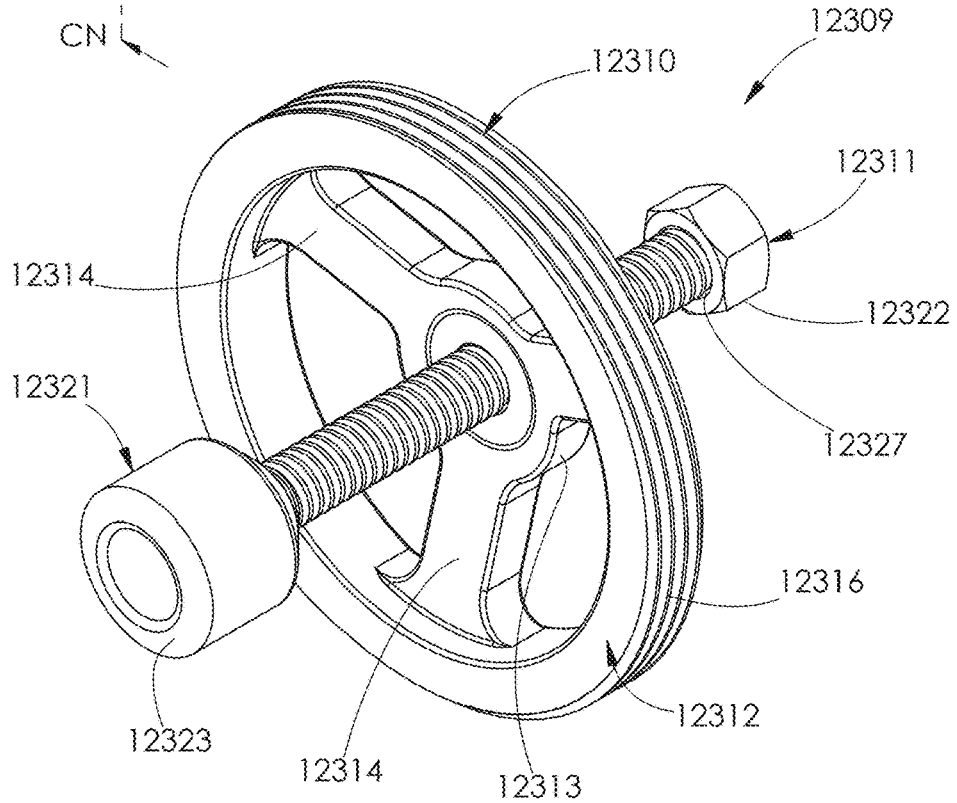

FIG. 222 is a rear isometric view of the installation tool shown in FIG. 221.

Figure 223:
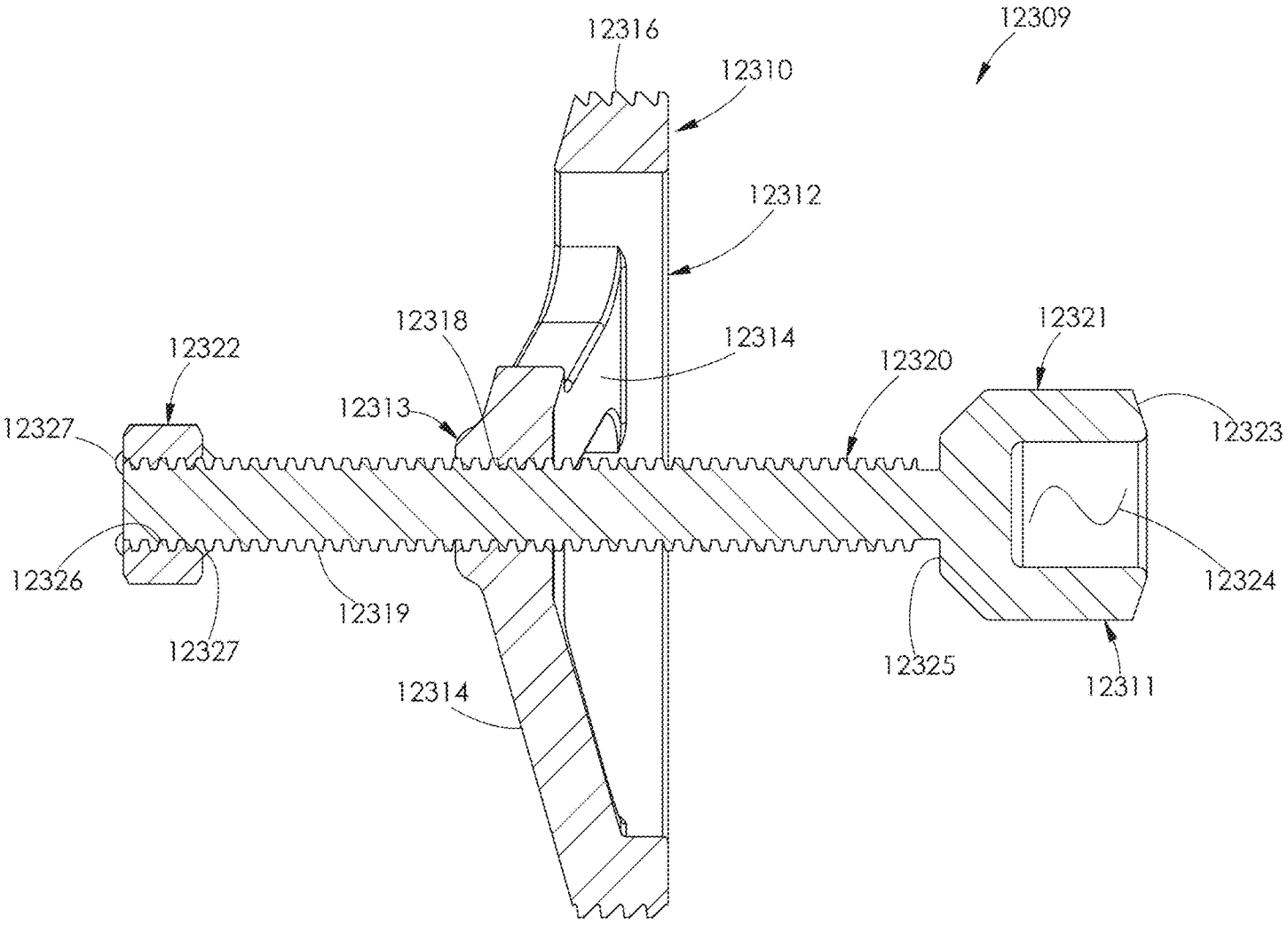

FIG. 223 is a cross-sectional view of the installation tool shown in FIG. 221, taken along line CN-CN.

Figure 224:
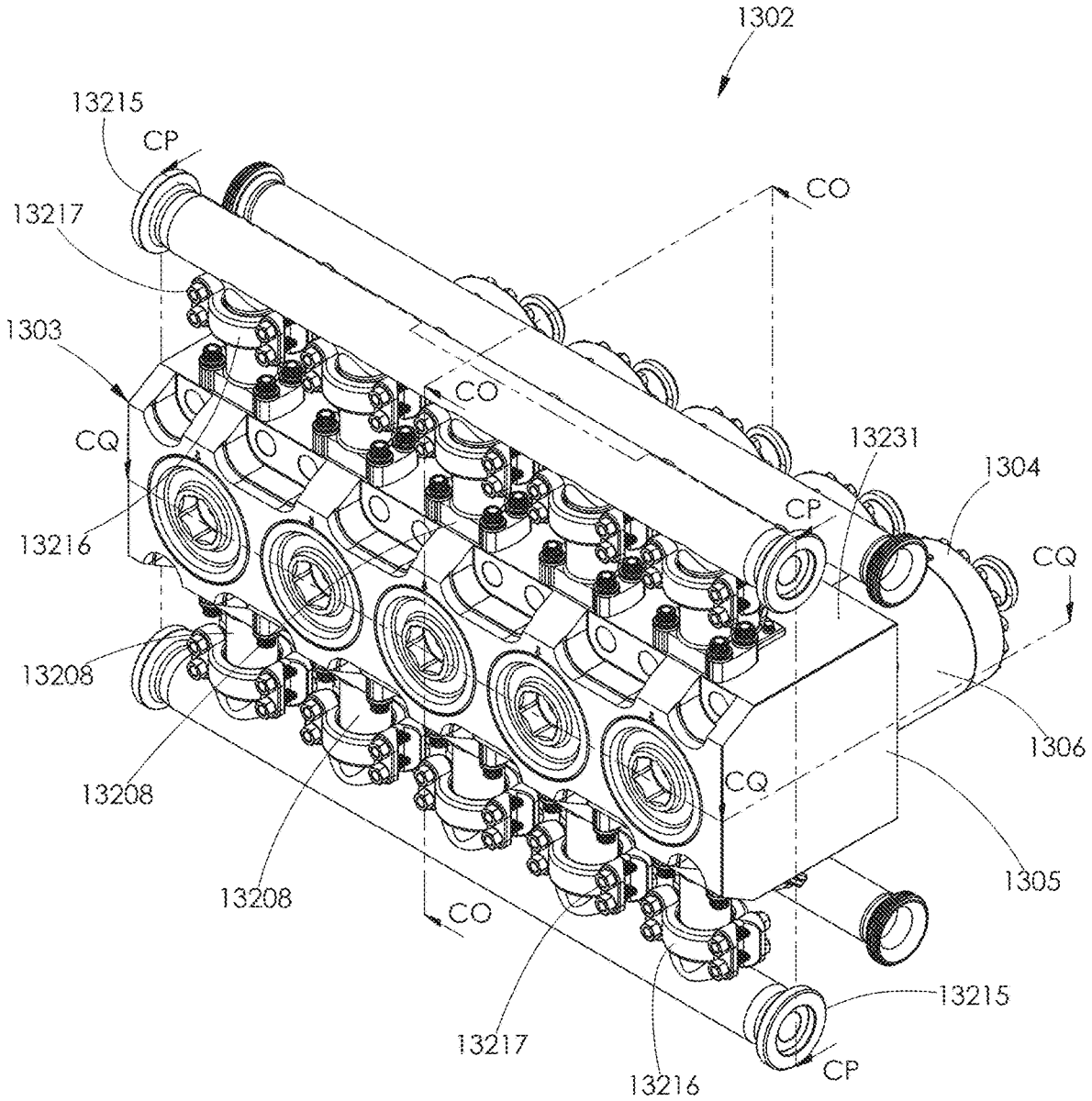

FIG. 224 is an isometric view of another embodiment of a multi-piece fluid end.

Figure 225:
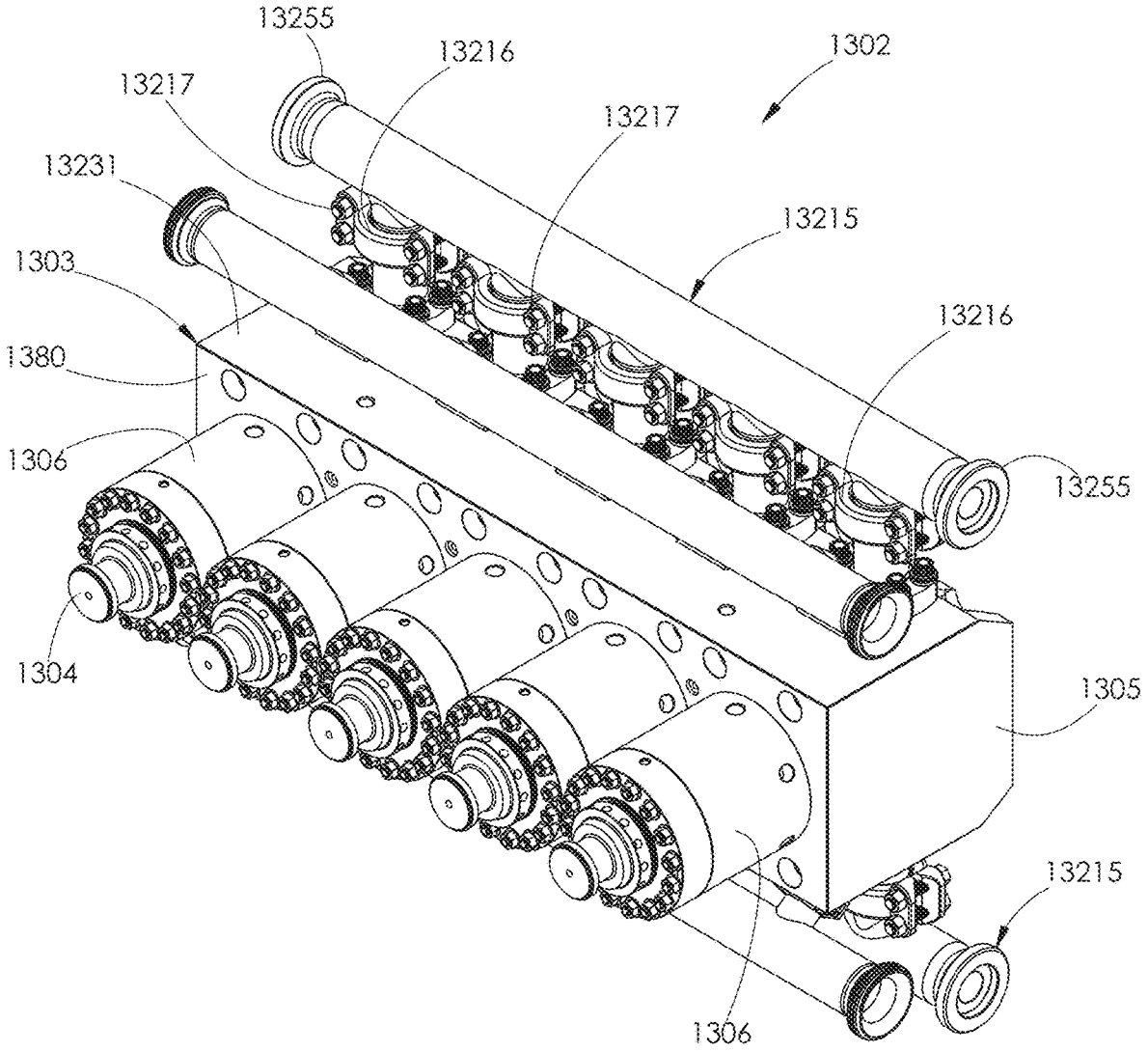

FIG. 225 is a rear isometric view of the multi-piece fluid end shown in FIG. 224.

Figure 226:
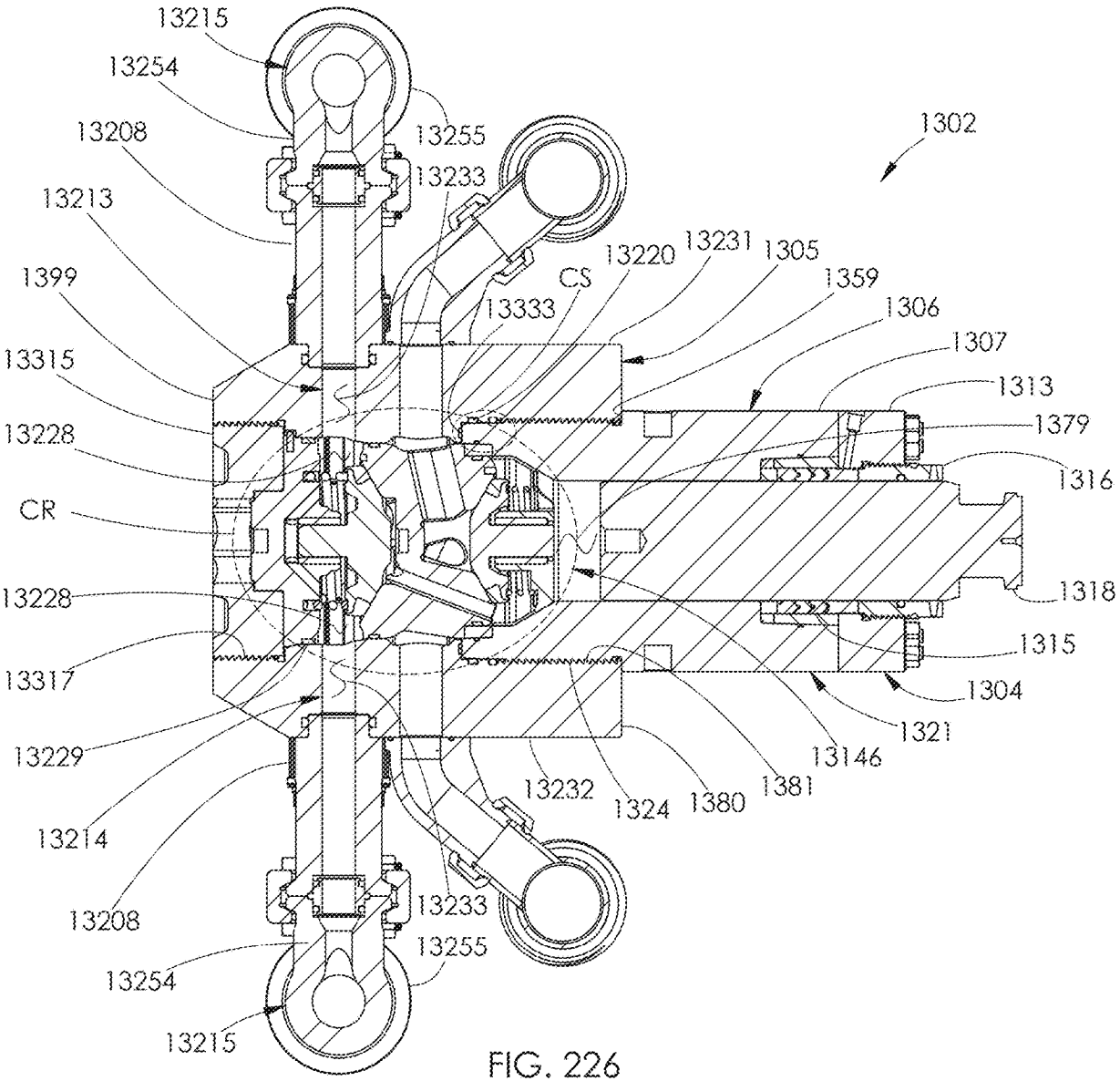

FIG. 226 is a cross-sectional view of the multi-piece fluid end shown in FIG. 224, taken along line CO-CO.

Figure 227:
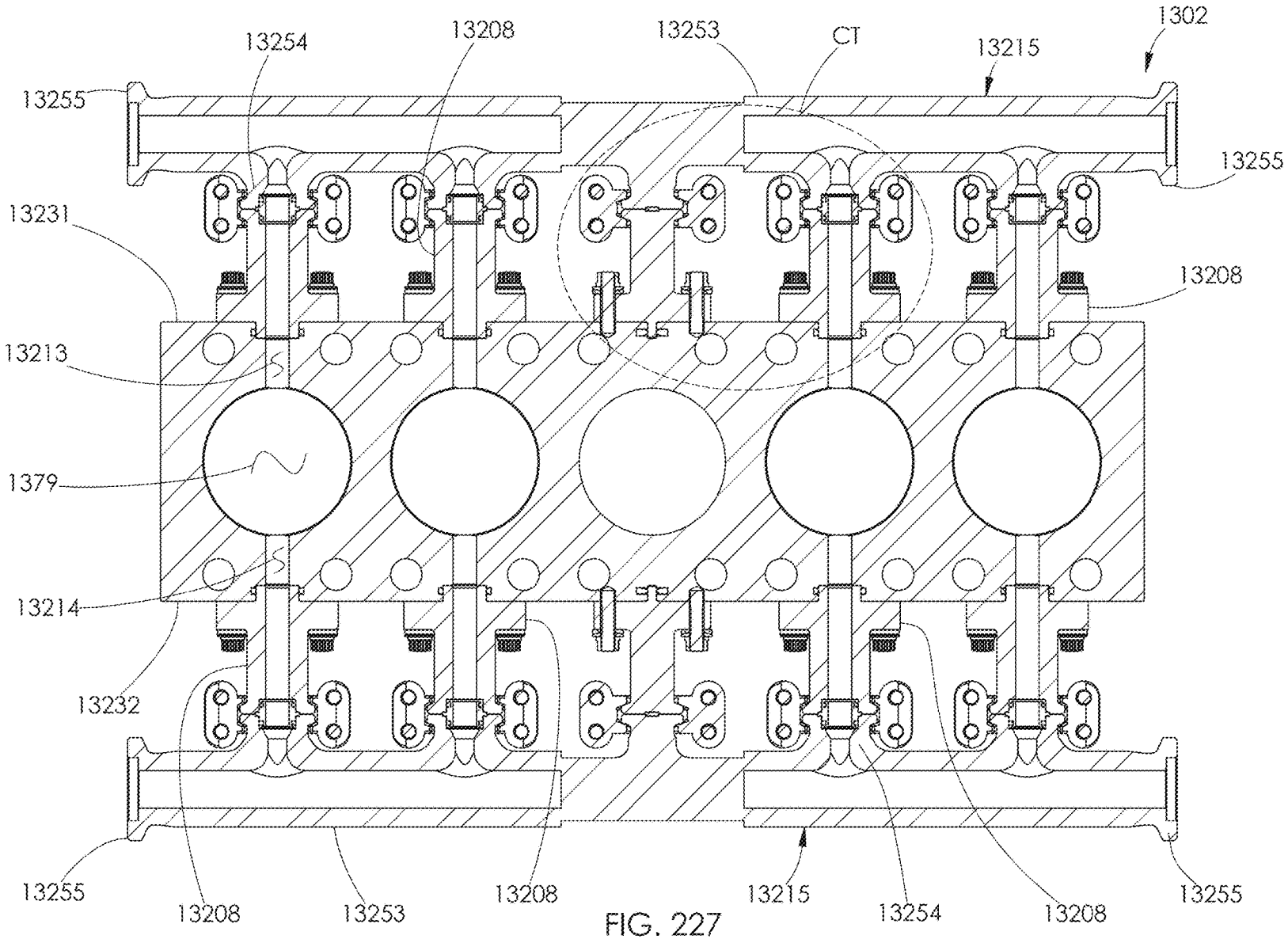

FIG. 227 is an offset cross-sectional view of the multi-piece fluid end shown in FIG. 224, taken along line CP-CP.

Figure 228:
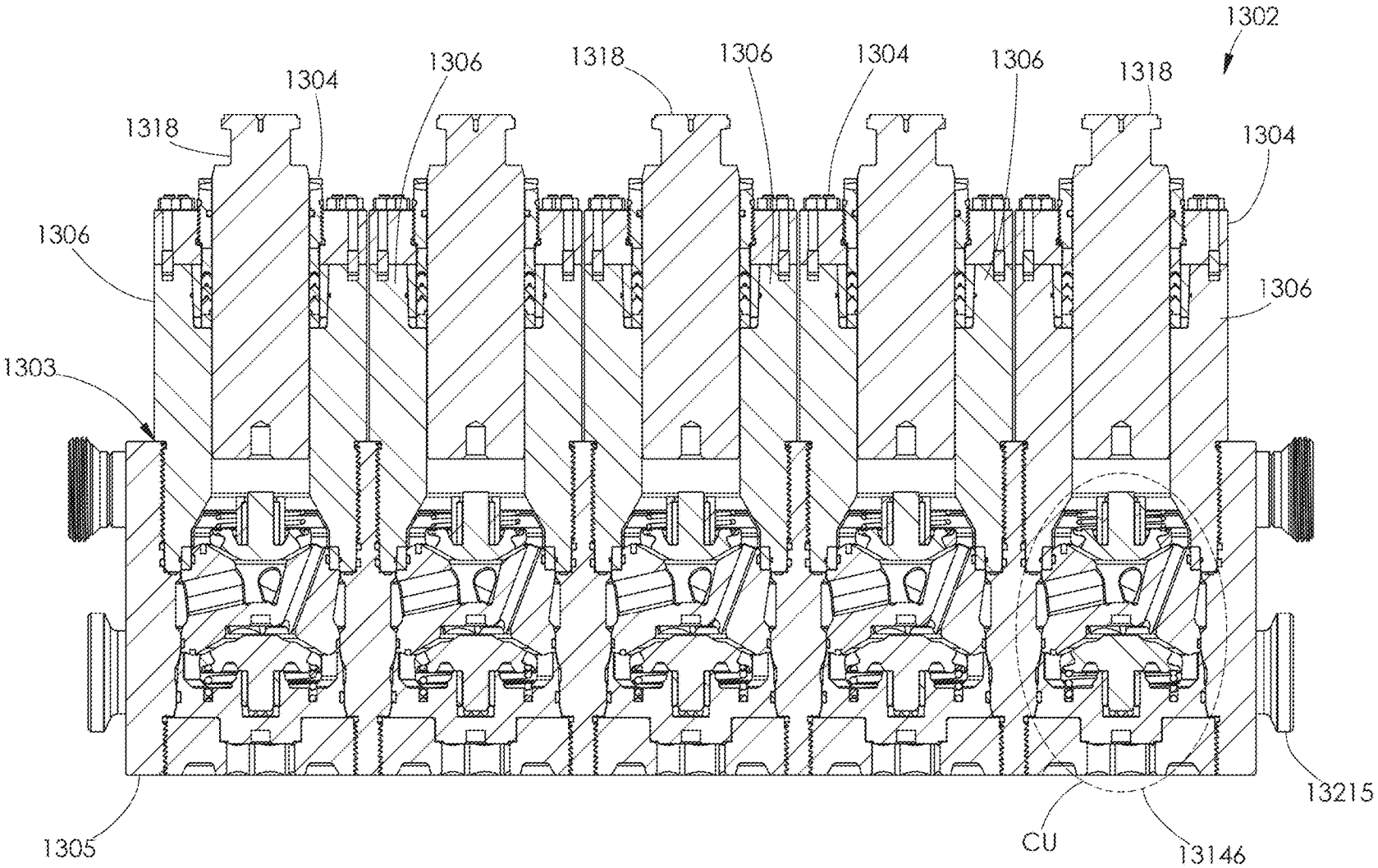

FIG. 228 is a cross-sectional view of the multi-piece fluid end shown in FIG. 224, taken along line CQ-CQ.

Figure 229:
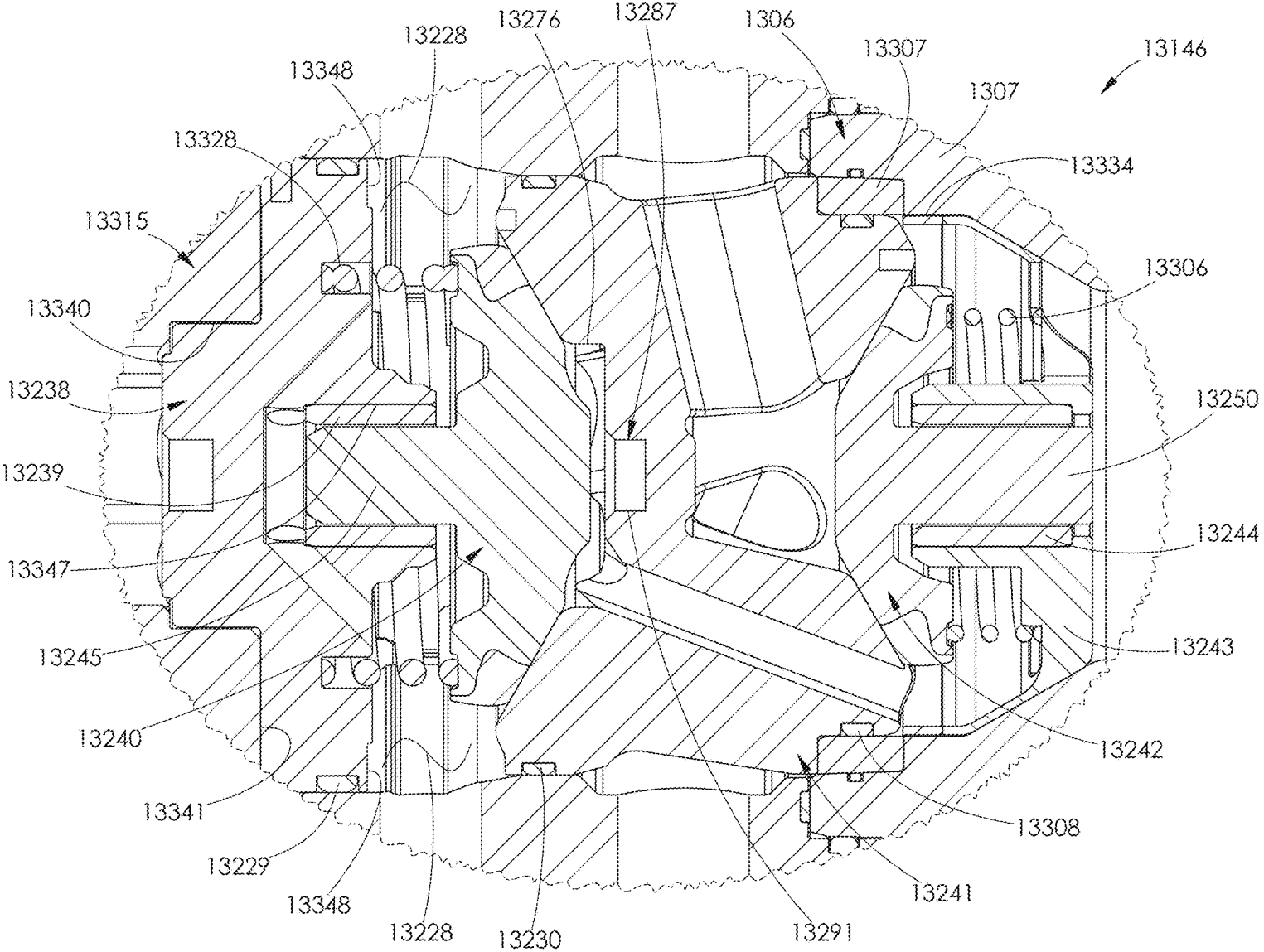

FIG. 229 is an enlarged view of area CR shown in FIG. 226.

Figure 230:
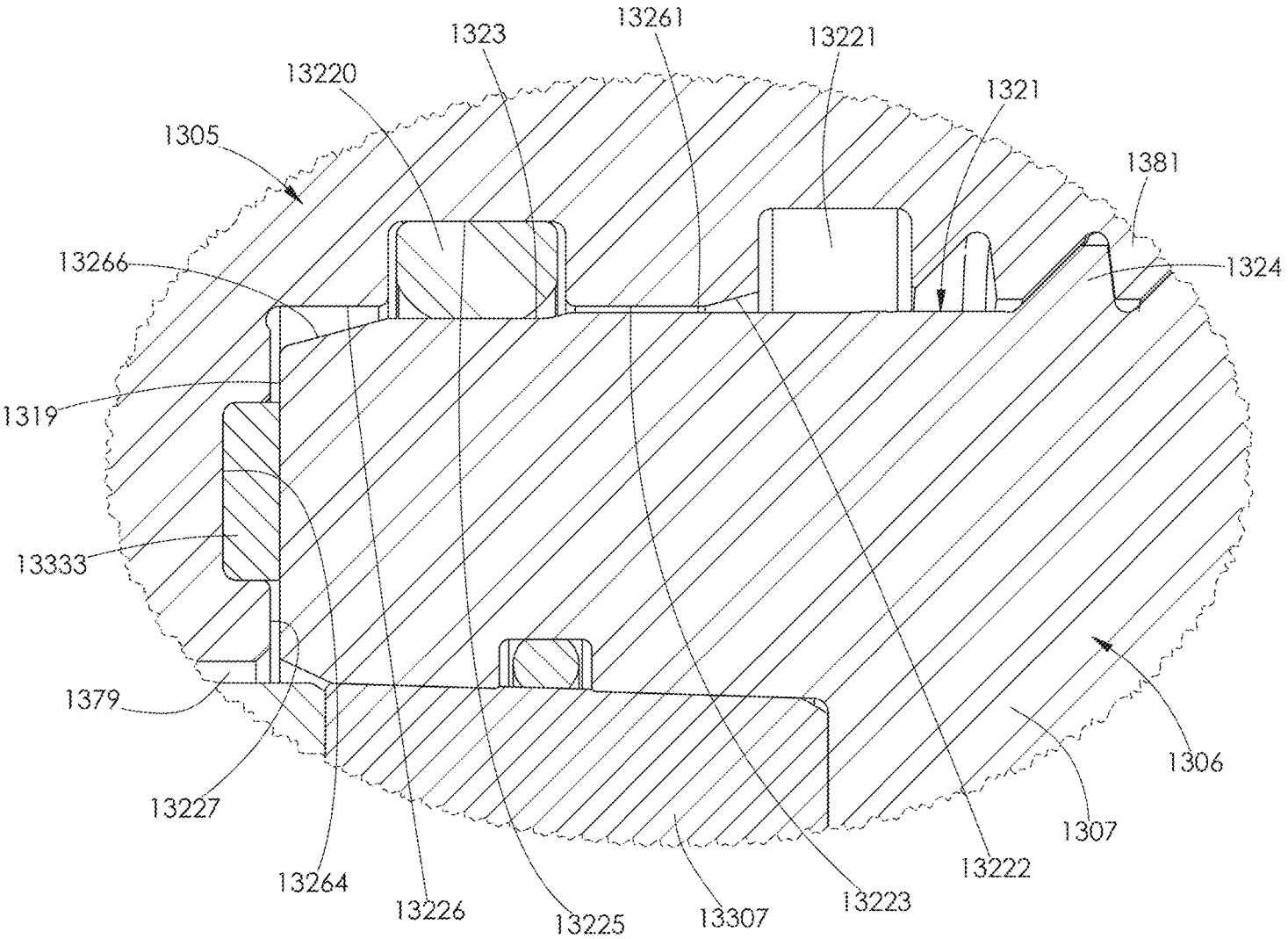

FIG. 230 is an enlarged view of area CS shown in FIG. 226.

Figure 231:
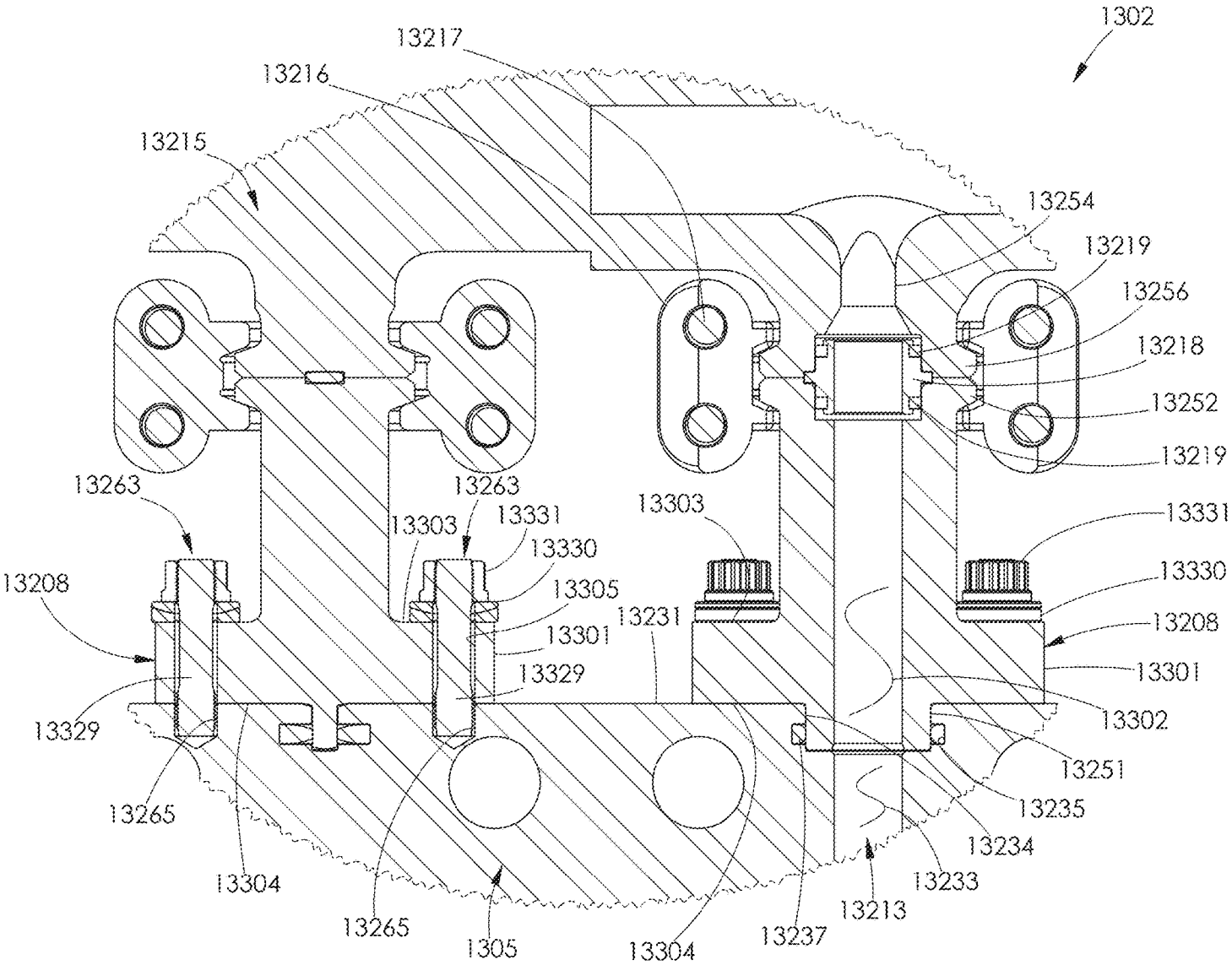

FIG. 231 is an enlarged view of area CT shown in FIG. 227.

Figure 232:
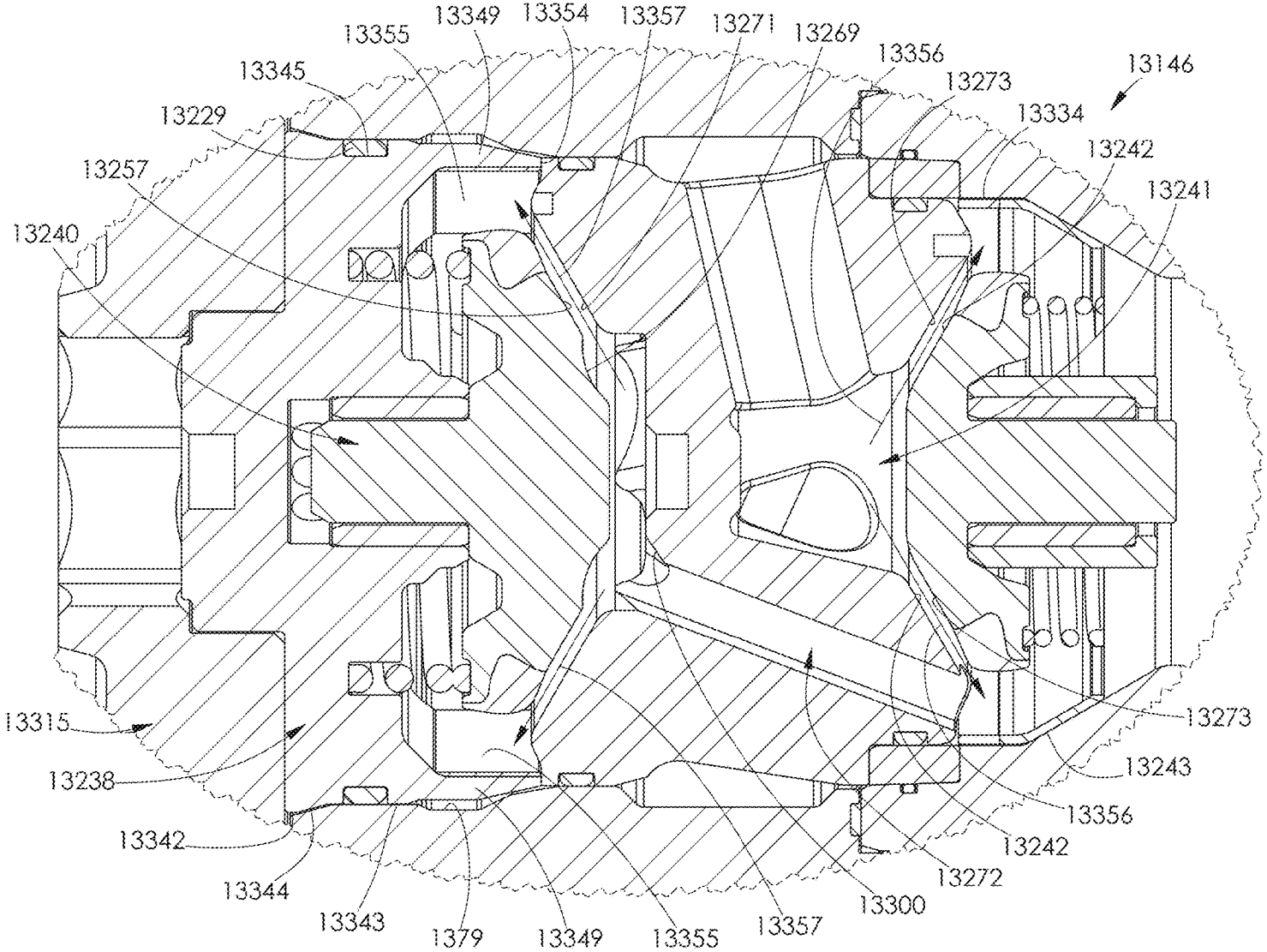

FIG. 232 is an enlarged view of area CU shown in FIG. 228.

Figure 233:
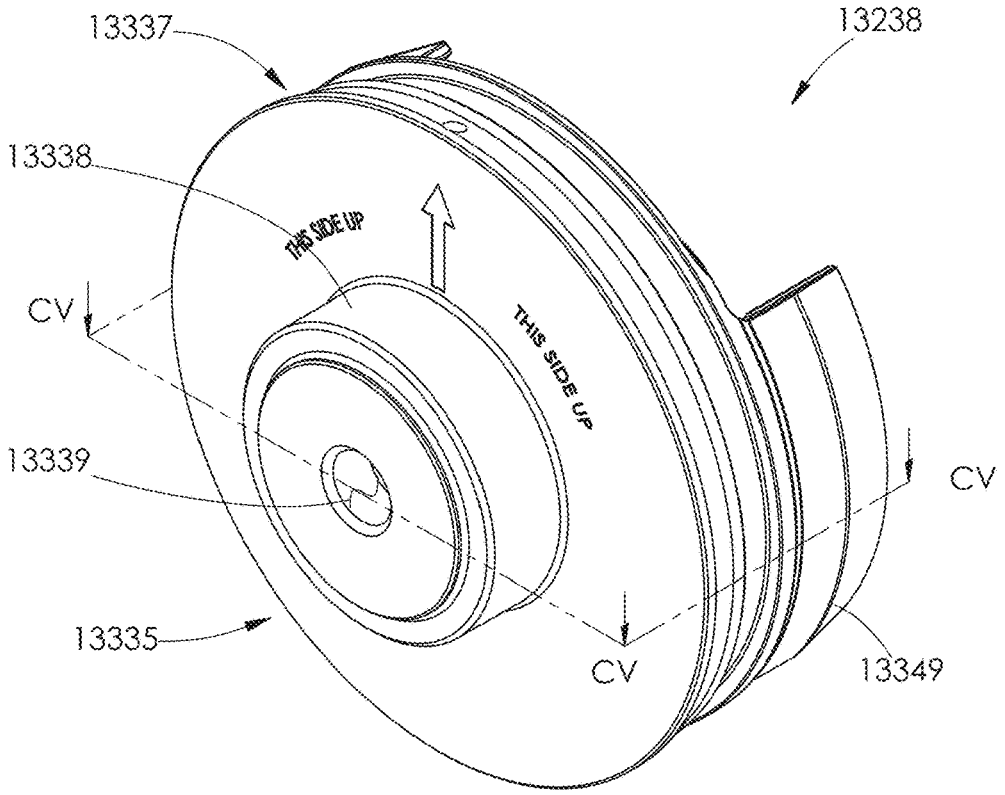

FIG. 233 is an isometric view of a discharge plug used in the multi-piece fluid end shown in FIG. 224.

Figure 234:
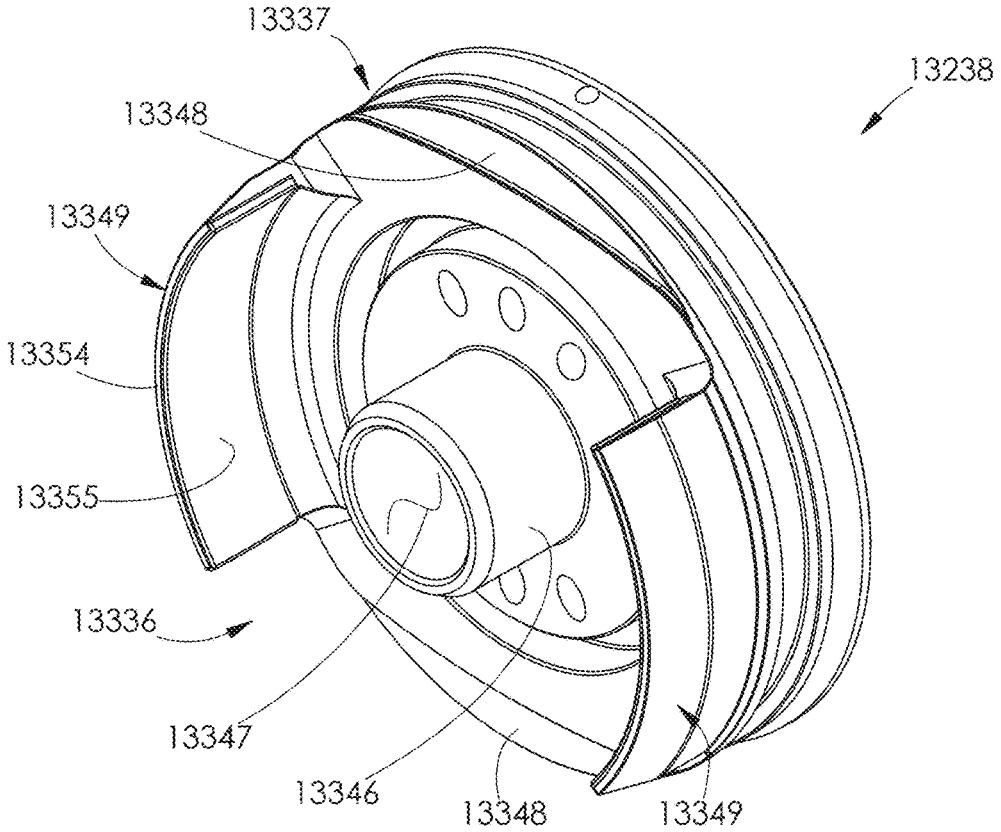

FIG. 234 is a rear isometric view of the discharge plug shown in FIG. 233.

Figure 235:
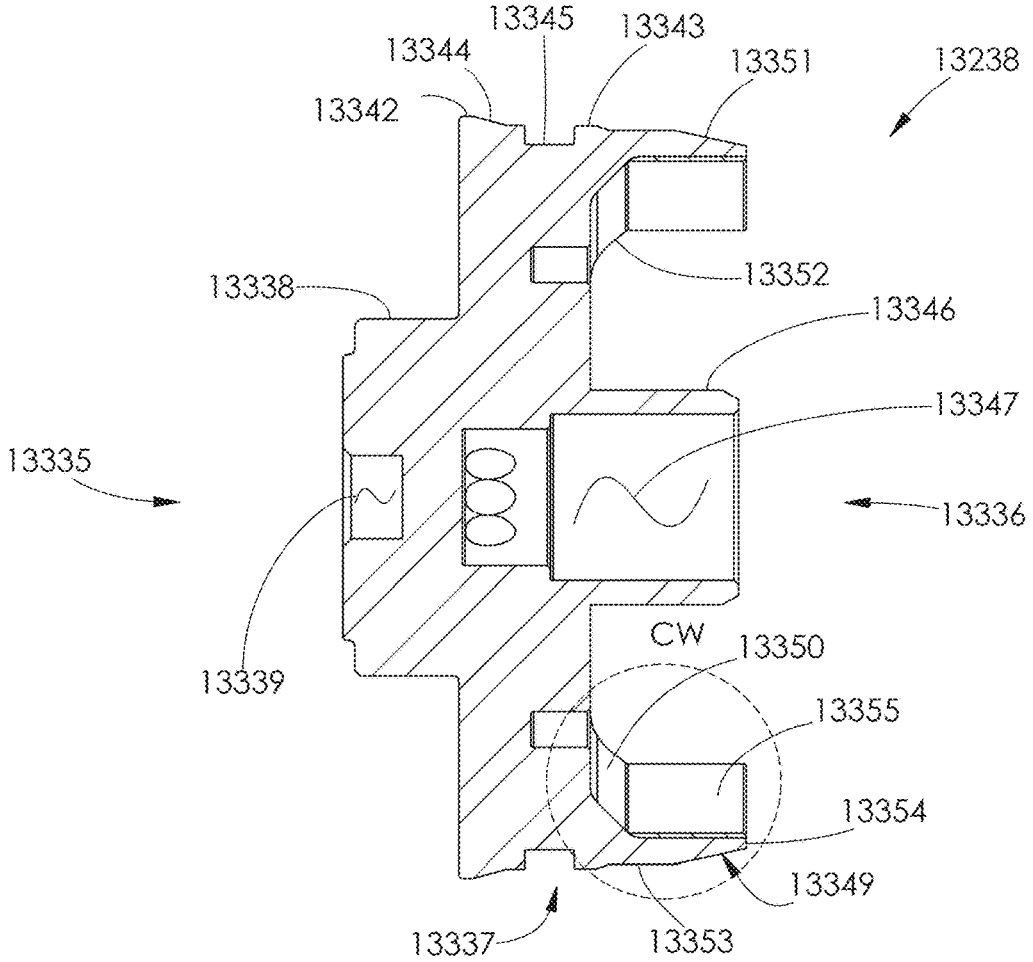

FIG. 235 is a cross-sectional view of the discharge plug shown in FIG. 233 taken along line CV-CV.

Figure 236:
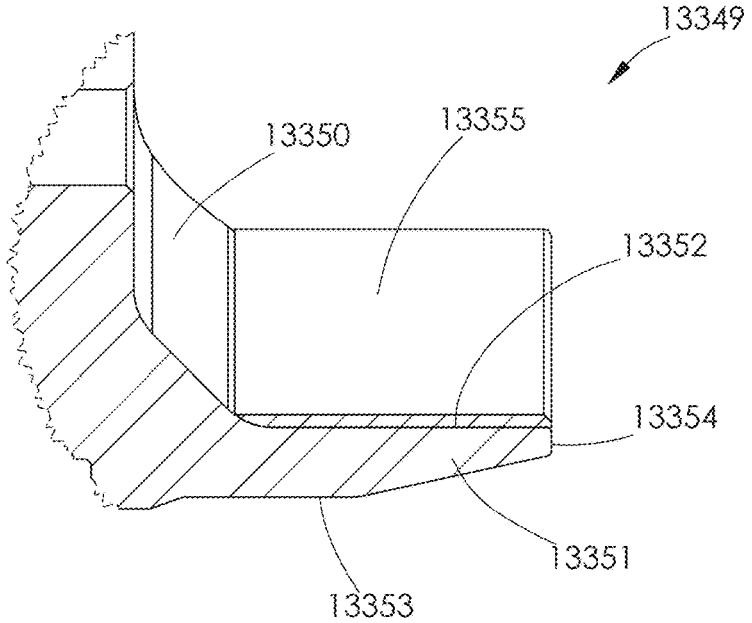

FIG. 236 is an enlarged view of area CW shown in FIG. 235.

Figure 237:
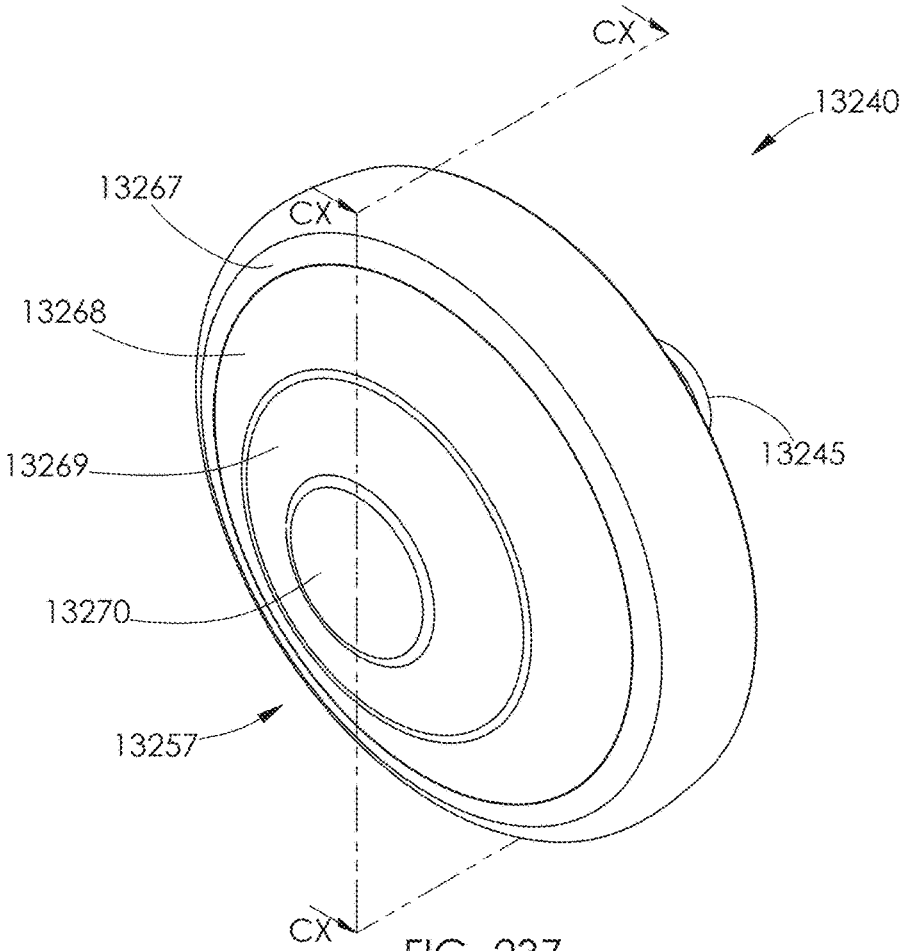

FIG. 237 is an isometric view of a discharge valve used in the multi-piece fluid end shown in FIG. 224.

Figure 238:
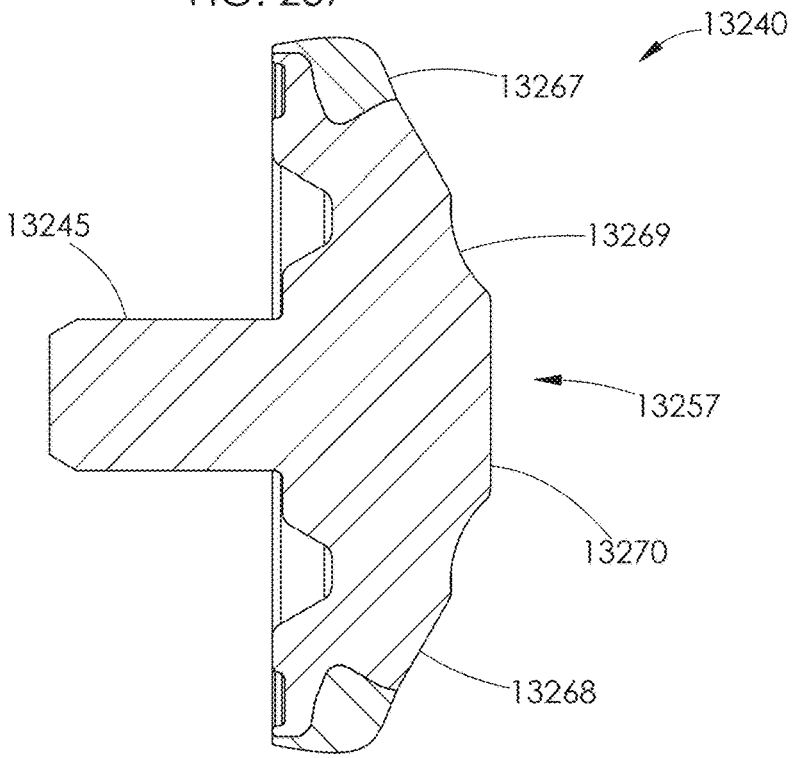

FIG. 238 is a cross-sectional view of the discharge valve shown in FIG. 237, taken along line CX-CX.

Figure 239:
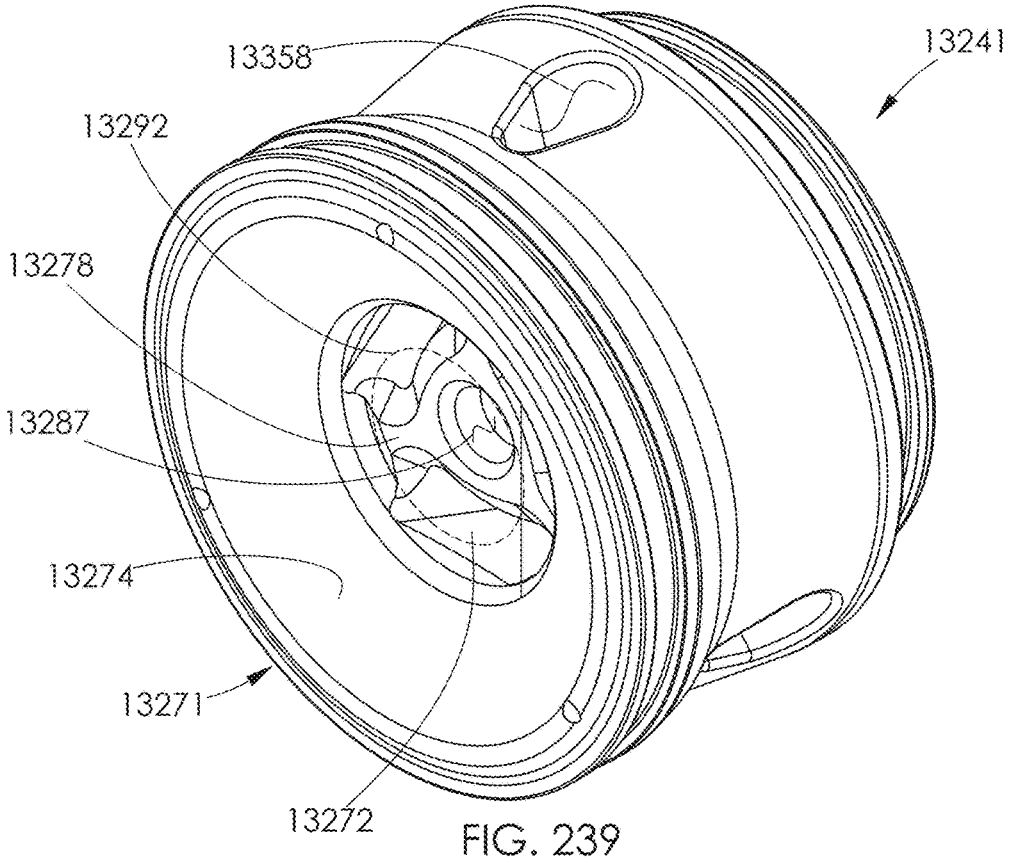

FIG. 239 is an isometric view of a fluid routing plug used in the multi-piece fluid end shown in FIG. 224.

Figure 240:
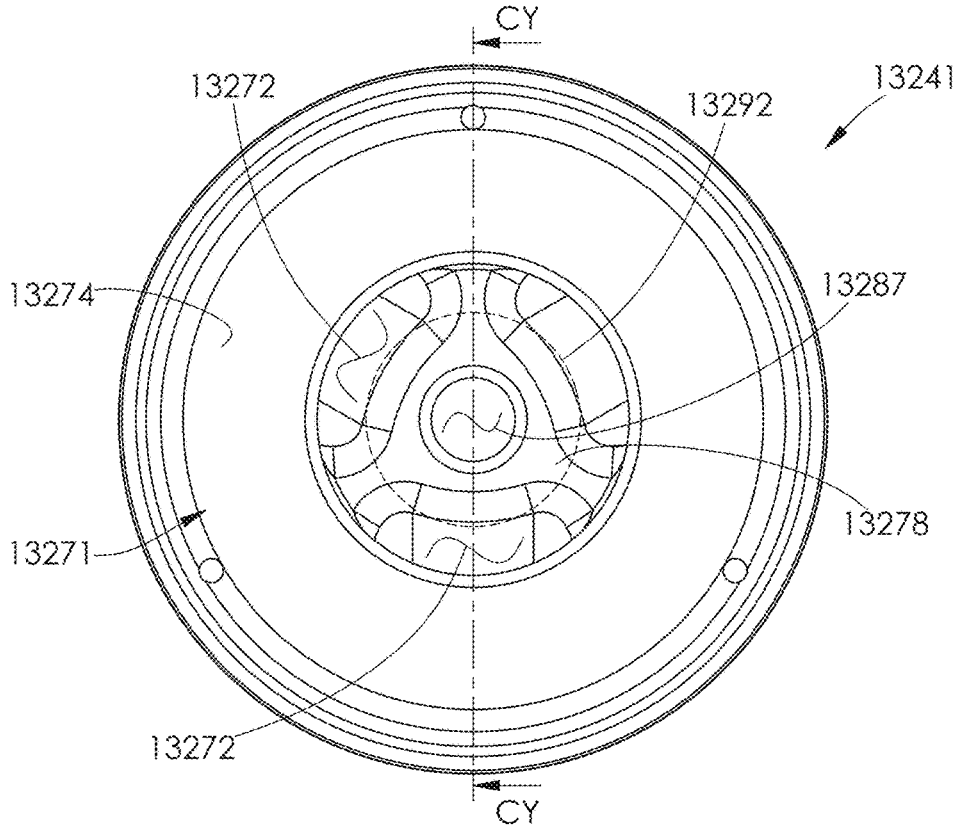

FIG. 240 is a front elevation view of the fluid routing plug shown in FIG. 239.

Figure 241:
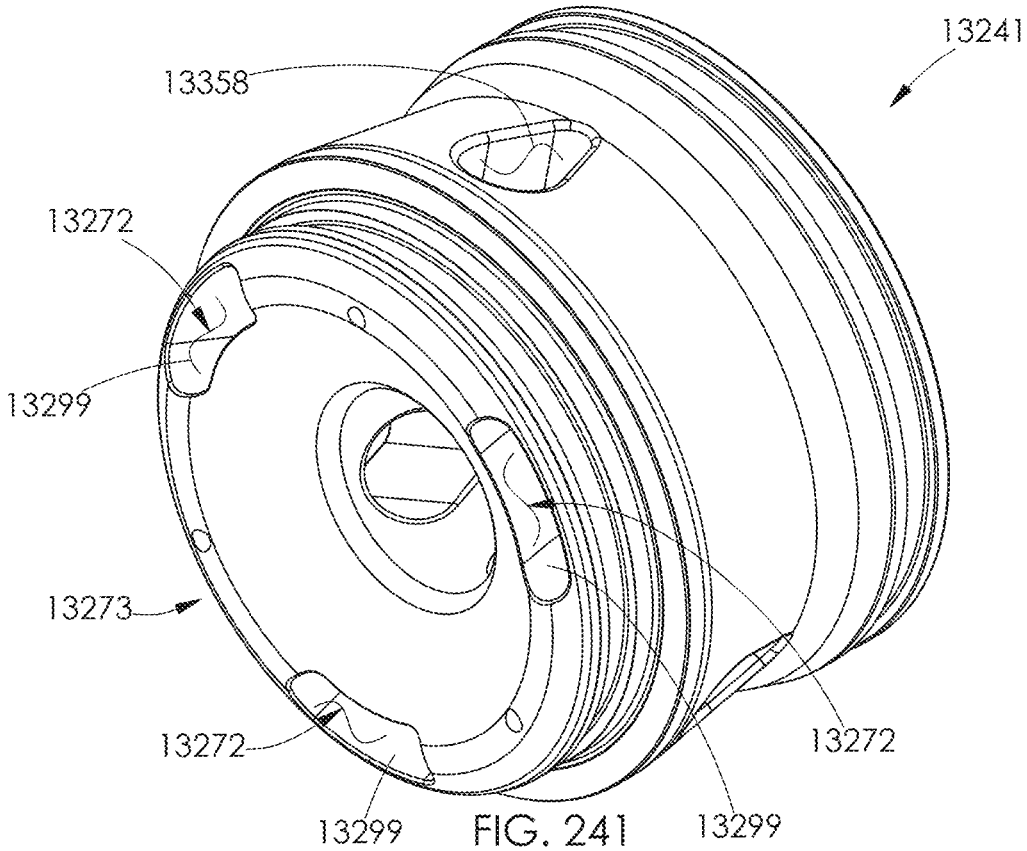

FIG. 241 is a rear isometric view of the fluid routing plug shown in FIG. 239.

Figure 242:
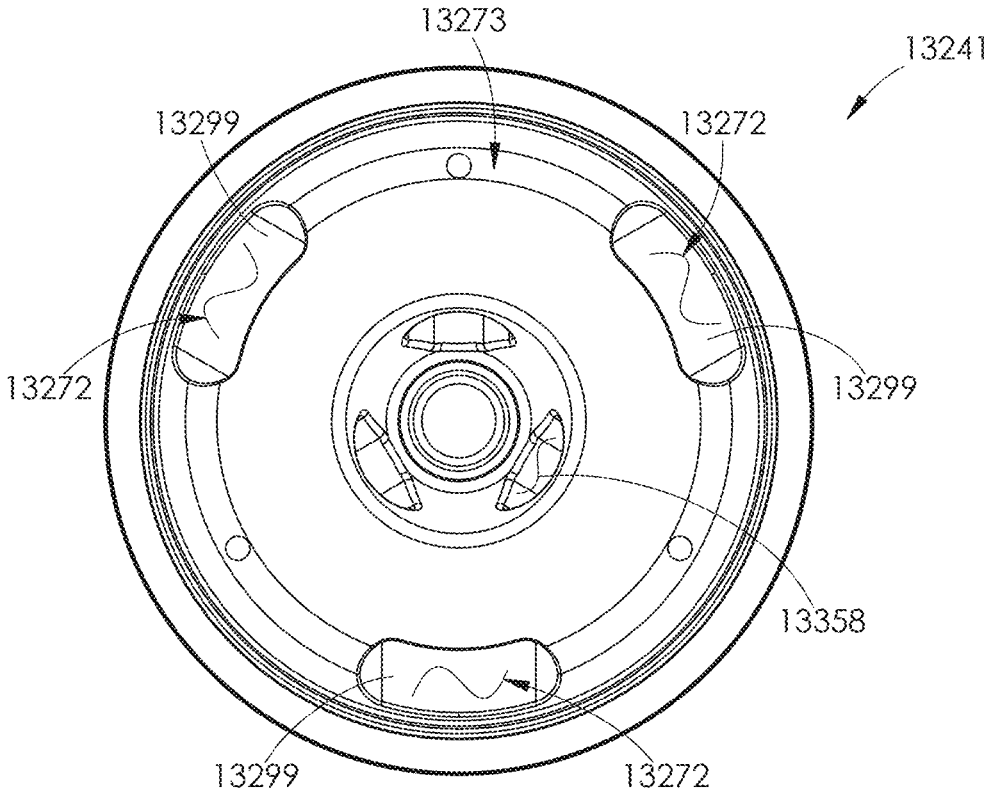

FIG. 242 is a rear elevation view of the fluid routing plug shown in FIG. 239.

Figure 243:
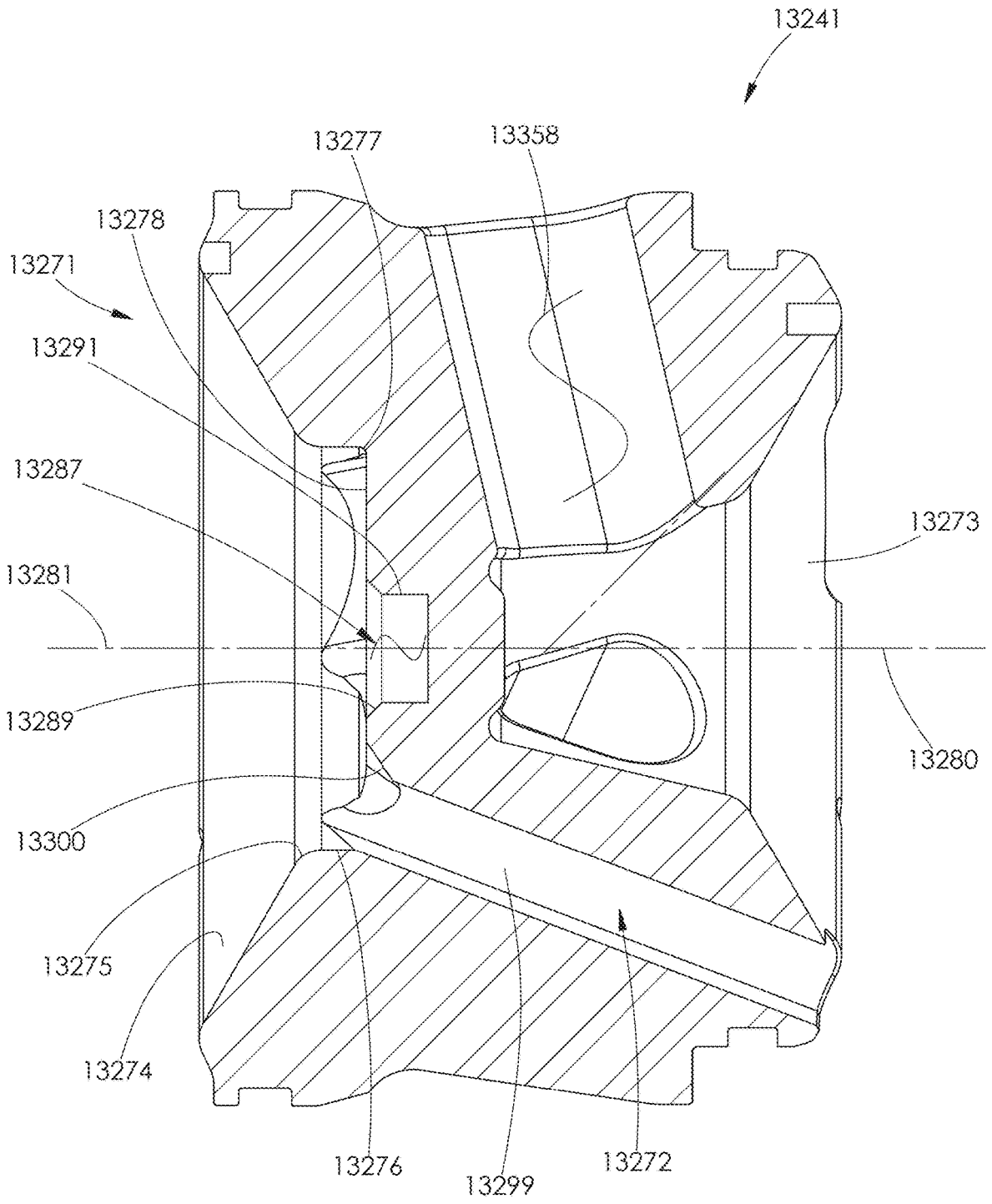

FIG. 243 is a cross-sectional view of the fluid routing plug shown in FIG. 240, taken along line CY-CY.

Figure 244:
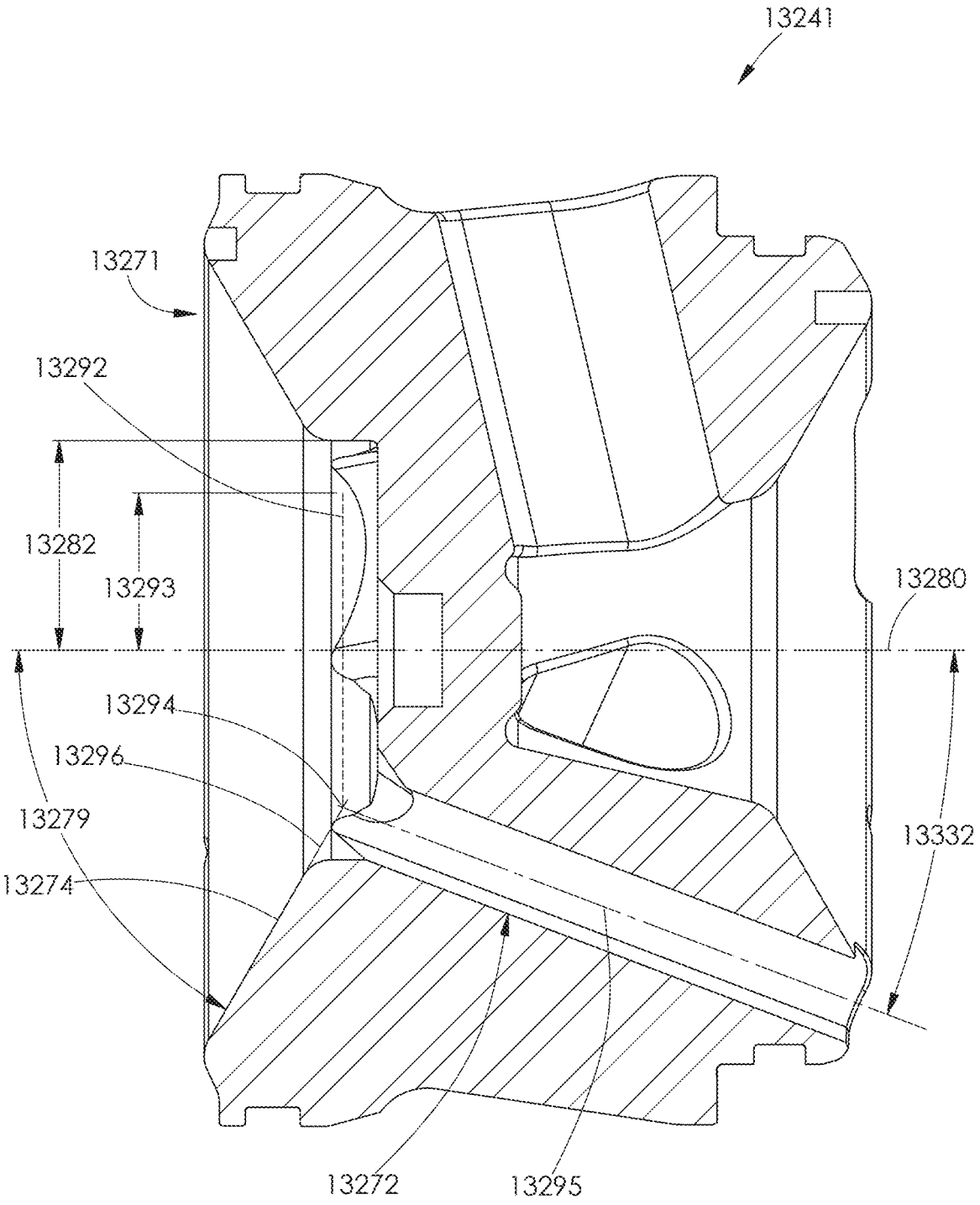

FIG. 244 is a cross-sectional view of the fluid routing plug shown in FIG. 240, taken along line CY-CY. This view illustrates the relationship between discharge fluid passage circle and the counterbore of the discharge surface.

Figure 55:
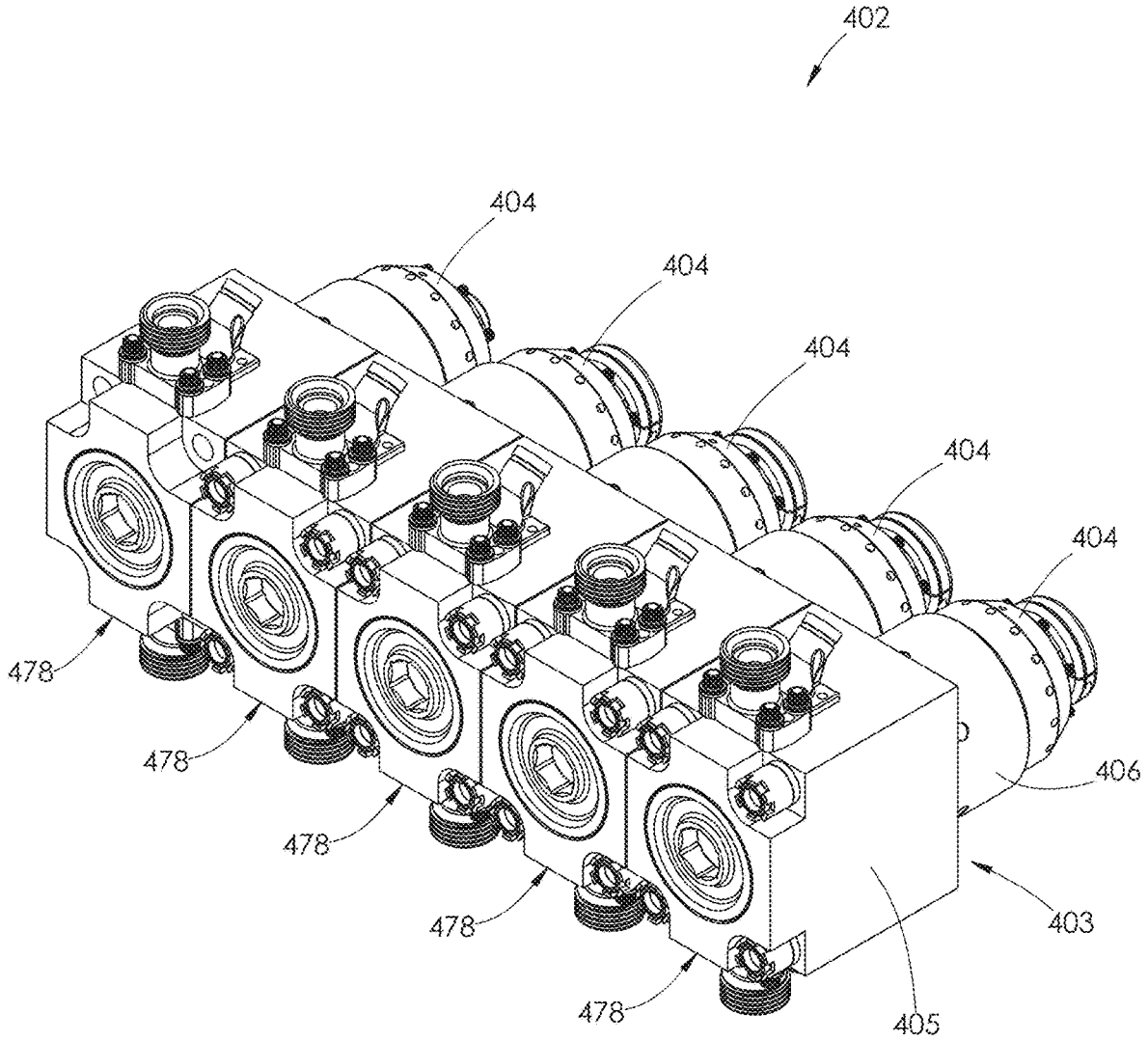
FIG. 55 is an isometric view of a fluid end used on the high-pressure pump shown in FIG. 54.
Figure 56:
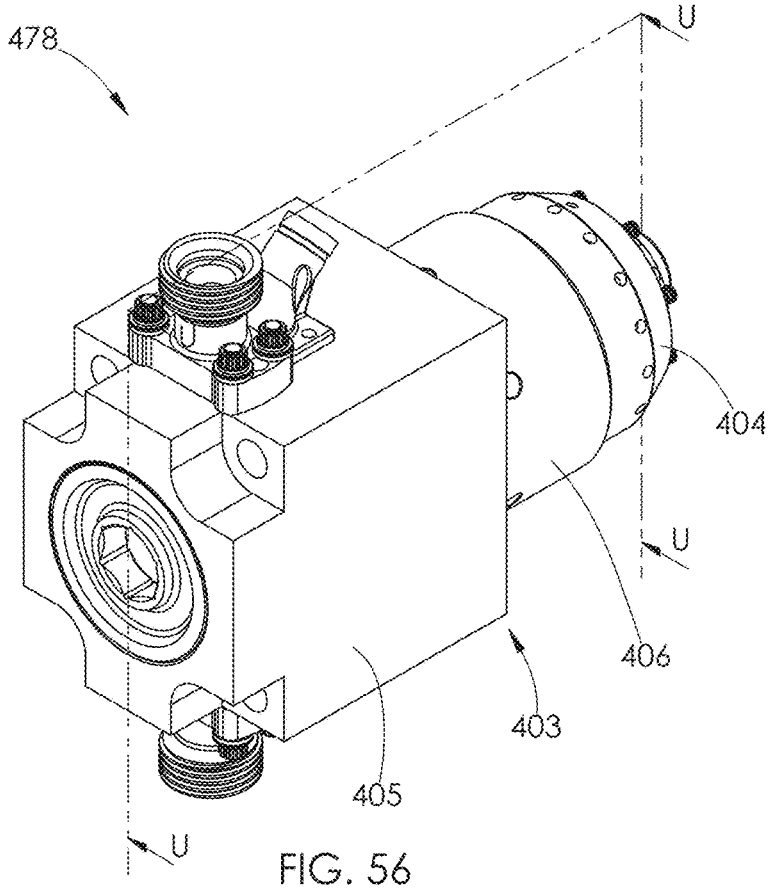
FIG. 56 is an isometric view of a fluid end section used on the fluid end shown in FIG. 55.
Figure 57:
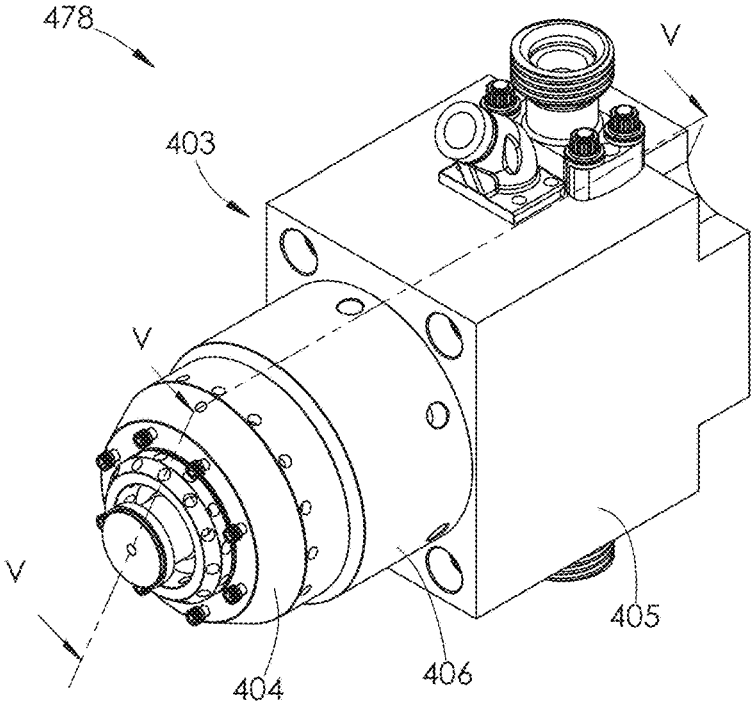
FIG. 57 is a back, top, left isometric view of the fluid end section shown in FIG. 56.
Figure 245:
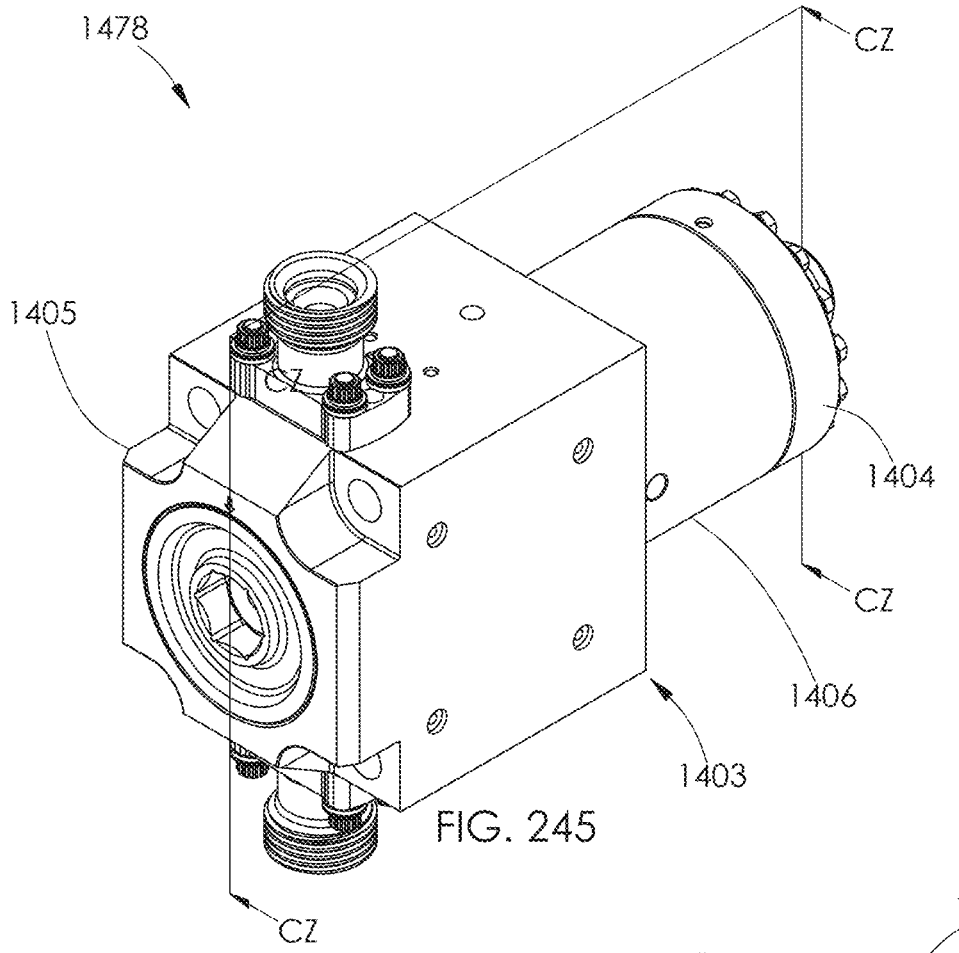

FIG. 245 is an isometric view of another embodiment of a fluid end section that may be used in the fluid end shown in FIG. 55.

Figure 246:
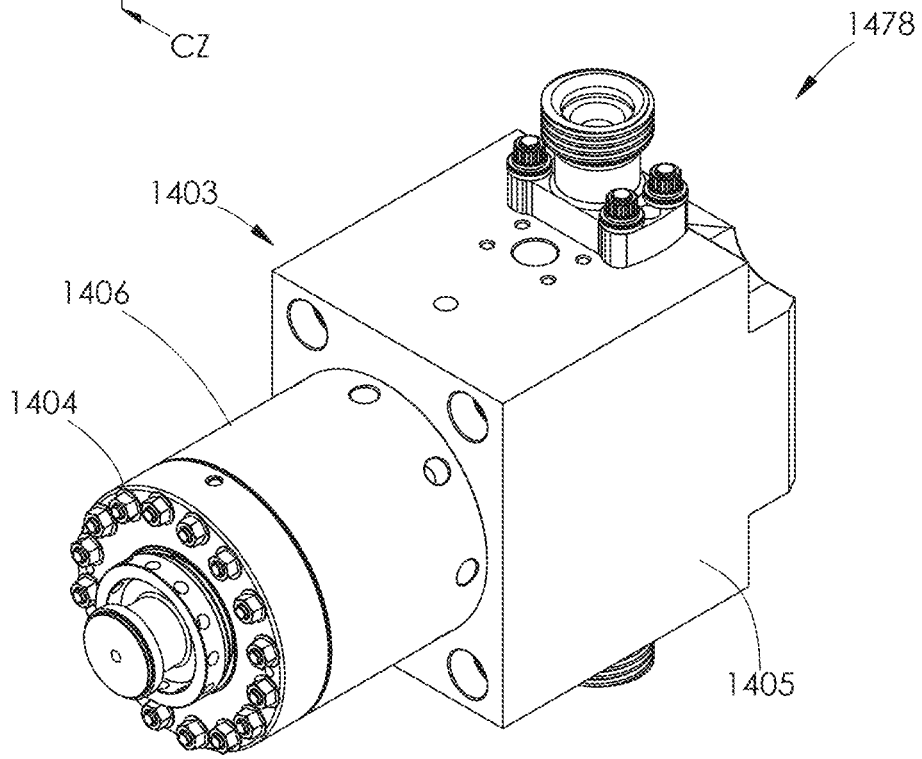

FIG. 246 is a rear isometric view of the fluid end section shown in FIG. 245.

Figure 247:
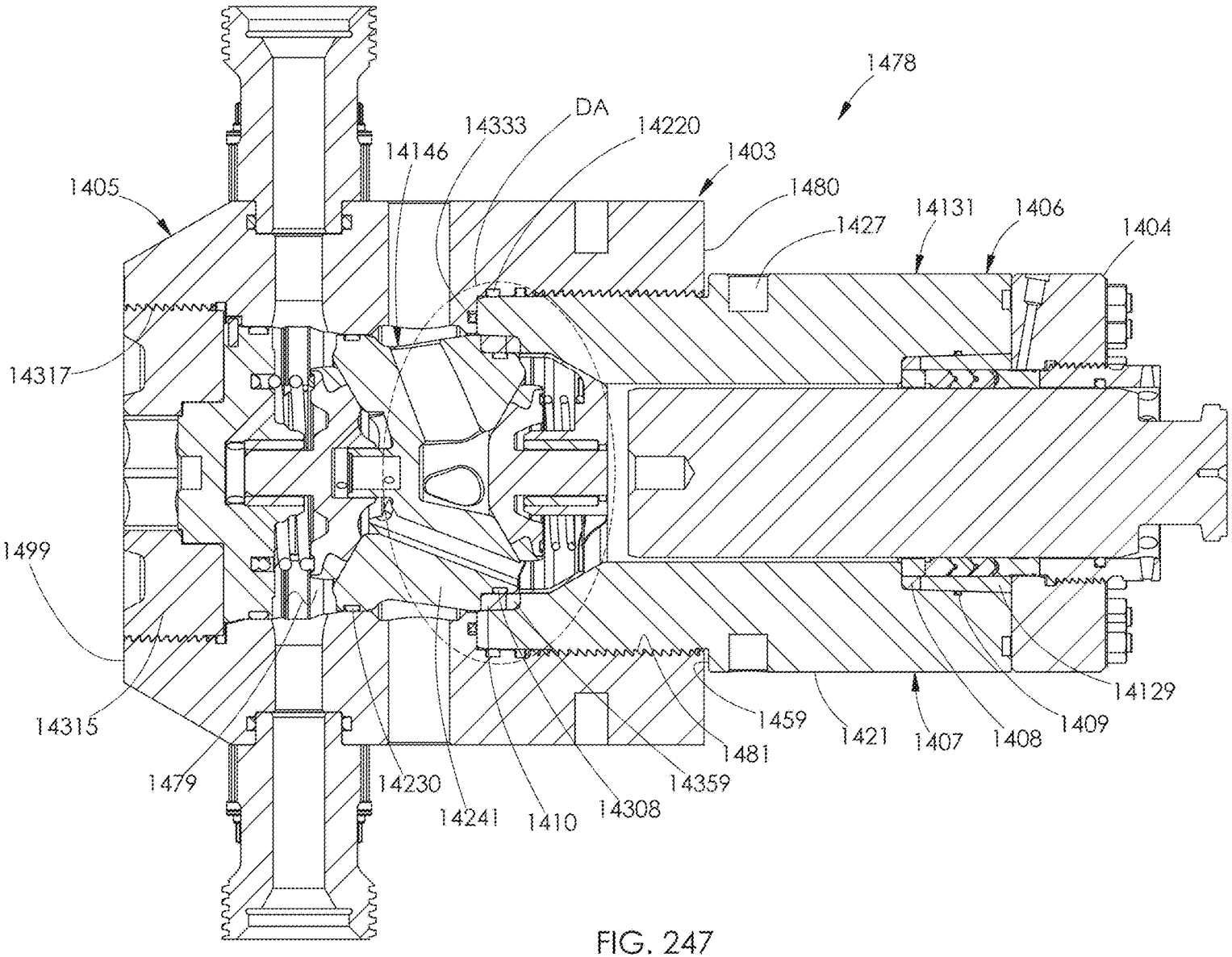

FIG. 247 is a cross-sectional view of the fluid end section shown in FIG. 245, taken along line CZ-CZ.

Figure 248:
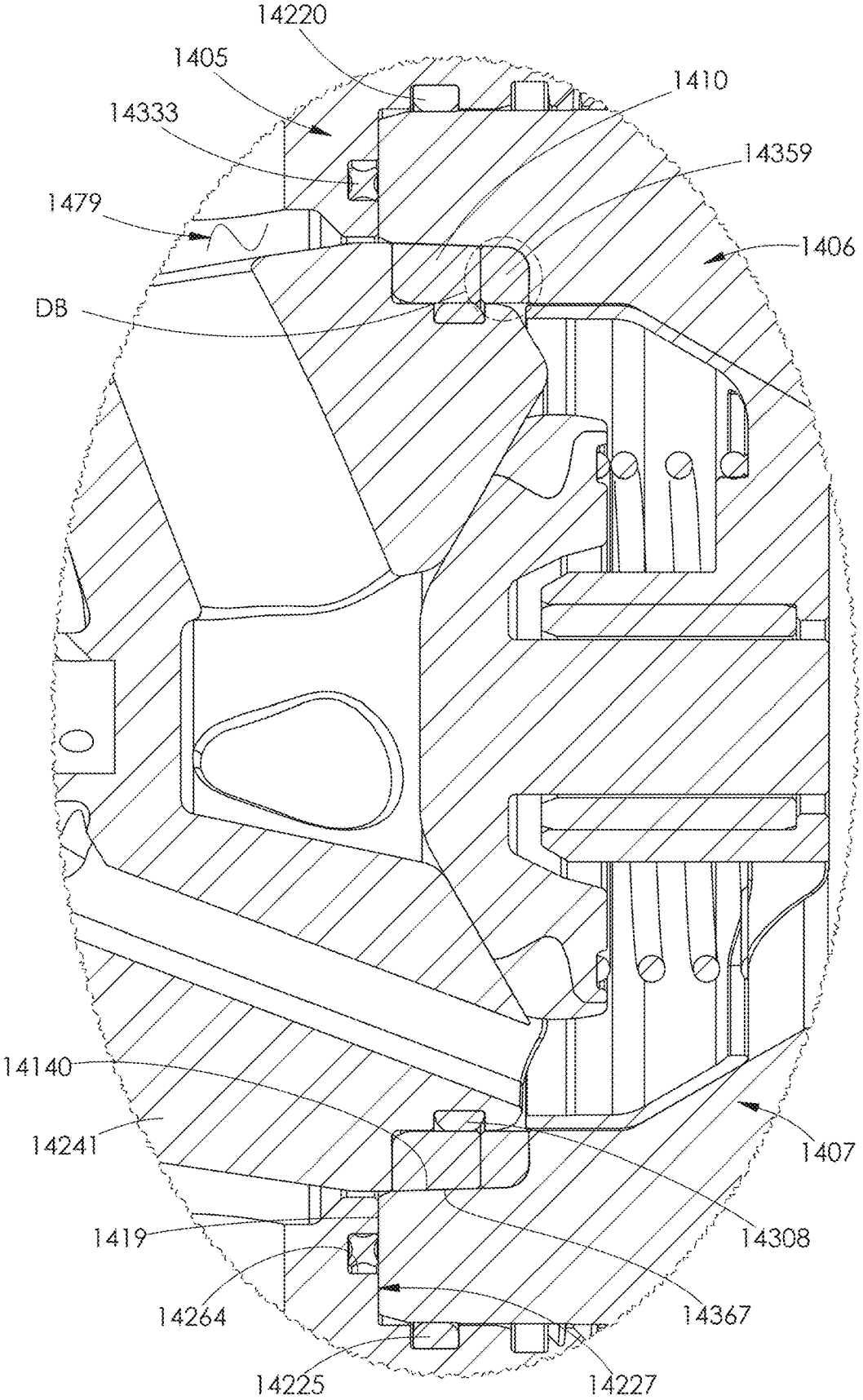

FIG. 248 is an enlarged view of area DA shown in FIG. 247.

Figure 249:
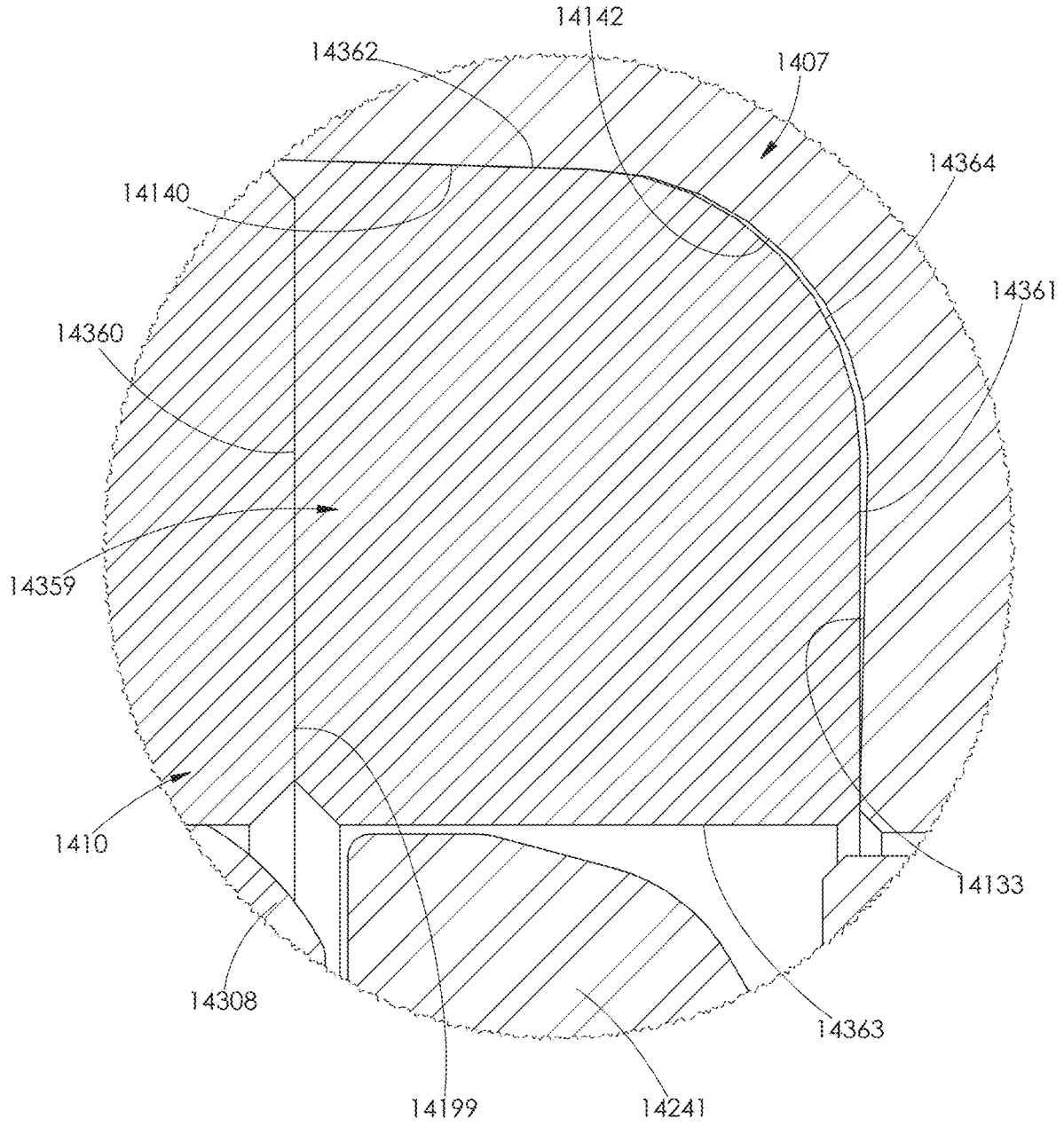

FIG. 249 is an enlarged view of area DB shown in FIG. 248. The angle of the flow control system wear ring shoulder has been exaggerated to illustrate the progressive engagement of the flow control system wear ring shoulder and the rear surface of the flow control system wear ring.

Figure 250:
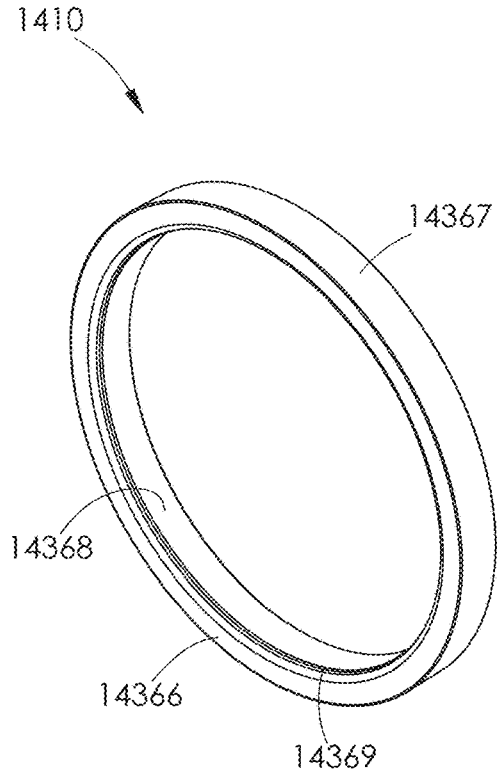

FIG. 250 is an isometric view of a front flow control system wear ring used in the fluid end section shown in FIG. 245.

Figure 251:
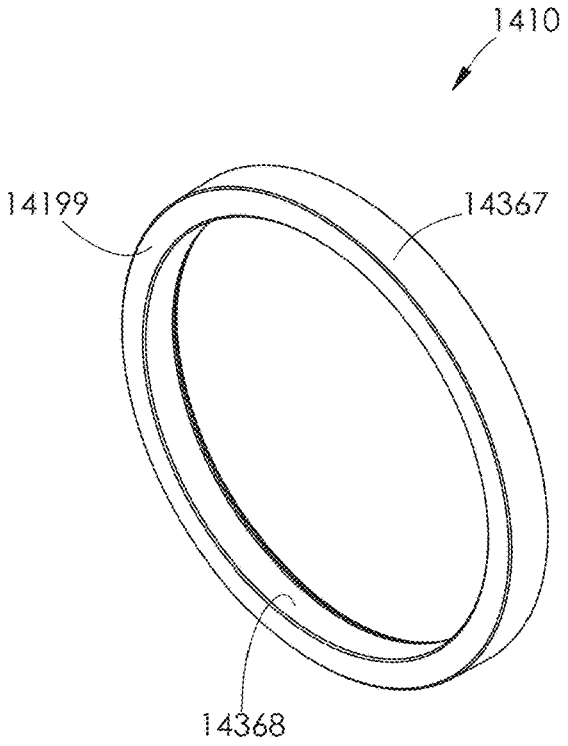

FIG. 251 is a rear isometric view of the front flow control system wear ring shown in FIG. 250.

Figure 252:
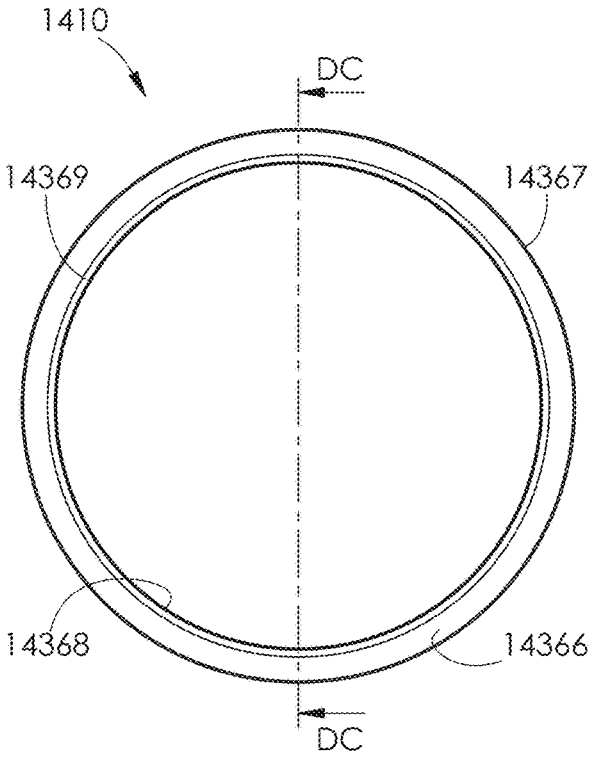

FIG. 252 is a front elevation view of the front flow control system wear ring shown in FIG. 250.

Figure 253:
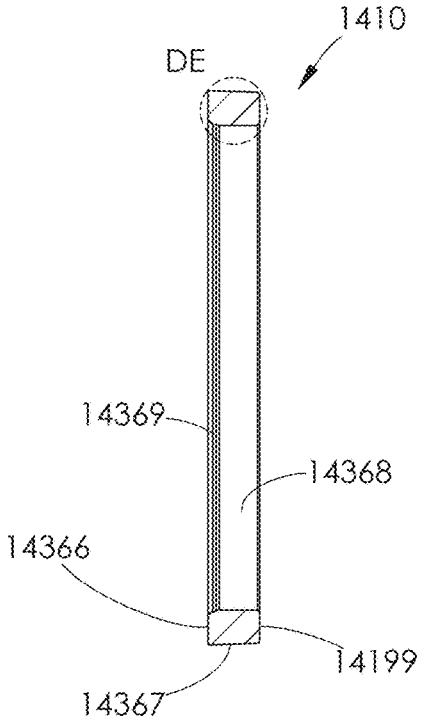

FIG. 253 is a cross-sectional view of the front flow control system wear ring shown in FIG. 252, taken along line DC-DC.

Figure 254:
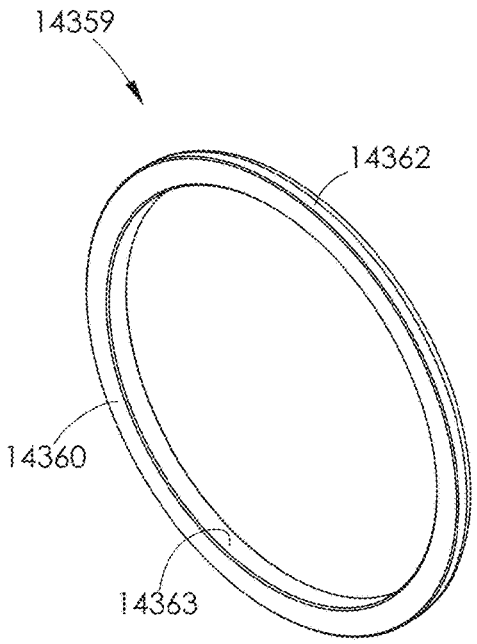

FIG. 254 is an isometric view of a rear flow control system wear ring used in the fluid end section shown in FIG. 245.

Figure 255:
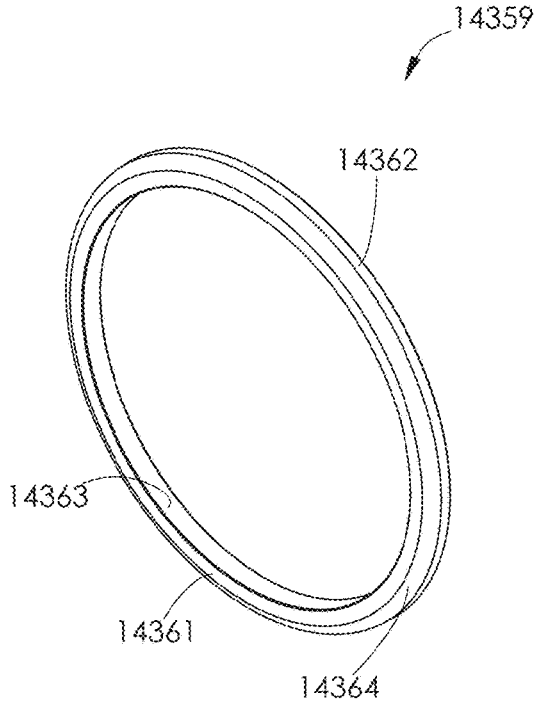

FIG. 255 is a rear isometric view of the rear flow control system wear ring shown in FIG. 254.

Figure 256:
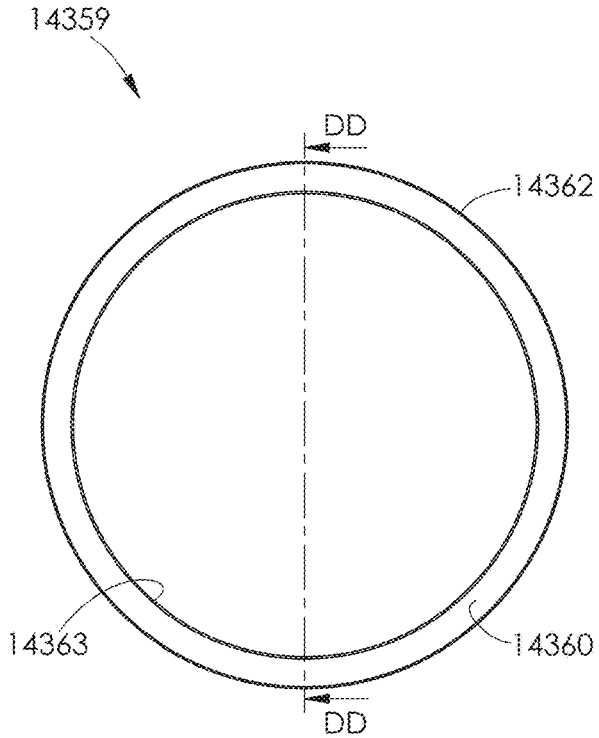

FIG. 256 is a front elevation view of the rear flow control system wear ring shown in FIG. 254.

Figure 257:
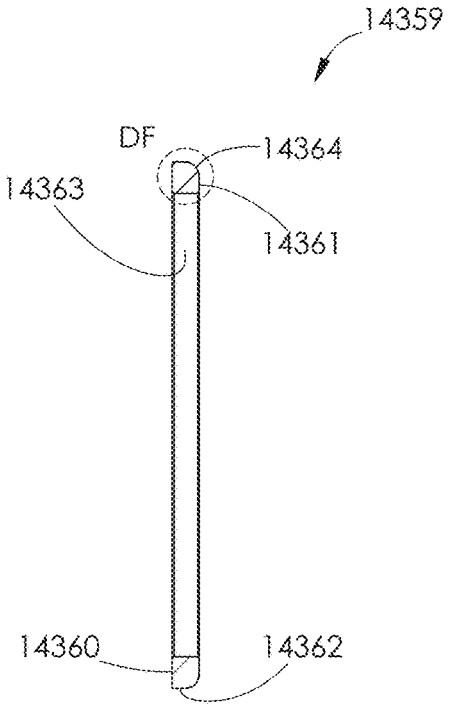

FIG. 257 is a cross-sectional view of the rear flow control system wear ring shown in FIG. 256, taken along line DD-DD.

Figure 258:
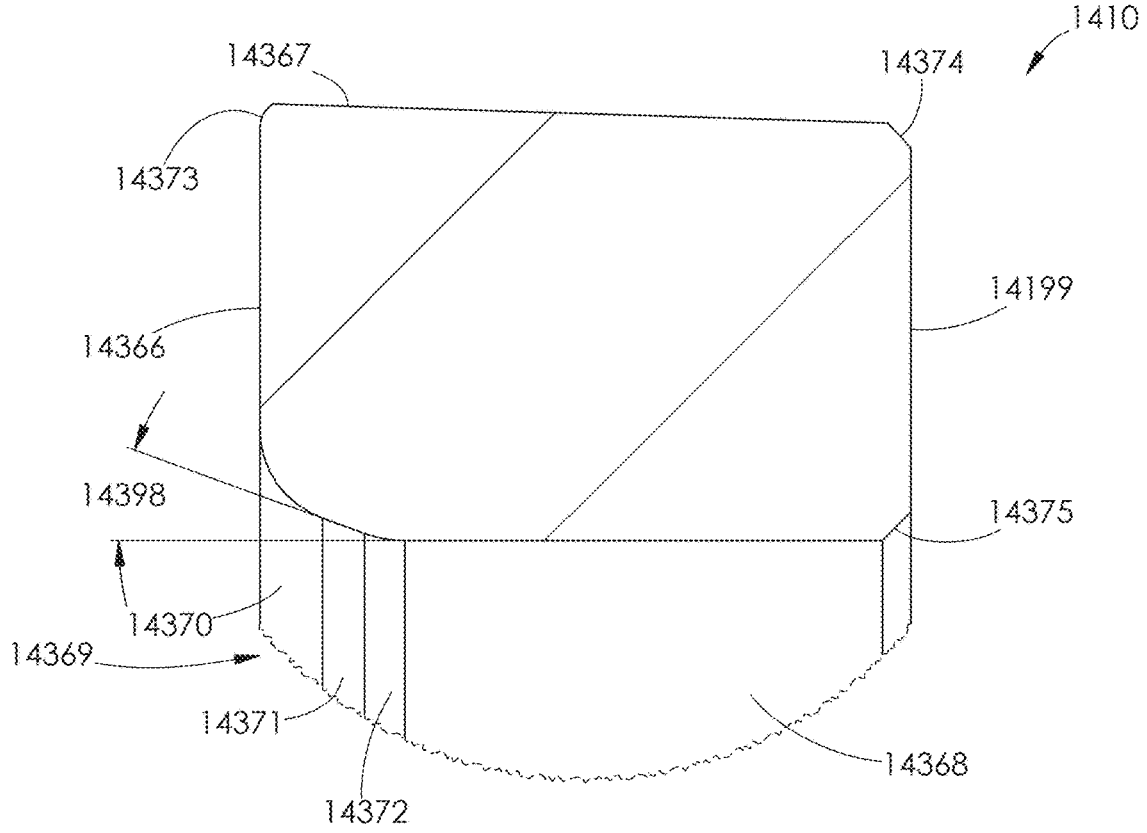

FIG. 258 is an enlarged view of area DE shown in FIG. 253.

Figure 259:
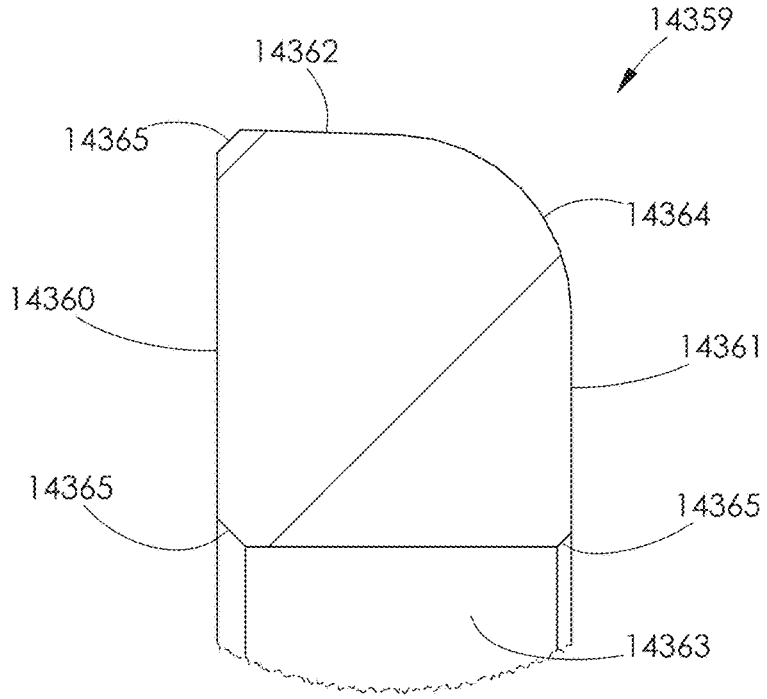

FIG. 259 is an enlarged view of area DF shown in FIG. 257.

Figure 260:
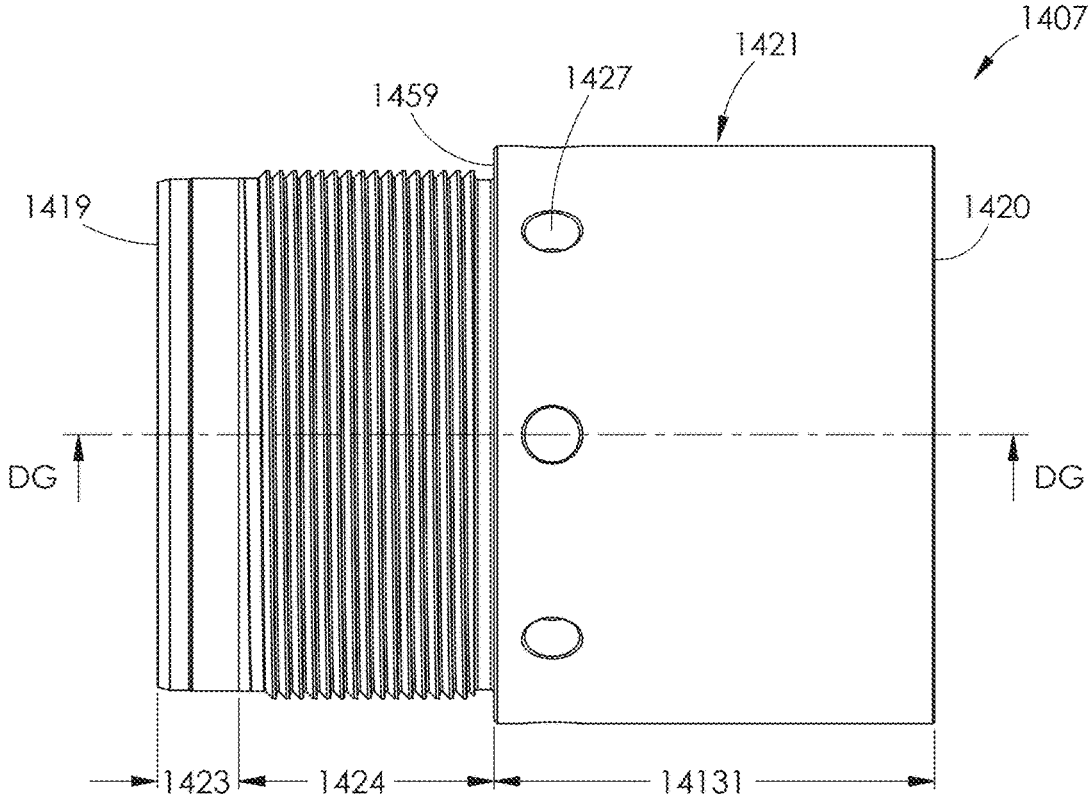

FIG. 260 is a top plan view of a dynamic body used in the fluid end section shown in FIG. 245.

Figure 261:
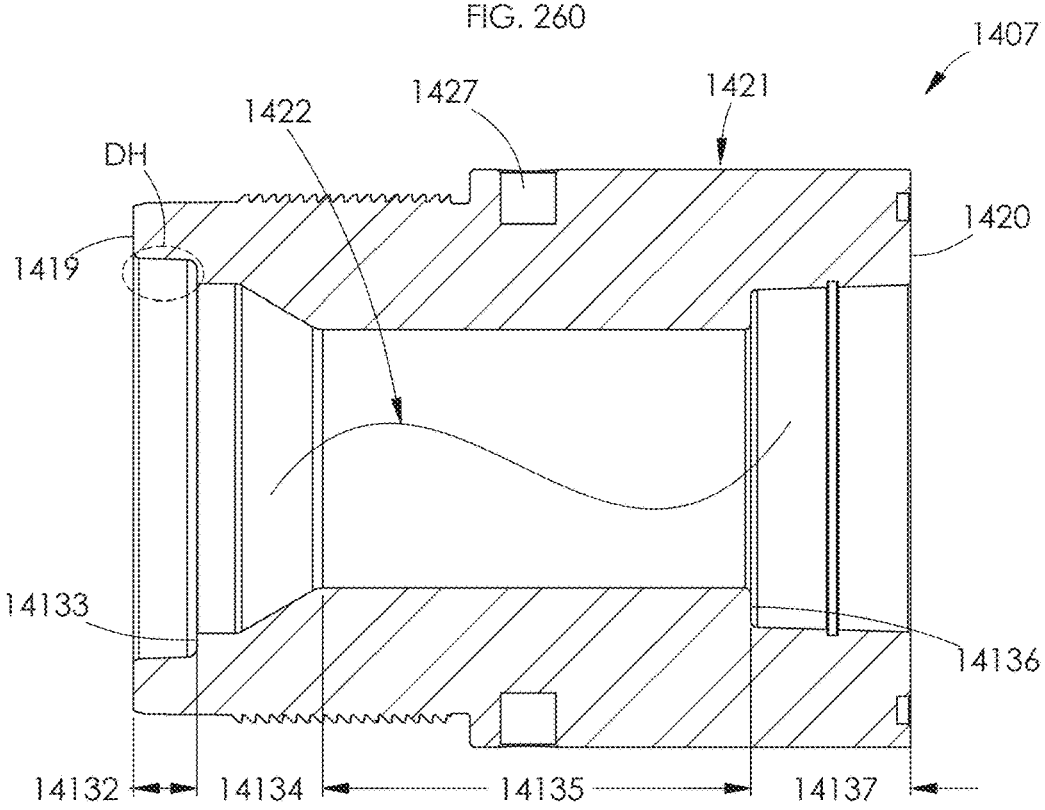

FIG. 261 is a cross-sectional view of the dynamic body shown in FIG. 260, taken along line DG-DG.

Figure 262:
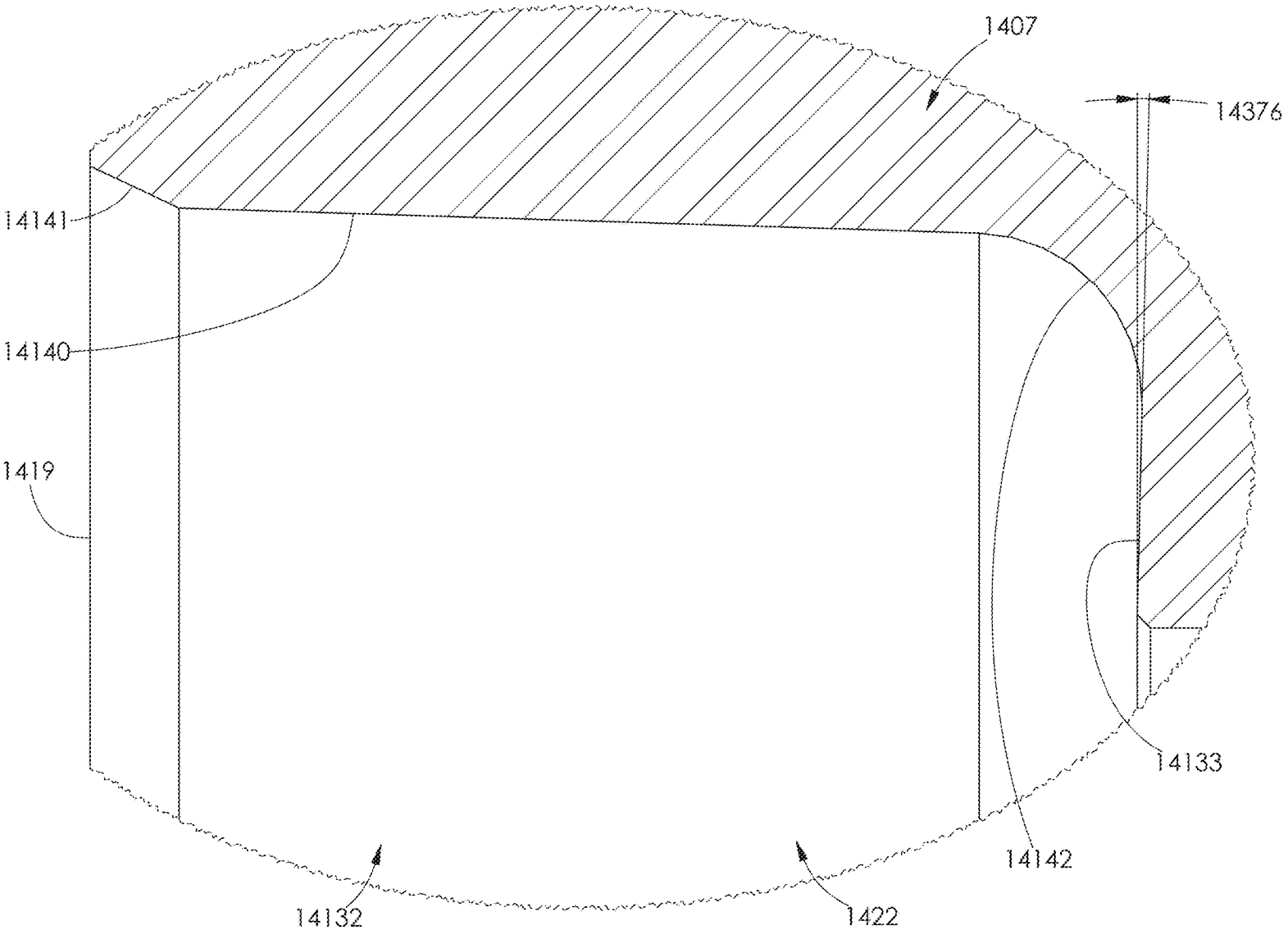

FIG. 262 is an enlarged view of area DH shown in FIG. 261.

Figure 263:
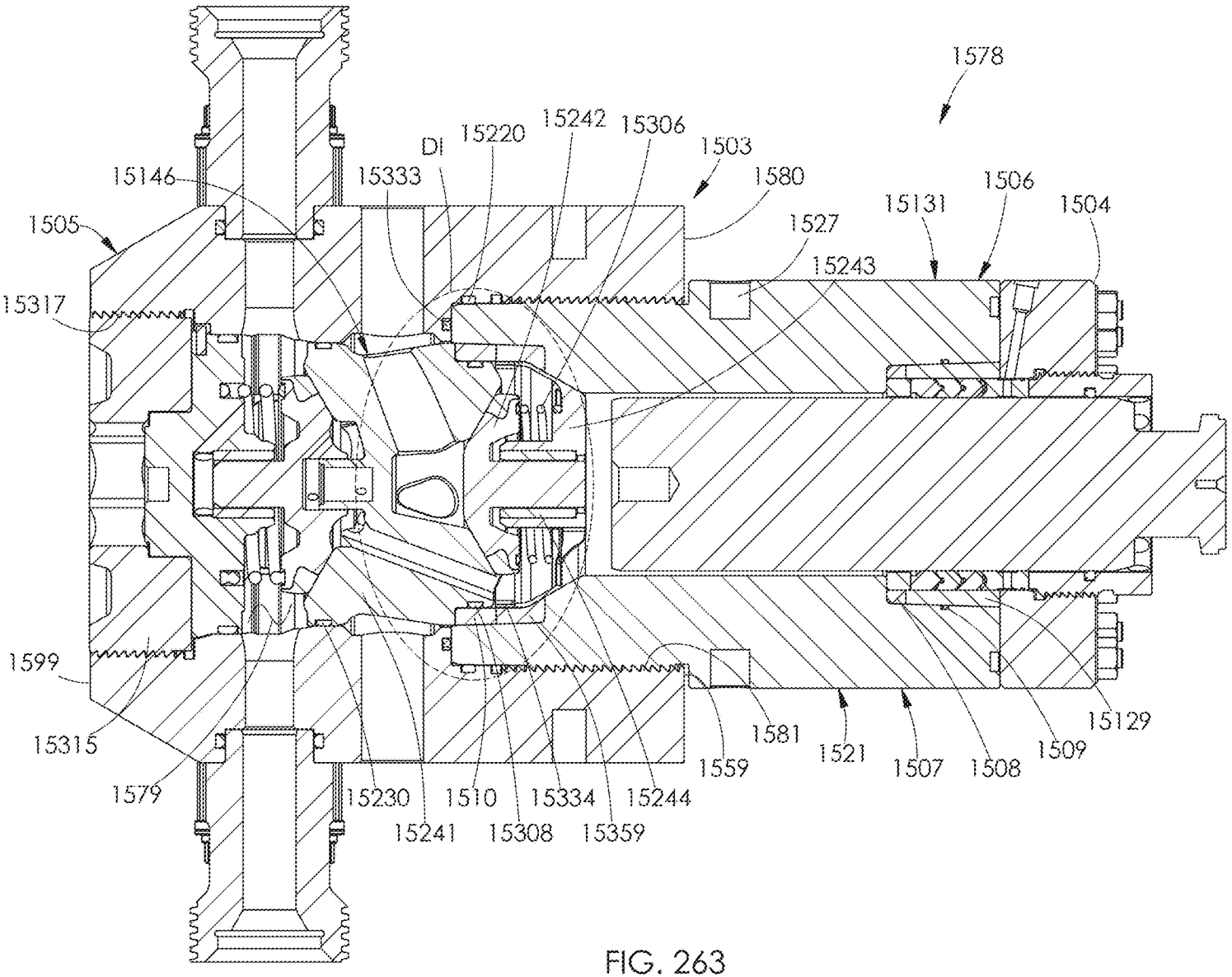

FIG. 263 is a cross-sectional view of another embodiment of a fluid end section that may be used in the fluid end shown in FIG. 55. This cross-sectional view is taken along a section line in the new embodiment that corresponds in location to CZ-CZ in FIG. 245.

Figure 264:
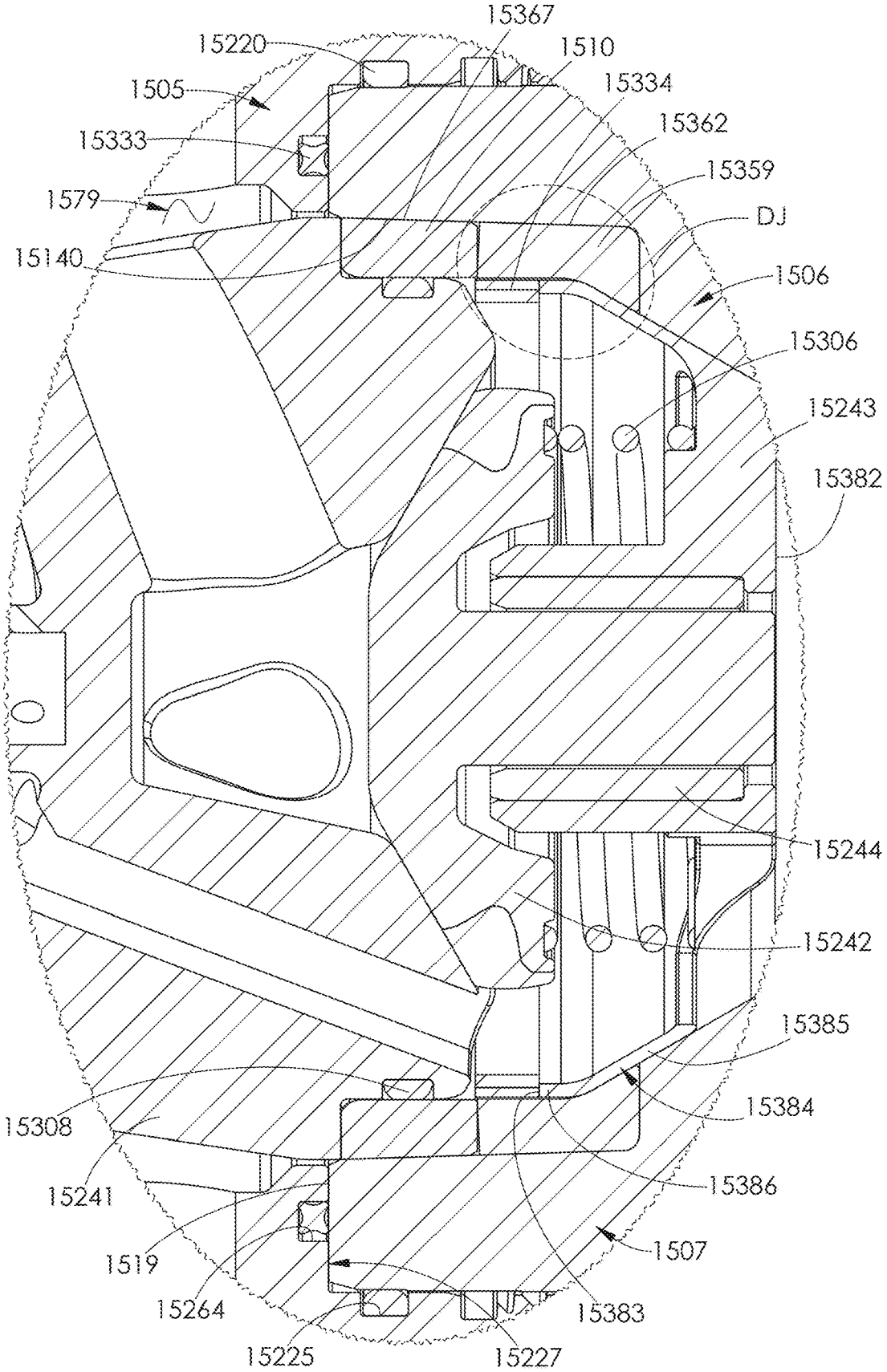

FIG. 264 is an enlarged view of area DI shown in FIG. 263.

Figure 265:
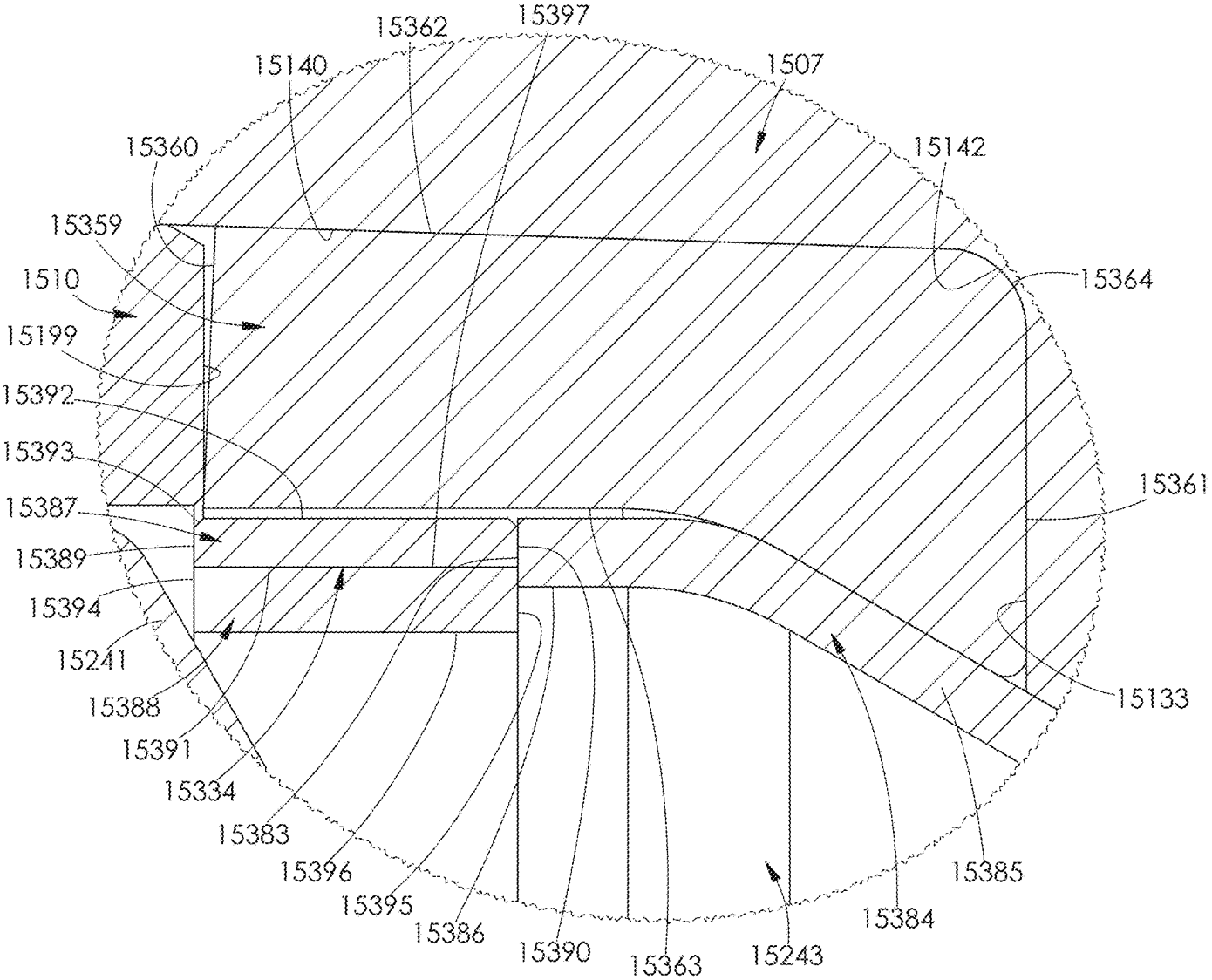

FIG. 265 is an enlarged view of area DJ shown in FIG. 264.

Figure 266:
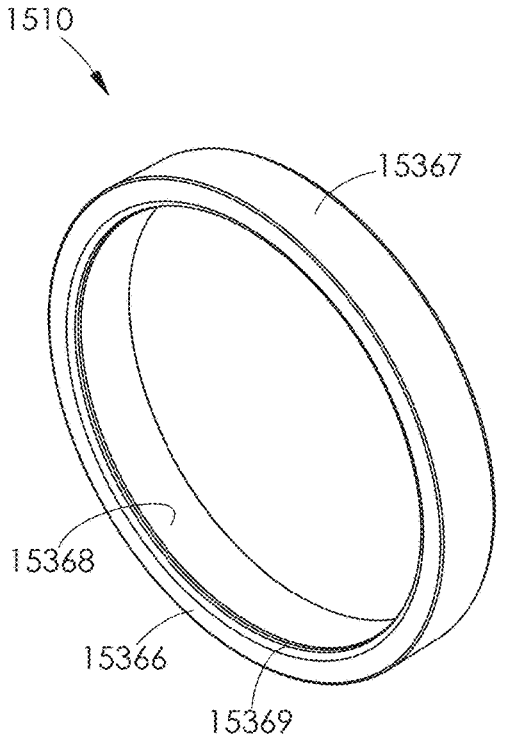

FIG. 266 is an isometric view of a front flow control system wear ring used in the fluid end section shown in FIG. 263.

Figure 267:
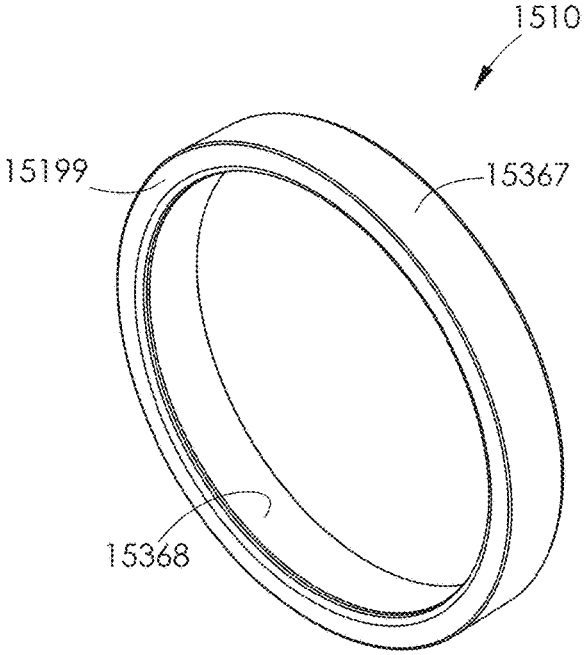

FIG. 267 is a rear isometric view of the front flow control system wear ring shown in FIG. 266.

Figure 268:
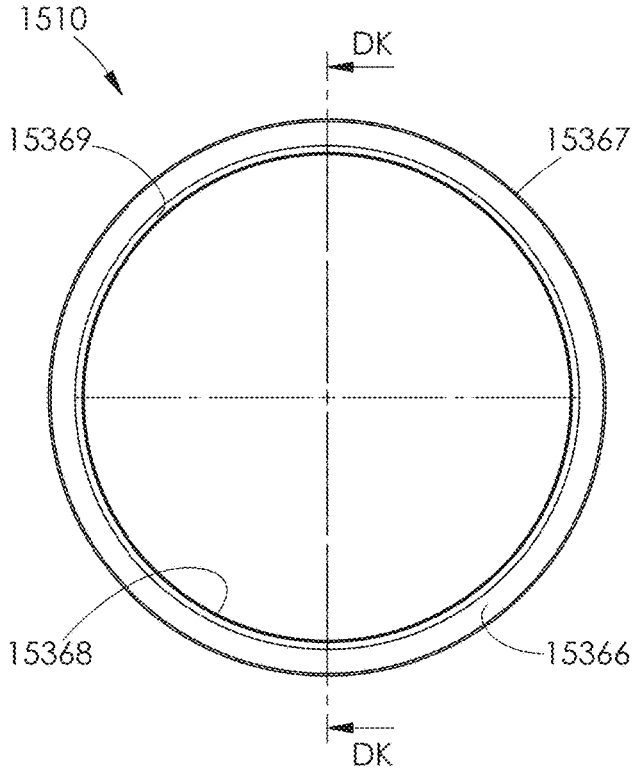

FIG. 268 is a front elevation view of the front flow control system wear ring shown in FIG. 266.

Figure 269:
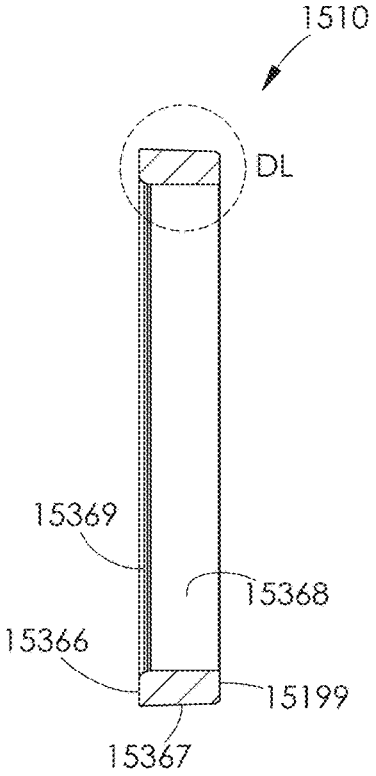

FIG. 269 is a cross-sectional view of the front flow control system wear ring shown in FIG. 268, taken along line DK-DK.

Figure 270:
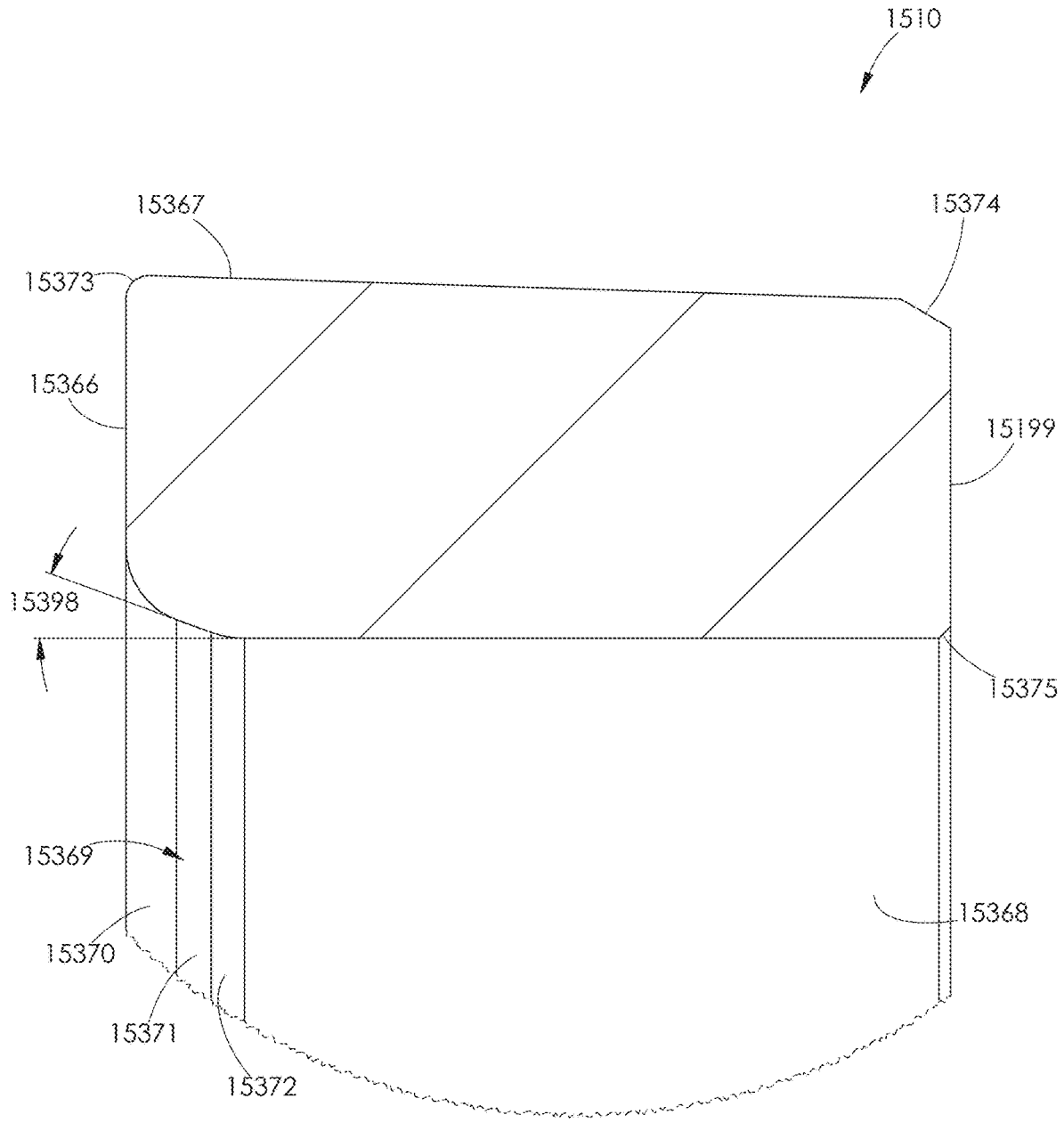

FIG. 270 is an enlarged view of area DL shown in FIG. 269.

Figure 271:
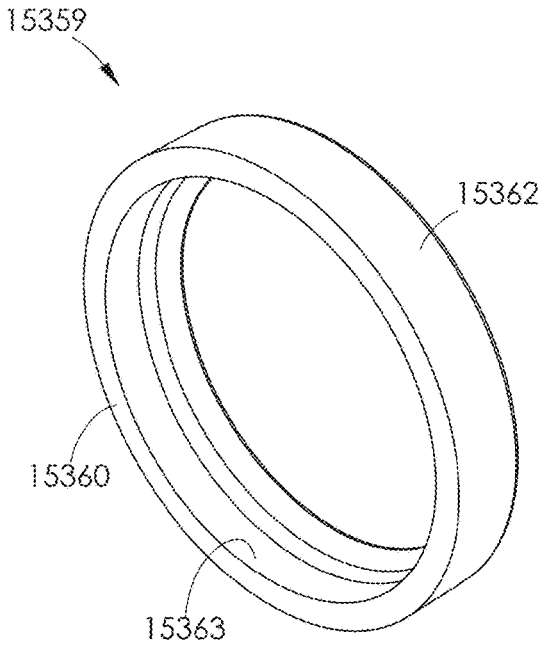

FIG. 271 is an isometric view of a rear flow control system wear ring shown in FIG. 263.

Figure 272:
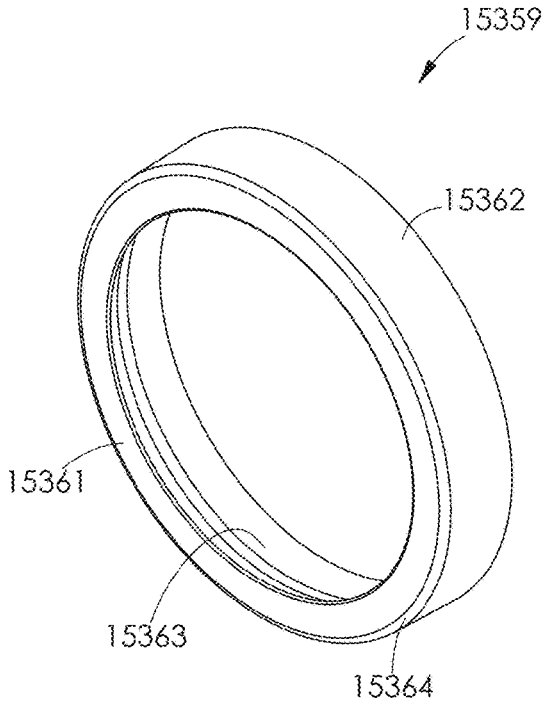

FIG. 272 is a rear isometric view of the rear flow control system wear ring shown in FIG. 271.

Figure 273:
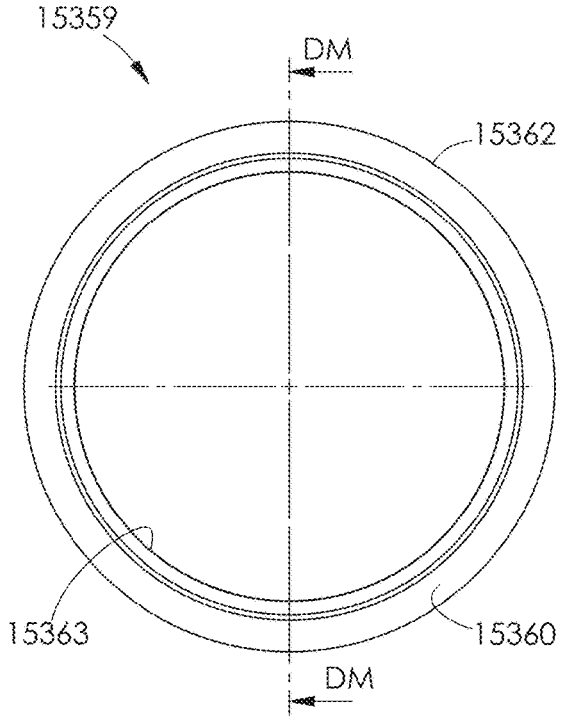

FIG. 273 is a front elevation view of the rear flow control system wear ring shown 271.

Figure 274:
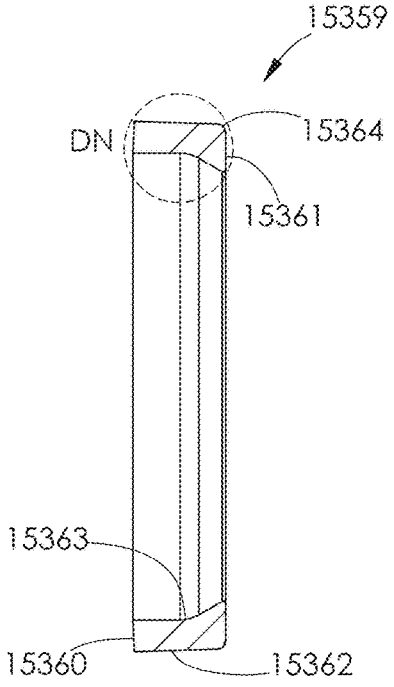

FIG. 274 is a cross-sectional view of the rear flow control system wear ring shown in FIG. 273, taken along line DM-DM.

Figure 275:
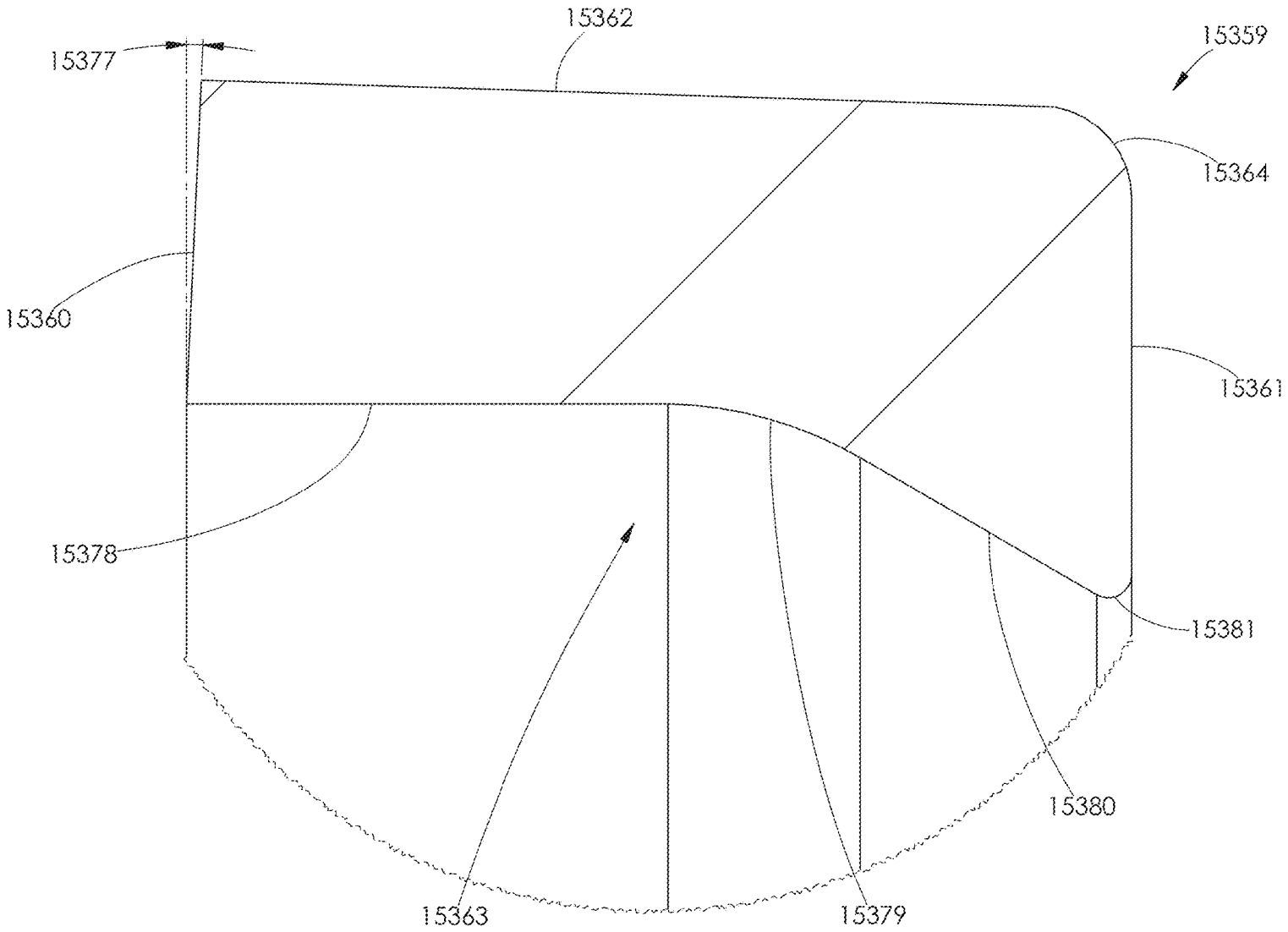

FIG. 275 is an enlarged view of area DN shown in FIG. 273.

Figure 276:
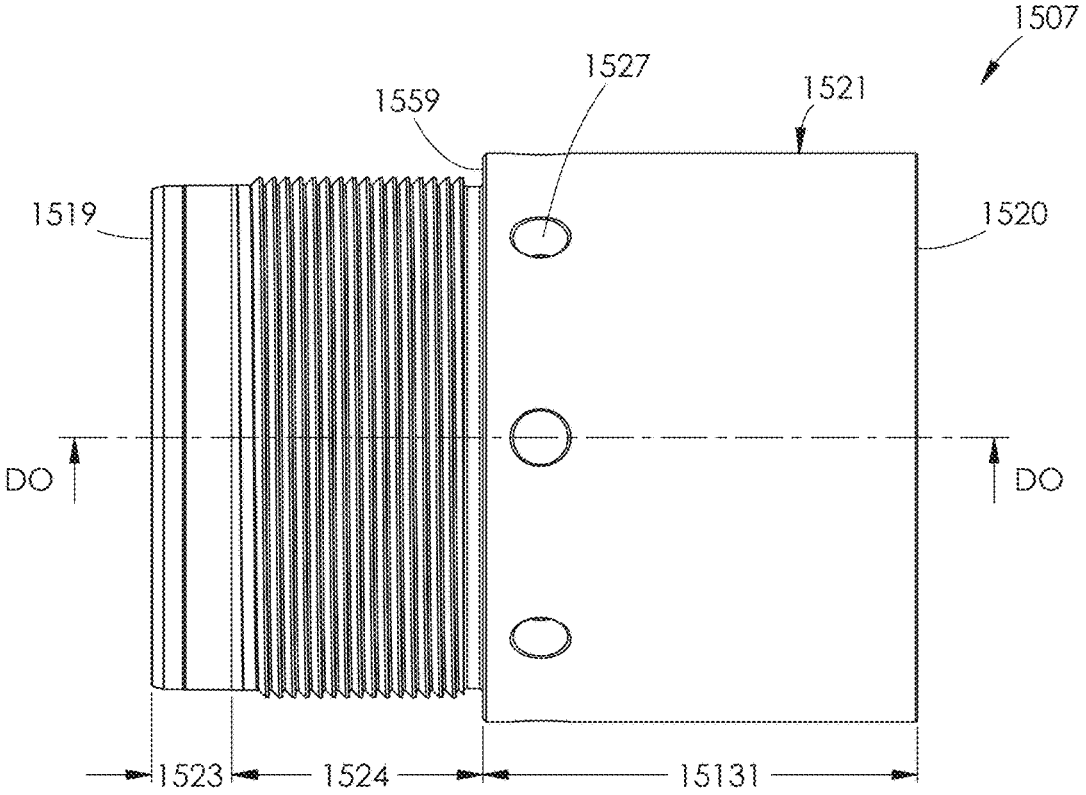

FIG. 276 is a top plan view of a dynamic body used in the fluid end section shown in FIG. 263.

Figure 277:
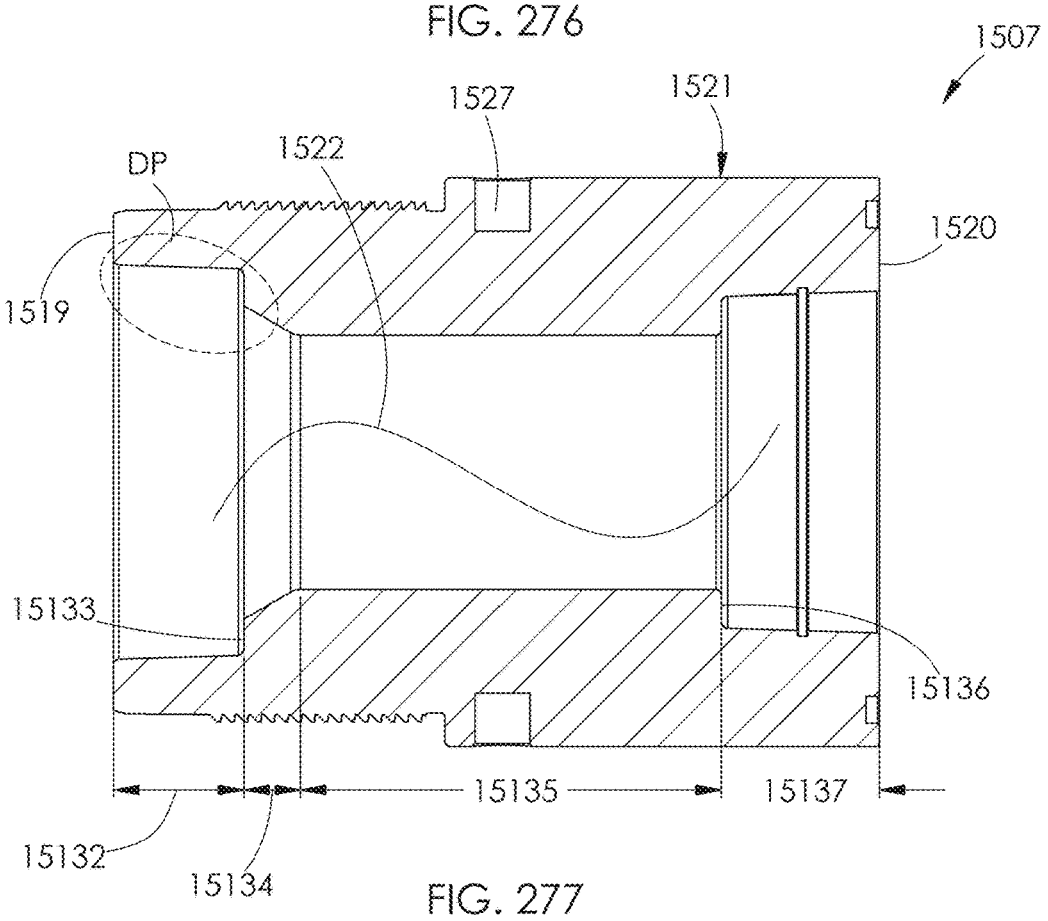

FIG. 277 is a cross-sectional view of the dynamic body shown in FIG. 276, taken along line DO-DO.

Figure 278:
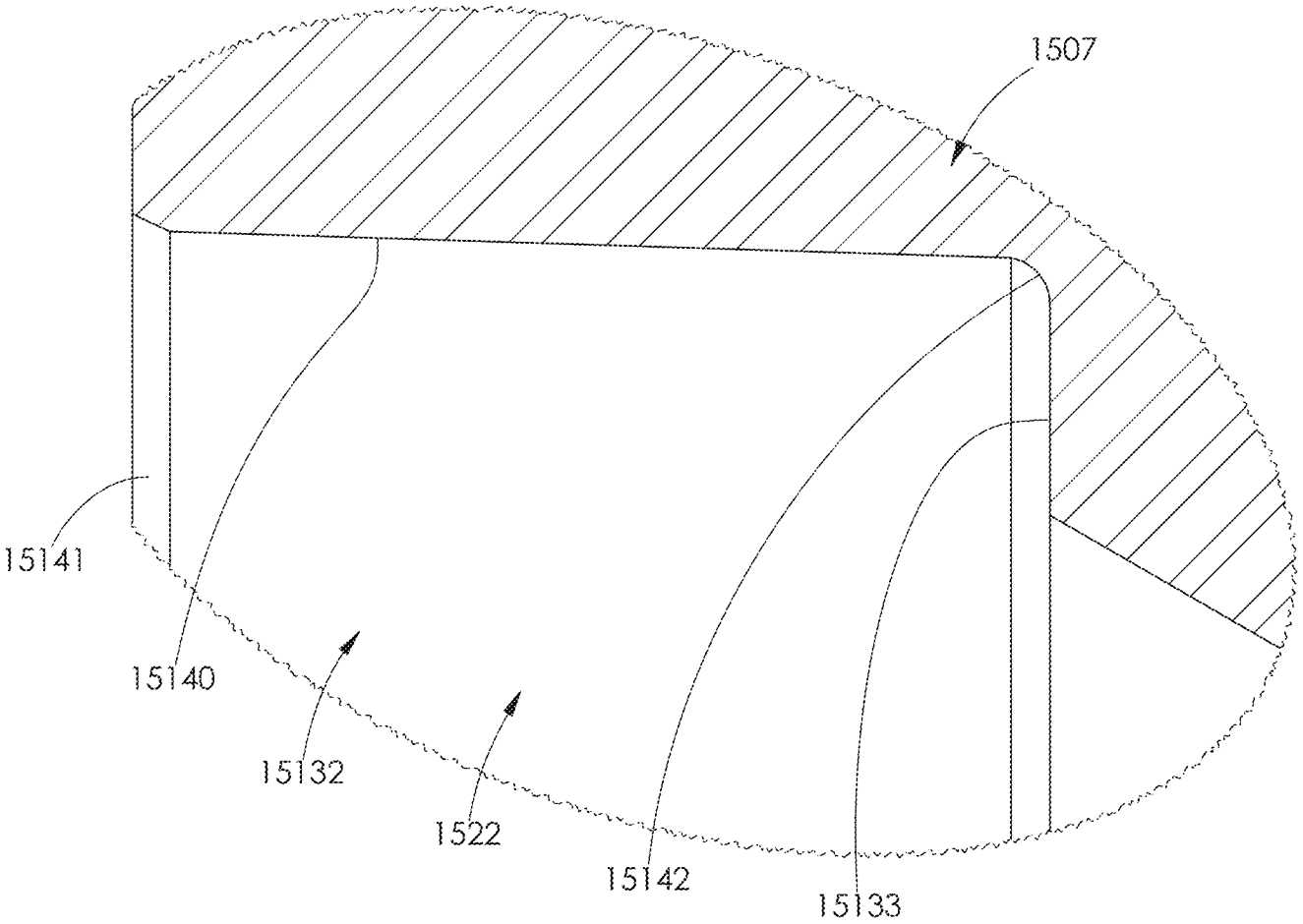

FIG. 278 is an enlarged view of area DP shown in FIG. 277.

DETAILED DESCRIPTION

This patent application describes an apparatus that simplifies the assembly, disassembly, and maintenance of a high-pressure pump shown in the figures. The design of the pump reduces wear, and transfers forces away from hard-to-replace parts and weak points of the pump. The application also describes a method for using the apparatus. The application further describes additional embodiments of such a high-pressure pump and components which may aid in its assembly, maintenance, and repair, as shown in the following figures and paragraphs. Features of the pump, shown, reduce and transfer wear in advantageous ways, resulting in better life and performance.

In general, the figures show improvements of a patented pump design shown in U.S. Pat. No. 11,346,339, issued to Nowell, et. al., and U.S. Pat. No. 12,018,662, issued to Keith, et. al., the contents of each of the foregoing patents are incorporated by reference herein.

However, while the pumps of the incorporated references are effective, the "in-line" nature of the fluid end of the pump has led to inventive features and designs which continue to improve operation. In particular, the pump of the following figures includes what is referred to herein as a "dynamic section." This phrase, generally, refers to the portion of the fluid-handling system of the pump's fluid end in which the plunger operates. This section is "dynamic" because fluid enters this section at a lower pressure, from a suction manifold, and is pressurized while forced across a fluid routing plug by an extension of a plunger, past a discharge valve. Once past the discharge valve, the fluid is now in a high pressure environment, and may exit at a fluid manifold.

Thus, in the "static section", as defined below, pressures are always generally the same—high pressure exists once fluid passes the discharge valve and enters the discharge conduits to exit into the discharge manifold. Low pressure exists around the intermediate section of a fluid routing plug where fluid enters. These areas are well-sealed and pressure fluctuations are minor. However, in the "dynamic section", the retraction and extension of the plunger causes repeated, dramatic pressure changes.

As a result, the connection between the "static section" and "dynamic section" is critical, as it may be a point at which wear can become evident and failures to valves and seals may occur. In addition, the manner in which components within the dynamic section are accessible is of the utmost importance, as the proper maintenance and replacement of worn parts will prevent the wear or failure of larger components.

To that end, this disclosure introduces a threaded dynamic section. Each threaded dynamic section is joined to the static sections by external threads about the periphery of the dynamic section, rather than being bolted to the static section. Various preloading methods and thread designs may be utilized to reduce stress concentrations and preserve thread life on these threads.

In addition, the dynamic section has a shoulder or nose at which a fluid routing plug, and the static section, seats. At this point, hardened inserts of various geometries are disclosed that may bear repeated compression force and thus improve the life of components, and various sealing methods may be utilized to address the potential for high pressure, abrasive fluid to create a failure point. These hardened inserts may be made of carbide, but the use of tool steel or another hardened metal alloy may also be utilized.

Various retaining mechanisms are described to limit movement and wear such that the life of the pump is extended and wear is transferred to easily-replaced components. Specifically, a discharge plug on the static section may allow access to many components for inspection, removal, and replacement.

High pressure fluid leaving the static section may benefit from symmetrical paths, and a discharge manifold having robust design and both a top and bottom portion is provided to eliminate wear to the static section and outlets caused by a single route.

Tools and procedures to install components, such as the fluid routing plug, should be used which prevent stress to critical points within the system. Such tools and procedures are inventive and described herein.

Dual guide valves and passages are used to clear material trapped within the pump. Such improvements reduce misalignment of valves due to gravity and the resulting uneven wear. Likewise, the components are utilized to promote laminar flow and eliminate or reduce direct impact (or its effects) of fluid flow on key components, such as the fluid routing plug, discharge valve face, flow bore, discharge plug, and suction valve guide.

Wear items between the dynamic section and the fluid routing plug aid in preventing damage to difficult-to-replace portions of the pump. For example, a wear ring is provided between the plug and the dynamic section. This wear ring may be formed in two parts which abut one another. The first part—or front wear ring—is heavy press fit within a bore of the dynamic section. A rear wear ring abuts this front wear ring and is light press fit—with a rear radius on the surface of the rear wear ring where it abuts the dynamic section body.

Additionally, a shoulder is formed on the dynamic section where the radius interfaces with the rear wear ring. This shoulder is formed such that localized elastic deformation gradually distributes the load associated with contact between the wear ring and the dynamic section.

The rear wear ring may be formed to conform with an inner, tapered surface of the dynamic section, such that a valve guide with a constant outer taper may be used. The valve guide may have a multi-piece transition to reduce wear. For example, the valve guide may abut a two-piece ring, which may be a sacrificial piece to set a minimum distance between a valve guide and the fluid routing plug. The inner piece of the two-piece ring may be made of a soft material, such as urethane, which is resistant to wear associated with high pressure abrasive fluid being forced out of and into the fluid routing plug with each stroke of the plunger. The outer ring may be a harder material, designed to resist longitudinal forces and to provide a medium for the inner ring to adhere to.

Figure 1:
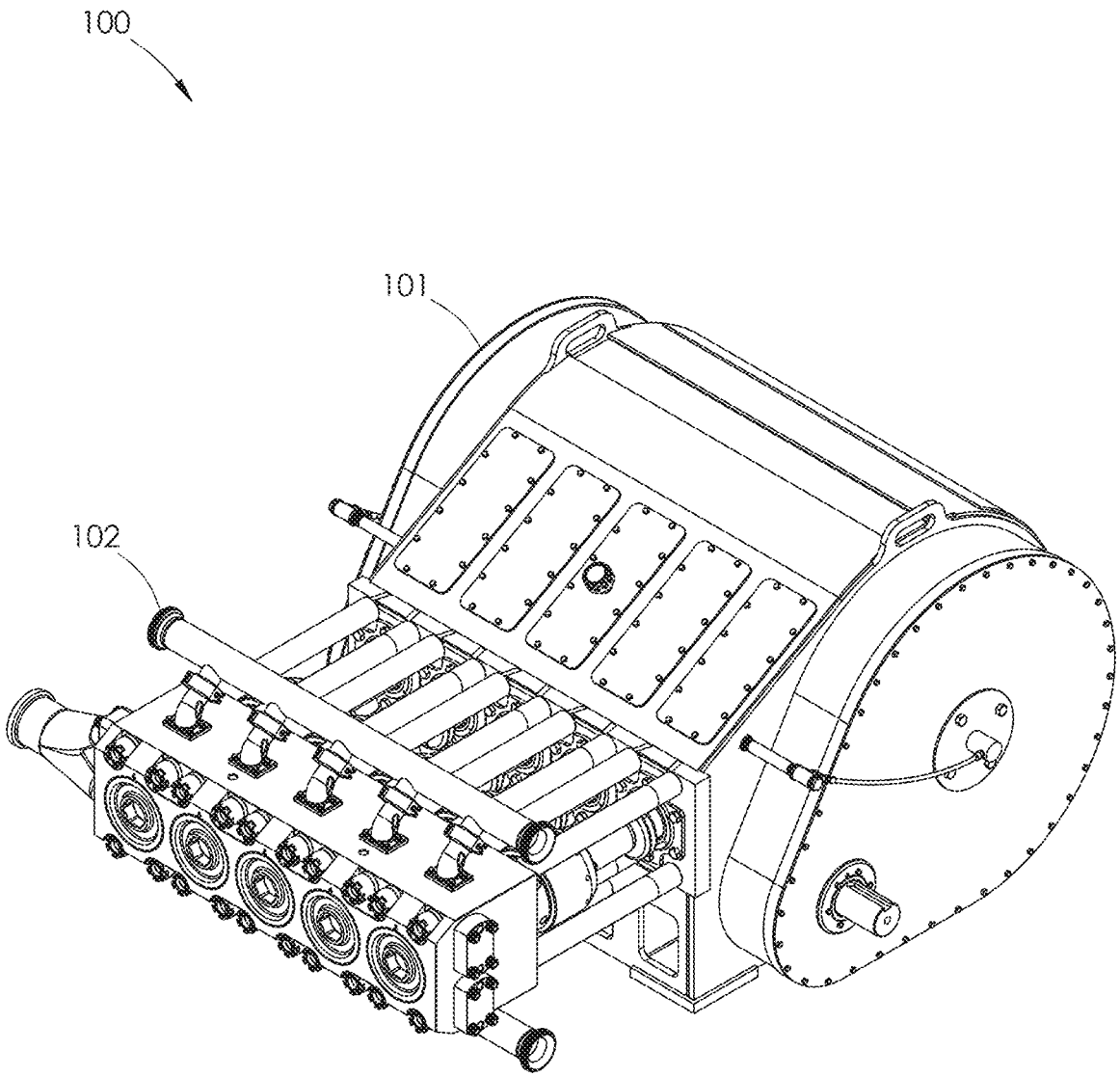
FIG. 1 is an isometric view of a high-pressure pump using one embodiment of a multi-piece fluid end.
Figure 2:
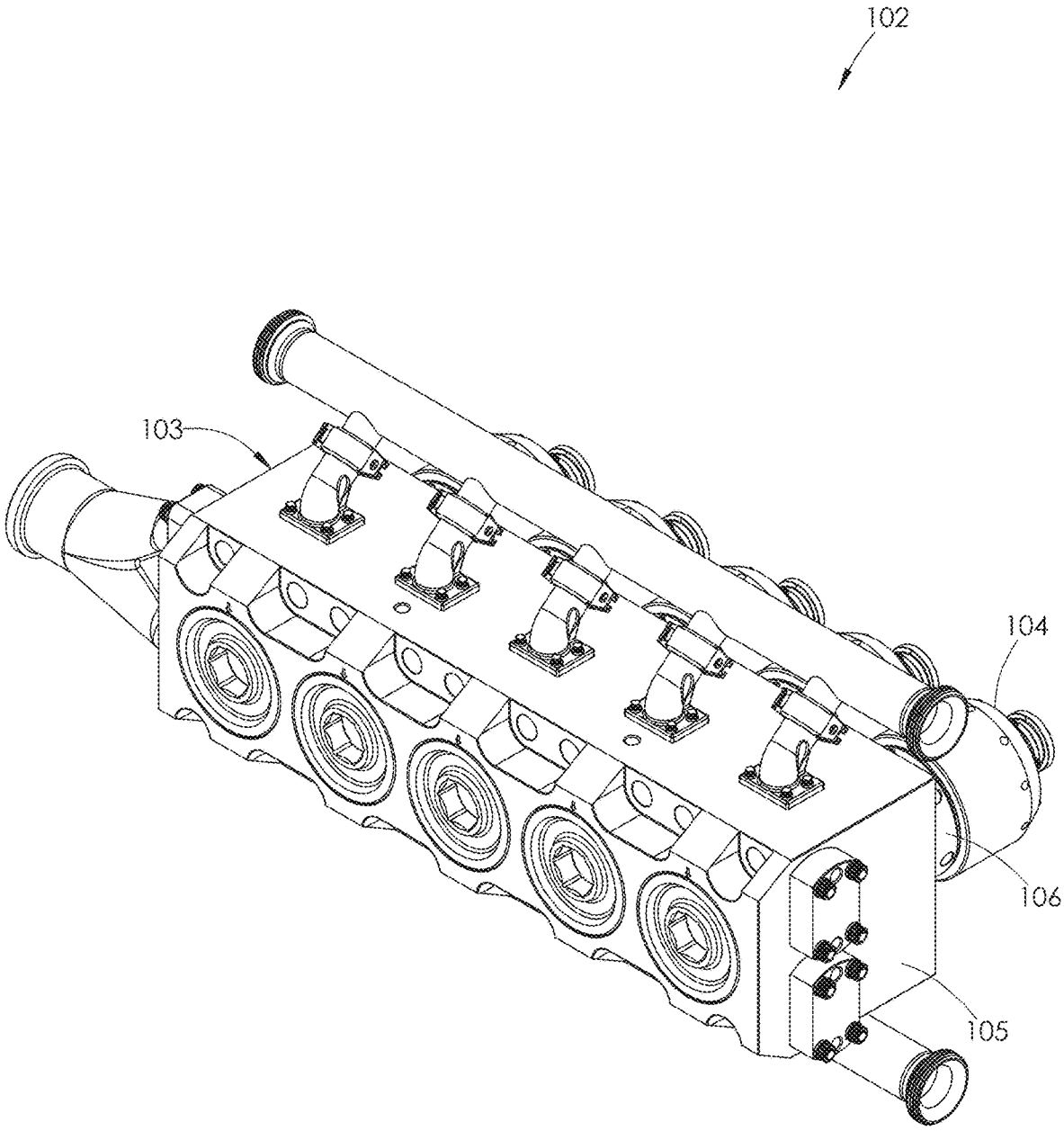
FIG. 2 is an isometric view of the multi-piece fluid end shown in FIG. 1.
Figure 3:
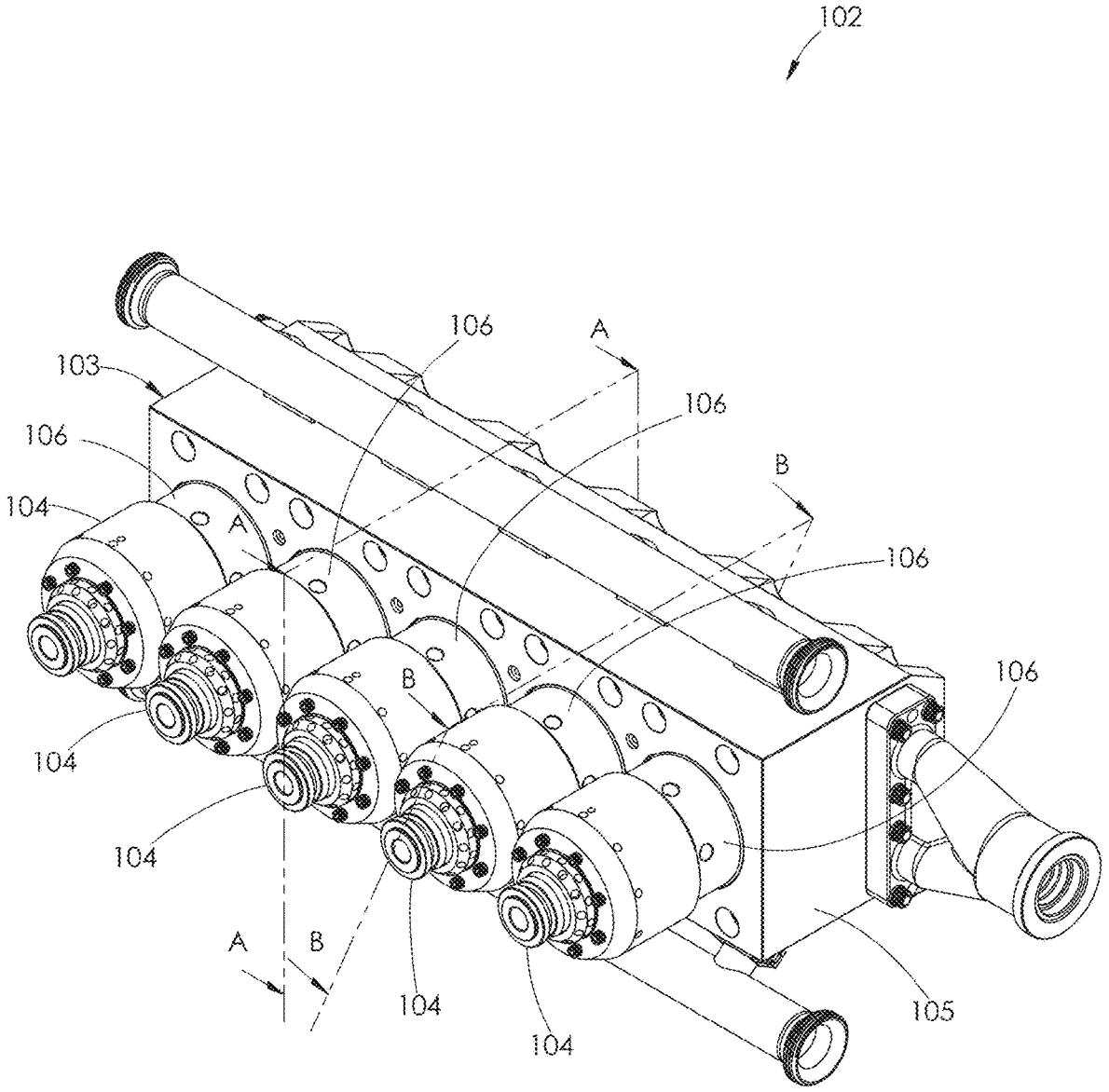
FIG. 3 is a back, top, left isometric view of the multi-piece fluid end shown in FIG. 2.
Figure 4:
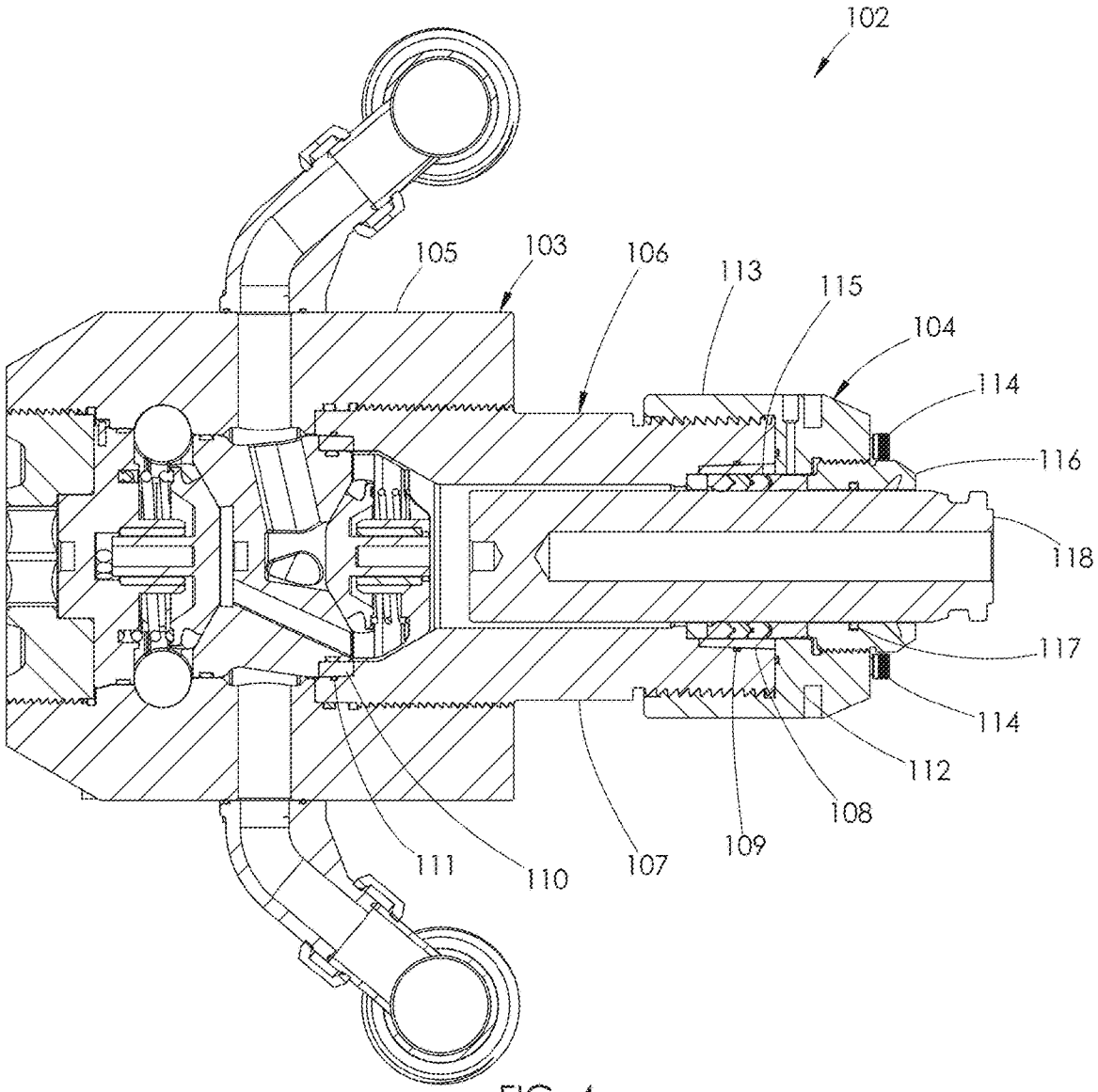
FIG. 4 is a cross-sectional view of the multi-piece fluid end shown in FIG. 3, taken along line A-A.
Figure 5:
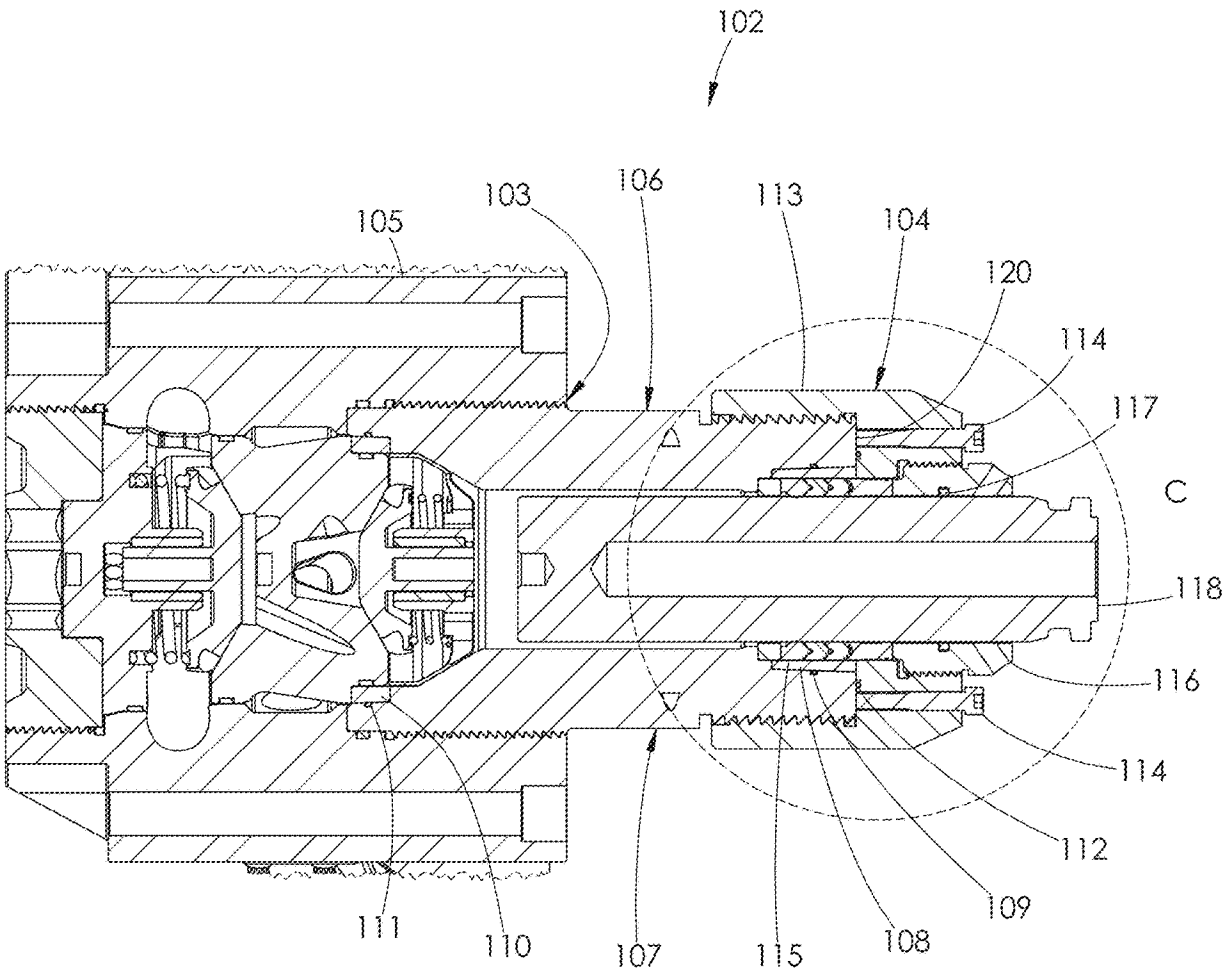
FIG. 5 is a cross-sectional view of the multi-piece fluid end shown in FIG. 3, taken along line B-B. Some components are cropped or not shown for clarity.
Figure 6:
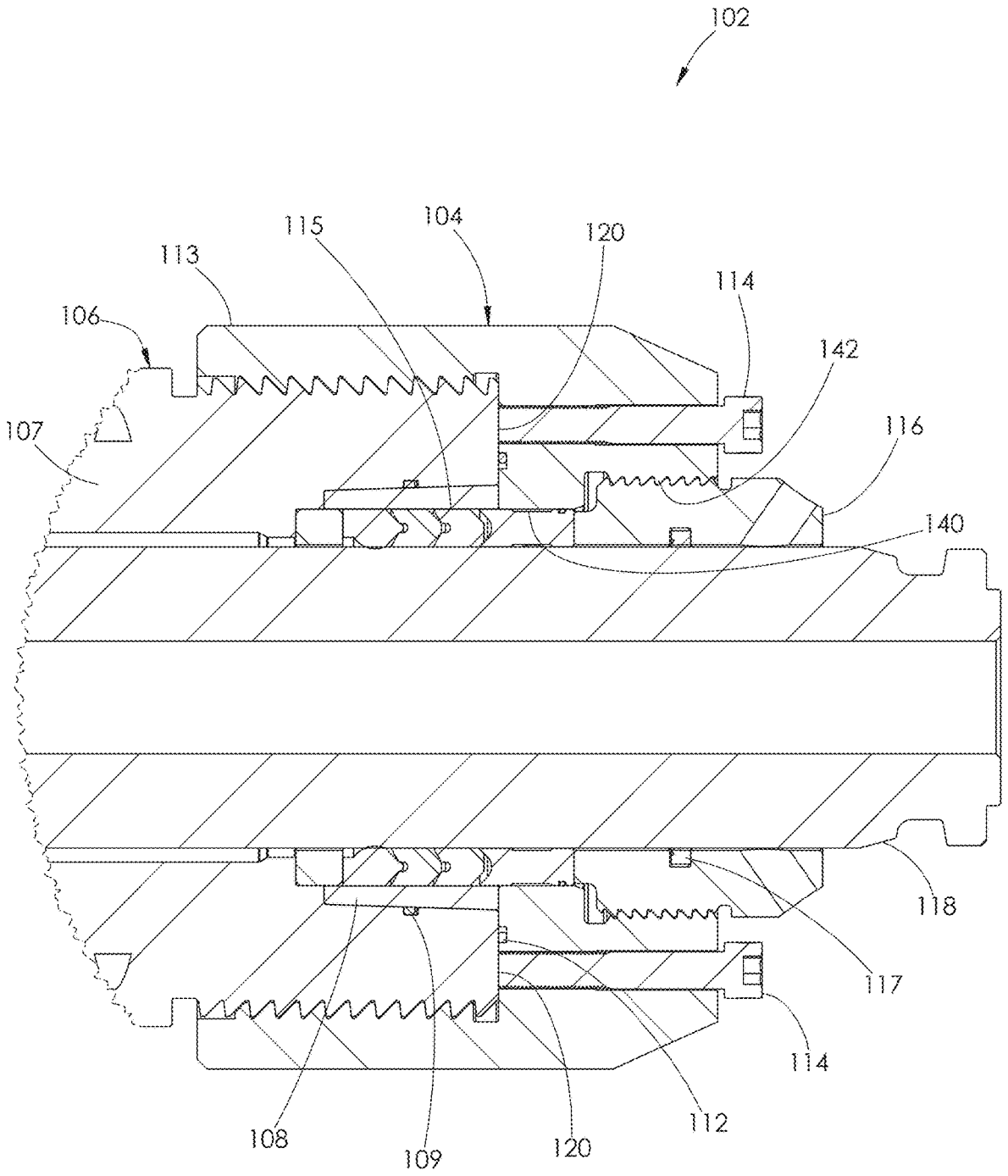
FIG. 6 is an enlarged view of area C shown in FIG. 5.
Figure 7:
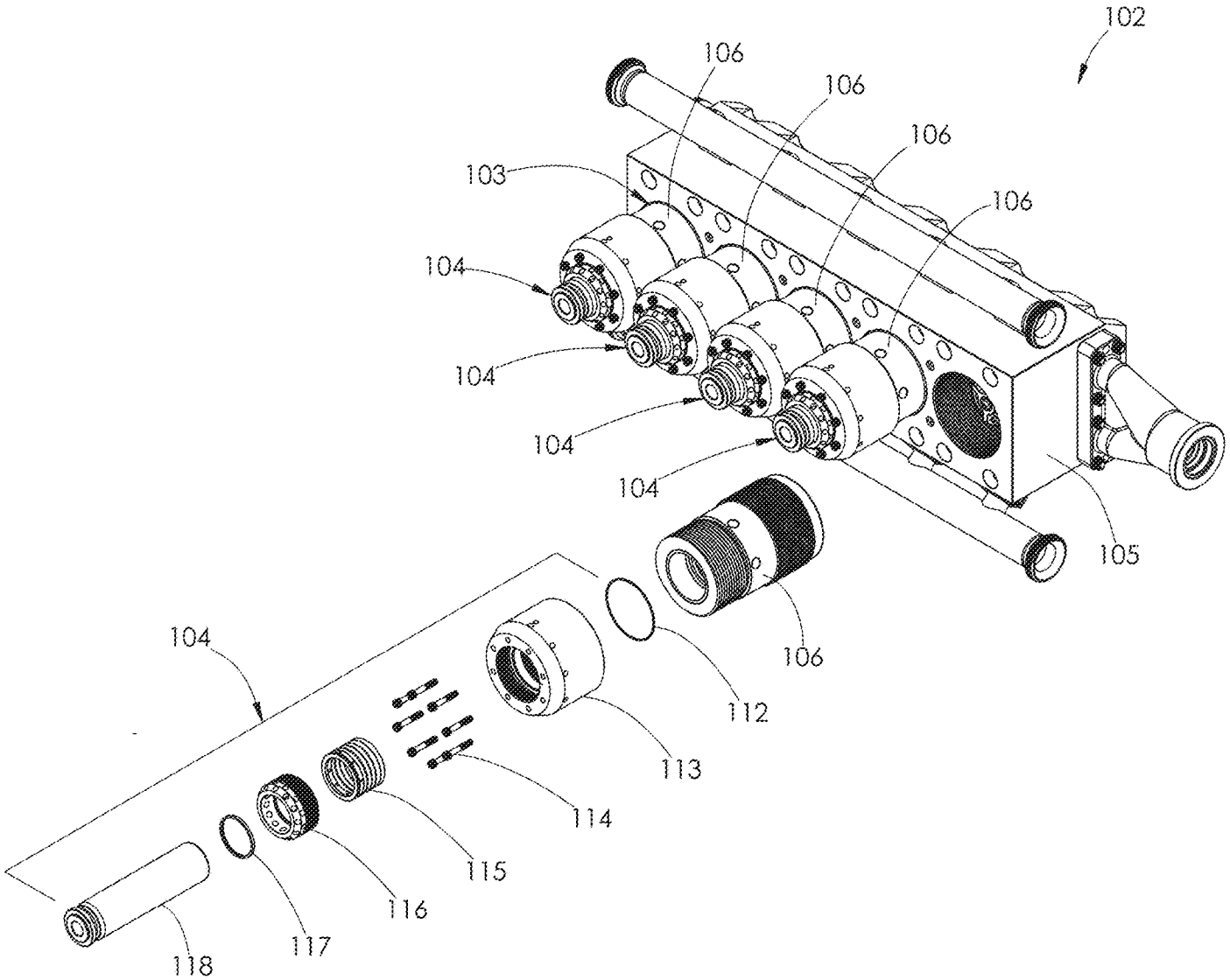
FIG. 7 is an exploded, back, top, left isometric view of the multi-piece fluid end shown in FIG. 2.

High-pressure pump 100 is shown in FIG. 1. The high-pressure pump 100 comprises a power end 101 connected to a multi-piece fluid end 102. The multi-piece fluid end 102 shown in FIGS. 1-7, comprises a fluid end body 103 and a plurality of plunger systems 104. The fluid end body 103 comprises a static section 105 and a plurality of dynamic sections 106. Each dynamic section 106 comprises a dynamic body 107, a plunger system wear ring 108, a plunger system wear ring seal 109, a flow control system wear ring 110, and a flow control system wear ring seal 111. Each plunger system 104 comprises a retainer seal 112, a retainer 113, a plurality of tension bolts 114, packing 115, a packing nut 116, a plunger seal 117, and a plunger 118.

Figure 8:
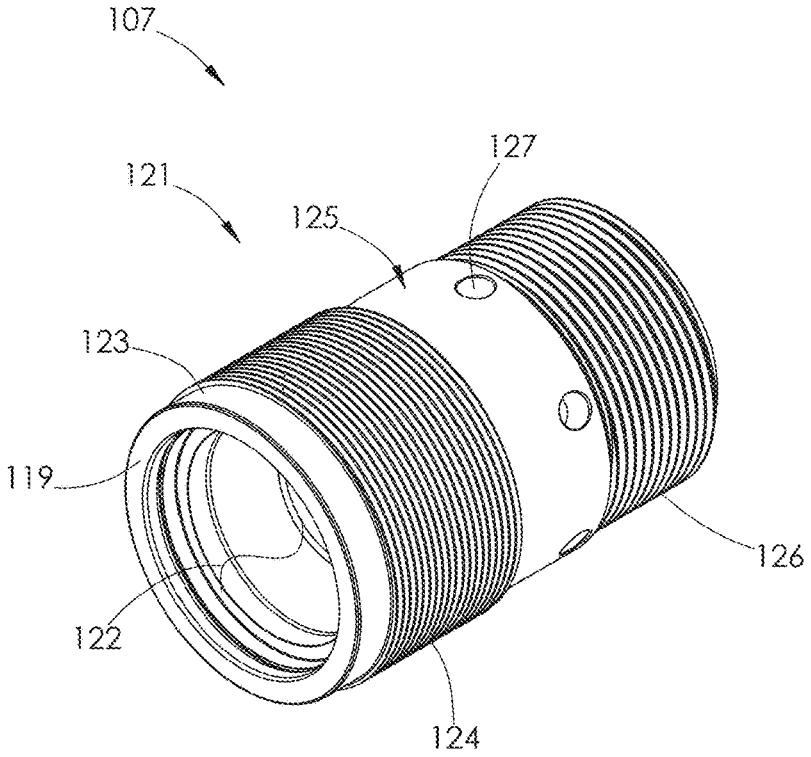
FIG. 8 is an isometric view of a dynamic body used in the multi-piece fluid end shown in FIG. 2.
Figure 9:
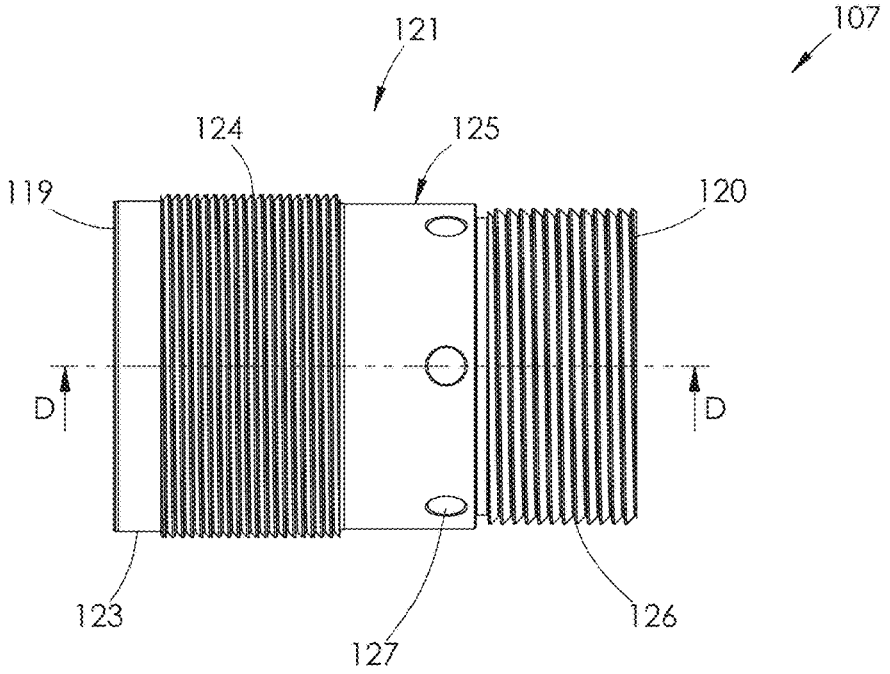
FIG. 9 is a top plan view of the dynamic body shown in FIG. 8.
Figure 10:
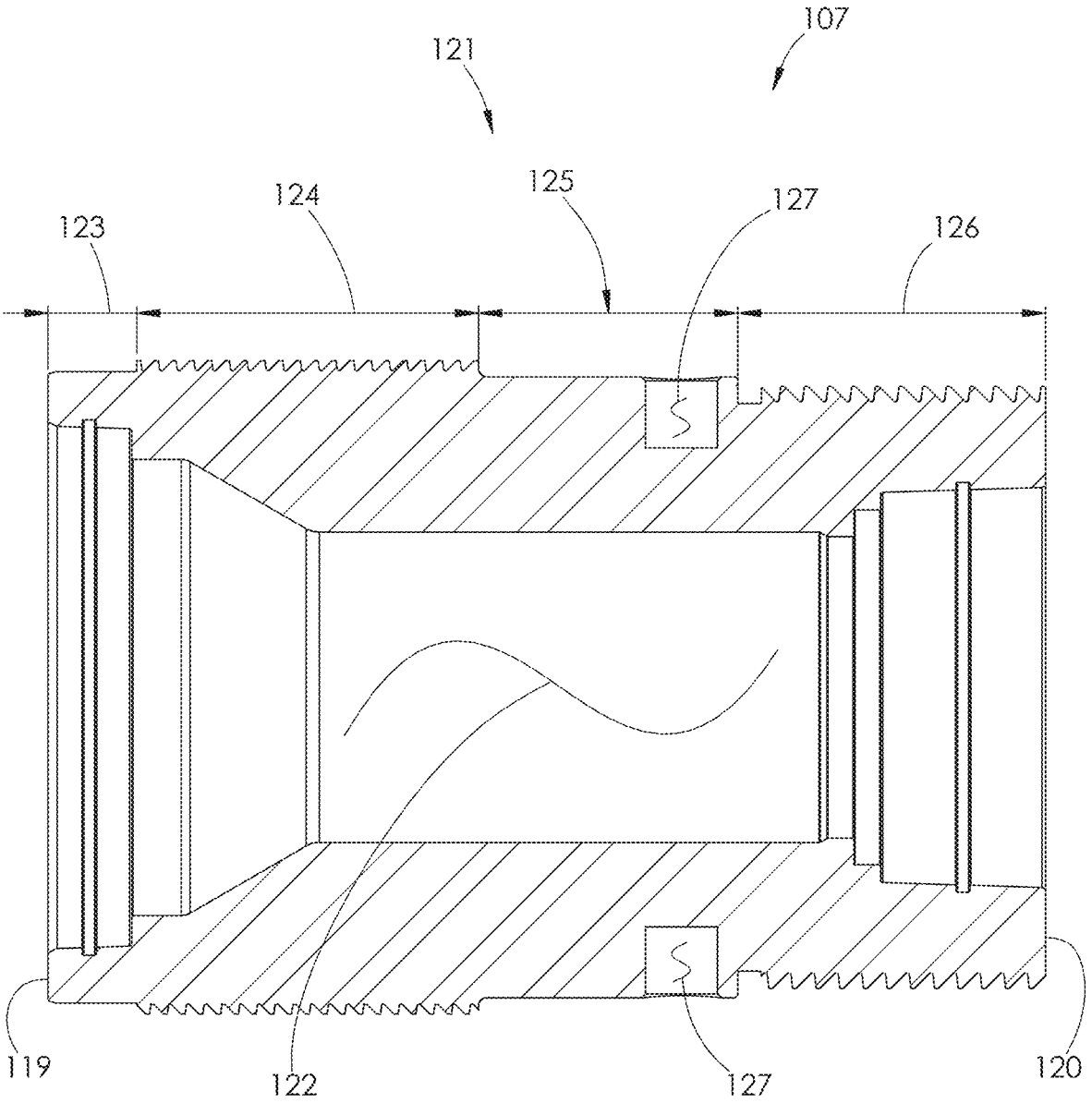
FIG. 10 is a cross-sectional view of the dynamic body shown in FIG. 9, taken along line D-D.
Figure 11:
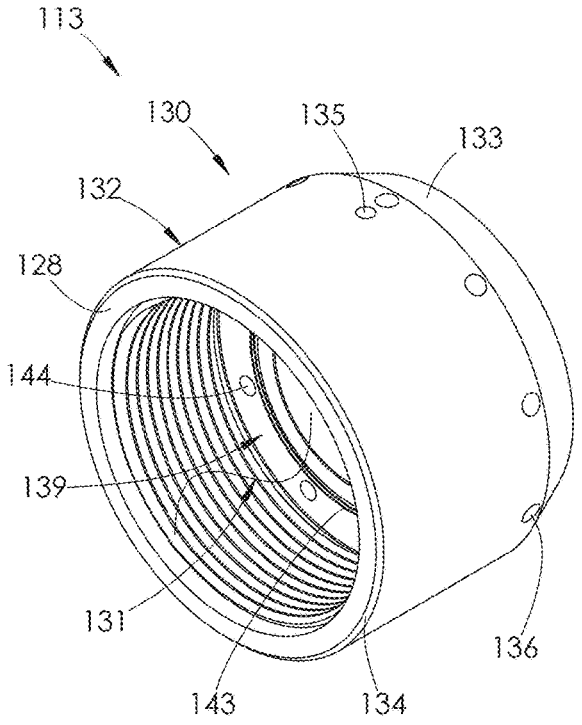
FIG. 11 is an isometric view of a retainer used in the multi-piece fluid end shown in FIG. 2.
Figure 12:
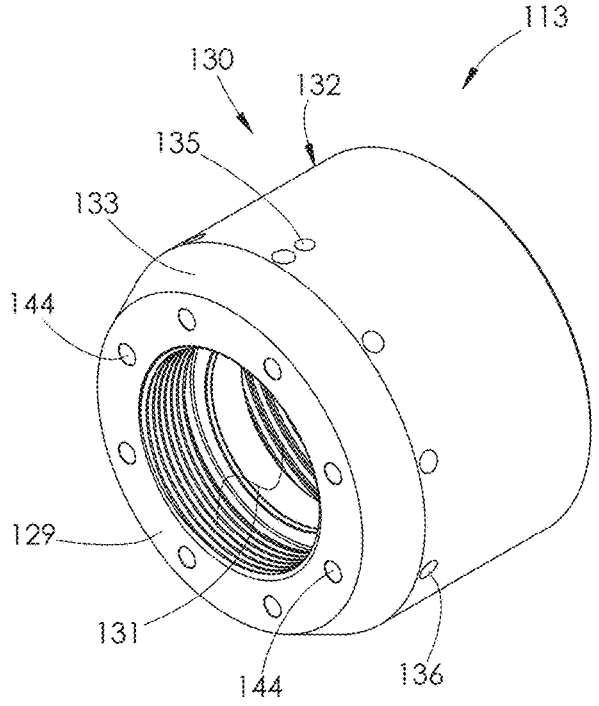
FIG. 12 is a back, top, left isometric view of the retainer shown in FIG. 11.
Figure 13:
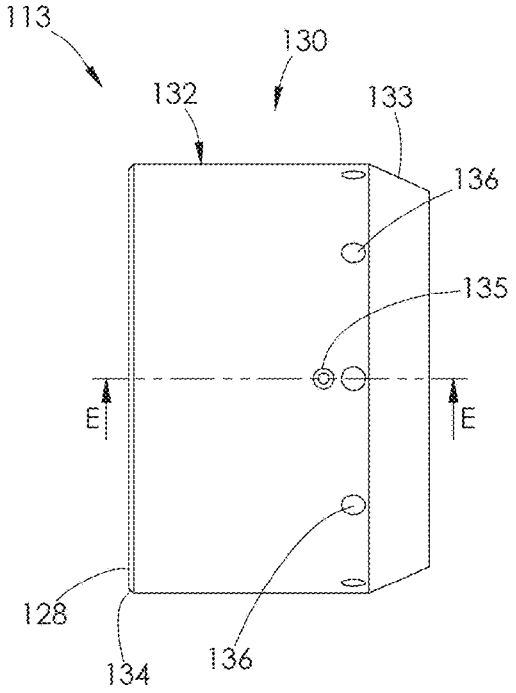
FIG. 13 is a top plan view of the retainer shown in FIG. 11.
Figure 14:
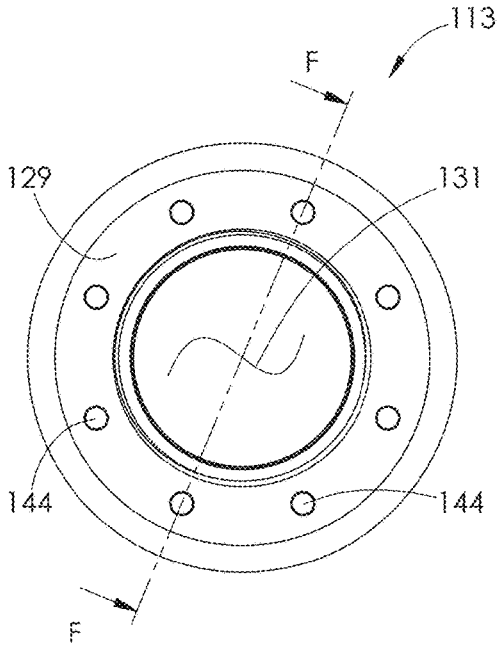
FIG. 14 is a back elevation view of the retainer shown in FIG. 11.
Figure 15:
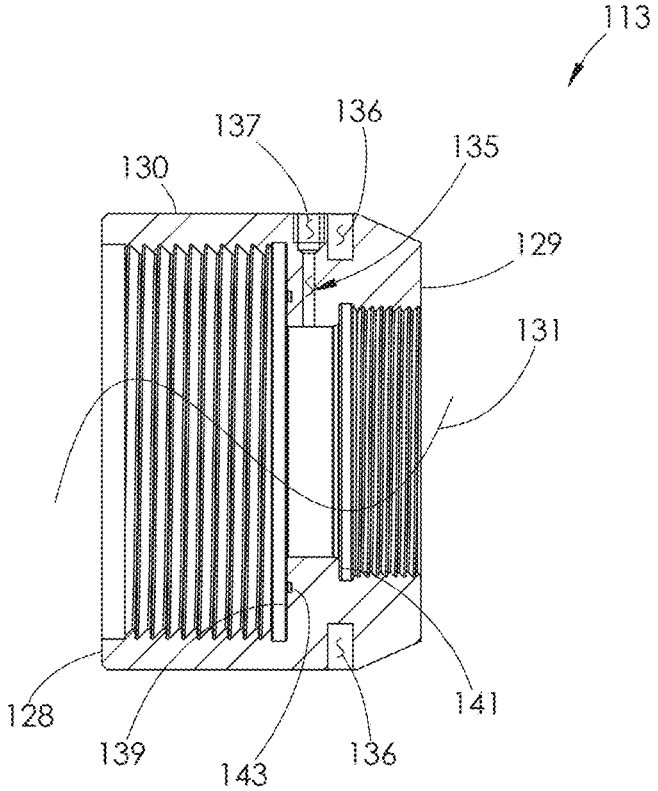
FIG. 15 is a cross-sectional view of the retainer shown in FIG. 13, taken along line E-E.
Figure 16:
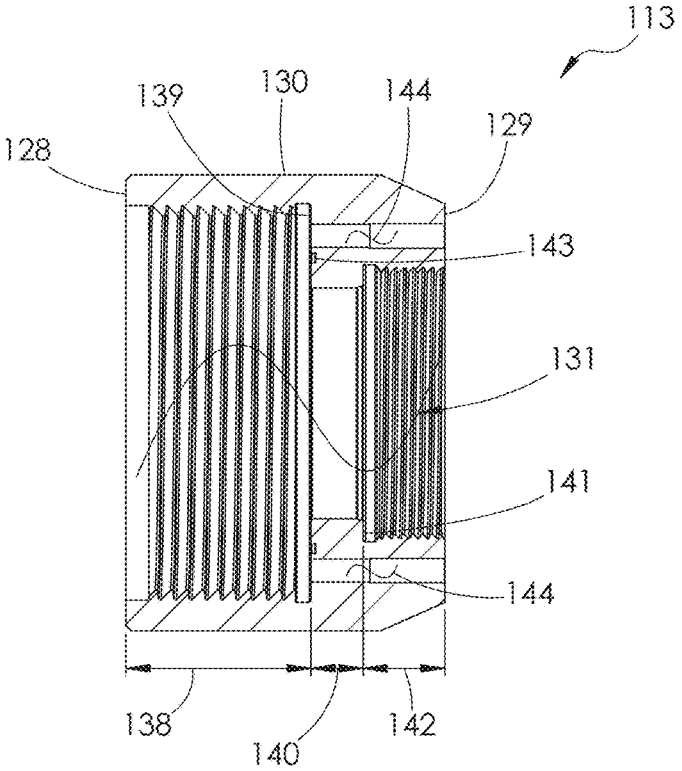
FIG. 16 is a cross-sectional view of the retainer shown in FIG. 14, taken along line F-F.
Figure 17:
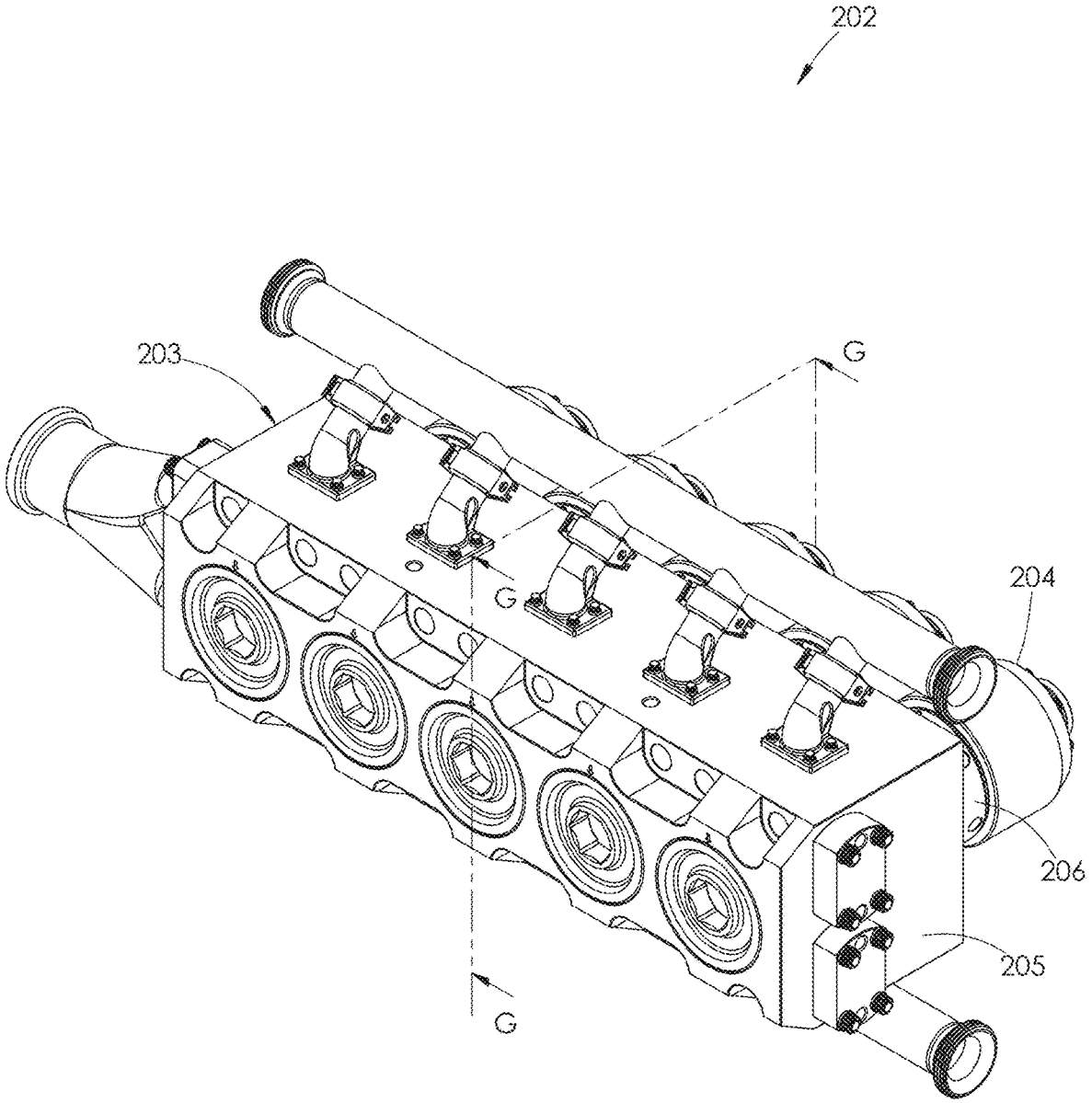
FIG. 17 is an isometric view of another embodiment of a multi-piece fluid end that may be used in the high-pressure pump shown in FIG. 1.
Figure 18:
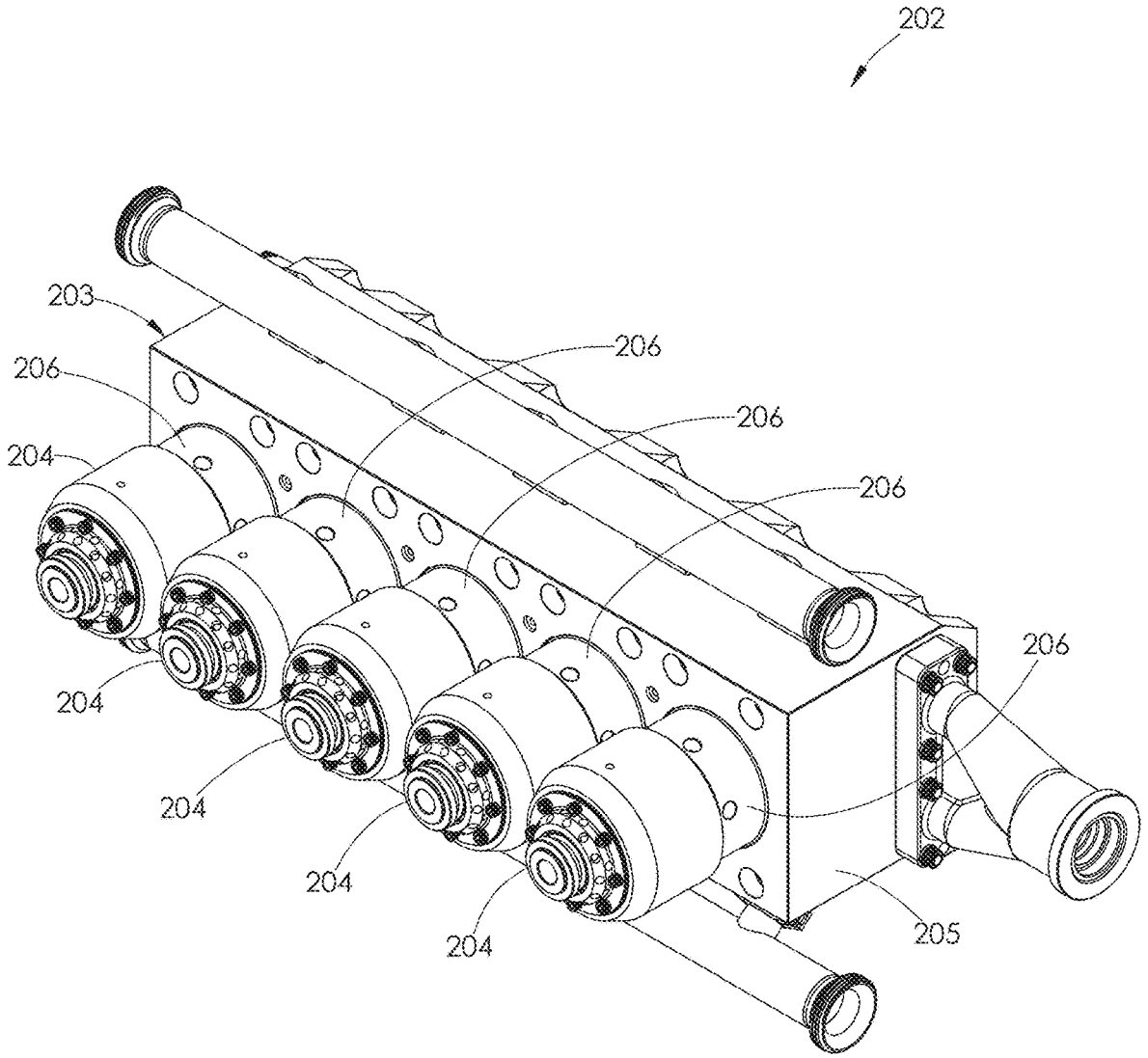
FIG. 18 is a back, top, left isometric view of the multi-piece fluid end shown in FIG. 17.

The dynamic body 107, shown in FIGS. 8-10, has a cylindrical shape. The dynamic body 107 comprises opposing front 119 and back 120 surfaces connected by an outer surface 121 and a flow bore 122. The outer surface 121 and flow bore 122 are concentric and their cylindrical axis is the longitudinal axis of the dynamic body 107.

The outer surface 121 comprises multiple sections, all the sections are concentric. Beginning at the front surface 119 of the dynamic body 107 and continuing along the longitudinal axis to the back surface 120 the outer surface 121 comprises a static seal section 123, static threads 124, intermediate section 125, and retainer threads 126. The intermediate section 125 comprises a plurality of spanner wrench holes 127. The spanner wrench holes 127 are radial blind bores with a bore axis that is perpendicular to the longitudinal axis of the dynamic body 107. Each spanner wrench hole 127 originates from the intermediate section 125 of the outer surface 121 but does not intersect the flow bore 122. In this embodiment the spanner wrench holes 127 are proximate the retainer threads 126, aligned longitudinally, and evenly spaced circumferentially but may be spaced in any manner on the intermediate section 125 as long as access for the spanner wrench (not shown) is available.

The flow bore 122 also comprises multiple sections and is configured to receive the plunger system wear ring seal 109, plunger system wear ring 108, flow control system wear ring seal 111, and flow control system wear ring 110. The flow bore 122 is not the focus of this improvement so no further details about the flow bore 122 are necessary to understand this disclosure.

The retainer 113, shown in FIGS. 11-16, has a generally cylindrical shape. The retainer 113 comprises a front surface 128 and back surface 129 connected by an outer surface 130 and plunger bore 131. The outer surface 130 and plunger bore 131 are concentric and their cylindrical axis is the longitudinal axis of the retainer 113.

The outer surface 130 comprises a straight section 132 and a tapered section 133. The straight section 132 begins at the front surface 128 and continues along the longitudinal axis until it connects with the tapered section 133. The straight section 132 occupies approximately 80% of the outer surface 130 but may be more or less. The straight section 132 comprises a front chamfer 134, a lubrication port 135, and a plurality of spanner wrench holes 136. The lubrication port 135 is a through bore connecting the straight section 132 of the outer surface 130 to the intermediate section 140 of the plunger bore 131. The lubrication port 135 comprises a threaded section 137 adjacent the outer surface 130 configured to receive a lubrication fitting (not shown) or plug (not shown).

The spanner wrench holes 136 are radial blind bores with a bore axis that is perpendicular to the longitudinal axis of the retainer 113. Each spanner wrench hole 136 originates from the straight section 132 of the outer surface 130 but does not intersect the plunger bore 131. In this embodiment the spanner wrench holes 136 are proximate the tapered section 133, aligned longitudinally, and evenly spaced circumferentially but may be spaced in any manner on the straight section 132 as long as access for the spanner wrench (not shown) is available.

The plunger bore 131 comprises multiple sections. Beginning at the front surface 128 and continuing along the longitudinal axis to the back surface 129 the plunger bore 131 comprises dynamic threads 138, a dynamic shoulder 139, an intermediate section 140, a packing nut shoulder 141, and packing nut threads 142. The dynamic shoulder 139 comprises a seal groove 143. The seal groove 143 is circular and concentric with the plunger bore 131. The seal groove 143 is configured to receive the retainer seal 112.

The retainer 113 further comprises a plurality of tension bolt holes 144. Each tension bolt hole 144 is a partially threaded through hole originating on the back surface 129 and terminating at the dynamic shoulder 139. The threaded portion of the tension bolt hole 144 extends from the dynamic shoulder 139 approximately half the tension bolt hole 144 length to the back surface 129 and is configured to receive a tension bolt 114. The tension bolt holes 144 are distributed evenly on a bolt circle that is concentric with the retainer 113.

Referring now to FIGS. 4-7, the assembly of the multi-piece fluid end 102 begins installation of a flow control system wear ring seal 111, a flow control system wear ring 110, a plunger system wear ring seal 109, and a plunger system wear ring 108 into each dynamic body 107 completing the assembly of the dynamic sections 106. Each dynamic section 106 is then attached to the static section 105 by threading the static threads 124 of the outer surface 121 of the dynamic body 107 into the matching threads of the static section 105. A spanner wrench (not shown) may be used to apply the required torque using the spanner wrench holes 127 in the intermediate section 125 of the outer surface 121 of the dynamic body 107. Finally the flow control components are installed from the other side of the static section.

Next, for each dynamic section 106, a retainer seal 112 is installed in the seal groove 143 of the dynamic shoulder 139 of the plunger bore 131 of a retainer 113. Then, the retainer 113 is attached to a dynamic section 106 by threading the dynamic threads 138 of the plunger bore 131 of the retainer 113 onto the retainer threads 126 of the outer surface 121 of the dynamic body 107. A spanner wrench (not shown) may be used to apply the required torque using the spanner wrench holes 136 in the straight section 132 of the outer surface 130 of the retainer 113. The plurality of tension bolts 114 are then inserted, on a one-to-one basis, into the tension bolt holes 144 from the back surface 129 of the retainer 113 and threaded into the threaded section of the tension bolt holes 144 until the front surface of each tension bolt 114 contacts the back surface 120 of the dynamic body 107. Once contact is made by all tension bolts 114 the tension bolts 114 may be torqued to specification in a piecewise manner.

One example of a piecewise manner is applying half the specified torque to a pair of diametrically opposed tension bolts 114 then applying half the specified torque to a second pair of diametrically opposed tension bolts 114 spaced 90 degrees from the first pair. Then applying half the specified torque to the remaining two pairs in a similar manner. After applying half the specified torque to all the tension bolts 114, the full specified torque may be applied in the same manner.

Next, the packing 115 is inserted into the dynamic section 106 and the intermediate section 140 of the plunger bore 131 of the retainer 113. Next, the plunger seal 117 is installed in the packing nut 116 and the packing nut 116 is threaded into the packing nut thread 142 of the plunger bore 131 of the retainer 113. Next, the plunger 118 is installed in the packing nut 116, packing 115, and dynamic section 106. Lastly, the packing nut 116 is torqued to specification.

In operation the tension bolts 114 place the threaded joint formed by the retainer threads 126 of the dynamic body 107 and the dynamic threads 138 of the retainer 113 in tension providing an additional tensile load above that produced by the torquing of the threads together. This additional tensile load reduces the magnitude of cyclic loading usually produced in the joint by the large pressure fluctuations in the dynamic section 106. This reduction in the magnitude of cyclic loading reduces thread to thread fretting and other issues inherent in the previously encountered full, or nearly full, cyclic loading of the threads. These benefits result in an easier and quicker removal of the retainer 113 for maintenance or replacement when necessary.

Referring now to FIGS. 17-31, another embodiment of a multi-piece fluid end 202 is shown. The multi-piece fluid end 202, shown in FIGS. 17-21, comprises a fluid end body 203 and a plurality of plunger systems 204. The fluid end body 203 comprises a static section 205, a plurality of dynamic sections 206. Each dynamic section 206 comprises a dynamic body 207, a plunger system wear ring 208, a plunger system wear ring seal 209, a flow control system wear ring 210, and a flow control system wear ring seal 211. Each plunger system 204 comprises a retainer seal 212, a retainer 213, a plurality of tension bolts 214, packing 215, a packing nut 216, a plunger seal 217, and a plunger 218.

The fluid end body 203 may be identical to the fluid end body 103. The retainer 213, shown in FIGS. 22-25, has a generally cylindrical shape. The retainer 213 comprises a front surface 228 and back surface 229 connected by an outer surface 230 and plunger bore 231. The outer surface 230 and plunger bore 231 are concentric and their cylindrical axis is the longitudinal axis of the retainer 213.

The outer surface 230 comprises a straight section 232 and a tapered section 233. The straight section 232 begins at the front surface 228 and continues along the longitudinal axis until it connects with the tapered section 233. The straight section 232 occupies approximately 80% of the outer surface 230 but may be more or less. The straight section 232 comprises a front chamfer 234 and a lubrication port 235. The lubrication port 235 is a through bore connecting the straight section 232 of the outer surface 230 to the intermediate section 240 of the plunger bore 231. The lubrication port 235 comprises a threaded section 237 adjacent to the outer surface 230 configured to receive a lubrication fitting (not shown) or plug (not shown).

The plunger bore 231 comprises multiple sections. Beginning at the front surface 228 and continuing along the longitudinal axis to the back surface 229 the plunger bore 231 comprises dynamic threads 238, a dynamic shoulder 239, an intermediate section 240, a packing nut shoulder 241, and packing nut threads 242. The dynamic shoulder 239 comprises a seal groove 243. The seal groove 243 is circular and concentric with the plunger bore 231. The seal groove 243 is configured to receive the retainer seal 212.

The packing nut 216, shown in FIGS. 26-31, is generally cylindrical in shape and comprises a front surface 244 and back surface 245 connected by an outer surface 246, and plunger bore 247. The outer surface 246 and plunger bore 247 are concentric and their cylindrical axis is the longitudinal axis of the packing nut 216. The plunger bore 247 comprises a plunger seal groove 257 configured to receive the plunger seal 217.

The outer surface 246 comprises multiple sections, all the sections are concentric. Beginning at the front surface 244 of the packing nut 216 and continuing along the longitudinal axis to the back surface 245 the outer surface 246 comprises a packing nose 248, a front shoulder 249, a threaded section 250, a back shoulder 251, straight spanner wrench section 252, and tapered spanner wrench section 253.

The straight spanner wrench section 252 comprises a plurality of spanner wrench holes 254. The spanner wrench holes 254 are radial blind bores with a bore axis that is perpendicular to the longitudinal axis of the packing nut 216. Each spanner wrench hole 254 originates from the straight spanner wrench section 252 of the outer surface 246 but does not intersect the plunger bore 247. In this embodiment the spanner wrench holes 254 are approximately centered longitudinally in the straight spanner wrench section 252 and evenly spaced circumferentially but may be spaced in any manner on the straight spanner wrench section 252 as long as access for the spanner wrench (not shown) is available.

The tapered spanner wrench section 253 comprises a plurality of spanner wrench holes 255. The spanner wrench holes 255 are radial through bores with a bore axis that is perpendicular to the tapered face of the tapered spanner wrench section 253. Each spanner wrench hole 255 originates from the tapered spanner wrench section 253 of the outer surface 246 and intersects the plunger bore 247. In this embodiment the spanner wrench holes 255 are approximately centered longitudinally in the tapered spanner wrench section 253. The spanner wrench holes 255 are evenly spaced circumferentially but offset circumferentially from the spanner wrench holes 254 of the straight spanner wrench section 252 to allow greater access by a spanner wrench (not shown). The spanner wrench holes 255, however, may be spaced in any manner on the tapered spanner wrench section 253 as long as access for the spanner wrench (not shown) is available.

The packing nut 216 further comprises a plurality of tension bolt holes 256. Each tenson bolt hole 256 is a partially threaded through hole connecting the front shoulder 249 of the outer surface 246 and the back shoulder 251 of the outer surface 246. The threaded portion of the tension bolt hole 256 extends from the front shoulder 249 approximately half the tension bolt hole 256 length to the back shoulder 251 and is configured to receive a tension bolt 214. The tension bolt holes 256 are distributed evenly on a bolt circle that is concentric with the packing nut 216.

Figure 19:
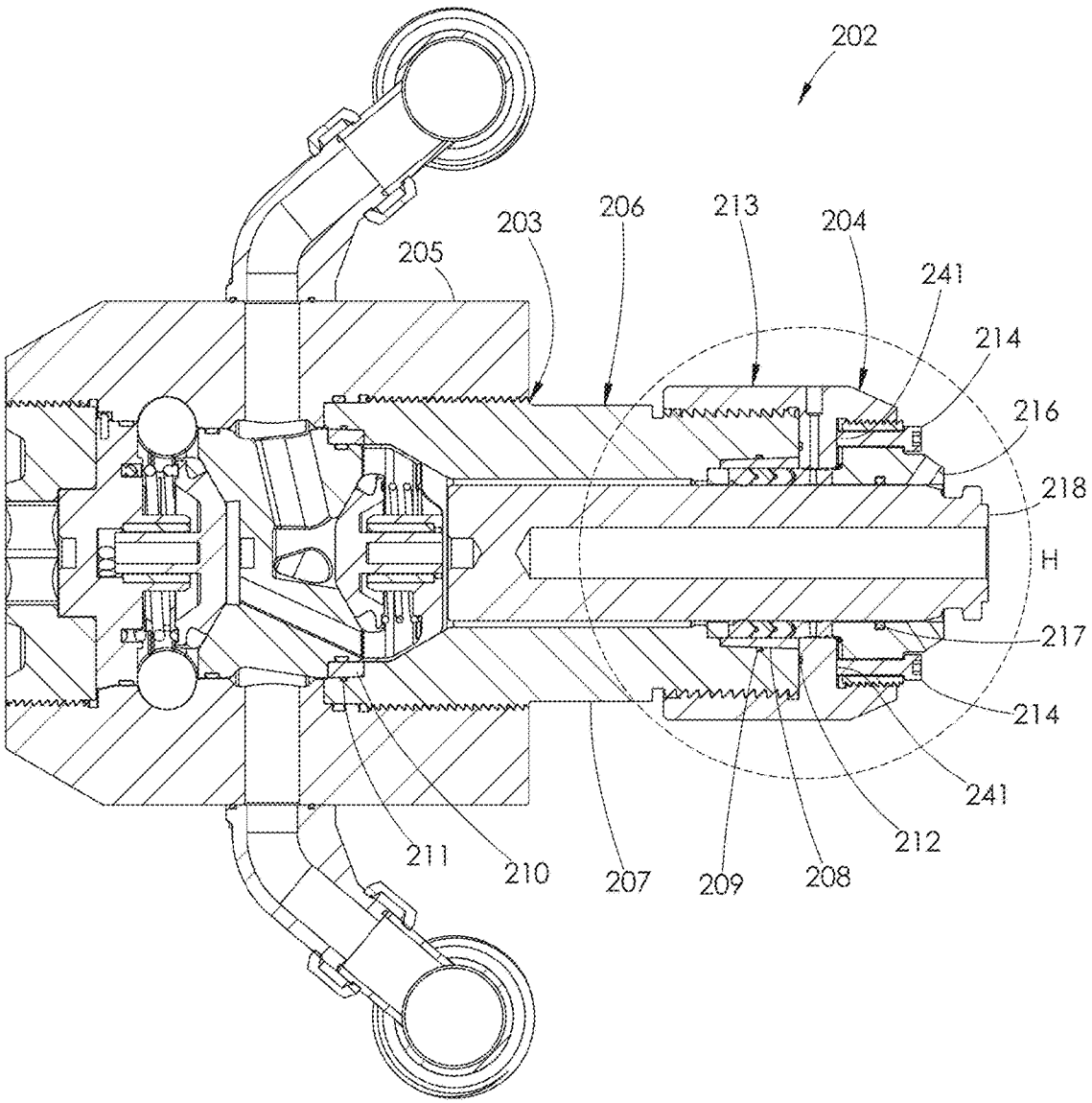
FIG. 19 is a cross-sectional view of the multi-piece fluid end shown in FIG. 17 taken along line G-G.
Figure 20:
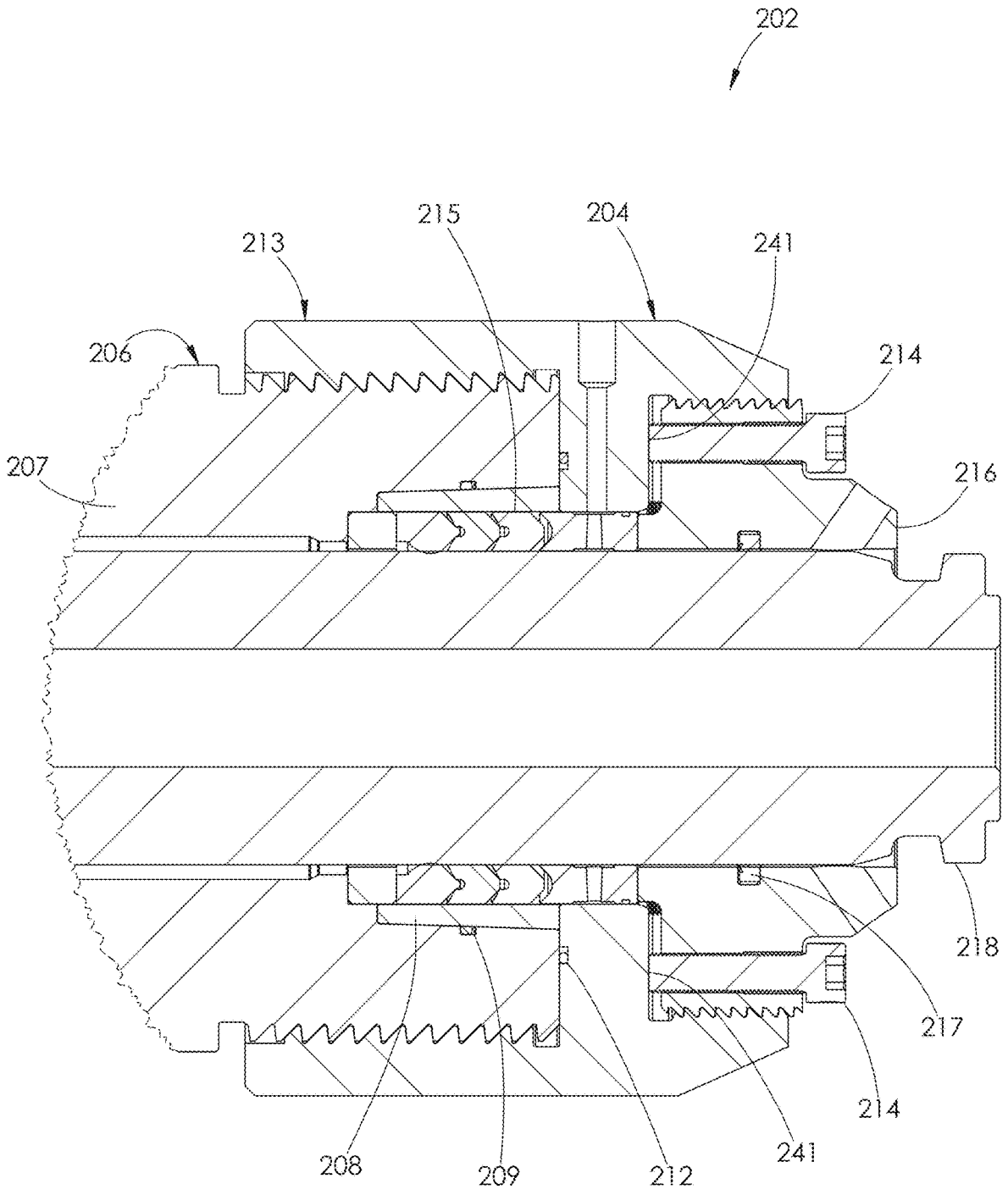
FIG. 20 is an enlarged view of area H shown in FIG. 19.
Figure 21:
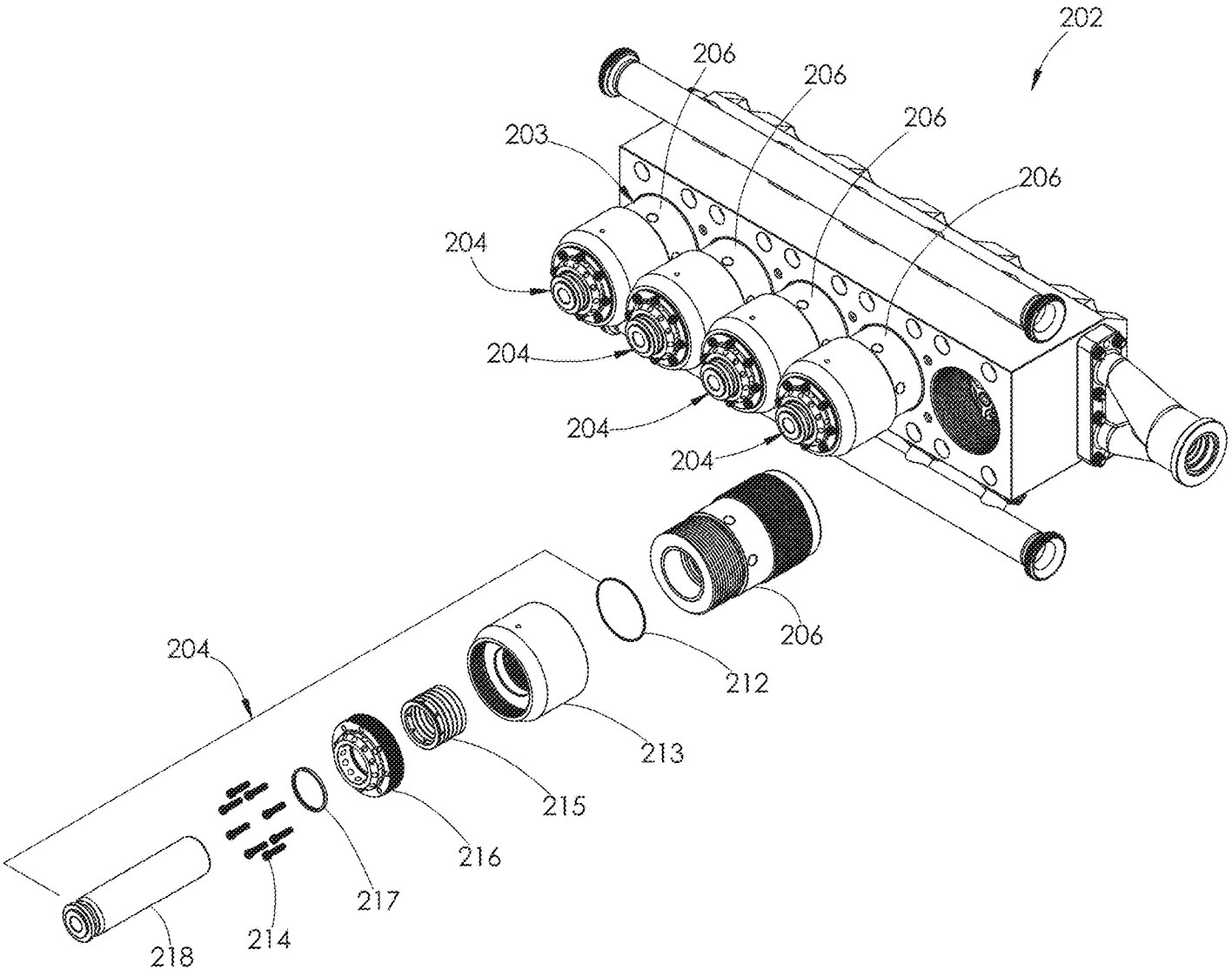
FIG. 21 is an exploded, back, top, left isometric view of the multi-piece fluid end shown in FIG. 17.
Figure 22:
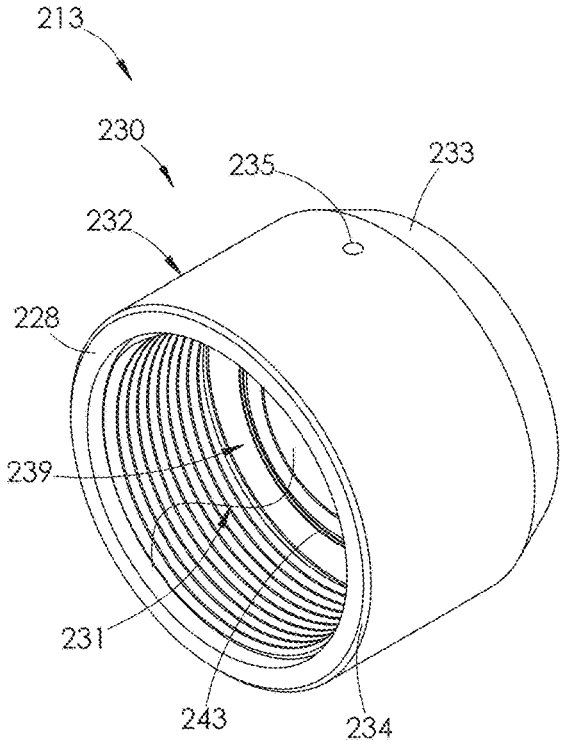
FIG. 22 is an isometric view of a retainer used in the multi-piece fluid end shown in FIG. 17.
Figure 23:
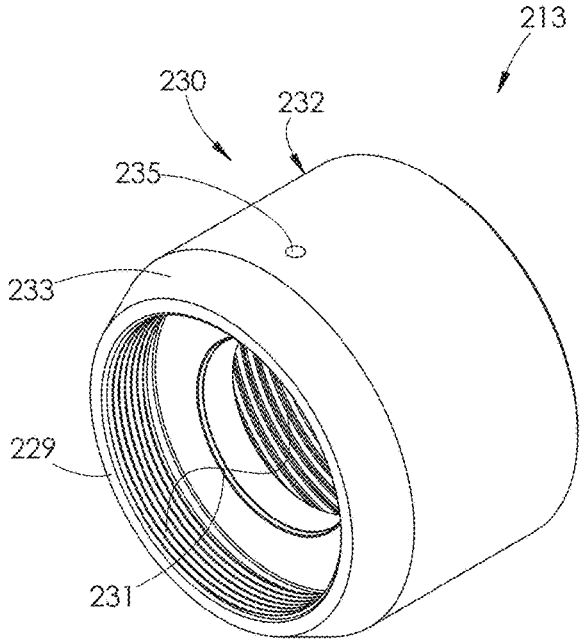
FIG. 23 is a back, top, left isometric view of the retainer shown in FIG. 22.
Figure 24:
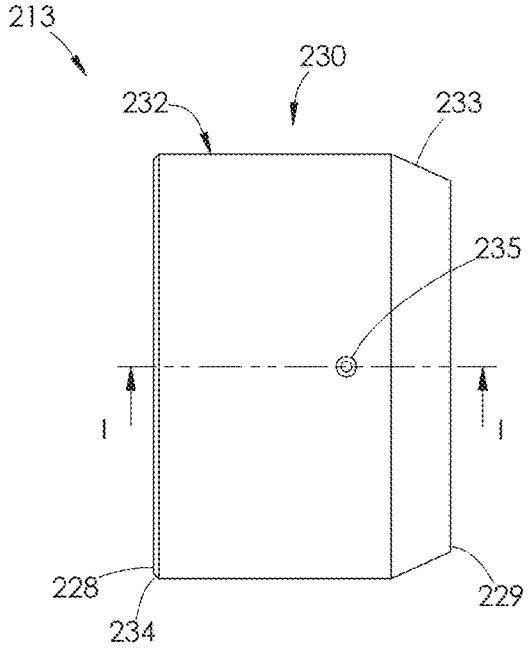
FIG. 24 is a top plan view of the retainer shown in FIG. 22.
Figure 25:
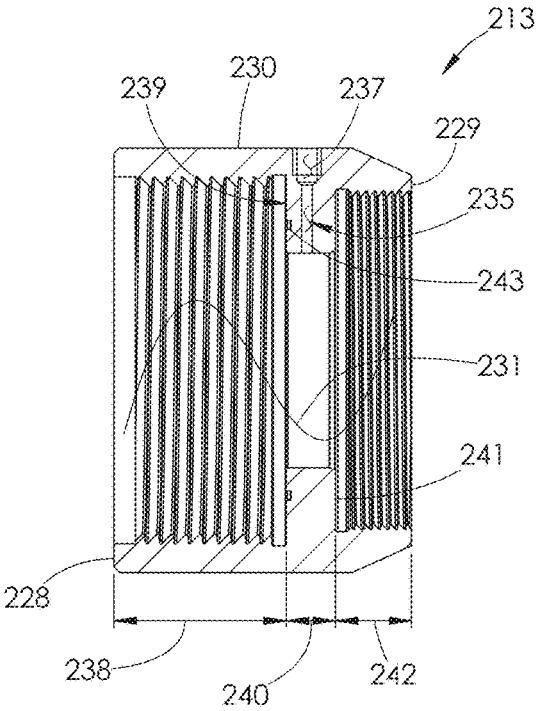
FIG. 25 is a cross-sectional view of the retainer shown in FIG. 24, taken along line I-I.
Figure 26:
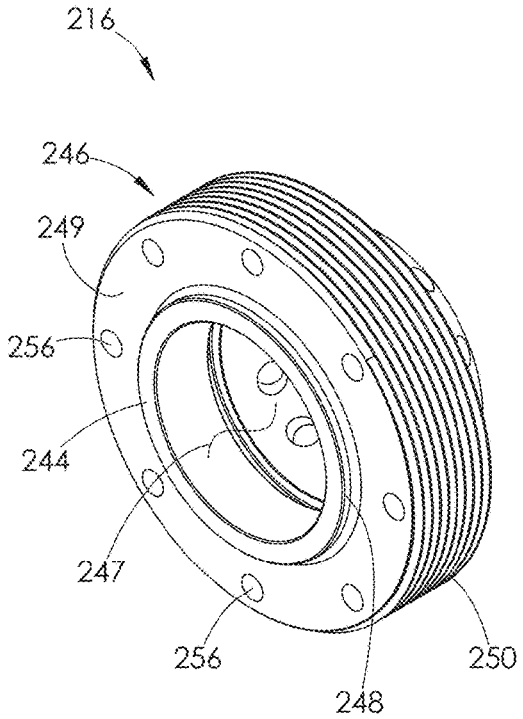
FIG. 26 is an isometric view of a packing nut used in the multi-piece fluid end shown in FIG. 17.
Figure 27:
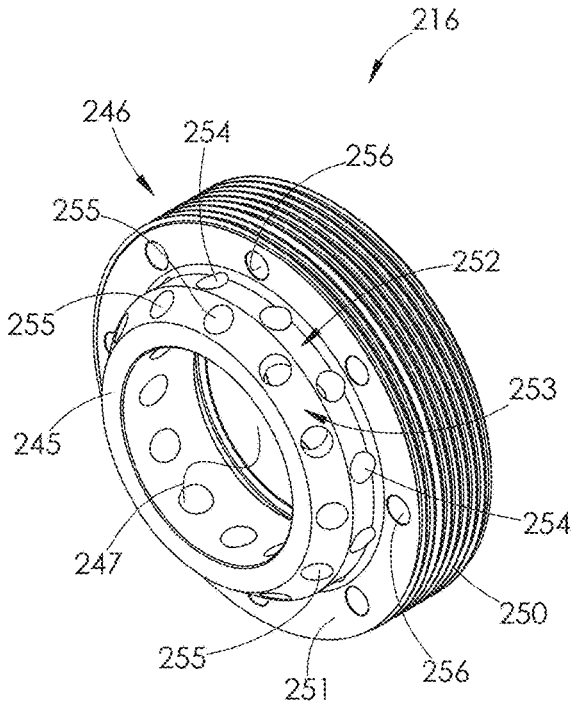
FIG. 27 is a back, top, left isometric view of the packing nut shown in FIG. 26.
Figure 28:
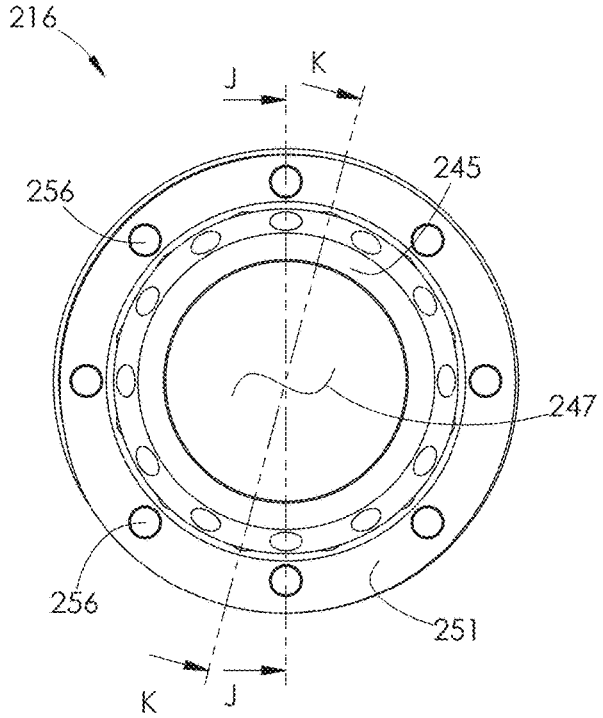
FIG. 28 is a back elevation view of the packing nut shown in FIG. 26.
Figure 29:
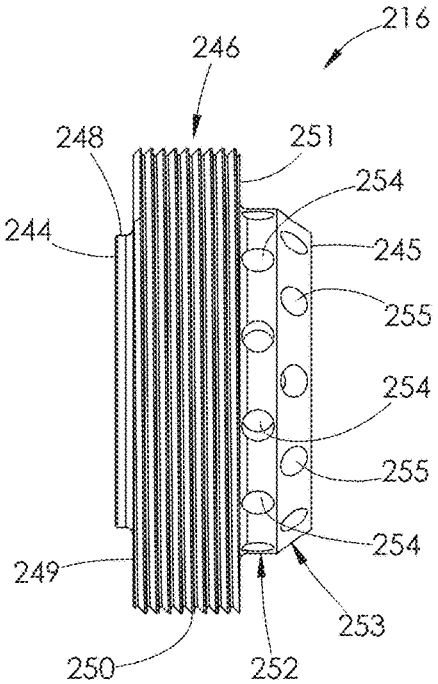
FIG. 29 is a top plan view of the packing nut shown in 26.
Figure 30:
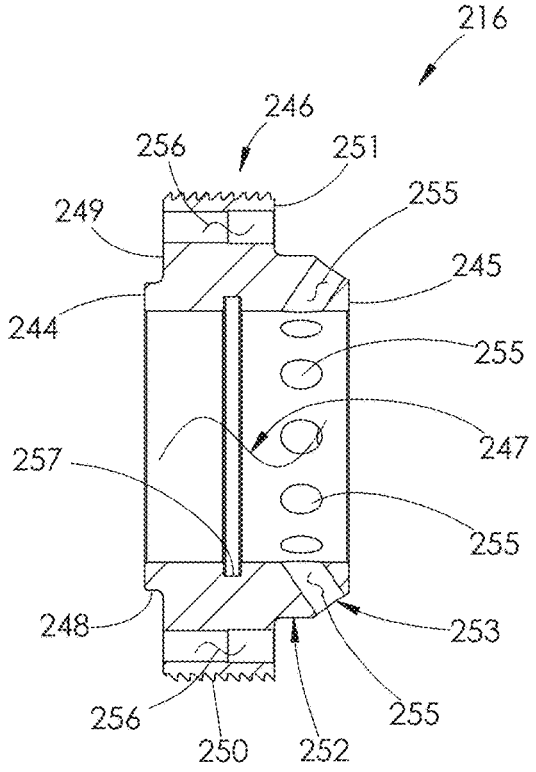
FIG. 30 is a cross-sectional view of the packing nut shown in FIG. 28, taken along line J-J.
Figure 31:
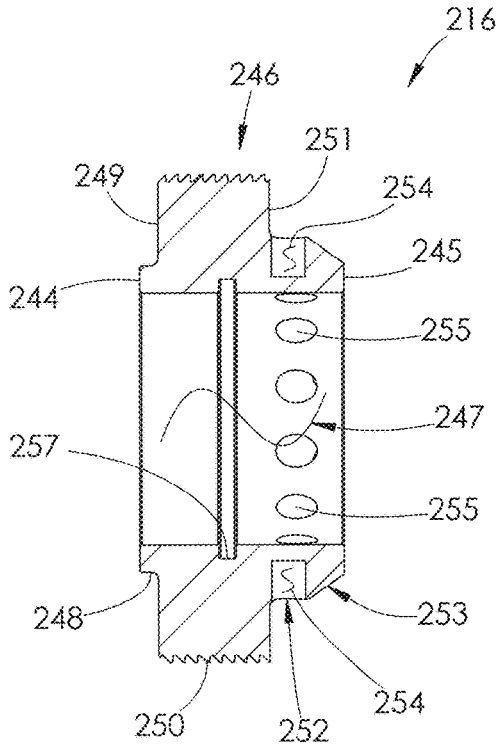
FIG. 31 is a cross-sectional view of the packing nut shown in FIG. 28, taken along line K-K.
Figure 32:
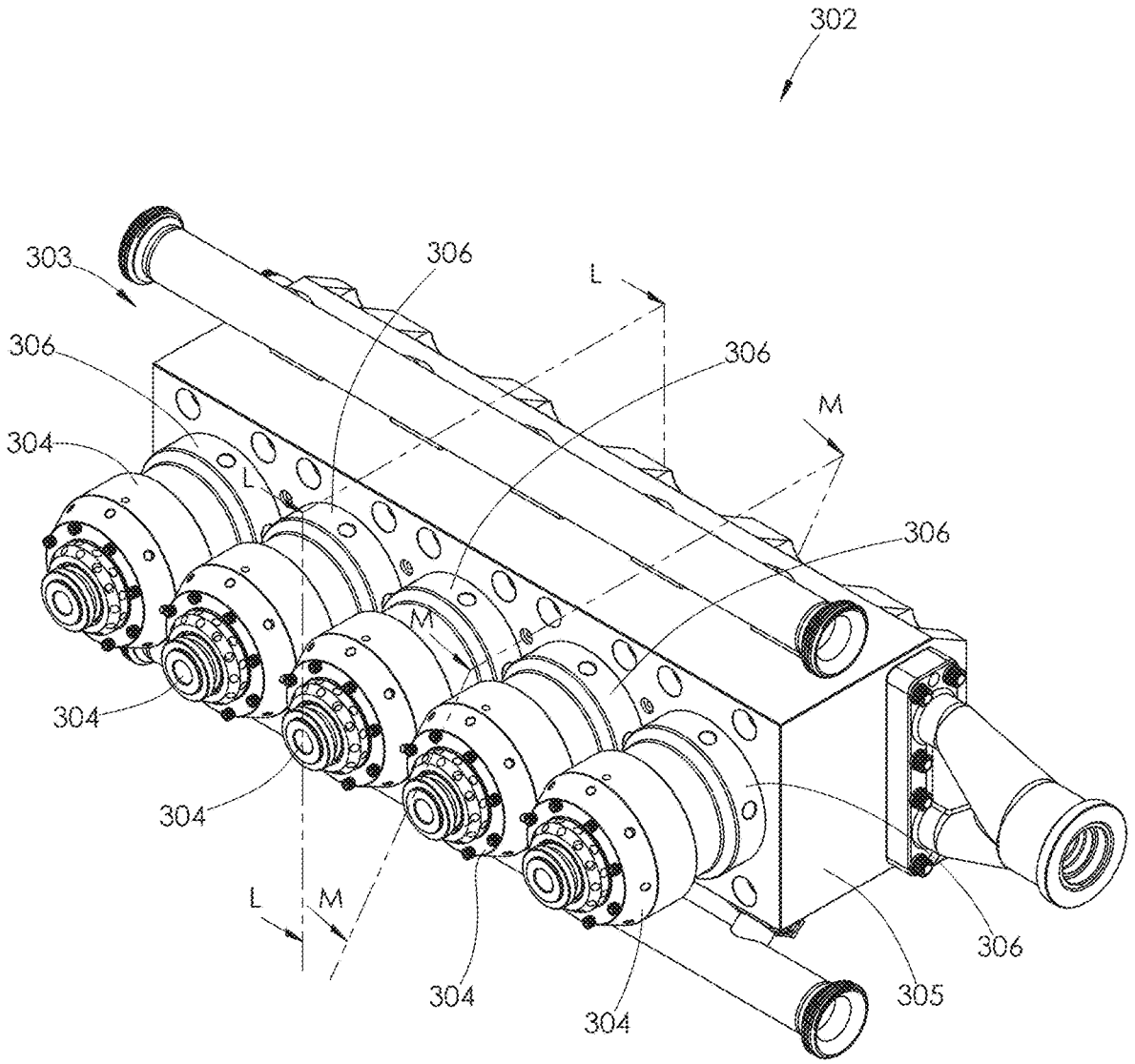
FIG. 32 is a back, top, left isometric view of another embodiment of a multi-piece fluid end.
Figure 33:
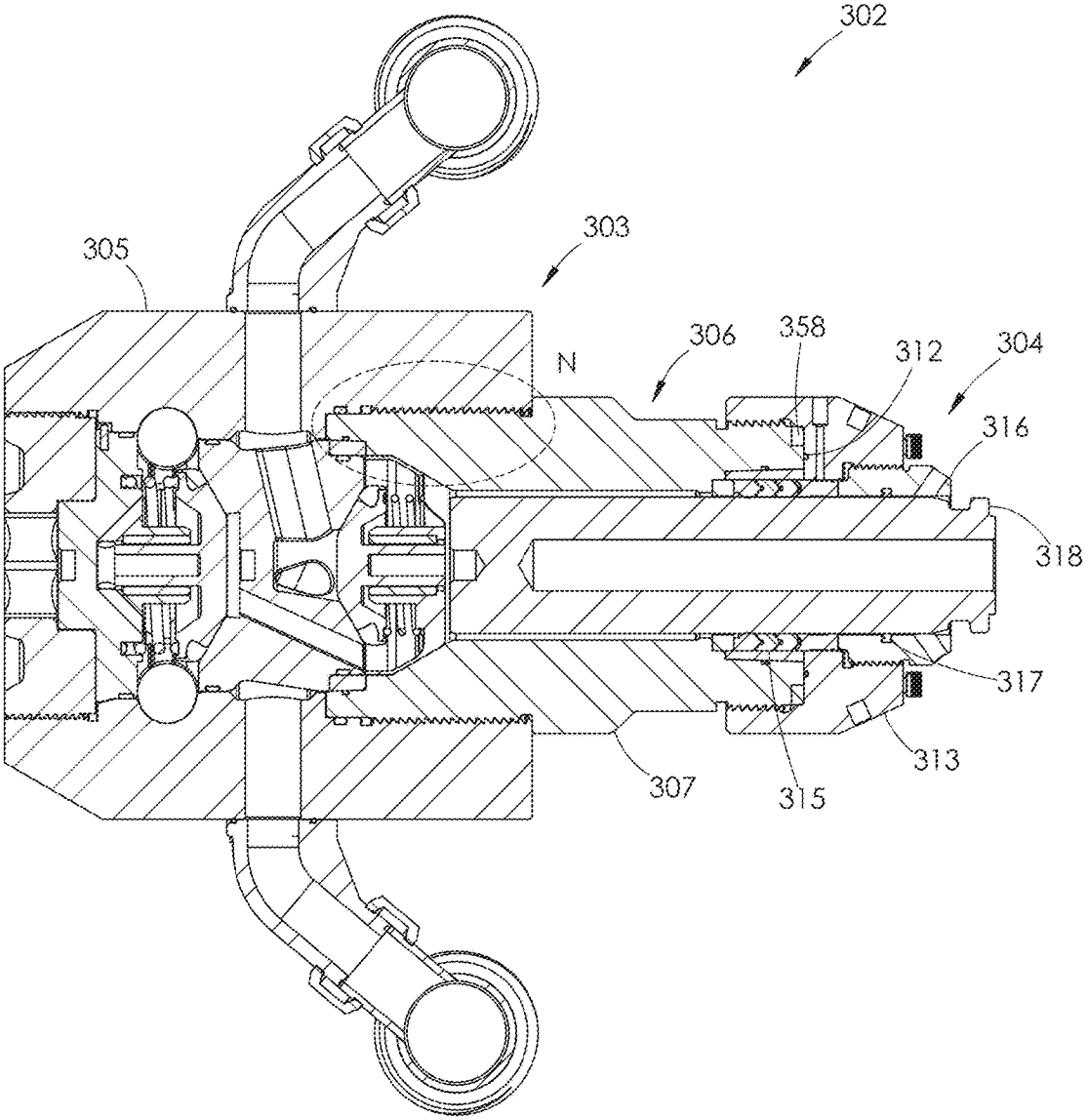
FIG. 33 is a cross-sectional view of the multi-piece fluid end shown in FIG. 32, taken along line L-L.
Figure 34:
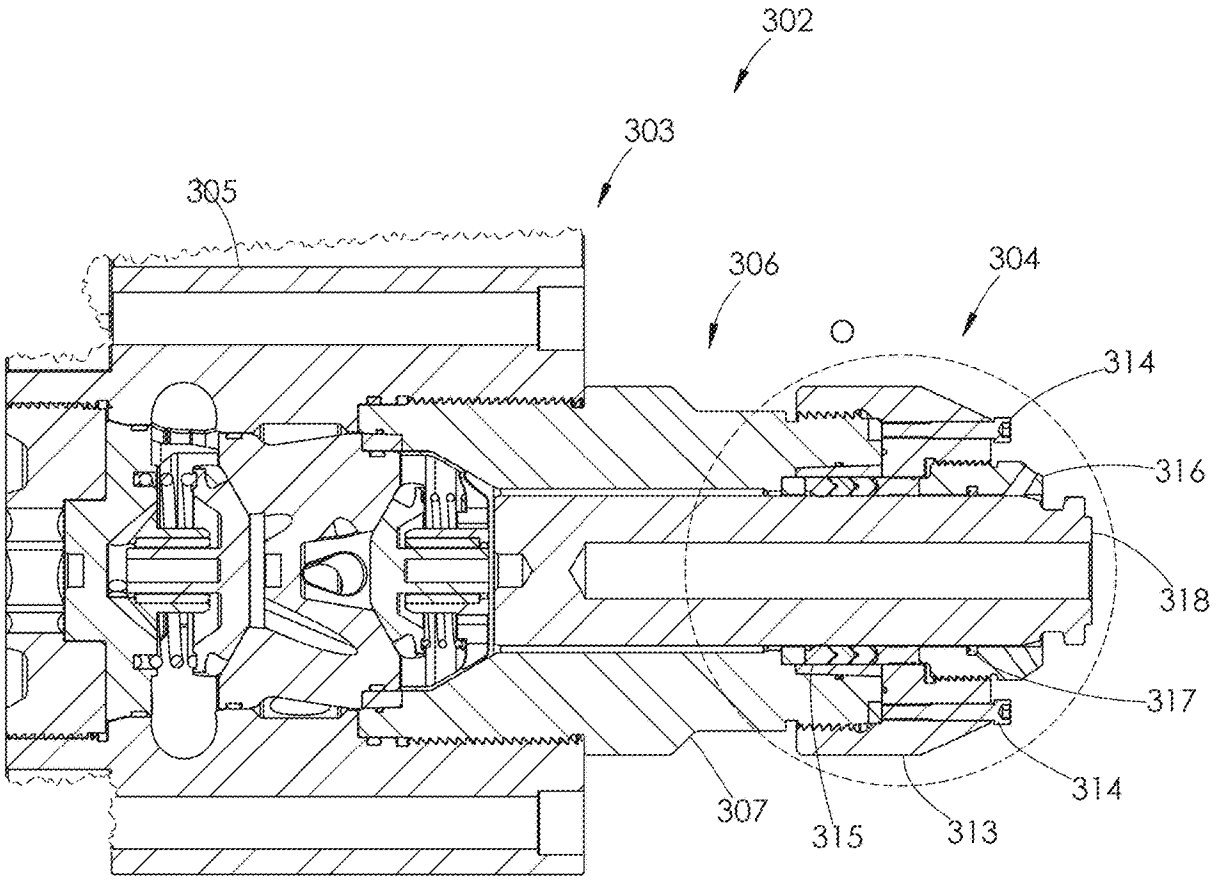
FIG. 34 is a cross-sectional view of the multi-piece fluid end shown in FIG. 32, taken along line M-M. Some components are cropped or not shown for clarity.

Referring now to FIGS. 19-21, the assembly of the multi-piece fluid end 202 begins with the assembling the dynamic sections 206 which are then attached to the static section 205 as described for dynamic sections 106 and static section 105 above. Then the flow control components are installed from the other side of the static section.

Next, for each dynamic section 206, the retainer seal 212 is installed in the seal groove 243 of the dynamic shoulder 239 of the plunger bore 231 of the retainer 213. Then, the retainer 213 is attached to the dynamic section 206 by threading the dynamic threads 238 of the plunger bore 231 of the retainer 213 onto the dynamic body 207.

Next, the packing 215 is inserted into the dynamic section 206 and the intermediate section 240 of the plunger bore 231 of the retainer 213. Next, the plunger seal 217 is installed in plunger seal groove 257 of the packing nut 216 and the packing nut 216 is threaded into the packing nut thread 242 of the plunger bore 231 of the retainer 213. Next, the plunger 218 is installed in the packing nut 216, packing 215, and dynamic section 206. Next, the packing nut 216 is torqued to specification. Lastly the plurality of tension bolts 214 are then inserted, on a one-to-one basis, into the tension bolt holes 256 from the back shoulder 251 of the packing nut 216 and threaded into the threaded section of the tension bolt holes 256 until the front surface of each tension bolt 214 contacts the packing nut shoulder 241 of the plunger bore 231 of the retainer 213. Once contact is made by all tension bolts 214, the tension bolts 214 may be torqued to specification in a piecewise manner.

In operation the tension bolts 214 place the threaded joint formed by the packing nut threads 242 of the plunger bore 231 of the retainer 213 and threaded section 250 of the packing nut 216 in tension providing an additional tensile load above that produced by the torquing of the threads together. This additional tensile load reduces the magnitude of cyclic loading usually produced in the joint by the large pressure fluctuations in the dynamic section 206. This reduction in the magnitude of cyclic loading reduces thread to thread fretting and other issues inherent in the previously encountered full, or nearly full, cyclic loading of the threads. These benefits result in an easier and quicker removal of the packing nut 216 for maintenance or replacement when necessary.

Figure 36:
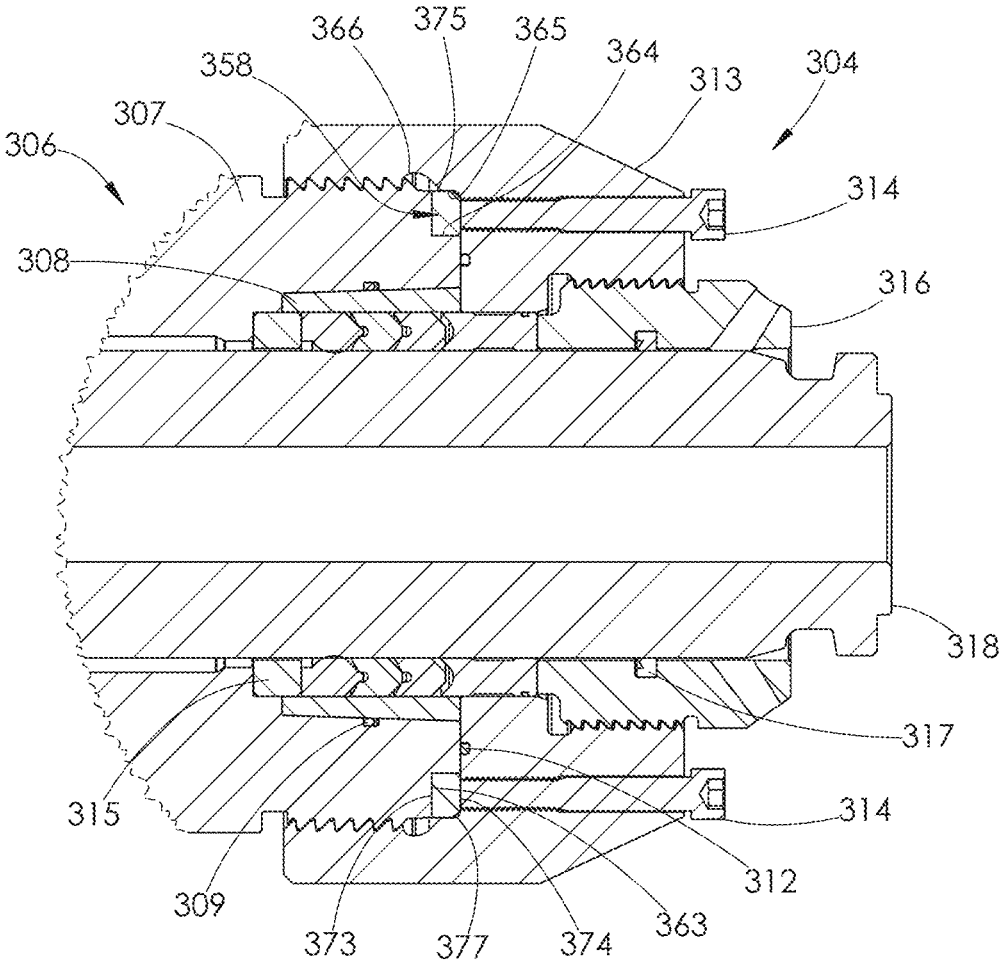
FIG. 36 is an enlarged view of area O shown in FIG. 34.
Figure 37:
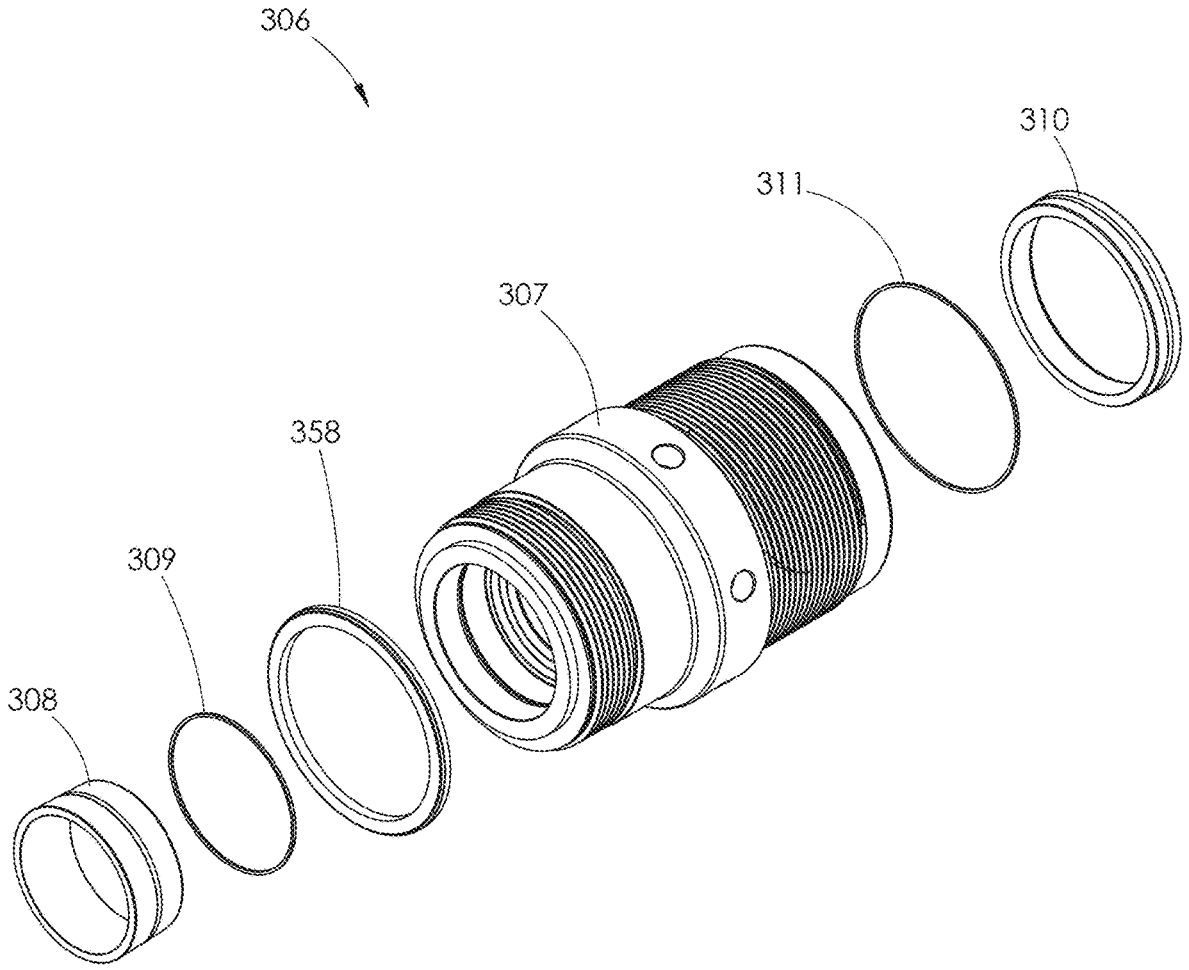
FIG. 37 is an exploded back, top, left, isometric view of a dynamic section of the multi-piece fluid end shown in FIG. 32.
Figure 38:
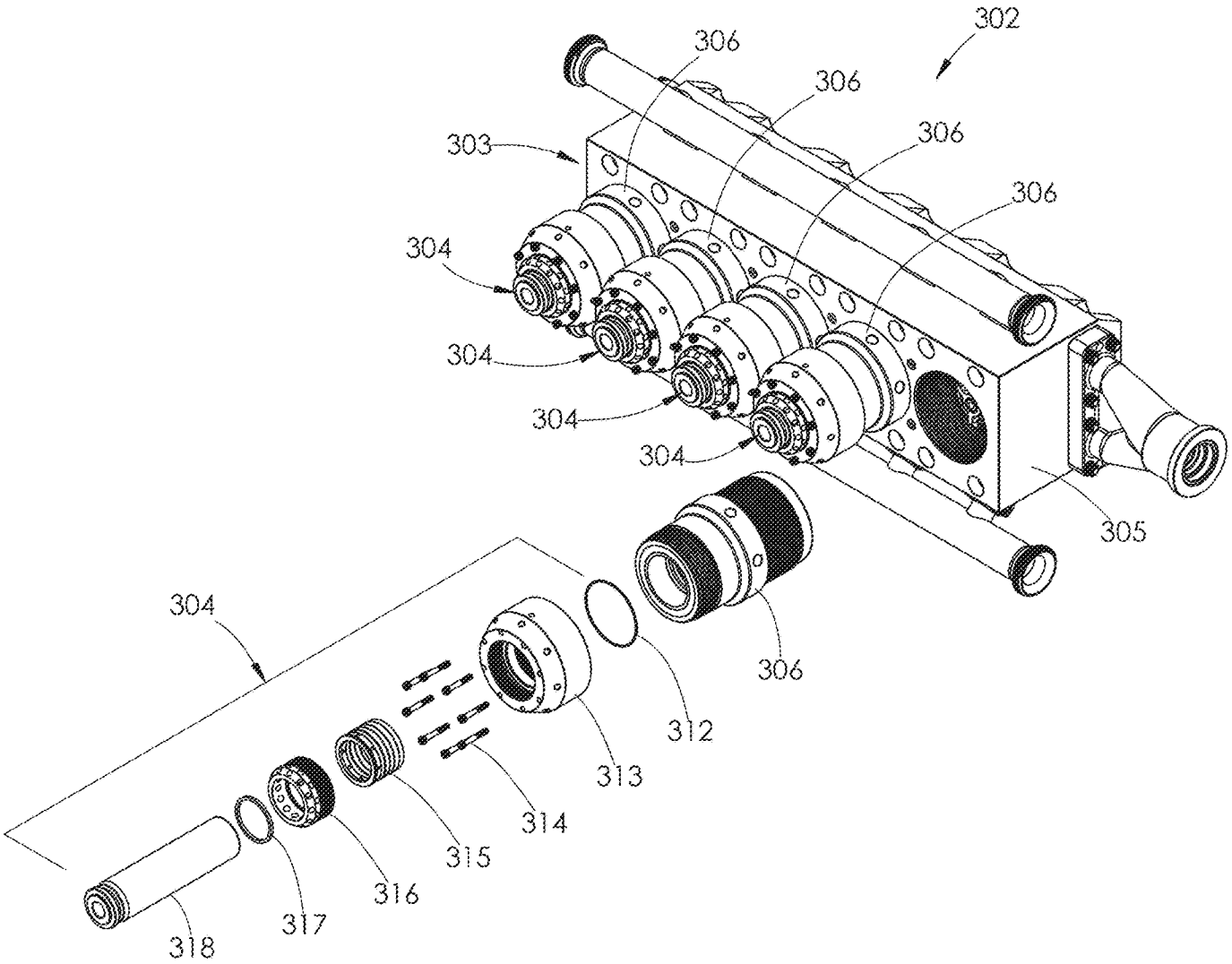
FIG. 38 is an exploded, back, top, left isometric view of the multi-piece fluid end shown in FIG. 32.
Figure 39:
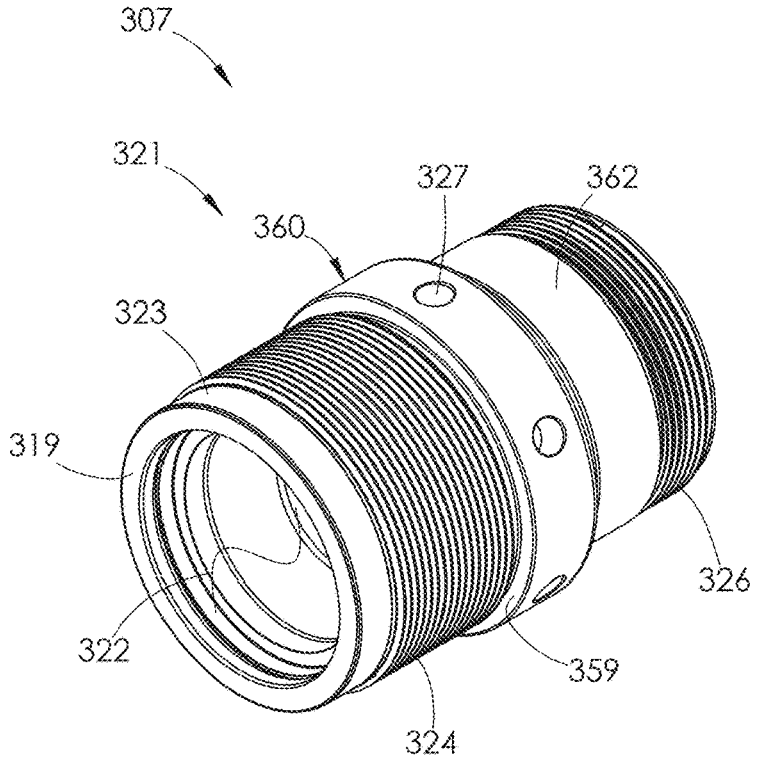
FIG. 39 is an isometric view of a dynamic body used in the dynamic section shown in FIG. 37.
Figure 40:
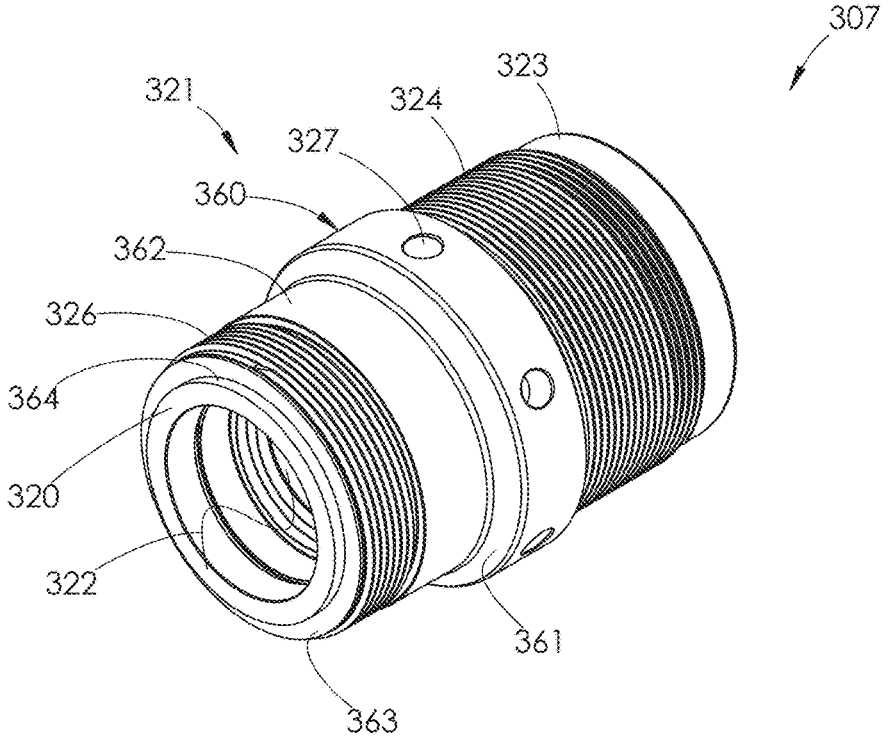
FIG. 40 is a back, top, left isometric view of the dynamic body shown in FIG. 39.
Figure 41:
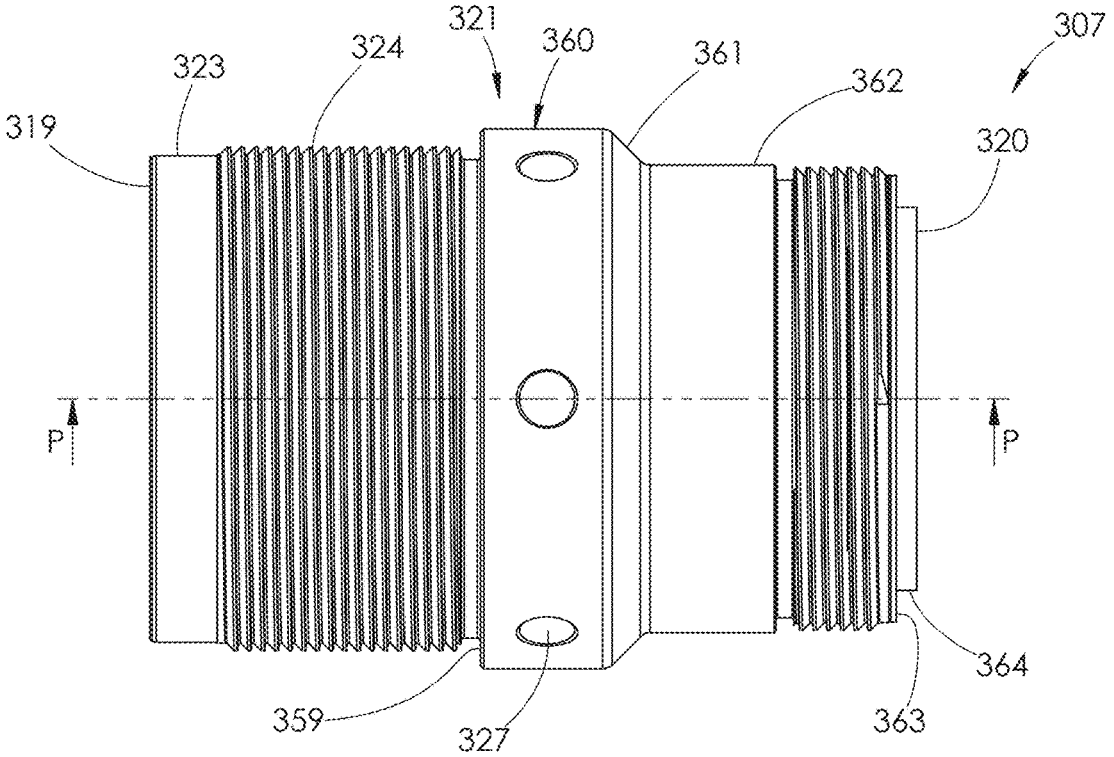
FIG. 41 is a top plan view of the dynamic body shown in FIG. 39.

Referring now to FIGS. 32-53, another embodiment of a multi-piece fluid end 302 is shown. The multi-piece fluid end 302 comprises a fluid end body 303 and a plurality of plunger systems 304. The fluid end body 303 comprises a static section 305 and a plurality of dynamic sections 306. Each dynamic section 306 comprises a dynamic body 307, a plunger system wear ring 308, a plunger system wear ring seal 309, a flow control system wear ring 310, a flow control system wear ring seal 311, and a centering ring 358 as shown in FIG. 37. Each plunger system 304 comprises a retainer seal 312, a retainer 313, a plurality of tension bolts 314, packing 315, a packing nut 316, a plunger seal 317, and a plunger 318, as shown in FIG. 36.

The dynamic body 307, shown in FIGS. 39-42, has a cylindrical shape. The dynamic body 307 comprises opposing front 319 and back 320 surfaces connected by an outer surface 321 and a flow bore 322. The outer surface 321 and flow bore 322 are concentric and their cylindrical axis is the longitudinal axis of the dynamic body 307.

Figure 42:
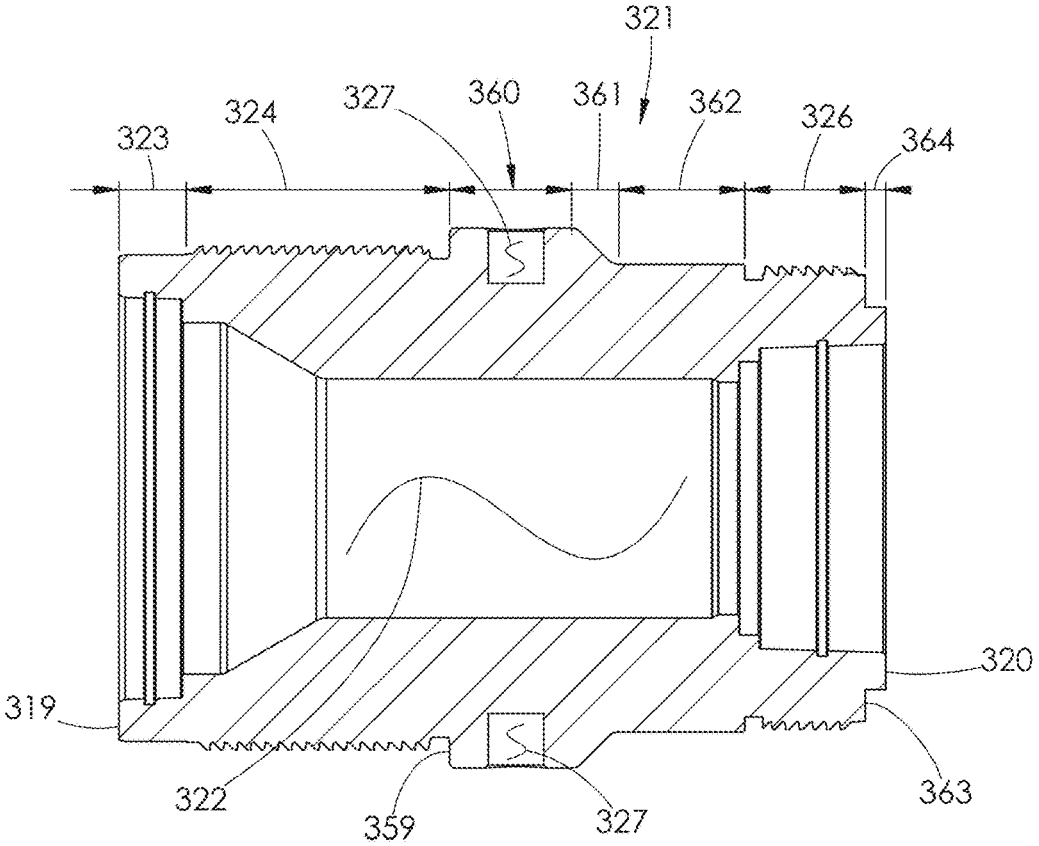
FIG. 42 is a cross-sectional view of the dynamic body shown in FIG. 41, taken along line P-P.
Figure 43:
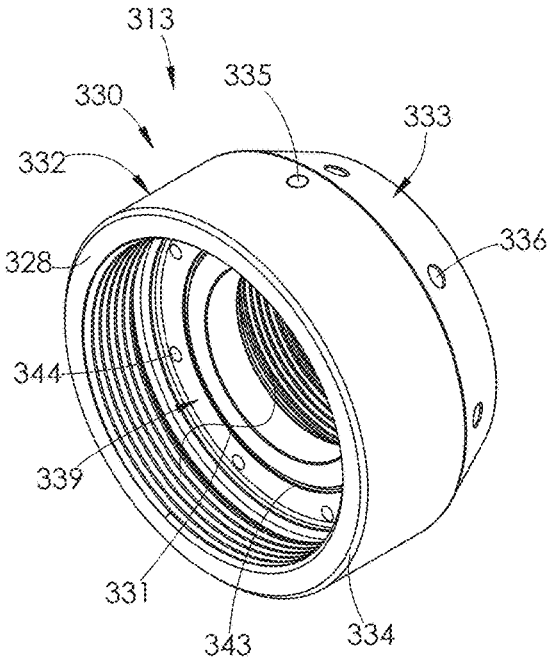
FIG. 43 is an isometric view of a retainer used in the multi-piece fluid end shown in FIG. 32.
Figure 44:
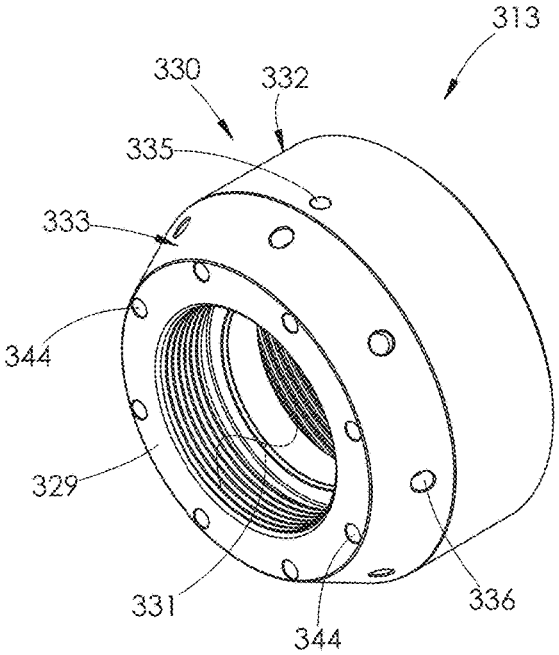
FIG. 44 is a back, top, left isometric view of the retainer shown in FIG. 43.
Figure 45:
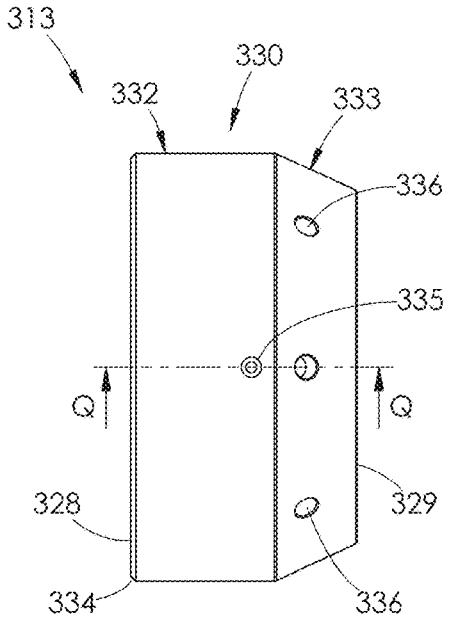
FIG. 45 is a top plan view of the retainer shown in FIG. 43.
Figure 46:
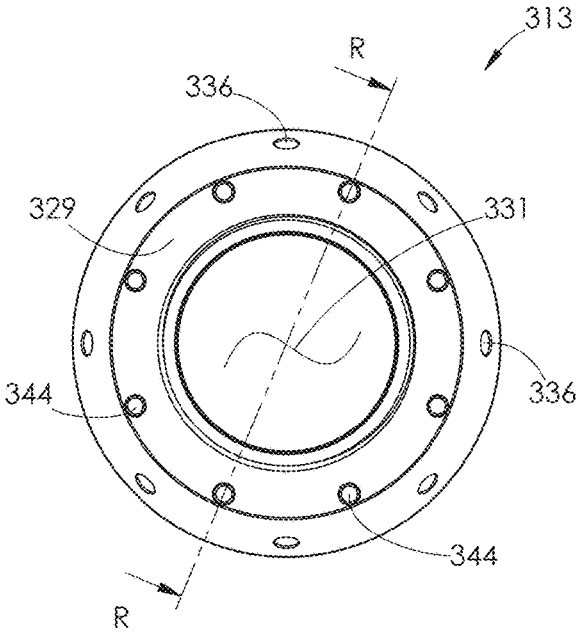
FIG. 46 is a back elevation view of the retainer shown in FIG. 43.
Figure 47:
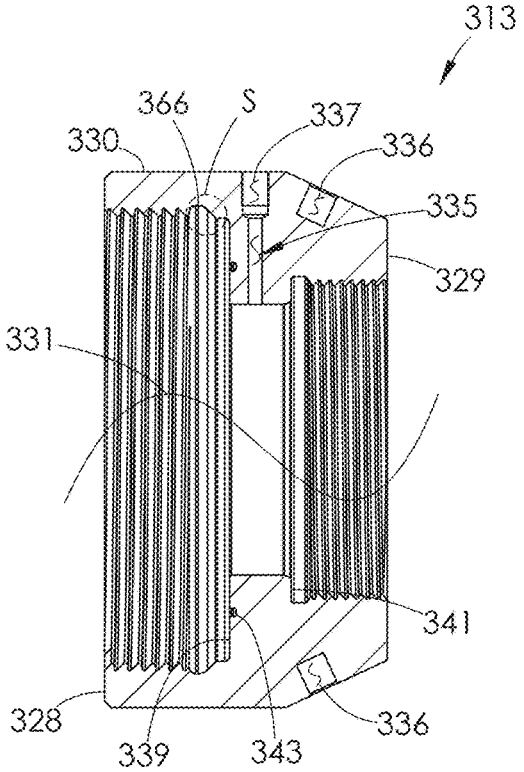
FIG. 47 is a cross-sectional view of the retainer shown in FIG. 45, taken along line Q-Q.

The outer surface 321, as shown in FIG. 42, comprises multiple concentric sections. Beginning at the front surface 319 of the dynamic body 307 and continuing along the longitudinal axis to the back surface 320 the outer surface 321 comprises a static seal section 323, static threads 324, locating shoulder 359, spanner section 360, transition taper 361, retainer section 362, retainer threads 326, centering ring shoulder 363, and centering ring section 364. The spanner section 360 comprises a plurality of spanner wrench holes 327. The spanner wrench holes 327 are radial blind bores with a bore axis that is perpendicular to the longitudinal axis of the dynamic body 307. Each spanner wrench hole 327 originates from the spanner section 360 of the outer surface 321 but does not intersect the flow bore 322. In this embodiment the spanner wrench holes 327 are approximately centered and aligned longitudinally in the spanner section 360, the spanner wrench holes 327 are also evenly spaced circumferentially but may be spaced in any manner on the spanner section 360 as long as access for the spanner wrench (not shown) is available.

The flow bore 322 also comprises multiple sections and is configured to receive the plunger system wear ring seal 309, plunger system wear ring 308, flow control system wear ring seal 311, and flow control system wear ring 310. The flow bore 322 is not the focus of this improvement so no further details about the flow bore 322 are necessary to understand this disclosure.

The retainer 313, shown in FIGS. 43-49, has a generally cylindrical shape. The retainer 313 comprises a front surface 328 and back surface 329 connected by an outer surface 330 and plunger bore 331. The outer surface 330 and plunger bore 331 are concentric and their cylindrical axis is the longitudinal axis of the retainer 313.

The outer surface 330 comprises a straight section 332 and a tapered section 333. The straight section 332 begins at the front surface 328 and continues along the longitudinal axis until it connects with the tapered section 333. The straight section 332 occupies approximately 60% of the outer surface 330 but may be more or less. The straight section 332 comprises a front chamfer 334 and a lubrication port 335. The lubrication port 335 is a through bore connecting the straight section 332 of the outer surface 330 to the intermediate section 340 of the plunger bore 331. The lubrication port 335 comprises a threaded section 337 adjacent the outer surface 330 configured to receive a lubrication fitting (not shown) or plug (not shown).

The tapered section 333 comprises a plurality of spanner wrench holes 336. The spanner wrench holes 336 are radial bores with a bore axis that is perpendicular to the tapered face of the tapered section 333. Each spanner wrench hole 336 originates from the tapered section 333 of the outer surface 330 and does not intersect the plunger bore 331. In this embodiment the spanner wrench holes 336 are proximate the straight section 332 longitudinally. The spanner wrench holes 336 are evenly spaced circumferentially, however, they may be spaced in any manner on the tapered section 333 as long as access for the spanner wrench (not shown) is available.

Figure 48:
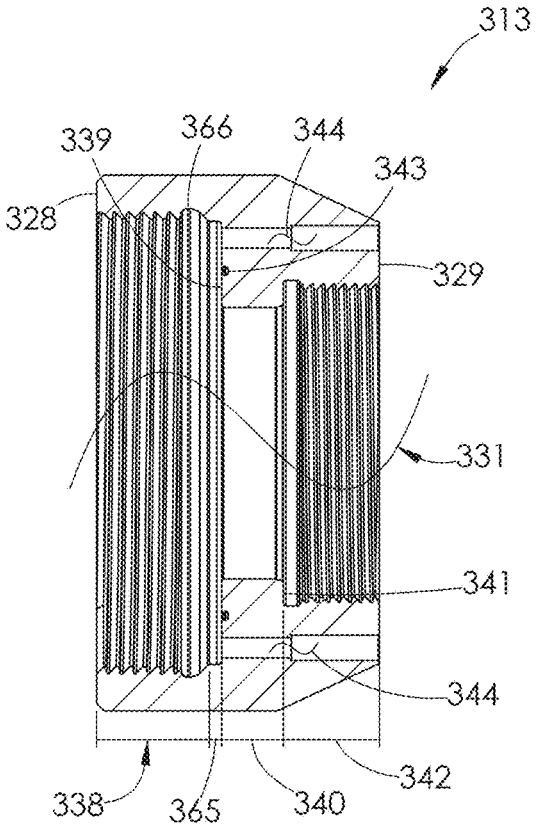
FIG. 48 is a cross-sectional view of the retainer shown in FIG. 46, taken along line R-R.

The plunger bore 331 comprises multiple sections, as shown in FIG. 48. Beginning at the front surface 328 and continuing along the longitudinal axis to the back surface 329 the plunger bore 331 comprises dynamic threads 338, a centering ring section 365, a dynamic shoulder 339, an intermediate section 340, a packing nut shoulder 341, and packing nut threads 342. The dynamic shoulder 339 comprises a seal groove 343. The seal groove 343 is circular and concentric with the plunger bore 331. The seal groove 343 is configured to receive the retainer seal 312.

Figure 49:
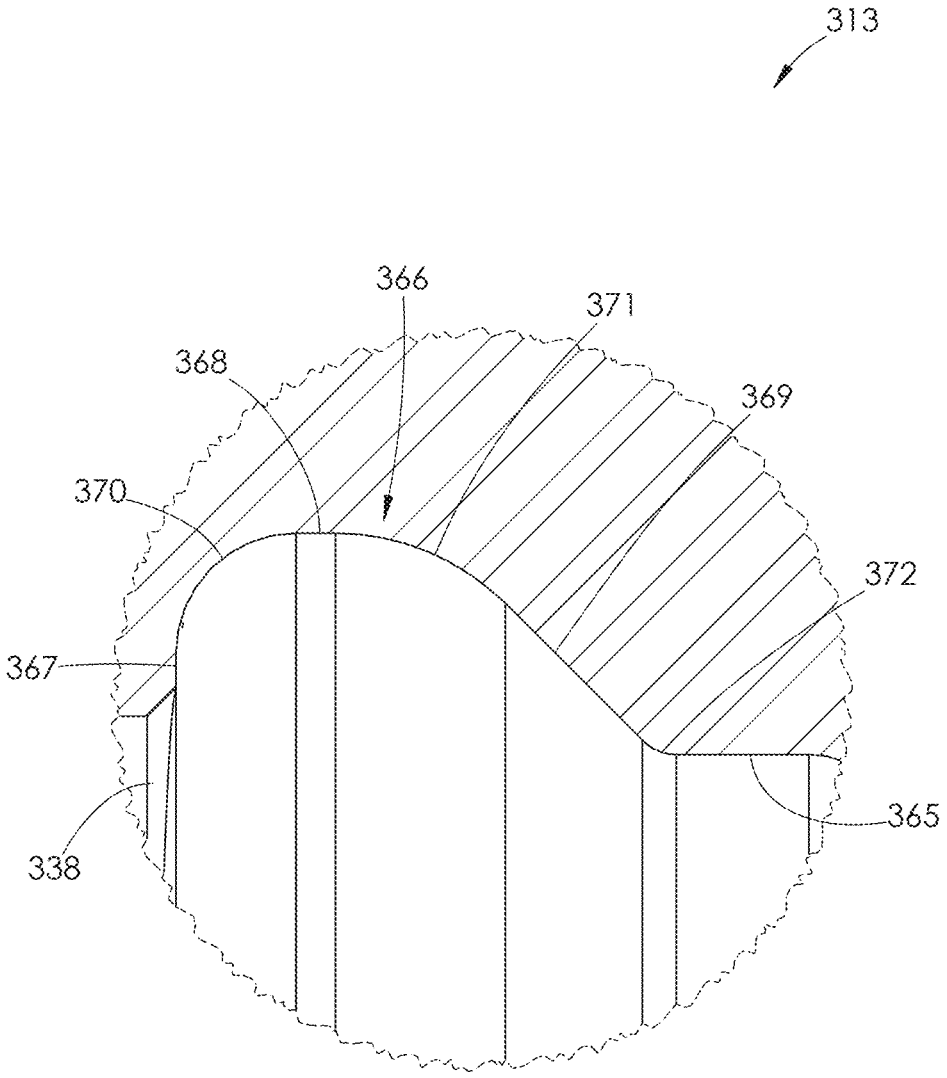
FIG. 49 is an enlarged view of area S shown in FIG. 47.
Figure 50:
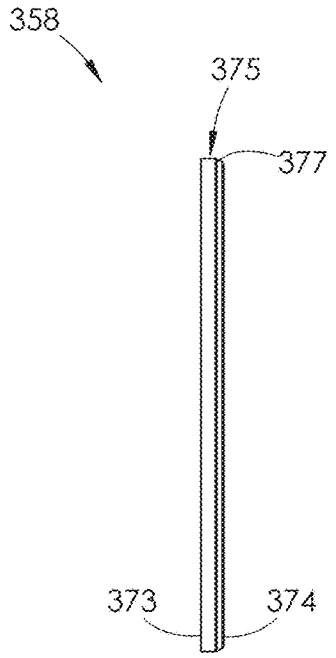
FIG. 50 is a top plan view of a centering ring used in the multi-piece fluid end shown in FIG. 32.
Figure 51:
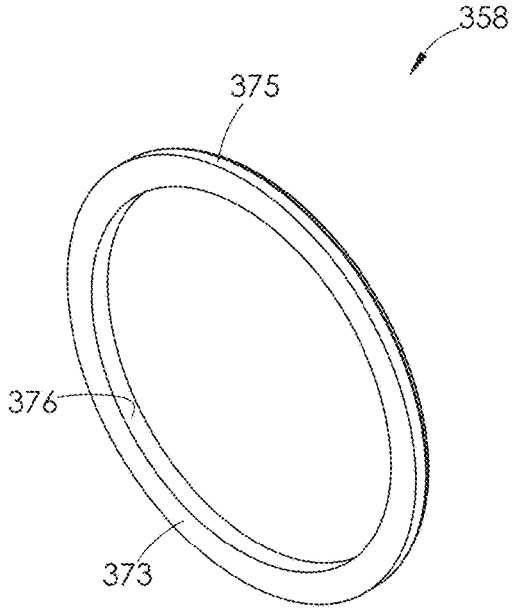
FIG. 51 is an isometric view of the centering ring shown in FIG. 50.
Figure 52:
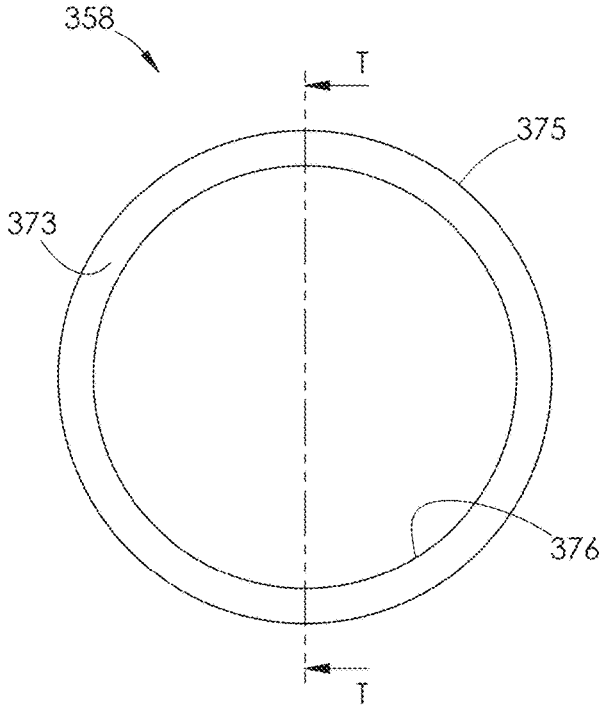
FIG. 52 is a front view of the centering ring shown in FIG. 50.
Figure 53:
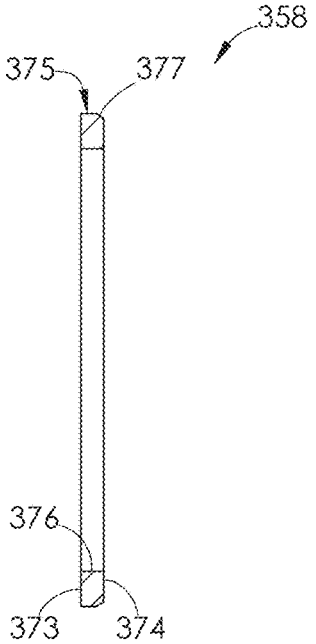
FIG. 53 is a cross-sectional view of the centering ring shown in FIG. 52, taken along line T-T.

The dynamic threads 338 comprise a thread relief 366 proximate the centering ring section 365. Referring now to FIG. 49, the thread relief 366 comprises a plurality of straight sections, straight section one 367, straight section two 368, and straight section three 369. The thread relief 366 further comprises a plurality of curved sections, curved section one 370, curved section two 371, and curved section three 372. Straight section one 367 extends radially from the last thread. Since the threads are angled, no thread face is perpendicular to the longitudinal axis of the retainer 313. Straight section one 367 makes a planar surface at the end of the threads. Curved section one 370 is concave and provides a transition from straight section one 367 to straight section two 368. Straight section two 368 is parallel with the longitudinal axis of the retainer 313 and provides a transition from curved section one 370 to curved section two 371 and the ability to extend the thread relief 366 if desired. Curved section two 371 is concave and provides a transition from straight section two 368 to straight section three 369. Straight section three 369 is angled relative to the longitudinal axis and provides a transition from curved section two 371 to curved section three 372. Curved section three 372 is convex and provides a transition from straight section three 369 to the centering ring section 365 of the plunger bore 331.

In this embodiment curved section two 371 has a larger radius than curved section one 370 but they may be the same or the radius of curved section one 370 may be larger than that of curved section two 371. It is also possible that straight section two 368 may be eliminated and curved section one 370 may transition directly to curved section two 371. In this embodiment straight section three 369 has an angle of approximately 45 degrees with the longitudinal axis however it may be any angle between 0 and 90 degrees. It is also contemplated that the curved sections 370, 371, and 372 may be spline curves with infinitely varying radii. If both curved section one 370 and curved section two 371 are spline curves and straight section two 368 is removed, then curved section one 370 and curved section two 371 may be considered a single curve.

The retainer 313 further comprises a plurality of tension bolt holes 344. Each tension bolt hole 344 is a partially threaded through hole originating on the back surface 329 and terminating at the dynamic shoulder 339. The threaded portion of the tension bolt hole 344 extends from the dynamic shoulder 339 approximately half the tension bolt hole 344 length to the back surface 329 and is configured to receive a tension bolt 314. The tension bolt holes 344 are distributed evenly on a bolt circle that is concentric with the retainer 313.

The centering ring 358, shown in FIGS. 50-53, is ring shaped and comprises a front surface 373 and back surface 374 connected by an outer surface 375 and an inner surface 376. The outer surface 375 comprises a chamfer 377 proximate the back surface 374. The front and back surfaces 373, 374 are planar, parallel to each other, and perpendicular to the longitudinal axis. The inner surface 376 is parallel to the longitudinal axis and configured to receive the centering ring section 364 of the outer surface 321 of the dynamic body 307. The outer surface 375, with the exception of the chamfer 377, is parallel to the longitudinal axis and configured to be received by the centering ring section 365 of the plunger bore 331 of the retainer 313. The centering ring 358 is formed of a harder material than dynamic body 307. The material may be carbide, tool steel, carburized 8620 steel or any of the many other harder materials well known in the art.

Referring now to FIGS. 33-38, the assembly of the multi-piece fluid end 302 begins the installation of a flow control system wear ring seal 311, a flow control system wear ring 310, a plunger system wear ring seal 309, and a plunger system wear ring 308 into each dynamic body 307, as shown in FIG. 37. Next a centering ring 358 is pressed over the centering ring section 364 of the outer surface 321 of each dynamic body 307 until the front surface 373 of the centering ring 358 abuts the centering ring shoulder 363 of the dynamic body 307. This completes the assembly of the dynamic sections 306, as shown in FIG. 36.

Figure 35:
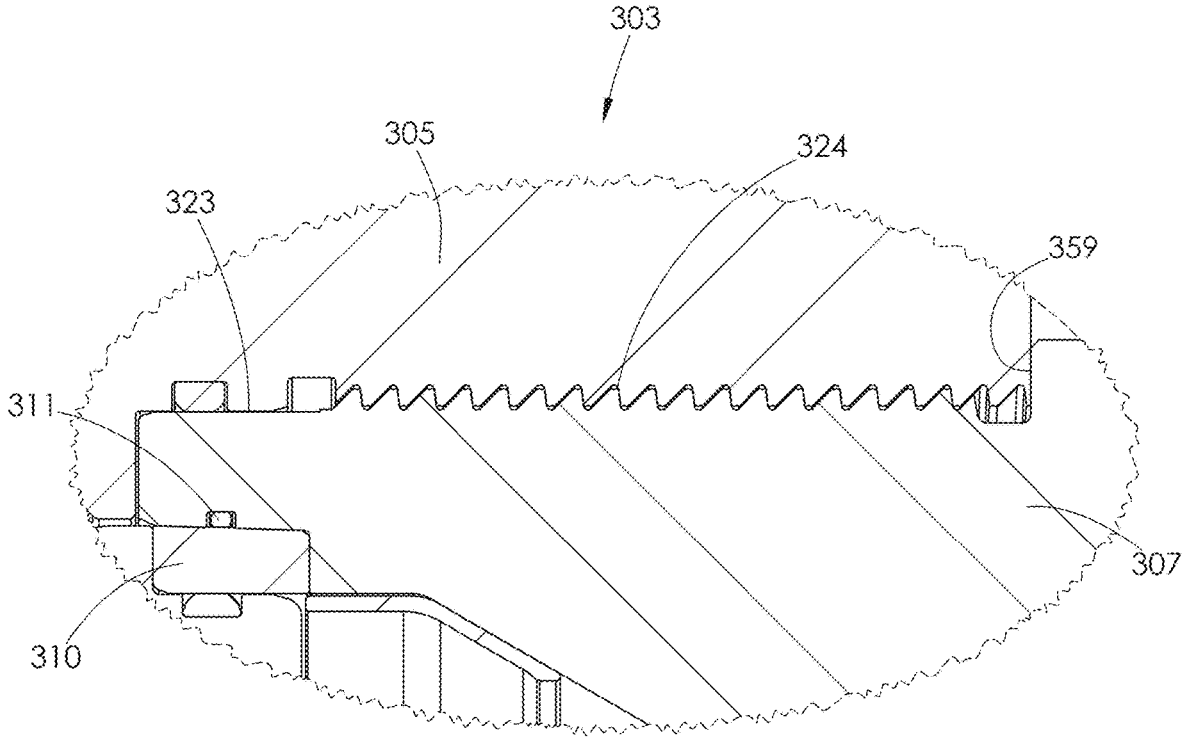
FIG. 35 is an enlarged view of area N shown in FIG. 33.

Each dynamic section 306 is then attached to the static section 305 by threading the static threads 324 of the outer surface 321 of the dynamic body 307 into the matching threads of the static section 305 until the locating shoulder 359 abuts the static section 305, as shown in FIG. 35. A spanner wrench (not shown) may be used to apply the required torque using the spanner wrench holes 327 in the spanner section 360 of the outer surface 321 of the dynamic body 307. The flow control components may now be installed front eh opposite side of the static section 305.

Next, for each dynamic section 306, a retainer seal 312 is installed in the seal groove 343 of the dynamic shoulder 339 of the plunger bore 331 of a retainer 313. Then, the retainer 313 is attached to a dynamic section 306 by threading the dynamic threads 338 of the plunger bore 331 of the retainer 313 onto the retainer threads 326 of the outer surface 321 of the dynamic body 307. A spanner wrench (not shown) may be used to apply the required torque using the spanner wrench holes 336 in the tapered section 333 of the outer surface 330 of the retainer 313. As the retainer 313 is being threaded on the dynamic body 307 the chamfer 377 of the centering ring 358 will facilitate the insertion of the centering ring 358 into the centering ring section 365 of the plunger bore 331 of the retainer 313, as shown in FIG. 36. The outer surface 375 and centering ring section 365 may have a line-to-line, or a light interference fit, to maximize the longitudinal alignment between the retainer 313 and the dynamic body 307.

The plurality of tension bolts 314 are then inserted, on a one-to-one basis, into the tension bolt holes 344 from the back surface 329 of the retainer 313 and threaded into the threaded section of the tension bolt holes 344 until the front surface of each tension bolt 314 contacts the back surface 374 of the centering ring 358. Once contact is made by all tension bolts 314 the tension bolts 314 may be torqued to specification in a piecewise manner. Since the tension bolts 314 engage the harder centering ring 358 there is no damage done to the dynamic body 307 allowing many assembly and disassembly cycles of the retainer 313 before having to consider the damage inflicted by the tension bolts 314 on the centering ring 358. Once the damage to the centering ring 358 is considered intolerable the centering ring 358 may be replaced without replacing the much more expensive dynamic body 307.

Next, the packing 315 is inserted into the dynamic section 306 and the intermediate section 340 of the plunger bore 331 of the retainer 313. Next, the plunger seal 317 is installed in the packing nut 316 and the packing nut 316 is threaded into the packing nut thread 342 of the plunger bore 331 of the retainer 313. Next, the plunger 318 is installed in the packing nut 316, packing 315, and dynamic section 306. Lastly, the packing nut 316 is torqued to specification.

In operation the tension bolts 314 place the threaded joint formed by the retainer threads 326 of the dynamic body 307 and the dynamic threads 338 of the retainer 313 in tension providing an additional tensile load above that produced by the torquing of the threads together. This additional tensile load reduces the magnitude of cyclic loading usually produced in the joint by the large pressure fluctuations in the dynamic section 306. This reduction in the magnitude of cyclic loading reduces thread to thread fretting and other issues inherent in the previously encountered full, or nearly full, cyclic loading of the threads. Also, the retainer seal 312 protects the retainer threads 326 and dynamic threads 338 from contamination when the packing 315 fails. These benefits result in easier and quicker removal of the retainer 313 for maintenance or replacement when necessary. Also during operation, the thread relief 366 reduces stress in the retainer 313 at the transition from the dynamic threads 338 to the dynamic shoulder 339.

Figure 54:
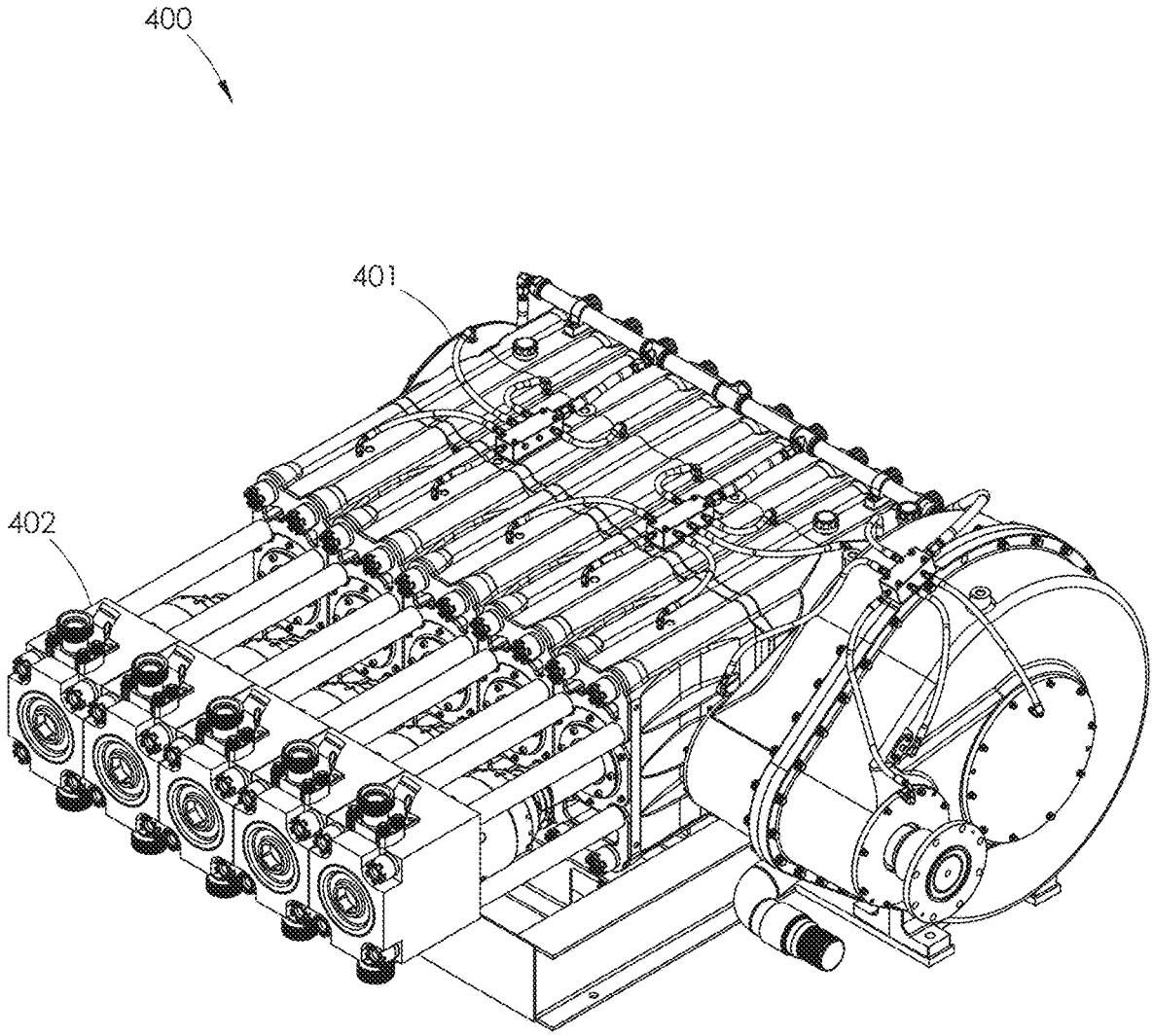
FIG. 54 is an isometric view of another embodiment of a high-pressure pump.

Another embodiment of a high-pressure pump 400 is shown in FIG. 54. The high-pressure pump 400 comprises a power end 401 connected to a fluid end 402. The fluid end 402 shown in FIG. 55, comprises a plurality of fluid end sections 478. Each fluid end section 478 comprises a fluid end body 403 and a plunger system 404. The fluid end body 403 comprises a static section 405 and a dynamic section 406.

Figure 58:
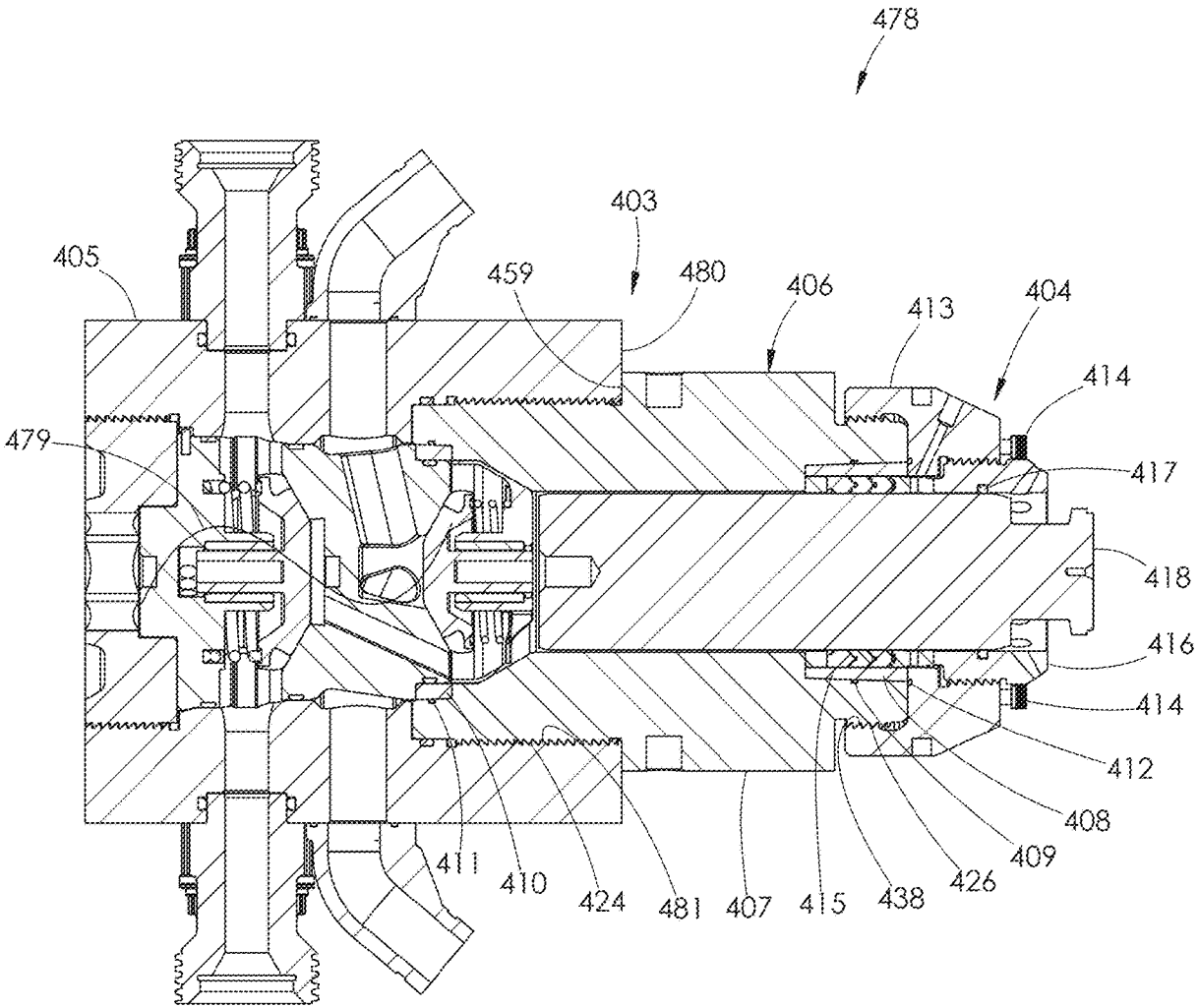
FIG. 58 is a cross-sectional view of the fluid end section shown in FIG. 56, taken along line U-U.
Figure 59:
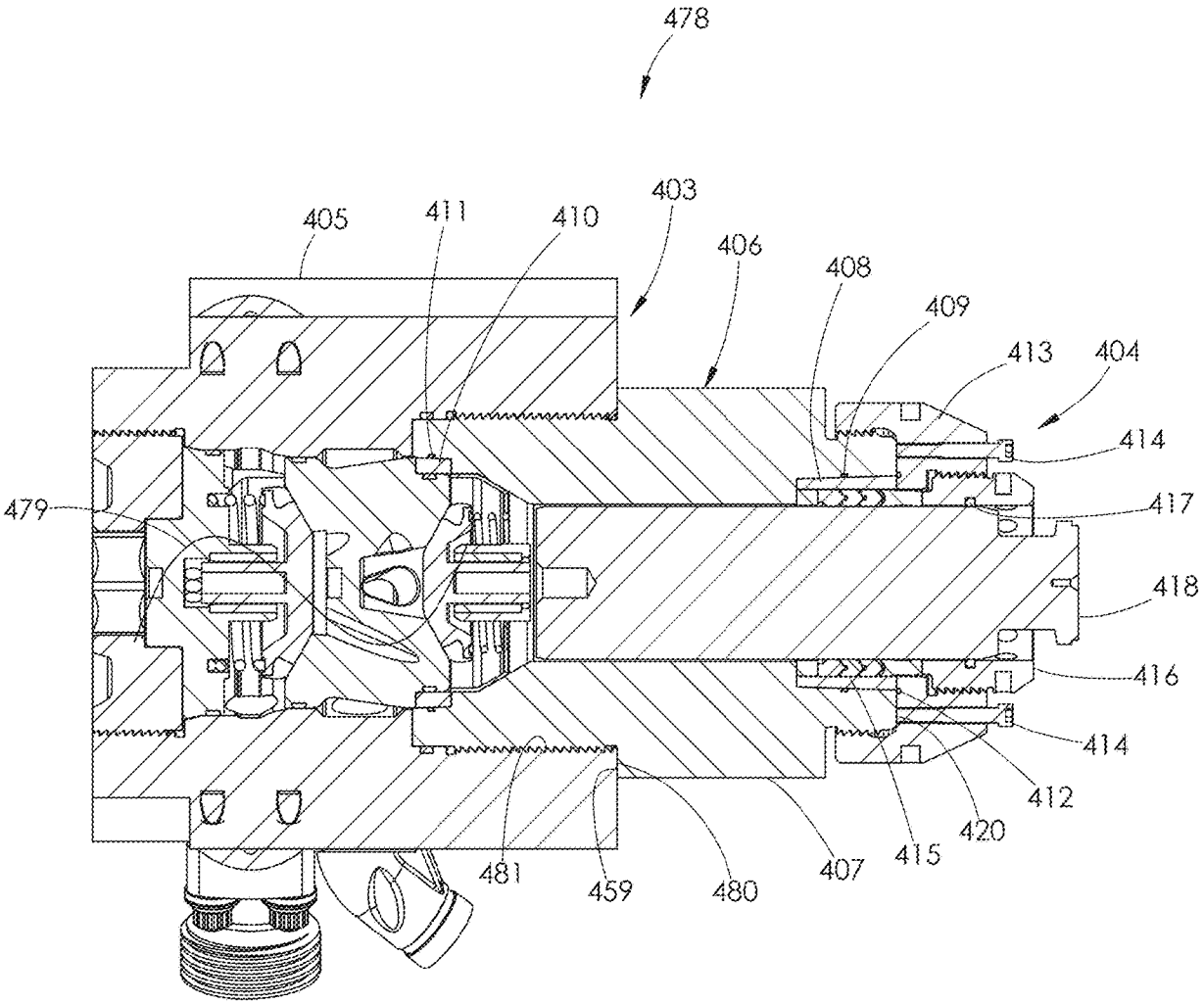
FIG. 59 is a cross-sectional view of the fluid end section shown in FIG. 57, taken along line V-V.
Figure 60:
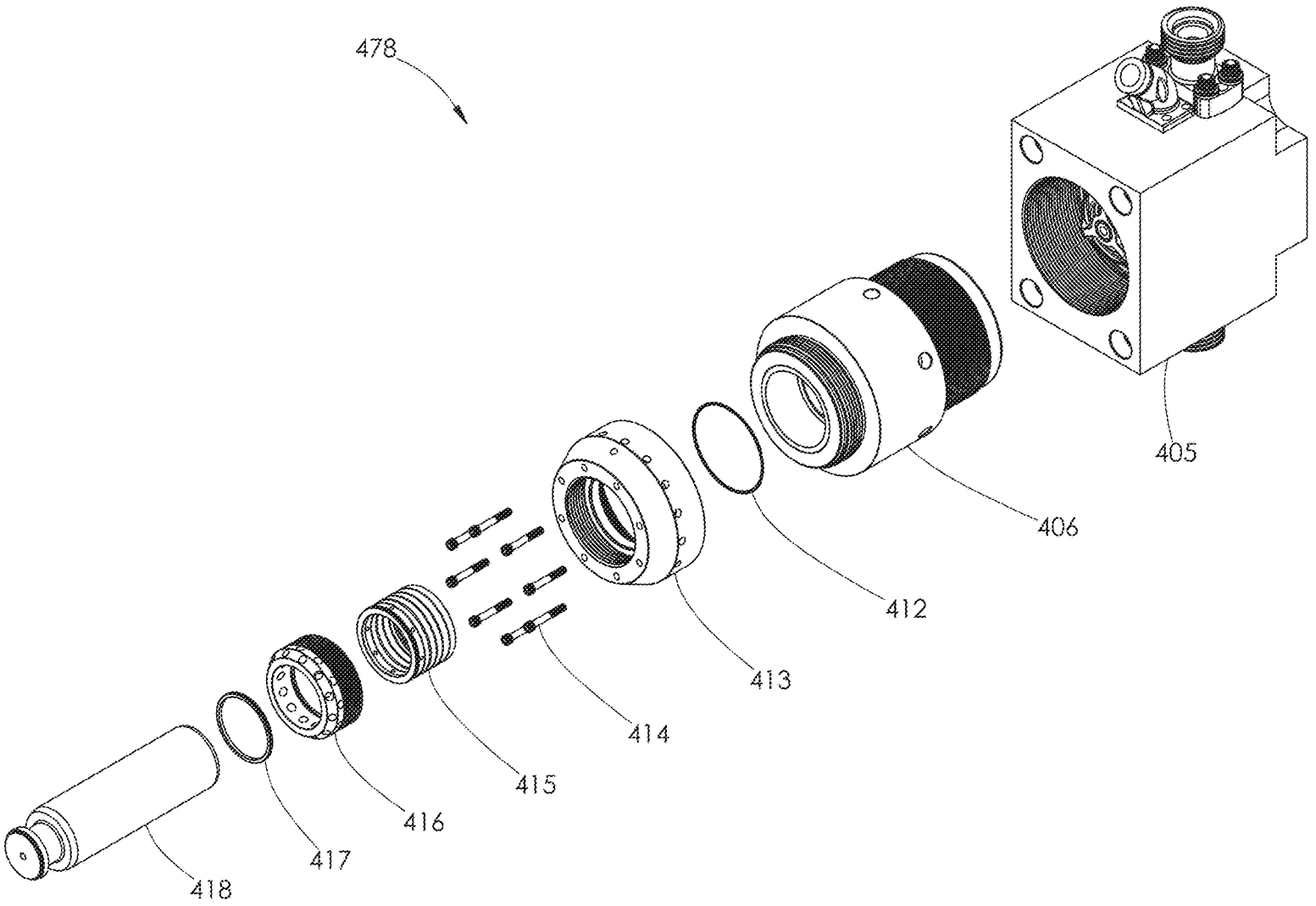
FIG. 60 is an exploded, back, top, left isometric view of the fluid end section shown in FIG. 56.

Each static section 405, shown in FIGS. 58 and 59, comprises a flow bore 479 and a back surface 480. The flow bore 479 is configured to receive flow control components. The flow bore 479 comprises a section of dynamic threads 481 proximate the back surface 480 of the static section 405. The dynamic threads 481 are configured to receive the static threads 424 of the dynamic section 406.

Each dynamic section 406 comprises a dynamic body 407, a plunger system wear ring 408, a plunger system wear ring seal 409, a flow control system wear ring 410, and a flow control system wear ring seal 411. Each plunger system 404 comprises a retainer seal 412, a retainer 413, a plurality of tension bolts 414, packing 415, a packing nut 416, a plunger seal 417, and a plunger 418.

Figure 61:
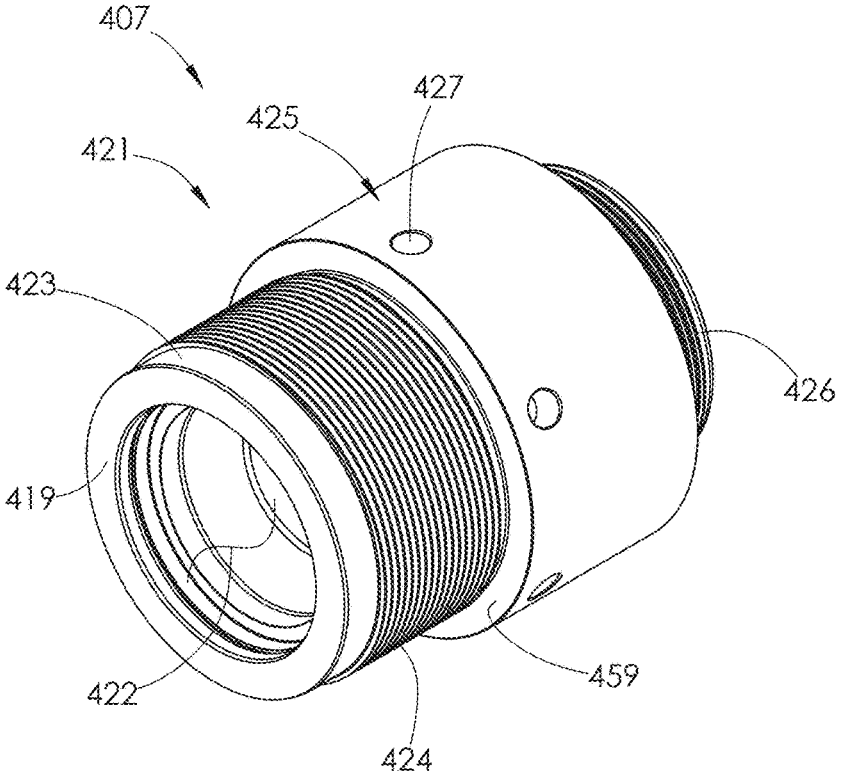
FIG. 61 is an isometric view of the dynamic body used in the dynamic section shown in FIG. 56.
Figure 62:
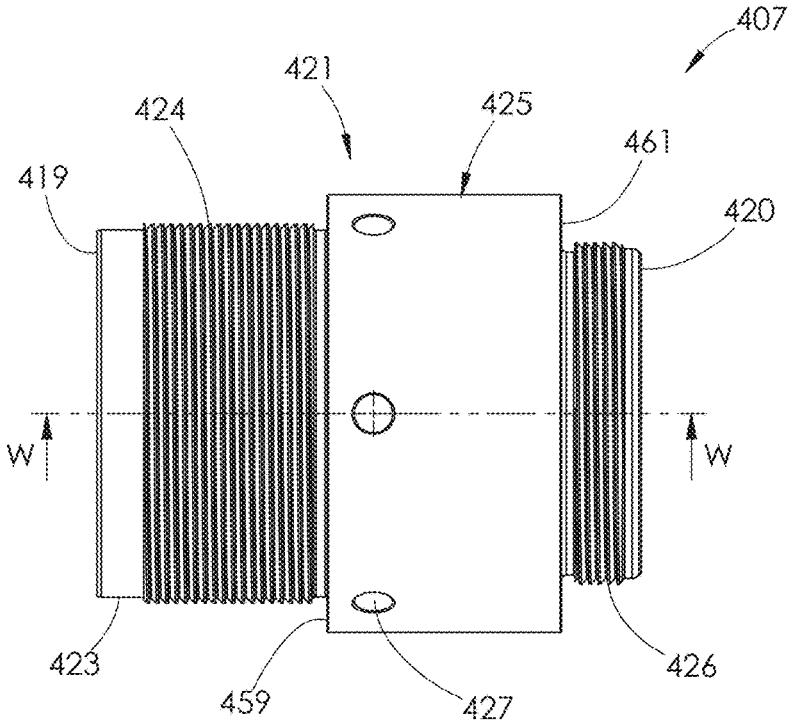
FIG. 62 is a top plan view of the dynamic body shown in FIG. 61.
Figure 63:
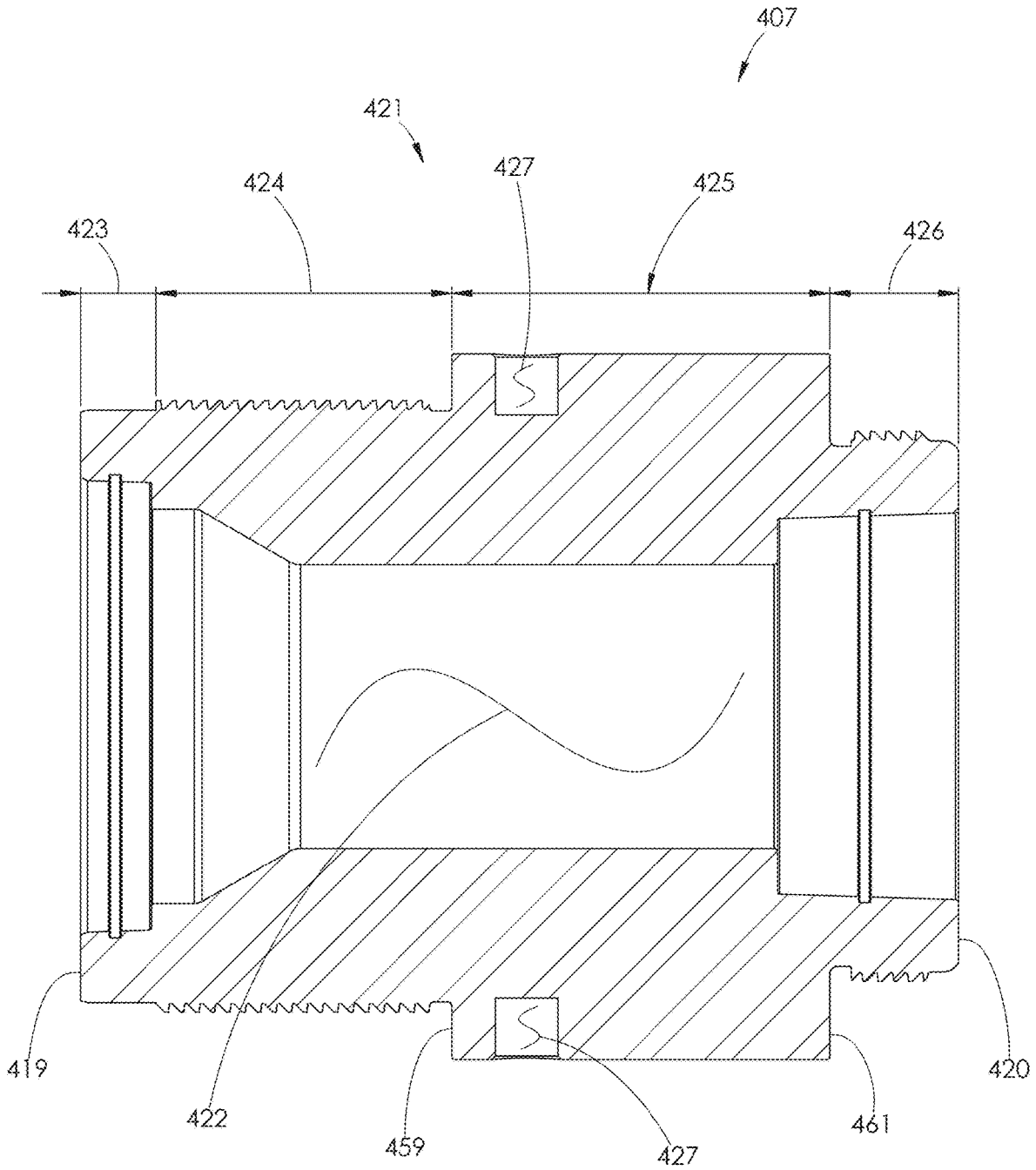
FIG. 63 is a cross-sectional view of the dynamic body shown in FIG. 62, taken along line W-W.
Figure 64:
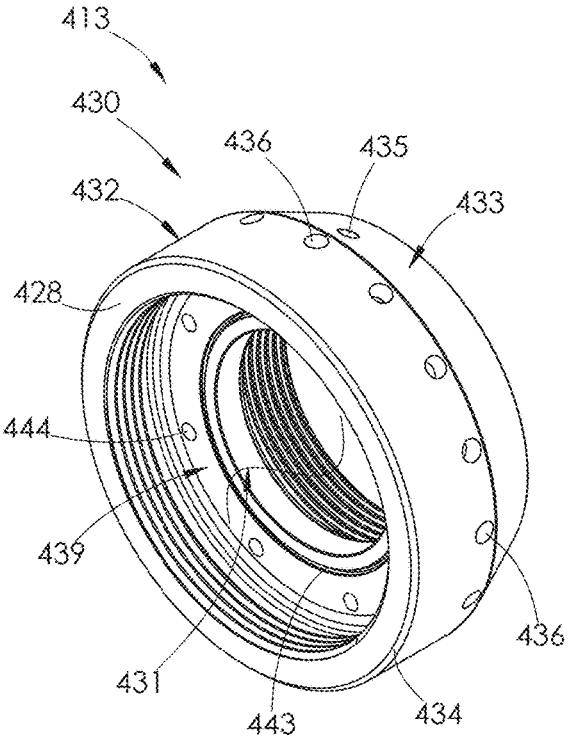
FIG. 64 is an isometric view of the retainer used in the plunger system shown in FIG. 56.
Figure 65:
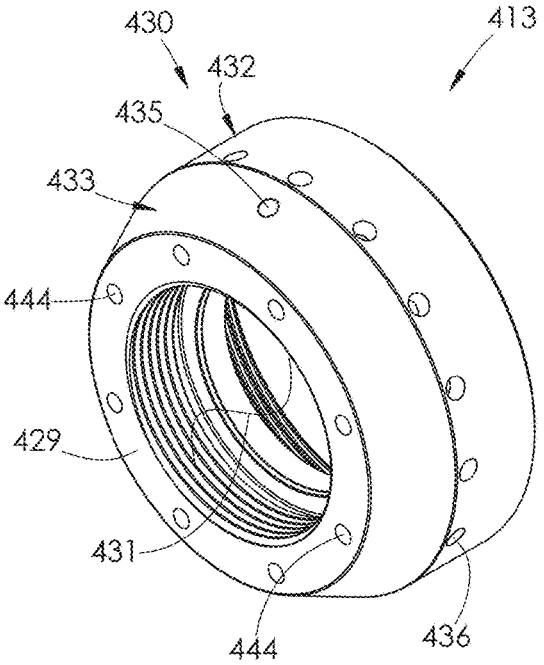
FIG. 65 is a back, top, left isometric view of the retainer shown in FIG. 64.
Figure 66:
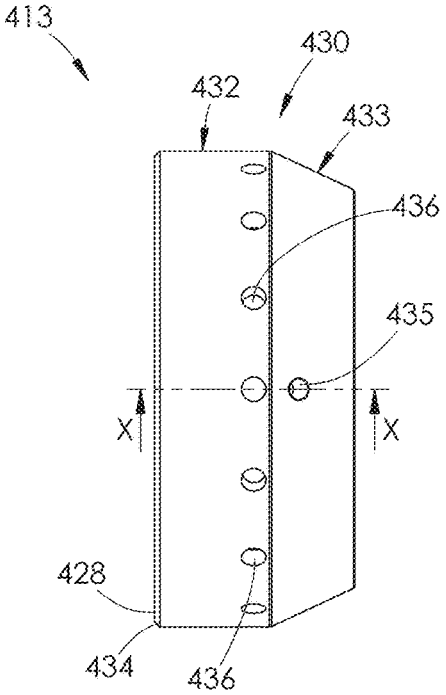
FIG. 66 is a top plan view of the retainer shown in FIG. 64.
Figure 67:
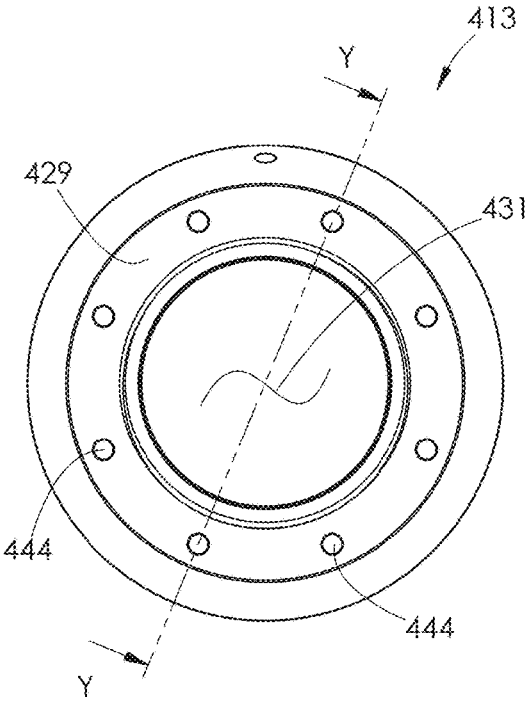
FIG. 67 is a back elevation view of the retainer shown in FIG. 64.
Figure 68:
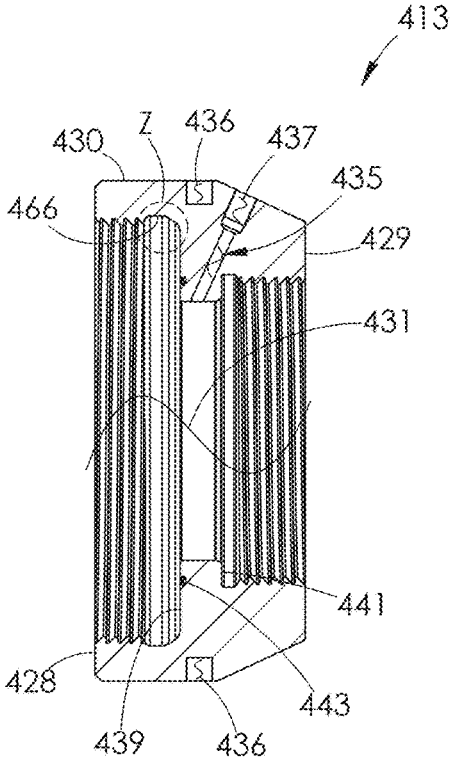
FIG. 68 is a cross-sectional view of the retainer shown in FIG. 66, taken along line X-X.

The dynamic body 407, shown in FIGS. 61-63, has a cylindrical shape. The dynamic body 407 comprises opposing front 419 and back 420 surfaces connected by an outer surface 421 and a flow bore 422. The outer surface 421 and flow bore 422 are concentric and their cylindrical axis is the longitudinal axis of the dynamic body 407.

The outer surface 421 comprises multiple sections, all the sections are concentric. Beginning at the front surface 419 of the dynamic body 407 and continuing along the longitudinal axis to the back surface 420 the outer surface 421 comprises a static seal section 423, static threads 424, locating shoulder 459, intermediate section 425, back shoulder 461, and retainer threads 426. The intermediate section 425 comprises a plurality of spanner wrench holes 427. The spanner wrench holes 427 are radial blind bores with a bore axis that is perpendicular to the longitudinal axis of the dynamic body 407. Each spanner wrench hole 427 originates from the intermediate section 425 of the outer surface 421 but does not intersect the flow bore 422. In this embodiment the spanner wrench holes 427 are proximate the locating shoulder 459, aligned longitudinally, and evenly spaced circumferentially but may be spaced in any manner on the intermediate section 425 as long as access for the spanner wrench (not shown) is available.

The flow bore 422 also comprises multiple sections and is configured to receive the plunger system wear ring seal 409, plunger system wear ring 408, flow control system wear ring seal 411, and flow control system wear ring 410. The flow bore 422 is not the focus of this improvement so no further details about the flow bore 422 are necessary to understand this disclosure.

The retainer 413, shown in FIGS. 64-70, has a generally cylindrical shape. The retainer 413 comprises a front surface 428 and back surface 429 connected by an outer surface 430 and plunger bore 431. The outer surface 430 and plunger bore 431 are concentric and their cylindrical axis is the longitudinal axis of the retainer 413.

The outer surface 430 comprises a straight section 432 and a tapered section 433. The straight section 432 begins at the front surface 428 and continues along the longitudinal axis until it connects with the tapered section 433. The straight section 432 occupies approximately 60% of the outer surface 430 but may be more or less. The straight section 432 comprises a front chamfer 434 and plurality of spanner wrench holes 436.

The spanner wrench holes 436 are radial blind bores with a bore axis that is perpendicular to the longitudinal axis of the retainer 413. Each spanner wrench hole 436 originates from the straight section 432 of the outer surface 430 but does not intersect the plunger bore 431. In this embodiment the spanner wrench holes 436 are proximate the tapered section 433, aligned longitudinally, and evenly spaced circumferentially but may be spaced in any manner on the straight section 432 as long as access for the spanner wrench (not shown) is available.

The tapered section 433 comprises a lubrication port 435. The lubrication port 435 is a radial through bore connecting the tapered section 433 of the outer surface 430 to the intermediate section 440 of the plunger bore 431. The bore axis of the lubrication port 435 is perpendicular to the tapered face of the tapered section 433. The lubrication port 435 comprises a threaded section 437 adjacent the outer surface 430 configured to receive a lubrication fitting (not shown) or plug (not shown).

Figure 69:
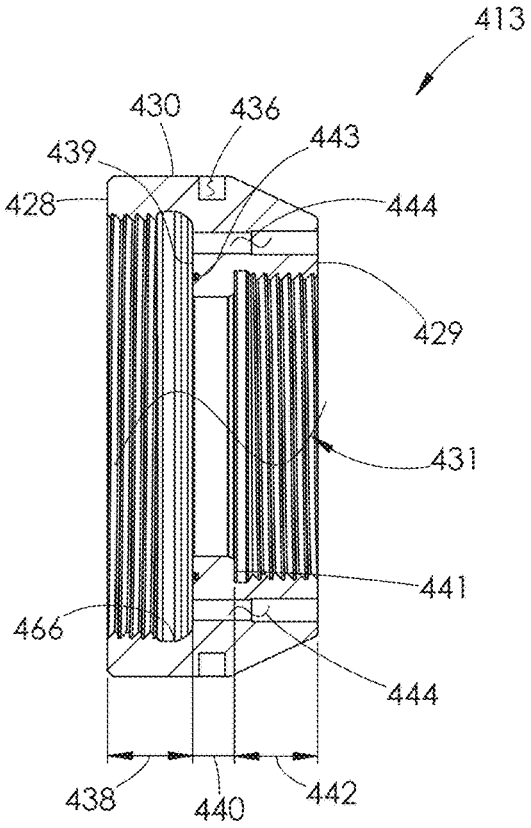
FIG. 69 is a cross-sectional view of the retainer shown in FIG. 67, taken along line Y-Y.

The plunger bore 431 comprises multiple sections, as shown in FIG. 69. Beginning at the front surface 428 and continuing along the longitudinal axis to the back surface 429 the plunger bore 431 comprises dynamic threads 438, a dynamic shoulder 439, an intermediate section 440, a packing nut shoulder 441, and packing nut threads 442. The dynamic shoulder 439 comprises a seal groove 443. The seal groove 443 is circular and concentric with the plunger bore 431. The seal groove 443 is configured to receive the retainer seal 412.

Figure 70:
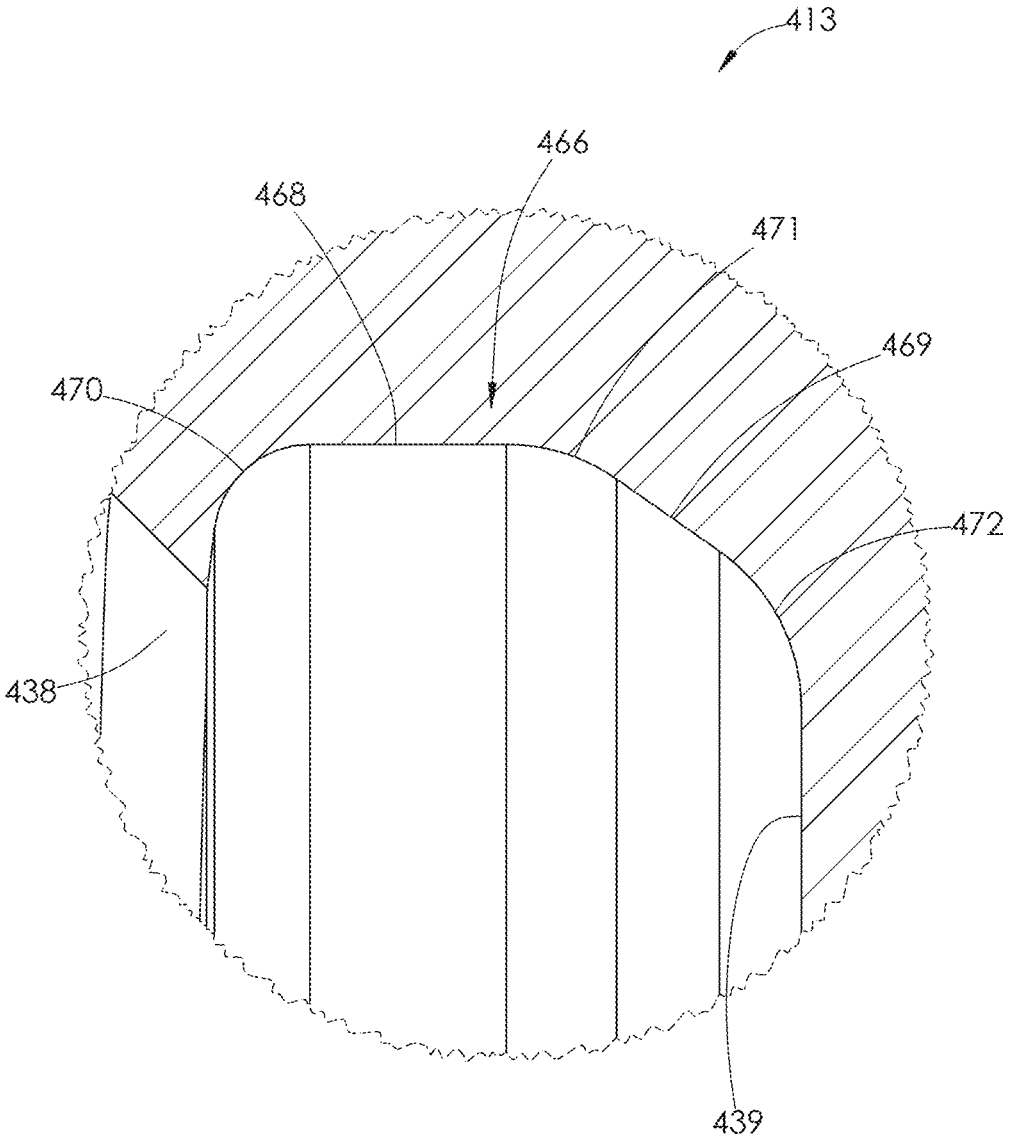
FIG. 70 is an enlarged view of area Z shown in FIG. 68.
Figure 71:
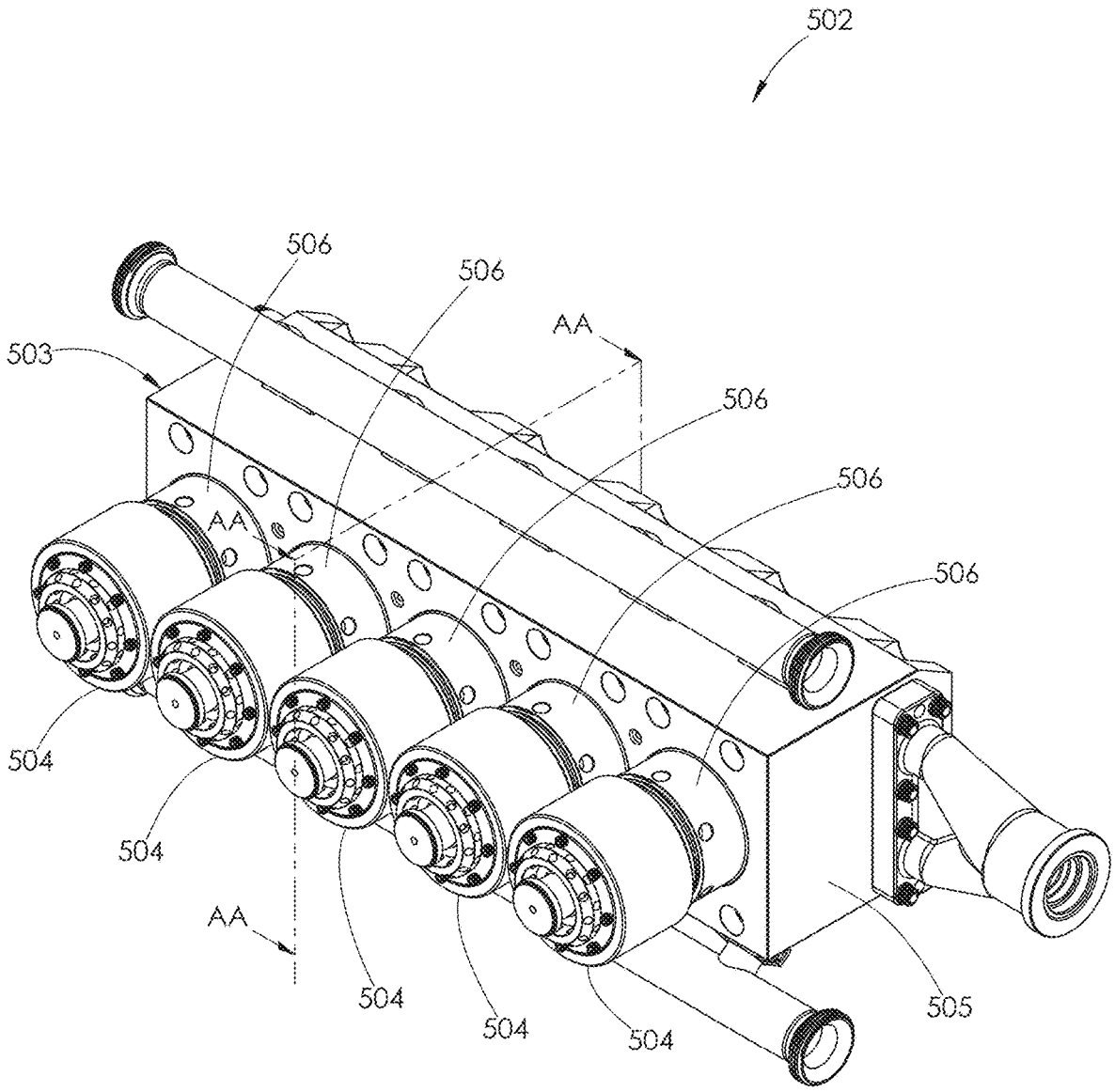
FIG. 71 is a back, top, left isometric view of another embodiment of a multi-piece fluid end.

The dynamic threads 438 comprise a thread relief 466 proximate the dynamic shoulder 439. Referring now to FIG. 70, the thread relief 466 comprises a plurality of straight sections, straight section one 468 and straight section two 469. The thread relief 466 further comprises a plurality of curved sections, curved section one 470, curved section two 471, and curved section three 472. Curved section one 470 is concave and provides a transition from the last thread of the dynamic threads 438 to straight section one 468. Straight section one 468 is parallel with the longitudinal axis of the retainer 413 and provides a transition from curved section one 470 to curved section two 471 and the ability to extend the thread relief 466 if desired. Curved section two 471 is concave and provides a transition from straight section one 468 to straight section two 469. Straight section two 469 is angled relative to the longitudinal axis and provides a transition from curved section two 471 to curved section three 472. Curved section three 472 is concave and provides a transition from straight section two 469 to the dynamic shoulder 439 of the plunger bore 431.

In this embodiment curved sections two 471 and three 472 have equal radii that are larger than the radius of curved section one 470 but the radii of the curved sections 470, 471, and 472 may be any value that still allows the geometric construction of the thread relief 466. It is also possible that straight section one 468 may be eliminated and curved section one 470 may transition directly to curved section two 471. In this embodiment straight section two 469 has an angle of approximately 35 degrees with the longitudinal axis however it may be any angle between 0 and 90 degrees. It is also contemplated that the curved sections 470, 471, and 472 may be spline curves with infinitely varying radii. If both curved section one 470 and curved section two 471 are spline curves and straight section one 468 is removed, then curved section one 470 and curved section two 471 may be considered a single curve. Also, if both curved section two 471 and curved section three 472 are spline curves and straight section two 469 is removed then curved section two 471 and curved section three 472 may be considered a single curve.

The retainer 413 further comprises a plurality of tension bolt holes 444. Each tension bolt hole 444 is a partially threaded through hole originating on the back surface 429 and terminating at the dynamic shoulder 439. The threaded portion of the tension bolt hole 444 extends from the dynamic shoulder 439 approximately half the tension bolt hole 444 length to the back surface 429 and is configured to receive a tension bolt 414. The tension bolt holes 444 are distributed evenly on a bolt circle that is concentric with the retainer 413.

Referring now to FIGS. 56-60, the assembly of a fluid end section 478 begins with the installation of a flow control system wear ring seal 411, a flow control system wear ring 410, a plunger system wear ring seal 409, and a plunger system wear ring 408 into the dynamic body 407, as shown in FIG. 58. This completes the assembly of the dynamic section 406.

The dynamic section 406 is then attached to the static section 405 by threading the static threads 424 of the outer surface 421 of the dynamic body 407 into the dynamic threads 481 of the static section 405 until the locating shoulder 459 abuts the back surface 480 of the static section 405, as shown in FIG. 58. A spanner wrench (not shown) may be used to apply the required torque using the spanner wrench holes 427 in the intermediate section 425 of the outer surface 421 of the dynamic body 407. The flow control components may now be installed in the flow bore 479 form the opposite side of the static section 405.

Next, a retainer seal 412 is installed in the seal groove 443 of the dynamic shoulder 439 of the plunger bore 431 of a retainer 413. Then, the retainer 413 is attached to a dynamic section 406 by threading the dynamic threads 438 of the plunger bore 431 of the retainer 413 onto the retainer threads 426 of the outer surface 421 of the dynamic body 407. A spanner wrench (not shown) may be used to apply the required torque using the spanner wrench holes 436 in the straight section 432 of the outer surface 430 of the retainer 413.

The plurality of tension bolts 414 are then inserted, on a one-to-one basis, into the tension bolt holes 444 from the back surface 429 of the retainer 413 and threaded into the threaded section of the tension bolt holes 444 until the front surface of each tension bolt 414 contacts the back surface 420 of the dynamic body 407, as shown in FIG. 59. Once contact is made by all tension bolts 414 the tension bolts 414 may be torqued to specification in a piecewise manner.

Next, the packing 415 is inserted into the dynamic section 406 and the intermediate section 440 of the plunger bore 431 of the retainer 413. Next, the plunger seal 417 is installed in the packing nut 416 and the packing nut 416 is threaded into the packing nut threads 442 of the plunger bore 431 of the retainer 413. Next, the plunger 418 is installed in the packing nut 416, packing 415, and dynamic section 406. Lastly, the packing nut 416 is torqued to specification.

In operation the tension bolts 414 place the threaded joint formed by the retainer threads 426 of the dynamic body 407 and the dynamic threads 438 of the retainer 413 in tension providing an additional tensile load above that produced by the torquing of the threads together. This additional tensile load reduces the magnitude of cyclic loading usually produced in the joint by the large pressure fluctuations in the dynamic section 406. This reduction in the magnitude of cyclic loading reduces thread to thread fretting and other issues inherent in the previously encountered full, or nearly full, cyclic loading of the threads. Also, the retainer seal 412 protects the retainer threads 426 and dynamic threads 438 from contamination when the packing 415 fails. These benefits result in easier and quicker removal of the retainer 413 for maintenance or replacement when necessary. Also during operation, the thread relief 466 reduces stress in the retainer 413 at the transition from the dynamic threads 438 to the dynamic shoulder 439.

Figure 72:
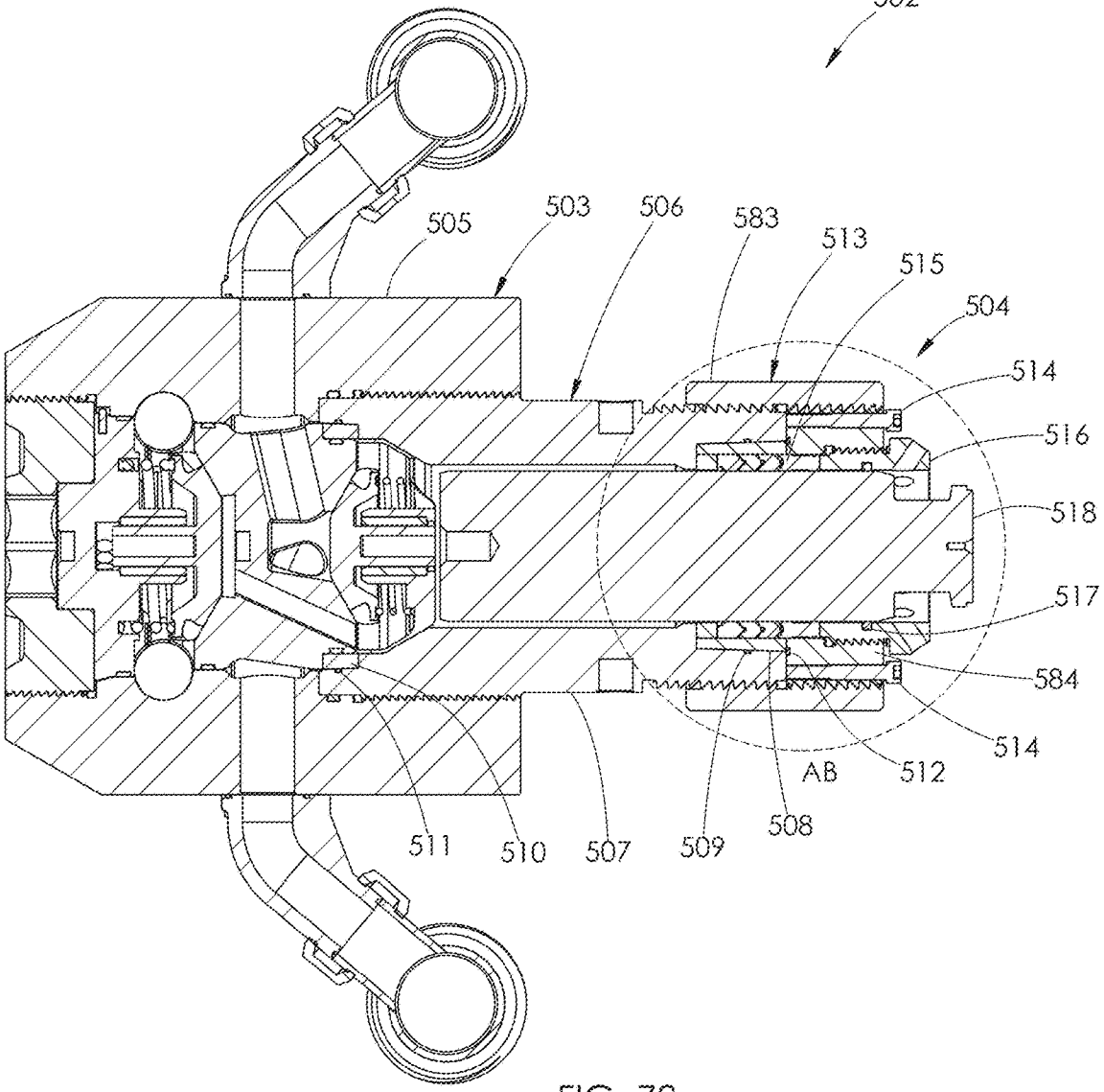
FIG. 72 is a cross-sectional view of the multi-piece fluid end shown in FIG. 71, taken along line AA-AA.
Figure 73:
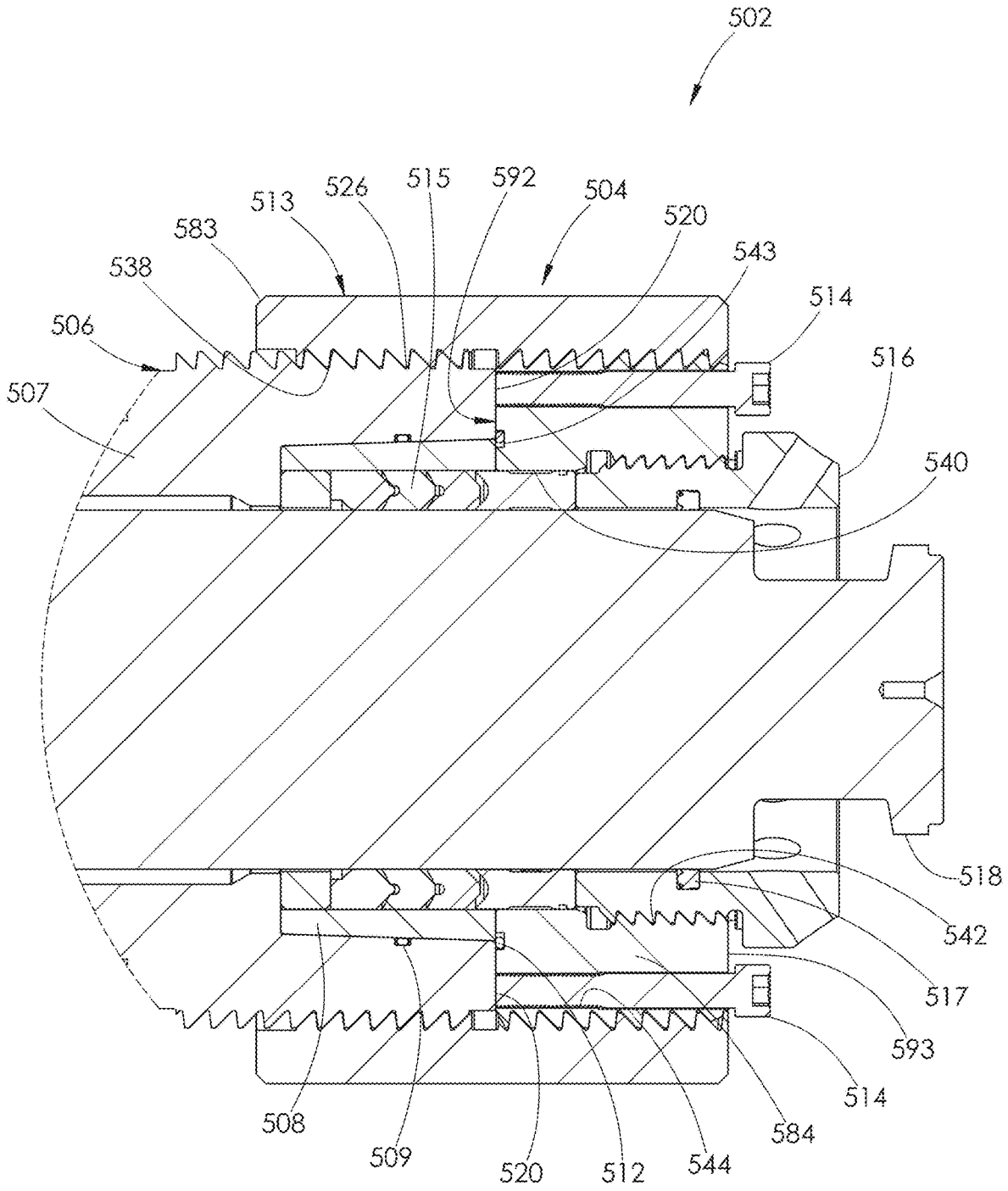
FIG. 73 is an enlarged view of area AB shown in FIG. 72.
Figure 74:
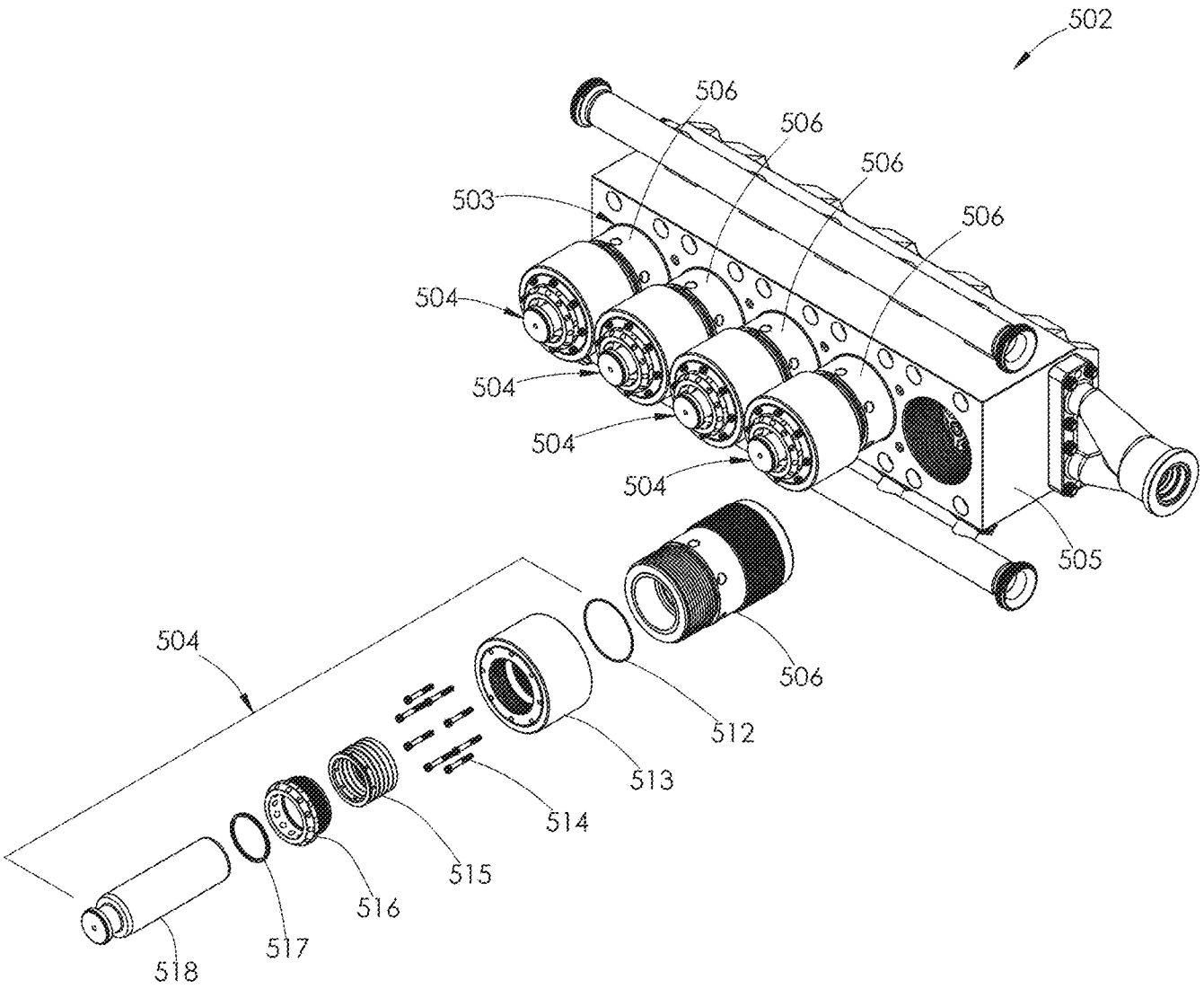
FIG. 74 is an exploded, back, top, left isometric view of the multi-piece fluid end shown in FIG. 71.

Referring now to FIGS. 71-87, another embodiment of a multi-piece fluid end 502 is shown. The multi-piece fluid end 502 comprises a fluid end body 503 and a plurality of plunger systems 504. The fluid end body 503 comprises a static section 505 and a plurality of dynamic sections 506. Each dynamic section 506 comprises a dynamic body 507, a plunger system wear ring 508, a plunger system wear ring seal 509, a flow control system wear ring 510, and a flow control system wear ring seal 511 as shown in FIG. 72. Each plunger system 504 comprises a retainer seal 512, a retainer assembly 513, a plurality of tension bolts 514, packing 515, a packing nut 516, a plunger seal 517, and a plunger 518, as shown in FIG. 73.

Figure 75:
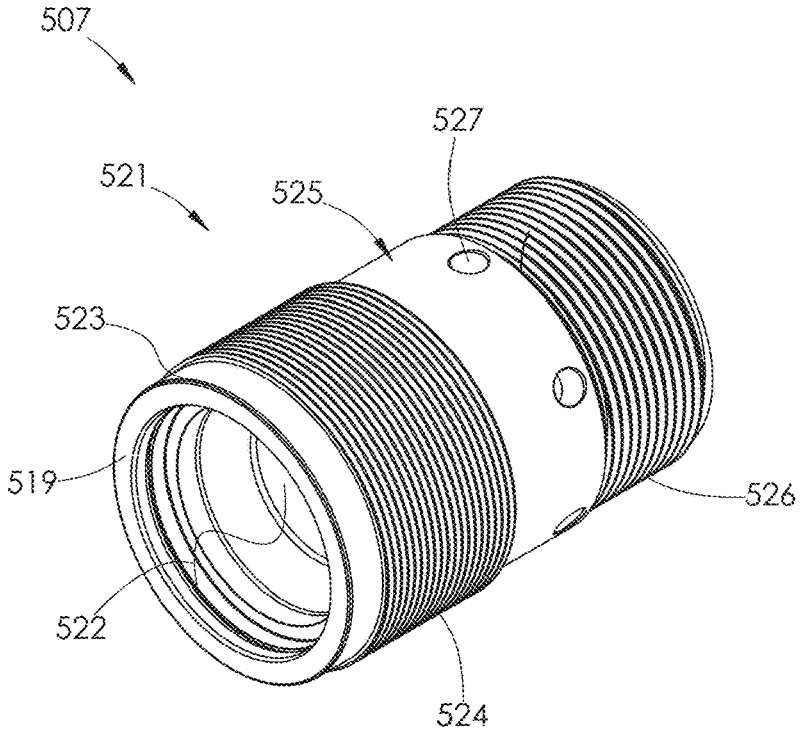
FIG. 75 is an isometric view of a dynamic body used in the multi-piece fluid end shown in FIG. 71.
Figure 76:
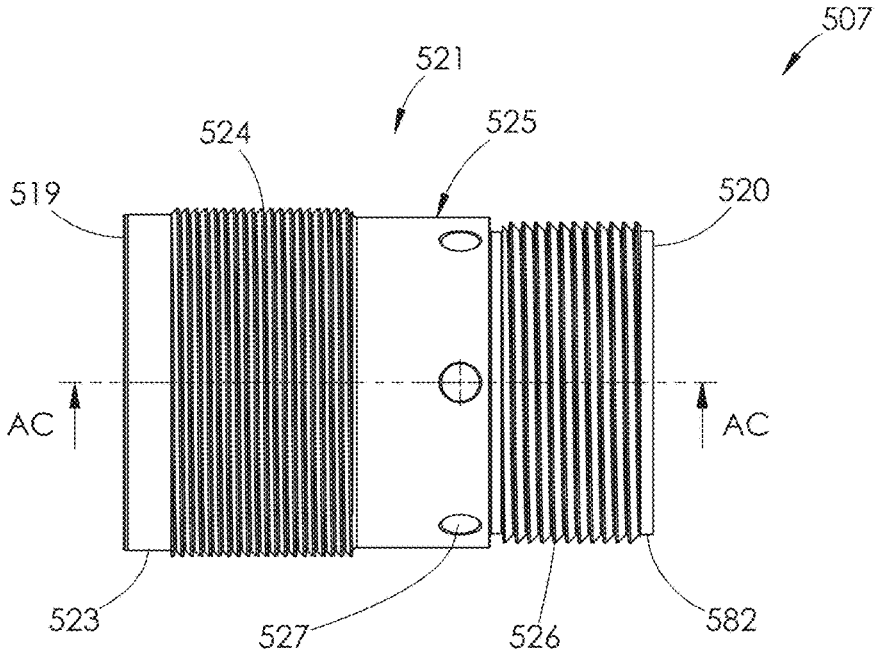
FIG. 76 is a top plan view of the dynamic body shown in FIG. 75.
Figure 77:
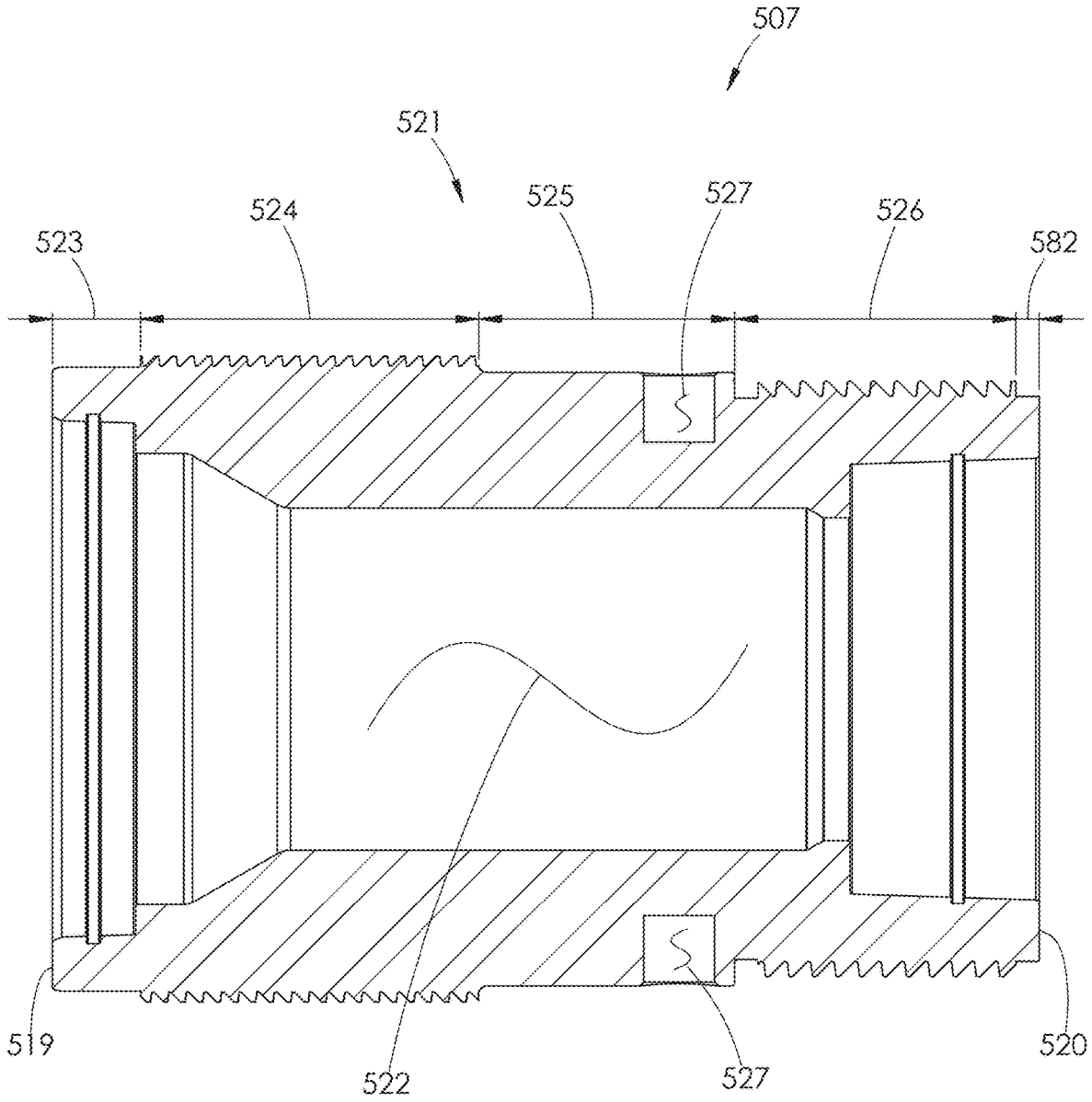
FIG. 77 is a cross-sectional view of the dynamic body shown in FIG. 76, taken along line AC-AC.
Figure 78:
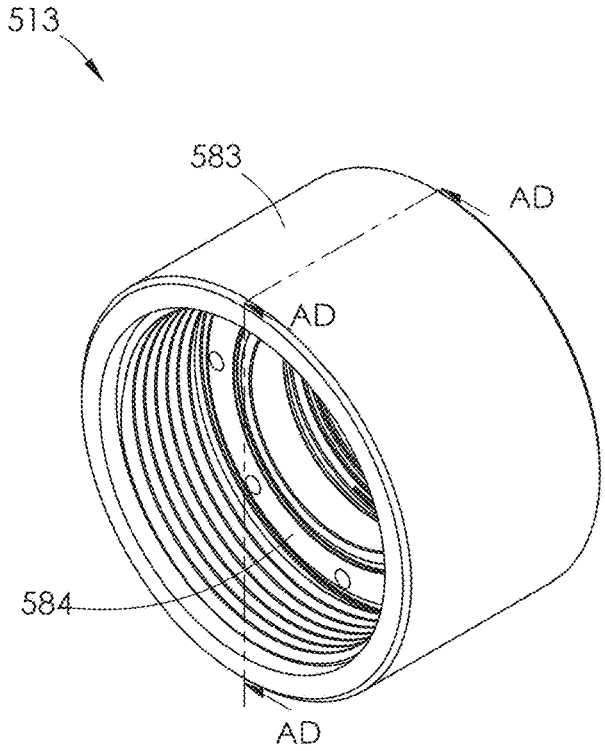
FIG. 78 is an isometric view of a retainer assembly used in the multi-piece fluid end shown in FIG. 71.
Figure 79:
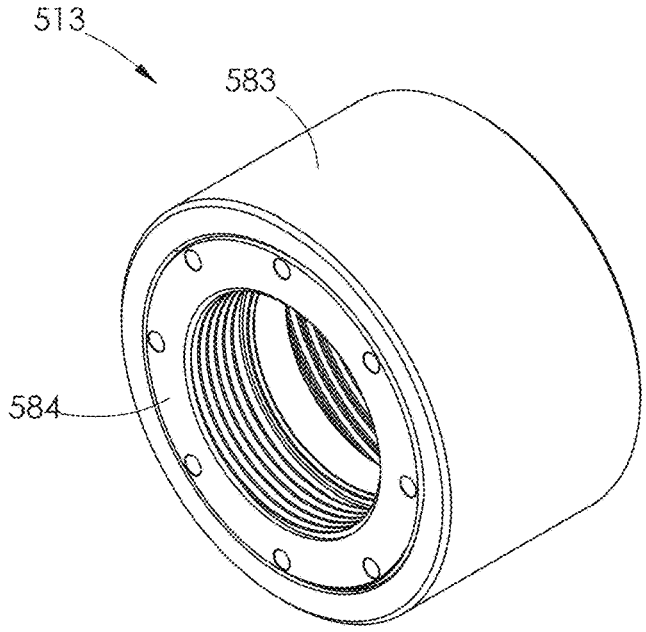
FIG. 79 is a back, top, left isometric view of the retainer assembly shown in FIG. 78.
Figure 80:
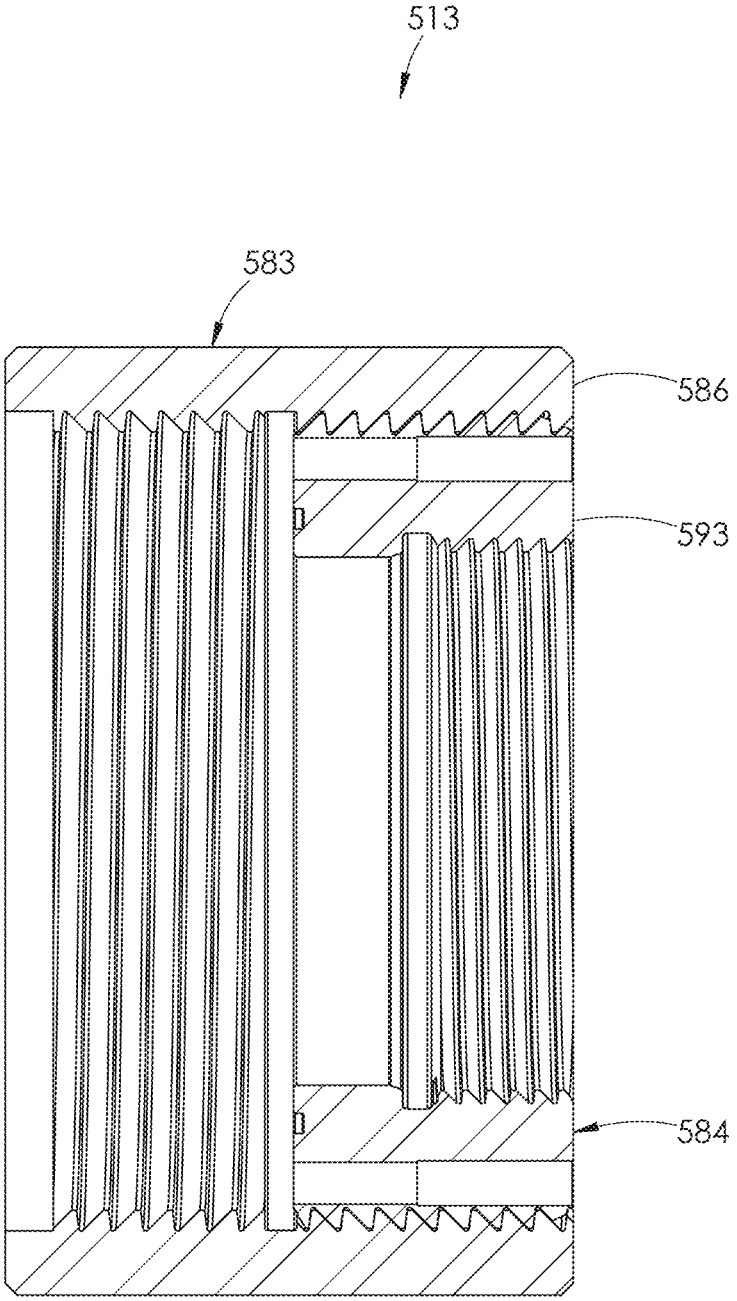
FIG. 80 is a cross-sectional view of the retainer assembly shown in FIG. 78, taken along line AD-AD.

The dynamic body 507, shown in FIGS. 75-77, has a cylindrical shape. The dynamic body 507 comprises opposing front 519 and back 520 surfaces connected by an outer surface 521 and a flow bore 522. The outer surface 521 and flow bore 522 are concentric and their cylindrical axis is the longitudinal axis of the dynamic body 507.

The outer surface 521, as shown in FIG. 77, comprises multiple concentric sections. Beginning at the front surface 519 of the dynamic body 507 and continuing along the longitudinal axis to the back surface 520 the outer surface 521 comprises a static seal section 523, static threads 524, intermediate section 525, retainer threads 526, and a pilot section 582. The intermediate section 525 comprises a plurality of spanner wrench holes 527. The spanner wrench holes 527 are radial blind bores with a bore axis that is perpendicular to the longitudinal axis of the dynamic body 507. Each spanner wrench hole 527 originates from the intermediate section 525 of the outer surface 521 but does not intersect the flow bore 522. In this embodiment the spanner wrench holes 527 are proximate the retainer threads 526, aligned longitudinally, and evenly spaced circumferentially but may be spaced in any manner on the intermediate section 525 as long as access for the spanner wrench (not shown) is available.

The flow bore 522 also comprises multiple sections and is configured to receive the plunger system wear ring seal 509, plunger system wear ring 508, flow control system wear ring seal 511, and flow control system wear ring 510. The flow bore 522 is not the focus of this improvement so no further details about the flow bore 522 are necessary to understand this disclosure.

Figure 82:
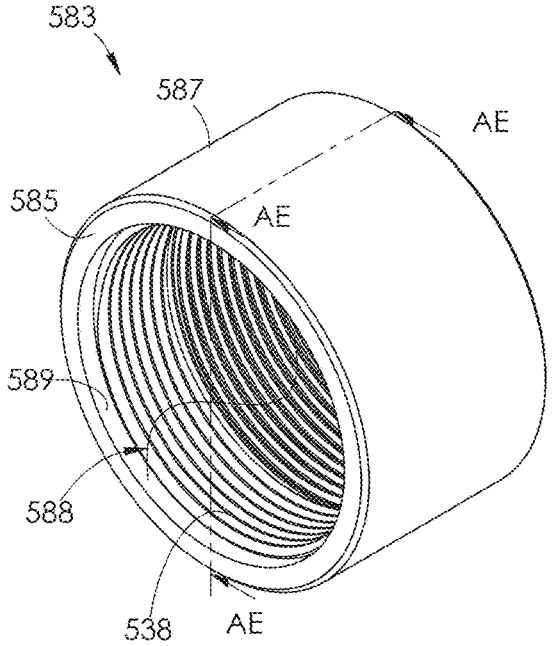
FIG. 82 is an isometric view of a coupling used in the retainer assembly shown in FIG. 78.
Figure 83:
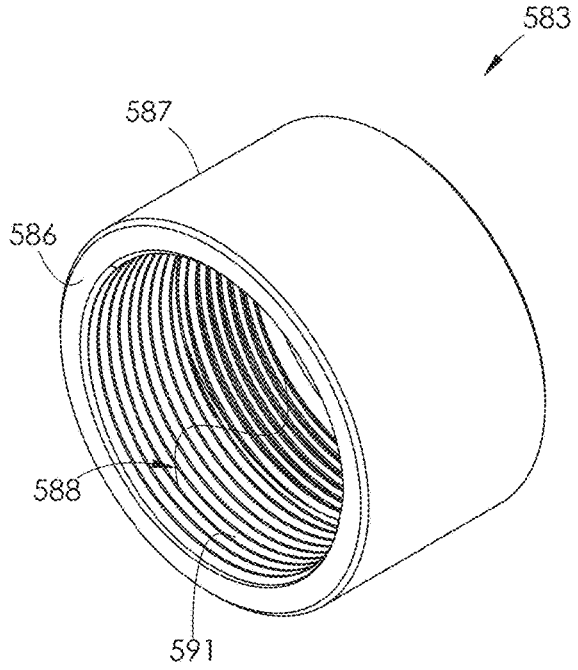
FIG. 83 is a back, top, left isometric view of the coupling shown in FIG. 82.
Figure 84:
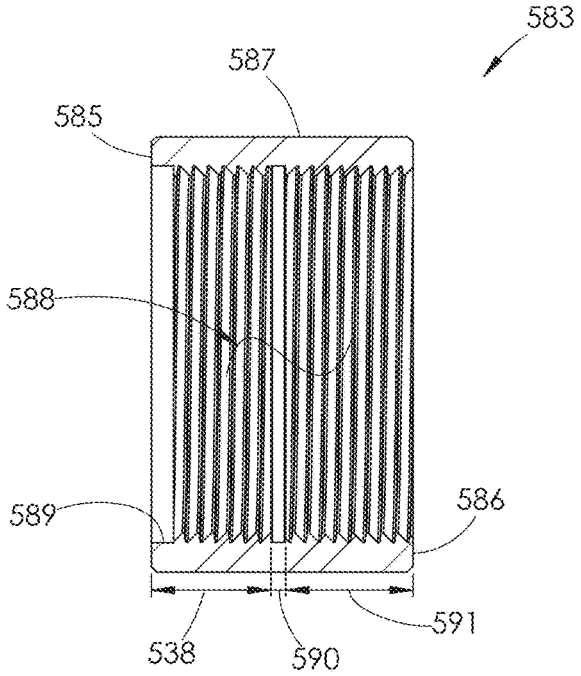
FIG. 84 is a cross-sectional view of the coupling shown in FIG. 82, taken along line AE-AE.

The retainer assembly 513, shown in FIGS. 78-81 comprises a coupling 583 and a packing nut retainer 584. The coupling 583, shown in FIGS. 82-84, is cylindrical and comprises a front surface 585 and back surface 586 connected by an outer surface 587 and central bore 588. The outer surface 587 and central bore 588 are concentric and their cylindrical axes are the longitudinal axis of the coupling 583.

The central bore 588, shown in FIG. 84, comprises multiple sections. Beginning at the front surface 585 and continuing along the longitudinal axis to the back surface 586 the central bore 588 comprises a pilot section 589, dynamic threads 538, a center relief section 590, and packing nut retainer threads 591. The center relief section 590 shown is straight but may be similar to thread relief 366.

Figure 85:
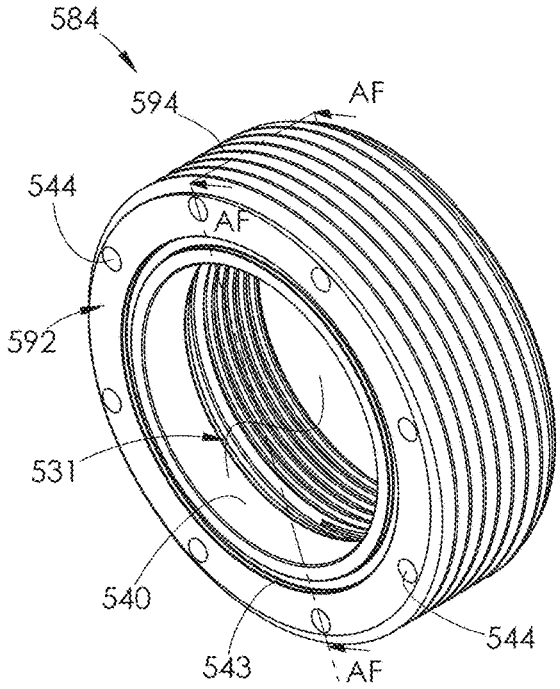
FIG. 85 is an isometric view of a packing nut retainer used in the retainer assembly shown in FIG. 78.
Figure 86:
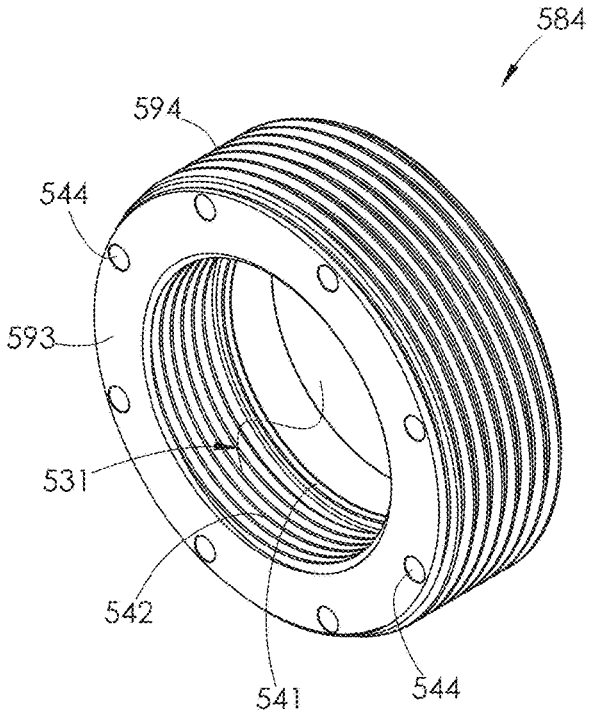
FIG. 86 is a back, top, left isometric view of the packing nut retainer shown in FIG. 85.
Figure 87:
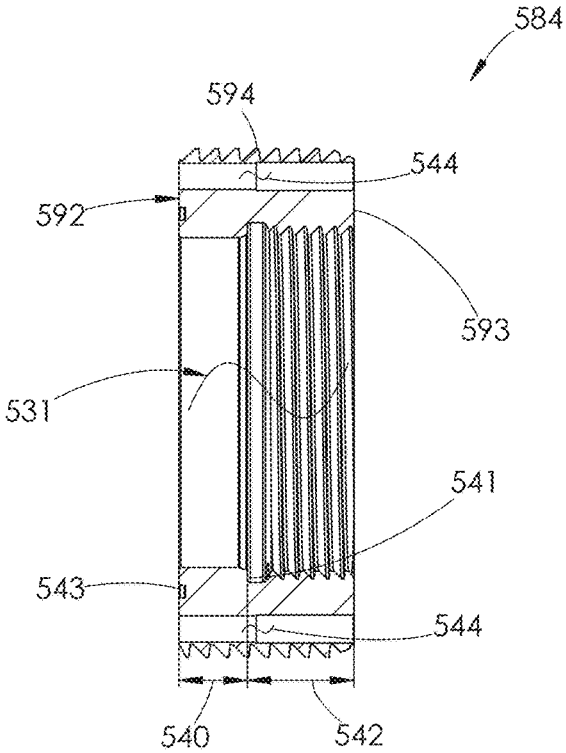
FIG. 87 is a cross-sectional view of the packing nut retainer shown in FIG. 85, taken along line AF-AF.
Figure 88:
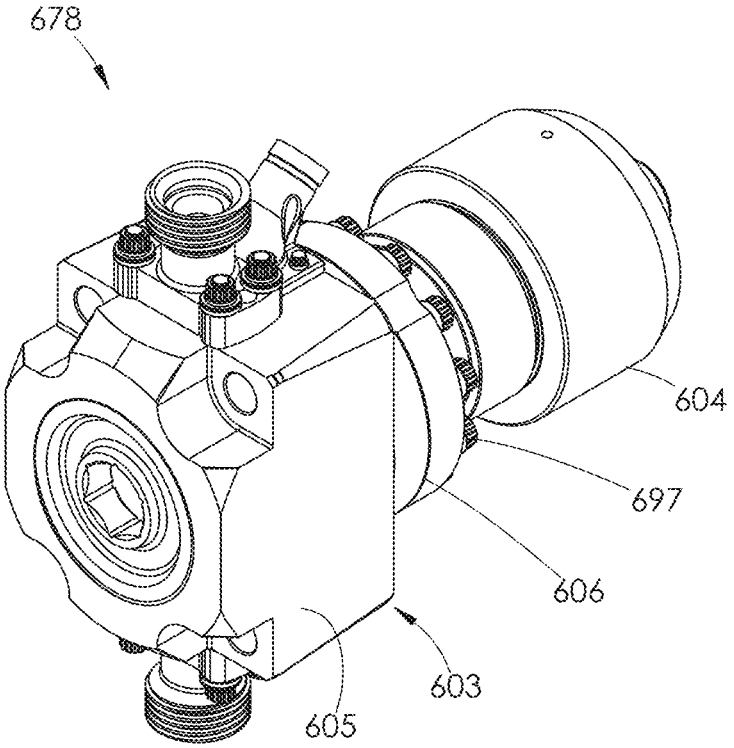
FIG. 88 is an isometric view of another embodiment of a fluid end section that may be used in the fluid end shown in FIG. 55.

The packing nut retainer 584, shown in FIGS. 85-87, is cylindrical and comprises a front surface 592 and back surface 593 connected by a threaded outer surface 594 and plunger bore 531. The threaded outer surface 594 and plunger bore 531 are concentric and their cylindrical axes are the longitudinal axis of the packing nut retainer 584.

The front surface 592 comprises a seal groove 543. The seal groove 543 is circular and concentric with the plunger bore 531. The seal groove 543 is configured to receive the retainer seal 512.

The plunger bore 531 comprises multiple sections. Beginning at the front surface 592 and continuing along the longitudinal axis to the back surface 593 the plunger bore 531 comprises a packing section 540, a packing nut shoulder 541 and packing nut threads 542.

The packing nut retainer 584 further comprises a plurality of tension bolt holes 544. Each tension bolt hole 544 is a partially threaded through hole connecting the front 592 and back 593 surfaces. The threaded portion of the tension bolt hole 544 extends from the front surface 592 approximately half the tension bolt hole 544 length to the back surface 593 and is configured to receive a tension bolt 514. The tension bolt holes 544 are distributed evenly on a bolt circle that is concentric with the retainer assembly 513.

Referring now to FIGS. 72-74 and 81, the assembly of the multi-piece fluid end 502 begins with the installation of a flow control system wear ring seal 511, a flow control system wear ring 510, a plunger system wear ring seal 509, and a plunger system wear ring 508 into each dynamic body 507 completing the assembly of the dynamic sections 506.

Each dynamic section 506 is then attached to the static section 505 by threading the static threads 524 of the outer surface 521 of the dynamic body 507 into the matching threads of the static section 505. A spanner wrench (not shown) may be used to apply the required torque using the spanner wrench holes 527 in the intermediate section 525 of the outer surface 521 of the dynamic body 507. The flow control components are then inserted in the static section 505 from the opposite side.

Figure 81:
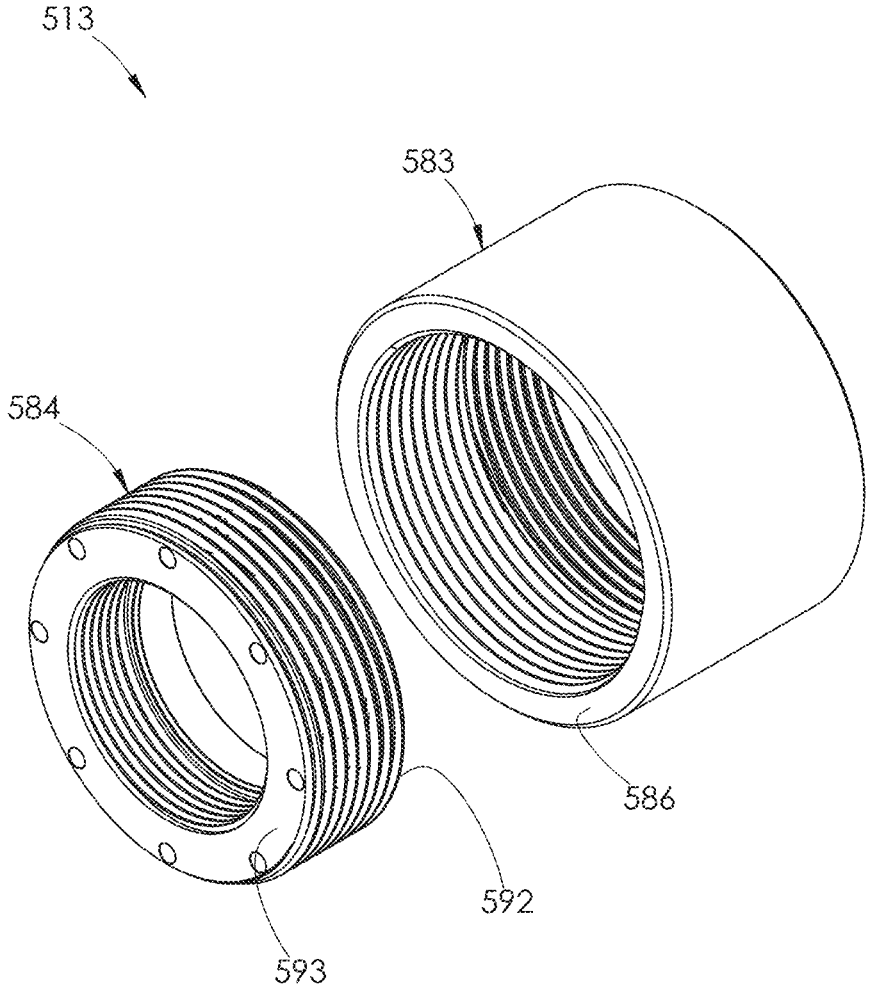
FIG. 81 is an exploded, back, top, left isometric view of the retainer assembly shown in FIG. 78.

Referring now to FIG. 81, the retainer assembly 513 is assembled by first orienting the front surface 592 of the packing nut retainer 584 to face the back surface 586 of the coupling 583. Second, the coupling 583 and packing nut retainer 584 should be aligned concentrically. Third, the packing nut retainer 584 is threaded into the coupling 583 until the back surface 593 of the packing nut retainer 584 is flush with the back surface 586 of the coupling 583.

Referring again to FIG. 73, for each dynamic section 506, a retainer seal 512 is installed in the seal groove 543 of the front surface 592 of the packing nut retainer 584. Then, the retainer assembly 513 is attached to a dynamic section 506 by threading the dynamic threads 538 of the coupling 583 onto the retainer threads 526 of the outer surface 521 of the dynamic body 507 until the front surface 592 of the packing nut retainer 584 contacts the back surface 520 of the dynamic body 507. No additional torque is applied to the retainer assembly 513 after contact. The plurality of tension bolts 514 are then inserted, on a one-to-one basis, into the tension bolt holes 544 from the back surface 593 of the packing nut retainer 584 and threaded into the threaded section of the tension bolt holes 544 until the front surface of each tension bolt 514 contacts the back surface 520 of the dynamic body 507. Once contact is made by all tension bolts 514 the tension bolts 514 may be torqued to specification in a piecewise manner.

Next, the packing 515 is inserted into the dynamic section 506 and the packing section 540 of the plunger bore 531 of the packing nut retainer 584. Next, the plunger seal 517 is installed in the packing nut 516 and the packing nut 516 is threaded into the packing nut thread 542 of the plunger bore 531 of the packing nut retainer 584. Next, the plunger 518 is installed in the packing nut 516, packing 515, and dynamic section 506. Lastly, the packing nut 516 is torqued to specification.

In operation the tension bolts 514 place the threaded joint formed by the retainer threads 526 of the dynamic body 507 and the dynamic threads 538 of the coupling 583 in tension providing a tensile load to the threads above that achievable by only torquing the threads to specification. Although as noted above, no additional torque is applied to the retainer assembly 513 after contact is made with the dynamic section 506. This tensile load reduces the magnitude of cyclic loading usually produced in the joint by the large pressure fluctuations in the dynamic section 506. This reduction in the magnitude of cyclic loading reduces thread to thread fretting and other issues inherent in the previously encountered full, or nearly full, cyclic loading of the threads. These benefits result in an easier and quicker removal of the retainer assembly 513 for maintenance or replacement when necessary. The lack of additional assembly torque after contact between the retainer assembly 513 and dynamic body 507 results in an even easier disassembly when desired. Once the tension bolts 514 are removed only a small amount of torque is needed to unthread the coupling 583 from the dynamic body 507.

Another embodiment of a fluid end section 678 is shown in FIGS. 88-110. The fluid end section 678 may be used in the fluid end 402 shown in FIGS. 54-55. The fluid end section 678 comprises a fluid end body 603 and a plunger system 604. The fluid end body 603 comprises a static section 605, a dynamic section 606, a dynamic seal 695, a plurality of studs 696, a plurality of nuts 697, and a plurality of dowel pins 698.

Each static section 605, shown in FIGS. 90-93, comprises front 699 and back 680 surfaces connected by a flow bore 679. The flow bore 679 is configured to receive flow control components.

The back surface 680 comprises seal groove 6100, a plurality of threaded holes 6101, and a plurality of dowel pin holes 6102. The seal groove 6100 is concentric with the flow bore 679 and configured to receive the dynamic seal 695. The plurality of threaded holes 6101 are blind holes configured to receive the studs 696 arranged in a circular pattern, and equally spaced around the flow bore 679. The diameter of the circular pattern is larger than the diameter of the seal groove 6100. This embodiment has twelve threaded holes 6101 but may have more or less, may not be arranged in a circular pattern, and may not be equally spaced around the flow bore 679. The dowel pin holes 6102 are blind holes configured to receive dowel pins 698. In this embodiment there are two dowel pin holes 6102 diametrically opposed on the transverse plane of the static section 605 at approximately the same diameter as the circular pattern of the threaded holes 6101 but spaced between them. There may be more or less dowel pin holes 6102 spaced in any manner as long as they do not intersect the threaded holes 6101.

Figure 93:
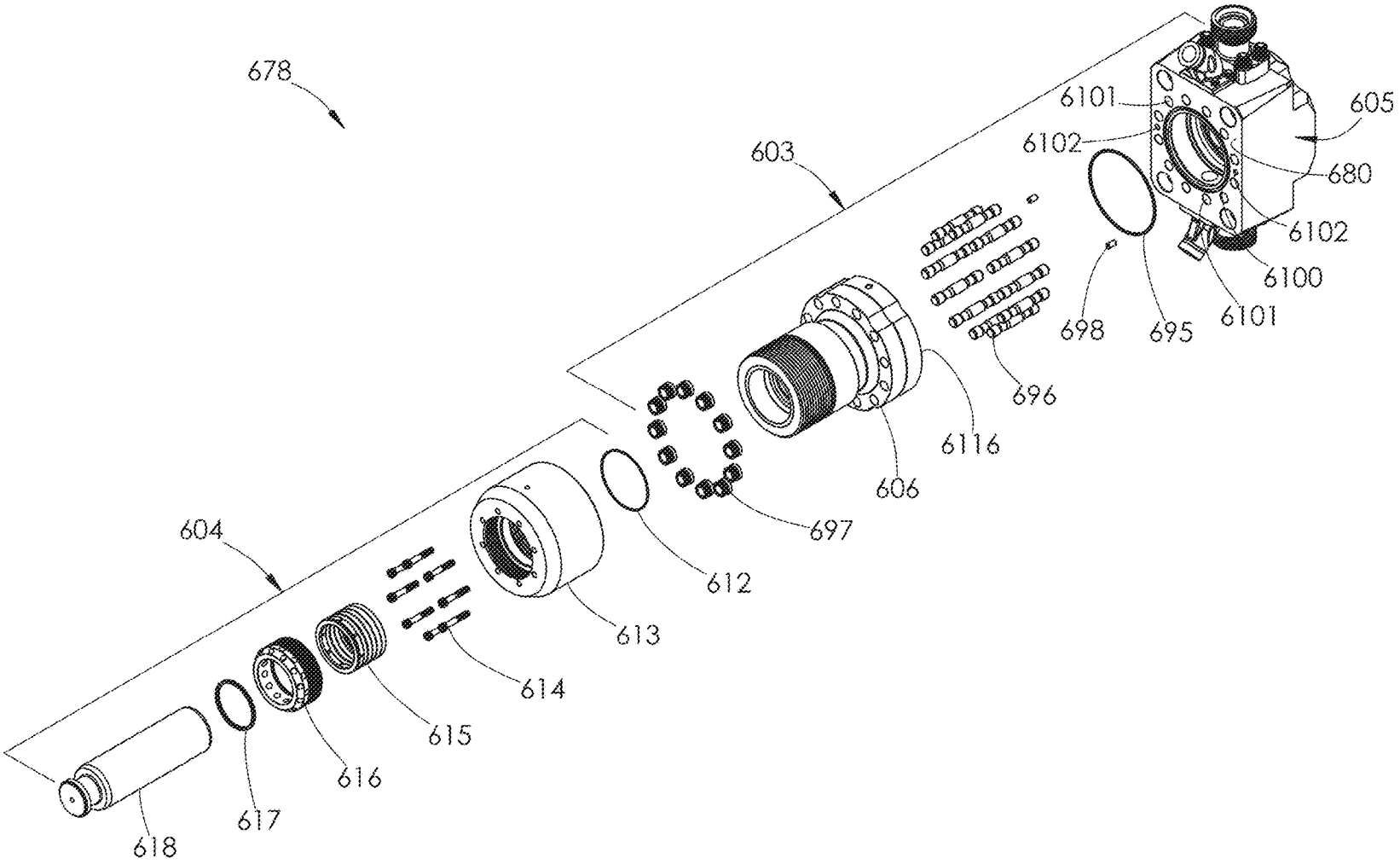
FIG. 93 is an exploded, back, top, left isometric view of the fluid end section shown in FIG. 88.
Figure 94:
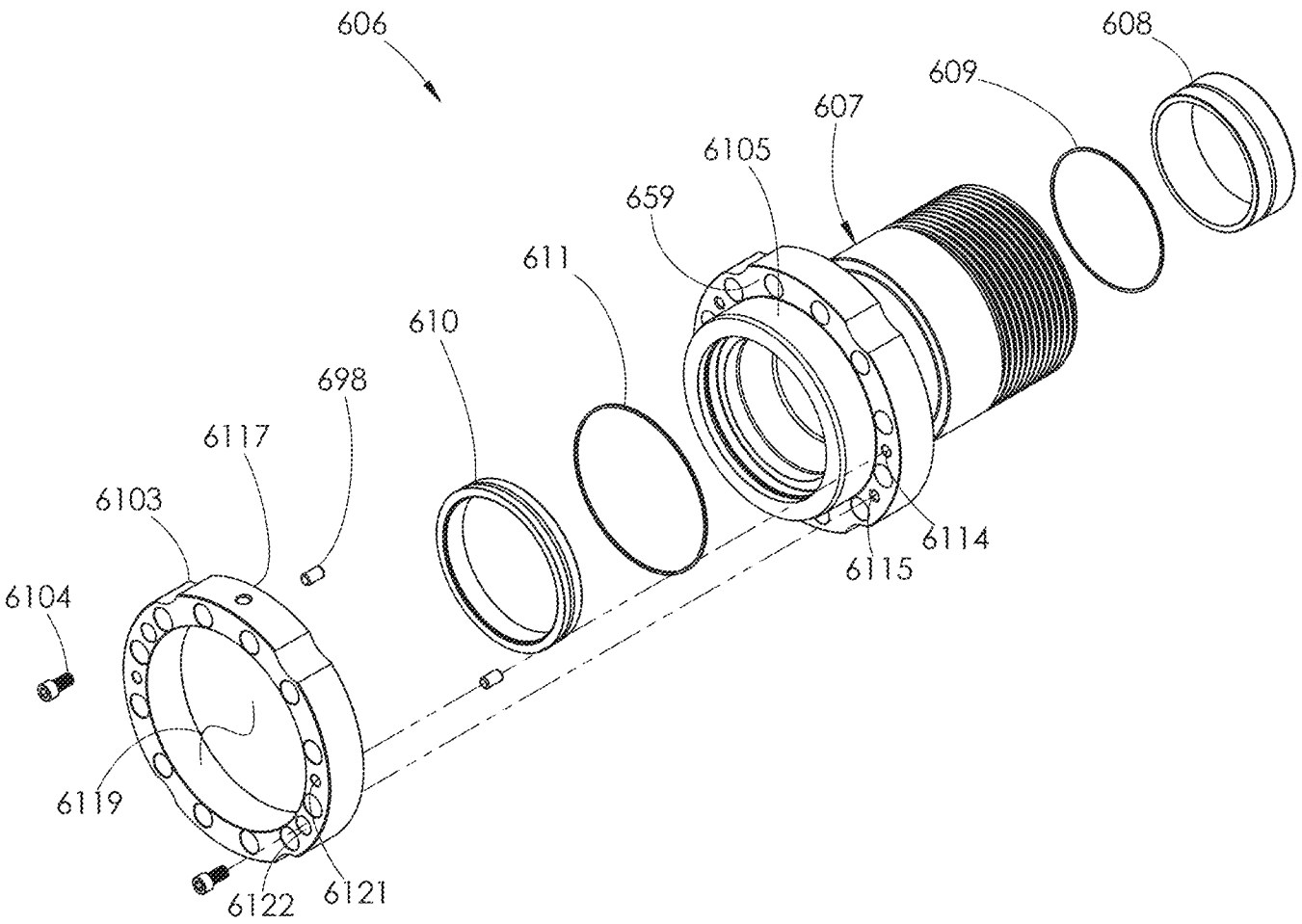
FIG. 94 is an exploded isometric view of the dynamic section shown in FIG. 93.

Each dynamic section 606, shown in FIG. 94, comprises a dynamic body 607, a plunger system wear ring 608, a plunger system wear ring seal 609, a flow control system wear ring 610, a flow control system wear ring seal 611, a spacer sleeve 6103, a plurality of dowel pins 698, and a plurality of screws 6104. Each plunger system 604, shown in FIG. 93, comprises a retainer seal 612, a retainer 613, a plurality of tension bolts 614, packing 615, a packing nut 616, a plunger seal 617, and a plunger 618.

Figure 95:
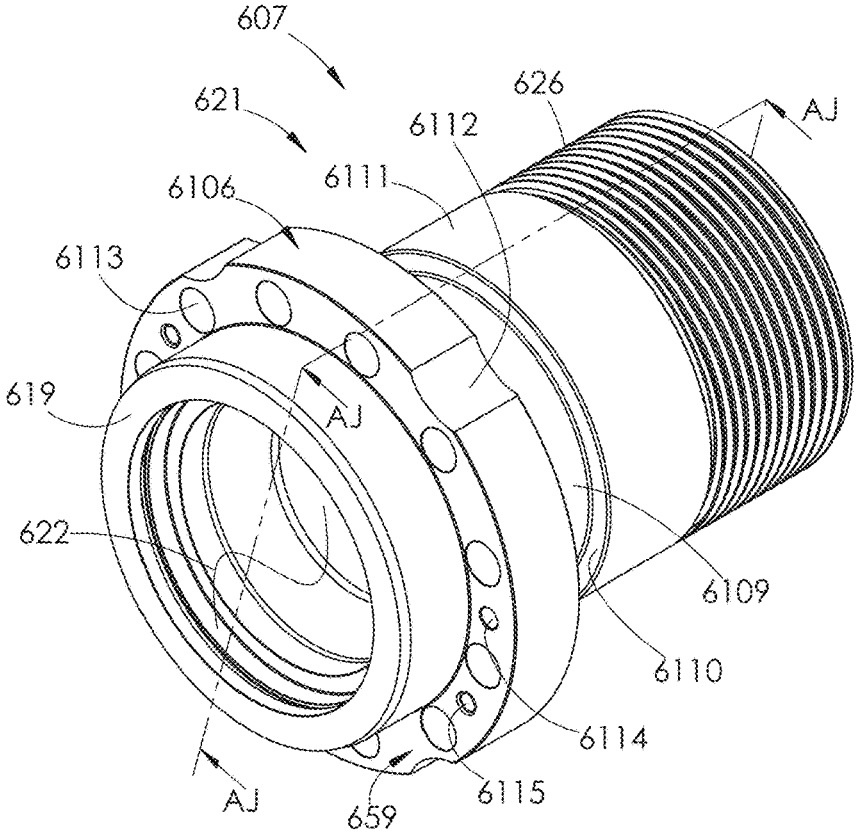
FIG. 95 is an isometric view of the dynamic body used in the dynamic section shown in FIG. 88.
Figure 96:
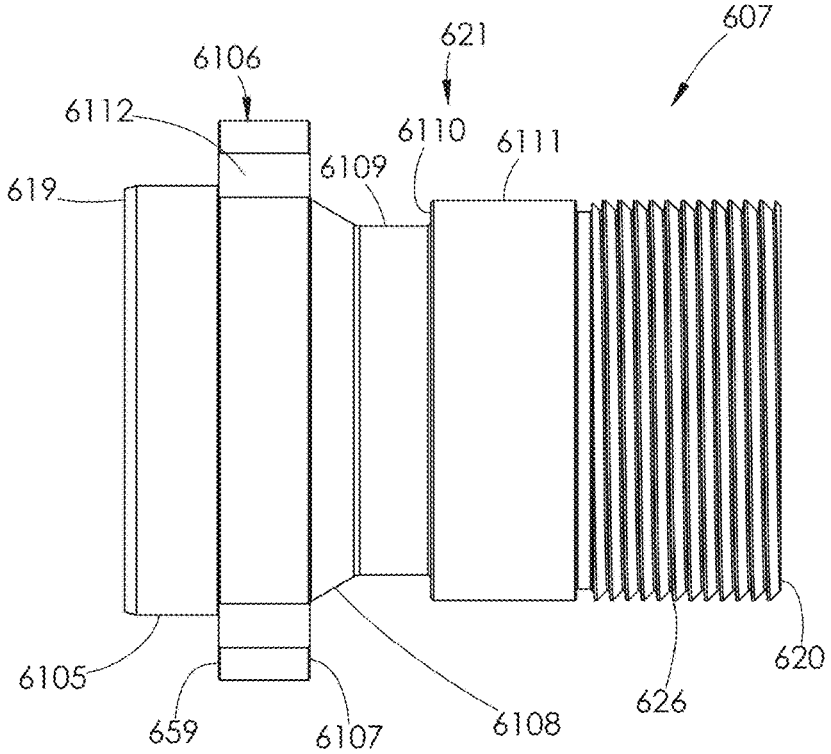
FIG. 96 is a top plan view of the dynamic body shown in FIG. 95.
Figure 97:
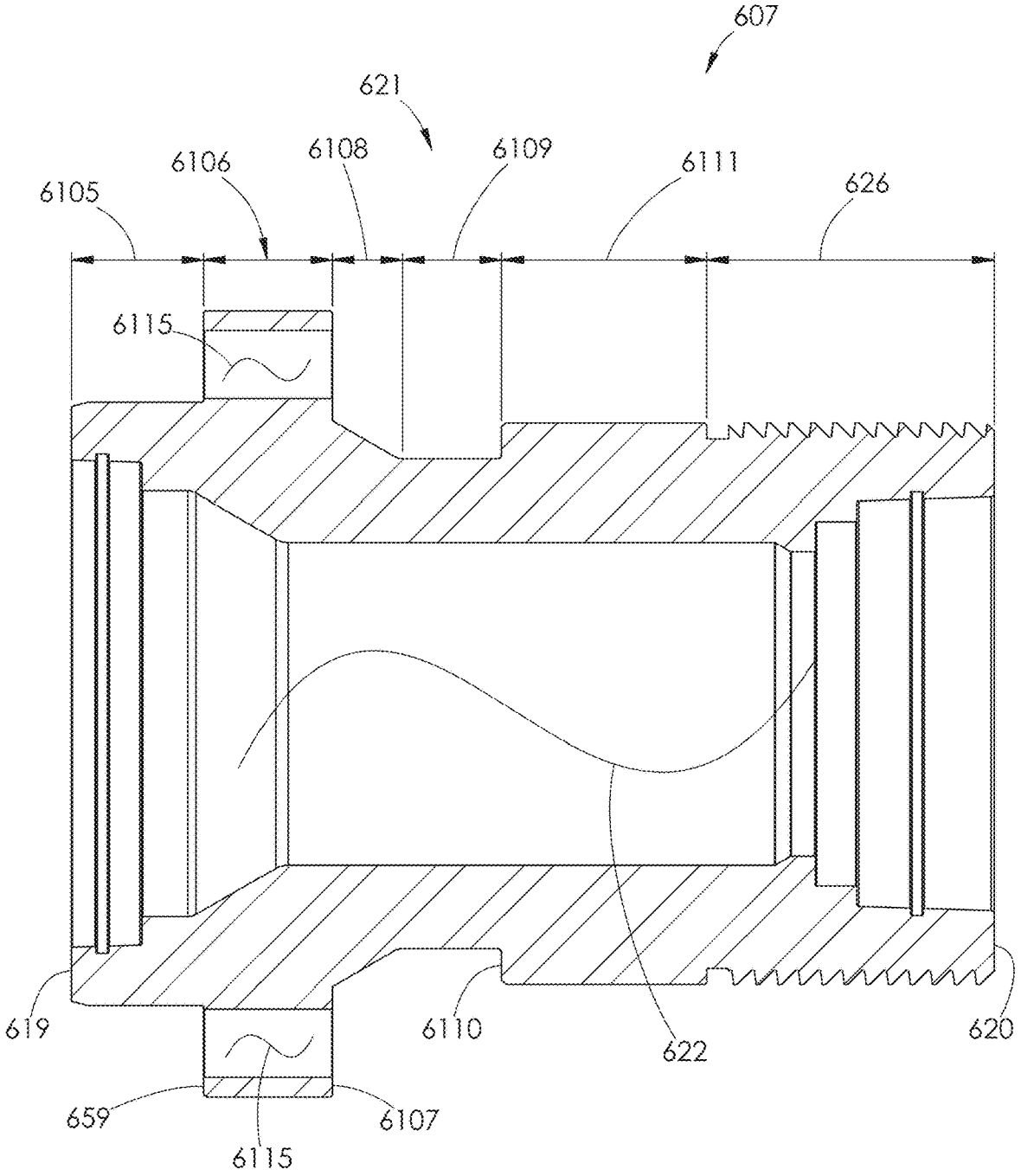
FIG. 97 is a cross-sectional view of the dynamic body shown in FIG. 95, taken along line AJ-AJ.
Figure 98:
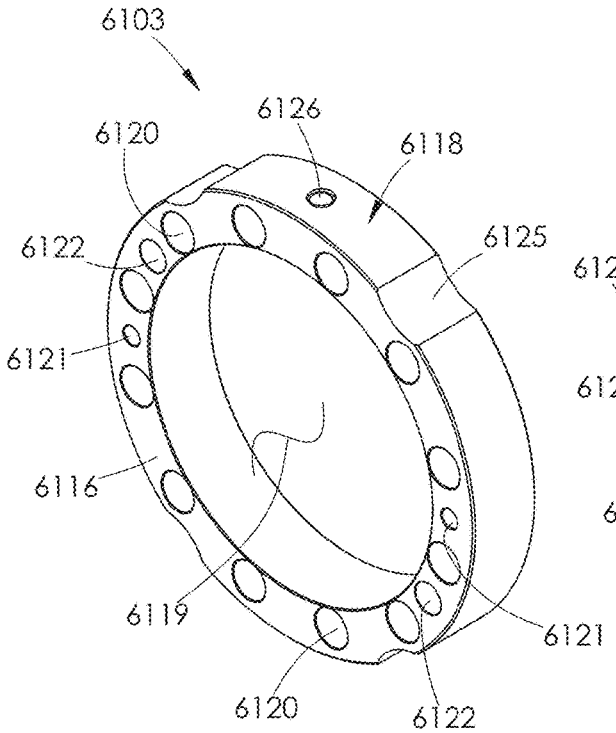
FIG. 98 is an isometric view of the spacer sleeve shown in FIG. 89.
Figure 99:
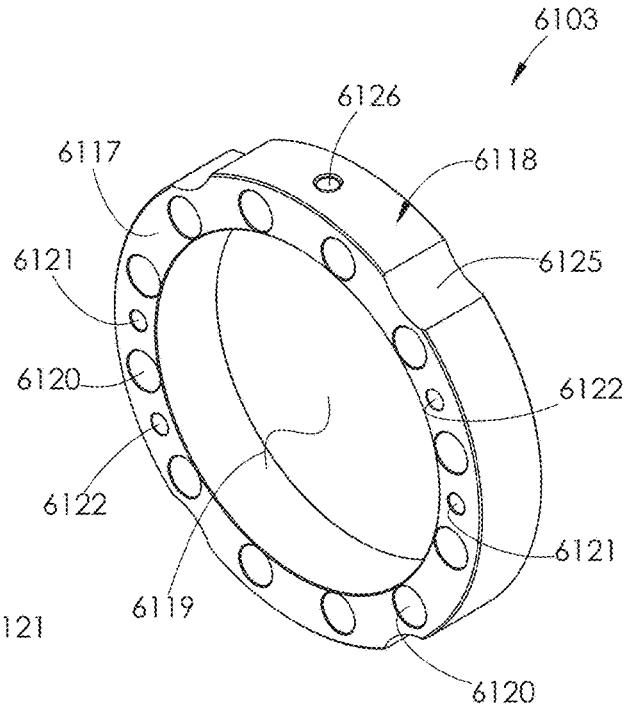
FIG. 99 is a back, top, left isometric view of the spacer sleeve shown in FIG. 98.
Figure 100:
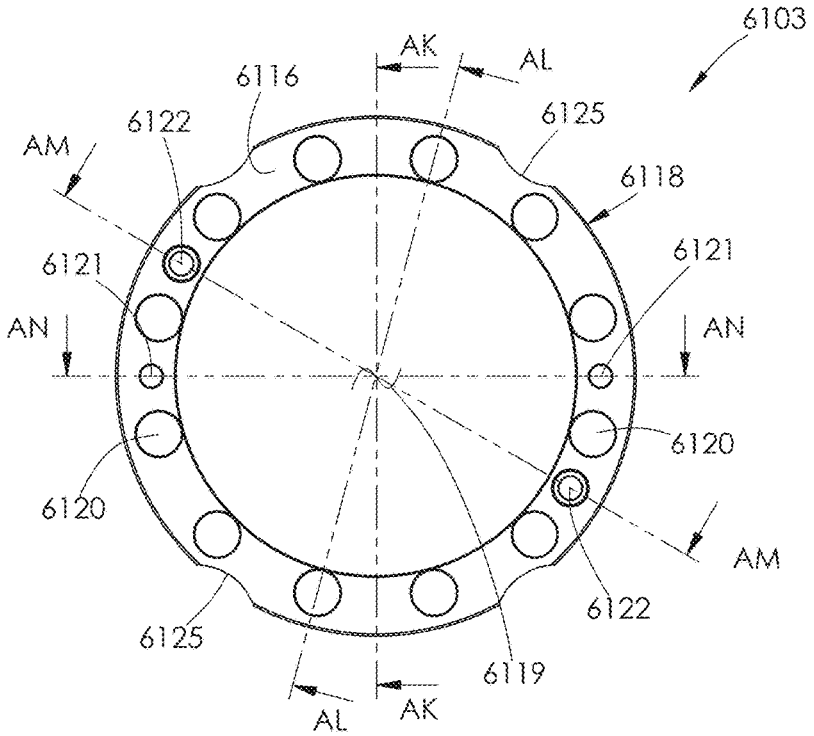
FIG. 100 is a front elevation view of the spacer sleeve shown in FIG. 98.
Figure 101:
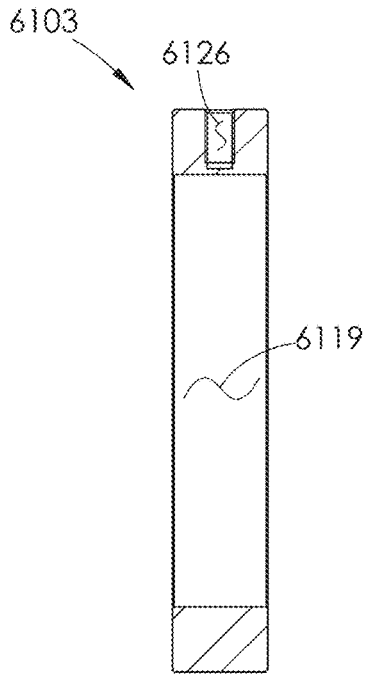
FIG. 101 is a cross-sectional view of the spacer sleeve shown in FIG. 100, taken along line AK-AK.
Figure 102:
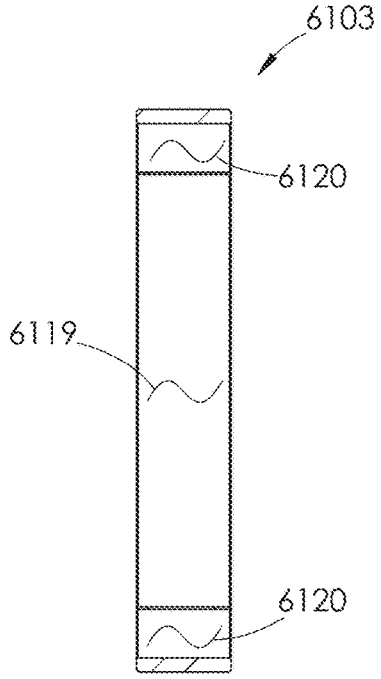
FIG. 102 is a cross-sectional view of the spacer sleeve shown in FIG. 100, taken along line AL-AL.
Figure 103:
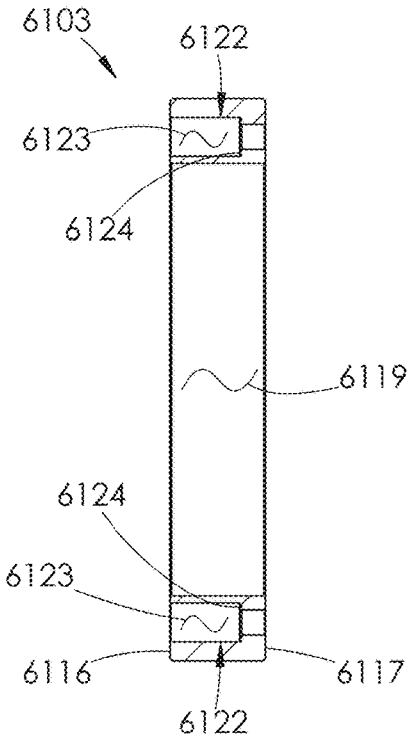
FIG. 103 is a cross-sectional view of the spacer sleeve shown in FIG. 100, taken along line AM-AM.
Figure 104:
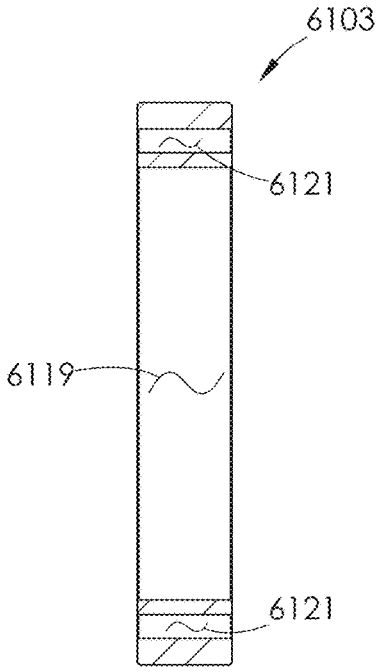
FIG. 104 is a cross-sectional view of the spacer sleeve shown in FIG. 100, taken along line AN-AN.
Figure 105:
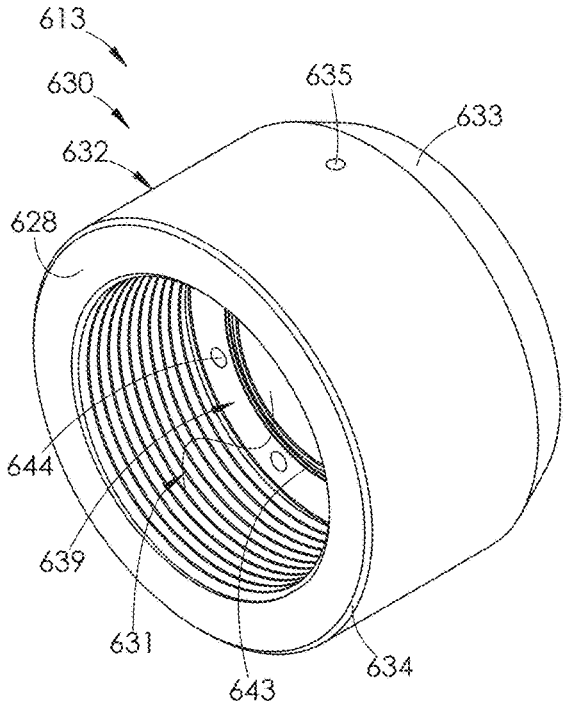
FIG. 105 is an isometric view of the retainer used in the plunger system shown in FIG. 88.
Figure 106:
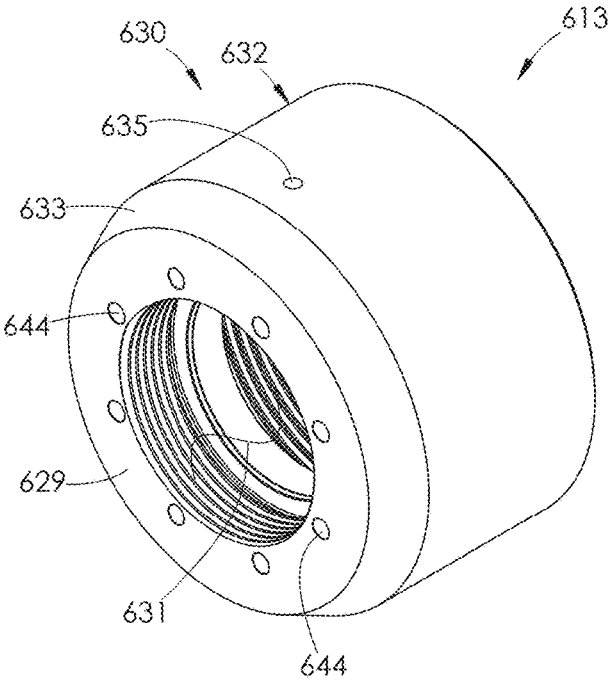
FIG. 106 is a back, top, left isometric view of the retainer shown in FIG. 105.
Figure 107:
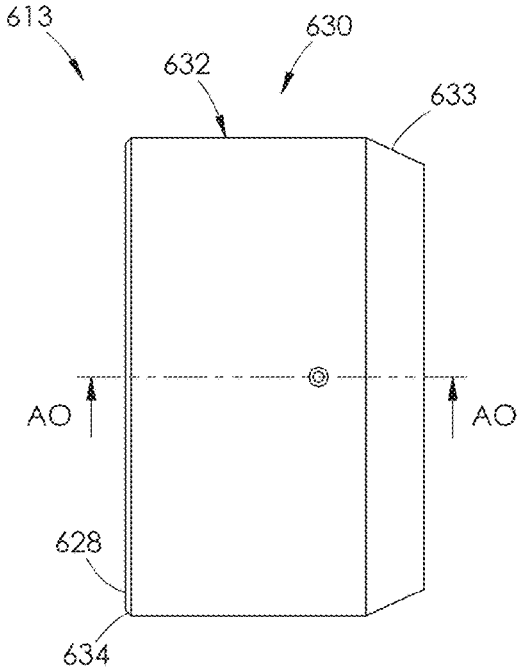
FIG. 107 is a top plan view of the retainer shown in FIG. 105.
Figure 108:
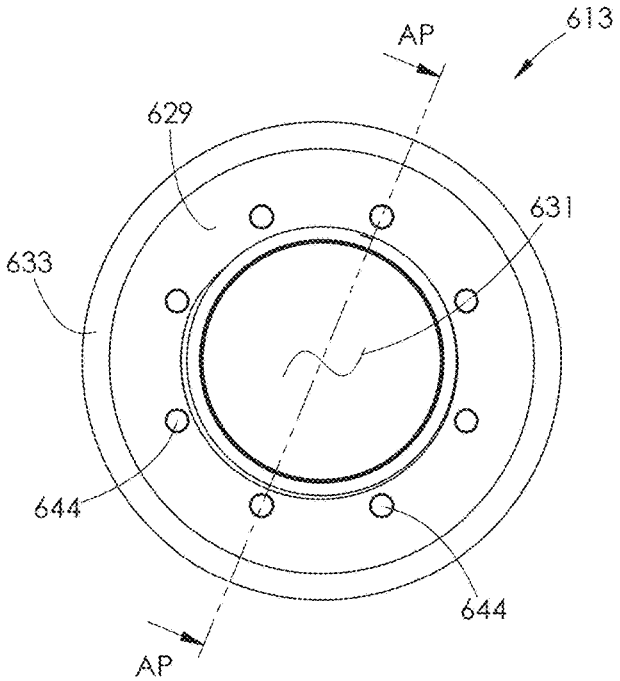
FIG. 108 is a back elevation view of the retainer shown in FIG. 105.

The dynamic body 607, shown in FIGS. 95-97, has a generally cylindrical shape. The dynamic body 607 comprises opposing front 619 and back 620 surfaces connected by an outer surface 621 and a flow bore 622. The outer surface 621 and flow bore 622 are concentric and their cylindrical axes are the longitudinal axis of the dynamic body 607.

The outer surface 621 comprises multiple sections, all the sections are concentric. Referring now to FIG. 97, beginning at the front surface 619 of the dynamic body 607 and continuing along the longitudinal axis to the back surface 620 the outer surface 621 comprises a spacer sleeve section 6105, locating shoulder 659, mounting flange 6106, mounting flange back surface 6107, transition taper 6108, wrench clearance section 6109, wrench clearance shoulder 6110, intermediate section 6111, and retainer threads 626.

The mounting flange 6106 comprises a plurality of clearance notches 6112 on the outer surface 621 and a plurality of stud holes 6113. There are four clearance notches 6112 configured to avoid interference with the stay rods and spacers when mounting the fluid end section 678 to a power end. The stud holes 6113 are through bores that connect the locating shoulder 659 to the mounting flange back surface 6107. The stud holes 6113 are configured to allow the passage of studs 696. There are the same number of stud holes 6113, with the same spacing, as the threaded holes 6101 in the back surface 680 of the static section 605.

The locating shoulder 659 comprises a plurality of dowel pin holes 6114 and a plurality of threaded holes 6115. The dowel pin holes 6114 are blind holes configured to receive dowel pins 698. There are the same number of dowel pin holes 6114, with the same spacing, as dowel pin holes 6102 in the back surface 680 of the static section 605. The threaded holes 6115 are blind holes configured to receive screws 6104. In this embodiment there are two threaded holes 6115 diametrically opposed on the same bolt circle as the stud holes 6113 and dowel pin holes 6114. The threaded holes 6115 are circumferentially spaced so that they do not intersect either the stud holes 6113 or the dowel pin holes 6114.

The flow bore 622 also comprises multiple sections and is configured to receive the plunger system wear ring seal 609, plunger system wear ring 608, flow control system wear ring seal 611, and flow control system wear ring 610. The flow bore 622 is not the focus of this improvement so no further details about the flow bore 622 are necessary to understand this disclosure.

The spacer sleeve 6103, shown in FIGS. 98-104, is ring shaped and comprises front 6116 and back 6117 surfaces connected by an outer surface 6118 and central bore 6119, a plurality of stud holes 6120, a plurality of dowel pin holes 6121, and a plurality of mounting screw holes 6122.

The stud holes 6120 are through holes connecting the front 6116 and back 6117 surfaces and are configured to allow the passage of the studs 696. There are the same number of stud holes 6120, with the same spacing, as the threaded holes 6101 in the back surface 680 of the static section 605.

The dowel pin holes 6121 are through holes connecting the front 6116 and back 6117 surfaces. Each dowel pin hole 6121 is configured to receive two dowel pins 698. One dowel pin 698 is inserted from the front surface 6116 and one from the back surface 6117. There are the same number of dowel pin holes 6121, with the same spacing, as dowel pin holes 6102 in the back surface 680 of the static section 605.

The mounting screw holes 6122 are through holes connecting the front 6116 and back 6117 surfaces and are configured to receive screws 6104. Each mounting screw hole 6122 comprises a counterbore 6123 and shoulder 6124. The counterbore 6123 originates from the front surface 6116 and is deep enough to allow the head of the screw 6104 to be completely below the front surface 6116 when assembled. There are the same number of mounting screw holes 6122, with the same spacing, as threaded holes 6115 in the mounting flange 6106 of the dynamic body 607.

The outer surface 6118 comprises a plurality of clearance notches 6125 and a lift hole 6126. The clearance notches 6125 extend from the front surface 6116 to the back surface 6117 and are shaped and positioned the same as the clearance notches 6112 of the dynamic body 607. The lift hole 6126 is a threaded blind radial bore originating from the outer surface 6118 positioned so that when fluid end section 678 is installed the threaded lift hole 6126 will be facing up.

The retainer 613, shown in FIGS. 105-110, has a generally cylindrical shape. The retainer 613 comprises a front surface 628 and back surface 629 connected by an outer surface 630 and plunger bore 631. The outer surface 630 and plunger bore 631 are concentric and their cylindrical axis is the longitudinal axis of the retainer 613.

Figure 109:
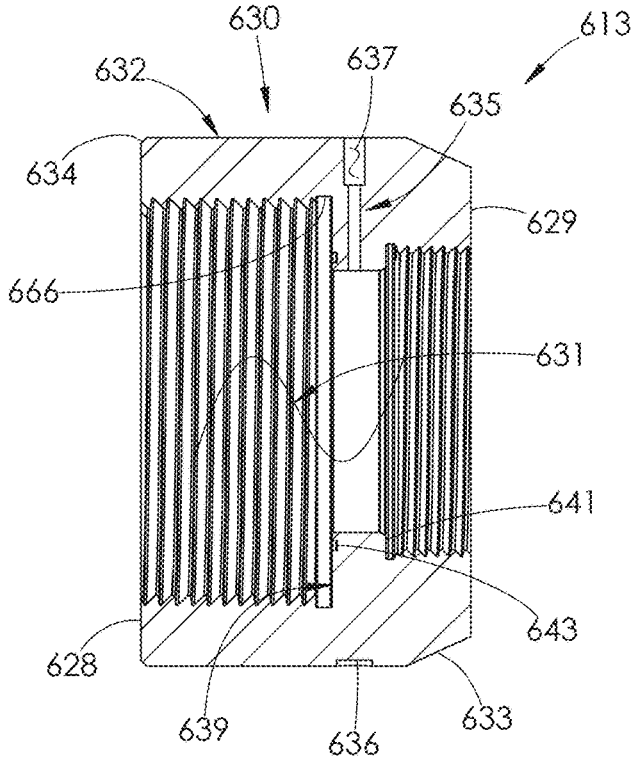
FIG. 109 is a cross-sectional view of the retainer shown in FIG. 107, taken along line AO-AO.

The outer surface 630 comprises a straight section 632 and a tapered section 633. As shown in FIG. 109, the straight section 632 begins at the front surface 628 and continues along the longitudinal axis until it connects with the tapered section 633. The straight section 632 occupies approximately 80% of the outer surface 630 but may be more or less. The straight section 632 comprises a front chamfer 634, a lubrication port 635, and a spanner wrench hole 636. The lubrication port 635 is a through bore connecting the straight section 632 of the outer surface 630 to the intermediate section 640 of the plunger bore 631. The lubrication port 635 comprises a threaded section 637 adjacent to the outer surface 630 configured to receive a lubrication fitting (not shown) or plug (not shown).

The spanner wrench hole 636 is a radial blind bore with a bore axis that is perpendicular to the longitudinal axis of the retainer 613. The spanner wrench hole 636 originates from the straight section 632 of the outer surface 630 but does not intersect the plunger bore 631. In this embodiment the spanner wrench hole 636 is proximate the tapered section 633 and aligned longitudinally with the lubrication port 635 but may be spaced in any manner on the straight section 632 as long as access for the spanner wrench (not shown) is available.

Figure 110:
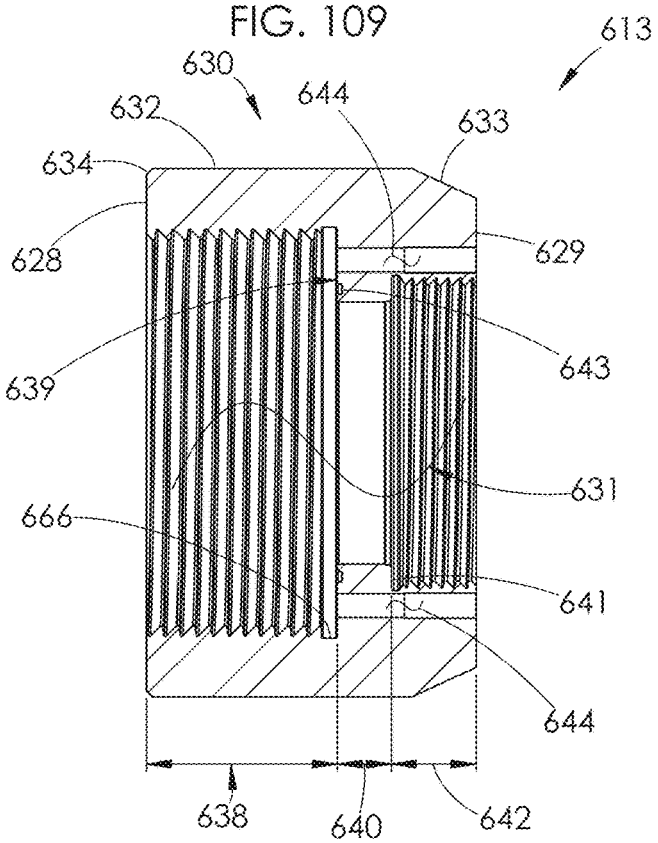
FIG. 110 is a cross-sectional view of the retainer shown in FIG. 108, taken along line AP-AP.
Figure 111:
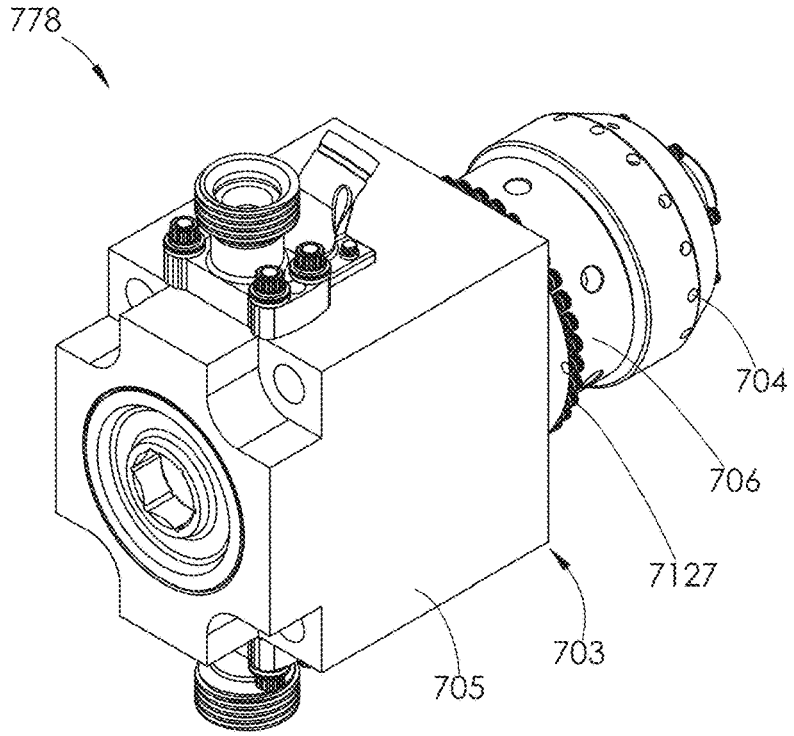
FIG. 111 is an isometric view of another embodiment of a fluid end section that may be used in the fluid end shown in FIG. 55.
Figure 112:
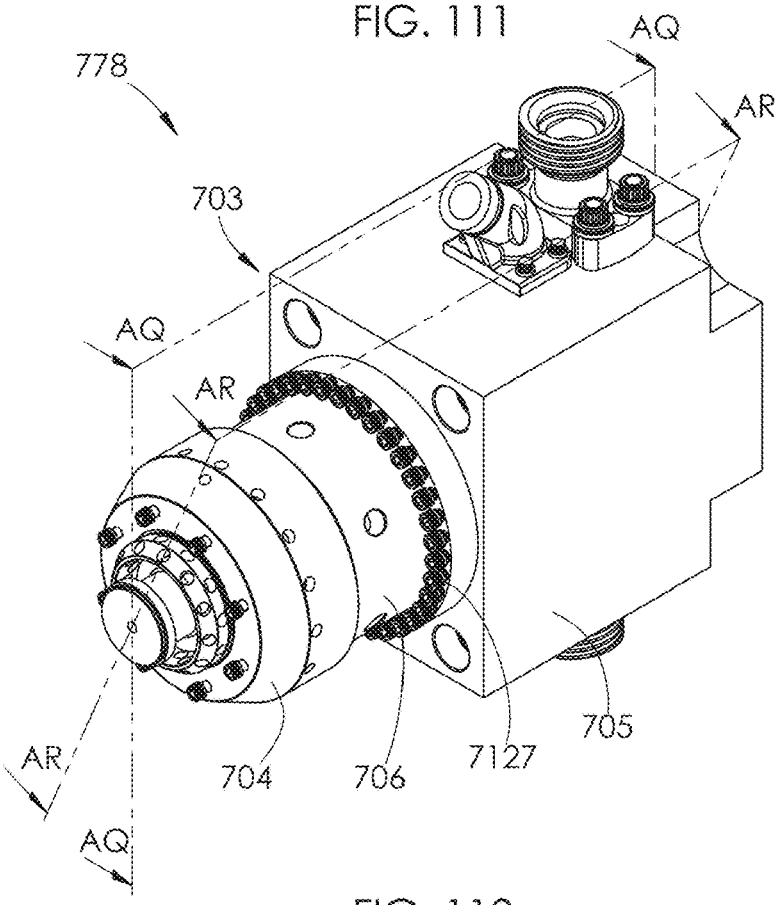
FIG. 112 is a back, top, left isometric view of the fluid end section shown in FIG. 111.

The plunger bore 631 comprises multiple sections, as shown in FIG. 110. Beginning at the front surface 628 and continuing along the longitudinal axis to the back surface 629 the plunger bore 631 comprises dynamic threads 638, a dynamic shoulder 639, an intermediate section 640, a packing nut shoulder 641, and packing nut threads 642. The dynamic shoulder 639 comprises a seal groove 643. The seal groove 643 is circular and concentric with the plunger bore 631. The seal groove 643 is configured to receive the retainer seal 612.

The dynamic threads 638 comprise a thread relief 666 proximate the dynamic shoulder 639. In this embodiment the thread relief 666 is straight walled but may be similar to the thread relief 466 shown in FIG. 70.

The retainer 613 further comprises a plurality of tension bolt holes 644. Each tension bolt hole 644 is a partially threaded through hole originating on the back surface 629 and terminating at the dynamic shoulder 639. The threaded portion of the tension bolt hole 644 extends from the dynamic shoulder 639 approximately half the tension bolt hole 644 length to the back surface 629 and is configured to receive a tension bolt 614. The tension bolt holes 644 are distributed evenly on a bolt circle that is concentric with the retainer 613.

Referring now to FIGS. 88-94, the assembly of a fluid end section 678 begins with the dynamic section 606. Referring now to FIG. 94, the dynamic section 606 is assembled by first installing a flow control system wear ring seal 611, a flow control system wear ring 610, a plunger system wear ring seal 609, and a plunger system wear ring 608 into the dynamic body 607. The depth of the dowel pin holes 6114 is such that, once inserted, a portion of each dowel pin 698 will be protruding from the locating shoulder 659. Third, the spacer sleeve 6103 is oriented to be concentric with the dynamic body 607, align the dowel pin holes 6121 with the protruding dowel pins 698, and to have the back surface 6117 facing the locating shoulder 659. Fourth, the spacer sleeve section 6105 of the outer surface 621 of the dynamic body 607 is then inserted in the central bore 6119 of the spacer sleeve 6103, while simultaneously inserting the protruding dowel pins 698 in the dowel pin holes 6121, until the back surface 6117 contacts the locating shoulder 659. Fifth, the screws 6104 are inserted in the mounting screw holes 6122, threaded into the threaded holes 6115 of the locating shoulder 659 and torqued to specification, thus attaching the spacer sleeve 6103 to the dynamic body 607 and completing the assembly of the dynamic section 606.

Figure 89:
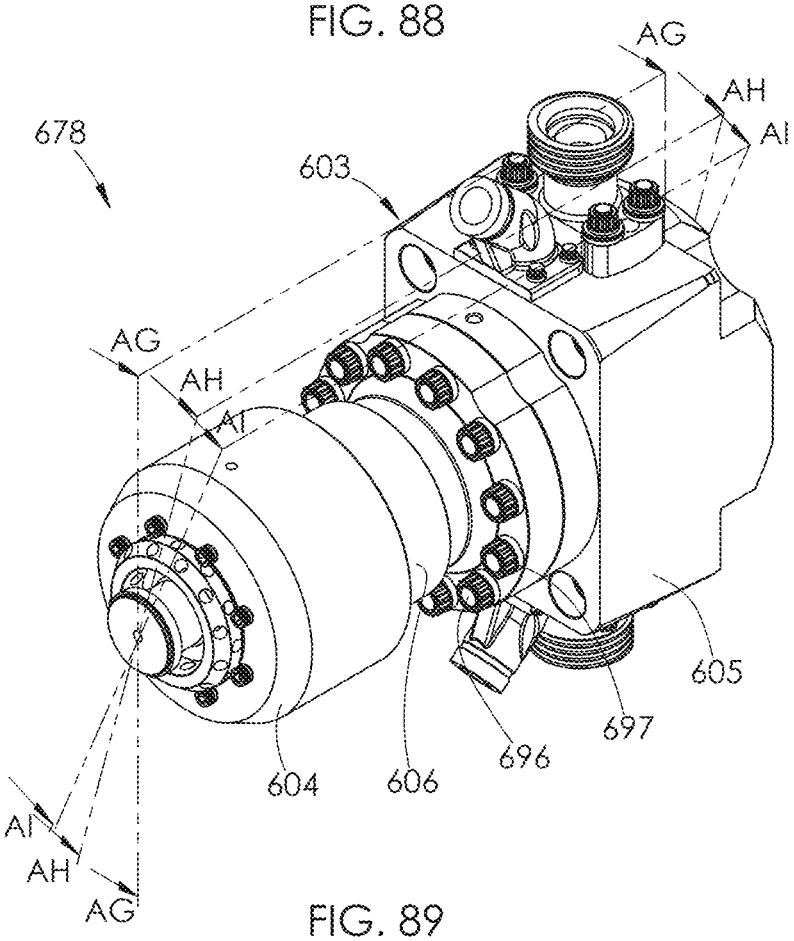
FIG. 89 is a back, top, left isometric view of the fluid end section shown in FIG. 88.
Figure 90:
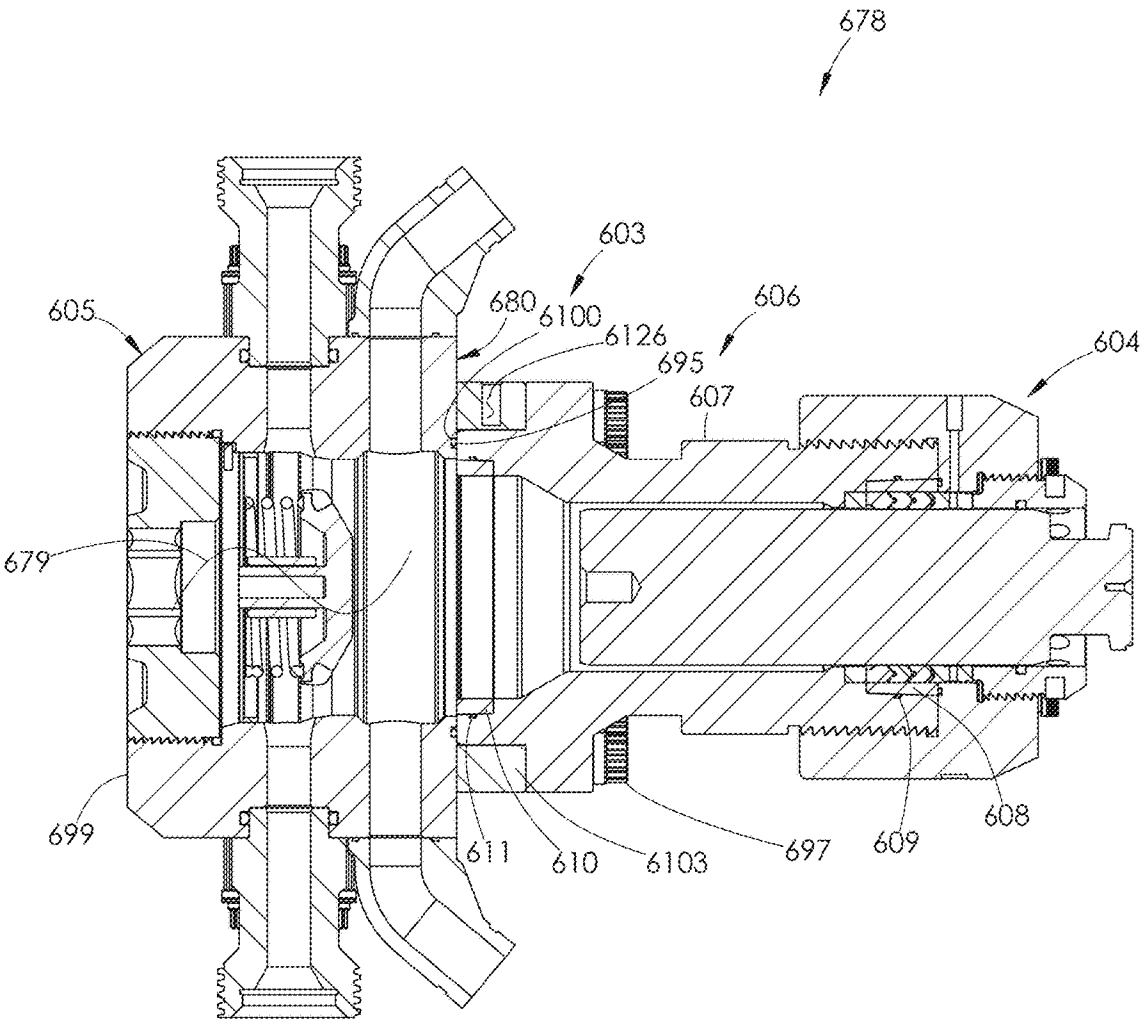
FIG. 90 is a cross-sectional view of the fluid end section shown in FIG. 89, taken along line AG-AG.
Figure 91:
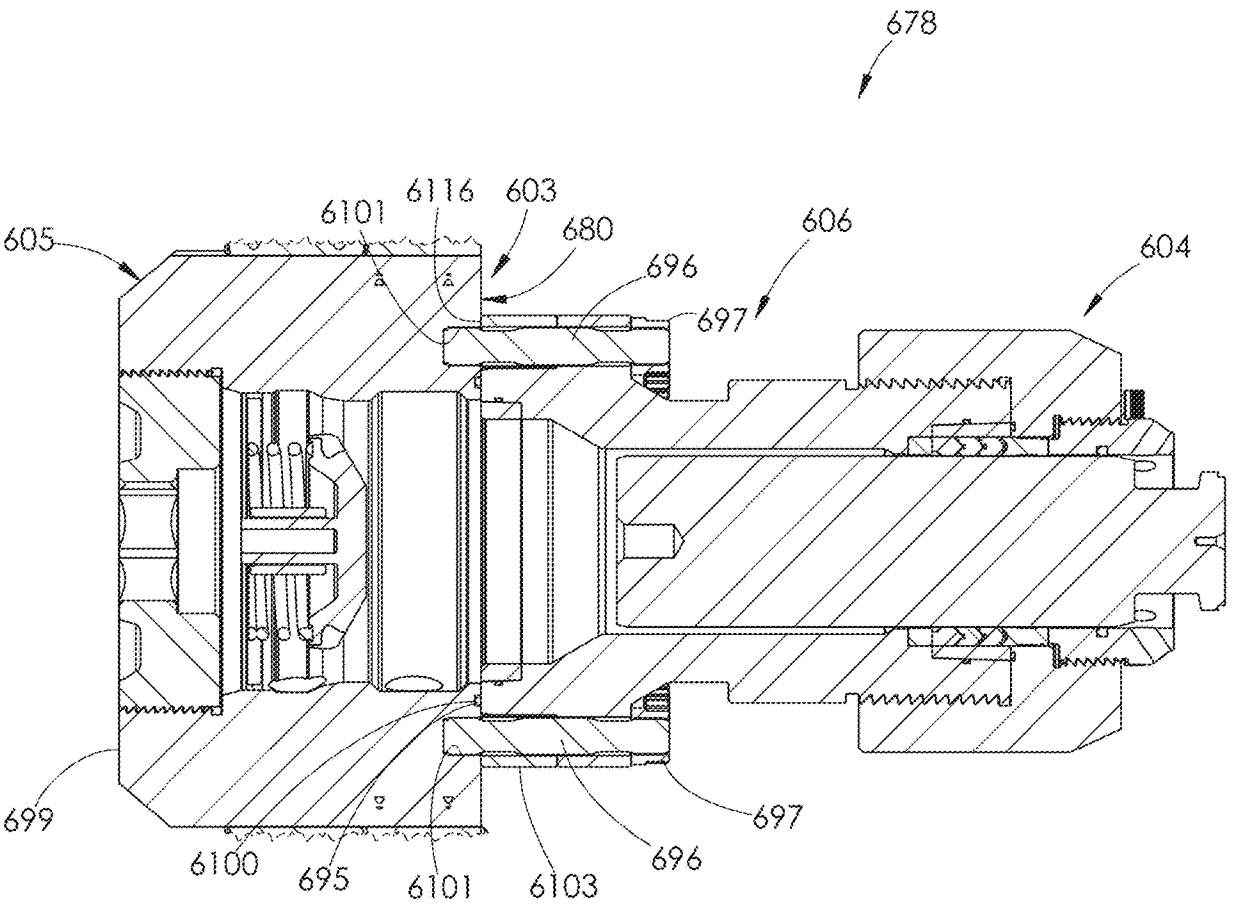
FIG. 91 is a cross-sectional view of the fluid end section shown in FIG. 89, taken along line AH-AH.

Referring now to FIGS. 89, 91, and 93, the dynamic section 606 is attached to the static section 605 by first, threading the studs 696 into the threaded holes 6101 in the back surface 680 of the static section 605 and torquing them to specification. Second, a dowel pin 698 is inserted in each of the dowel pin holes 6102 in the back surface 680 of the static section 605. The depth of the dowel pin holes 6102 is such that, once inserted, a portion of each dowel pin 698 will protrude from the back surface 680. Third, dynamic seal 695 is installed in seal groove 6100 of the back surface 680. Fourth, the dynamic section 606 is oriented to be concentric with the flow bore 679 of the static section 605, align the dowel pin holes 6121 with the protruding dowel pins 698, face the lift hole 6126 up, and to have the front surface 6116 facing the back surface 680 of the static section 605. Fifth, the dynamic section 606 is moved toward the static section 605 until the front surface 6116 of the spacer sleeve 6103 contacts the back surface 680 of the static section 605, simultaneously, the studs 696 are inserted in the stud holes 6120 and the dowel pins 698 are inserted in the dowel pin holes 6121. Sixth, the nuts 697 are threaded on the studs 696 and torqued to specification completing the attachment of the dynamic section 606 to the static section 605. Now the flow control components may be installed in the flow bore 679.

Figure 92:
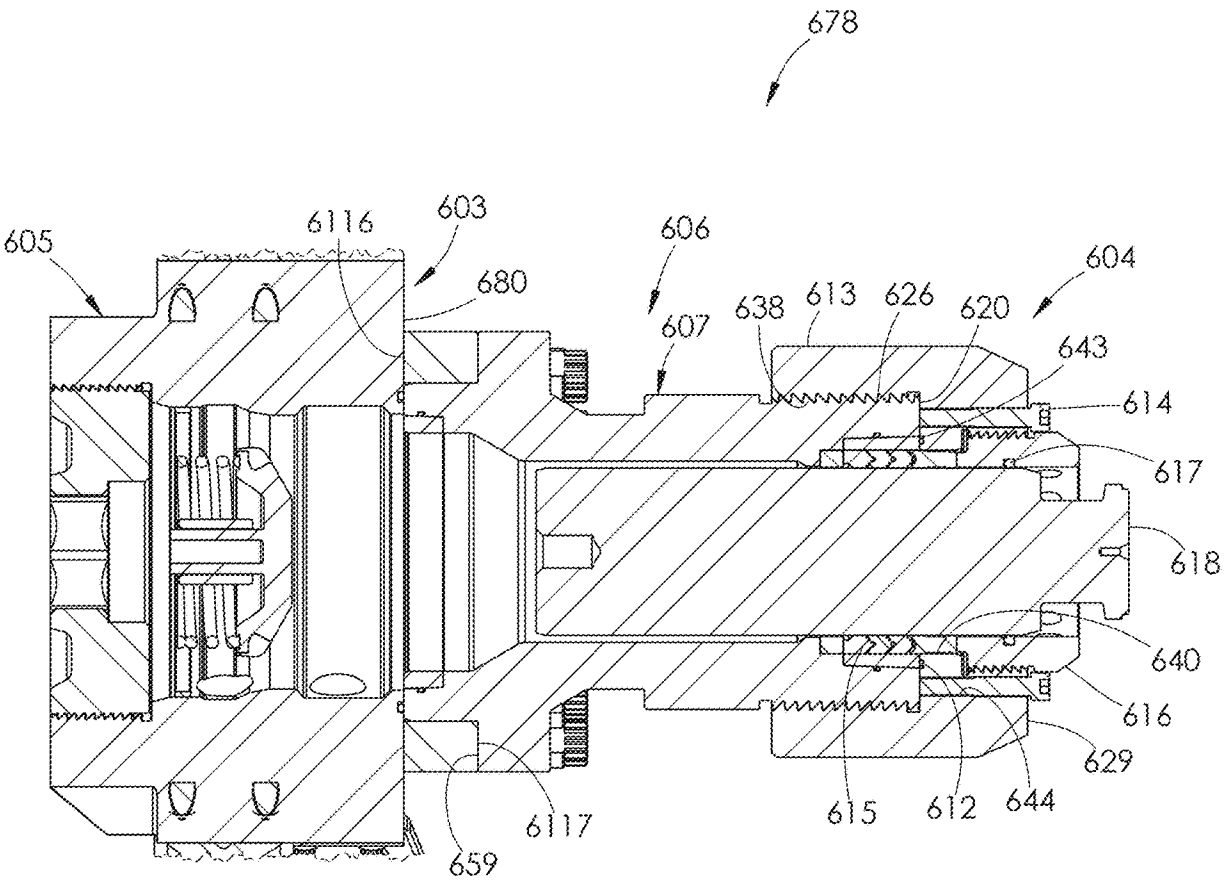
FIG. 92 is a cross-sectional view of the fluid end section shown in FIG. 89, taken along line AI-AI.

Referring now to FIGS. 89, 92, and 93, the plunger system 604 is assembled to the dynamic section 606 by first, installing a retainer seal 612 in the seal groove 643 of the dynamic shoulder 639 of the plunger bore 631 of a retainer 613. Second, the retainer 613 is attached to a dynamic section 606 by threading the dynamic threads 638 of the plunger bore 631 of the retainer 613 onto the retainer threads 626 of the outer surface 621 of the dynamic body 607. A spanner wrench (not shown) may be used to apply the required torque using the spanner wrench hole 636 in the straight section 632 of the outer surface 630 of the retainer 613.

Third, the plurality of tension bolts 614 are then inserted, on a one-to-one basis, into the tension bolt holes 644 from the back surface 629 of the retainer 613 and threaded into the threaded section of the tension bolt holes 644 until the front surface of each tension bolt 614 contacts the back surface 620 of the dynamic body 607, as shown in FIG. 92. Once contact is made by all tension bolts 614 the tension bolts 614 may be torqued to specification in a piecewise manner.

Fourth, the packing 615 is inserted into the dynamic section 606 and the intermediate section 640 of the plunger bore 631 of the retainer 613. Fifth, the plunger seal 617 is installed in the packing nut 616 and the packing nut 616 is threaded into the packing nut threads 642 of the plunger bore 631 of the retainer 613. Sixth, the plunger 618 is installed in the packing nut 616, packing 615, and dynamic section 606. Lastly, the packing nut 616 is torqued to specification.

In operation the tension bolts 614 place the threaded joint formed by the retainer threads 626 of the dynamic body 607 and the dynamic threads 638 of the retainer 613 in tension providing an additional tensile load above that produced by the torquing of the threads together. This additional tensile load reduces the magnitude of cyclic loading usually produced in the joint by the large pressure fluctuations in the dynamic section 606. This reduction in the magnitude of cyclic loading reduces thread to thread fretting and other issues inherent in the previously encountered full, or nearly full, cyclic loading of the threads. Also, the retainer seal 612 protects the retainer threads 626 and dynamic threads 638 from contamination when the packing 615 fails. These benefits result in easier and quicker removal of the retainer 613 for maintenance or replacement when necessary. Also the use of the studs 696 and nuts 697 to attach the dynamic section 606 to the static section 605 may require less torque than a single large thread simplifying disassembly when needed.

Another embodiment of a fluid end section 778 is shown in FIGS. 111-125. The fluid end section 778 may be used in the fluid end 402 shown in FIGS. 54-55. The fluid end section 778 comprises a fluid end body 703 and a plunger system 704. The fluid end body 703 comprises a static section 705, a dynamic section 706, and a plurality of tension bolts 7127.

Figure 113:
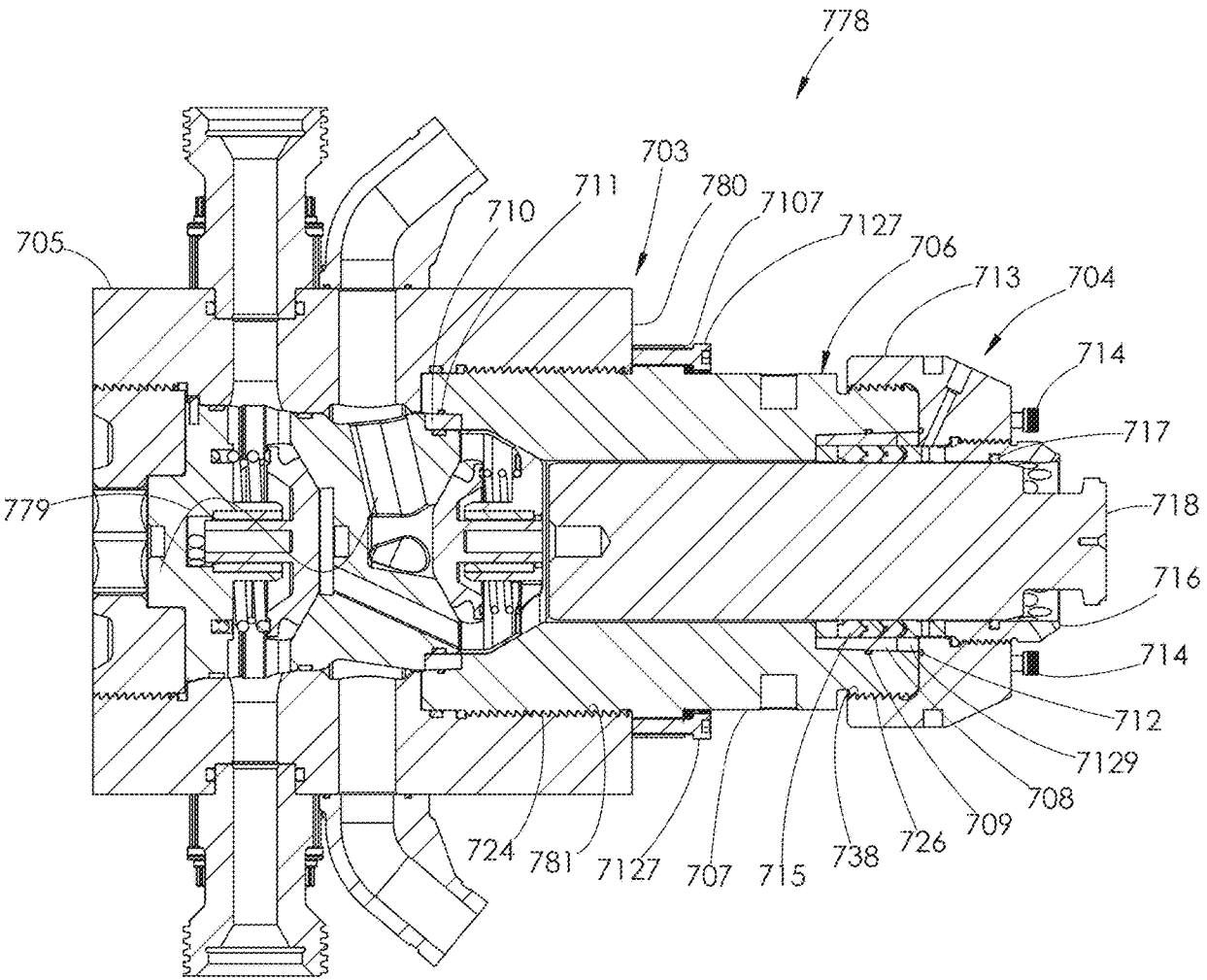
FIG. 113 is a cross-sectional view of the fluid end section shown in FIG. 112, taken along line AQ-AQ.
Figure 114:
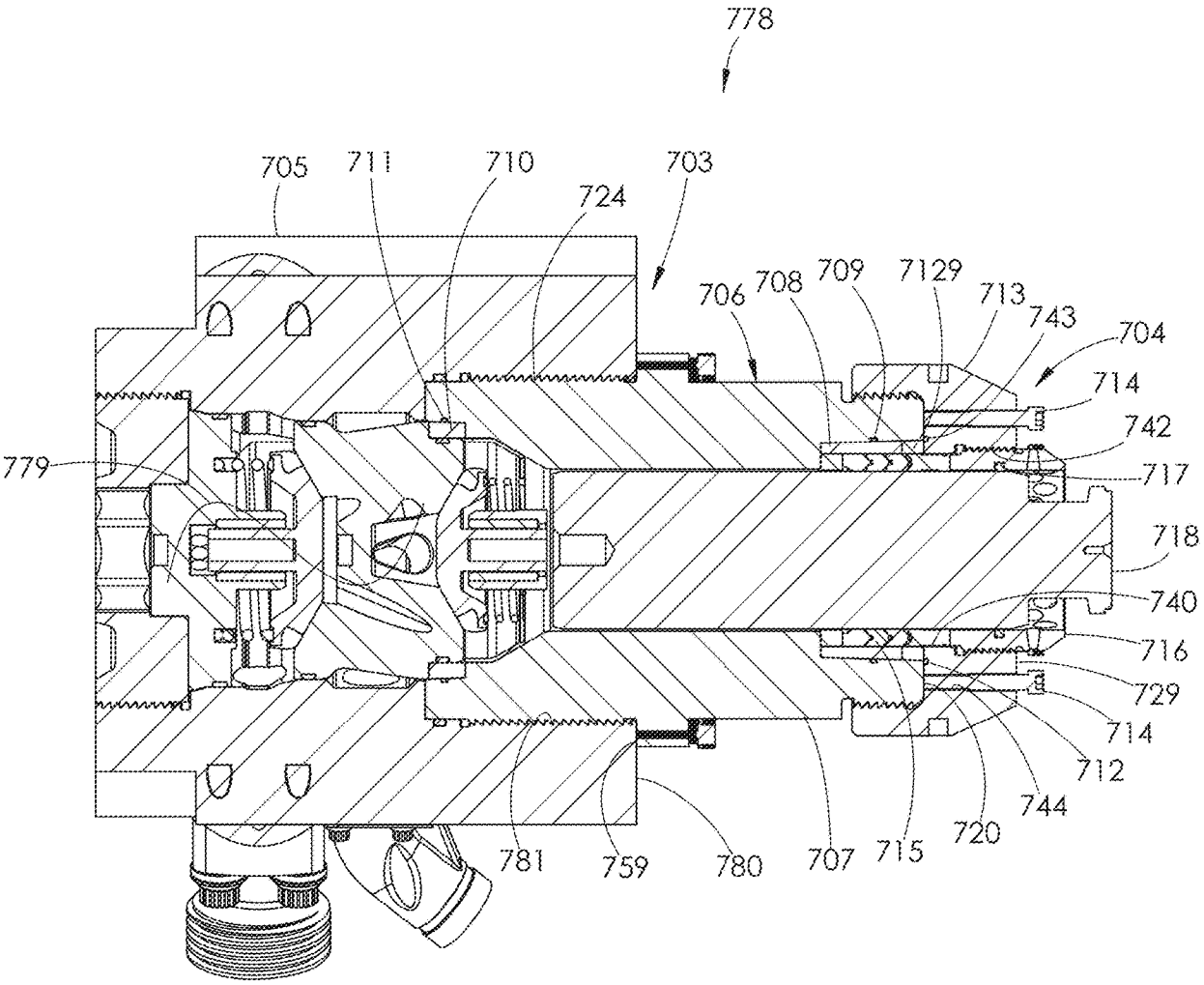
FIG. 114 is a cross-sectional view of the fluid end section shown in FIG. 112, taken along line AR-AR.
Figure 115:
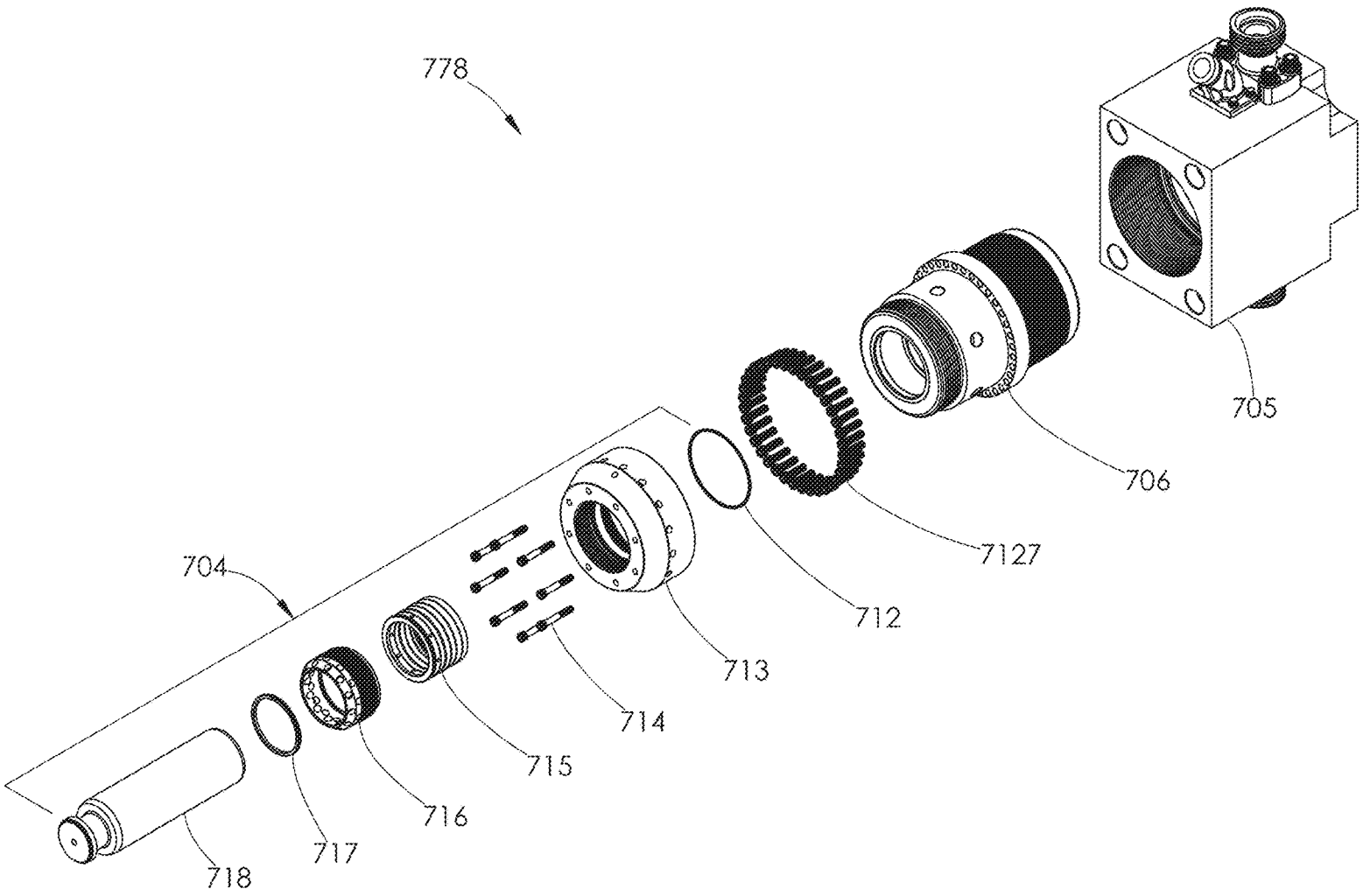
FIG. 115 is an exploded, back, top, left isometric view of the fluid end section shown in FIG. 111.

Each static section 705, shown in FIGS. 113 and 114, comprises a flow bore 779 and a back surface 780. The flow bore 779 is configured to receive flow control components. The flow bore 779 comprises a section of dynamic threads 781 proximate the back surface 780 of the static section 705. The dynamic threads 781 are configured to receive the static threads 724 of the dynamic section 706.

Referring now to FIG. 114, each dynamic section 706 comprises a dynamic body 707, a plunger system wear ring 708, a plunger system wear ring seal 709, a flow control system wear ring 710, a flow control system wear ring seal 711, and a spacer ring 7129. Each plunger system 704 comprises a retainer seal 712, a retainer 713, a plurality of tension bolts 714, packing 715, a packing nut 716, a plunger seal 717, and a plunger 718.

Figure 116:
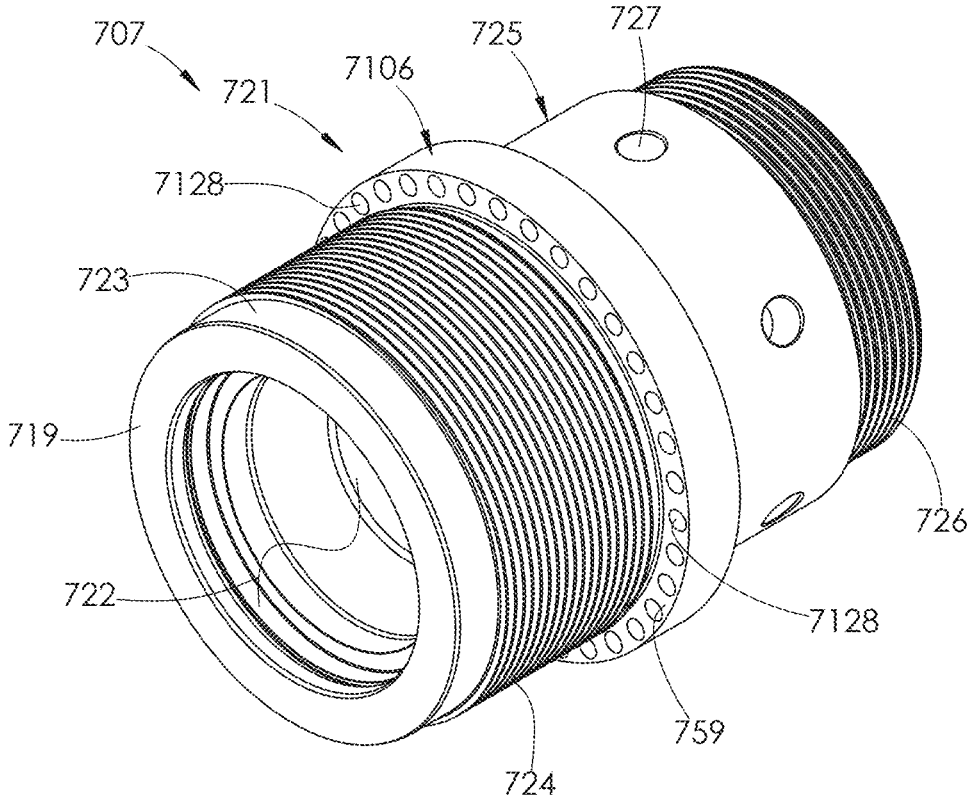
FIG. 116 is an isometric view of the dynamic body used in the dynamic section shown in FIG. 111.
Figure 117:
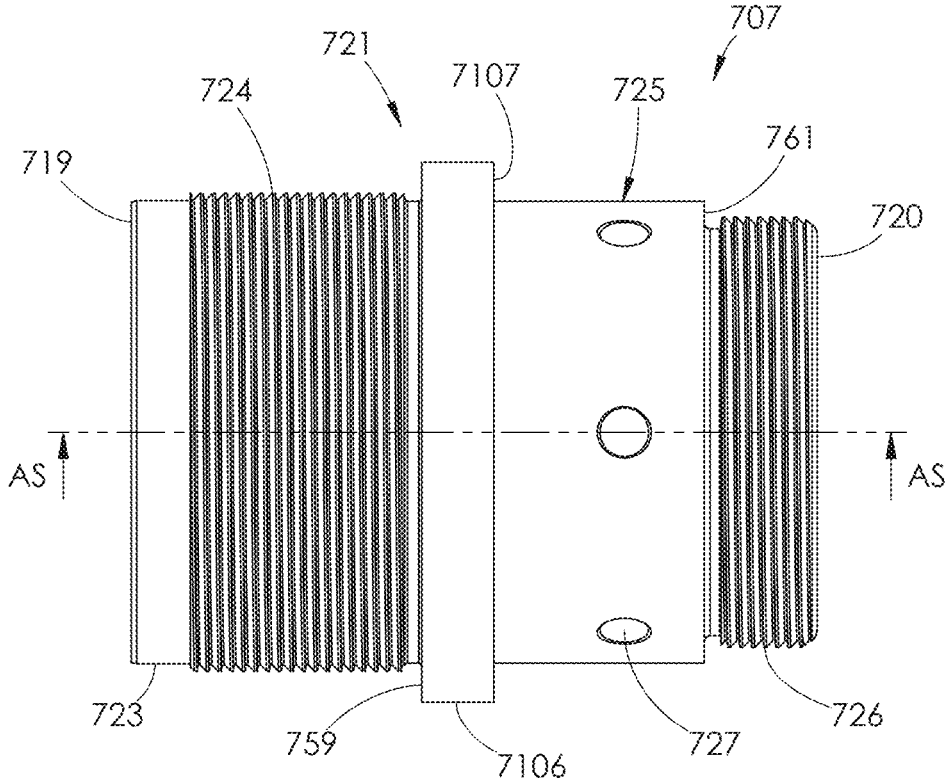
FIG. 117 is a top plan view of the dynamic body shown in FIG. 116.
Figure 118:
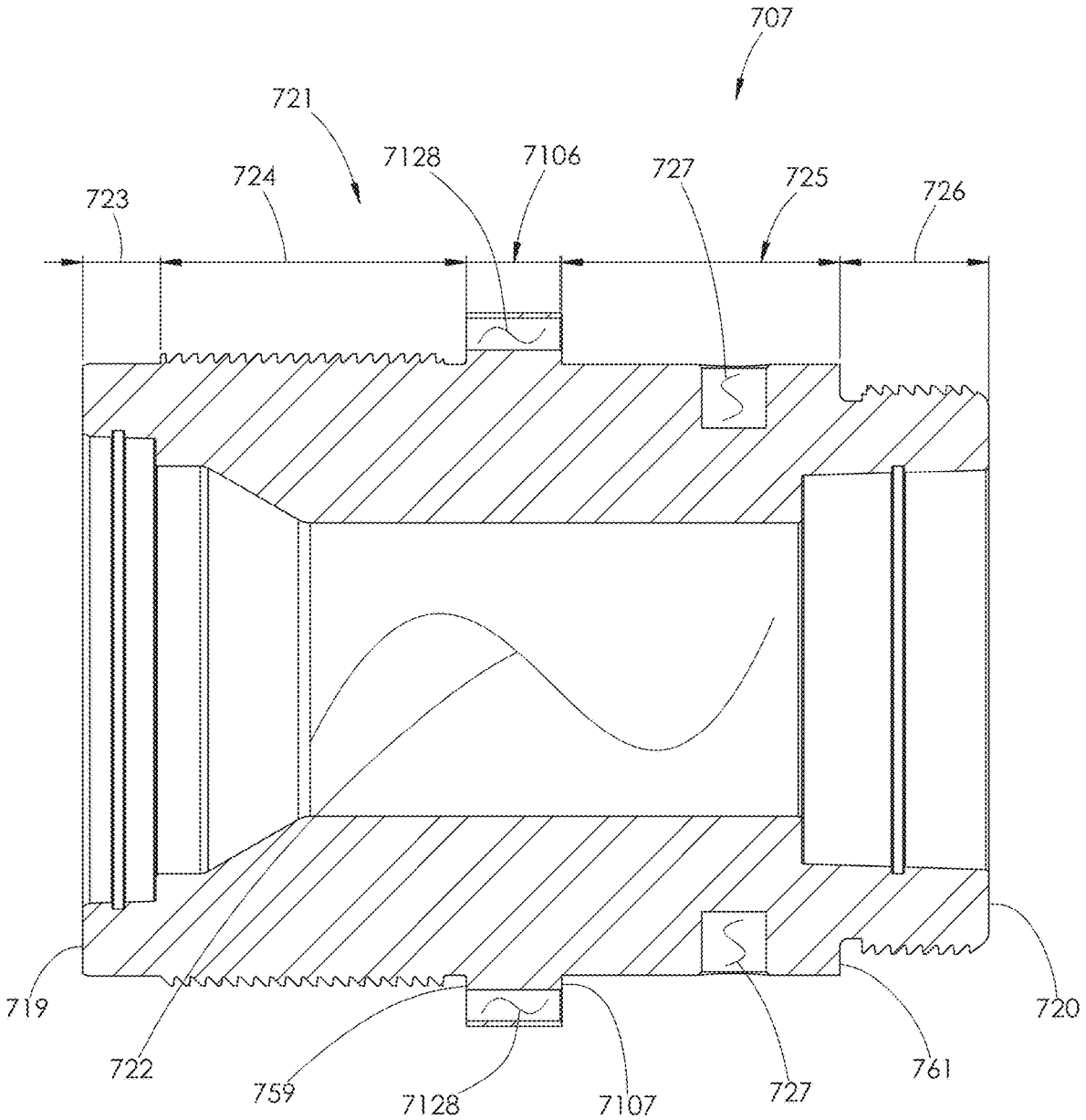
Figure 119:
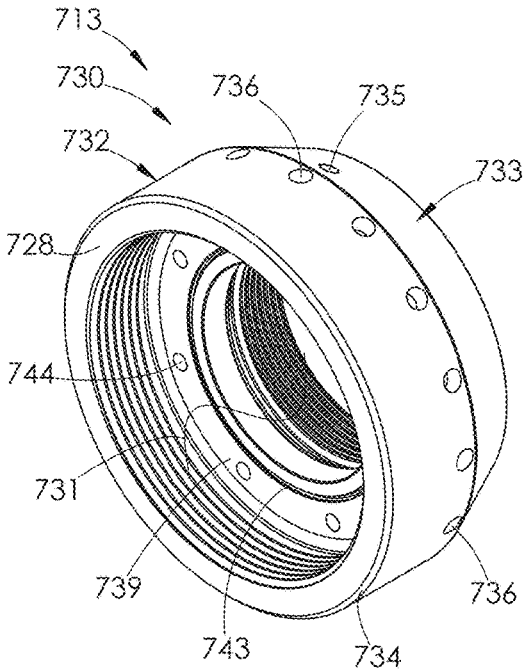
FIG. 119 is an isometric view of the retainer used in the plunger system shown in FIG. 111.
Figure 120:
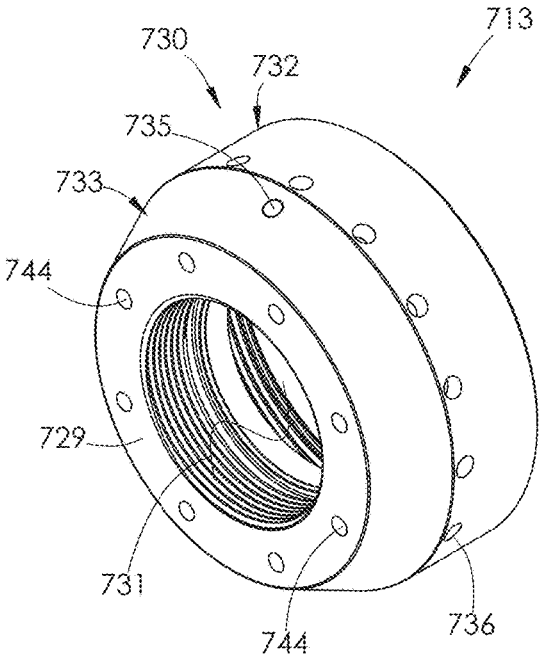
Figure 121:
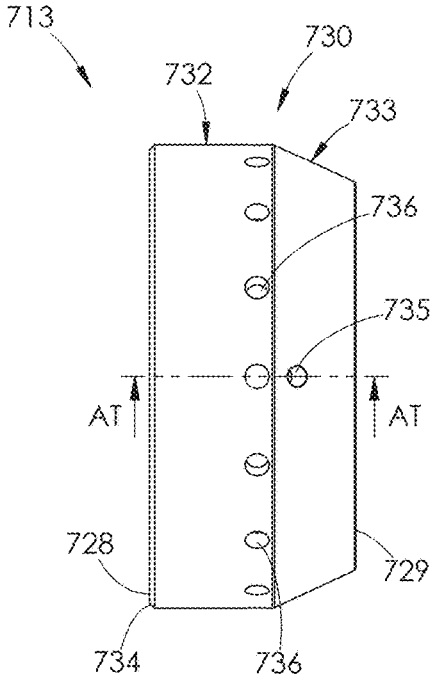
Figure 122:
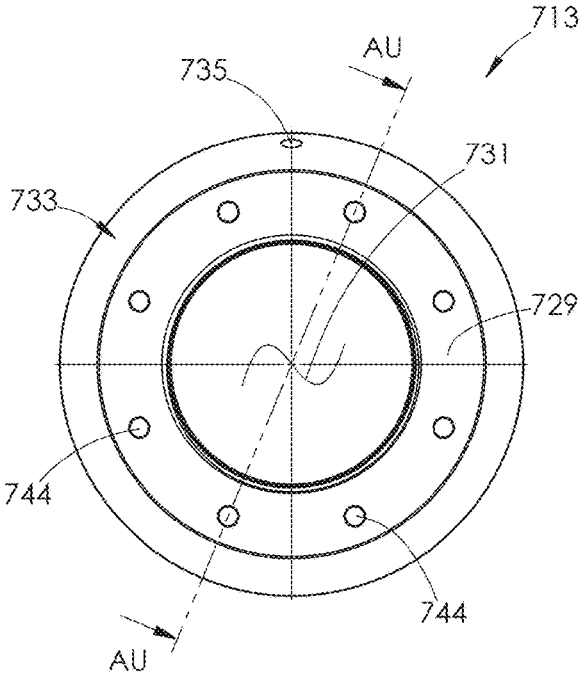
Figure 123:
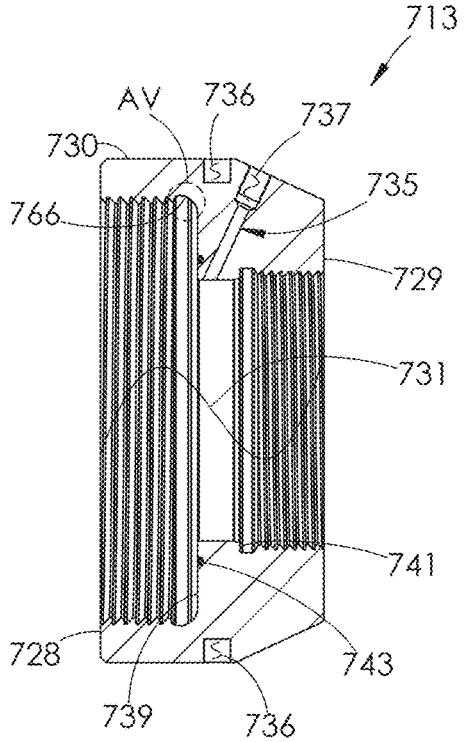

The dynamic body 707, shown in FIGS. 116-118, has a cylindrical shape. The dynamic body 707 comprises opposing front 719 and back 720 surfaces connected by an outer surface 721 and a flow bore 722. The outer surface 721 and flow bore 722 are concentric and their cylindrical axes are the longitudinal axis of the dynamic body 707.

Referring now to FIG. 118, the outer surface 721 comprises multiple sections, all the sections are concentric. Beginning at the front surface 719 of the dynamic body 707 and continuing along the longitudinal axis to the back surface 720 the outer surface 721 comprises a static seal section 723, static threads 724, locating shoulder 759, mounting flange 7106, mounting flange back surface 7107, intermediate section 725, back shoulder 761, and retainer threads 726. The intermediate section 725 comprises a plurality of spanner wrench holes 727. The spanner wrench holes 727 are radial blind bores with a bore axis that is perpendicular to the longitudinal axis of the dynamic body 707. Each spanner wrench hole 727 originates from the intermediate section 725 of the outer surface 721 but does not intersect the flow bore 722. In this embodiment the spanner wrench holes 727 are proximate the back shoulder 761, aligned longitudinally, and evenly spaced circumferentially but may be spaced in any manner on the intermediate section 725 as long as access for the spanner wrench (not shown) is available.

The mounting flange 7106 comprises a plurality of tension bolt holes 7128. The tension bolt holes 7128 are threaded through holes that connect the locating shoulder 759 to the mounting flange back surface 7107. The tension bolt holes 7128 are configured to receive the tension bolts 7127. The tension bolt holes 7128 are formed in a circular pattern concentric with the outer surface 721. In this embodiment there are thirty-six tension bolt holes 7128 spaced evenly in the circular pattern but there may be more or less spaced in any manner as desired.

The flow bore 722 also comprises multiple sections and is configured to receive the plunger system wear ring seal 709, plunger system wear ring 708, flow control system wear ring seal 711, flow control system wear ring 710, and spacer ring 7129. The flow bore 722 is not the focus of this improvement so no further details about the flow bore 722 are necessary to understand this disclosure.

The retainer 713, shown in FIGS. 119-124, has a generally cylindrical shape. The retainer 713 comprises a front surface 728 and back surface 729 connected by an outer surface 730 and plunger bore 731. The outer surface 730 and plunger bore 731 are concentric and their cylindrical axes are the longitudinal axis of the retainer 713.

The outer surface 730 comprises a straight section 732 and a tapered section 733. The straight section 732 begins at the front surface 728 and continues along the longitudinal axis until it connects with the tapered section 733. The straight section 732 occupies approximately 60% of the outer surface 730 but may be more or less. The straight section 732 comprises a front chamfer 734 and plurality of spanner wrench holes 736.

The spanner wrench holes 736 are radial blind bores with a bore axis that is perpendicular to the longitudinal axis of the retainer 713. Each spanner wrench hole 736 originates from the straight section 732 of the outer surface 730 but does not intersect the plunger bore 731. In this embodiment the spanner wrench holes 736 are proximate the tapered section 733, aligned longitudinally, and evenly spaced circumferentially but may be spaced in any manner on the straight section 732 as long as access for the spanner wrench (not shown) is available.

The tapered section 733 comprises a lubrication port 735. The lubrication port 735 is a radial through bore connecting the tapered section 733 of the outer surface 730 to the intermediate section 740 of the plunger bore 731. The bore axis of the lubrication port 735 is perpendicular to the tapered face of the tapered section 733. The lubrication port 735 comprises a threaded section 737 adjacent to the outer surface 730 configured to receive a lubrication fitting (not shown) or plug (not shown).

Figure 124:
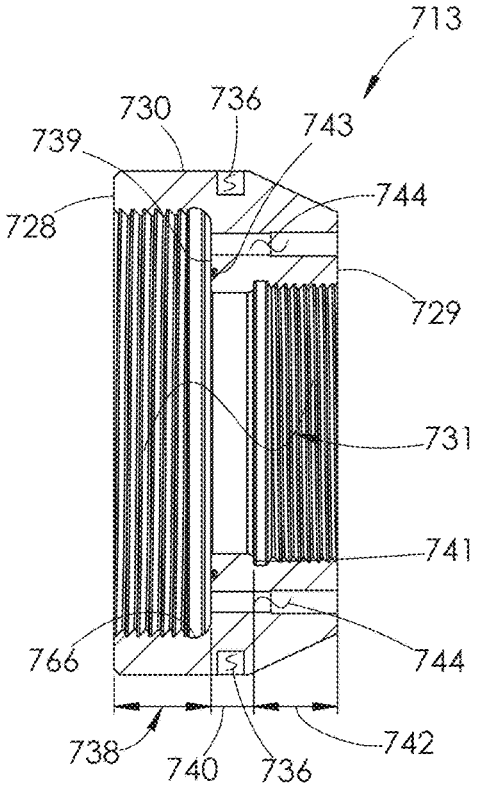

The plunger bore 731 comprises multiple sections, as shown in FIG. 124. Beginning at the front surface 728 and continuing along the longitudinal axis to the back surface 729 the plunger bore 731 comprises dynamic threads 738, a dynamic shoulder 739, an intermediate section 740, a packing nut shoulder 741, and packing nut threads 742. The dynamic shoulder 739 comprises a seal groove 743. The seal groove 743 is circular and concentric with the plunger bore 731. The seal groove 743 is configured to receive the retainer seal 712.

Figure 125:
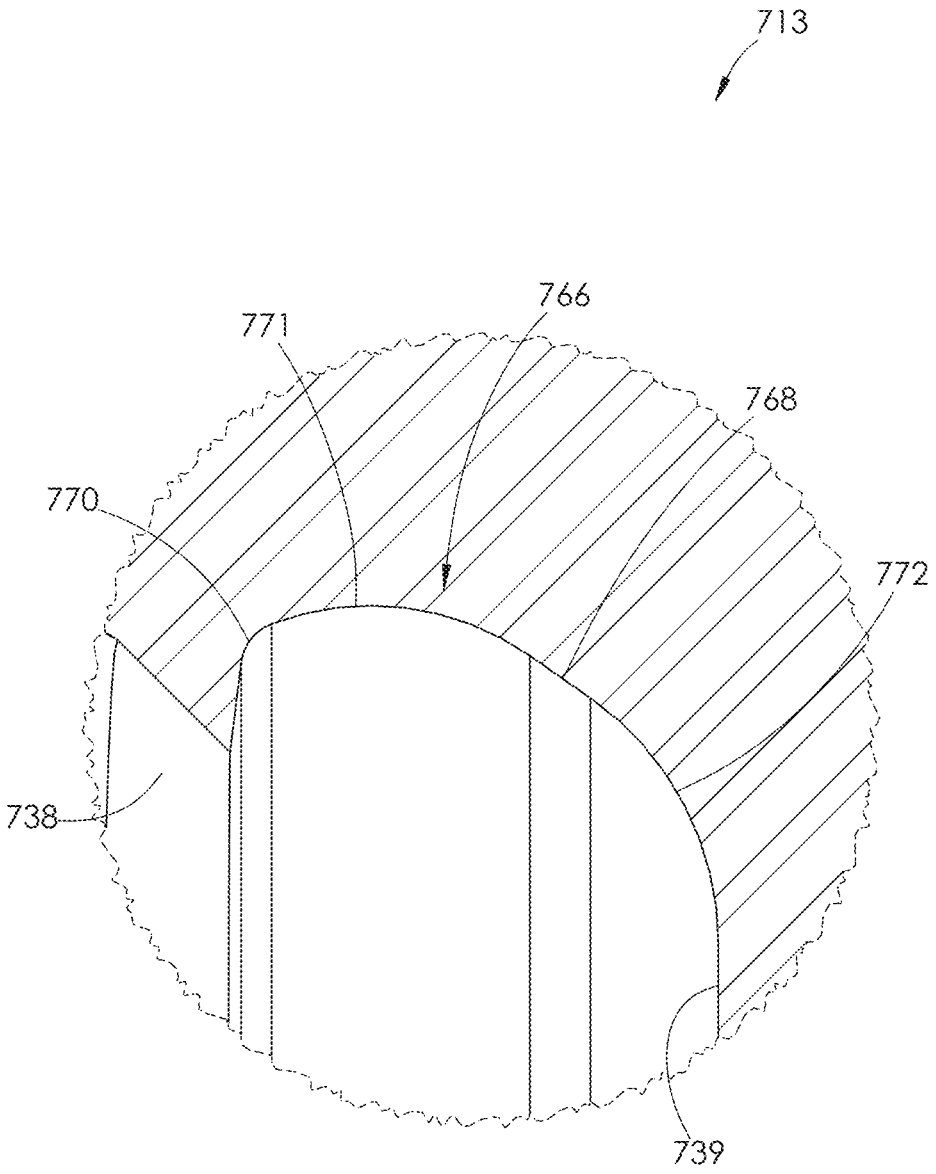

The dynamic threads 738 comprise a thread relief 766 proximate the dynamic shoulder 739. Referring now to FIG. 125, the thread relief 766 comprises a straight section 768 and a plurality of curved sections, curved section one 770, curved section two 771, and curved section three 772. Curved section one 770 is concave and provides a transition from the last thread of the dynamic threads 738 to curved section two 771. Curved section two 771 is concave and provides a transition from curved section one 770 to the straight section 768. Straight section 768 is angled relative to the longitudinal axis and provides a transition from curved section two 771 to curved section three 772. Curved section three 772 is concave and provides a transition from straight section 768 to the dynamic shoulder 739 of the plunger bore 731.

In this embodiment the radius of curved section one 770 is less than the radius of curved section two 771 and the radius of curved section two 771 is less than the radius of curved section three 772 but the radii of the curved sections 770, 771, and 772 may be any value that still allows the geometric construction of the thread relief 766. In this embodiment straight section 768 has an angle of approximately 35 degrees with the longitudinal axis however it may be any angle between 0 and 90 degrees. It is also contemplated that the curved sections 770, 771, and 772 may be spline curves with infinitely varying radii. If both curved section one 770 and curved section two 771 are spline curves, then curved section one 770 and curved section two 771 may be considered a single curve. Also, if both curved section two 771 and curved section three 772 are spline curves and straight section 768 is removed then curved section two 771 and curved section three 772 may be considered a single curve.

Referring now to FIG. 124, the retainer 713 further comprises a plurality of tension bolt holes 744. Each tension bolt hole 744 is a partially threaded through hole originating on the back surface 729 and terminating at the dynamic shoulder 739. The threaded portion of the tension bolt hole 744 extends from the dynamic shoulder 739 approximately half the tension bolt hole 744 length to the back surface 729 and is configured to receive a tension bolt 714. The tension bolt holes 744 are distributed evenly on a bolt circle that is concentric with the retainer 713.

Referring now to FIGS. 111-115, the assembly of a fluid end section 778 begins with the dynamic section 706. Referring now to FIG. 113, the dynamic section is assembled by installing a flow control system wear ring seal 711, a flow control system wear ring 710, a plunger system wear ring seal 709, plunger system wear ring 708, and spacer ring 7129 into the dynamic body 707.

The dynamic section 706 is then attached to the static section 705 by threading the static threads 724 of the outer surface 721 of the dynamic body 707 into the dynamic threads 781 of the static section 705 until the locating shoulder 759 abuts the back surface 780 of the static section 705, as shown in FIG. 114. A spanner wrench (not shown) may be used to apply the required torque using the spanner wrench holes 727 in the intermediate section 725 of the outer surface 721 of the dynamic body 707.

Next, the plurality of tension bolts 7127 are then threaded, on a one-to-one basis, into the tension bolt holes 7128 from the mounting flange back surface 7107 of the dynamic body 707 until the front surface of each tension bolt 7127 contacts the back surface 780 of the static section 705, as shown in FIG. 113. Once contact is made by all tension bolts 7127 the tension bolts 7127 may be torqued to specification in a piecewise manner.

Next, a retainer seal 712 is installed in the seal groove 743 of the dynamic shoulder 739 of the plunger bore 731 of a retainer 713. Then, the retainer 713 is attached to a dynamic section 706 by threading the dynamic threads 738 of the plunger bore 731 of the retainer 713 onto the retainer threads 726 of the outer surface 721 of the dynamic body 707. A spanner wrench (not shown) may be used to apply the required torque using the spanner wrench holes 736 in the straight section 732 of the outer surface 730 of the retainer 713.

The plurality of tension bolts 714 are then inserted, on a one-to-one basis, into the tension bolt holes 744 from the back surface 729 of the retainer 713 and threaded into the threaded section of the tension bolt holes 744 until the front surface of each tension bolt 714 contacts the back surface 720 of the dynamic body 707, as shown in FIG. 114. Once contact is made by all tension bolts 714 the tension bolts 714 may be torqued to specification in a piecewise manner. The flow control components may now be installed in the flow bore 779 of static section 705.

Next, the packing 715 is inserted into the dynamic section 706 and the intermediate section 740 of the plunger bore 731 of the retainer 713. Next, the plunger seal 717 is installed in the packing nut 716 and the packing nut 716 is threaded into the packing nut threads 742 of the plunger bore 731 of the retainer 713. Next, the plunger 718 is installed in the packing nut 716, packing 715, and dynamic section 706. Lastly, the packing nut 716 is torqued to specification.

In operation the tension bolts 714 place the threaded joint formed by the retainer threads 726 of the dynamic body 707 and the dynamic threads 738 of the retainer 713 in tension providing an additional tensile load above that produced by the torquing of the threads together. This additional tensile load reduces the magnitude of cyclic loading usually produced in the joint by the large pressure fluctuations in the dynamic section 706. This reduction in the magnitude of cyclic loading reduces thread to thread fretting and other issues inherent in the previously encountered full, or nearly full, cyclic loading of the threads. Also, the retainer seal 712 protects the retainer threads 726 and dynamic threads 738 from contamination when the packing 715 fails. These benefits result in easier and quicker removal of the retainer 713 for maintenance or replacement when necessary. Also during operation, the thread relief 766 reduces stress in the retainer 713 at the transition from the dynamic threads 738 to the dynamic shoulder 739.

In like manner to the tension bolts 714, tension bolts 7127 provide an additional tensile load to the threaded joint formed by the static threads 724 of the dynamic body 707 and the dynamic threads 781 of the static section 705 above that produced by the torquing of the threads together. This also results in lower failure rates and easier assembly and disassembly of the fluid end section 778.

Figure 130:
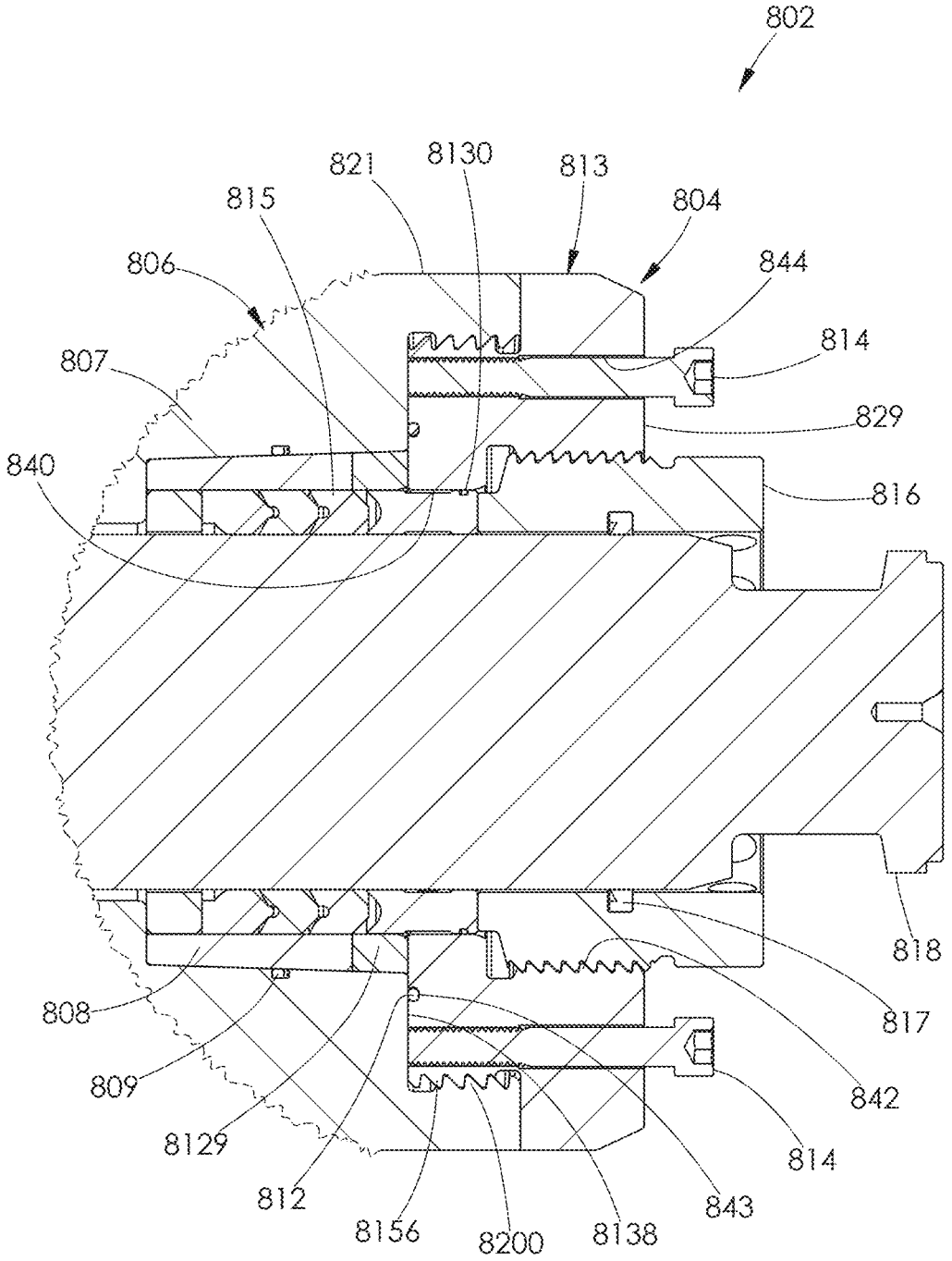
Figure 131:
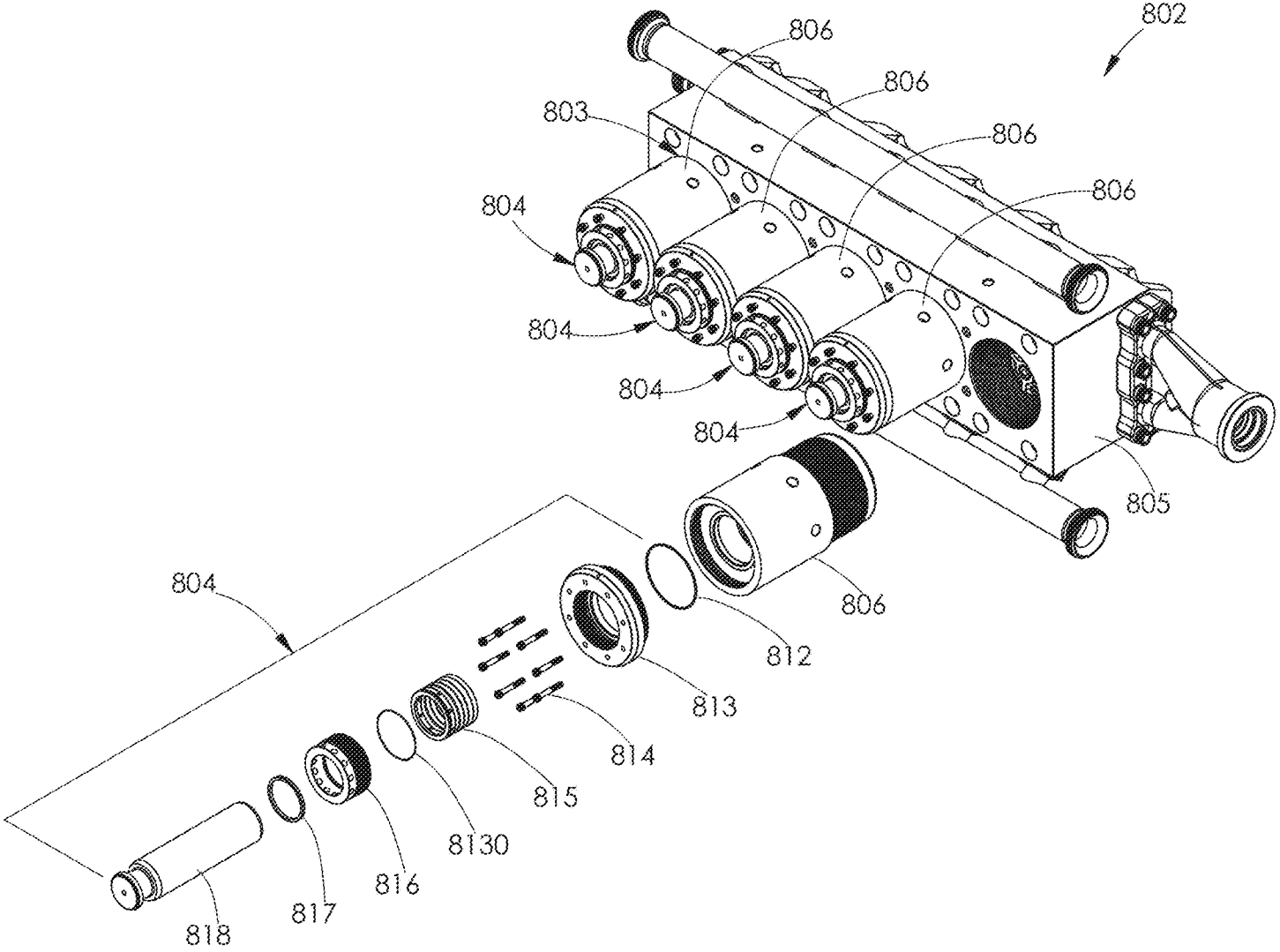

Referring now to FIGS. 126-142, another embodiment of a multi-piece fluid end 802 is shown. The multi-piece fluid end 802 comprises a fluid end body 803, a plurality of plunger systems 804, and a plurality of flow control systems 8146. The fluid end body 803 comprises a static section 805 and a plurality of dynamic sections 806. Each dynamic section 806 comprises a dynamic body 807, a plunger system wear ring 808, a plunger system wear ring seal 809, a spacer ring 8129, a flow control system wear ring 810, and a flow control system wear ring seal 811 as shown in FIGS. 127-130. Each plunger system 804 comprises a retainer seal 812, a retainer 813, a plurality of tension bolts 814, packing 815, a lantern ring seal 8130, a packing nut 816, a plunger seal 817, and a plunger 818, as shown in FIGS. 130-131.

The dynamic body 807, shown in FIGS. 132-136, has a cylindrical shape. The dynamic body 807 comprises opposing front 819 and back 820 surfaces connected by an outer surface 821 and a flow bore 822. The outer surface 821 and flow bore 822 are concentric and their cylindrical axis is the longitudinal axis of the dynamic body 807.

Referring now to FIG. 134, the outer surface 821 comprises multiple concentric sections. Beginning at the front surface 819 of the dynamic body 807 and continuing along the longitudinal axis to the back surface 820, the outer surface 821 comprises a static seal section 823, static threads 824, locating shoulder 859, and a back section 8131. The back section 8131 comprises a plurality of spanner wrench holes 827. The spanner wrench holes 827 are radial blind bores with a bore axis that is perpendicular to the longitudinal axis of the dynamic body 807. Each spanner wrench hole 827 originates from the back section 8131 of the outer surface 821 but does not intersect the flow bore 822. In this embodiment the spanner wrench holes 827 are proximate the static threads 824, aligned longitudinally, and evenly spaced circumferentially but may be spaced in any manner on the back section 8131 as long as access for the spanner wrench (not shown) is available.

Continuing with FIG. 134, beginning at the front surface 819 of the dynamic body 807 and moving along the bore axis of the flow bore 822 to the back surface 820, the flow bore 822 comprises a plurality of concentric sections. They are a flow control system wear ring section 8132, a flow control system wear ring shoulder 8133, a flow control system section 8134, a plunger section 8135, a plunger system wear ring shoulder 8136, a plunger system wear ring section 8137, a retainer shoulder 8138, and a retainer thread section 8139.

Figure 127:
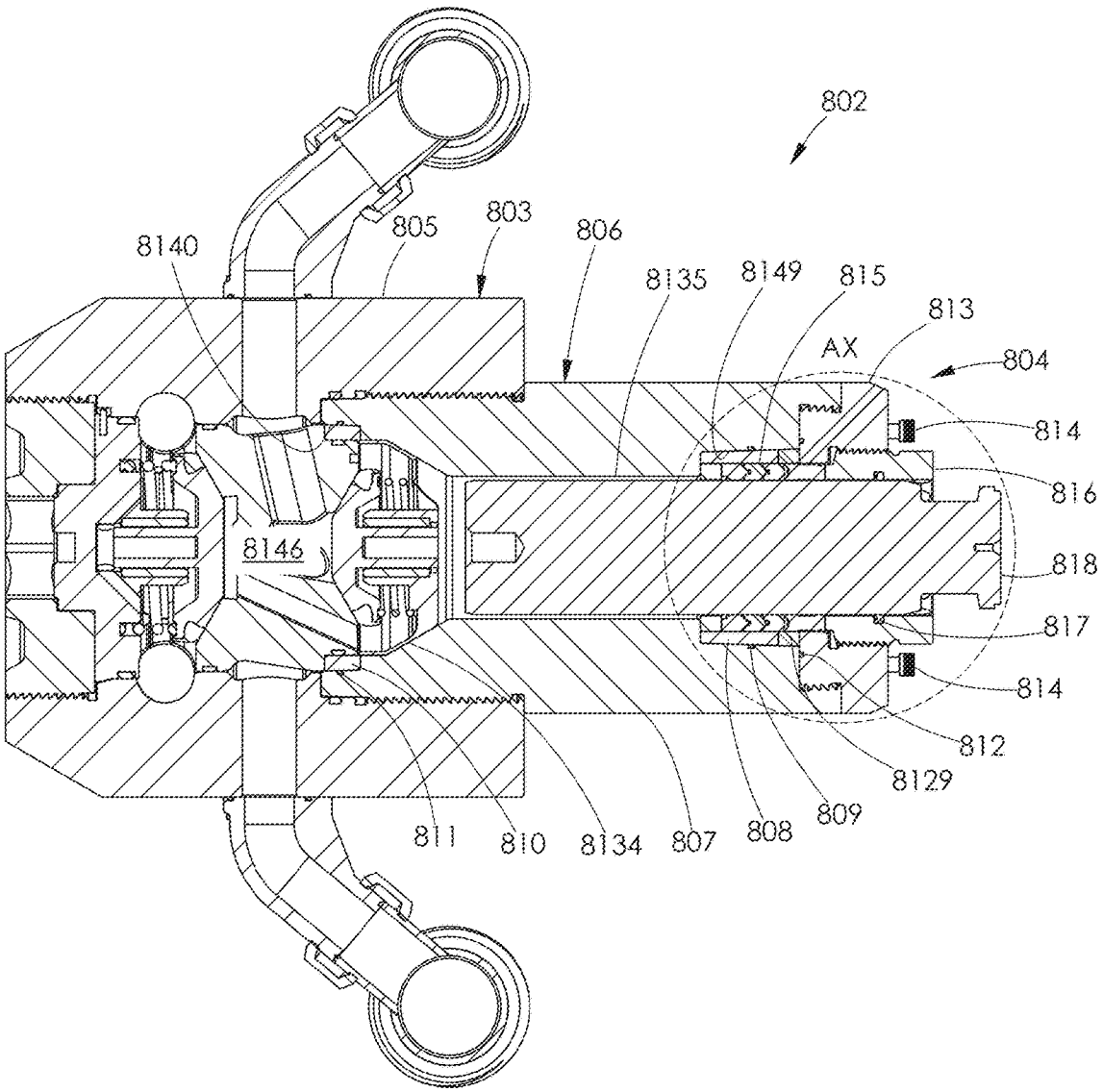

Referring now to FIG. 135, the flow control system wear ring section 8132 comprises a tapered bore 8140. The largest diameter of the tapered bore 8140 is at the front surface 819 and the smallest diameter is at the flow control system wear ring shoulder 8133. The taper is complementary to the taper of the outer surface of the flow control system wear ring 810, as shown in FIG. 127. The flow control system wear ring section 8132 may further comprise a front chamfer 8141 to aid in the installation of the flow control system wear ring 810. The flow control system wear ring section 8132 may further comprise a transition radius 8142 at the base of the tapered bore 8140 to reduce stress in the transition between the tapered bore 8140 and the flow control system wear ring shoulder 8133.

The tapered bore 8140 comprises a seal groove 8143 comprising two side walls 8144 connected by a base 8145. Each side wall 8144 is perpendicular to the bore axis of the flow bore 822 and extends from the surface of the tapered bore 8140 radially away from the bore axis of the flow bore 822. The base 8145 is flat, that is parallel to the bore axis of the flow bore 822. The seal groove 8143 is located from the front surface 819 approximately one-half of the longitudinal distance between the front surface 819 and the flow control system wear ring shoulder 8133.

The flow control system wear ring shoulder 8133 is formed by the reduction in diameter of the flow bore 822 between the flow control system wear ring section 8132 and the flow control system section 8134. The flow control system wear ring shoulder 8133 is perpendicular to the bore axis of the flow bore 822.

The flow control system section 8134 comprises a straight portion 8147, that is the bore wall is parallel to the bore axis of the flow bore 822, and a tapered portion 8148. As can be seen in FIG. 127, the flow control system section 8134 is configured to receive particular components of the flow control system 8146. The flow control system section 8134 may further comprise a front chamfer 8206 to aid in the installation of the particular components of the flow control system 8146 and a transition radius 8203 from the straight portion 8147 to the tapered portion 8148.

The plunger section 8135 is also straight and provides a volume for the fluid to enter on the suction stroke of the plunger system 804 and to exit when the plunger system 804 applies force, generating fluid pressure, on the pressure stroke, as shown in FIG. 127. The plunger section 8135 may further comprise a transition radius 8204 from the flow control system section 8134, shown in FIG. 135, and another transition radius 8205 into the plunger system wear ring shoulder 8136, shown in FIG. 136.

Referring now to FIG. 136, the plunger system wear ring shoulder 8136 is formed by the increase in diameter of the flow bore 822 between the plunger section 8135 and the plunger system wear ring section 8137. The plunger system wear ring shoulder 8136 is perpendicular to the bore axis of the flow bore 822.

Figure 128:
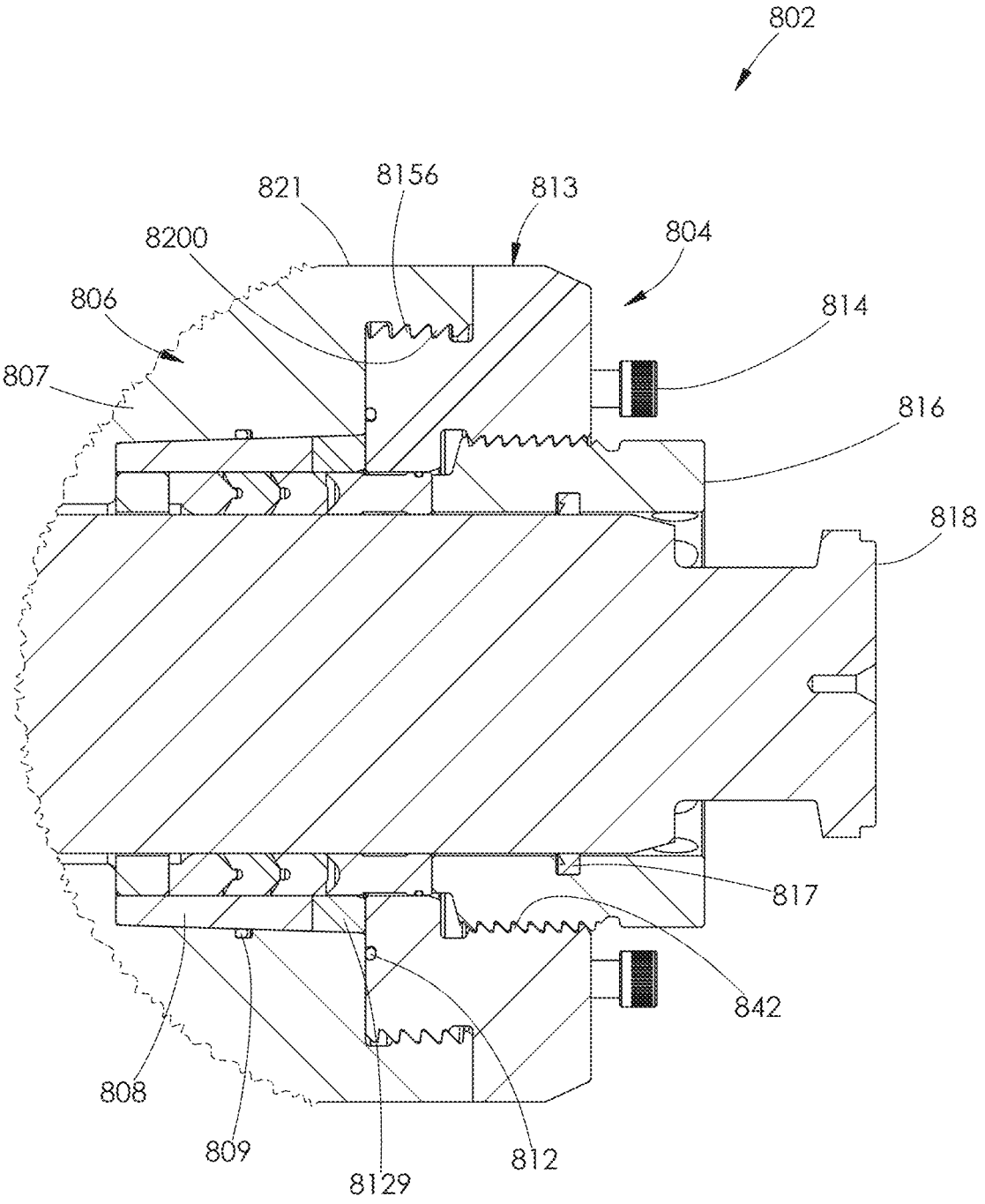

The plunger system wear ring section 8137 comprises a tapered bore 8149. The largest diameter of the tapered bore 8149 is at the retainer shoulder 8138 and the smallest diameter is at the plunger system wear ring shoulder 8136. The taper is complementary to the taper of the outer surfaces of the plunger system wear ring 808 and spacer ring 8129, as shown in FIG. 128. The plunger system wear ring section 8137 may further comprise a back chamfer 8150 to aid in the installation of the plunger system wear ring 808 and spacer ring 8129. The plunger system wear ring section 8137 may also comprise a transition radius 8151 at the base of the tapered bore 8149 to reduce stress in the transition between the tapered bore 8149 and the plunger system wear ring shoulder 8136.

The tapered bore 8149 comprises a seal groove 8152 comprising two side walls 8153 connected by a base 8154. Each side wall 8153 is perpendicular to the bore axis of the flow bore 822 and extends from the surface of the tapered bore 8149 radially away from the bore axis of the flow bore 822. The base 8154 is flat, that is parallel to the bore axis of the flow bore 822. The seal groove 8152 is located from the retainer shoulder 8138 approximately one-half of the longitudinal distance between the retainer shoulder 8138 and the plunger system wear ring shoulder 8136.

The retainer shoulder 8138 is formed by the increase in diameter of the flow bore 822 between the plunger system wear ring section 8137 and the retainer thread section 8139. The retainer shoulder 8138 is perpendicular to the bore axis of the flow bore 822.

The retainer thread section 8139 comprises an internal thread 8200 and a thread relief 866. The internal thread 8200 begins at the back surface 820 and ends at the thread relief 866. The internal thread 8200 is configured to receive external thread 8156 of the retainer 813. The thread relief 866 extends from the retainer shoulder 8138 to the internal thread 8200. The thread relief 866 shown is a typical thread relief but may be similar to thread reliefs 366, 466, or 766.

The retainer 813, shown in FIGS. 137-142, has a generally cylindrical shape. The retainer 813 comprises a front surface 828 and back surface 829 connected by an outer surface 830 and plunger bore 831. The outer surface 830 and plunger bore 831 are concentric and their cylindrical axes are the longitudinal axis of the retainer 813.

The front surface 828 comprises a seal groove 843. The seal groove 843 is circular and concentric with the plunger bore 831. The seal groove 843 is configured to receive the retainer seal 812.

The outer surface 830, as shown in FIG. 139, comprises a dynamic thread section 8201, a dynamic shoulder 8155, a straight section 832 and a tapered section 833. The dynamic thread section 8201 comprises an external thread 8156, and a thread relief 866. The external thread 8156 begins at the front surface 828 and continues along the longitudinal axis until it intersects the thread relief 866. The thread relief 866 extends from the external thread 8156 to the dynamic shoulder 8155. The straight section 832 begins at the dynamic shoulder 8155 and continues along the longitudinal axis until it connects with the tapered section 833. The tapered section 833 extends from the straight section 832 to the back surface 829. The outer surface 830 may further comprise a transition radius 8157 between the straight section 832 and tapered section 833 and a transition radius 8158 between the tapered section 833 and the back surface 829. The thread relief 866 shown is a typical thread relief but may be similar to thread reliefs 366, 466, or 766.

The tapered section 833 comprises a lubrication port 835. The lubrication port 835 is a radial through bore connecting the tapered section 833 of the outer surface 830 to the packing section 840 of the plunger bore 831. The bore axis of the lubrication port 835 may be perpendicular to the tapered face of the tapered section 833. The lubrication port 835 may comprise a threaded section (not shown) adjacent to the outer surface 830 configured to receive a lubrication fitting (not shown) or plug (not shown).

The plunger bore 831 comprises multiple sections, as shown in FIG. 142. Beginning at the front surface 828 and continuing along the longitudinal axis to the back surface 829, the plunger bore 831 comprises the packing section 840, a packing nut shoulder 841, and packing nut threads 842. The packing nut threads 842 comprise internal threads 8159 configured to receive the external threads of the packing nut 816 and a thread relief 866. The thread relief 866 shown is a typical thread relief but may be similar to thread reliefs 366, 466, or 766.

Referring now to FIGS. 140 and 142, the retainer 813 further comprises a plurality of tension bolt holes 844. Each tension bolt hole 844 is a partially threaded through hole originating on the back surface 829 and terminating at the front surface 828. The threaded portion of the tension bolt hole 844 extends from the front surface 828 approximately half the tension bolt hole 844 length to the back surface 829 and is configured to receive a tension bolt 814. The tension bolt holes 844 are distributed evenly on a bolt circle that is concentric with the retainer 813.

Referring now to FIGS. 126-131, the assembly of the multi-piece fluid end 802 begins with the assembly of the plurality of dynamic sections 806. A flow control system wear ring seal 811, a flow control system wear ring 810, a plunger system wear ring seal 809, plunger system wear ring 808, and spacer ring 8129 are installed into the flow bore 822 of each dynamic body 807.

Figure 129:
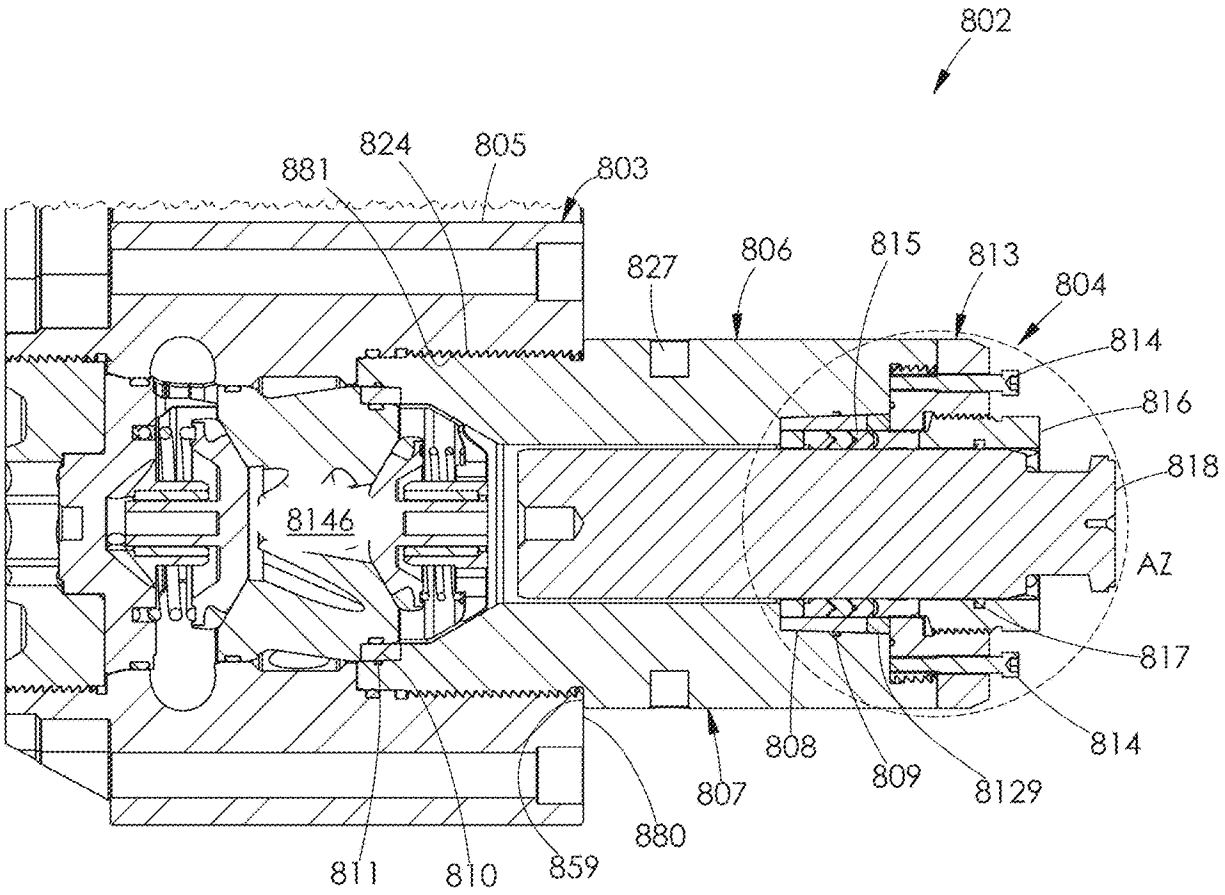

Each dynamic section 806 is then attached to the static section 805 by threading the static threads 824 of the outer surface 821 of the dynamic body 807 into the dynamic threads 881 of the static section 805 until the locating shoulder 859 abuts the back surface 880 of the static section 805, as shown in FIG. 129. A spanner wrench (not shown) may be used to apply the required torque using the spanner wrench holes 827 in the back section 8131 of the outer surface 821 of the dynamic body 807. The applicable components of the flow control system 8146 may now be installed into the sections of the static sections 805 and flow bores 822 of the assembled dynamic bodies 807 configured to receive them.

Referring now to FIG. 130, a retainer seal 812 is installed in the seal groove 843 of the front surface 828 of a retainer 813. Then, the retainer 813 is attached to a dynamic section 806 by threading the external threads 8156 of the dynamic thread section 8201 of the outer surface 830 of the retainer 813 into the internal threads 8200 of the retainer thread section 8139 of the flow bore 822 of the dynamic body 807. Minimal torque is required to make up the engaged external 8156 and internal 8200 threads. As will be described later, the tension bolts 814 provide the necessary tensile load. The joint only needs to be made up tight enough to ensure the retainer seal 812 sufficiently engages the retainer shoulder 8138 of the flow bore 822 of the dynamic body 807.

The plurality of tension bolts 814 are then inserted, on a one-to-one basis, into the tension bolt holes 844 from the back surface 829 of the retainer 813 and threaded into the threaded section of the tension bolt holes 844 until the front surface of each tension bolt 814 contacts the retainer shoulder 8138 of the flow bore 822 of the dynamic body 807. Once contact is made by all tension bolts 814, the tension bolts 814 may be torqued to specification in a piecewise manner.

Next, the packing 815 is inserted into the dynamic section 806 and the packing section 840 of the plunger bore 831 of the retainer 813. Next, the plunger seal 817 is installed in the packing nut 816 and the packing nut 816 is threaded into the packing nut threads 842 of the plunger bore 831 of the retainer 813. Next, the plunger 818 is installed in the packing nut 816, packing 815, and dynamic section 806. Lastly, the packing nut 816 is torqued to specification.

In operation the tension bolts 814 place the threaded joint formed by the internal threads 8200 of the retainer thread section 8139 of the flow bore 822 of the dynamic body 807 and the external threads 8156 of the dynamic thread section 8201 of the outer surface 830 of the retainer 813 in tension providing an additional tensile load above that produced by the torquing of the threads together. This allows for minimal make-up torque by the operator simplifying assembly and disassembly. The additional tensile load also reduces the magnitude of cyclic loading usually produced in the joint by the large pressure fluctuations in the dynamic section 806. This reduction in the magnitude of cyclic loading reduces thread to thread fretting and other issues inherent in the previously encountered full, or nearly full, cyclic loading of the threads. Also, the retainer seal 812 protects the retainer thread section 8139 and dynamic thread section 8201 from contamination when the packing 815 fails. These benefits result in easier and quicker removal of the retainer 813 for maintenance or replacement when necessary.

Referring now to FIGS. 143-175, another embodiment of a multi-piece fluid end 902 is shown. The multi-piece fluid end 902 comprises a fluid end body 903, a plurality of plunger systems 904, and a plurality of flow control systems 9146. The fluid end body 903 comprises a static section 905 and a plurality of dynamic sections 906. Each dynamic section 906 comprises a dynamic body 907, a front plunger system wear ring 908, a plunger system wear ring seal 909, a back plunger system wear ring 9129, a flow control system wear ring 910, and a flow control system wear ring seal 911 as shown in FIGS. 144-148. Each plunger system 904 comprises a plurality of locating dowel pins 9160, a retainer 913, a plurality of studs 9161, a plurality of nuts 9162, packing 915, a packing nut 916, a plunger seal 917, and a plunger 918, as shown in FIGS. 145, 146, 148 and 149.

The dynamic body 907, shown in FIGS. 149-152, has a cylindrical shape. The dynamic body 907 comprises opposing front 919 and back 920 surfaces connected by an outer surface 921 and a flow bore 922. The outer surface 921 and flow bore 922 are concentric and their cylindrical axis is the longitudinal axis of the dynamic body 907.

Referring now to FIG. 152, the outer surface 921 comprises multiple concentric sections. Beginning at the front surface 919 of the dynamic body 907 and continuing along the longitudinal axis to the back surface 920 the outer surface 921 comprises a static seal section 923, static threads 924, locating shoulder 959, and a back section 9131. The back section 9131 comprises a plurality of spanner wrench holes 927. The spanner wrench holes 927 are radial blind bores with a bore axis that is perpendicular to the longitudinal axis of the dynamic body 907. Each spanner wrench hole 927 originates from the back section 9131 of the outer surface 921 but does not intersect the flow bore 922. In this embodiment the spanner wrench holes 927 are proximate the static threads 924, aligned longitudinally, and evenly spaced circumferentially but may be spaced in any manner on the back section 9131 as long as access for the spanner wrench (not shown) is available.

Referring now to FIG. 153, the flow bore 922 also comprises multiple sections and is configured to receive the plunger system wear ring seal 909, front plunger system wear ring 908, back plunger system wear ring 9129, flow control system wear ring seal 911, and flow control system wear ring 910. The flow bore 922 comprises a flow control system wear ring section 9132, a flow control system wear ring shoulder 9133, a flow control system section 9134, a plunger section 9135, a plunger system wear ring shoulder 9136 and a plunger system wear ring section 9137.

The flow control system wear ring section 9132 comprises a tapered bore 9140. The largest diameter of the tapered bore 9140 is at the front surface 919 and the smallest diameter is at the flow control system wear ring shoulder 9133. The taper is complementary to the taper of the outer surface of the flow control system wear ring 910, as shown in FIG. 144. The flow control system wear ring section 9132 may further comprise a front chamfer 9141 to aid in the installation of the flow control system wear ring 910. The flow control system wear ring section 9132 may further comprise a transition radius 9142 at the base of the tapered bore 9140 to reduce stress in the transition between the tapered bore 9140 and the flow control system wear ring shoulder 9133.

The tapered bore 9140 comprises a seal groove 9143 comprising two side walls 9144 connected by a base 9145. Each side wall 9144 is perpendicular to the bore axis of the flow bore 922 and extends from the surface of the tapered bore 9140 radially away from the bore axis of the flow bore 922. The base 9145 is flat, that is parallel to the bore axis of the flow bore 922. The seal groove 9143 is located from the front surface 919 approximately one-half of the longitudinal distance between the front surface 919 and the flow control system wear ring shoulder 9133.

The flow control system wear ring shoulder 9133 is formed by the reduction in diameter of the flow bore 922 between the flow control system wear ring section 9132 and the flow control system section 9134. The flow control system wear ring shoulder 9133 is perpendicular to the bore axis of the flow bore 922.

The flow control system section 9134 comprises a straight portion 9147, that is the bore wall is parallel to the bore axis of the flow bore 922, and a tapered portion 9148. As can be seen in FIG. 144 the flow control system section 9134 is configured to receive particular components of the flow control system 9146. The flow control system section 9134 may further comprise a front chamfer 9206 to aid in the installation of the particular components of the flow control system 9146 and a transition radius 9203 from the straight portion 9147 to the tapered portion 9148.

The plunger section 9135 is also straight and provides a volume for the fluid to enter on the suction stroke of the plunger system 904 and to exit from as the plunger system 904 applies force, generating fluid pressure, on the pressure stroke, as shown in FIG. 144. The plunger section 9135 may further comprise a transition radius 9204 from the flow control system section 9134 and another transition radius 9205 into the plunger system wear ring shoulder 9136.

The plunger system wear ring shoulder 9136 is formed by the increase in diameter of the flow bore 922 between the plunger section 9135 and the plunger system wear ring section 9137. The plunger system wear ring shoulder 9136 is perpendicular to the bore axis of the flow bore 922.

The plunger system wear ring section 9137 comprises a tapered bore 9149. The largest diameter of the tapered bore 9149 is at the back surface 920 and the smallest diameter is at the plunger system wear ring shoulder 9136. The taper is complementary to the taper of the outer surface 9169 of the front plunger system wear ring 908 and the outer surface 9175 of the back plunger system wear ring 9129, ensuring a precise fit, as shown in FIG. 145. The plunger system wear ring section 9137 may further comprise a back chamfer 9150 to aid in the installation of the front plunger system wear ring 908 and back plunger system wear ring 9129. The plunger system wear ring section 9137 may further comprise a transition radius 9151 at the base of the tapered bore 9149 to reduce stress in the transition between the tapered bore 9149 and the plunger system wear ring shoulder 9136. The transition radius 9151 may also be called the root 9151 of the tapered bore 9149.

The tapered bore 9149 comprises a seal groove 9152 comprising two side walls 9153 connected by a base 9154. Each side wall 9153 is perpendicular to the bore axis of the flow bore 922 and extends from the surface of the tapered bore 9149 radially away from the bore axis of the flow bore 922. The base 9154 is flat, that is parallel to the bore axis of the flow bore 922. The seal groove 9152 is located from the back surface 920 approximately one-half of the longitudinal distance between the back surface 920 and the plunger system wear ring shoulder 9136.

Referring now to FIGS. 151 and 152, the back surface 920 comprises a plurality of threaded blind holes 9163 configured to receive the studs 9161. The plurality of threaded blind holes 9163 are arranged in a circular pattern, and equally spaced around the flow bore 922. This embodiment has sixteen threaded blind holes 9163 but may have more or less, may not be arranged in a circular pattern, and may not be equally spaced around the flow bore 922.

Referring now to FIGS. 151 and 153, the back surface 920 may further comprise a plurality of blind holes 9164 configured to receive the locating dowel pins 9160. In this embodiment there are two blind holes 9164 diametrically opposed at approximately the same diameter as the circular pattern of the threaded blind holes 9163 but spaced between them. There may be more or less blind holes 9164 spaced in any manner as long as they do not intersect the threaded blind holes 9163.

The front plunger system wear ring 908, shown in FIGS. 160-163, has an annular shape, with a front 9167 and back surface 9168 connected by an outer 9169 and inner 9170 surface. The front 9167 and back 9168 surfaces are parallel to each other and perpendicular to the longitudinal axis of the front plunger system wear ring 908. The inner surface 9170 is parallel to the longitudinal axis of the front plunger system wear ring 908. The outer surface 9169 is tapered. The taper is complementary to the taper of the tapered bore 9149 of the plunger system wear ring section 9137 of the flow bore 922 of the dynamic body 907, ensuring a precise fit, as shown in FIG. 145. The front plunger system wear ring 908 further comprises a clearance chamfer 9171. The clearance chamfer 9171 is located at the intersection of the front surface 9167 and outer surface 9169. The front plunger system wear ring 908 may further comprise a plurality of small chamfers 9172 at the intersections of the remaining surfaces. These small chamfers 9172, commonly referred to as 'break edges', facilitate safer handling and durability.

The back plunger system wear ring 9129, shown in FIGS. 164-167, has an annular shape, with a front 9173 and back surface 9174 connected by an outer 9175 and inner 9176 surface. The front 9173 and back 9174 surfaces are parallel to each other and perpendicular to the longitudinal axis of the back plunger system wear ring 9129. The inner surface 9176 is parallel to the longitudinal axis of the back plunger system wear ring 9129. The outer surface 9175 is tapered. The taper is complementary to the taper of the tapered bore 9149 of the plunger system wear ring section 9137 of the flow bore 922 of the dynamic body 907, ensuring a precise fit, as shown in FIG. 145. The back plunger system wear ring 9129 further comprises a plurality of clearance chamfers 9177. One clearance chamfer 9177 is located at the intersection of the front surface 9173 and outer surface 9175. A second clearance chamfer 9177 is located at the intersection of the back surface 9174 and inner surface 9176. The back plunger system wear ring 9129 may further comprise a plurality of small chamfers 9172 at the intersections of the remaining surfaces. These small chamfers 9172, commonly referred to as 'break edges', facilitate safer handling and durability.

The retainer 913, shown in FIGS. 154-159, has a generally cylindrical shape. The retainer 913 comprises a front surface 928 and back surface 929 connected by an outer surface 930 and plunger bore 931. The outer surface 930 and plunger bore 931 are concentric and their cylindrical axes are the longitudinal axis of the retainer 913. The retainer 913 further comprises a plurality of stud through holes 9165, a plurality of locating dowel pin through holes 9166, and a lubrication port 935.

The plunger bore 931 comprises multiple sections, as shown in FIG. 157. Beginning at the front surface 928 and continuing along the longitudinal axis to the back surface 929 the plunger bore 931 comprises the packing section 940, a packing nut shoulder 941, and packing nut threads 942. The packing nut threads 942 comprise internal threads 9159 configured to receive the external threads of the packing nut 916 and a thread relief 966. The thread relief 966 shown is a typical thread relief but may be similar to thread reliefs 366, 466, or 766.

Referring now to FIGS. 156 and 158, the stud through holes 9165 have a bore axis that is parallel to the longitudinal axis of the retainer 913 and connect the front 928 and back 929 surfaces. There are the same number of stud through holes 9165, with the same spacing, as the threaded blind holes 9163 in the back surface 920 of the dynamic body 907.

Referring now to FIGS. 156 and 159, the locating dowel pin through holes 9166 have a bore axis that is parallel to the longitudinal axis of the retainer 913 and connect the front 928 and back 929 surfaces. Each locating dowel pin through hole 9166 comprises a counterbore 9202 originating from the front surface 928 and extending approximately twenty-five percent of the total length of the locating dowel pin through hole 9166.

Referring back to FIG. 157, the lubrication port 935 is a radial through bore connecting the outer surface 930 to the packing section 940 of the plunger bore 931. The bore axis of the lubrication port 935 is perpendicular to the longitudinal axis of the retainer 913. The lubrication port 935 may comprise a threaded section 937 adjacent to the outer surface 930 configured to receive a lubrication fitting (not shown) or plug (not shown).

The packing 915 comprises a junk ring 9178, a backup ring 9179, a plurality of V-rings 9180, a front lantern ring 9181, and a back lantern ring 9182, as shown in FIGS. 145 and 149. The junk ring 9178, backup ring 9179, and V-rings 9180 are typical of those used in the industry.

The front lantern ring 9181, shown in FIGS. 168-171, has an annular shape and comprises a front surface 9183 and back surface 9184, which are connected by an outer surface 9185 and inner surface 9186. The front surface 9183 comprises a V-shaped cutout 9187. The V-shaped cutout 9187 is complementary to the V-shaped extrusion of the V-ring 9180 with which the front lantern ring 9181 interfaces. The front 9183 and back 9184 surfaces, excepting the portion of the front surface 9183 that is the V-shaped cutout 9187, are parallel to each other and perpendicular to the longitudinal axis of the front lantern ring 9181. The outer surface 9185 and inner surface 9186 are parallel to the longitudinal axis of the front lantern ring 9181. The front lantern ring 9181 may further comprise a plurality of small chamfers 9172 at the intersection of the back surface 9184 and outer surface 9185 and the intersection of the back surface 9184 and inner surface 9186. These small chamfers 9172, commonly referred to as 'break edges', facilitate safer handling and durability.

The back lantern ring 9182, shown in FIGS. 172-175, has an annular shape and comprises a front surface 9188 and back surface 9189, which are connected by an outer surface 9190 and an inner surface 9191. The front 9188 and back 9189 surfaces are parallel to each other and perpendicular to the longitudinal axis of the back lantern ring 9182.

The outer surface 9190 comprises a front section 9192 and a back section 9193 connected by a transition section 9194. As shown in FIG. 175, the front section 9192 begins at the front surface 9188 and continues parallel to the longitudinal axis of the back lantern ring 9182 until intersecting the transition section 9194. The back section 9193 begins at the back surface 9189 and continues parallel to the longitudinal axis of the back lantern ring 9182 until intersecting the transition section 9194. The front section 9192 has a smaller diameter than the back section 9193. The transition section 9194 connects the smaller diameter front section 9192 to the larger diameter back section 9193 and has a short length along the longitudinal axis of the back lantern ring 9182 causing the transition section 9194 to be angled with the longitudinal axis.

Continuing with FIG. 175, the inner surface 9191 also comprises a front section 9195 and a back section 9196 connected by a transition section 9197. The front section 9195 begins at the front surface 9188 and continues parallel to the longitudinal axis of the back lantern ring 9182 until intersecting the transition section 9197. The back section 9196 begins at the back surface 9189 and continues parallel to the longitudinal axis of the back lantern ring 9182 until intersecting the transition section 9197. The front section 9195 has a larger diameter than the back section 9196. The transition section 9197 connects the larger diameter front section 9195 to the smaller diameter back section 9196 and has a short length along the longitudinal axis of the back lantern ring 9182 causing the transition section 9197 to be angled with the longitudinal axis.

The back lantern ring 9182 further comprises a plurality of lubrication holes 9198. Each lubrication hole 9198 is a through bore connecting the front section 9192 of the outer surface 9190 to the front section 9195 of the inner surface 9191. Each lubrication hole 9198 has a bore axis that is perpendicular to the longitudinal axis of the back lantern ring 9182. In this embodiment there are eight lubrication holes 9198 spaced evenly around the circumference of the back lantern ring 9182. The lubrication holes 9198 are also aligned longitudinally and located approximately at the longitudinal center of the front sections 9192 and 9195 of the outer 9190 and inner 9191 surfaces. There may be more or less lubrication holes 9198, spaced in any manner as long as they connect the front sections 9192 and 9195 of the outer 9190 and inner 9191 surfaces.

The back lantern ring 9182 may further comprise a plurality of small chamfers 9172 at the intersection of all the surfaces 9188, 9189, 9190, and 9191. These small chamfers 9172, commonly referred to as 'break edges', facilitate safer handling and durability.

Referring now to FIGS. 143-149, the assembly of the multi-piece fluid end 902 begins with the assembly of the plurality of dynamic sections 906. Each dynamic section 906 is assembled by first, installing the flow control system wear ring seal 911 into the seal groove 9143 of the tapered bore 9140 of the flow control system wear ring section 9132 of the flow bore 922. Second, inserting the flow control system wear ring 910, back surface 9199 first, into the tapered bore 9140 until the back surface 9199 of the flow control system wear ring 910 contacts the flow control system wear ring shoulder 9133. This may be a press fit. Third, a front plunger system wear ring 908 is inserted, front surface 9167 first, into the tapered bore 9149 of the plunger system wear ring section 9137 of the flow bore 922 of the dynamic body 907 until the front surface 9167 of the front plunger system wear ring 908 contacts the plunger system wear ring shoulder 9136. This may be a slip fit. Fourth, a plunger system wear ring seal 909 is installed in the seal groove 9152 of the tapered bore 9149. Fifth, a back plunger system wear ring 9129 is inserted, front surface 9173 first, into the tapered bore 9149 until the back surface 9174 is flush with the back surface 920 of the dynamic body 907. This may be a press fit. This assembly procedure leaves a predetermined distance between the front surface 9173 of the back plunger system wear ring 9129 and the plunger system wear ring shoulder 9136. That distance is greater than the length of the front plunger system wear ring 908.

Each dynamic section 906 is then attached to the static section 905 by threading the static threads 924 of the outer surface 921 of the dynamic body 907 into the dynamic threads 981 of the static section 905 until the locating shoulder 959 abuts the back surface 980 of the static section 905, as shown in FIG. 146. A spanner wrench (not shown) may be used to apply the required torque using the spanner wrench holes 927 in the back section 9131 of the outer surface 921 of the dynamic body 907. The applicable components of the flow control system 9146 may now be installed into the sections of the static section 905 and flow bores 922 of the assembled dynamic bodies 907 configured to receive them.

Next, the retainer 913 is attached to a dynamic section 906 by first, threading a stud 9161 into each of the threaded blind holes 9163 in the back surface 920 of the dynamic body 907 and torquing to specification. Second, the locating dowel pins 9160 are inserted into the blind holes 9164 in the back surface 920 of the dynamic body 907, as shown in FIG. 149. Third, the retainer 913 is oriented with the front surface 928 facing the back surface 920 of the dynamic body 907 and the stud through holes 9165 and locating dowel pin through holes 9166 aligned with the studs 9161 and locating dowel pins 9160 now protruding from the back surface 920 of the dynamic body 907. Fourth, the front surface 928 of the retainer 913 is moved toward the back surface 920 of the dynamic body 907, while simultaneously inserting the studs 9161 and locating dowel pins 9160 now protruding from the back surface 920 of the dynamic body 907 into the stud through holes 9165 and locating dowel pin through holes 9166 of the retainer 913, until the two surfaces 928 and 920 contact. Fifth, the nuts 9162 are threaded onto the studs 9161 now protruding from the back surface 929 of the retainer 913 and torqued to specification.

Next, the packing 915 is inserted into the dynamic section 906 and the packing section 940 of the plunger bore 931 of the retainer 913. For this embodiment, the components of the packing 915 are inserted in the following order with the V-shaped cutouts 9187 'pointing' toward the back surface 920 of the dynamic body 907 where applicable; junk ring 9178, backup ring 9179, two V-rings 9180, front lantern ring 9181, and back lantern ring 9182.

Next, the plunger seal 917 is installed in the packing nut 916 and the packing nut 916 is threaded into the packing nut threads 942 of the plunger bore 931 of the retainer 913. Next, the plunger 918 is installed in the packing nut 916, packing 915, and dynamic section 906. Lastly, the packing nut 916 is torqued to specification.

Once the assembly is complete the front section 9192 of the outer surface 9190 of the back lantern ring 9182 may extend across the joint formed by the contact between the back surface 9174 of the back plunger system wear ring 9129 and the front surface 928 of the retainer 913. The smaller diameter of the front section 9192 creates a radial clearance between the front section 9192 of the outer surface 9190 of the back lantern ring 9182 and the inner surface 9176 of the back plunger system wear ring 9129 and also the packing section 940 of the plunger bore 931 of the retainer 913 as can be seen in FIG. 145.

In operation the extremely high forces generated by a power end connected to this multi-piece fluid end 902 may cause an axial or radial misalignment of the plunger 918 within the packing 915 and packing nut 916. Any misalignment creates a radial displacement of the plunger 918.

In the prior art the radial displacement creates a bending load on both the one-piece lantern ring and one-piece plunger system wear ring. In the prior art this bending load is transferred to the root of the tapered bore containing the plunger system wear ring resulting in premature failures of the dynamic body.

In this improvement the lantern ring is divided into the front lantern ring 9181 and back lantern ring 9182 and the plunger system wear ring is divided into the front plunger system wear ring 908 and the back plunger system wear ring 9129. Dividing these components reduces the radial displacement of the components, thereby reducing the bending stress at the root 9151 of the tapered bore 9149 of the plunger system wear ring section 9137 of the flow bore 922 of the dynamic body 907.

The reduction in radial displacement is accomplished by the clearance between the front section 9192 of the outer surface 9190 of the back lantern ring 9182 and the inner surface 9176 of the back plunger system wear ring 9129 and also the packing section 940 of the plunger bore 931 of the retainer 913 as can be seen in FIG. 145. Any radial displacement of a plunger 918 will first be 'absorbed' by the clearance preventing contact between the back lantern ring 9182 and the back plunger system wear ring 9129.

If the radial displacement is greater than the clearance provided by the back lantern ring 9182, the front section 9192 of the outer surface 9190 of the back lantern ring 9182 will contact the inner surface 9176 of the back plunger system wear ring 9129. This contact will create a bending stress throughout the back plunger system wear ring 9129. The predetermined distance between the front surface 9173 of the back plunger system wear ring 9129 and the plunger system wear ring shoulder 9136 provides another buffer preventing contact between the back plunger system wear ring 9129 and the front plunger system wear ring 908. The bending stress is transmitted into the dynamic body 907 but not at the root 9151 of the tapered bore 9149.

If the radial displacement of the plunger 918 is large enough to eliminate the clearance of the back lantern ring 9182 and the back plunger system wear ring 9129 such that contact is made with the front plunger system wear ring 908 then a third level of buffer is provided by the loose fit, that is non-press fit, of the front plunger system wear ring 908 into the tapered bore 9149. This loose fit will require even more radial displacement of the plunger 918 before the outer surface 9169 of the front plunger system wear ring 908 contacts the tapered bore 9149 and transmits bending stress to the root 9151 of the tapered bore 9149.

These three levels of clearance, or buffer, essentially decouple the bending stress from the root 9151 of the tapered bore 9149. This decoupling greatly reduces the likelihood of failure of the dynamic body 907 at the root 9151 of the tapered bore 9149 increasing the life and reducing operating costs of the multi-piece fluid end 902.

Referring back to FIGS. 143, 147, and 149, the multi-piece fluid end 902 may further comprise a dual discharge conduit adapter 9207, a single discharge conduit adapter 9208, a discharge conduit plug 9209, and fasteners 9210 to attach each to the static section 905 of the fluid end body 903.

Referring to FIGS. 143, 144 and 147, the static section 905 may further comprise a left surface 9211, right surface 9212, and plurality of flow bores 979 to house the flow control systems 9146 on a one-to-one basis. Each flow bore 979 is concentric with a plunger system 904 and comprises a dynamic thread 981. The static section 905 may further comprise an upper discharge conduit 9213 and a lower discharge conduit 9214. Each discharge conduit 9213, 9214 is a straight bore that is parallel to the transverse axis and intersects the left and right surfaces 9211, 9212. Each discharge conduit 9213, 9214 also partially intersects every flow bore 979. The upper discharge conduit 9213 intersects the top of each flow bore 979 while the lower discharge conduit 2914 intersects the bottom of each flow bore 979.

As can be seen in FIG. 147, the dual discharge conduit adapter 9207, single discharge conduit adapter 9208, and discharge conduit plug 9209 are attached to the static section 905 using fasteners 9210. Depending on the orientation of the high-pressure pump 100 at the well site and the number of high-pressure pumps 100 in use, one or more of each type of discharge conduit adapter 9207, 9208 or discharge conduit plug 9209 may be attached to the static section 905.

In operation pressurized fluid flows from each flow bore 979 into the upper and lower discharge conduits 9213, 9214 then out of the static section 905 through each discharge conduit adapter 9207, 9208. The volume of fluid flowing out of each discharge conduit adapter 9207, 9208 and through each discharge conduit 9213, 9214 is not consistent and depends on many factors such as which discharge conduit adapters 9207, 9208 and/or discharge conduit plugs 9209 are used and the flow restrictions downstream of each conduit adapter 9207, 9208. Furthermore, the flow rate at any point within either discharge conduit 9213, 9214 is also dependent on the number and type of discharge conduit adapters 9207, 9208 and discharge conduit plugs 9209 used.

For example, FIG. 147 shows a dual discharge conduit adapter 9207 attached to the left surface 9211 of the static section 905 such that the flow from both the discharge conduits 9213, 9214 are combined. Further, a single discharge conduit adapter 9208 is attached to the right surface 9212 of the static section 905 to receive only the flow from the upper discharge conduit 9213. Lastly, a discharge conduit plug 9209 blocks flow out of the lower discharge conduit 9214 on the right side of the static section 905. This configuration results in no flow out of the right end of lower discharge conduit 9214 resulting in minimal or erosion of the lower discharge conduit 9214 at that point, however at the left end of the lower discharge conduit 9214 flow will be approximately five times that of the right end because all the fluid must exit at the left end of the lower discharge conduit 9214. This results in higher erosion rates at the end with the greater flow rate. The numerous possible discharge configurations sometimes result in reduced life of the static section 905 due to concentrated flow rates as described above.

Referring now to FIGS. 176-193, another embodiment of a multi-piece fluid end 1002 is shown. The multi-piece fluid end 1002 comprises a fluid end body 1003, a plurality of plunger systems 1004, a plurality of flow control systems 10146, a plurality of discharge conduit adapters 10208, a plurality of discharge manifolds 10215, a plurality of clamps 10216, a plurality of clamp fasteners 10217, a plurality of seal carriers 10218, a plurality of clamp seals 10219, and a plurality of discharge adapter seals 10237.

The fluid end body 1003, shown in FIGS. 176-182, comprises a static section 1005, a plurality of dynamic sections 1006, and a plurality of radial static seals 10220. The static section 1005 comprises a plurality of flow bores 1079. The flow bores 1079 are evenly spaced transversely and centered vertically within the static section 1005. Each flow bore 1079 is a through bore connecting the front and rear surfaces 1099, 1080 of the static section 1005 having a bore axis that is parallel to the longitudinal axis. The flow bores 1079 are configured to receive a portion of the flow control systems 10146 on a one-to-one basis and to facilitate the attachment of the dynamic sections 1006 to the static section 1005 on a one-to-one basis. As shown in FIGS. 178, 181, and 182 each flow bore 1079 comprises a dynamic thread 1081 proximate the rear surface 1080, a thread relief 10221, an entry chamfer 10222, a first straight section 10223, a clearance bevel 10224, a static seal groove 10225, a second straight section 10226, and a static shoulder 10227. Each flow bore 1079 further comprises a discharge section 10228 between the discharge plug seal 10229 and the front fluid routing plug seal 10230 of the flow control system 10146 installed within the flow bore 1079, as shown in FIG. 178.

Referring again to FIGS. 178 and 179, the static section 1005 further comprises a plurality of upper discharge conduits 10213 and a plurality of lower discharge conduits 10214. Each upper discharge conduit 10213 is a through bore that extends from the top surface 10231 of the static section 1005 to the discharge section 10228 of a corresponding flow bore 1079. Each upper discharge conduit 10213 has a vertical bore axis that intersects the bore axis of its respective flow bore 1079 on a one-to-one basis.

The lower discharge conduits 10214 are mirror images of the upper discharge conduits 10213. Each lower discharge conduit 10214 extends from the bottom surface 10232 of the static section 1005 to the discharge section 10228 of its corresponding flow bore 1079.

Each discharge conduit 10213, 10214 comprises a flow section 10233 at its intersection with the flow bore 1079, extending to a counterbore 10234 that includes a seal groove 10235, and further extending to a threaded section 10236 that intersects the respective surface 10231, 10232.

Each dynamic section 1006 comprises a dynamic body 1007, shown in FIGS. 178, 181, and 182. The dynamic body 1007 comprises a front surface 1019 and outer surface 1021.

The outer surface 1021 comprises a static seal section 1023, static threads 1024, and locating shoulder 1059.

Returning to FIG. 180, each flow control system 10146 comprises a discharge plug 10238, a discharge plug insert 10239, a discharge plug seal 10229, a discharge valve 10240, a fluid routing plug 10241, a front fluid routing plug seal 10230, a suction valve 10242, a suction valve guide 10243, and a suction valve guide insert 10244.

The discharge valve 10240, shown in FIGS. 183-185, comprises a stem 10245 and a guide bore 10246. The stem 10245 and guide bore 10246 are concentric and opposed. As shown in FIG. 180, the stem 10245 is configured to be received in the discharge plug insert 10239 and the guide bore 10246 is configured to receive the discharge valve guide 10247 of the fluid routing plug 10241. In this embodiment the stem 10245 is a circular boss and the guide bore 10246 is circular but other cross-sectional shapes may be used.

The fluid routing plug 10241, shown in FIGS. 186-190, comprises a discharge valve guide 10247 and suction valve guide bore 10248. The discharge valve guide 10247 and suction valve guide bore 10248 are concentric and opposed. As shown in FIG. 180, the discharge valve guide 10247 is configured to be received by the guide bore 10246 of the discharge valve 10240. The suction valve guide bore 10248 is configured to receive the guide legs 10249 of the suction valve 10242. In this embodiment the discharge valve guide 10247 is a circular boss and the suction valve guide bore 10248 is circular but other cross-sectional shapes may be used.

The suction valve 10242, shown in FIGS. 191-193, comprises a plurality of guide legs 10249 and a stem 10250. The guide legs 10249 are opposed to the stem 10250 and located entirely within, and spaced evenly around, the circumference of a circle that is concentric with the stem 10250. The circle has a diameter slightly smaller than the diameter of the suction valve guide bore 10248. As shown in FIG. 180, the guide legs 10249 are configured to be received by the suction valve guide bore 10248 and the stem 10250 is configured to be received by the suction valve guide insert 10244. In this embodiment there are four guide legs 10249 but there may be more or less. Also, in this embodiment the stem 10250 is a circular boss but other cross-sectional shapes may be used. Likewise, the placement of the guide legs 10249 may be such that they are located within any cross-section shape.

The discharge conduit adapter 10208, shown in FIGS. 178 and 179, comprises a threaded end 10251 and opposed flanged end 10252. The threaded end 10251 is configured to mate with the threaded sections 10236 of the upper and lower discharge conduits 10213 and 10214. The flanged end 10252 is configured for use in a clamp joint used to connect the discharge manifolds 10215 to the static section 1005. The clamp joint is the type commonly used in the industry for high pressure connections.

The discharge manifold 10215, shown in FIGS. 176-179, comprises a manifold body 10253 a plurality of inlet ports 10254 and a plurality of outlet ports 10255. Each inlet port 10254 comprises a flanged end 10256 configured for use in a clamp joint. The inlet ports 10254 are perpendicular to the manifold body 10253 and spaced so they will be coincident with the discharge conduit adapters 10208 once assembled. The outlet ports 10255 are configured to be connected to high pressure conduits (not shown) which may be attached to the other discharge manifold 10215, or to other discharge manifolds of other fluid ends, or to the wellhead.

Referring now to FIGS. 181 and 182, during assembly of the fluid end 1002, the dynamic sections 1006 must be threaded into the dynamic threads 1081 of the static section 1005. The weight of the dynamic sections 1006, the clearance between the mating dynamic threads 1081 and static threads 1024, and the uneven resistance of the radial static seal 10220 as the static seal section 1023 initially contacts the radial static seal 10220, all contribute to a misalignment between the longitudinal axis of the dynamic body 1007 and the axis of the flow bore 1079. This causes the static seal section 1023 of the outer surface 1021 of the dynamic body 1007 to contact the first straight section 10223 of the flow bore 1079, scarring the static seal section 1023. However, the clearance bevel 10224 does not contact the static seal section 1023. Once the dynamic section 1006 is fully threaded into its operating position, the scarring is outside the contact area of the radial static seal 10220 allowing leak free operation.

Referring now to FIGS. 178 and 180, the assembly of the fluid end 1002 also requires the insertion of the components of the flow control systems 10146 into the flow bores 1079. Once the components are assembled, in each flow bore 1079, the stem 10250 of the suction valve 10242 is inserted in the suction valve guide insert 10244, the guide legs 10249 of the suction valve 10242 are inserted in the suction valve guide bore 10248 of the fluid routing plug 10241, the discharge valve guide 10247 of the fluid routing plug 10241 is inserted in the guide bore 10246 of the discharge valve 10240, and the stem 10245 of the discharge valve 10240 is inserted in the discharge plug insert 10239.

Referring now to FIGS. 176-179, the assembly of the discharge manifolds 10215 to the static section 1005 is as follows. The discharge adapter seals 10237 are inserted in the seal grooves 10235 of the upper and lower discharge conduits 10213 and 10214. Next, the threaded end 10251 of the discharge conduit adapters 10208 are threaded into the threaded sections 10236 of the upper and lower discharge conduits 10213 and 10214. Third, the clamp seals 10219 are installed in the seal carriers 10218 and the seal carriers 10218 are inserted in the flanged ends 10252 of the discharge conduit adapters 10208. Fourth, the flanged ends 10256 of the inlet ports 10254 are placed over the seal carriers 10218. At this point in the assembly the two flanged ends 10252 and 10256 will be in contact. Fifth, the clamps 10216 are placed around the flanged ends 10252 and 10256 and the clamp fasteners 10217 are installed.

Referring now to FIGS. 178 and 180, in operation, the discharge and suction valves 10240 and 10242 alternate between fully open and fully closed positions by moving parallel to the bore axis of the flow bore 1079. At all times, regardless of position, at least a portion of the discharge valve guide 10247 remains inserted in the guide bore 10246 of the discharge valve 10240 and at least a portion of the stem 10245 of the discharge valve 10240 remains inserted in the discharge plug insert 10239. Similarly, at all times and in any position, at least a portion of the guide legs 10249 of the suction valve 10242 remain inserted in the suction valve guide bore 10248 of the fluid routing plug 10241, and at least a portion of the stem 10250 of the suction valve 10242 remains inserted in the suction valve guide insert 10244.

In the prior art, valves only supported on one end, by stems within guide inserts, often experience an axial misalignment between the longitudinal axes of the valves and the longitudinal axes of the fluid routing plug and/or the guide inserts. This misalignment, or drooping, leads to uneven and premature wear of the stems, guide inserts, and sealing faces of the valves. The present improvement, which provides continuous engagement of guide elements at both the front and rear ends of the discharge and suction valves 10240 and 10242, eliminates or significantly reduces axial misalignment, thereby increasing the operational life of the valves 10240 and 10242.

Referring now to FIGS. 178 and 179, during operation, the pressurized fluid exits each flow bore 1079 through the upper or lower discharge conduits 10213 and 10214. The fluid then immediately exits the fluid end body 1003 and enters a discharge manifold 10215 through an inlet port 10254. The resulting pressure within the manifold bodies 10253 is evenly distributed along their length, creating uniform back pressure on each discharge valve 10240 within the fluid end body 1003. This even pressure distribution eliminates the uneven pressure on discharge valves seen in prior art designs, thereby extending the life of the discharge valves 10240.

Referring now to FIGS. 194-202, another embodiment of a multi-piece fluid end 1102 is shown. The multi-piece fluid end 1102 comprises a fluid end body 1103, a plurality of plunger systems 1104, a plurality of flow control systems 11146, a plurality of discharge conduit adapters 11208, a plurality of discharge manifolds 11215, a plurality of hammer union seals 11219, and a plurality of discharge adapter seals 11237.

The fluid end body 1103, shown in FIGS. 194-199, comprises a static section 1105, a plurality of dynamic sections 1106, and a plurality of radial static seals 11220. The static section 1105 comprises a plurality of flow bores 1179. The flow bores 1179 are evenly spaced transversely and centered vertically within the static section 1105. Each flow bore 1179 is a through bore connecting the front and rear surfaces 1199, 1180 of the static section 1105 having a bore axis that is parallel to the longitudinal axis. The flow bores 1179 are configured to receive a portion of the flow control systems 11146 on a one-to-one basis and to facilitate the attachment of the dynamic sections 1106 to the static section 1105 on a one-to-one basis. As shown in FIGS. 196 and 199 each flow bore 1179 comprises a dynamic thread 1181 proximate the rear surface 1180, a thread relief 11221, an entry chamfer 11222, a first straight section 11223, a static seal groove 11225, a second straight section 11226, and a static shoulder 11227. Each flow bore 1179 further comprises a discharge section 11228 between the discharge plug seal 11229 and the front fluid routing plug seal 11230 of the flow control system 11146 installed within the flow bore 1179, as shown in FIGS. 196 and 198. In alternative embodiments the static shoulder 11227 may comprise a groove (not shown) configured to receive a face seal (not shown). The face seal may be used in addition to, or instead of, the radial static seal 11220.

Referring again to FIGS. 196 and 197, the static section 1105 further comprises a plurality of upper discharge conduits 11213 and a plurality of lower discharge conduits 11214. Each upper discharge conduit 11213 is a through bore that extends from the top surface 11231 of the static section 1105 to the discharge section 11228 of a corresponding flow bore 1179. Each upper discharge conduit 11213 has a vertical bore axis that intersects the bore axis of its respective flow bore 1179 on a one-to-one basis.

The lower discharge conduits 11214 are mirror images of the upper discharge conduits 11213. Each lower discharge conduit 11214 extends from the bottom surface 11232 of the static section 1105 to the discharge section 11228 of its corresponding flow bore 1179.

Each discharge conduit 11213, 11214 comprises a flow section 11233 at its intersection with the flow bore 1179, extending to a counterbore 11234 that includes a seal groove 11235, and further extending to a threaded section 11236 that intersects the respective surface 11231, 11232. In alternative embodiments the threaded section 11236 may be omitted, and a bolt pattern may be formed in the top or bottom surface 11231, 11232 around the discharge conduits 11213, 11214 to facilitate the attachment of discharge conduit adapters 11208 configured with a flange for attachment to the static section 1105.

Each dynamic section 1106 comprises a dynamic body 1107, shown in FIGS. 196 and 199. The dynamic body 1107 comprises a front surface 1119 and outer surface 1121. The outer surface 1121 comprises a static seal section 1123, a guide section 11261, static threads 1124, and locating shoulder 1159. The guide section 11261 has a larger diameter than the static seal section 1123 and extends from the static threads 1124 to the static seal section 1123.

Returning to FIG. 198, each flow control system 11146 comprises a discharge plug 11238, a discharge plug insert 11239, a discharge plug seal 11229, a discharge valve 11240, a fluid routing plug 11241, a front fluid routing plug seal 11230, a suction valve 11242, a suction valve guide 11243, and a suction valve guide insert 11244.

The discharge valve 11240, shown in FIGS. 200-202, comprises a stem 11245, a guide bore 11246, a front surface 11257, and a plurality of passages 11258. The stem 11245 and guide bore 11246 are concentric and opposed. As shown in FIG. 198, the stem 11245 is configured to be received in the discharge plug insert 11239 and the guide bore 11246 is configured to receive the discharge valve guide 11247 of the fluid routing plug 11241. In this embodiment the stem 11245 is a circular boss and the guide bore 11246 is circular but other cross-sectional shapes may be used.

The passages 11258 interconnect the guide bore 11246 and the front surface 11257. Specifically, the passages 11258 interconnect that portion of the front surface 11257 that does not contact the fluid routing plug 11241 when the discharge valve 11240 is in the closed position as shown in FIG. 198. In this embodiment there are three linear passages 11258 with circular cross sections spaced evenly around the circumference of the discharge valve 11240. The longitudinal axis of each passage 11258 forms an acute angle with the longitudinal axis of the discharge valve 11240. In alternative embodiments there may be more or less than three passages 11258 and they may not be linear and may have a cross-section that is not circular.

The fluid routing plug 11241, shown in FIG. 198, comprises a discharge valve guide 11247. The discharge valve guide 11247 is configured to be received by the guide bore 11246 of the discharge valve 11240. In this embodiment the discharge valve guide 11247 is a circular boss but other cross-sectional shapes may be used.

The discharge conduit adapter 11208, shown in FIGS. 194-197, comprises a threaded end 11251 and opposed female hammer union end 11252. The threaded end 11251 is configured to mate with the threaded sections 11236 of the upper and lower discharge conduits 11213 and 11214. The female hammer union end 11252 is configured for use in a hammer union joint used to connect the discharge manifolds 11215 to the static section 1105. The hammer union joint is commonly used in the industry for high pressure connections and may be called a hammer wing union or wing joint in some sectors of the industry. In alternative embodiments the threaded end 11251 may be replaced by a bolt on flange (not shown) configured to be attached to the top or bottom surface 11231, 11232 of the static section 1105.

The discharge manifold 11215, shown in FIGS. 194-197, comprises a manifold body 11253 having a plurality of inlet ports 11254, a plurality of outlet ports 11255, a plurality of wing nuts 11259 and a plurality of split retainers 11260. Each inlet port 11254 comprises a male hammer union end 11256 configured for use in a hammer union joint. The inlet ports 11254 are perpendicular to the manifold body 11253 and spaced so they will be coincident with the discharge conduit adapters 11208 once assembled. The outlet ports 11255 are configured to be connected to high pressure conduits (not shown) which may be attached to the other discharge manifold 11215, or to other discharge manifolds of other fluid ends, or to the wellhead.

Referring now to FIG. 199, during assembly of the multi-piece fluid end 1102, the dynamic sections 1106 must be threaded into the dynamic threads 1181 of the static section 1105. The weight of the dynamic sections 1106, the clearance between the mating dynamic threads 1181 and static threads 1124, and the uneven resistance of the radial static seal 11220 as the static seal section 1123 initially contacts the radial static seal 11220, all contribute to a misalignment between the longitudinal axis of the dynamic body 1107 and the axis of the flow bore 1179. This causes the guide section 11261 of the outer surface 1121 of the dynamic body 1107 to contact the first straight section 11223 of the flow bore 1179, scarring the guide section 11261. However, the smaller diameter static seal section 1123 does not contact any portion of the flow bore 1179 thus avoiding any scarring to the static seal section 1123 and allowing leak free operation.

Referring now to FIGS. 196 and 198, the assembly of the multi-piece fluid end 1102 also requires the insertion of the components of the flow control systems 11146 into the flow bores 1179. Once the components are assembled, in each flow bore 1179, the discharge valve guide 11247 of the fluid routing plug 11241 is inserted in the guide bore 11246 of the discharge valve 11240, and the stem 11245 of the discharge valve 11240 is inserted in the discharge plug insert 11239.

Referring to FIGS. 194-197, the assembly of each discharge manifold 11215 must be completed prior to its attachment to the static section 1105. For each inlet port 11254 the following steps are performed: First, a wing nut 11259 is slid onto the male hammer union end 11256 of the inlet port 11254. Next, the components of the split retainer 11260, typically comprising three separate pieces, are positioned around inlet port 11254, encircling it entirely. Once the split retainer 11260 is in place, the wing nut 11259 is slid back down toward the male hammer union end 11256. The split retainer 11260 prevents the wing nut 11259 from sliding completely off the inlet port 11254 and the wing nut 11259 prevents the split retainer from falling off the inlet port 11254. This also allows relative movement between the wing nut 11259 and inlet port 11254. In alternate embodiments the split retainer 11260 may be attached to the inlet port 11254 with a fastener.

The assembly of the discharge manifolds 11215 to the static section 1105 is as follows. First, the discharge adapter seals 11237 are inserted in the seal grooves 11235 of the upper and lower discharge conduits 11213 and 11214. Second, the threaded ends 11251 of the discharge conduit adapters 11208 are threaded into the threaded sections 11236 of the upper and lower discharge conduits 11213 and 11214. Third, the hammer union seals 11219 are installed in the female hammer union ends 11252 of the discharge conduit adapters 11208. Fourth, the male hammer union ends 11256 of the inlet ports 11254 are placed in corresponding female hammer union ends 11252 of the discharge conduit adapters 11208. At this point in the assembly the two hammer union ends 11252 and 11256 will be in contact. Fifth, the internal threads of the wing nuts 11259 are threaded onto the external threads of the female hammer union end 11252 of the discharge conduit adapters 11208. Sixth, a hammer, or other suitable impact tool, is used to tighten each wing nut 11259 securely, ensuring proper engagement and sealing.

Referring now to FIGS. 196 and 198, in operation, any fluid or other material trapped within the guide bore 11246 exits the discharge valve 11240 through the passages 11258 as the discharge valve 11240 is closed. The material is expelled into the annular space 11262 formed by the front surface 11257 of the discharge valve 11240 and the fluid routing plug 11241 when the discharge valve 11240 is closed. In alternative embodiments passages to facilitate the expulsion of trapped material may be included in the discharge valve guide 11247 in addition to, or instead of, the passages 11258 in the discharge valve 11240.

Referring now to FIGS. 203-218, another embodiment of a multi-piece fluid end 1202 is shown. The multi-piece fluid end 1202 comprises a fluid end body 1203, a plurality of plunger systems 1204, a plurality of flow control systems 12146, a plurality of discharge conduit adapters 12208, a plurality of discharge manifolds 12215, a plurality of hammer union seals 12219, a plurality of discharge adapter seals 12237, and a plurality of fasteners 12263.

The fluid end body 1203, shown in FIGS. 203-206 and 208, comprises a static section 1205, a plurality of dynamic sections 1206, and a plurality of axial static seals 12333. The static section 1205 comprises a plurality of flow bores 1279. The flow bores 1279 are evenly spaced transversely and centered vertically within the static section 1205. Each flow bore 1279 is a through bore connecting the front and rear surfaces 1299, 1280 of the static section 1205 having a bore axis that is parallel to the longitudinal axis. The flow bores 1279 are configured to receive a portion of the flow control systems 12146 on a one-to-one basis and to facilitate the attachment of the dynamic sections 1206 to the static section 1205 on a one-to-one basis. As shown in FIGS. 205 and 208 each flow bore 1279 comprises a dynamic thread 1281 proximate the rear surface 1280, a thread relief 12221, an entry chamfer 12222, a straight section 12223, and a static shoulder 12227. The static shoulder 12227 comprises an axial static seal groove 12264. Each flow bore 1279 further comprises a discharge section 12228 between the discharge plug seal 12229 and the front fluid routing plug seal 12230 of the flow control system 12146 installed within the flow bore 1279, as shown in FIG. 207. Each flow bore 1279 further comprises an internal front retainer thread 12317 proximate the front surface 1299. The internal front retainer thread 12317 is configured to receive the front retainer 12315 of the flow control system 12146 and the installation tool 12309 as shown in FIG. 219.

Referring again to FIGS. 205, 206, and 209 the static section 1205 further comprises a plurality of upper discharge conduits 12213 and a plurality of lower discharge conduits 12214. Each upper discharge conduit 12213 is a through bore that extends from the top surface 12231 of the static section 1205 to the discharge section 12228 of a corresponding flow bore 1279. Each upper discharge conduit 12213 has a vertical bore axis that intersects the bore axis of its respective flow bore 1279 on a one-to-one basis.

The lower discharge conduits 12214 are mirror images of the upper discharge conduits 12213. Each lower discharge conduit 12214 extends from the bottom surface 12232 of the static section 1205 to the discharge section 12228 of its corresponding flow bore 1279.

Each discharge conduit 12213, 12214, shown in FIG. 209, comprises a flow section 12233 at its intersection with the flow bore 1279, extending to a counterbore 12234 that intersects the respective top or bottom surface 12231 or 12232. The counterbore 12234 includes a seal groove 12235.

The top and bottom surfaces 12231 and 12232 of the static section 1205 comprise a plurality of blind threaded holes 12265 arranged around each discharge conduit 12213, 12214, as shown in FIG. 209. The blind threaded holes 12265 facilitate the attachment of discharge conduit adapters 12208 to the static section 1205.

Each dynamic section 1206 comprises a dynamic body 1207 and an insert 12307, shown in FIGS. 205, 207 and 208. The dynamic body 1207 comprises a front surface 1219 and outer surface 1221. The outer surface 1221 comprises a nose section 1223, a nose chamfer 12266, static threads 1224, and locating shoulder 1259.

Returning to FIG. 207, each flow control system 12146 comprises a front retainer 12315, a discharge plug 12238, a discharge plug insert 12239, a discharge plug seal 12229, a discharge valve spring 12328, a discharge valve 12240, a fluid routing plug 12241, a front fluid routing plug seal 12230, a rear fluid routing plug seal 12308, a suction valve 12242, a suction valve spring 12306, a suction valve guide 12243, and a suction valve guide insert 12244.

The discharge valve 12240, shown in FIGS. 210-212, comprises a stem 12245, a guide bore 12246, a front surface 12257, and a plurality of passages 12258. The stem 12245 and guide bore 12246 are concentric and opposed. As shown in FIG. 207, the stem 12245 is configured to be received by the discharge plug insert 12239 and the guide bore 12246 is configured to receive the discharge valve guide 12247 of the fluid routing plug 12241.

In this embodiment the stem 12245 is a circular boss and the guide bore 12246 is circular but other cross-sectional shapes may be used. The front surface 12257 comprises the strike face of the valve insert 12267, the strike face 12268, a relief section 12269, and a guide bore section 12270, all of which are concentric with the stem 12245 and guide bore 12246.

The strike face of the valve insert 12267 and strike face 12268 are known in the art. The relief section 12269 is a concave frustoconical section between the strike face 12268 and the guide bore section 12270. The guide bore section 12270 is flat, perpendicular to the longitudinal axis, and provides a surface for the formation of the guide bore 12246.

The passages 12258 interconnect the guide bore 12246 and the relief section 12269. In this embodiment there are three linear passages 12258 with circular cross sections spaced evenly around the circumference of the discharge valve 12240. The longitudinal axis of each passage 12258 forms an acute angle with the longitudinal axis of the discharge valve 12240. In alternative embodiments there may be more or less than three passages 12258 and they may not be linear and may have a cross-section that is not circular.

The fluid routing plug 12241, shown in FIGS. 213-218, comprises a discharge surface 12271, a plurality of discharge fluid passages 12272, and a suction surface 12273. The discharge surface 12271 comprises a discharge seat 12274, a first transition radius 12275, a counterbore 12276, a second transition radius 12277, a central base 12278, and a discharge fluid passage circle 12292.

The discharge seat 12274 is a frustoconical surface forming an acute angle 12279 with the longitudinal axis 12280 of the fluid routing plug 12241, as shown in FIG. 218.

The counterbore 12276 has a bore axis 12281 colinear with the longitudinal axis 12280 and extends from the first transition radius 12275 to the second transition radius 12277. The counterbore 12276 also comprises a radius 12282.

The central base 12278 is also a frustoconical surface forming an acute angle 12283 with the longitudinal axis 12280, as shown in FIG. 218. The central base 12278 extends from the second transition radius 12277 to the center of the discharge surface 12271. The central base 12278 comprises a cylindrical discharge valve guide 12247. The discharge valve guide 12247 is concentric with the longitudinal axis 12280 of the fluid routing plug 12241. As shown in FIG. 205, the discharge valve guide 12247 is configured to be received by the guide bore 12246 of the discharge valve 12240.

The discharge valve guide 12247 is a circular boss that comprises a third transition radius 12284, an outer surface 12285, a front surface 12286, a blind bore 12287, and a plurality of passages 12288. The blind bore 12287 is concentric with the discharge valve guide 12247. The blind bore 12287 comprises a countersink 12289, a counterbore 12290 and a threaded section 12291 configured to receive an externally threaded removal tool (not shown). In this embodiment the discharge valve guide 10247 is a circular boss but other cross-sectional shapes may be used.

The discharge fluid passage circle 12292 is concentric with the longitudinal axis 12280. The radius 12293 of the discharge fluid passage circle 12292 is the distance from the longitudinal axis 12280 of the fluid routing plug 12241 to the point of intersection 12294 between the longitudinal axis 12295 of any discharge fluid passage 12272 and a discharge seat extension line 12296, as shown in FIG. 218. The discharge seat extension line 12296 extends from the discharge seat 12274 at the same acute angle 12279 of the discharge seat 12274 in any cross-sectional view of the discharge seat 12274, as shown in FIG. 218. In this embodiment the radius 12282 of the counterbore 12276 is greater than 30% larger than the radius 12293 of the discharge fluid passage circle 12292.

The passages 12288 interconnect the outer surface 12285 and the threaded section 12291 of the blind bore 12287. In this embodiment there are three linear passages 12288 with circular cross sections spaced evenly around the circumference of the discharge valve guide 12247. The longitudinal axis of each passage 12288 forms an acute angle with the longitudinal axis 12280 of the fluid routing plug 12241. In alternative embodiments there may be more or less than three passages 12288, they may not form an acute angle with the longitudinal axis 12280, may not be linear, and may not have a circular cross-section.

Each discharge fluid passage 12272 comprises a longitudinal axis 12295 forming an acute angle 12332 with the longitudinal axis 12280 of the fluid routing plug 12241, as shown in FIG. 218. Each discharge fluid passage 12272 further comprises a discharge surface section 12297, an intermediate section 12298, and a suction surface section 12299, as shown in FIG. 217. The discharge surface section 12297 comprises a bevel 12300. The suction surface section 12299 begins at the suction surface 12273 and ends at the intermediate section 12298. The intermediate section 12298 begins at the end of the suction surface section 12299 and ends at the discharge surface section 12297. The discharge surface section 12297 begins at the end of the intermediate section 12298 and ends at the discharge surface 12271. The cross-sectional areas of the suction surface section 12299 and the intermediate section 12298 are equal. The cross-sectional area of the discharge surface section 12297 is equal to the cross-sectional area of the of the intermediate section 12298 at the point of transition from the intermediate section 12298 to the discharge surface section 12297 but, due to the bevel 12300, increases until the end of the discharge surface section 12297 at the discharge surface 12271. The cross-sectional area of the discharge surface section 12297 at the discharge surface 12271 is greater than 50% larger than the cross-sectional area of the intermediate section 12298 or the suction surface section 12299.

Each discharge conduit adapter 12208, shown in FIGS. 203-206 and 209 comprises a female hammer union end 12252, a bolt-on flange 12301, a circular boss 12251, and a flow bore 12302.

The bolt-on flange 12301 has the general form of a flat rectangular prism, with a height significantly smaller than its width and depth. The bolt-on flange 12301 comprises a top surface 12303, an opposing and parallel bottom surface 12304, and a plurality of through bores 12305 extending between the top surface 12303 and bottom surface 12304. The through bores 12305 are configured to receive fasteners 12263 and are arranged with the same spacing as the blind threaded holes 12265 on the top and bottom surfaces 12231, 12232 of the static section 1205. Each through bore 12305 has a bore axis perpendicular to the top and bottom surfaces 12303, 12304.

The female hammer union end 12252 extends perpendicularly from the top surface 12303 of the bolt-on flange 12301 and is centered on the top surface 12303. The female hammer union end 12252 is configured for use in a hammer union joint, which connects the discharge manifold 12215 to the static section 1205 via the discharge conduit adapters 12208. This hammer union joint is commonly used in the industry for high pressure connections and may also be referred to as a hammer wing union or wing joint in certain sectors of the industry.

The circular boss 12251 extends perpendicularly from the bottom surface 12304 of the bolt-on flange 12301. It is centered on the bottom surface 12304 and is concentric with the female hammer union end 12252. Each circular boss 12251 is configured to mate with a counterbore 12234 of the upper or lower discharge conduits 12213 and 12214 in the static section 1205.

The flow bore 12302 has a bore axis that is perpendicular to the top and bottom surfaces 12303, 12304 of the bolt-on flange 12301. The bore axis is concentric with both the female hammer union end 12252 and the circular boss 12251.

The discharge manifold 12215, shown in FIGS. 203-206 and 209, comprises a manifold body 12253 having a plurality of inlet ports 12254, a plurality of outlet ports 12255, a plurality of wing nuts 12259 and a plurality of split retainers 12260. Each inlet port 12254 comprises a male hammer union end 12256 configured for use in a hammer union joint. The inlet ports 12254 are perpendicular to the manifold body 12253 and spaced so they will be coincident with the discharge conduit adapters 12208 once assembled. The outlet ports 12255 are configured to be connected to high pressure conduits (not shown) which may be attached to the other discharge manifold 12215, or to other discharge manifolds of other fluid ends, or to the wellhead.

Referring now to FIG. 208, during assembly of the multi-piece fluid end 1202, the dynamic sections 1206 must be threaded into the dynamic threads 1281 of the static section 1205. The weight of the dynamic sections 1206 and the clearance between the mating dynamic threads 1281 and static threads 1224 can cause a misalignment between the longitudinal axis of the dynamic body 1207 and the axis of the flow bore 1279. This misalignment may result in the nose section 1223 of the outer surface 1221 of the dynamic body 1207 contacting the straight section 12223 of the flow bore 1279, potentially scarring the nose section 1223. However, the axial static seal 12301 seals against the front surface 1219 of the dynamic body 1207, rendering any scarring of the outer surface 1221 inconsequential.

Referring now to FIGS. 205 and 207, the assembly of the multi-piece fluid end 1202 also requires the insertion of the components of the flow control systems 12146 into the flow bores 1279. First, the suction valve guide insert 12244 is inserted in the suction valve guide 12243. There may be an interference fit between the suction valve guide insert 12244 and the suction valve guide 12243 to prevent relative motion between the two components during operations. Second, the suction valve guide 12243, with the assembled suction valve guide insert 12244, is installed in the flow bore 1279. Third, the suction valve spring 12306 is inserted in the flow bore 1279. Fourth, the suction valve 12242 is installed in the flow bore 1279, with the stem 12250 being inserted into the suction valve guide insert 12244, thereby trapping the suction valve spring 12306 between the suction valve guide 12243 and the suction valve 12242. Fifth, the front fluid routing plug seal 12230 and the rear fluid routing plug seal 12308 are installed on the fluid routing plug 12241. Sixth, the fluid routing plug 12241 is inserted into the flow bore 1279.

The fits between the rear fluid routing plug seal 12308 and the insert 12307, and between the front fluid routing plug seal 12230 and flow bore 1279, are so tight that a significant force must be applied to the discharge surface 12271 of the fluid routing plug 12241 to install it. The most accessible portion of the discharge surface 12271 is the front surface 12286 of the discharge valve guide 12247. However, applying the required force to the front surface 12286 of the discharge valve guide 12247 will distort the discharge valve guide 12247 rendering it inoperable.

To address this problem an installation tool 12309 is used. Referring to FIGS. 219-223, the installation tool 12309 comprises an anchor 12310 and a push rod 12311. The anchor 12310 is generally shaped like a thin cylinder, with a rim 12312 connected to a hub 12313 by spokes 12314. In this embodiment, there are three spokes 12314, but the number of spokes 12314 may vary. The rim 12312 comprises a threaded outer surface 12316 configured to mate with the internal front retainer threads 12317 of the flow bore 1279.

The hub 12313 is located concentrically within the rim 12312 of the anchor 12310 and is connected to the rim 12312 by the spokes 12314. The hub 12313 comprises a concentric threaded through hole 12318 configured to receive the external threads 12319 of the stem 12320 of the push rod 12311.

The push rod 12311 comprises the stem 12320, the cup 12321 and the nut 12322. The cup 12321 comprises a rear surface 12323, a clearance bore 12324, and a front surface 12325. The rear surface 12323 is configured to contact the central base 12278 of the discharge surface 12271 of the fluid routing plug 12241. Specifically, the rear surface 12323 features a frustoconical surface complementary to the frustoconical surface of the central base 12278, as shown in FIG. 220.

The clearance bore 12324 is a blind bore that is concentric with the stem 12320. It is configured to receive the discharge valve guide 12247 without contacting the outer surface 12285 during the insertion of the fluid routing plug 12241 within the fluid bore 1279.

The stem 12320 is a cylindrical shaft concentric with the cup 12321 and integrally formed on the front surface 12325 of the cup 12321. The stem 12320 extends from the front surface 12325 and comprises an external thread 12319 along its entire length.

The nut 12322 is a standard hex nut with internal threads 12326 configured to thread on the external thread 12319 of the stem 12320.

Prior to use in the assembly of the multi-piece fluid end 1202, a fluid end section, or other fluid end, the installation tool 12309 must be assembled. Referring to FIGS. 221-223, the external threads 12319 of the stem 12320 are first threaded into the threaded through hole 12318 of the hub 12313 until the end of the stem 12320 protrudes from the hub 12313 by more than half the length of the stem 12320. Next, the internal threads 12326 of the nut 12322 are threaded onto the external threads 12319 of the protruding end of the stem 12320 until all the internal threads 12326 are fully engaged with the external threads 12319. Once the nut 12322 is in place, it is welded to the stem 12320. The welds 12327 can best be seen in FIG. 223. As can be seen the anchor 12310 is trapped between the cup 12321 and the nut 12322 of the push rod 12311. This completes the assembly of the installation tool 12309.

Returning now to the assembly of the multi-piece fluid end 1202, specifically to step six, the insertion of the fluid routing plug 12241 into the flow bore 1279, the installation tool 12309 may be used. Referring now to FIG. 220, once the fluid routing plug 12241 has been inserted as far as possible within the flow bore 1279 by hand, the installation tool 12309 may be employed. First, the push rod 12311 is turned until the rear surface 12323 of the cup 12321 abuts the hub 12313 of the anchor 12310. Next, the threaded outer surface 12316 of the rim 12312 of the anchor 12310 is threaded into the internal front retainer threads 12317 of the flow bore 1279. In this embodiment, the anchor 12310 is shown threaded to the full depth of the internal front retainer threads 12317 but may be threaded in until the only the full length of the threaded outer surface 12316 of the rim 12312 engages the internal front retainer threads 12317. Third, using the nut 12322, the push rod 12311 is turned clockwise (assuming right hand threads), extending the cup 12321 from the hub 12313 until the clearance bore 12324 goes over the discharge valve guide 12247 and the rear surface 12323 of the cup 12321 contacts the central base 12278 of the discharge surface 12271 of the fluid routing plug 12241. Once the rear surface 12323 contacts the central base 12278, torsional resistance increases to the point where a wrench or other torsional amplifier must be used to continue turning the push rod 12311 using the nut 12322. As the nut 12322 is turned, the push rod 12311 continues to force the fluid routing plug 12241 into the flow bore 1279 until full insertion is achieved. Once the fluid routing plug 12241 is fully inserted, the push rod 12311 may be retracted by turning the nut 12322 counterclockwise and the anchor 12310 unscrewed from the internal front retainer threads 12317, removing the installation tool 12309 for the continuation of the assembly process.

The remaining components of the flow control system 12146 may now be inserted in the flow bore 1279. Continuing with step seven and referring to FIGS. 205 and 207, the discharge valve 12240 is inserted in the flow bore 1279 with the front surface 12257 first, and the discharge valve guide 12247 of the fluid routing plug 12241 is inserted in the guide bore section 12270 of the front surface 12257. Eighth, the discharge valve spring 12328 is inserted in the flow bore 1279. Ninth, after the discharge plug seal 12229 and discharge plug insert 12239 have been installed in the discharge plug 12238, the assembly is inserted in the flow bore 1279 such that the stem 12245 of the discharge valve 12240 is guided into the discharge plug insert 12239. The discharge valve spring 12328 is now trapped between the discharge valve 12240 and the discharge plug 12238. Finally, the front retainer 12315 is threaded into the internal front retainer threads 12317 and torqued to specification, thus completing the assembly of the flow control system 12146 within the multi-piece fluid end 1202.

Referring to FIGS. 203-206 and 209, the assembly of each discharge manifold 12215 must be completed prior to its attachment to the static section 1205. For each inlet port 12254 the following steps are performed: First, a wing nut 12259 is slid onto the male hammer union end 12256 of the inlet port 12254. Next, the components of the split retainer 12260, typically comprising three separate pieces, are positioned around inlet port 12254, encircling it entirely. Once the split retainer 12260 is in place, the wing nut 12259 is slid back down toward the male hammer union end 12256. The split retainer 12260 prevents the wing nut 12259 from sliding completely off the inlet port 12254, and the wing nut 12259 prevents the split retainer 12260 from falling off the inlet port 12254. This arrangement allows relative movement between the wing nut 12259 and inlet port 12254. In alternate embodiments, the split retainer 12260 may be attached to the inlet port 12254 with a fastener.

The assembly of the discharge manifolds 12215 to the static section 1205 is as follows. First, the discharge adapter seals 12237 are inserted in the seal grooves 12235 of the upper and lower discharge conduits 12213 and 12214. Second, the circular bosses 12251 of the discharge conduit adapters 12208 are inserted into the counterbores 12234 of the upper and lower discharge conduits 12213 and 12214 until the bottom surface 12304 of the bolt-on flange 12301 contacts the top surface 12231 of the static section 1205. Third, the through bores 12305 of each bolt-on flange 12301 are aligned with the blind threaded holes 12265 of the top surface 12231 and bottom surface 12232 of the static section 1205. Fourth, the fasteners 12263 are inserted through the through bores 12305 and torqued into the blind threaded holes 12265 thus securing the discharge conduit adapters 12208 to the static section 1205. Fifth, the hammer union seals 12219 are installed in the female hammer union ends 12252 of the discharge conduit adapters 12208. Sixth, the male hammer union ends 12256 of the inlet ports 12254 are placed in corresponding female hammer union ends 12252 of the discharge conduit adapters 12208. At this point in the assembly the two hammer union ends 12252 and 12256 will be in contact. Seventh, the internal threads of the wing nuts 12259 are threaded onto the external threads of the female hammer union ends 12252 of the discharge conduit adapters 12208. Eighth, a hammer, or other suitable impact tool, is used to tighten each wing nut 12259 securely, ensuring proper engagement and sealing. In this embodiment, each fastener 12263 comprises a stud 12329, a leveling washer 12330, and a flanged nut 12331. In alternative embodiments, the fastener 12263 may omit the leveling washer 12330, use a standard washer, comprise a flanged bolt, or use any other fasteners or fastening systems known in the art.

Referring now to FIGS. 205 and 207, during operation, any fluid or other material trapped within the guide bore 12246 of the discharge valve 12240 or the blind bore 12287 of the discharge valve guide 12247 exits through the passages 12258 and 12288 as the discharge valve 12240 is closed. The material is expelled into the annular space 12262 formed by the front surface 12257 of the discharge valve 12240 and the fluid routing plug 12241 when the discharge valve 12240 is closed. In alternative embodiments only a single set of passages, either 12258 or 12288, may be employed to facilitate the expulsion of trapped material.

Other improvements described herein provide further operational benefits by combining to reduce erosion of the front surface 12257 of the discharge valve 12240 and the discharge surface 12271 of the fluid routing plug 12241. Specifically, as fluid exits the discharge fluid passage 12272, the increased cross-sectional area of the discharge surface section 12297 reduces fluid velocity, thereby reducing erosion around the discharge fluid passage 12272 on the discharge surface 12271 of the fluid routing plug 12241. The reduced velocity also reduces the impact force of the fluid on the front surface 12257 of the discharge valve 12240. Additionally, the acute angle 12332 of the longitudinal axis 12295 of the discharge fluid passages 12272 ensures that fluid is not directly aimed at the discharge valve guide 12247, thereby extending the service life of the fluid routing plug 12241 by reducing the erosion rate of discharge valve guide 12247. Lastly, the relief section 12269 on the front surface 12257 of the discharge valve 12240 provides a smooth flow transition as fluid flows past the front surface 12257 of the discharge valve 12240 into the discharge section 12228 area of the flow bore 1279. These improvements collectively reduce erosion and extend the service life of both the discharge valve 12240 and the fluid routing plug 12241.

Referring now to FIGS. 224-244, another embodiment of a multi-piece fluid end 1302 is shown. The multi-piece fluid end 1302 comprises a fluid end body 1303, a plurality of plunger systems 1304, a plurality of flow control systems 13146, a plurality of discharge conduit adapters 13208, a plurality of discharge manifolds 13215, a plurality of clamps 13216, a plurality of clamp fasteners 13217, a plurality of seal carriers 13218, a plurality of clamp seals 13219, a plurality of discharge adapter seals 13237, and a plurality of fasteners 12263.

The plunger system 1304 depicted in FIGS. 224-244 is largely similar to plunger system 904 shown in FIG. 149, with a single-piece lantern ring. That is, the system 1304 comprises a plunger 1318, bolted on retainer 1313 configured to thread to a packing nut 1316, and various seals making up the packing 1315 (similar to packing 915). These individual items are not repeated here, but an artisan can understand the systems 904 and 1304 to be largely the same.

The fluid end body 1303, shown in FIGS. 224-228 and 230 comprises a static section 1305, a plurality of dynamic sections 1306, a plurality of radial static seals 13220, and a plurality of axial static seals 13333. The static section 1305 comprises a plurality of flow bores 1379. The flow bores 1379 are evenly spaced transversely and centered vertically within the static section 1305. Each flow bore 1379 is a through bore connecting the front and rear surfaces 1399, 1380 of the static section 1305 having a bore axis that is parallel to the longitudinal axis. The flow bores 1379 are configured to receive a portion of the flow control systems 13146 on a one-to-one basis and to facilitate the attachment of the dynamic sections 1306 to the static section 1305 on a one-to-one basis. As shown in FIGS. 226 and 230 each flow bore 1379 comprises a dynamic thread 1381 proximate the rear surface 1380, a thread relief 13221, an entry chamfer 13222, a first straight section 13223, a radial static seal groove 13225, a second straight section 13226, and a static shoulder 13227. The static shoulder 13227 comprises an axial static seal groove 13264. Each flow bore 1379 further comprises a discharge section 13228 between the discharge plug seal 13229 and the front fluid routing plug seal 13230 of the flow control system 13146 installed within the flow bore 1379, as shown in FIG. 229. Each flow bore 1379 further comprises an internal front retainer thread 13317 proximate the front surface 1399. The internal front retainer thread 13317 is configured to receive the front retainer 13315 as shown in FIG. 226.

Referring again to FIGS. 226, 227, and 231 the static section 1305 further comprises a plurality of upper discharge conduits 13213 and a plurality of lower discharge conduits 13214. Each upper discharge conduit 13213 is a through bore that extends from the top surface 13231 of the static section 1305 to the discharge section 13228 of a corresponding flow bore 1379. Each upper discharge conduit 13213 has a vertical bore axis that intersects the bore axis of its respective flow bore 1379 on a one-to-one basis.

The lower discharge conduits 13214 are mirror images of the upper discharge conduits 13213. Each lower discharge conduit 13214 extends from the bottom surface 13232 of the static section 1305 to the discharge section 13228 of its corresponding flow bore 1379.

Each discharge conduit 13213, 13214, shown in FIG. 231, comprises a flow section 13233 at its intersection with the flow bore 1379, extending to a counterbore 13234 that intersects the respective top or bottom surface 13231 or 13232. The counterbore 13234 includes a seal groove 13235.

The top and bottom surfaces 13231 and 13232 of the static section 1305 comprise a plurality of blind threaded holes 13265 arranged around each discharge conduit 13213, 13214, as shown in FIG. 231. The blind threaded holes 13265 facilitate the attachment of discharge conduit adapters 13208 to the static section 1305.

Each dynamic section 1306 comprises a dynamic body 1307 and an insert 13307, shown in FIGS. 226, 229 and 230. The dynamic body 1307 comprises a front surface 1319 and outer surface 1321. The outer surface 1321 comprises a nose chamfer 13266, a radial static seal section 1323, a guide section 13261, static threads 1324, and locating shoulder 1359. The guide section 13261 has a larger diameter than the radial static seal section 1323 and extends from the static threads 1324 to the radial static seal section 1323.

Returning to FIGS. 226, 229, and 232 each flow control system 13146 comprises a front retainer 13315, a discharge plug 13238, a discharge plug insert 13239, a discharge plug seal 13229, a discharge valve spring 13328, a discharge valve 13240, a fluid routing plug 13241, a front fluid routing plug seal 13230, a rear fluid routing plug seal 13308, a suction valve 13242, a suction valve spring 13306, a suction valve guide wear ring 13334, a suction valve guide 13243, and a suction valve guide insert 13244.

The discharge plug 13238, shown in FIGS. 233-236, has a generally cylindrical shape and comprises a front surface 13335, a rear surface 13336, and an outer surface 13337. The front surface 13335 comprises a circular boss 13338 and a blind threaded hole 13339, both concentric with the outer surface 13337. The circular boss 13338 is configured fit within a counterbore 13340 on the rear surface 13341 of the front retainer 13315, as shown in FIG. 229. The blind threaded hole 13339 is configured to receive an assembly tool (not shown).

The outer surface 13337 comprises a large diameter section 13342 connected to a small diameter section 13343 by a tapered section 13344. The small diameter section 13343 comprises a seal groove 13345. As shown in FIG. 232, the large diameter section 13342, tapered section 13344, and small diameter section 13343 are configured to fit closely within the flow bore 1379, and the seal groove 13345 is configured to receive the discharge plug seal 13229.

The rear surface 13336 comprises a circular boss 13346, a blind hole 13347, a plurality of flow cutouts 13348, and a plurality of legs 13349. The circular boss 13346 and blind hole 13347 are concentric with the outer surface 13337. The blind hole 13347 is configured to receive the discharge plug insert 13239.

The discharge plug insert 13239 must be long enough to reduce rotation of the of the discharge valve stem 13245 about the transverse axis. To accommodate this, the circular boss 13346 extends from the rear surface 13336, increasing the depth of the blind hole 13347 so that the entire discharge plug insert 13239 engages the blind hole 13347, as shown in FIG. 229.

In this embodiment there are two flow cutouts 13348 and two legs 13349. Neither the cutouts 13348 nor the legs 13349 extend around the entire circumference of the discharge plug 13238. Each feature extends approximately ninety degrees around the circumference and alternates. Each flow cutout 13348 is parallel to the rear surface 13336 and removes material from the rear surface 13336, resulting in a shorter, or thinner, section of the discharge plug 13238 in that area, as shown in FIGS. 229 and 234.

Each leg 13349 is a cylindrical arc segment that extends circumferentially approximately ninety degrees and longitudinally from the rear surface 13336. The leg 13349 comprises a base section 13350, a nose section 13351, and inner surface 13352, an outer surface 13353, a rear surface 13354, and a wear surface 13355. The base section 13350 extends from the rear surface 13336 of the discharge plug 13238 to the nose section 13351, and the nose section 13351 extends from the base section 13350 to the rear surface 13354 of the leg 13349. The rear surface 13354 of the leg 13349 is perpendicular to the longitudinal axis of the discharge plug 13238 and is configured to engage the discharge surface 13271 of the fluid routing plug 13241 when assembled, as shown in FIG. 232. In this embodiment, the wear surface 13355 is an elastomeric material applied to the inner surface 13352 of the nose section 13351 of the leg 13349. The wear surface 13355 may be cast-in-place, pre-formed, or bonded and does not cover the rear surface 13354 of the leg 13349.

In alternate embodiments, the wear surface 13355 may be a pre-formed elastomeric piece that fits over the leg 13349, covering the inner surface 13352 and outer surface 13353 but not the rear surface 13354 of the leg 13349. In further alternate embodiments, the rear surface 13354 of the leg 13349 may have cutouts, or crenellations, formed to accommodate a pre-formed wear surface 13355 that wraps the inner surface 13352 and outer surface 13353, and the cutout portions of the rear surface 13354 of the leg 13349 still leaving the portions of the rear surface 13354 of the leg 13349 that contact the fluid routing plug 13241 uncovered.

The discharge valve 13240, shown in FIGS. 237-238, comprises a stem 13245 opposite a front surface 13257. The stem 13245 and front surface 13257 are concentric and opposed. As shown in FIG. 229, the stem 13245 is configured to be received by the discharge plug insert 13239.

In this embodiment the stem 13245 is a circular boss but other cross-sectional shapes may be used. The front surface 13257 comprises the strike face of the valve insert 13267, the strike face 13268, a relief section 13269, and a center section 13270, all of which are concentric with the stem 13245.

The strike face of the valve insert 13267 and strike face 13268 are known in the art. The relief section 13269 is a concave frustoconical section between the strike face 13268 and the center section 13270. The center section 13270 is flat and perpendicular to the longitudinal axis of the discharge valve 13240.

The fluid routing plug 13241, shown in FIGS. 239-244, comprises a discharge surface 13271, a plurality of discharge fluid passages 13272, a suction surface 13273, and a plurality of suction passages 13358. The discharge surface 13271 comprises a discharge seat 13274, a first transition radius 13275, a counterbore 13276, a second transition radius 13277, a central base 13278, and a discharge fluid passage circle 13292.

It should be understood that the mechanics of a fluid routing plug, such as fluid routing plug 13241, are generally shown (as to function, not to specific features) in U.S. Pat. No. 11,300,111, issued to Thomas, et. al. Fluid is taken in at an intermediate surface from a suction manifold in response to the retreat of a plunger. The suction valve thus pulls away from the suction surface 13273 and fluid fills the dynamic internal flow bore. The plunger then pushes into the dynamic internal flow bore, forcing the suction valve to cover suction bores in the suction surface. Fluid flows instead through the discharge fluid passages 13272, which are not covered by the suction valve.

Fluid flow through discharge fluid passages 13272 forces a discharge valve away from the discharge surface. High pressure fluid may then leave the fluid end 1302 through discharge manifolds 13215.

The discharge seat 13274 is a frustoconical surface forming an acute angle 13279 with the longitudinal axis 13280 of the fluid routing plug 13241, as shown in FIG. 244.

The counterbore 13276 has a bore axis 13281 colinear with the longitudinal axis 13280 and extends from the first transition radius 13275 to the second transition radius 13277. The counterbore 13276 also comprises a radius 13282.

The central base 13278 is a planar surface that is perpendicular to the longitudinal axis 13280, as shown in FIG. 243. The central base 13278 extends from the second transition radius 13277 to the center of the discharge surface 13271. The central base 13278 comprises a blind bore 13287. The blind bore 13287 is concentric with the counterbore 13276. The blind bore 13287 comprises a countersink 13289 and a threaded section 13291 configured to receive an externally threaded removal tool (not shown).

The discharge fluid passage circle 13292 is concentric with the longitudinal axis 13280. The radius 13293 of the discharge fluid passage circle 13292 is the distance from the longitudinal axis 13280 of the fluid routing plug 13241 to the point of intersection 13294 between the longitudinal axis 13295 of any discharge fluid passage 13272 and a discharge seat extension line 13296, as shown in FIG. 244. The discharge seat extension line 13296 extends from the discharge seat 13274 at the same acute angle 13279 of the discharge seat 13274 in any cross-sectional view of the discharge seat 13274. In this embodiment the radius 13282 of the counterbore 13276 is greater than 30% larger than the radius 13293 of the discharge fluid passage circle 13292.

Each discharge fluid passage 13272 comprises a longitudinal axis 13295 that forms an acute angle 13332 with the longitudinal axis 13280 of the fluid routing plug 13241, as shown in FIG. 244. Each discharge fluid passage 13272 further comprises a suction surface section 13299 and a bevel 13300, as shown in FIG. 243.

The suction surface section 13299 has a constant cross-sectional area and extends from the suction surface 13273 to the bevel 13300. The bevel 13300 extends from the suction surface section 13299 to the discharge surface 13271. The cross-sectional area of the bevel 13300 gradually increases from the suction surface section 13299 until the bevel 13300 intersects the discharge surface 13271. The cross-sectional area of the bevel 13300 at the discharge surface 13271 is greater than 50% larger than the cross-sectional area of the suction surface section 13299.

Each discharge conduit adapter 13208, shown in FIGS. 224-227 and 231 comprises a bolt-on flange 13301, a circular boss 13251, an opposed flanged end 13252, and a flow bore 13302. The flanged end 13252 is configured for use in a clamp joint used to connect the discharge manifolds 13215 to the static section 1305. The clamp joint is the type commonly used in the industry for high pressure connections.

The bolt-on flange 13301 has the general form of a flat rectangular prism, with a height significantly smaller than its width and depth. The bolt-on flange 13301 comprises a top surface 13303, an opposing and parallel bottom surface 13304, and a plurality of through bores 13305 extending between the top surface 13303 and bottom surface 13304. The through bores 13305 are configured to receive fasteners 13263 and are arranged with the same spacing as the blind threaded holes 13265 on the top and bottom surfaces 13231, 13232 of the static section 1305. Each through bore 13305 has a bore axis perpendicular to the top and bottom surfaces 13303, 13304.

The circular boss 13251 extends perpendicularly from the bottom surface 13304 of the bolt-on flange 13301. It is centered on the bottom surface 13304 and is concentric with the flanged end 13252. Each circular boss 13251 is configured to mate with a counterbore 13234 of the upper or lower discharge conduits 13213 and 13214 in the static section 1305.

The flow bore 13302 has a bore axis that is perpendicular to the top and bottom surfaces 13303, 13304 of the bolt-on flange 13301. The bore axis is concentric with both the flanged end 13252 and the circular boss 13251.

The discharge manifold 13215, shown in FIGS. 224-227, and 231, comprises a manifold body 13253, a plurality of inlet ports 13254 and a plurality of outlet ports 13255. Each inlet port 13254 comprises a flanged end 13256 configured for use in a clamp joint. The inlet ports 13254 are perpendicular to the manifold body 13253 and spaced so they will be coincident with the discharge conduit adapters 13208 once assembled. The outlet ports 13255 are configured to be connected to high pressure conduits (not shown) which may be attached to the other discharge manifold 13215, or to other discharge manifolds of other fluid ends, or to the wellhead.

Referring now to FIGS. 229 and 230, during assembly of the multi-piece fluid end 1302, the dynamic sections 1306 must be threaded into the dynamic threads 1381 of the static section 1305. The weight of the dynamic sections 1306, the clearance between the mating dynamic threads 1381 and static threads 1324, and the uneven resistance of the radial static seal 13220 as the radial static seal section 1323 initially contacts the radial static seal 13220, all contribute to a misalignment between the longitudinal axis of the dynamic body 1307 and the axis of the flow bore 1379. This causes the guide section 13261 of the outer surface 1321 of the dynamic body 1307 to contact the first straight section 13223 of the flow bore 1379, scarring the guide section 13261. However, the smaller diameter radial static seal section 1323 does not contact any portion of the flow bore 1379 thus avoiding any scarring to the radial static seal section 1323 and allowing leak free operation. Additionally, the axial static seal 13333 seals against the front surface 1319 of the dynamic body 1307 providing a safeguard in case the radial static seal 13220 does fail.

Referring now to FIGS. 226, 228, 229, and 232, the assembly of the multi-piece fluid end 1302 also requires the insertion of the components of the flow control systems 13146 into the flow bores 1379. First, the suction valve guide insert 13244 is inserted in the suction valve guide 13243. There may be an interference fit between the suction valve guide insert 13244 and the suction valve guide 13243 to prevent relative motion between the two components during operation. Second, the suction valve guide 13243, with the assembled suction valve guide insert 13244, is installed in the flow bore 1379. Third, the suction valve guide wear ring 13334 is installed in the flow bore 1379 abutting the suction valve guide 13243. Fourth, the suction valve spring 13306 is inserted in the flow bore 1379. Fifth, the suction valve 13242 is installed in the flow bore 1379, with the stem 13250 being inserted into the suction valve guide insert 13244, thereby trapping the suction valve spring 13306 between the suction valve guide 13243 and the suction valve 13242. Sixth, the front fluid routing plug seal 13230 and the rear fluid routing plug seal 13308 are installed on the fluid routing plug 13241. Seventh, the fluid routing plug 13241 is inserted into the flow bore 1379.

The fluid routing plug 13241 may be inserted in the flow bore 1379 using the installation tool 12309. However, since the fluid routing plug 13241 does not have the discharge valve guide 12247 feature of fluid routing plug 12241, a cylindrical shaft (not shown) with a diameter larger than the blind bore 13287 and smaller than counterbore 13276 may be used apply force to the central base 13278 for insertion of the fluid routing plug 13241. A removal tool (not shown) with a threaded end may be threaded into the threaded section 13291 of the blind bore 13287 and used to apply the force necessary to remove the fluid routing plug 13241 from the flow bore 1379 when necessary.

The remaining components of the flow control system 13146 may now be inserted in the flow bore 1379. Continuing with step eight and referring to FIGS. 226-229, and 232, the discharge valve 13240 is inserted in the flow bore 1379 with the front surface 13257 first. Ninth, the discharge valve spring 13328 is inserted in the flow bore 1379. Tenth, after the discharge plug seal 13229 and discharge plug insert 13239 have been installed in the discharge plug 13238, the assembly is inserted in the flow bore 1379 such that the stem 13245 of the discharge valve 13240 is guided into the discharge plug insert 12339. The discharge plug 13238 is inserted until the rear surfaces 13354 of the legs 13349 contact the fluid routing plug 13241. The discharge valve spring 13328 is now trapped between the discharge valve 13240 and the discharge plug 13238. Finally, the front retainer 13315 is threaded into the internal front retainer threads 13317 and torqued to specification, thus completing the assembly of the flow control system 13146 within the multi-piece fluid end 1302.

Referring now to FIGS. 224-227, and 231, the assembly of the discharge manifolds 13215 to the static section 1305 is as follows. First, the discharge adapter seals 13237 are inserted in the seal grooves 13235 of the upper and lower discharge conduits 13213 and 13214. Second, the circular bosses 13251 of the discharge conduit adapters 13208 are inserted into the counterbores 13234 of the upper and lower discharge conduits 13213 and 13214 until the bottom surface 13304 of the bolt-on flange 13301 contacts the top surface 13231 of the static section 1305. Third, the through bores 13305 of each bolt-on flange 13301 are aligned with the blind threaded holes 13265 of the top surface 13231 and bottom surface 13232 of the static section 1305. Fourth, the fasteners 13263 are inserted through the through bores 13305 and torqued into the blind threaded holes 13265 thus securing the discharge conduit adapters 13208 to the static section 1305. Fifth, the clamp seals 13219 are installed in the seal carriers 13218 and the seal carriers 13218 are inserted in the flanged ends 13252 of the discharge conduit adapters 13208. Sixth, the flanged ends 13256 of the inlet ports 13254 are placed over the seal carriers 13218. At this point in the assembly the two flanged ends 13252 and 13256 will be in contact. Seventh, the clamps 13216 are placed around the flanged ends 13252 and 13256 and the clamp fasteners 13217 are installed. In this embodiment, each fastener 13263 comprises a stud 13329, a leveling washer 13330, and a flanged nut 13331. In alternative embodiments, the fastener 13263 may omit the leveling washer 13330, use a standard washer, comprise a flanged bolt, or use any other fasteners or fastening systems known in the art.

Referring now to FIGS. 228 and 232, for illustration purposes only, both the suction valve 13242 and discharge valve 13240 are shown in the open position. During operation, as the plunger 1318 retracts, the suction valve 13242 opens, allowing fluid to enter the flow bore 1379 by passing between the suction surface 13273 of the fluid routing plug 13241 and the suction valve 13242. The fluid flow is represented by arrows 13356. The fluid then impacts the suction valve guide wear ring 13334 as it enters the flow bore 1379.

The suction valve guide wear ring 13334 comprises a harder material than the suction valve guide 13243 or the dynamic body 1307, protecting both from erosion. The increased hardness of the suction valve guide wear ring 13334 results in longer maintenance intervals and allows for the replacement of only the suction valve guide wear ring 13334 if required, reducing the cost of operation.

In an alternate embodiment the suction valve guide wear ring 13334 may comprise a material that is not harder than the suction valve guide 13243. In this alternate embodiment, the suction valve guide wear ring 13334 primarily serves as a sacrificial element, absorbing erosion rather than preventing it, thereby still providing protection for the suction valve guide 13243 and dynamic body 1307.

As the plunger 1318 extends, the suction valve 13242 closes and the discharge valve 13240 opens. Fluid flows out of the bevel 13300 of the discharge fluid passage 13272 of the fluid routing plug 13241, impacting the relief section 13269 of the front surface 13257 of the discharge valve 13240, then flowing between the discharge surface 13271 of the fluid routing plug 13241 and the front surface 13257 of the discharge valve 13240. The fluid then impacts the wear surface 13355 of the leg 13349 of the discharge plug 12238. The fluid flow is represented by arrows 13357.

As fluid exits the discharge fluid passage 13272, the increased cross-sectional area of the bevel 13300 reduces fluid velocity, thereby reducing erosion around the bevel 13300 on the discharge surface 13271 of the fluid routing plug 13241. The reduced velocity also decreases the impact force of the fluid on the front surface 13257 of the discharge valve 13240. The relief section 13269 on the front surface 13257 of the discharge valve 13240 provides a smooth flow transition as fluid flows along the front surface 13257 of the discharge valve 13240.

The wear surface 13355 comprises a material that reduces erosion and/or functions as a sacrificial element, thereby increasing the life of the leg 13349 and, consequently, the discharge plug 13238. This results in extended maintenance intervals and reduced operational cost. If the wear surface 13355 is an embodiment configured for replacement, maintenance costs are further reduced by allowing only the wear surface 13355 to replaced.

Referring now to FIGS. 245-262, another embodiment of a fluid end section 1478 is shown. This embodiment implements a series of improvements directed specifically at reducing the high stress concentrations occurring at the transition radius 14142 at the base of the tapered bore 14140. These improvements include a two-piece flow control system wear ring assembly, selective application of press fits, and modified geometries of key mating features. Each improvement is intended to either reduce the magnitude of operational forces transmitted to the transition radius 14142, alter the direction or distribution of those forces, or isolate the transition radius 14142 from direct loading altogether.

The fluid end section 1478 comprises a fluid end body 1403, a plunger system 1404, and a flow control system 14146. The fluid end body 1403 comprises a static section 1405, a dynamic section 1406, a radial static seal 14220, and an axial static seal 14333. The axial static seal 14333, shown in FIGS. 247 and 248, is an X-ring, also known as a quad seal.

The static section 1405 comprises a front surface 1499, rear surface 1480, and flow bore 1479. The flow bore 1479 centered transversely and vertically within the static section 1405. The flow bore 1479 is a through bore connecting the front and rear surfaces 1499, 1480 of the static section 1405 having a bore axis that is parallel to the longitudinal axis. The flow bore 1479 is configured to receive a portion of the flow control system 14146 and to facilitate the attachment of the dynamic section 1406 to the static section 1405. As shown in FIGS. 247 and 248 the flow bore 1479 comprises a dynamic thread 1481 proximate the rear surface 1480, a radial static seal groove 14225, and a static shoulder 14227. The static shoulder 14227 comprises an axial static seal groove 14264. The flow bore 1479 further comprises internal front retainer thread 14317 proximate the front surface 1499. The internal front retainer thread 14317 is configured to receive the front retainer 14315 as shown in FIG. 247.

The dynamic section 1406 comprises a dynamic body 1407, a front plunger system wear ring 1408, a plunger system wear ring seal 1409, a rear plunger system wear ring 14129, a front flow control system wear ring 1410, and rear flow control system wear ring 14359 as shown in FIGS. 245-248.

The dynamic body 1407, shown in FIGS. 260-262, has a cylindrical shape. The dynamic body 1407 comprises opposing front 1419 and rear 1420 surfaces connected by an outer surface 1421 and a flow bore 1422. The outer surface 1421 and flow bore 1422 are concentric and their cylindrical axis is the longitudinal axis of the dynamic body 1407.

Referring now to FIG. 260, the outer surface 1421 of the dynamic body 1407 comprises multiple concentric sections. Beginning at the front surface 1419 of the dynamic body 1407 and continuing along the longitudinal axis to the rear surface 1420 the outer surface 1421 comprises a static seal section 1423, static threads 1424, shoulder 1459, and a rear section 14131. The shoulder 1459 is not a locating shoulder as shown in previous embodiments such as 359, 459, 859, 959, 1059, 1159, 1259, and 1359. Instead, shoulder 1459 only exists because of the increase in wall thickness of the dynamic body 1407 between the static threads 1424 and the rear section 14131. As can be seen in FIG. 247, the shoulder 1459 does not contact the static section 1405 when assembled and has no involvement in the axial location of the dynamic body 1407 relative to the static section 1405.

The rear section 14131 comprises a plurality of spanner wrench holes 1427. The spanner wrench holes 1427 are radial blind bores with a bore axis that is perpendicular to the longitudinal axis of the dynamic body 1407. Each spanner wrench hole 1427 originates from the rear section 14131 of the outer surface 1421 but does not intersect the flow bore 1422. In this embodiment the spanner wrench holes 1427 are proximate the static threads 1424, aligned longitudinally, and evenly spaced circumferentially but may be spaced in any manner on the rear section 14131 as long as access for the spanner wrench (not shown) is available.

Referring now to FIG. 261, the flow bore 1422 also comprises multiple sections and is configured to receive the plunger system wear ring seal 1409, front plunger system wear ring 1408, rear plunger system wear ring 14129, front flow control system wear ring 1410, and rear flow control system wear ring 14359. The flow bore 1422 comprises a flow control system wear ring section 14132, a flow control system wear ring shoulder 14133, a flow control system section 14134, a plunger section 14135, a plunger system wear ring shoulder 14136 and a plunger system wear ring section 14137.

The flow control system wear ring section 14132 comprises a tapered bore 14140. The largest diameter of the tapered bore 14140 is at the front surface 1419 and the smallest diameter is at the flow control system wear ring shoulder 14133. The taper is complementary to the taper of the outer surface 14367 of the front flow control system wear ring 1410, as shown in FIG. 248. The flow control system wear ring section 14132 may further comprise a front chamfer 14141 to aid in the installation of the flow control system wear rings 1410 and 14359. The flow control system wear ring section 14132 may further comprise a transition radius 14142 at the base of the tapered bore 14140 to reduce stress in the transition between the tapered bore 14140 and the flow control system wear ring shoulder 14133 as shown in FIG. 262.

The flow control system wear ring shoulder 14133 is formed by the reduction in diameter of the flow bore 1422 between the flow control system wear ring section 14132 and the flow control system section 14134. The flow control system wear ring shoulder 14133 is not perpendicular to the bore axis of the flow bore 1422. Instead, the flow control system wear ring shoulder 14133 is angled slightly relative to a plane that is perpendicular to the longitudinal axis-sloping rearward, away from the front surface 1419 of the dynamic body 1407. As shown in FIGS. 249 and 262, the angle 14376 of the flow control system wear ring shoulder 14133 may be between greater than 0.0 degrees to 2.0 degrees from perpendicular, or from less than 90.0 degrees to 88.0 degrees relative to the longitudinal axis.

The rear flow control system wear ring 14359, shown in FIGS. 254-257 and 259, has an annular shape, with a front 14360 and rear surface 14361 connected by an outer 14362 and inner 14363 surface. The front 14360 and rear 14361 surfaces are parallel to each other and perpendicular to the longitudinal axis of the rear flow control system wear ring 14359. The inner surface 14363 is parallel to the longitudinal axis of the rear flow control system wear ring 14359. The outer surface 14362 is tapered. The taper is complementary to the taper of the tapered bore 14140 of the flow control system wear ring section 14132 of the flow bore 1422 of the dynamic body 1407, as shown in FIG. 249. The rear flow control system wear ring 14359 further comprises a radius 14364. The radius 14364 is located at the intersection of the rear surface 14361 and outer surface 14362. The radius 14364 is complementary to or slightly larger than the transition radius 14142 at the base of the tapered bore 14140. The rear flow control system wear ring 14359 may further comprise a plurality of small chamfers 14365 at the intersections of the remaining surfaces. These small chamfers 14365, commonly referred to as 'break edges', facilitate safer handling and durability.

The front flow control system wear ring 1410, shown in FIGS. 250-253 and 258 has an annular shape, with a front 14366 and rear surface 14199 connected by an outer 14367 and inner 14368 surface. The front 14366 and rear 14199 surfaces are parallel to each other and perpendicular to the longitudinal axis of the front flow control system wear ring 1410. The inner surface 14368 is parallel to the longitudinal axis of the front flow control system wear ring 1410. The outer surface 14367 is tapered. The taper is complementary to the taper of the tapered bore 14140 of the flow control system wear ring section 14132 of the flow bore 1422 of the dynamic body 1407, as shown in FIG. 248.

The front flow control system wear ring 1410 further comprises an insertion relief 14369 formed at the intersection of the front surface 14366 and inner surface 14368 comprising a first radius 14370, a straight section 14371, and a second radius 14372. The first radius 14370 transitions from the front surface 14366 to the straight section 14371. The straight section 14371 may form and angle 14398 relative to the longitudinal axis with the end farthest from the longitudinal axis connecting tangentially to the first radius 14370 and the end closest to the longitudinal axis connected tangentially to the second radius 14372. The angle 14398 may be 15-25 degrees as shown in FIG. 258. The second radius 14372 transitions from the straight section 14371 to the inner surface 14368.

The front flow control system wear ring 1410 further comprises a third radius 14373 at the transition between the front surface 14366 and the outer surface 14367. The third radius 14373 is tangential to both surfaces 14366 and 14367.

The front flow control system wear ring 1410 further comprises a plurality of chamfers. A first chamfer 14374 transitions from the outer surface 14367 to the rear surface 14199 and a second chamfer 14375 transitions from the rear surface 14199 to the inner surface 14368.

The flow control system 14146 comprises a fluid routing plug 14241, front fluid routing plug seal 14230, rear fluid routing plug seal 14308, and front retainer 14315.

Referring now to FIGS. 245-249, the assembly of the fluid end section 1478 begins with the assembly of the dynamic section 1406. The dynamic section 1406 is assembled by first, inserting the rear flow control system wear ring 14359, rear surface 14361 first, into the tapered bore 14140 until the rear surface 14361 of the rear flow control system wear ring 14359 contacts the flow control system wear ring shoulder 14133. This may be a line-to-line to a light press fit, that is an interference fit of 0.000 to 0.002 inches diametrically. Second, the front flow control system wear ring 1410 is inserted, rear surface 14199 first, into the tapered bore 14140 of the flow control system wear ring section 14132 of the flow bore 1422 of the dynamic body 1407 until the rear surface 14199 of the front flow control system wear ring 1410 contacts the front surface 14360 of the rear flow control system wear ring 14359. This may be a heavy press fit, that is an interference fit of 0.008 to 0.010 inches diametrically. Third, the plunger system wear ring seal 1409, front plunger system wear ring 1408, and rear plunger system wear ring 14129 are installed in the plunger system wear ring section 14137 of the flow bore 1422 completing the assembly of the dynamic section 1406.

Prior to attaching the dynamic section 1406 to the static section 1405 the radial static seal 14220 is installed in the radial static seal groove 14225 of the flow bore 1479 of the static section 1405 and the axial static seal 14333 is installed in the axial static seal groove 14264 of the static shoulder 14227 of the flow bore 1479.

The dynamic section 1406 is then attached to the static section 1405 by threading the static threads 1424 of the outer surface 1421 of the dynamic body 1407 into the dynamic threads 1481 of the static section 1405 until the front surface 1419 of the dynamic body 1407 abuts the static shoulder 14227 of the flow bore 1479 of the static section 1405, as shown in FIGS. 247-248. A spanner wrench (not shown) may be used to apply the required torque using the spanner wrench holes 1427 in the rear section 14131 of the outer surface 1421 of the dynamic body 1407.

The components of the flow control system 14146 may now be installed into the flow bore 1479 of the static section 1405 and flow bore 1422 of the assembled dynamic body 1407. While the flow control system 14146 includes additional components, the following description focuses on the installation of the fluid routing plug 14241. After the front and rear fluid routing plug seals 14230 and 14308 are installed onto the fluid routing plug 14241, the fluid routing plug 14241 is inserted into the front flow control system wear ring 1410 until the front surface 1419 of the dynamic body 1407 contacts the fluid routing plug 14241. The insertion relief 14369 facilitates the insertion process and reduces the risk of damaging the rear fluid routing plug seal 14308. The remaining components not already installed, and installation of the flow control system 14146 is completed by threading the front retainer 14315 into the internal front retainer thread 14317 of the flow bore 1479.

Finally, the plunger system 1404 is assembled to the dynamic section 1406 completing the assembly of the fluid end section 1478. As described in earlier embodiment 400, and shown in FIGS. 54 and 55, a plurality of fluid end sections 1478 may be assembled to form a fluid end which may then be connected to a power end to form a high-pressure pump.

In operation, the extremely high pressures created within a fluid end assembled from a plurality of these fluid end sections 1478 creates a corresponding large force on the fluid routing plug 14241. While the force is primarily along the longitudinal axis there are also radial components to the force. This force is transferred to the front flow control system wear ring 1410, rear flow control system wear ring 14359, tapered bore 14140, transition radius 14142, flow control system wear ring shoulder 14133, and finally the threaded joint formed between the dynamic threads 1481 and static threads 1424. Of these, the transition radius 14142 experiences the highest stress concentration and is the most likely point of failure.

This embodiment 1478 incorporates multiple improvements intended to eliminate the transition radius 14142 as the most likely point of failure. These improvements either reduce the magnitude of the force applied at the transition radius 14142, whether in whole or in one or more directional components, such as radial or longitudinal, or by enhancing the ability of the transition radius 14142 to withstand the applied force.

One improvement is the implementation of a two-piece wear ring assembly comprising a front flow control system wear ring 1410 and a rear flow control system wear ring 14359. The front flow control system wear ring 1410 is installed into the tapered bore 14140 using a heavy press fit, typically a diametrical interference of 0.008 to 0.010 inches. This press fit ensures the front flow control system wear ring 1410 remains securely seated during operation and generates substantial compressive residual hoop stresses in the surrounding material of the dynamic body 1407. Because the front flow control system wear ring 1410 is not inserted fully into the tapered bore 14140, the stresses associated with the heavy press fit are not transferred, or only minimally transferred, to the transition radius 14142.

A complementary improvement is the light press fit of the rear flow control system wear ring 14359, typically with a diametrical interference of 0.000 to 0.002 inches. This fit provides sufficient axial retention while avoiding the introduction of substantial residual stresses in the transition radius 14142.

Another improvement is the radius 14364 on the rear flow control system wear ring 14359. This radius 14364 is designed to be complementary to, or slightly larger than, the transition radius 14142 at the base of the tapered bore 14140. The resulting conformal interface ensures continuous surface contact rather than point contact, distributing applied loads more evenly, increasing the load bearing area, reducing stress risers, and lowering the risk of localized yielding or cracking. This geometry improves the smoothness of the load path and enhances the load-carrying capacity of the transition interface.

An additional improvement is the angled face of the flow control system wear ring shoulder 14133. The flow control system wear ring shoulder 14133 is formed such that initial axial force is applied at a location radially spaced from the transition radius 14142, specifically, adjacent the inner diameter of the flow control system wear ring shoulder 14133. As axial load increases during operation, localized elastic or plastic deformation of the angled shoulder face occurs, allowing the load to gradually distribute across a broader portion of the flow control system wear ring shoulder 14133 radially towards the transition radius 14142. This progressive engagement delays direct force transfer near the transition radius 14142 and promotes a more uniform load path, reducing peak stresses at the transition radius 14142 and improving the fatigue resistance.

Collectively, these improvements in fluid end section 1478 significantly reduce the peak stresses experienced at the transition radius 14142 during operation. The combination of controlled press fits, conformal interfaces, and modified geometries results in a more robust and durable fluid end assembly. Variations and alternative embodiments of these features are discussed in the following sections.

There are a number of alternative configurations that may be implemented either instead of, or in addition to, the specific improvements already described. One such variation relates to how a lighter press fit may be achieved for the rear flow control system wear ring 14359. For example, if the outer surface 14362 of the rear flow control system wear ring 14359 is tapered at a slightly different angle than the tapered bore 14140, a progressive interference fit may be created. In this case, the outer surface 14362 of the rear flow control system wear ring 14359 may be dimensioned to match the tapered bore 14140 at its rear surface 14361, then gradually increase in diameter at a greater rate than the tapered bore 14140 toward the front surface 14360. This results in minimal or zero interference at initial insertion, followed by a light interference fit as the rear flow control system wear ring 14359 is fully seated, thereby facilitating controlled positioning while avoiding substantial residual stresses near the transition radius 14142. Alternatively, the same progressive interference fit may be achieved by instead modifying the geometry of the tapered bore 14140 such that its diameter decreases at a slower rate along the axial direction. This shallower taper results in a lower interference fit near the rear surface 14361 and a gradually increasing interference fit toward the front surface 14360 once the rear flow control system wear ring 14359 is fully installed, thereby producing a progressive interference profile across its axial length.

Another alternative involves giving the rear flow control system wear ring 14359 a straight outer surface 14362, that is parallel to the longitudinal axis of the rear flow control system wear ring 14359, combined with a corresponding straight counterbore in the dynamic body 1407. This configuration provides a uniform, light interference fit along the axial length of the engagement. Unlike a tapered interface, which may release suddenly under axial displacement, a straight fit offers consistent holding capability while reducing the risk of transferring residual stress to the transition radius 14142.

Another alternative design involves configuring the flow control system wear ring shoulder 14133 to be perpendicular to the longitudinal axis of the fluid end section 1478. This geometry causes the full face of the flow control system wear ring shoulder 14133 to engage immediately upon axial loading, resulting in a direct and uniform transfer of force across the entire contact area from the onset of operation.

Another alternative design is to add the angled face to any of the other interfaces along the line of longitudinal force transmission. For instance, the front surface 14360 of the rear flow control system wear ring 14359 may be angled to attain similar advantages to those received from the angled flow control system wear ring shoulder 14133 face. This concept may also be applied to the interface between the front surface 14366 of the front flow control system wear ring 1410 and the fluid routing plug 14241. Additionally, these alternatives may be applied individually or in any combination with other embodiments, on one, two, or all interface surfaces.

Another variation includes applying a contoured profile to the face of the flow control system wear ring shoulder 14133. Instead of a purely flat or angled surface, the profile may be crowned, stepped, or include a combination of angled and straight segments. These non-uniform geometries can be tailored to control the progression and distribution of axial loads, further managing stress distribution and deformation patterns during operation. Such geometries, discussed here and elsewhere in this application, are disclosed in U.S. patent application Ser. No. 19/213,760, authored by Son et. al., the contents of which are incorporated herein by reference. Additionally, similar contoured profiles may be applied to the interface between the rear surface 14199 of the front flow control system wear ring 1410 and the front surface 14360 of rear flow control system wear ring 14359 or the interface between the fluid routing plug 14241 and the front surface 14366 of the front flow control system wear ring 1410. These contoured profiles may be used individually or in any combination with other embodiments, on one, two, or all interface surfaces.

Referring now to FIGS. 263-278, another embodiment of a fluid end section 1578 is shown. This embodiment, like embodiment 1478, implements a series of improvements directed specifically at reducing the high stress concentrations occurring at the transition radius 15142 at the base of the tapered bore 15140. These improvements include different embodiments of a two-piece flow control system wear ring assembly, selective application of press fits, and modified geometries of key mating features. Each improvement is intended to either reduce the magnitude of operational forces transmitted to the transition radius 15142, alter the direction or distribution of those forces, or isolate the transition radius 15142 from direct loading altogether. Also disclosed in this embodiment is a new embodiment of suction valve guide wear ring 15334

The fluid end section 1578 comprises a fluid end body 1503, a plunger system 1504, and a flow control system 15146. The fluid end body 1503 comprises a static section 1505, a dynamic section 1506, a radial static seal 15220, and an axial static seal 15333.

The static section 1505 comprises a front surface 1599, rear surface 1580, and flow bore 1579. The flow bore 1579 is centered transversely and vertically within the static section 1505. The flow bore 1579 is a through bore connecting the front and rear surfaces 1599, 1580 of the static section 1505 having a bore axis that is parallel to the longitudinal axis. The flow bore 1579 is configured to receive a portion of the flow control system 15146 and to facilitate the attachment of the dynamic section 1506 to the static section 1505. As shown in FIGS. 263-264, the flow bore 1579 comprises a dynamic thread 1581 proximate the rear surface 1580, a radial static seal groove 15225, and a static shoulder 15227. The static shoulder 15227 comprises an axial static seal groove 15264. The flow bore 1579 further comprises internal front retainer thread 15317 proximate the front surface 1599. The internal front retainer thread 15317 is configured to receive the front retainer 15315 as shown in FIG. 263.

The dynamic section 1506 comprises a dynamic body 1507, a front plunger system wear ring 1508, a plunger system wear ring seal 1509, a rear plunger system wear ring 15129, a front flow control system wear ring 1510, and rear flow control system wear ring 15359 as shown in FIG. 263.

The dynamic body 1507, shown in FIGS. 276-278, has a cylindrical shape. The dynamic body 1507 comprises opposing front 1519 and rear 1520 surfaces connected by an outer surface 1521 and a flow bore 1522. The outer surface 1521 and flow bore 1522 are concentric and their cylindrical axis is the longitudinal axis of the dynamic body 1507.

Referring now to FIG. 276, the outer surface 1521 of the dynamic body 1507 comprises multiple concentric sections. Beginning at the front surface 1519 of the dynamic body 1507 and continuing along the longitudinal axis to the rear surface 1520 the outer surface 1521 comprises a static seal section 1523, static threads 1524, shoulder 1559, and a rear section 15131. As with shoulder 1459, shoulder 1559 is not a locating shoulder.

The rear section 15131 comprises a plurality of spanner wrench holes 1527. The spanner wrench holes 1527 are radial blind bores with a bore axis that is perpendicular to the longitudinal axis of the dynamic body 1507. Each spanner wrench hole 1527 originates from the rear section 15131 of the outer surface 1521 but does not intersect the flow bore 1522. In this embodiment the spanner wrench holes 1527 are proximate the static threads 1524, aligned longitudinally, and evenly spaced circumferentially but may be spaced in any manner on the rear section 15131 as long as access for the spanner wrench (not shown) is available.

Referring now to FIG. 277, the flow bore 1522 also comprises multiple sections and is configured to receive the plunger system wear ring seal 1509, front plunger system wear ring 1508, rear plunger system wear ring 15129, front flow control system wear ring 1510, and rear flow control system wear ring 15359. The flow bore 1522 comprises a flow control system wear ring section 15132, a flow control system wear ring shoulder 15133, a flow control system section 15134, a plunger section 15135, a plunger system wear ring shoulder 15136 and a plunger system wear ring section 15137.

The flow control system wear ring section 15132 comprises a tapered bore 15140. The largest diameter of the tapered bore 15140 is at the front surface 1519 and the smallest diameter is at the flow control system wear ring shoulder 15133. The taper is complementary to the taper of the outer surface 15367 of the front flow control system wear ring 1510, as shown in FIG. 264. The flow control system wear ring section 15132 may further comprise a front chamfer 15141 to aid in the installation of the flow control system wear rings 1510 and 15359. The flow control system wear ring section 15132 may further comprise a transition radius 15142 at the base of the tapered bore 15140 to reduce stress in the transition between the tapered bore 15140 and the flow control system wear ring shoulder 15133, as shown in FIG. 278.

The flow control system wear ring shoulder 15133 is formed by the reduction in diameter of the flow bore 1522 between the flow control system wear ring section 15132 and the flow control system section 15134. The flow control system wear ring shoulder 15133 is perpendicular to the bore axis of the flow bore 1522.

The rear flow control system wear ring 15359, shown in FIGS. 271-275, has an annular shape, with a front 15360 and rear surface 15361 connected by an outer 15362 and inner 15363 surface. The front surface 15360 is angled slightly relative to a plane that is perpendicular to the longitudinal axis, sloping rearward, toward rear surface 15361 of the rear flow control system wear ring 15359. As shown in FIG. 275, the angle 15377 of the front surface 15360 may be between greater than 0 degrees to 2 degrees from perpendicular, or from less than 90.0 degrees to 88.0 degrees relative to the longitudinal axis. The rear surface 15361 is perpendicular to the longitudinal axis of the rear flow control system wear ring 15359. The inner surface 15363 comprises three sections, a straight section 15378, a curved section 15379, and a tapered section 15380. The profile of the inner surface 15363 is generally complementary to the outer surface of the suction valve guide 15243 and suction valve guide wear ring 15334 as shown in FIG. 265. The outer surface 15362 is tapered. The taper is complementary to the taper of the tapered bore 15140 of the flow control system wear ring section 15132 of the flow bore 1522 of the dynamic body 1507, as shown in FIGS. 264-265. The rear flow control system wear ring 15359 further comprises a radius 15364. The radius 15364 is located at the intersection of the rear surface 15361 and outer surface 15362. The radius 15364 is complementary to or slightly larger than the transition radius 15142 at the base of the tapered bore 15140. The rear flow control system wear ring 15359 may further comprise a radius 15381 at the intersection of the rear surface 15361 and inner surface 15363 and small chamfers (not shown) at the intersections of the remaining surfaces. These features facilitate safer handling and durability.

The front flow control system wear ring 1510, shown in FIGS. 266-270, has an annular shape, with a front 15366 and rear surface 15199 connected by an outer 15367 and inner 15368 surface. The front 15366 and rear 15199 surfaces are parallel to each other and perpendicular to the longitudinal axis of the front flow control system wear ring 1510. The inner surface 15368 is parallel to the longitudinal axis of the front flow control system wear ring 1510. The outer surface 15367 is tapered. The taper is complementary to the taper of the tapered bore 15140 of the flow control system wear ring section 15132 of the flow bore 1522 of the dynamic body 1507, as shown in FIG. 264.

The front flow control system wear ring 1510 further comprises an insertion relief 15369 formed at the intersection of the front surface 15366 and inner surface 15368 comprising a first radius 15370, a straight section 15371, and a second radius 15372. The first radius 15370 transitions from the front surface 15366 to the straight section 15371. The straight section 15371 may form an angle 15398 relative to the longitudinal axis with the end farthest from the longitudinal axis connecting tangentially to the first radius 15370 and the end closest to the longitudinal axis connected tangentially to the second radius 15372. The angle 15398 may be 15-25 degrees as shown in FIG. 270. The second radius 15372 transitions from the straight section 15371 to the inner surface 15368.

The front flow control system wear ring 1510 further comprises a third radius 15373 at the transition between the front surface 15366 and the outer surface 15367. The third radius 15373 is tangential to both surfaces 15366 and 15367.

The front flow control system wear ring 1510 further comprises a plurality of chamfers. A first chamfer 15374 transitions from the outer surface 15367 to the rear surface 15199 and a second chamfer 15375 transitions from the rear surface 15199 to the inner surface 15368.

The flow control system 15146 comprises a front fluid routing plug seal 15230, fluid routing plug 15241, suction valve 15242, suction valve guide 15243, suction valve guide insert 15244, suction valve spring 15306, rear fluid routing plug seal 15308, front retainer 15315, and suction valve guide wear ring 15334.

The suction valve guide 15243 comprises front and rear surfaces, 15382 and 15383, and a skirt. The front and rear surfaces, 15382 and 15383, are parallel and perpendicular to the longitudinal axis of the suction valve guide 15243. The skirt 15384 comprises a tapered section 15385 and a straight section 15386. The tapered section 15385 is proximate the front surface 15382, tapered relative to the longitudinal axis of the suction valve guide 15243, and generally complementary to the tapered section 15380 of the inner surface 15363 of the rear flow control system wear ring 15359. The straight section 15386 is proximate the rear surface 15383 and parallel to the longitudinal axis of the suction valve guide 15243, and terminates in a front-facing skirt surface.

As shown in FIGS. 264 and 265, the suction valve guide wear ring 15334 comprises an outer ring 15387 and an inner ring 15388. The outer ring 15387 is a straight-walled, right circular cylinder with front and rear surfaces, 15389 and 15390, and inner and outer cylindrical surfaces, 15391 and 15392. The diameter of the outer surface 15392 is approximately equal to the outer diameter of the straight section 15386 of the skirt 15384 of the suction valve guide 15243. The inner diameter of the outer ring 15387 is larger than the inner diameter of the straight section 15386 of the skirt 15384. The outer ring 15387 may extend longitudinally from the suction valve guide 15243 to, or nearly to, the fluid routing plug 15241. The outer ring 15387 is preferably formed of a corrosion-resistant material that is structurally capable of resisting the longitudinal movement of the suction valve guide 15243 during operation and can bond to urethane, such as 316 stainless steel. The outer ring 15387 may further comprise a plurality of small chamfers 15393 at the intersection of any two adjacent surfaces to facilitate assembly, disassembly, safe handling, or other operational characteristics.

The inner ring 15388 is also a straight-walled, right circular cylinder with front and rear surfaces, 15394 and 15395, and inner and outer cylindrical surfaces, 15396 and 15397. The outer surface 15397 is congruent to the inner surface 15391 of the outer ring 15387. The diameter of the inner surface 15396 is smaller than the inner diameter of the straight section 15386 of the skirt 15384 of the suction valve guide 15243. The inner ring 15388 may be the same length as the outer ring 15387. However, to avoid contact with the fluid routing plug 15241, as shown in FIG. 265, the length may be shorter than that of the outer ring 15387 and the inner ring 15388 may be bonded such that the rear surfaces, 15390 and 15395, of both rings 15387 and 15388 are aligned longitudinally. The inner ring 15388 is preferably formed of a soft, sacrificial material that may be bonded or otherwise secured to the outer ring 15387, such as a urethane.

In this embodiment, the outer and inner rings 15387 and 15388 are permanently bonded such that the suction valve guide wear ring 15334 may be considered a single component. During maintenance, the operator replaces the entire suction valve guide wear ring 15334. In alternative embodiments the inner ring 15388 may be separable from the outer ring 15387, allowing for replacement of only the worn component as needed.

Referring now to FIGS. 263-265, the assembly of the fluid end section 1578 begins with the assembly of the dynamic section 1506. The dynamic section 1506 is assembled by first, inserting the rear flow control system wear ring 15359, rear surface 15361 first, into the tapered bore 15140 until the rear surface 15361 of the rear flow control system wear ring 15359 contacts the flow control system wear ring shoulder 15133. This may be a line-to-line to a light press fit, that is an interference fit of 0.000 to 0.002 inches diametrically. Second, the front flow control system wear ring 1510 is inserted, rear surface 15199 first, into the tapered bore 15140 of the flow control system wear ring section 15132 of the flow bore 1522 of the dynamic body 1507 until the rear surface 15199 of the front flow control system wear ring 1510 contacts the front surface 15360 of the rear flow control system wear ring 15359. This may be a heavy press fit, that is an interference fit of 0.008 to 0.010 inches diametrically. Third, the plunger system wear ring seal 1509, front plunger system wear ring 1508, and rear plunger system wear ring 15129 are installed in the plunger system wear ring section 15137 of the flow bore 1522 completing the assembly of the dynamic section 1506.

Prior to attaching the dynamic section 1506 to the static section 1505 the radial static seal 15220 is installed in the radial static seal groove 15225 of the flow bore 1579 of the static section 1505 and the axial static seal 15333 is installed in the axial static seal groove 15264 of the static shoulder 15227 of the flow bore 1579.

The dynamic section 1506 is then attached to the static section 1505 by threading the static threads 1524 of the outer surface 1521 of the dynamic body 1507 into the dynamic threads 1581 of the static section 1505 until the front surface 1519 of the dynamic body 1507 abuts the static shoulder 15227 of the flow bore 1579 of the static section 1505, as shown in FIGS. 263-264. A spanner wrench (not shown) may be used to apply the required torque using the spanner wrench holes 1527 in the rear section 15131 of the outer surface 1521 of the dynamic body 1507.

The components of the flow control system 15146 may now be installed into the flow bore 1579 of the static section 1505 and flow bore 1522 of the assembled dynamic body 1507. First, with the suction valve guide insert 15244 already installed in the suction valve guide 15243, the suction valve guide 15243 is installed in the flow bore 1522. Second, the suction valve guide wear ring 15334. Third, the suction valve spring 15306. Fourth, the suction valve 15242. Fifth, after the front and rear fluid routing plug seals 15230 and 15308 are installed onto the fluid routing plug 15241, the fluid routing plug 15241 is inserted into the front flow control system wear ring 1510. The insertion relief 15369 facilitates the insertion process and reduces the risk of damaging the rear fluid routing plug seal 15308. The remaining components of the flow control system 15146 are then inserted, and installation of the flow control system 15146 is completed by threading the front retainer 15315 into the internal front retainer thread 15317 of the flow bore 1579.

Finally, the plunger system 1504 is assembled to the dynamic section 1506 completing the assembly of the fluid end section 1578. As described in earlier embodiment 400, and shown in FIGS. 54 and 55, a plurality of fluid end sections 1578 may be assembled to form a fluid end which may then be connected to a power end to form a high-pressure pump.

In operation, the extremely high pressures created within a fluid end assembled from a plurality of these fluid end sections 1578 creates a corresponding large force on the fluid routing plug 15241. While the force is primarily along the longitudinal axis there are also radial components to the force. This force is transferred to the front flow control system wear ring 1510, rear flow control system wear ring 15359, tapered bore 15140, transition radius 15142, flow control system wear ring shoulder 15133 and finally the threaded joint formed between the dynamic threads 1581 and static threads 1524. Of these, the transition radius 15142 experiences the highest stress concentration and is the most likely point of failure.

This embodiment 1578 incorporates multiple improvements intended to eliminate the transition radius 15142 as the most likely point of failure. These improvements either reduce the magnitude of the force applied at the transition radius 15142, whether in whole or in one or more directional components, such as radial or longitudinal, or by enhancing the ability of the transition radius 15142 to withstand the applied force.

One improvement is the implementation of a two-piece wear ring assembly comprising a front flow control system wear ring 1510 and a rear flow control system wear ring 15359. The front flow control system wear ring 1510 is installed into the tapered bore 15140 using a heavy press fit, typically a diametrical interference of 0.008 to 0.010 inches. This press fit ensures the front flow control system wear ring 1510 remains securely seated during operation and generates substantial compressive residual hoop stresses in the surrounding material of the dynamic body 1507. Because the front flow control system wear ring 1510 is not inserted fully into the tapered bore 15140, the stresses associated with the heavy press fit are not transferred, or only minimally transferred, to the transition radius 15142.

A complementary improvement is the light press fit of the rear flow control system wear ring 15359, typically with a diametical interference of 0.000 to 0.002 inches. This fit provides sufficient axial retention while avoiding the introduction of substantial residual stresses in the transition radius 15142.

Another improvement is the depth of the tapered bore 15140. Increasing the depth of the tapered bore 15140 as compared to previous embodiments also increases the longitudinal distance of the transition radius 15142 from detrimental bending stresses that are generated by forces applied at, or close to, the front surface 1519 of the dynamic body 1507.

Another improvement is the radius 15364 on the rear flow control system wear ring 15359. This radius 15364 is designed to be complementary to, or slightly larger than, the transition radius 15142 at the base of the tapered bore 15140. The resulting conformal interface ensures continuous surface contact rather than point contact, distributing applied loads more evenly, increasing the load bearing area, reducing stress risers, and lowering the risk of localized yielding or cracking. This geometry improves the smoothness of the load path and enhances the load-carrying capacity of the transition interface.

An additional improvement is the angled front surface 15360 of the rear flow control system wear ring 15359. The front surface 15360 is formed such that an initial axial force is applied at a location radially spaced from the transition radius 15142, specifically, adjacent the inner diameter of the rear flow control system wear ring 15359. As axial load increases during operation, localized elastic or plastic deformation of the angled front surface 15360 occurs, allowing the load to gradually distribute across a broader portion of the front surface 15360 radially towards the outer surface 15362 of the rear flow control system wear ring 15359. This progressive engagement delays direct force transfer near the transition radius 15142 and promotes a more uniform load path, reducing peak stresses at the transition radius 15142 and improving the fatigue resistance.

Collectively, these improvements in fluid end section 1578 significantly reduce the peak stresses experienced at the transition radius 15142 during operation. The combination of controlled press fits, conformal interfaces, and modified geometries results in a more robust and durable fluid end assembly. Variations and alternative embodiments of these features are discussed in the following sections.

There are a number of alternative configurations that may be implemented either instead of, or in addition to, the specific improvements already described. These alternatives are the same as those listed for embodiment 1478. In fact, two of those alternative configurations are used on this embodiment 1578, namely the use of a perpendicular face on the flow control system wear ring shoulder 15133 and the use of an angled front surface 15360 on the rear flow control system wear ring 15359. The remaining alternative embodiments listed for embodiments 1478 may be applied to this embodiment 1578 with the appropriate substitution of the prefix 15 for the prefix 14 for each component reference number.

Also during operation, fluid flow will directly impinge on the inner surface 15396 of the inner ring 15388 of the suction valve guide wear ring 15334 during the suction stroke and flow parallel to the inner surface 15396 during the pressure stroke. Another improvement of this embodiment 1578 is the reduction in erosion due to the presence of the sacrificial inner ring 15388. Another improvement is the ability to independently replace the suction valve guide wear ring 15334.

Another improvement is the support for the inner ring 15388 supplied by the suction valve guide 15243 due to the joint between the inner and outer rings 15388 and 15387 being radially aligned within the front surface 15382 of the suction valve guide 15243. This helps protect the inner ring 15388 from shear forces that might cause a premature failure of the bond between the inner and outer rings 15388 and 15387.

An alternative embodiment of the suction valve guide wear ring 15334 may include non-bonded inner and outer rings 15388 and 15387 such that the inner or outer ring 15388 or 15387 may be replaced as needed. Another alternative embodiment may include multiple inner rings 15388 of varying hardness and/or different materials, bonded or non-bonded, to the outer ring 15387.

While the improvements disclosed herein are described in detail as being used with or applied to multi-piece fluid ends or fluid end sections, it is expected that one skilled in the art will recognize that these improvements can readily be adapted for use with either style of fluid end. Moreover, it is contemplated that the disclosed improvements are applicable to prior art fluid ends of any design or configuration.

The various features and alternative details of construction of the apparatuses described herein for the practice of the present technology will readily occur to the skilled artisan in view of the foregoing discussion, and it is to be understood that even though numerous characteristics and advantages of various embodiments of the present technology have been set forth in the foregoing description, together with details of the structure and function of various embodiments of the technology, this detailed description is illustrative only, and changes may be made in detail, especially in matters of structure and arrangements of parts within the principles of the present technology to the full extent indicated by the broad general meaning of the terms in which the appended claims are expressed.

The invention claimed is:

1. A high-pressure pump having a body, the body comprising first and second sections, wherein:

the first section has an internal bore and a set of external threads, the external threads circumscribing the internal bore; and the second section has an internal bore and a set of internal threads, the internal threads circumscribing the internal bore;

wherein the external threads of the first section are configured to mate with the internal threads of the second section such that the internal bore of the first section and internal bore of the second section are aligned to form a longitudinal through-bore, the high-pressure pump comprising:

a fluid routing plug disposed within the longitudinal through-bore, the fluid routing plug extending from a first side to a second side; and a two-piece wear ring disposed between the fluid routing plug and the first section;

in which the two-piece wear ring comprises a first ring and a second ring, wherein:

the first ring has a first surface, a second surface, an inner surface and an outer surface, the first surface interconnecting the inner surface and the outer surface and abutting the fluid routing plug; and the second ring has a first surface, a second surface, an inner surface and an outer surface, the first surface of the second ring abutting the second surface of the first ring.

2. The high-pressure pump of claim 1 in which the fluid routing plug defines a circumferential groove and further comprising a seal disposed in the circumferential groove, wherein the inner surface of the first ring abuts the seal.

3. The high-pressure pump of claim 1 in which the second ring defines a first transition radius portion interconnecting the second surface of the second ring and the outer surface of the second ring.

4. The high-pressure pump of claim 3 in which the first section is defined by a first section radiused surface, wherein the first section radiused surface is complementary to and opposed to the first transition radius portion of the second ring.

5. The high-pressure pump of claim 4 in which the first section radiused surface contacts the first transition radius portion of the second ring.

6. The high-pressure pump of claim 4 in which the second ring contacts the first section at its second surface and its outer surface, but not at the first transition radius portion.

7. The high-pressure pump of claim 1 further comprising:

a first valve disposed in the internal bore of the first section; and a valve guide disposed in the internal bore of the first section, the valve guide being seated against the internal bore, such that the first valve is defined by a range of travel, wherein:

at a first limit of the range of travel, the first valve is seated against the second side of the fluid routing plug; and at a second limit of the range of travel, movement of the first valve is restricted by the valve guide.

8. The high-pressure pump of claim 7 further comprising:

a plunger configured to reciprocate within the internal bore of the first section, in which reciprocation of the plunger moves the first valve between the first limit of the range of travel and the second limit of the range of travel.

9. The high-pressure pump of claim 7 further comprising:

a second valve disposed in the internal bore of the second section, in which the second valve has a range of travel defining a first limit, in which the second valve abuts the first side of the fluid routing plug.

10. The high-pressure pump of claim 9 further comprising:

a plunger configured to reciprocate within the internal bore of the first section, in which reciprocation of the plunger in a first direction moves the first valve to its second limit of the range of travel and the second valve to its first limit of the range of travel, and wherein reciprocation of the plunger in a second direction moves the first valve to its first limit of the range of travel and the second valve away from the fluid routing plug, in which the first direction and the second direction are opposing.

11. The high-pressure pump of claim 7 in which the inner surface of the second ring is complementary to an outer surface of the valve guide.

12. The high-pressure pump of claim 11 in which the inner surface of the second ring comprises:

a straight surface, in which the inner surface is parallel to a longitudinal axis of the internal bore of the first section;

a tapered surface, complementary to a tapered portion of the internal bore; and a curved surface disposed between the straight surface and the tapered surface.

13. A high-pressure pump having a body, the body comprising first and second sections, wherein:

the first section has an internal bore and a set of external threads, the external threads circumscribing the internal bore;

the second section has an internal bore and a set of internal threads, the internal threads circumscribing the internal bore;

wherein the external threads of the first section are configured to mate with the internal threads of the second section such that the internal bore of the first section and internal bore of the second section are aligned to form a longitudinal through-bore, the high-pressure pump comprising:

a fluid routing plug disposed within the longitudinal through-bore, the fluid routing plug extending from a first side to a second side; and a two-piece wear ring disposed between the fluid routing plug and the first section;

and further comprising:

a first valve disposed in the internal bore of the first section; and a valve guide disposed in the internal bore of the first section, the valve guide being seated against the internal bore, such that the first valve is defined by a range of travel, wherein:

at a first limit of the range of travel, the first valve is seated against the second side of the fluid routing plug; and at a second limit of the range of travel, movement of the first valve is restricted by the valve guide.

14. The high-pressure pump of claim 13 in which the valve guide comprises:

a first surface;

a spring extending from the first surface, wherein the spring is configured to bias the first valve toward the second side of the fluid routing plug; and a skirt disposed against a tapered surface of the internal bore of the first section, the skirt defining a front-facing skirt surface, in which the front-facing skirt surface is disposed at an end of the skirt and faces the second surface of the fluid routing plug.

15. The high-pressure pump of claim 14 in which the front-facing skirt surface contacts the fluid routing plug.

16. The high-pressure pump of claim 14 further comprising:

a cylindrical ring disposed between the second surface of the fluid routing plug and the front-facing surface of the skirt.

17. The high-pressure pump of claim 16 further comprising an inner ring disposed within the cylindrical ring, the inner ring made of a different material than the cylindrical ring.

18. The high-pressure pump of claim 17 in which the inner ring is made of a urethane material.

19. The high-pressure pump of claim 17 in which the cylindrical ring is made of a stainless steel material.

20. The high-pressure pump of claim 17 in which the skirt is made of a different material than the cylindrical ring or the inner ring.

21. The high-pressure pump of claim 20 in which the cylindrical ring is made of a stainless steel material and the inner ring is made of a urethane material.

22. The high-pressure pump of claim 21 in which the two-piece wear ring comprises a first ring and a second ring, wherein:

the first ring has a first surface, a second surface, an inner surface and an outer surface, the first surface interconnecting the inner surface and the outer surface and abutting the fluid routing plug; and the second ring has a first surface, a second surface, an inner surface and an outer surface, the first surface of the second ring abutting the second surface of the first ring.

23. The high-pressure pump of claim 22 in which the inner surface of the second ring is complementary to an outer surface of the skirt.

* * * * *